United States Patent [19]

Gubelmann, deceased et al.

[11] 4,273,455

[45] Jun. 16, 1981

[54] COMBINED FORWARD AND REVERSE PROPORTIONAL SPACING MECHANISM

[75] Inventors: W. S. Gubelmann, deceased, late of Convent, N.J.; by Walter S. Gubelmann, executor, Palm Beach, Fla.; William R. Grier, New Vernon, N.J.

[73] Assignee: Realty and Industrial Corporation, Morristown, N.J.

[21] Appl. No.: 945,802

[22] Filed: Sep. 25, 1978

Related U.S. Application Data

[62] Division of Ser. No. 732,973, Oct. 15, 1976, which is a division of Ser. No. 213,045, Dec. 28, 1971, Pat. No. 3,993,179.

[51] Int. Cl.[3] ..... B41J 19/62

[52] U.S. Cl. ..... 400/309; 400/260; 400/306.2; 400/310; 400/311

[58] Field of Search ..... 400/4, 260, 303, 306.1, 400/306.2, 309, 310, 311

[56] References Cited

U.S. PATENT DOCUMENTS

| | | | |
|---|---|---|---|
| 416,743 | 12/1889 | Redfield | 400/306.2 X |
| 448,587 | 3/1891 | Redfield | 400/306.2 X |
| 2,700,447 | 1/1955 | Blodgett | 400/4 |
| 2,848,091 | 8/1958 | Smathers | 400/306.2 |
| 2,904,159 | 9/1959 | Smathers | 400/306.2 |
| 2,946,421 | 7/1960 | Intagliata et al. | 400/260 X |
| 2,965,212 | 12/1960 | Toggenburger | 400/306.1 X |
| 3,096,865 | 7/1963 | Smathers | 400/306.2 |

OTHER PUBLICATIONS

IBM Technical Disclosure Bulletin, "Integrated Forward and Backspace Mechanism," Miles et al., vol. 12, No. 12, May 1970, pp. 2189–2191.

*Primary Examiner*—Ernest T. Wright, Jr.
*Attorney, Agent, or Firm*—Burgess, Ryan and Wayne

[57] ABSTRACT

A mechanism which provides bi-directional movement of the carrier of an electric typewriter incorporating proportional spacing. A ratchet arrangement is operable in both directions to provide the desired proportional spacing increments, with rotation of a ratchet wheel in the clockwise direction being controlled by engagement of an associated pawl with one of a plurality of stop engaging surfaces of a control member which sets the number of proportional spacing increments desired. For rotation of the ratchet wheel in the counterclockwise direction, a solenoid is coupled to the control member to momentarily rotate it clockwise until a stop engaging surface thereof abuts a selected stop surface corresponding to the number of proportional spacing increments desired, and causing the pawl associated with the ratchet wheel to move clockwise by a corresponding number of ratchet teeth—after which the solenoid is released, permitting a cocked spring to return the control member to its initial position and cause the pawl to rotate the ratchet wheel counterclockwise by a corresponding number of proportional spacing increments.

4 Claims, 188 Drawing Figures

FIG. 6
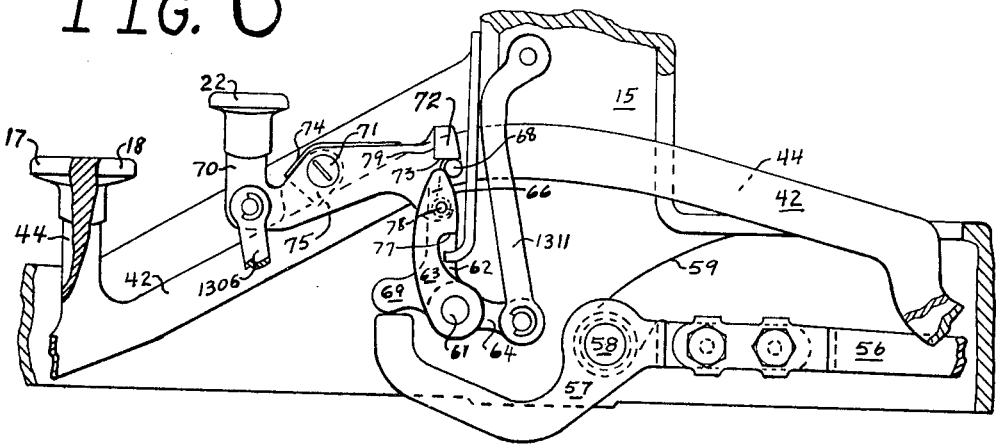
FIG. 7
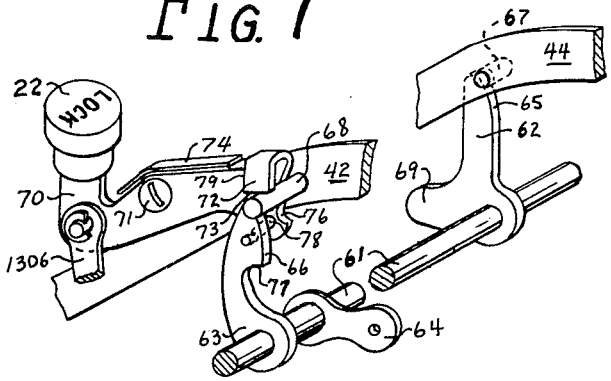
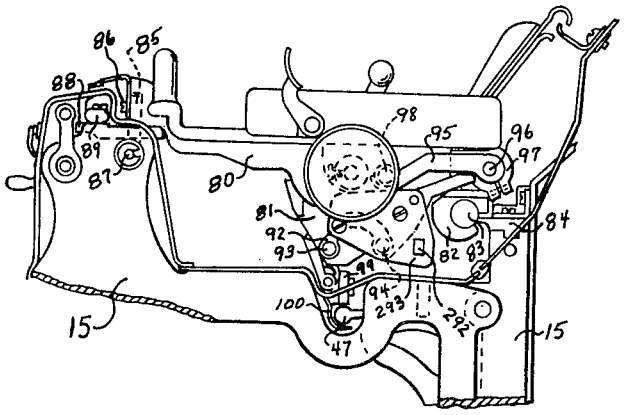
FIG 8

19
23
127
130
131
128
129
114
117
116
118
122
138
172
3224
170
171
174
175
176
177
178
179
200
1293
183
184
185
186
187
188
189
190
191
192
193
194
195
196
197
1288
1287
3154
3181
3140
3175
3177
3172
3160
3171
3158
182
181
180
198
199
137
1271
130
1269
1268
1267
1151
1152
1153
1154
1155
1156
1157
1158
1159
1160
1161
1162
1163
1164
1165
1166
1167
1168
1169
1170
693
S
N
O

FIG. 61.
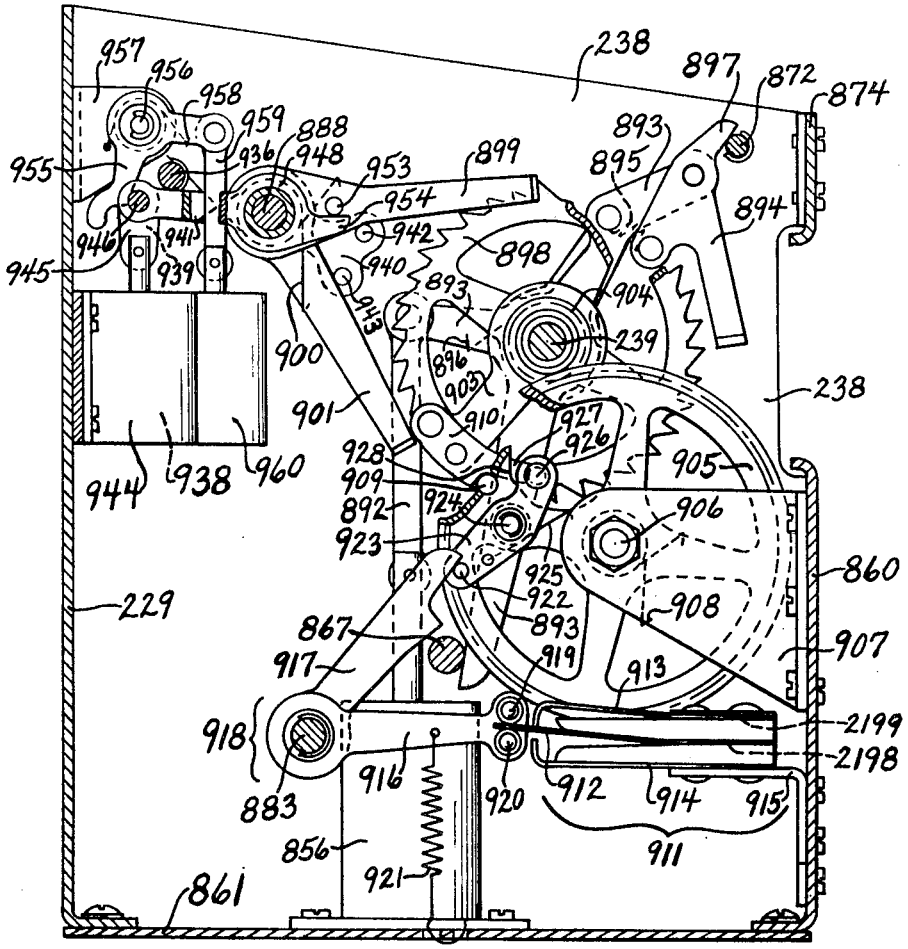
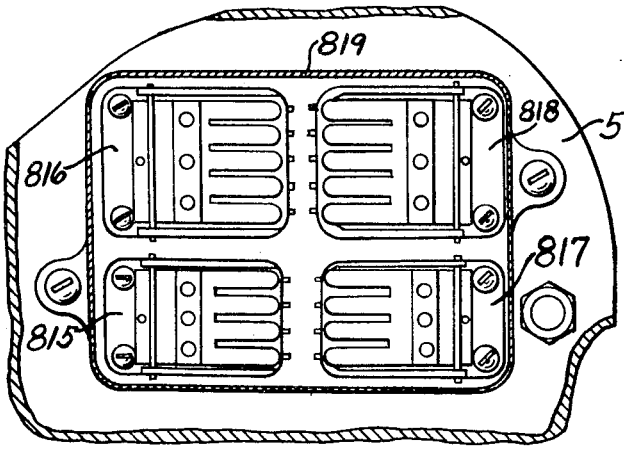
FIG. 60.

FIG. 64.
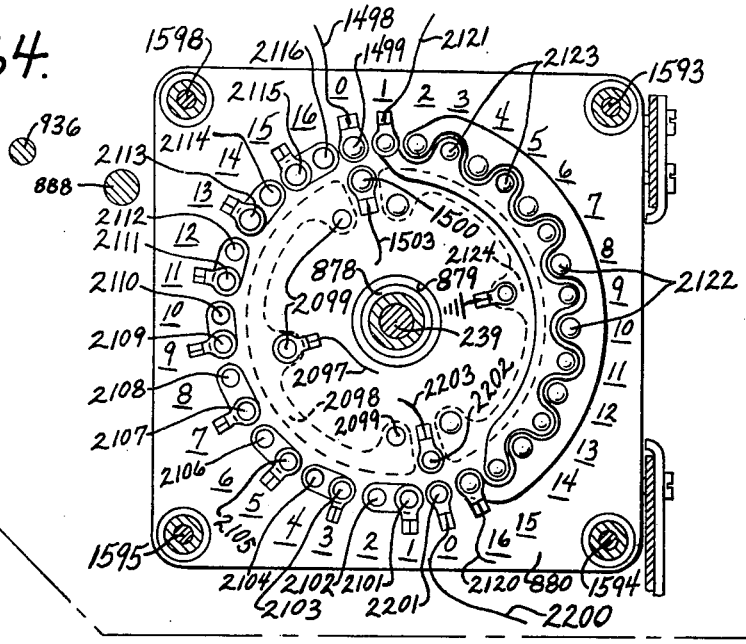
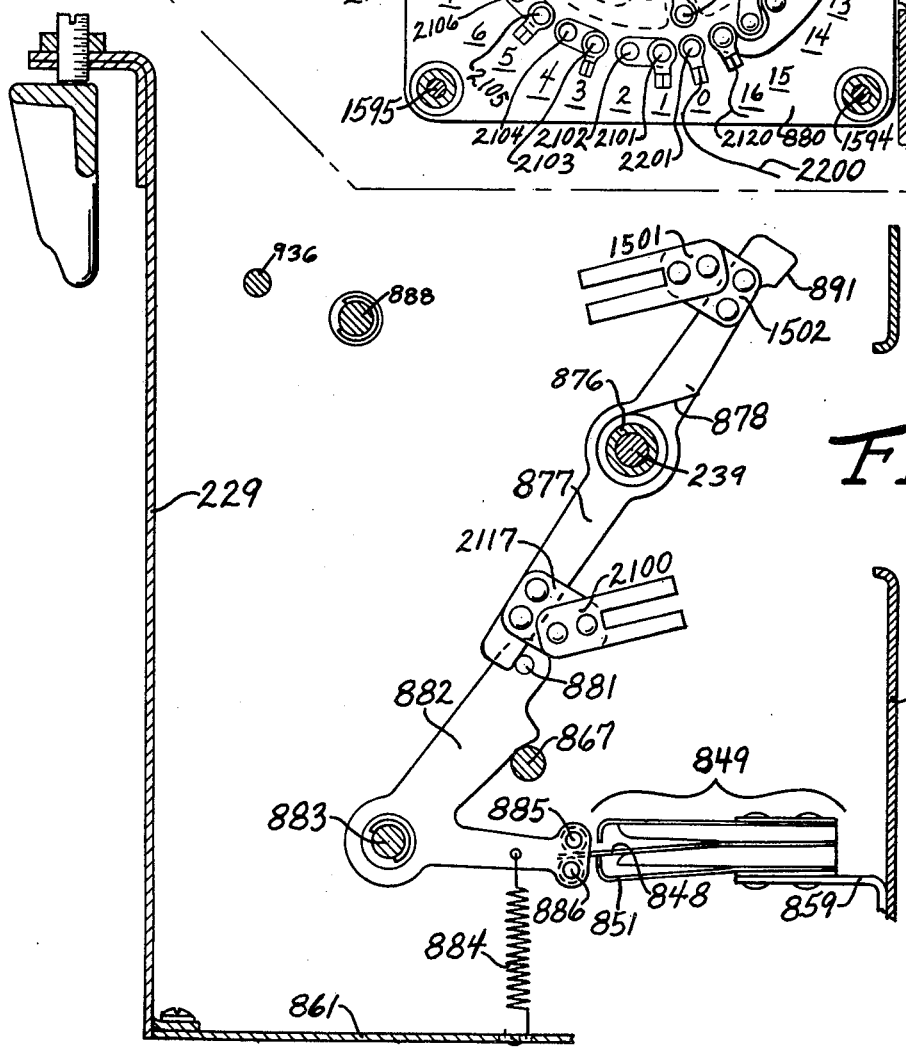
FIG. 63.

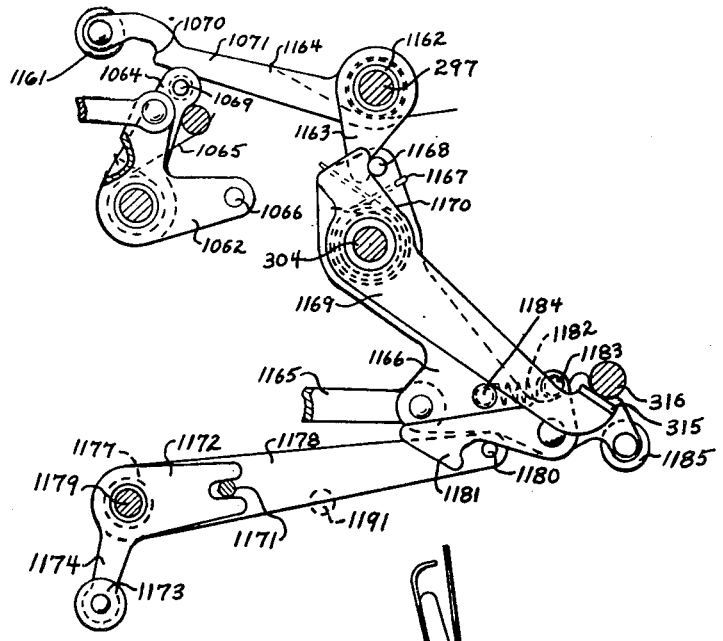
Fig. 76
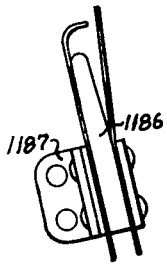
Fig. 77
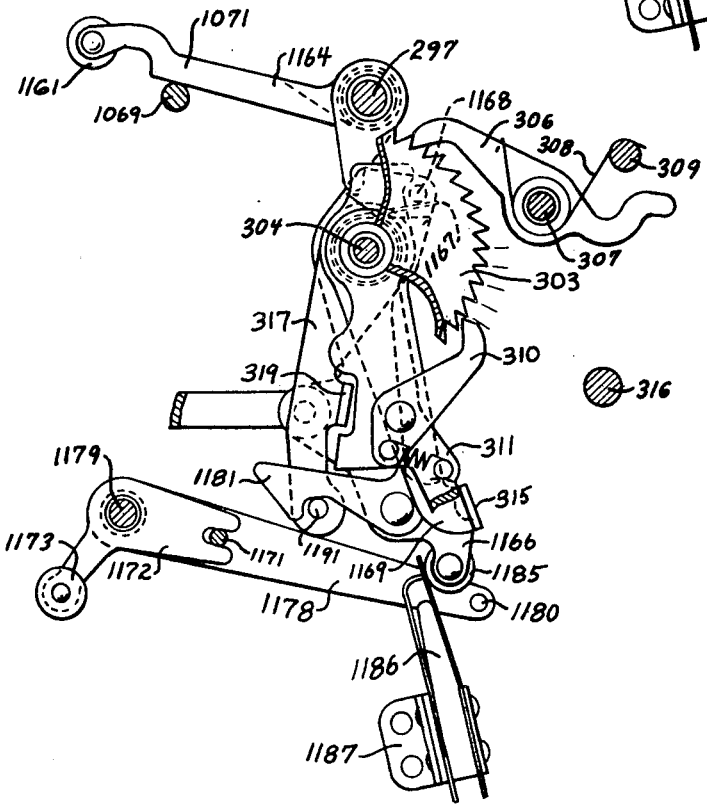

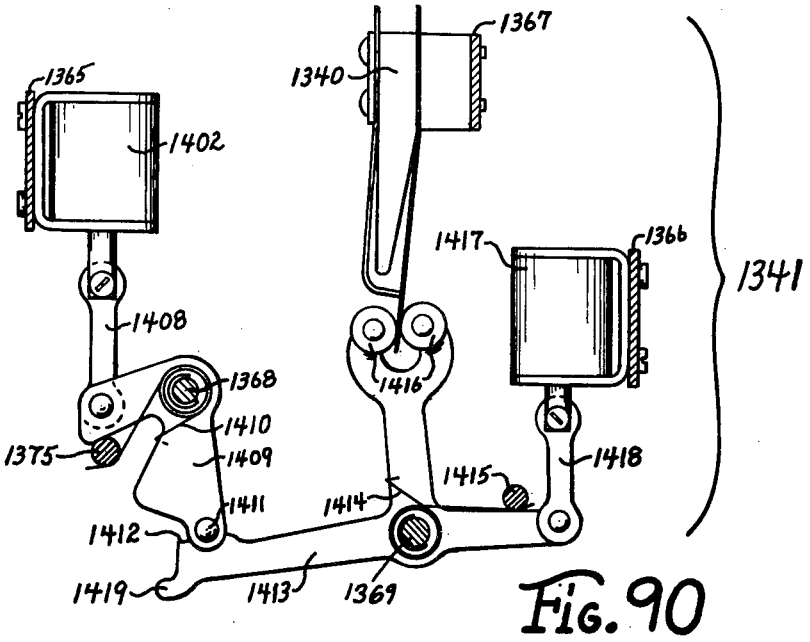
FIG. 90
FIG. 89
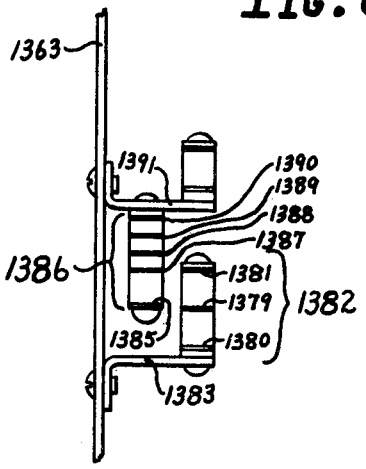

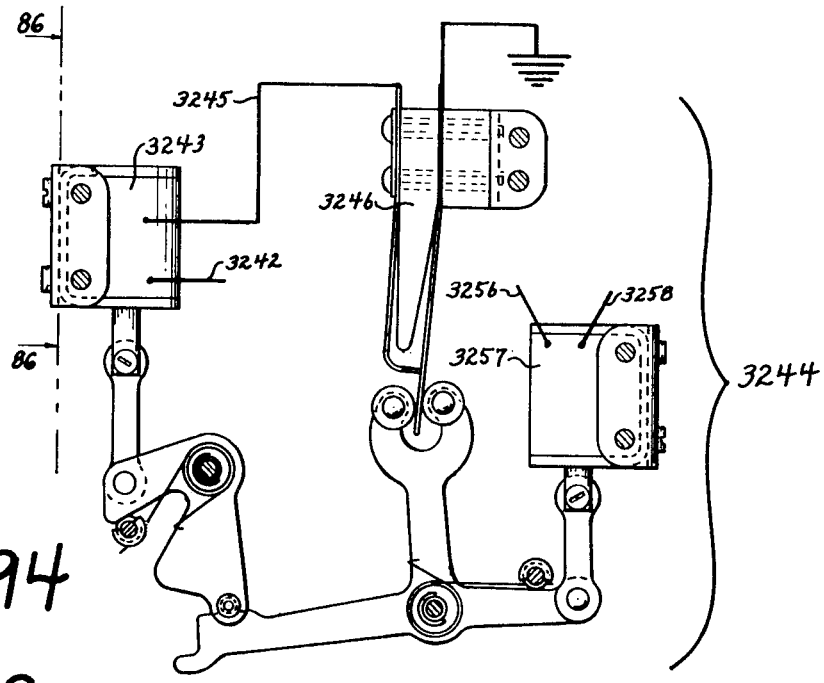
FIG. 94
FIG. 93
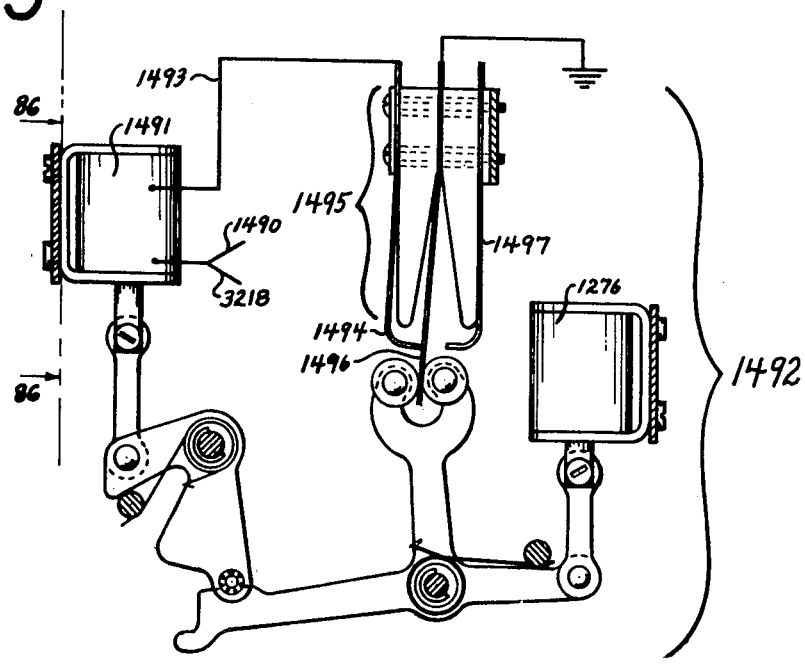

FIG. 95
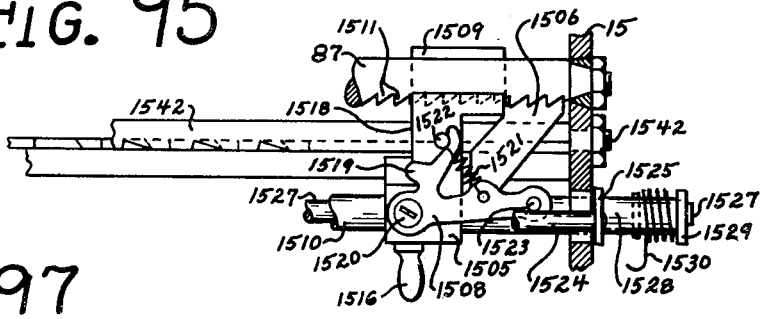
FIG. 97
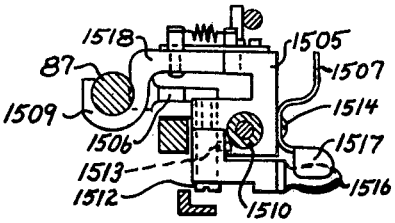
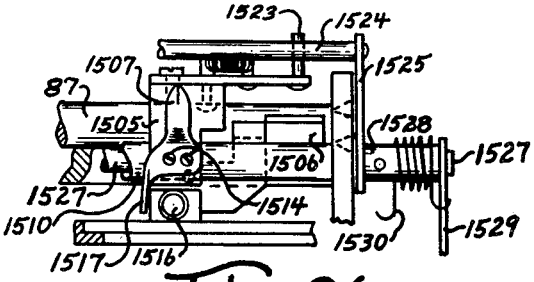
FIG. 96
FIG. 98
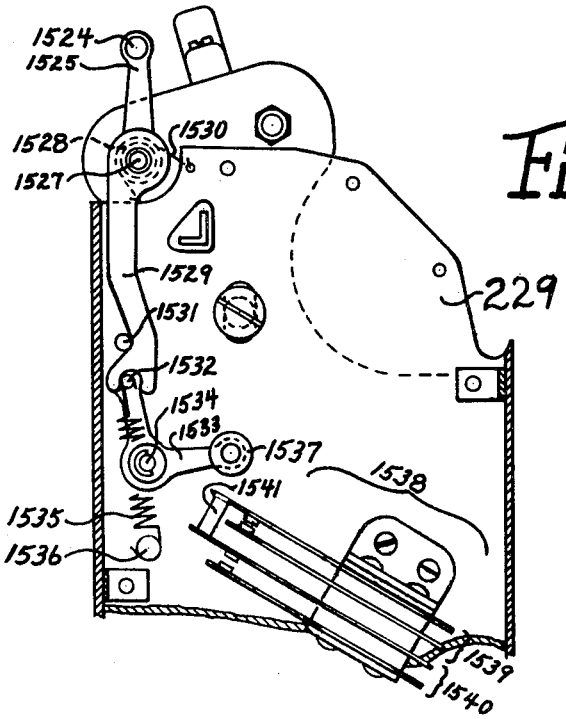

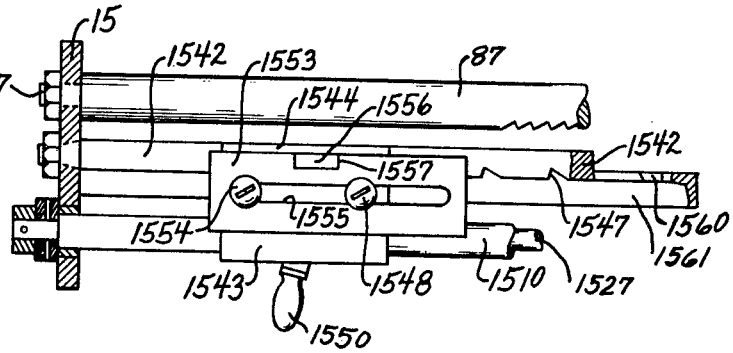
FIG. 100.
FIG. 99.
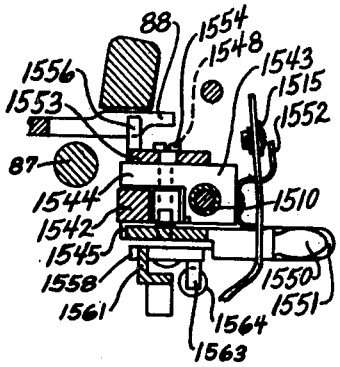
FIG. 101.
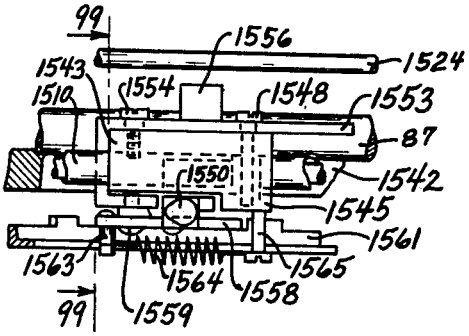
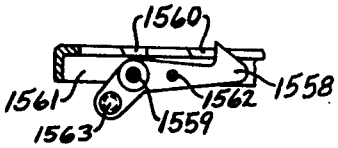
FIG. 103.
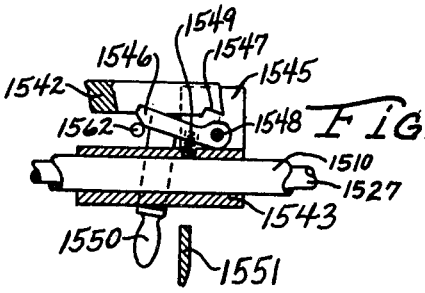
FIG. 102.

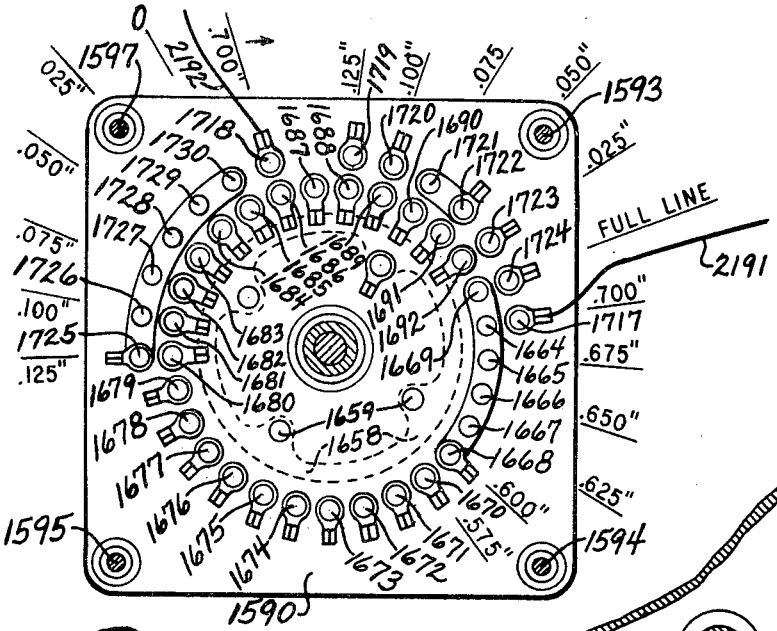
FIG. 108.
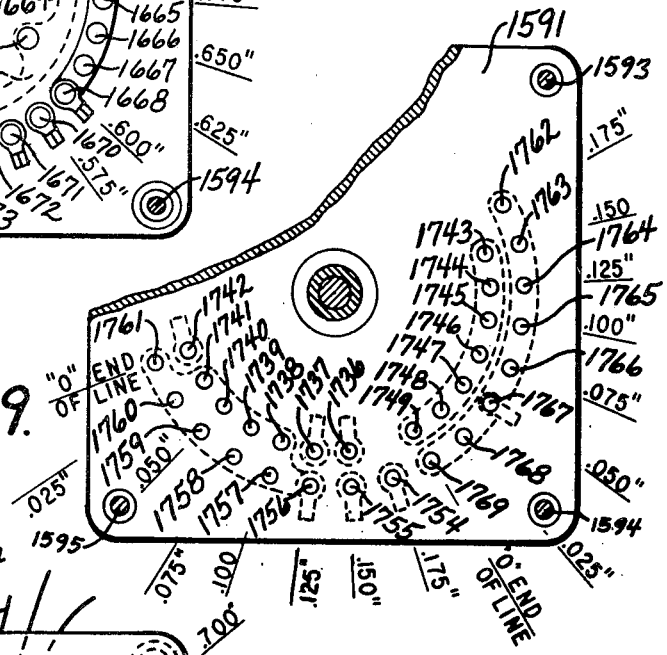
FIG. 109.
FIG. 110.
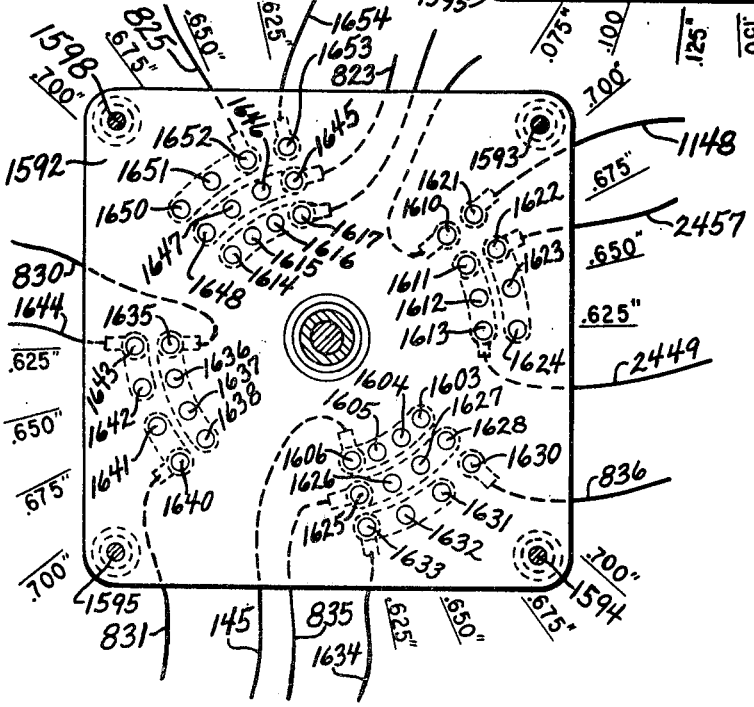

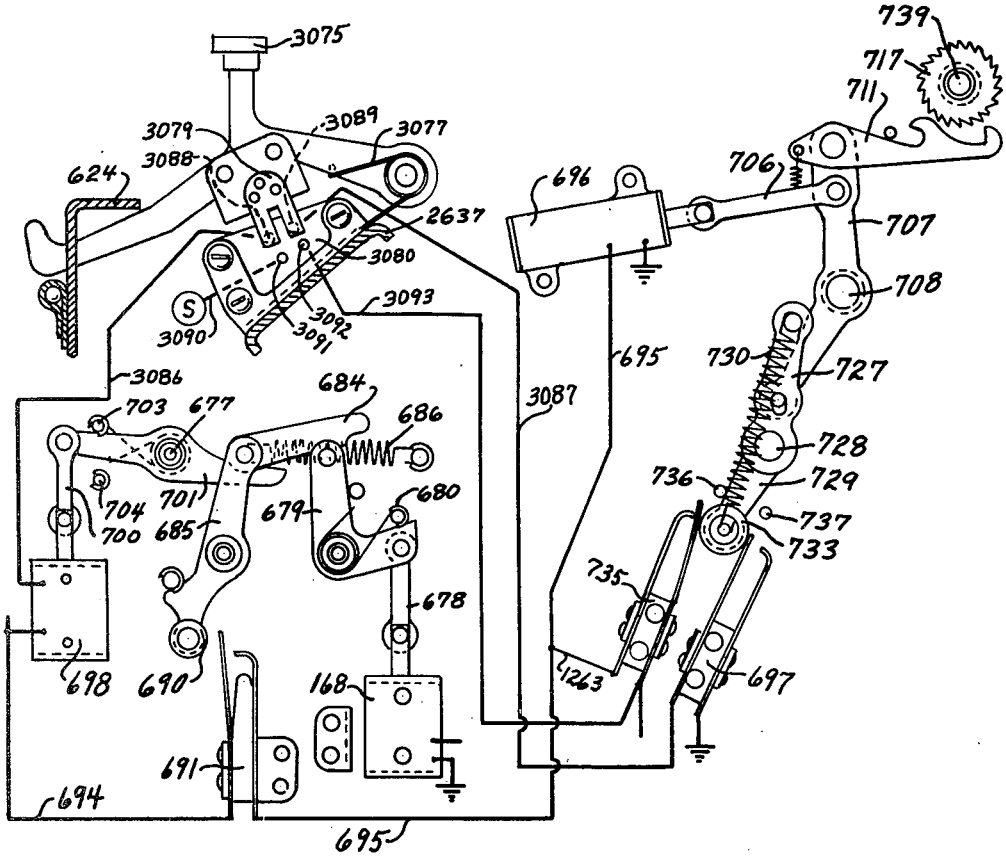
Fig. 177
Fig. 178
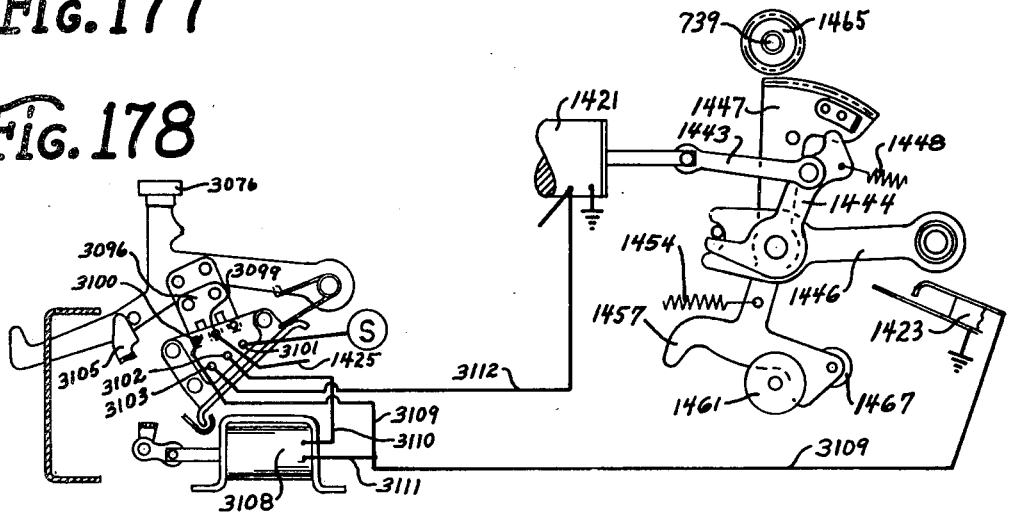

FIG. 183.
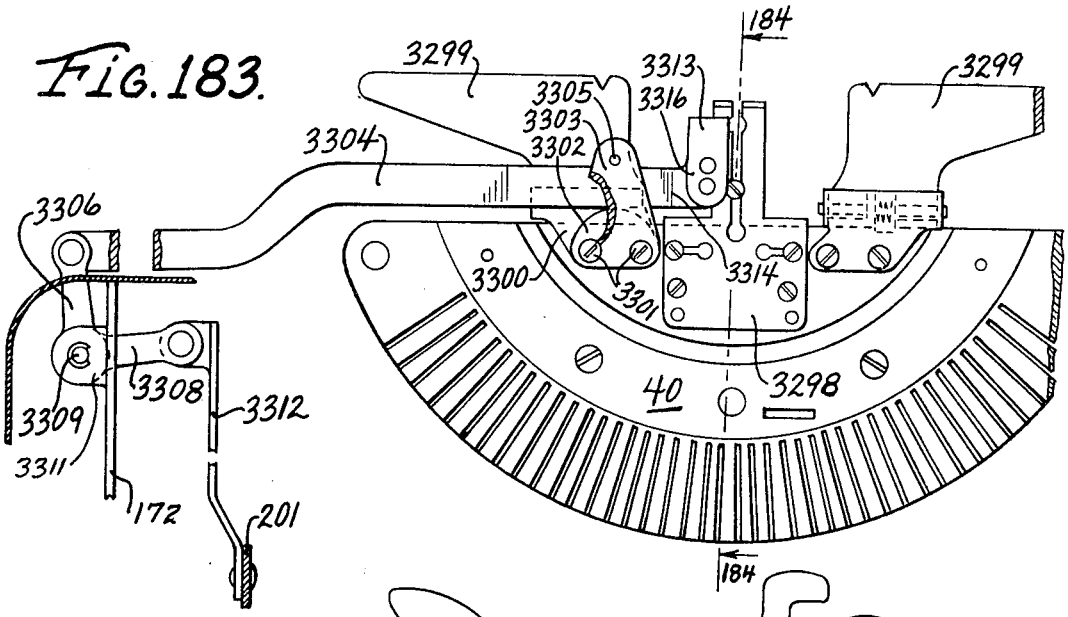
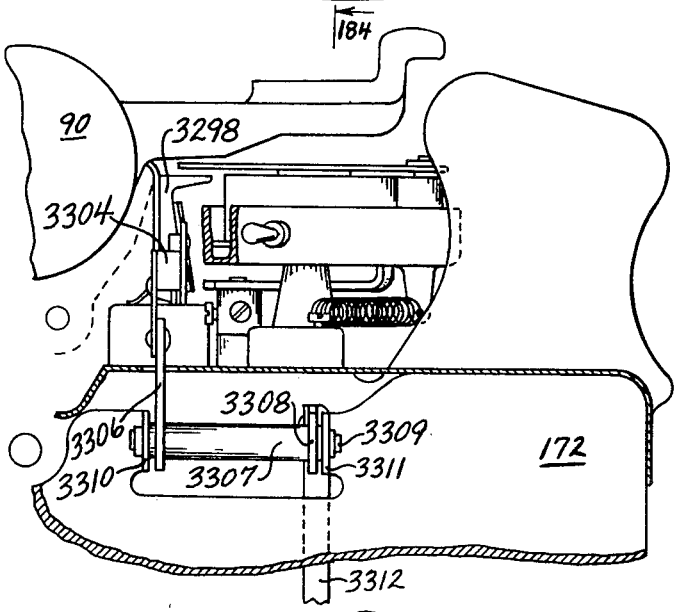
FIG. 185.
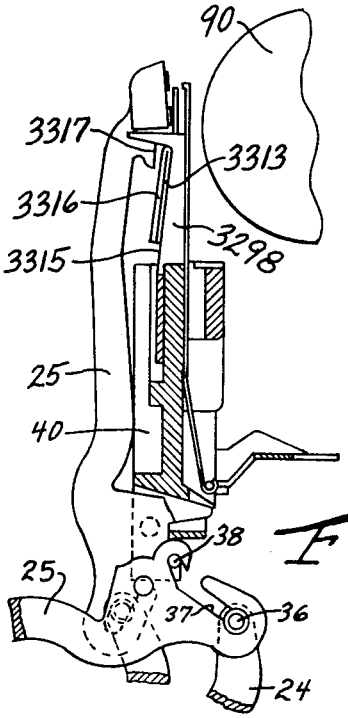
FIG. 184.

COMBINED FORWARD AND REVERSE PROPORTIONAL SPACING MECHANISM

This is a division of application Ser. No. 732,973, filed Oct. 15, 1976, which is a division of U.S. Ser. No. 213,045 filed Dec. 28, 1971 and now U.S. Pat. No. 3,993,179 dated Nov. 23, 1976.

BACKGROUND OF THE INVENTION

This invention relates to a desk top justifying text writing composing machine.

The machine includes automatic justifying computing and encoding means, and the justifying codes are recorded ahead of the text codes for a line, so reading for reproduction purposes proceeds smoothly in one direction. The dividing and justifying encoding means is automatically operable under control of a word space counter and an amount left in a line measuring means upon return of the composing machine carriage. This dividing and encoding means automatically divides the amount left in a line by the counted word spaces in the line, and immediately encodes the justifying information without first realizing a digitally expressed answer and without any operator intervention. The machine is capable of encoding for justification of any line that has at least one word space and that extends into a generous predetermined justifying area which precedes the right hand margin. Thus, the arrangement can accommodate the encoding requirements of very narrow columns, as used in newspapers for example, and even in such narrow columns the justified copy will present a proper appearance as long as the line is filled out in accordance with normal good typing practices. The code medium is completely automatically served and fed through all of the encoding and reading means, including reading for justified reproduction purposes, and thus all customary manual handling of the code medium is eliminated. Furthermore, the machine automatically shifts the code medium during all back space and deleting functions. The justified line is produced one line behind the unjustified copy; in other words, the justified copy line is produced automatically while a succeeding unjustified copy line is being typed.

A differential character and space key lock means prevents operation of character and space keys that would extend a line beyond the right hand margin, and this means is appropriately effective to permit the addition of any character or space that will still fit in the line at any given time and the arrangement also accounts for the difference in character sizes for each key in upper and lower case conditions.

Since a "space" at the end of a justified line would destroy the effect of justifying, the machine also includes means for preventing conclusion of a justifiable line when a word space or a nut space is the last encoded information in that line. A nut space is a space that is not alterable for justifying purposes. The line encoding operations are automatically concluded and the justifying information encoded upon return of the composing machine carriage. Therefore, means are provided for preventing inadvertent return of the composing machine carriage, when a "space" is the last thing encoded and the line has been extended into the justifying area at the end of the line. When the carriage is locked by this means, it may be unlocked for return of the carriage by deletion of the "space" or by addition of one or more characters.

Adjustable left and right hand margin means are provided for locating the position and width of a column, and the right hand margin means is affected by approach of the carriage near the end of a line for measuring the amount left in that line for justifying purposes, for differential end of line key locking purposes, for rendering effective the means for preventing a "space" at the end of a justifiable line, and for controlling an audio-visual justifying area signal means that indicates the final progress of a line to the operator.

The machine includes a color coded justifying area signal means that indicates entry of a line into the justifying area and thereafter it indicates the number of units left in that line, appropriately indicates the keys that may be locked by the differential key locks, and finally may indicate that the line is perfectly filled out, as the case may be.

A text and general function encoding means, a back space and deleting reading device, justifying encoding means and a main reading device for controlling reproducing operations, arranged in that order in respect to the flow of code media therethrough, together with slack code media sensing means and automatic media handling means, are assembled into a single unit for performance of automatic encoding, automatic deleting, and automatic justifying reproducing operations without any manual handling of the code media.

A key initiated 'clearing' arrangement is provided for restoring the composing machine to normal set-up conditions and for encoding a clear code, at the same time, for automatically controlling the reproducing machine to assume the same normal set-up conditions. A key initiated 'conditioning' arrangement is provided for encoding the instant set-up conditions of the composing machine on the code medium, and this code will control the reproducer to assume these same conditions when the code is read during reproducing operations. These keys may be operated at any time during encoding operations. However, their functions are most significant when a piece of work is begun, to assure proper coordination between the composing and reproducing machines, particularly immediately after a new supply of code media is inserted in the machine. A manually presettable key is also provided for determining that the "clearing arrangement" or the "conditioning arrangement" will operate automatically for encoding the clear code or a conditioning code following carriage return or a line delete operation for example. Thus, it is unnecessary to make condition set-up notations manually on any code media that may be separated from preceding code media and stored away for future reuse, since a clear code or a condition code will precede the text codes for each line.

Forward and reverse extra line space keys are provided for correspondingly rotating the platen one line space upon each operation of the respective key in the composing machine and for encoding for the same extra line spacing in the reproducing machine. These extra line spaces are differentiated from the normal line spacing that occurs upon return of the carriage. Upon automatic deletion of an extra line space code, the platen in the composing machine is rotated one line space in the opposite direction to the code then deleted, to thus position the line as it was before that particular line space was encoded.

GENERAL DESCRIPTION

The justifying text writing system disclosed herein involves two machines, a justification computing and encoding composing machine and a justified copy reproducer. However, the composing machine and the controls for the reproducer only are described in full detail in this application. The full detailed structure of the justified copy reproducer is described in copending application Ser. No. 212,895, filed Dec. 28, 1971 now U.S. Pat. No. 3,945,480 issued Mar. 23, 1976, by the inventors William S. Gubelmann and William R. Grier.

Manual or automatic operation of the composing machine produces an unjustified copy, as on a normal office typewriter. However, this operation of the composing machine also excites mechanism therein for automatically encoding the text and machine operations in a line of composition, for automatically counting the number of word spaces in the line, for automatically measuring the amount in units left between the end of the unjustified line a preset right hand margin means, for automatically encoding a carriage return operation at the end of the text codes and at the same time automatically dividing the amount left in the line upon return of the carriage, for automatically encoding the justifying information ahead of the codes for the text of the line, and for automatically feeding the code media containing all of the codes for the line directly into a main reading device serving area, automatic media feeding means feeds the code media into the main reading device, whereupon the main reading device first reads the justifying information and accordingly prepares the reproducer to add the appropriate amount to each of the significant word spaces as they occur, and then the main reading device reads the successive text and function codes for producing the line in justified form. While the justified copy of the line is being automatically produced by the reproducer, the operator may use the composer to encode a succeeding line. All of the above automatic functions, including computing, encoding, media handling and operation of the reproducing machine, are performed without manual intervention other than the normal typing operations in the composing machine and the return of the carriage therein. The typist need not be concerned about the differential character spacing, and he need merely put paper in each machine, set the margin controls in the composing machine, set the left margin stop only in the reproducer, and type the text on the composing machine in the usual manner while filling out the lines only in conformity with good typing practice. However, the arrangement will justify any line that extends into a generous area (justifying area) preceding the right hand margin control.

The instant invention provides differential character spacing with type faces similar to good handset type, and provides automatic encoding for justification of lines with no special manual setting operations. The expansion of lines for justifying purposes is accomplished by adding unit extents to normal word spacing; however, the same results can be obtained by adding unit extends to the normal letter spacing or to the normal letter spacing and the normal word spacing without departing from the spirit of the invention. Illustratively, the character sizes are two, three and four units and the normal extent of word spacing is two units, and, in justifying, the word spacing is two units or more as required. The instant embodiment sets forth an encoding system wherein the additional units are to be added to the first sixteen word spaces, providing there are sixteen or more such spaces in the line. If the line contains less than sixteen word spaces, an additional unit or units will be added to each word space in the line, providing there are as many units to be added to the line. The number of units to be added to the first sixteen or less spaces is determined by automatic justifying mechanism in the composing machine, which mechanism divides the number of units needed to extend the line the justifying amount by the number of word spaces to which units are to be added. The justifying mechanism expresses its answer by controlling the encoding of one code representing the complete quotient at times when there is no remainder, and by controlling the encoding of one code representing the quotient amount and an additional code representing the remaining number of units when the division results in a remainder. When there is a remaining number of units resulting from the division, the reproducer will word space an extent equal to the normal word space, plus the quotient number of units for sixteen spaces or less, and plus one unit for as many word spaces as there are units in the remainder, sufficient to place the last character in the line at the right margin.

The composing machine encodes for justification of lines according to the following exemplified system. If it is necessary to expand the length of a line 19 units and the line has 18 word spaces, the first three word spaces will be four units each (the normal two units, plus one which is the quotient amount of 19 units divided by the 16 spaces to which extra units will be added, plus one from the remainder), the next 13 word spaces will be three units each (normal two units, plus the one quotient amount), and the last two spaces (the 17th and the 18th spaces in the line) will be of the normal two units each. Similarly, in a case where the typist has not filled out a line in a very narrow column, such as used in newspapers, and there are only three word spaces and the maximum 23 units are needed to justify the line, the first two word spaces will be ten units each (2+7+1), and the last space will be nine units (2+7).

The present embodiment is conceived for accommodating justification encoding requirements under extenuating circumstances such as are found occasionally in narrow columns, when large words are used, and the typist, perhaps in haste, has not most desirably filled out the line. The illustrated embodiment will encode to accommodate a maximum of 23 units to be added to a line, even though there may be only one word space therein. If the line is more completely filled out, the justified line will present a better appearance, but it is considered more desirable to have the line justified regardless of whether the line is filled out or not. In the illustrated preferred form of the invention, a typist can produce excellent justified lines by filling out the line in normally good form on the composing machine. A differential key locking means is also provided for preventing the typist from filling out the line beyond the right margin.

In the preferred illustrated embodiment, an encoding and code reading assembly, including a text encoding means, a back space delete reader (for text code correction purposes), justifying encoding means, a reproducer controlling main reader (in that order in respect to the normal flow of code media therethrough), and code media handling means, is secured on the composing machine for convenience, although the assembly could just as well be a separate unit that is connected by wires to the composing machine, without departing from the spirit of the invention. In any case, the main reader and related media handling circuits in the encoding and reading assembly are preferably connected to the reproducing machine by wires which provide flexibility in respect to the relative locations of the two machines.

Preferably in the usual installation, the composing machine with the encoding and code reading assembly and the reproducing machine are situated near an operator's chair, where one person may conveniently insert paper into both machines and otherwise tend both machines at the same time. However, the invention accommodates various individually modified installation requirements, for example, the composing machine with the encoding and code reading assembly may be in one room under control of a typist and the reproducing machine may be in another room, connected to the composing machine by wires as in the usual installation, and in this arrangement the reproducing machine may be tended by a person devoted to handling only the justified copies which are the finished product. In still another modified installation, the composing machine equipped with the text encoding means, back space delete reader (for possible text code correction purposes), justifying encoding means, and a telegraph or other communication main reading device may be provided in one geographic location for preparing encoded information which may be transmitted by the communication means for reproducing the encoded media in a central office and/or other offices, for example, where the justified copy may be prepared on a reproducer equipped with at least a main code reader. Also, if a usual installation of composing machine, encoding and reading assembly and reproducing machine are provided at a first geographic location and also in a second location or a plurality of other locations, together with communication means for transmitting the main reading information between the various locations, and unjustified and a justified copy can be prepared simultaneously (there being only one line difference in the time) in one of the locations, and the main reading information transmitted to the other location, or locations, where a justified copy of the text can be produced. Thus, it can be seen for example, an editor or reporter for that matter can prepare a justified copy in one office or at some station in the field and he can transmit justified copy to all papers in their news service, in the shortest possible time.

In the composing machine disclosed herein, combined back spacing of the machine and deleting of encoded matter on the code media is performed automatically upon depression of a delete key. When the typist operates the machine and makes a typographical error or he otherwise wishes to change the text he has typed and the machine has automatically encoded during normal forward operations in a line, he merely depresses the delete key and the machine automatically reverses (back spaces) the encoded operations and deletes the related one or more codes. Momentary depression of the delete key causes automatic deleting of the corresponding code. If the operator wants to delete more than one operation, he merely holds the delete key down during a suitable number of rapid cycles of deleting operations sufficient to delete the unwanted operations. When he has deleted the unwanted portion of the line, the operator may manually rotate the platen one line space, return the deleted portion of the code media through the encoding means by operation of a media return key, and then proceed with composition of the corrected line, without need for erasing.

As mentioned previously, the encoding and code reading assembly includes a text encoding means and a back space delete reader. This normally ineffective reader is located one forward code media step away from the text encoding means, and, during forward encoding operations, the text codes are put on the media and the media is shifted one step forwardly after each encoding operation for shifting the last code into the delete reader. Thus, when forward encoding stops and the operator depresses the delete key, the last code is in the then effective back space delete reader, where the last code can immediately control for the back spacing operation. As soon as the last encoded text operation or function is back spaced, the code media is automatically moved one step reversely, where the last code is shifted back into the text encoding means and the next to the last code is shifted back into the back space delete reader. As soon as a back spaced code is returned into the text encoding means, this means is automatically operated to encode a delete code on top of the original code and thus the original code is rendered ineffective for reproducing purposes. If the operator releases the delete key during the first back space sequence of operations, the machine returns the key before the next sequence and the next to the last encoded code is not read for back spacing and deleting purposes. However, if the operator holds the delete key down for more than one sequence, the corresponding number of successive codes will be back spaced and deleted. When the delete key is returned, all other encoding keys are automatically locked against manipulation, but a media return key may then be manipulated to return the deleted codes through the text encoding means, to bring unaffected media into the encoding means, and to unlock the keyboard. At such a time, the machine is in condition for further forward encoding operations. When the corrected line is read by the main reading device, the reproducer operates according to the effective codes and it bypasses the deleted codes. A line-delete key is also provided for deleting an entire line, in cases where a large part of an encoded line would have to be eliminated in order to make a desired change in the text.

A novel key locking means is disclosed herein, and it is constructed and arranged for locking the character and space keys differentially in accordance with the size of the respective character or space key. This locking means accounts for the fact that the individual keys usually have different character sizes in upper case and lower case, and it locks all keys appropriately in either case. In either case condition of the machine, all 0.100", 0.075"and 0.050" character and space keys are locked when there is less than 0.100", 0.075" and 0.050", respectively, remaining in the line, and, thus, the typist can fill out the line as much as possible without being permitted to overrun the right hand margin. Although it would not be considered normal to do so, the key locking means, combined with the previously mentioned automatic back spacing and deleting feature, permits an operator to fill out a line until the next character key is locked, then to back-space to the first hyphenating position or word ending, as the case may be, and finally to insert the hyphen or return the carriage, whichever is appropriate for the thusly most perfectly filled out line.

Another automatic means is provided for locking the carriage against return and thus preventing the line from being ended, when an underline mark, a word space or a nut space is the last text representing operation in the line. A nut space is a space that is not alterable in size for justifying purposes. This means for assuring proper termination of a line prevents carriage return, which causes justifying encoding as previously mentioned, when an underline (without a character over it), a word space or a nut space is the last encoded text representing operation in the line and the carriage has been advanced to within the justifying area. In other words, for example, when the line is advanced to within the justifying area and the machine is otherwise set for justifying, a space bar operation will effectuate locking means for preventing carriage return, an ensuing character will render the locking means ineffective, another operation of the space bar will again effectuate the locking means and so on until the carriage is returned following a character key operation. This means prevents proper justification from being upset by a space, an underline and corresponding code at the end of a line, as will be more fully explained hereinafter. A common office typewriter, with a customary shiftable paper carriage, is used illustratively as a major component of the composing machine which includes many other novel automatic components, but it will become apparent that any typewriter, including those with shiftable imprinting means or other means for coordinating characters and spaces on a print receiving means to compose a line of text instead of the illustrated shiftable carriage, may be incorporated by one schooled in the art without departing from the spirit of the invention.

Manually presettable left and right hand margin control means are provided for locating the position and width of a column on a copy paper. The left hand control is a positive stop for return of the carriage or imprinting means, much the same as on a common office typewriter. However, this left margin means includes a novel switch means that controls operations of various mechanisms upon full return of the carriage. The right hand margin means is not a stop in itself, but it is automatically affected by approach of the carriage near the end of a line for measuring the amount left in that line for justifying purposes, for differential end of line key locking purposes, for rendering effective the means for preventing a "space" at the end of a justifiable line, and for controlling an audio-visual justifying area signal means that indicates the final progress of a line to the operator.

The audio-visual justifying area signal means includes an audible signal means that emits a sound for each unit movement of the carriage as the line extends into the justifying area, and it also includes a progressive series of color coded lights that first indicate entry of a line into the justifying area and thereafter indicate the number of units left in that line, several final lights in the series individually indicate the differential character and space keys that may be locked by the differential key locks, and finally they may indicate that the line is perfectly filled out, as the case may be at a given time.

A key initiated 'clearing' arrangement is provided for restoring the composing machine to normal set-up condition, and for encoding a clear code, at the same time, for automatically controlling the reproducing machine to assume the same normal set-up condition. A key initiated 'conditioning' arrangement is provided for encoding the instant set-up condition of the composing machine on the code medium, and this code will control the reproducer to assume this same condition when the code is read during reproducing operations. These keys may be operated at any time during encoding operations. However, their functions are most significant when a piece of work is begun, to assure proper coordination between the composing and reproducing machines, particularly immediately after a new supply of code media is inserted in the machine. A manually presettable key is also provided for determining that the "clearing arrangement" or the "conditioning arrangement" will operate automatically for encoding the clear code or a conditioning code following carriage return or a line delete operation for example. Thus, it is unnecessary to make condition set-up notations manually on any code media that may be separated from preceding code media and stored away for future reuse, since a clear code or a condition code will precede the text codes for each line.

Further function keys, such as justifying on-off, stop printer, code media feed, encoding control (punch control), print control, bold and regular control and power on-off switch keys, are provided on the composing machine keyboard. The justifying on-off key is shiftable from one position to another for respectively controlling the composing machine to automatically encode justifying information for each line or to omit the justifying encoding operations, and thus the reproducer will operate for producing a justified copy or an unjustified copy, respectively. The stop printer key is operable for encoding a stop printer code, which will control the reproducer to stop at that point, where variables, e.g. names, or dates may be added for example. There are two code media feed keys shown herein as a preferred form. Operation of one of these keys causes the code media to be fed through the main reader an amount equal to a plurality of code space increments in one motion whereby the increments correspond to the advance of tape by one step. Operation of the other feed key causes the code media to be fed one increment for each operation of the key, and, in another form of this key, the code media is automatically fed consecutive increments as long as the operator holds the key in operated position. If one or more of such blank code media increments are provided within the text codes for a line, the blank space will cause the reading for reproducing purposes to stop at that point, much like a stop printer code. By manipulation of these keys, an operator may provide sufficient blank space on a code media tape for writing special notations that may be useful for providing unusual set-up control of the reproducer. If a stop printer code and blank space code media tape is provided at the beginning of a piece of work (a letter, for example), the reproducer will stop before the reproduced copy is begun, notations for special set-up of the reproducer may be noted on the tape in the blank space, paper (special letterhead, for example) may be put in the reproducer, and also, before or after the reproducer is operated to reproduce the work, special filing information may be placed on the blank space to aid is proper filing of the tape for future use. The encoding control (Punch control) key is shiftable from one position to another for controlling the encoding means to encode the operations of the composing machine for reproducing purposes, or upon return of the key to the first position for rendering the encoding means ineffective so the composing machine may be operated alone, respectively. The print control key is shiftable between two Another object of this invention is to provide an improved justifying text writing composing machine, including the mechanisms set forth in the preceding object together with encoding mechanism and justifying reproducer control mechanism, wherein the differential character and space key locks prevent the composing machine from overrunning the right hand margin and prevent the encoding mechanism from encoding for a line of text that would cause the control mechanism to operate the reproducer beyond the right hand margin.

Still another object of the invention is to provide, in a justifying text writing composing machine, means for preventing termination of a justifiable line, during normal forward operations, when a space that would destroy the justified appearance of the line is the last operation performed in the line.

Another object of the invention is to provide, in a justifying typewriter composing machine, means for encoding a text for a line and for terminating a justifiable line by returning the carriage, and means for preventing return of the carriage during normal forward operations, when a space that would destroy the justified appearance of such a reproduced line is the last operation performed and encoded in the line.

Another object of the invention is to provide a justifying text writing composing machine for encoding a written text and automatically encoding for justification of a line that extends into a justifying area, at the end of a line, combined with means for deleting encoded matter in accordance with already encoded matter upon depression of a delete key, the delete key being automatically held in operated position by a detent means until a cycle of deleting operations is properly complete, a plurality of deletion cycles of operations being automatically performed upon manually holding the delete key beyond at least one full cycle of deleting operations, the arrangement further including a space sensing means that is effective only when the line is extended into the justifying area for avoiding the release of the delete key by the detent means when a space code is the last effective code, whereby deleting operations will be terminated only when a character code is the last effective code in the line or when the line is deleted back out of the justifying area.

Still another object of the invention is to provide improved left and right hand margin controls for locating the position and width of a column, the left hand margin control including means for stopping the carriage upon carriage return and including electrical means for indicating that the carriage is fully returned, the right hand margin control including means affected by approach of the carriage near the end of a line for measuring the amount left in that line for justifying purposes, for differential end of line key locking purposes, for differential end of line key locking purposes, for rendering effective a means for preventing a "space" at the end of a justifable line and for controlling an audio-visual justifying area signal means.

Still another object of the invention is to provide an improved audio-visual justifying area signal means including an audible signal that emits sound upon each unit extension of the line after the line has reached the justifying area and including a color coded justifying area signal means that indicates entry of a line into the justifying area and thereafter it indicates the number of units left in that line, appropriately indicates the keys that may be locked by the differential key locks, and finally may indicate that the line is perfectly filled out, as the case may be.

Still another object of the invention is to provide a composing machine and a reproducing machine interconnected by an encoding assembly means comprising a first encoding means for coding the functions and text as the composing machine is operated to set up a line of type; a second encoding means, situated following the first encoding means in respect to the normal flow of the code media, automatically operable upon return of the composing machine carriage for encoding justifying information ahead of the code for the text of the line; and a code reading means situated following the second encoding means for reading first the justifying information and then the codes for the text of the line and therethrough controlling the reproducing machine to produce a justified copy line, one line behind the one being typed and encoded on the composing machine, without manual attention by the typist.

Another object of the invention is to provide a composing machine and a reproducing machine interconnected by a paper tape punching and reading assembly comprising a first punch mechanism responsive to manual operation of the composing machine for punching codes which represent the functions and text as the composing machine is operated; a first code reading means, located one step following said first punch mechanism, combined with back spacing and deleting control mechanism operable upon momentary or sustained manipulation of a back-space delete key and thereupon being responsive to said first reading means for operating reversely according to the last punched and/or consecutively preceding plurality of sets of code holes, respectively, and therethrough automatically back-spacing the composing machine and the coded tape and controlling said first punch mechanism to punch a delete code over the back-spaced code on the tape for correcting or otherwise changing the previously encoded text for the line; a second punch mechanism, following the first punch mechanism and said first code reading means, combined with justifying encoding mechanism automatically operable upon return of the composing machine carriage for punching justifying information ahead of the codes for the text of the line; and a second code reading means, following the second punch mechanism, for reading first the justifying code and then the corrected or altered text codes for each line and thereby controlling the reproducing machine to produce a desired justified copy, one line behind the one being typed on the composing machine, all with automatic tape handling.

Another object of the invention is to provide mechanism including that expressed in the preceding object and further including a manipulative tape return key and suitable mechanism operable following deleting operations for returning the deleted code portion of the control tape forwardly through the first punch mechanism and serving clear unpunched tape into the first punch mechanism.

Another object of the invention is to provide a combined encoding and code reading assembly including a text and general function encoding means, a back space and deleting reading device, justifying encoding means and a main reading device for controlling reproducing operations, arranged in that order in respect to the flow of code media therethrough, together with slack code media sensing means and automatic media handling means, for the performance of automatic encoding, positions for encoding a print code upon shift of the key to one position and for encoding a no-print code upon shift to the other position, whereby the reproducer is controlled to print and accordingly shift the print receiving paper in a normal manner for reproducing an encoded text, or whereby the reproducer is controlled to shift the paper according to an encoded text without printing the characters of the text, respectively. The bold and regular control key is shiftable into one position for encoding a bold-face code, and it is shiftable into another position for encoding a regular face code, whereupon the reproducer is controlled to print in a pronounced bold-face, or to print in a lighter regular-face, respectively. The power on-off switch key of course is for turning the electrical power on or off in the composing machine.

Forward and reverse line space keys are located conveniently on the keyboard of the composing machine, and they, together with suitable mechanism in the machine, are selectively operable for rotating the platen one line space forward or reverse respectively and, at the same time, for encoding for the same line spacing in the reproducer.

An object of this invention is to provide an improved justification and literal text writing and encoding composing machine, and control means for automatically controlling a justified copy reproducing machine.

Another object of this invention is to provide a text writing composing machine, requiring only normal typing experience and normal typing skill of an operator, for encoding complete justifying text writing information.

Another object of this invention is to provide an improved composing typewriter that will automatically encode text, function and justifying information for automatically controlling a justified copy reproducer to produce successive justified lines of a text following a single typing of each line of the text on the composing typewriter.

Another object of the invention it to provide correcting or editing means, in a text writing composing machine, and a composing machine controlled reproducer combination, whereby the composing machine operator may easily correct or otherwise change a line of text, as the line is typed, before the reproducer automatically reproduces the corrected or altered line.

Another object of the invention is to provide, in a typewriting composer and typewriting reproducer combination including a controlling code medium, completely automatic correcting means under control of a manipulative key, in the composer, operable for controlling the correcting means to automatically delete one or more effective material codes already on the code medium, to correct justifying data stored in the composer, to reversely read consecutive affected codes and to appropriately back-space the carriage and perform reverse functions in accordance with each code and to handle the code medium automatically, so as to condition the composer and the code medium for receiving correct new material.

Another object of the invention is to provide a literal text writing composing machine and an encoding mechanism controlled by the keys of the machine for recording on a code medium the normal forwarding sequence of key actuations that make up a line, and a back-space decoder, a back-space code reader for controlling said decoder, and mechanism under control of the decoder for automatically back-spacing the line and conditioning the machine in accordance with the reverse order of the codes on the code medium and sequentially deleting the codes that are back-spaced, so the remaining extent of the line always accurately corresponds with the spacing required for the remaining and not deleted codes on the medium, so the machine is always conditioned according to the last undeleted function or machine conditioning code, and so the operator need not know the set width of the characters of spaces in order to unerringly back-space the characters, spaces and functions.

Another object of this invention is to provide an improved text writing composing machine capable of encoding for justification of any line that extends into a generous justifying area near the right hand margin of a column, providing there is at least one word space in the line. One schooled in the art may employ the teaching of this invention in a system for adding the justifying amounts to the letter spacing, or to the letter spacing and the word spacing, without departing from the spirit of the invention, and in such an arrangement the composing machine will encode for justification of any line that extends into the justifying area, even in a very narrow column where there is a large word and no word space.

Another object of this invention is to provide a manually operable non-justifying typewriter, on which an operator may type a line and proofread the text of each typed line before returning the carriage, and which carriage operation causes justifying reproducer control mechanism in said typewriter to operate a reproducer to print a justified line of the text, automatically through successive lines, without interrupting the manual typing processes.

Another object of this invention is to provide an improved justifying text writing composing machine, including text encoding, line delete encoding and justifying encoding means together with a main reading device for reproducing purposes, wherein the justifying information codes or the line delete codes, as the case may be, are appropriately encoded ahead of the text codes for each line, and wherein the code media for a line is proportional to the length of the line, the feed controls are simpler and faster, and the code media is fed only in one direction through the main reading device and the justifying information codes or the line delete codes are read for reproducing set-up purposes before the text codes for a line are fed into the reading device.

An object of the invention is to provide systems for automatically controlling production of justified written copy, one line behind the composition of each line of unjustified copy, without special intervention by an operator.

Still another object of the invention is to provide an improved literal text writing keyboard machine, having differential characters keys (some of which are for a different size character in upper case than in lower case), case shifting control means, differential space keys, left and right hand margin control means and including differential character and space key locks, wherein successive lines of text may be written between the margin control means and wherein the key locks prevent operation of each of said keys only when their respective character or space will not fit between the end of a line and the right hand margin as controlled by the right hand margin control means and the case shifting control means.

automatic deleting, and automatic justifying reproducing operations without any manual handling of the code media.

Still another object of the invention is to provide a key initiated clearing arrangement for restoring a composing machine to nomral set-up conditions, and for encoding a clear code, at the same time, for automatically controlling a reproducing machine to assume the same normal set-up conditions.

Still another object of the invention is to provide a key initiated conditioning arrangement for encoding the instant set-up conditions of a composing machine on a code medium, and this code will control a reproducer to assume these same conditions when the code is read during reproducing operations.

Still another object of the invention is to provide, in a composing machine including the clearing arrangement and the conditioning arrangement mentioned above, a manually presettable key for determining that the clearing arrangement or the conditioning arrangement will operate automatically for clearing the machine and encoding the clear code for encoding the conditioning code, respectively, following carriage return or line delete operations.

Still another object of the invention is to provide, in an encoding composing machine, forward and reverse extra line spacing keys and a mechanism controlled thereby for correspondingly rotating the machine's platen one line space upon each operation of a respective key and for at the same time encoding for the same extra line spacing.

Another object of the invention is to provide, in a composing machine capable of normal composing encoding operation and back-space deleting operations, and in such a machine having a forward and reverse extra line spacing mechanism and a forward and a reverse extra line space keys that are selectively operable for respectively controlling the line spacing mechanism to rotate the machine's platen one line space and for at the same time to encode the appropriate extra line space operation during forward operations, means for controlling the extra line spacing mechanism during deleting operations to rotate the machine's platen on line space in the opposite direction to the code then deleted, to thus position the platent as it was before that particular line space was encoded.

Further objects and advantages of this invention will appear in the detailed description taken in connection with the accompanying drawing in which:

FIGURE DESCRIPTIONS

FIG. 6 is a fragmentary right side view showing greater details of upper and lower case mechanisms shown in part in FIG. 4.

FIG. 7 is a fragmentary right rear quarter perspective view of some of the parts shown in FIG. 6.

FIG. 8 is a fragmentary right side view of the standard typewriter showing primarily the carriage and its mountings.

Figure 19:
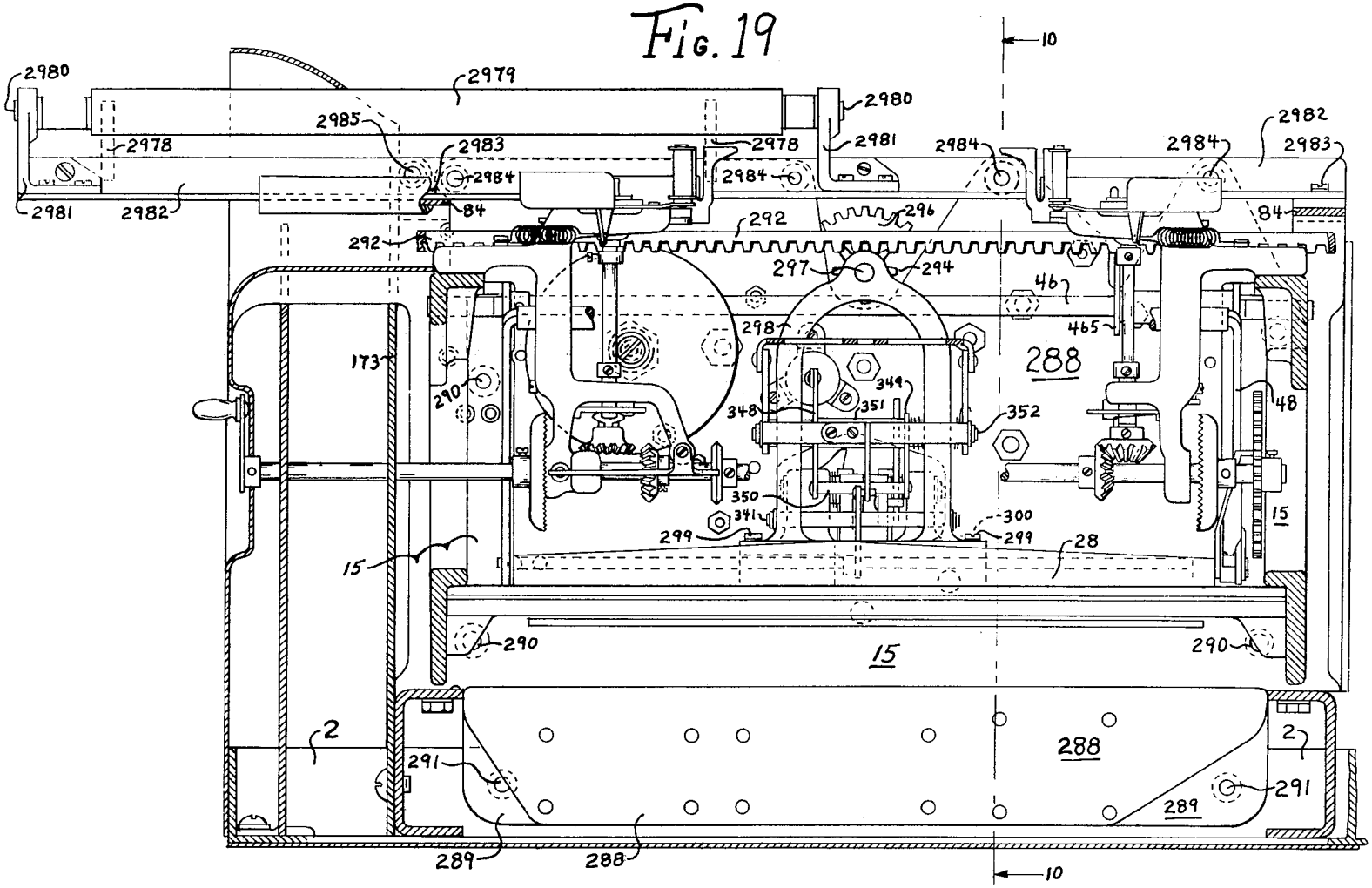

FIG. 19 is a reduced fragmentary sectional front view of the typewriter, taken generally on line 19—19 (FIG. 3), with the carriage, type mechanism and other relatively common mechanism omitted for clarity, showing primarily some of the details of the typewriter support frame members and part of the ribbon feed mechanism and part of the carriage moving mechanism, inciuding a fragment of the carriage borne movement control rack.

Figure 20:
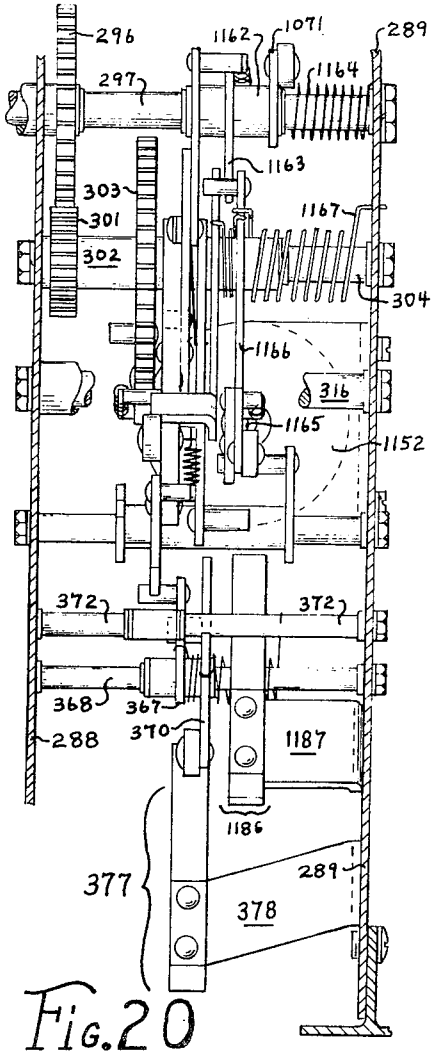

FIG. 20 is a fragmentary right sectional elevation of part of the carriage moving mechanism as seen from line 20—20 (FIG. 23) with some parts omitted for clarity.

Figure 21:
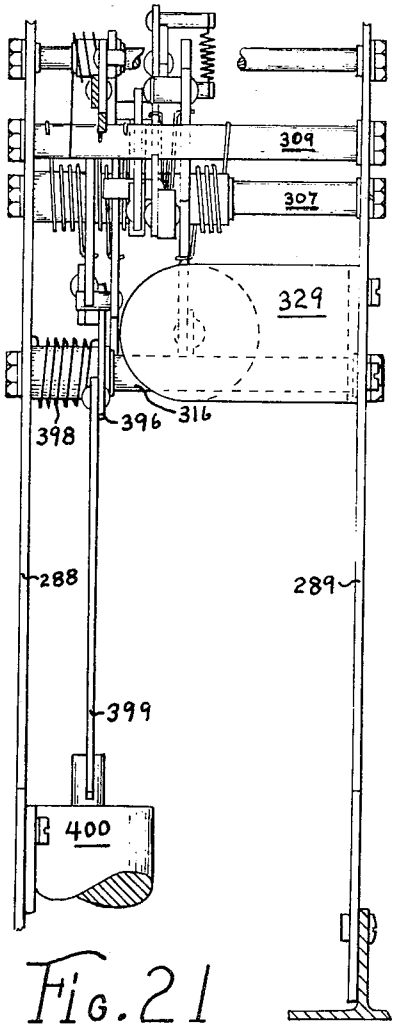
Figure 23:
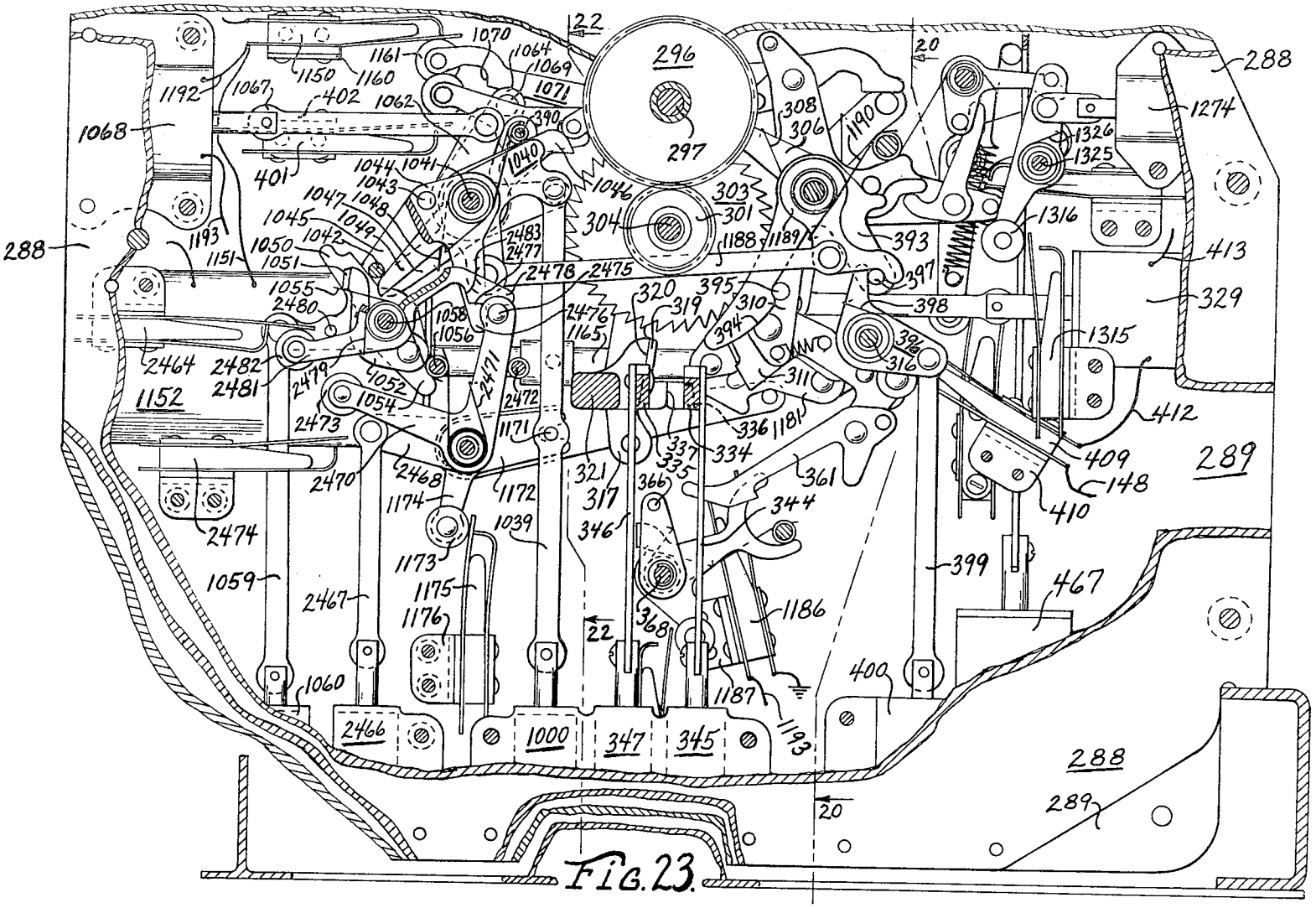

FIG. 21 is a fragmentary right side elevational view of mechanism shown in FIG. 23, with some parts omitted for clarity.

Figure 22:
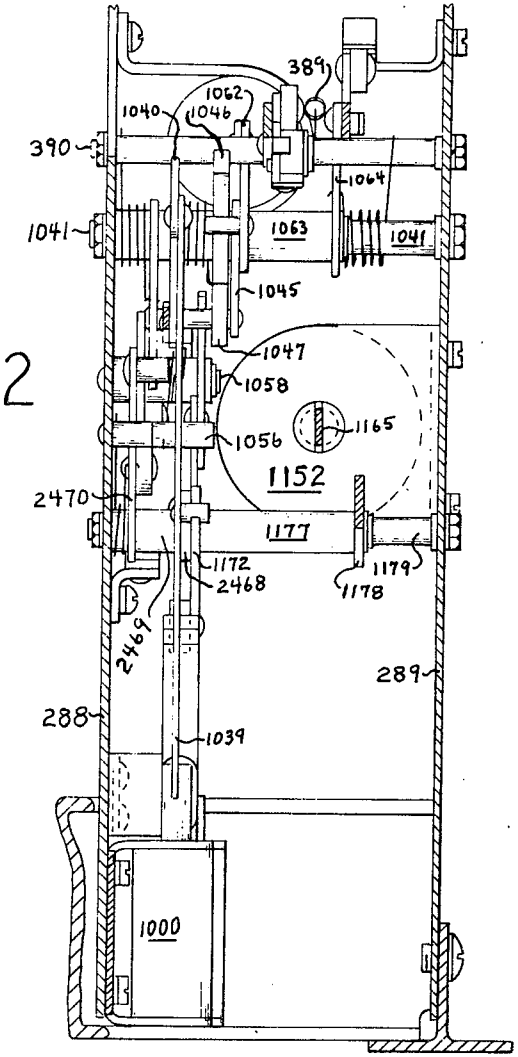

FIG. 22 is a right sectional elevation of the carriage moving mechanism as viewed from line 22—22 (FIG. 23).

FIG. 23 is a fragmentary front sectional elevation taken on line 23—23 (FIG. 10) and showing a major part of the carriage moving mechanism.

Figure 24:
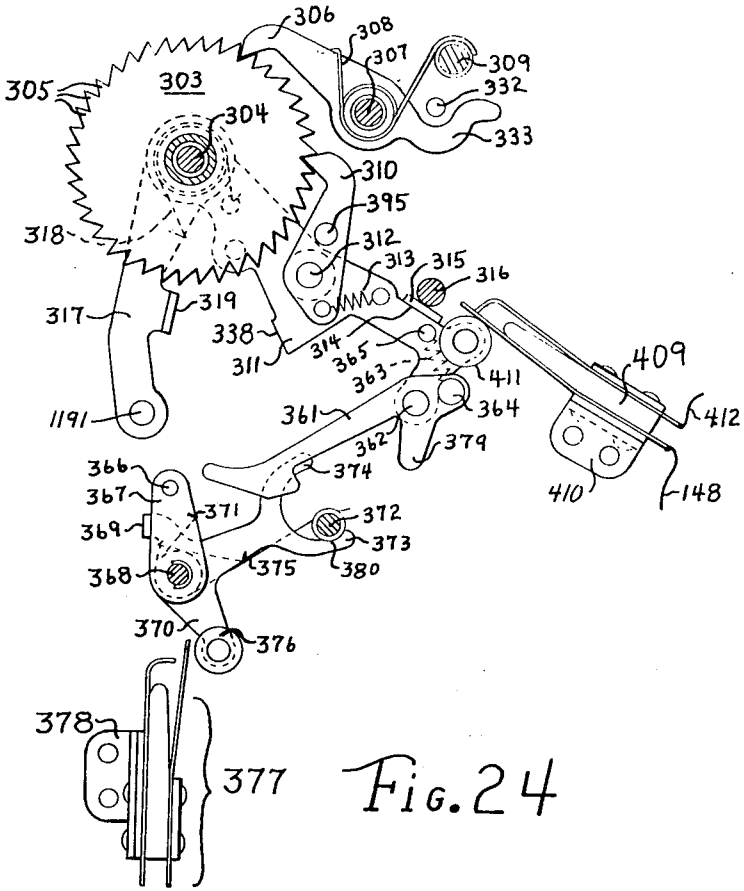

FIG. 24 is a front view of some of the mechanism shown less clearly in FIG. 23.

Figure 25:
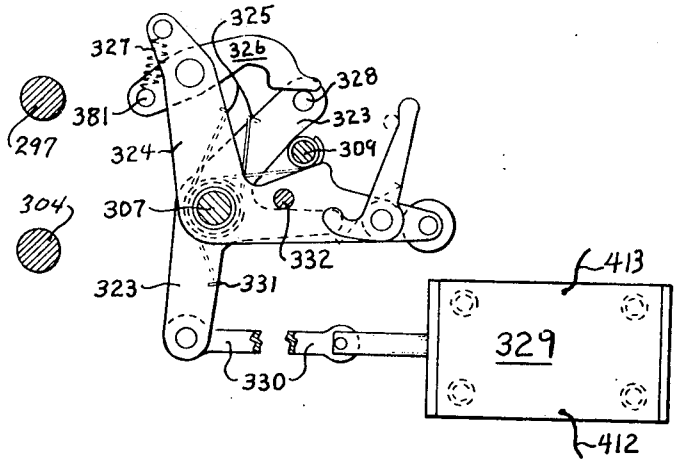

FIG. 25 is a front view of some of the mechanism included obscurely in FIG. 23.

Figure 26:
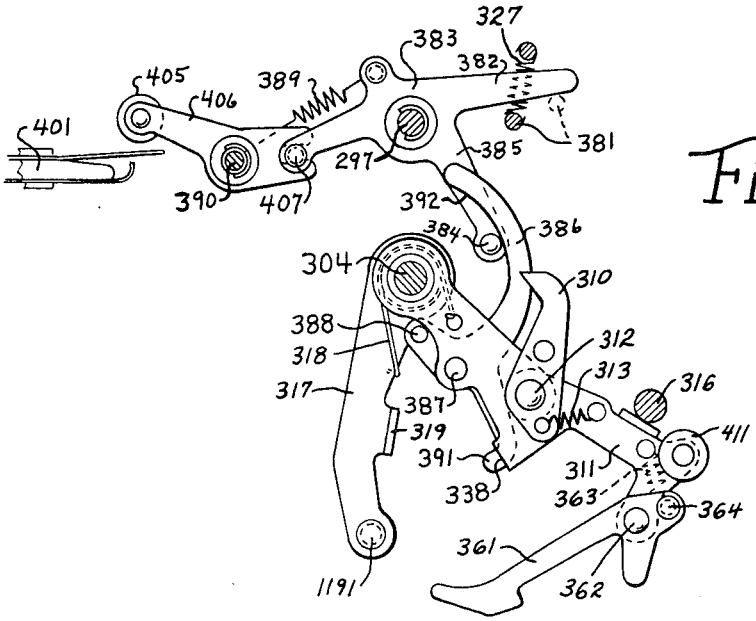

FIG. 26 is a front view of some of the mechanism shown obscurely in FIG. 23.

Figure 27:
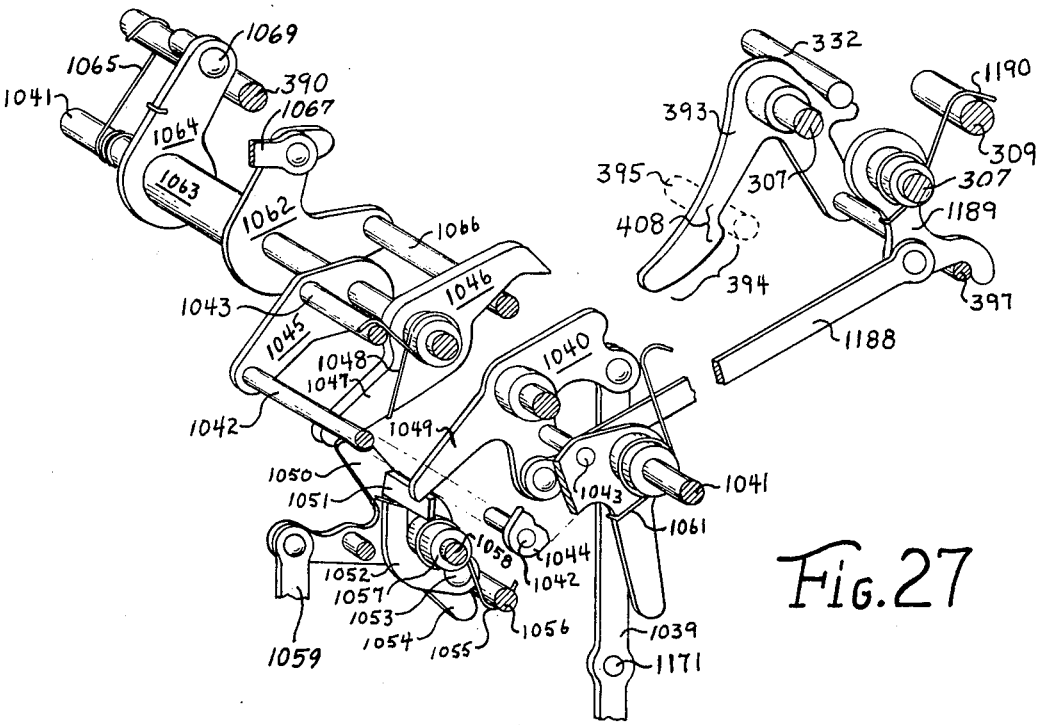

FIG. 27 is fragmentary exploded isometric view of some of the parts shown obscurely in FIG. 23.

Figures 28, 29, 30:
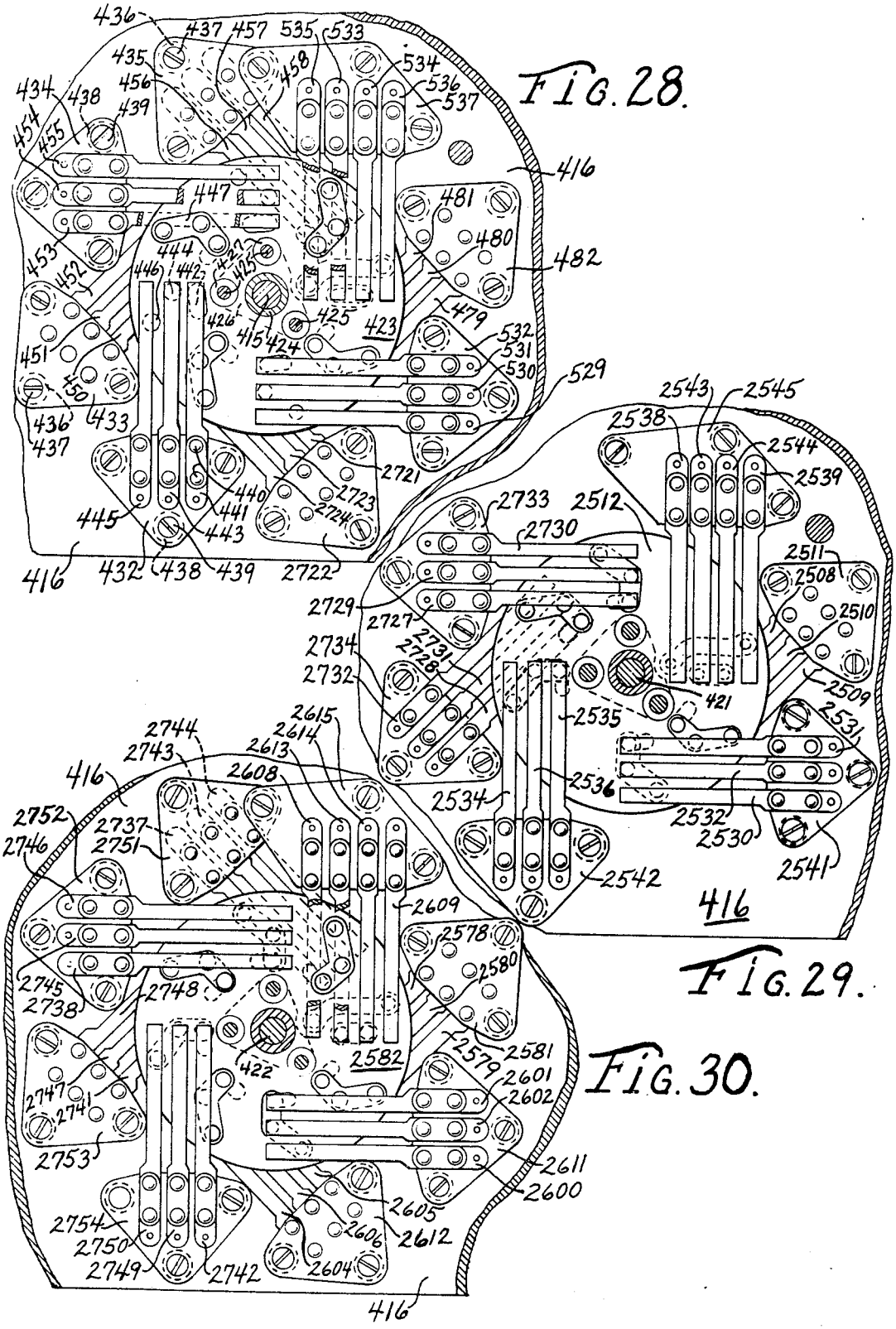

FIG. 28 is a fragmentary sectional rear view, taken on line 28—28 (FIG. 31), showing primarily upper-lower case switch means for controlling differential carriage movement.

FIG. 29 is a view like FIG. 28, but showing a "bold" and "regular" switch means.

FIG. 30 is a view like FIG. 28, but showing a "print" and "no print" switch means.

Figure 2:
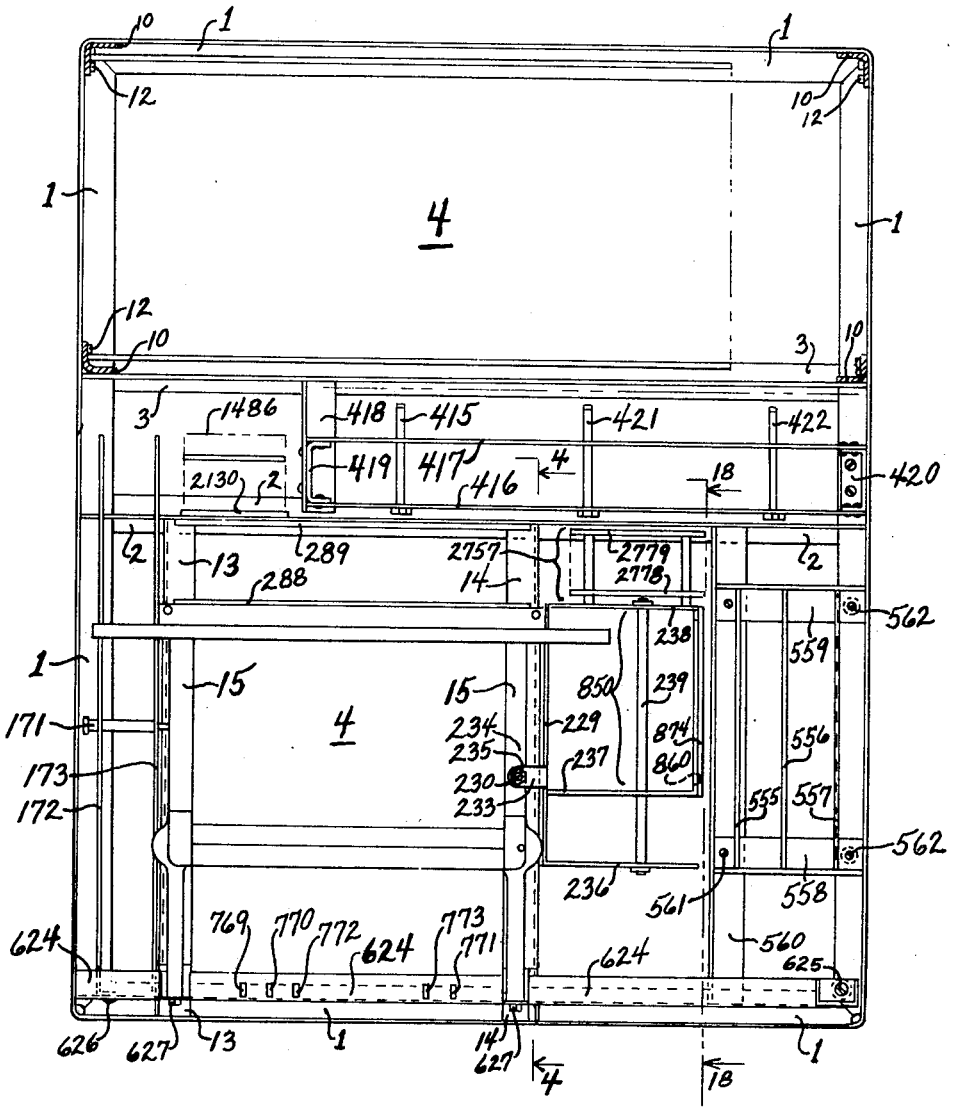
FIG. 2 is a reduced top plan view of the machine, with the cover and mechanism omitted to show the details of the basic framework.
Figure 31:
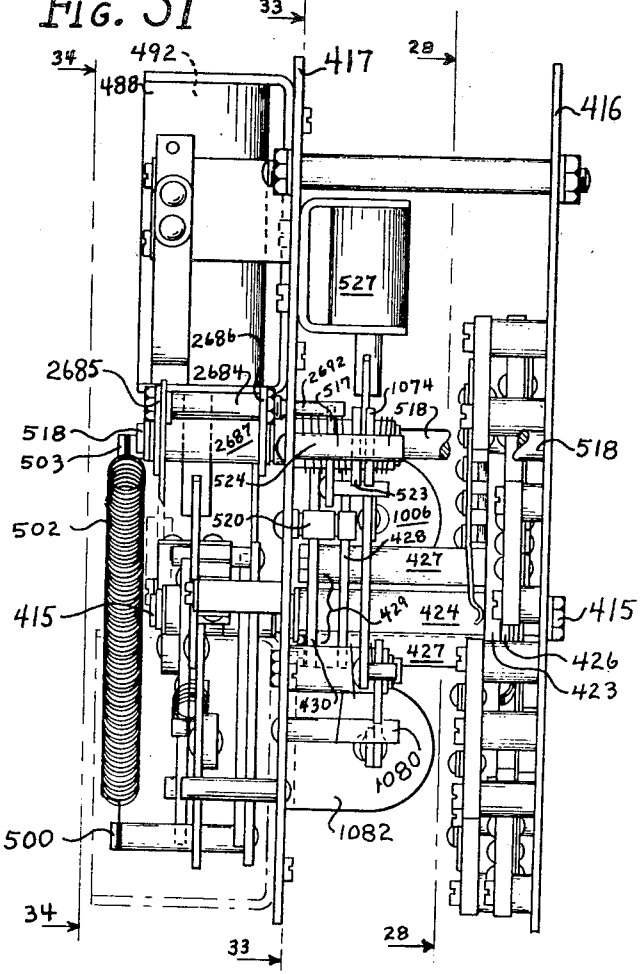

FIG. 31 is a full left side elevation of a snap switch assembly supported principally on vertical plates 416 and 417 (FIG. 2).

Figure 32:
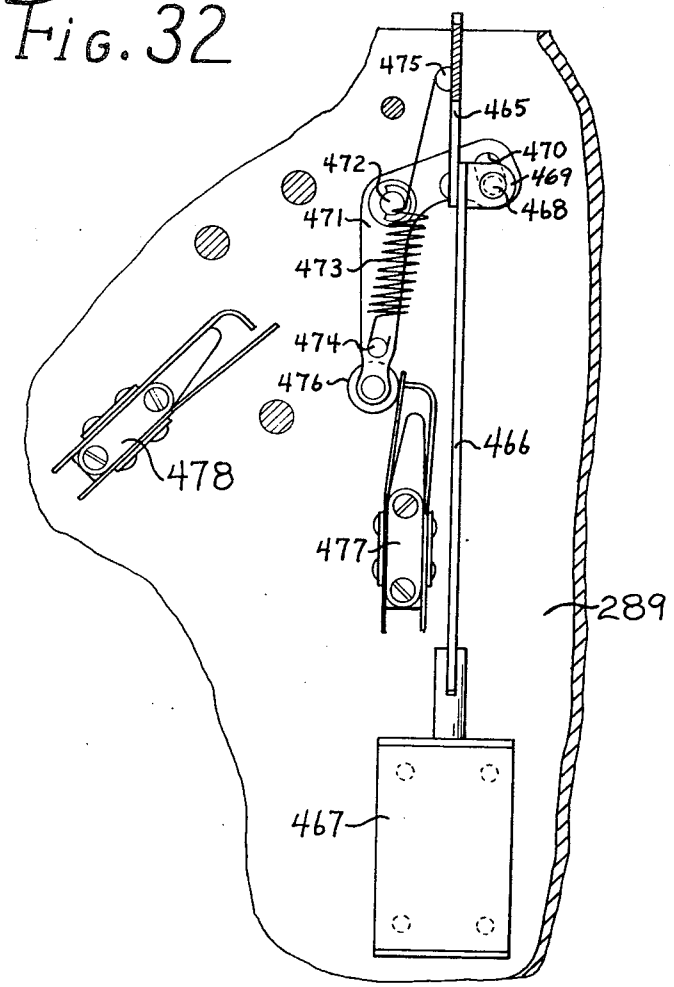

FIG. 32 is a front view of case shifting switch mechanism shown obscurely in FIG. 23.

Figure 33:
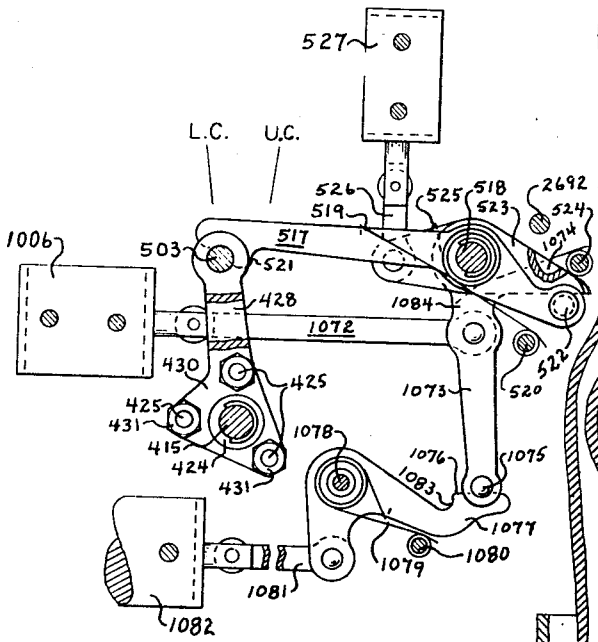

FIG. 33 is a fragmentary sectional rear view, taken on line 33—33 (FIG. 31), of some of the mechanism in FIG. 31.

Figure 34:
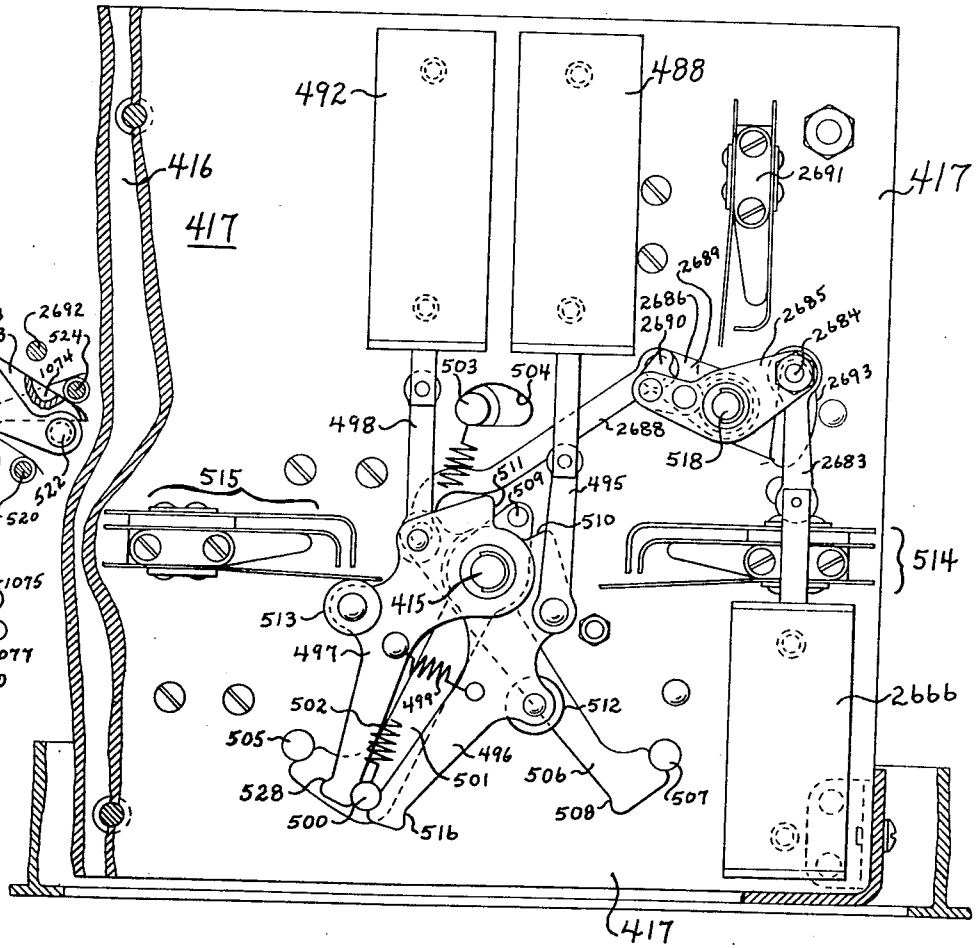

FIG. 34 is a rear elevational view of case shifting snap switch mechanism as viewed from the left (line 34—34) in FIG. 31.

Figure 35:
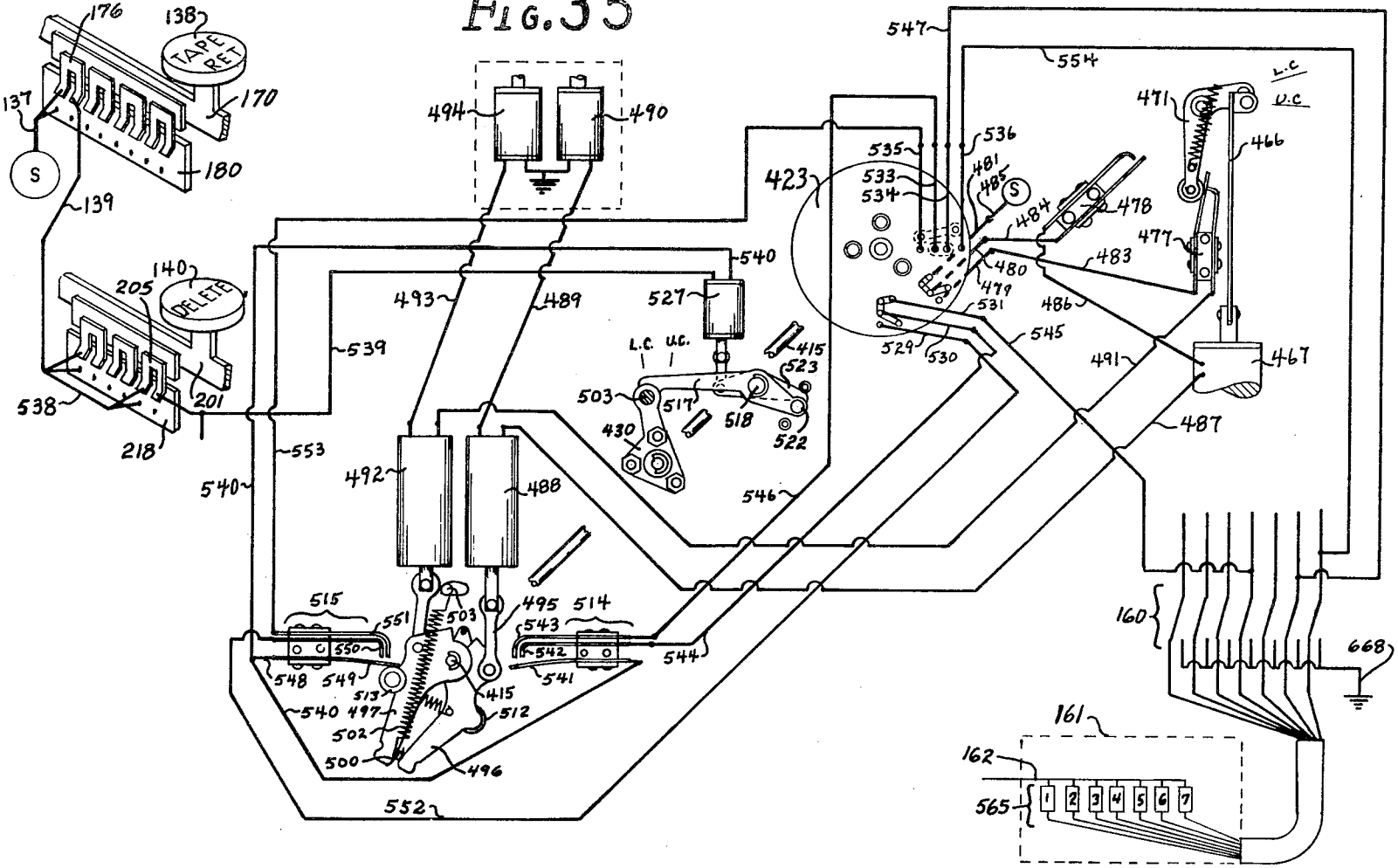

FIG. 35 is a schematic wiring diagram of the case shift circuitry.

Figure 36:
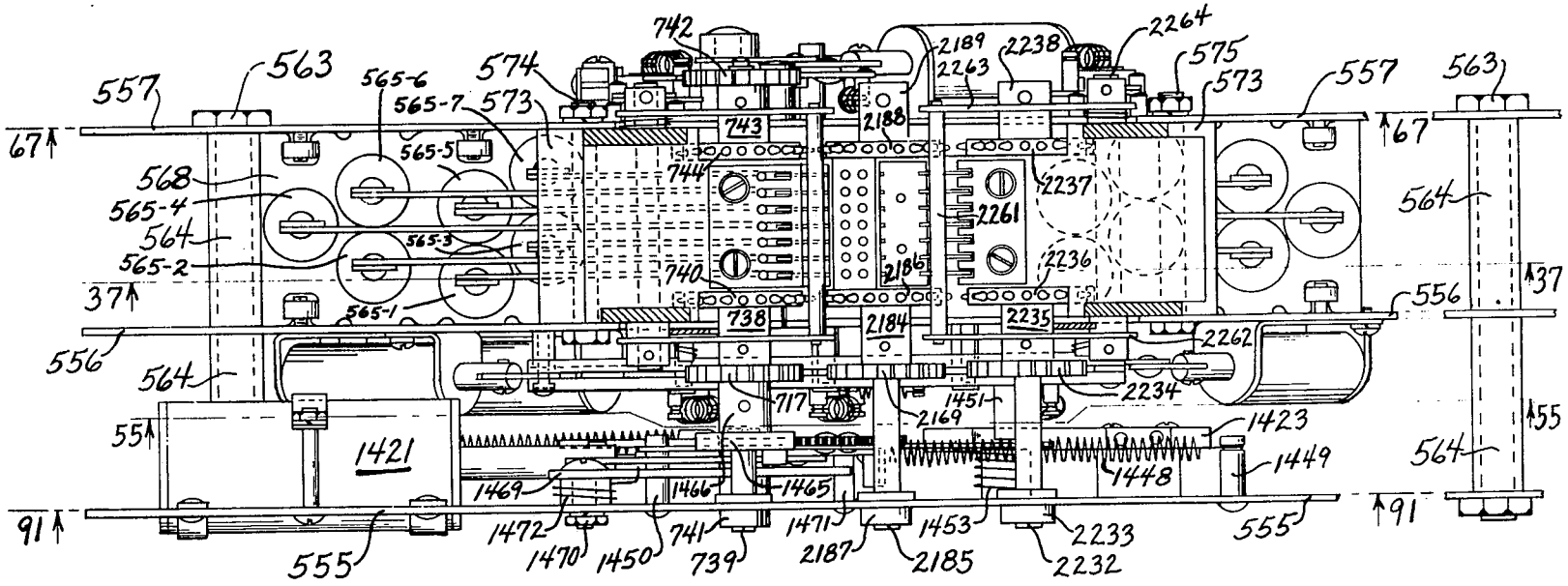

FIG. 36 is an oblique sectional view taken as seen from the top and front of the machine, generally on line 36—36 (FIG. 37), showing the tape handling assembly (punches, readers, etc.) with its hinged cover and general machine covering removed for clarity.

Figure 37:
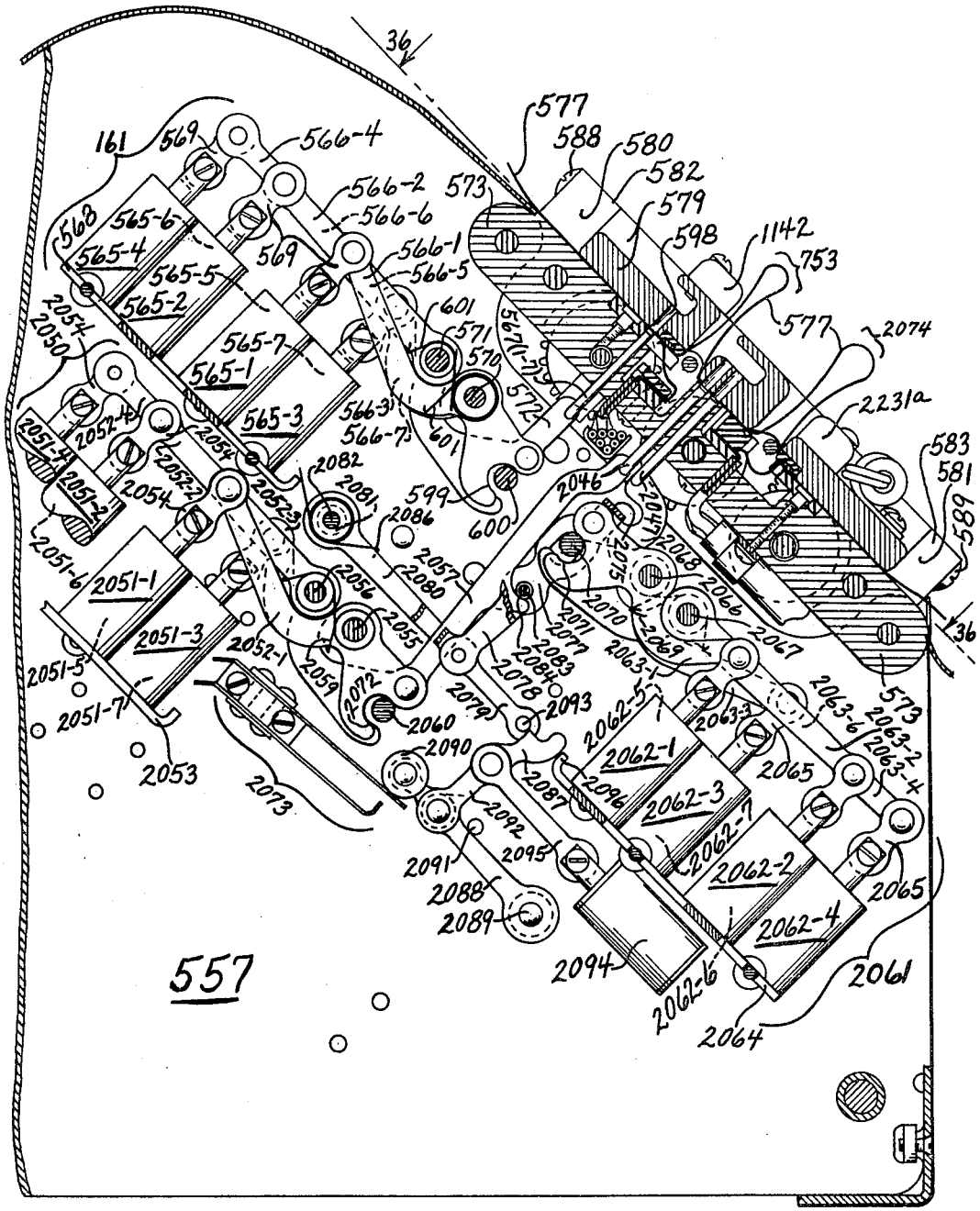
Figure 39:
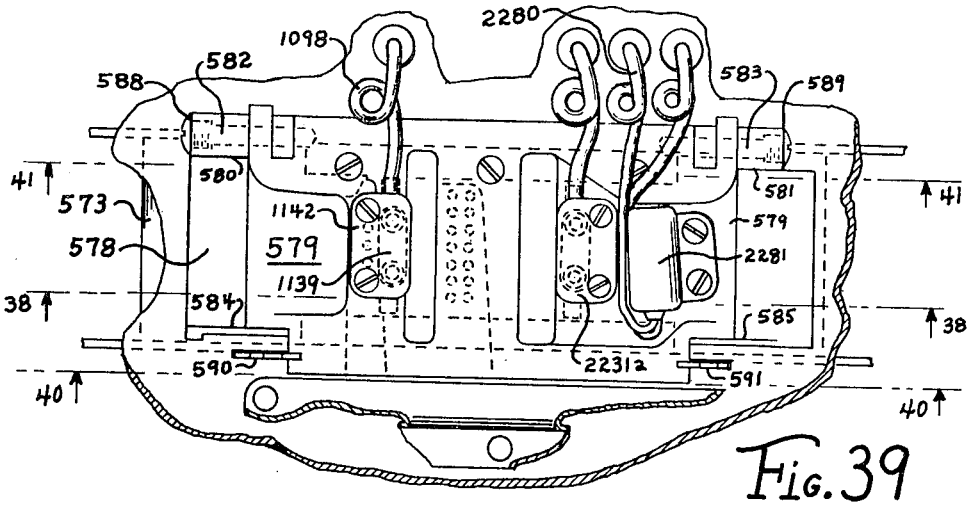

FIG. 37 is a left sectional elevation of the tape handling assembly, as viewed generally from line 37—37 (FIG. 36), but including the assembly's cover as viewed from line 38—38 (FIG. 39).

Figure 38:
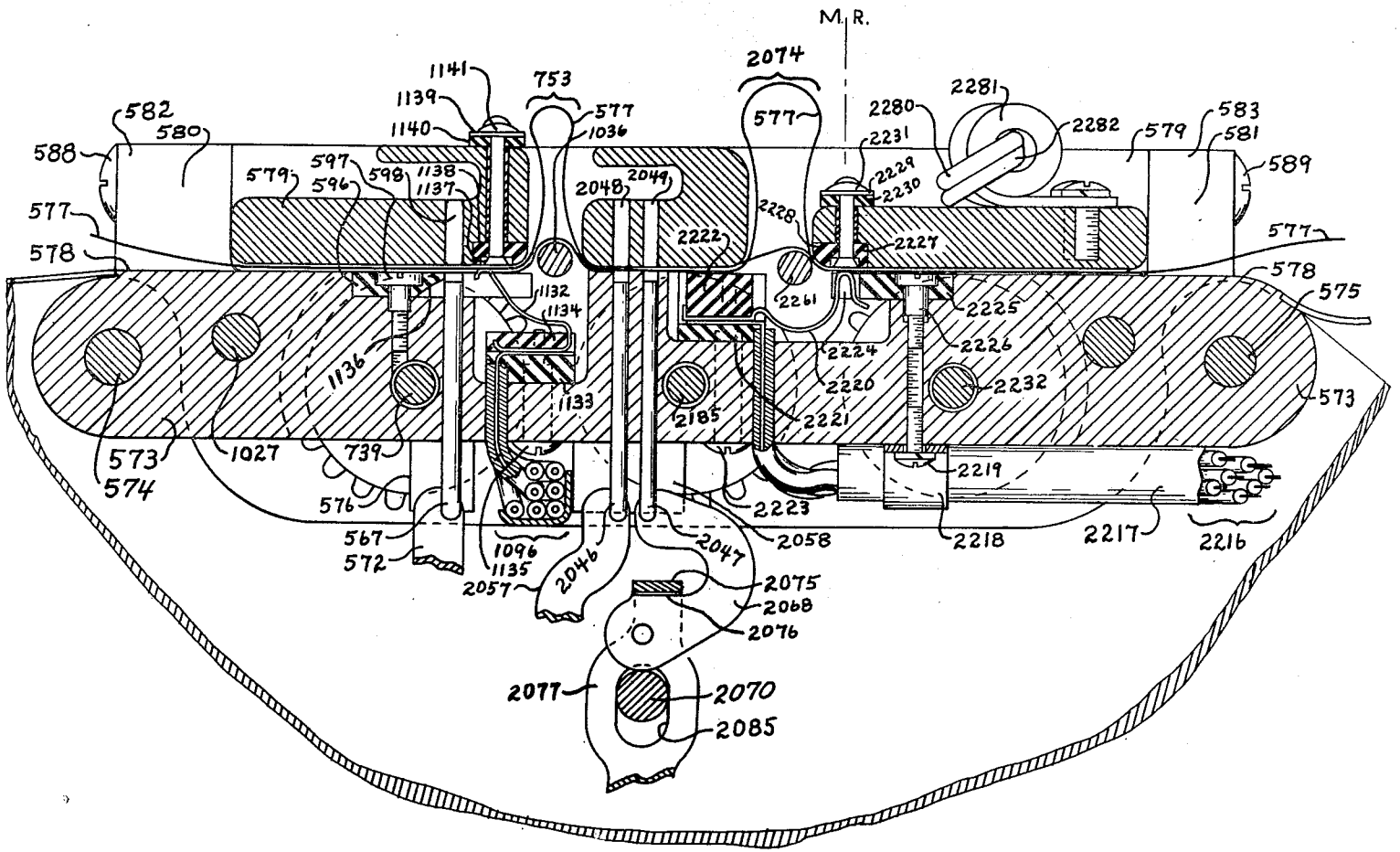

FIG. 38 is an enlarged scale fragmentary left sectional view, taken generally on line 37—37 (FIG. 36) and on line 38—38 (FIG. 39), showing more clearly some of the mechanism in FIG. 37.

FIG. 39 is a fragmentary oblique plane view of the tape handling assembly, showing primarily the assembly's hinged cover.

Figure 40:
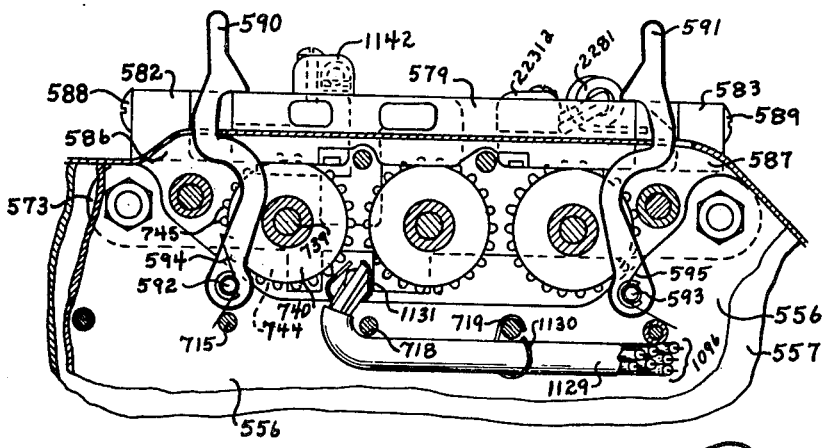

FIG. 40 is a fragmentary left sectional view, taken on line 40-40 (FIG. 39), showing some of the details of the tape handling assembly.

Figure 41:
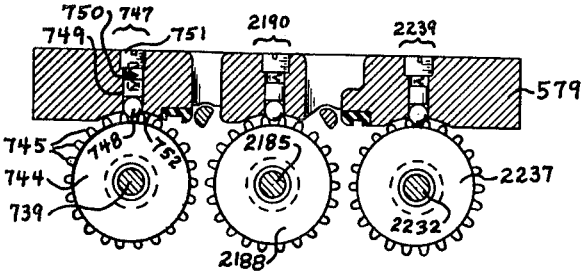

FIG. 41 is a sectional view of some of the tape feeding sprockets and detents therefor, taken on line 41—41 (FIG. 39).

Figure 42:
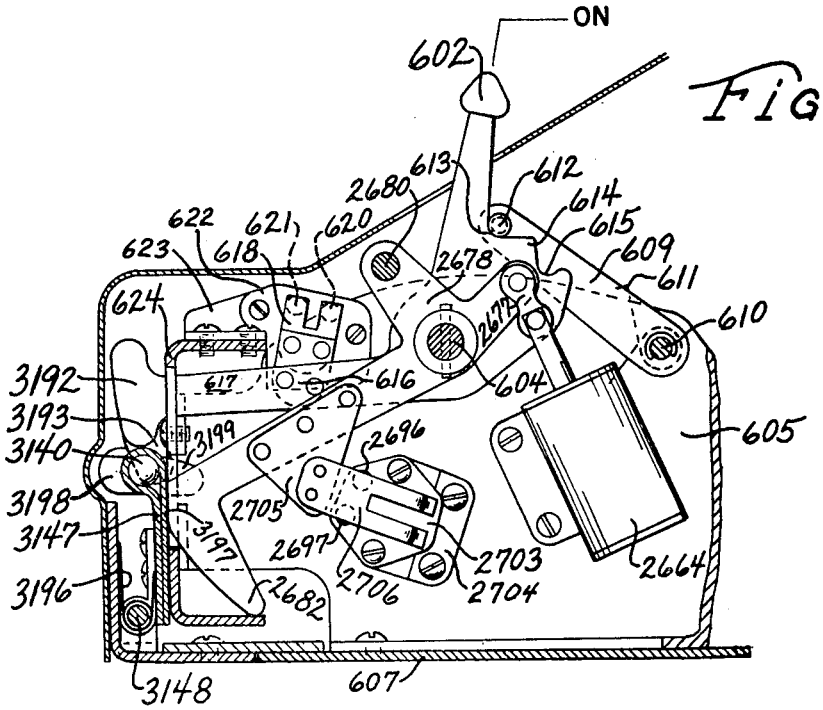
Figure 44:
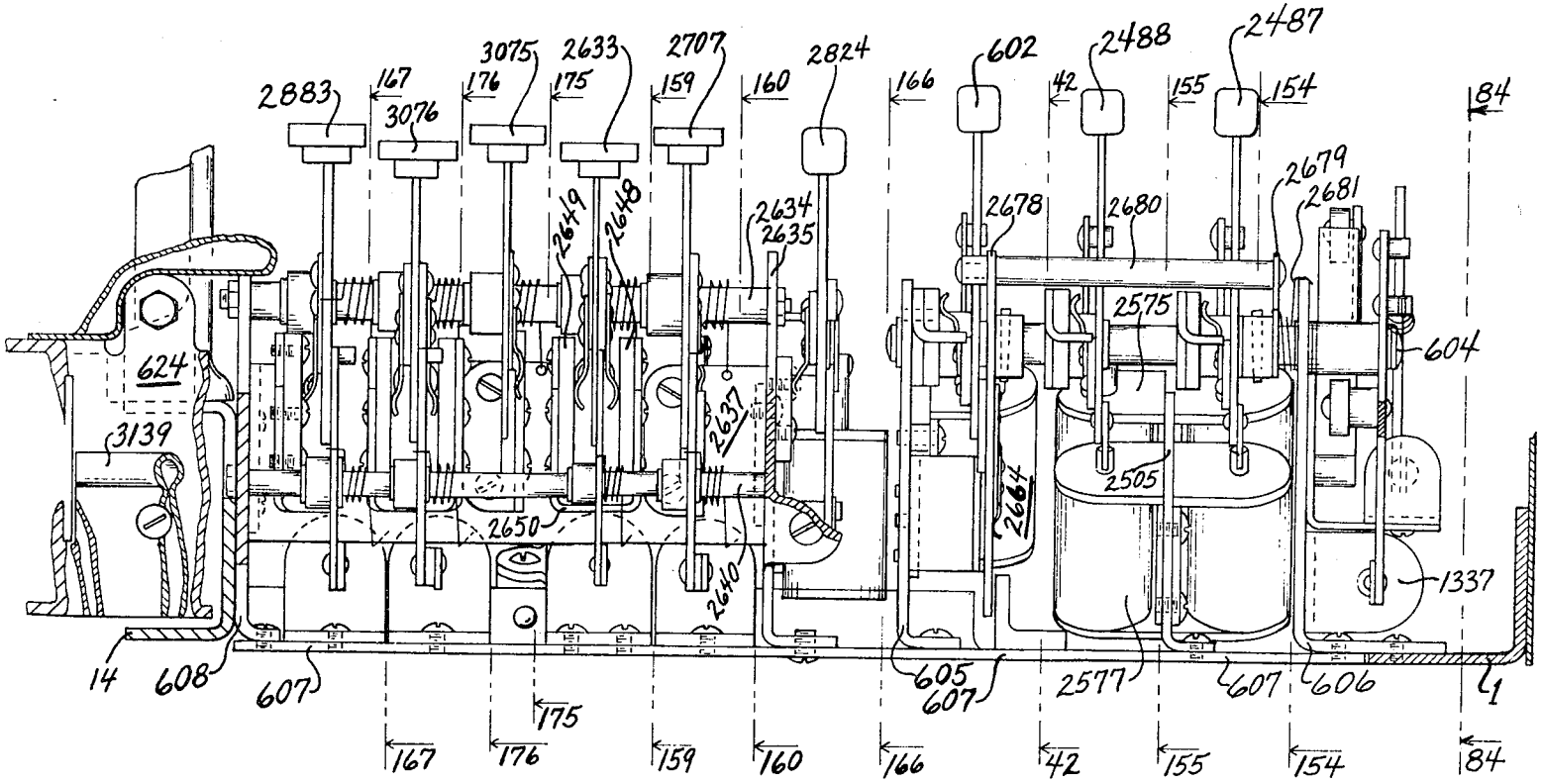

FIG. 42 is a fragmentary right sectional view of the punch control key, in "on" position, as seen generally from line 42—42 (FIG. 44).

Figure 43:
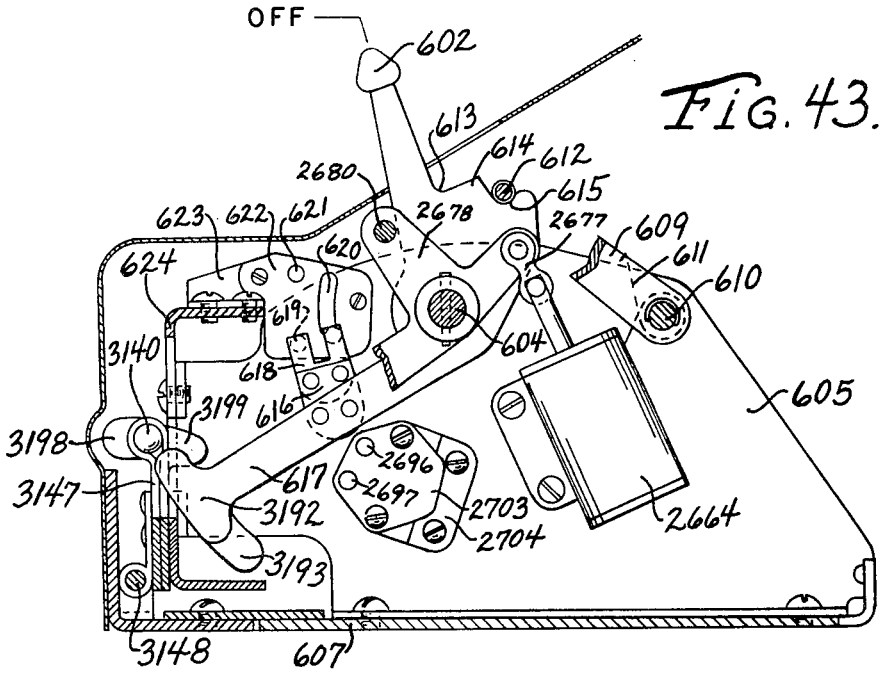

FIG. 43 is similar to FIG. 42, but it shows the punch control/key in "off" position.

Figure 3:
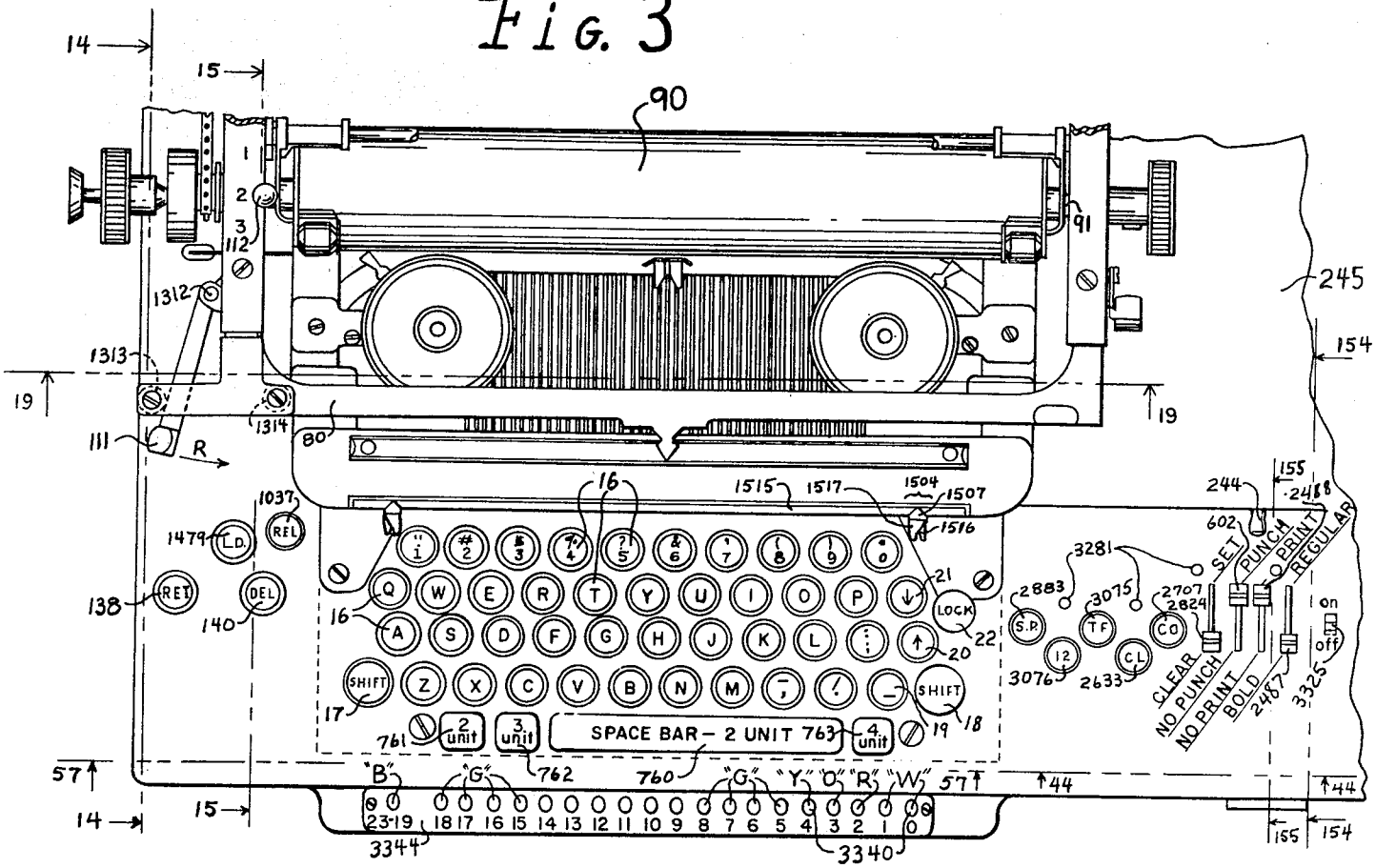
FIG. 3 is a fragmentary top view of the machine, showing primarily a portion of the paper carriage and the keys on the keyboard.

FIG. 44 is a fragmentary front view of the function control keys, located on the right side of the keyboard as viewed generally from line 44—44 (FIG. 3).

Figure 45:
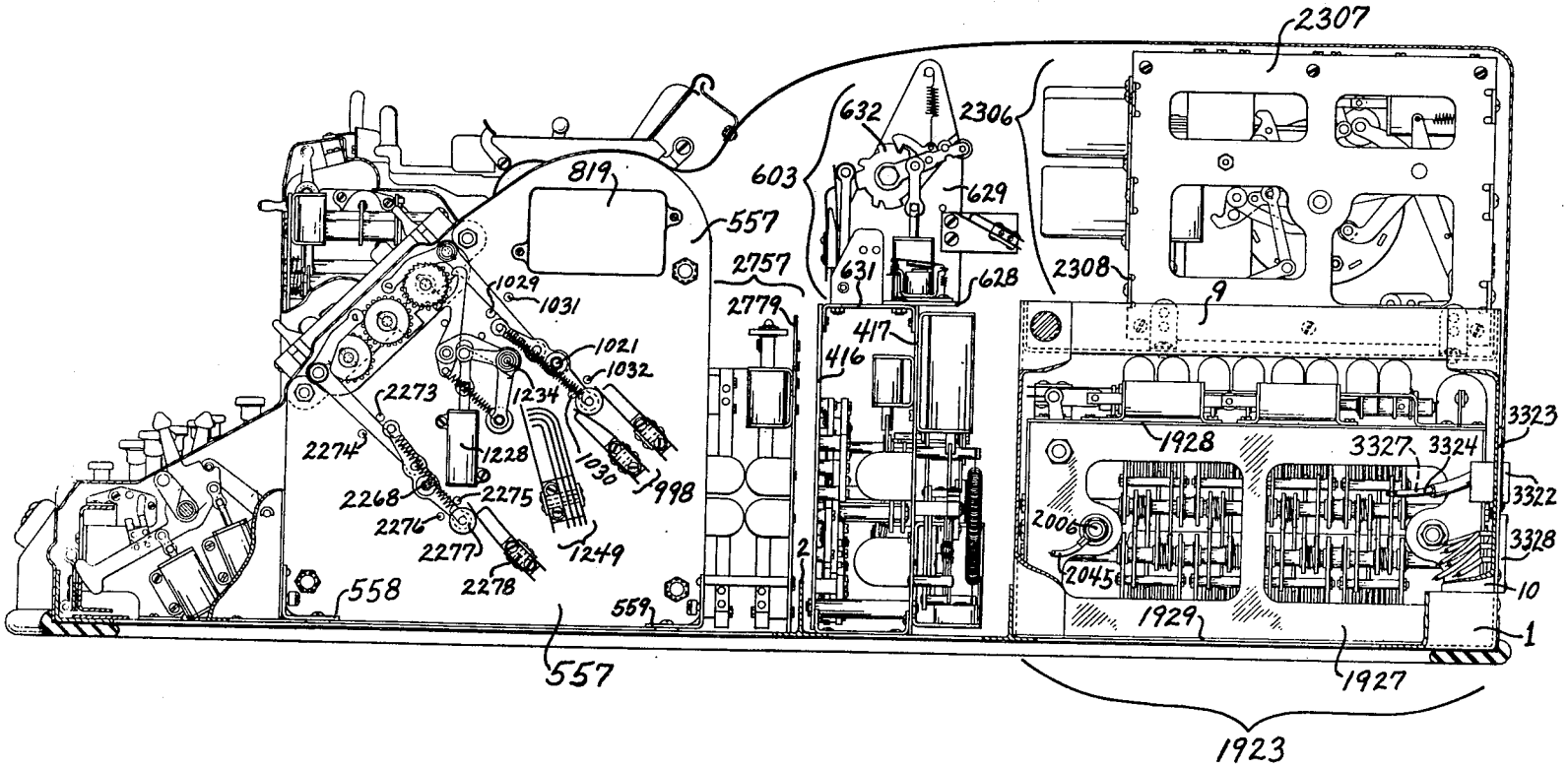

FIG. 45 is fragmented full right side elevation of the machine with the cover and various parts cut away to show greater detail.

Figure 46:
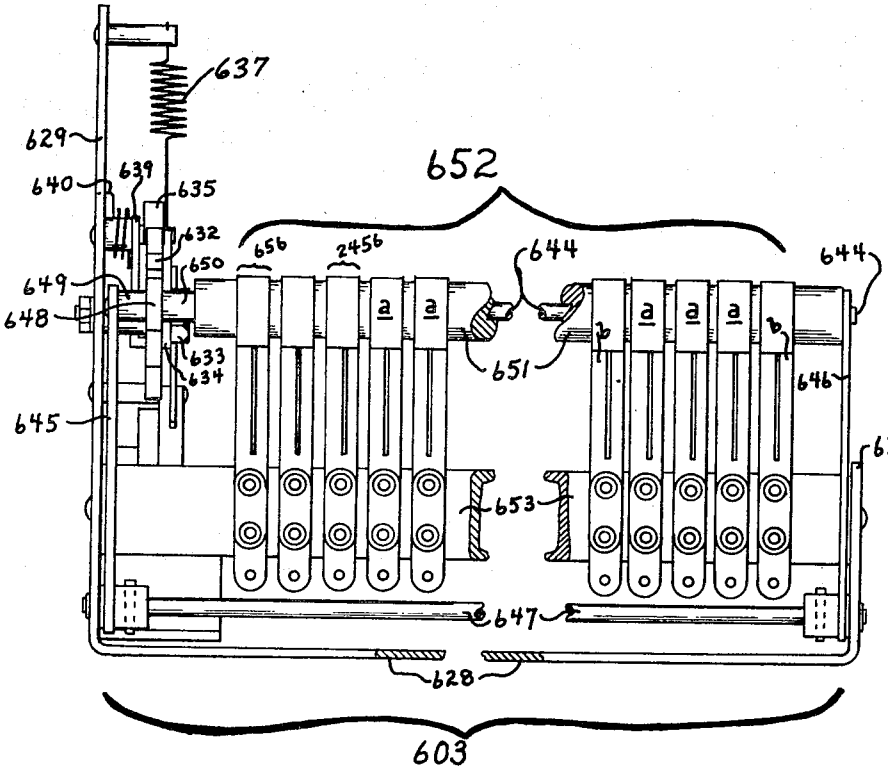

FIG. 46 is a fragmentary condensed full scale front view of the punch control relay 603, included in reduced scale FIG. 45.

Figure 47:
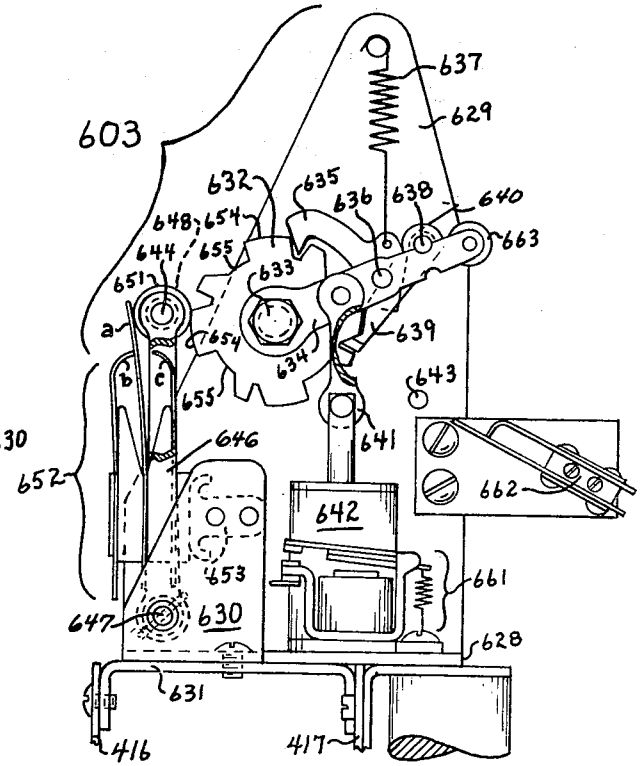

FIG. 47 is a fragmented full scale right side view of the punch control relay shown in FIG. 46.

Figure 48:
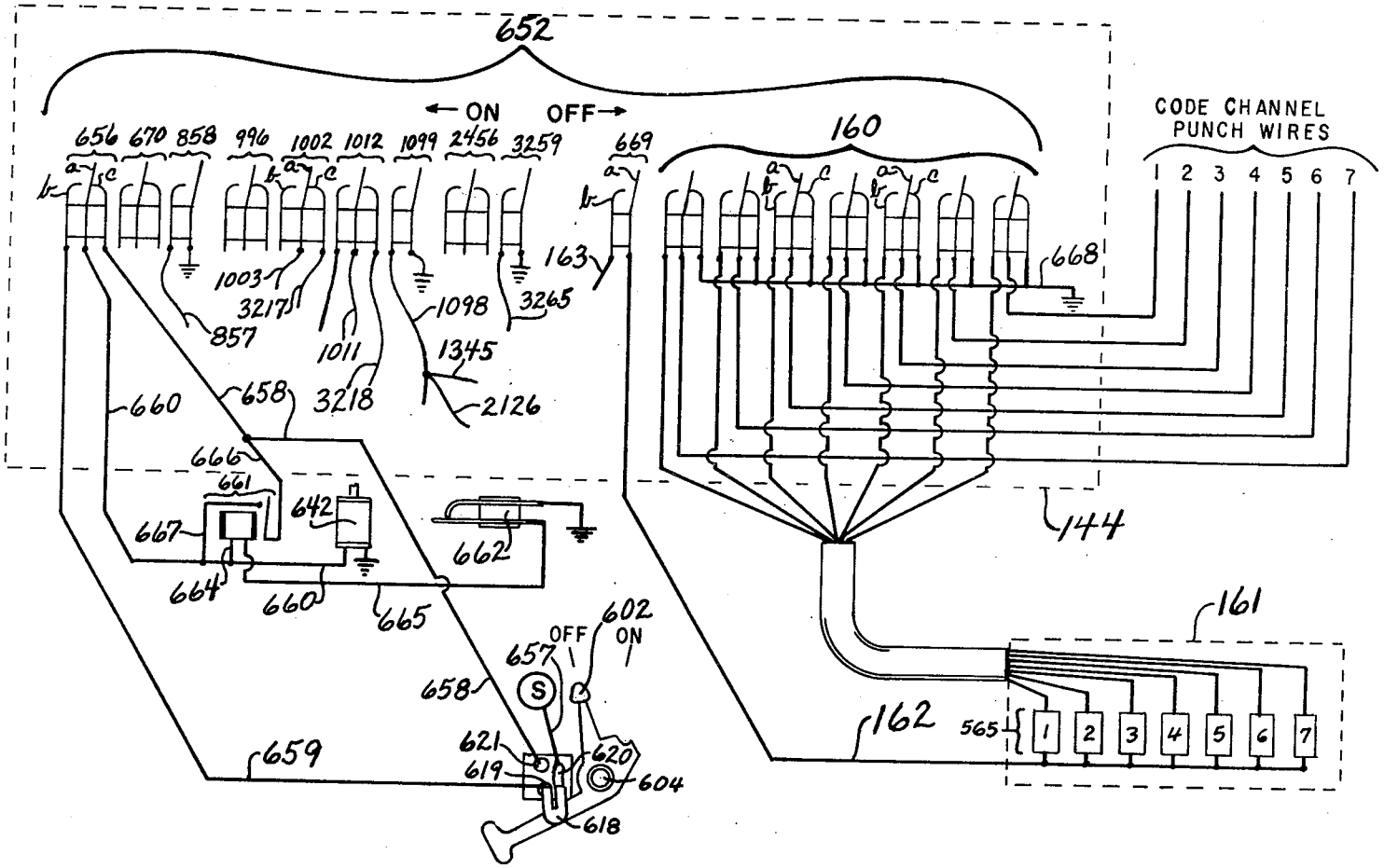

FIG. 48 is a schematic wiring diagram, showing primarily the punch control key arrangement in "off" position.

Figure 1:
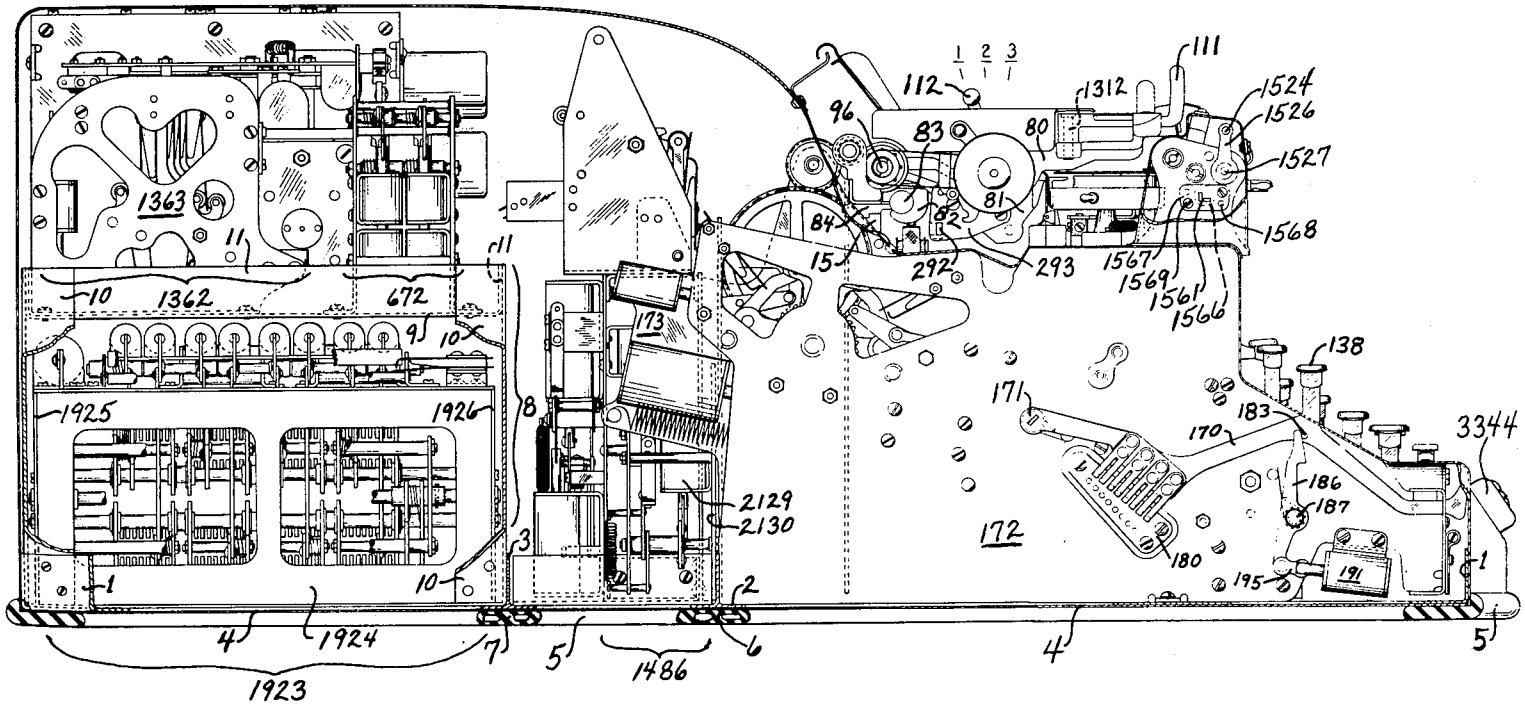
FIG. 1 is a reduced full left side elevation of the machine, with the cover fragmented to expose the mechanism immediately therebehind.
Figure 49:
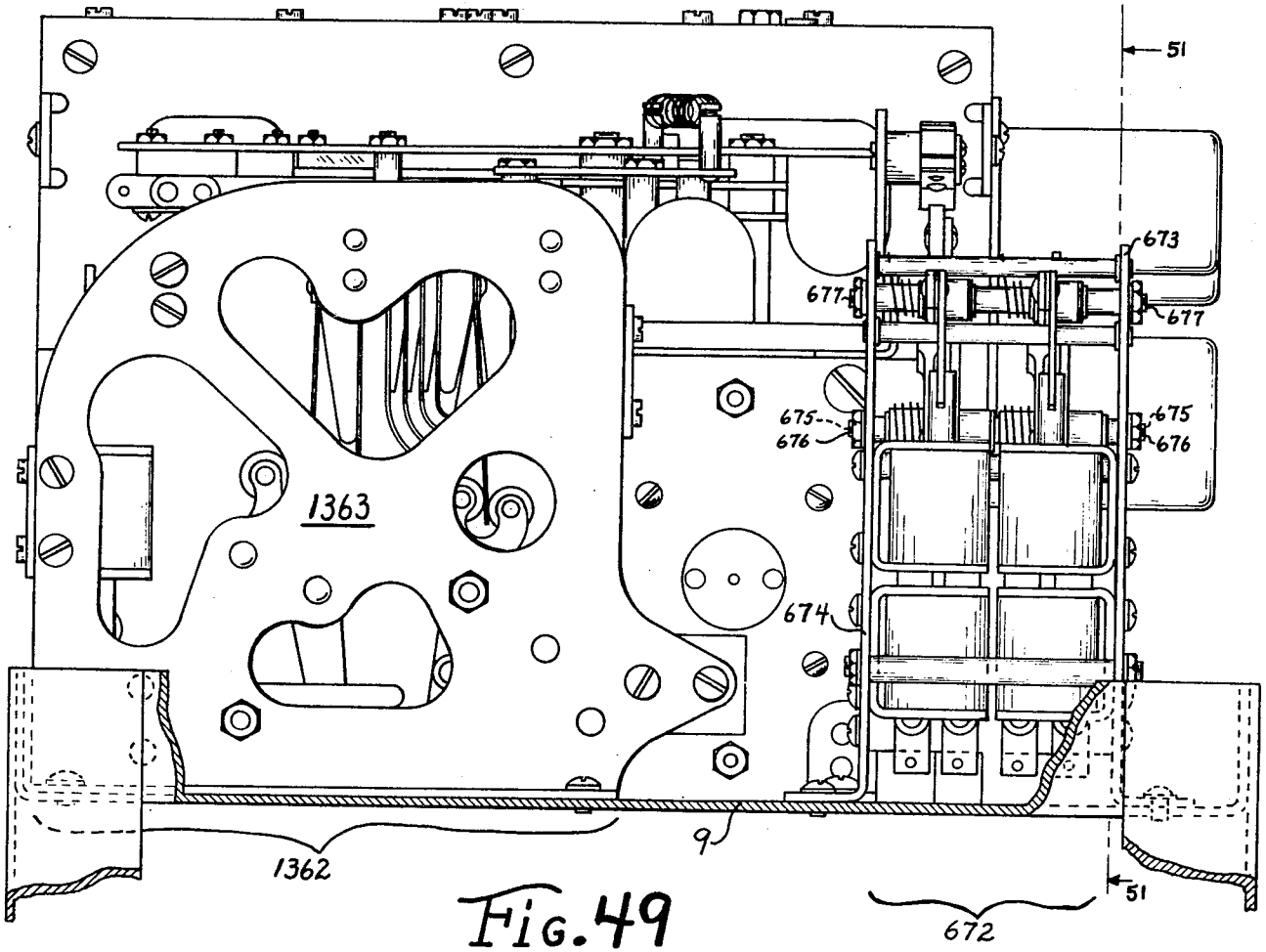

FIG. 49 is a full scale fragmented left side view of some of the mechanism shown in reduced scale in FIG. 1.

Figure 50:
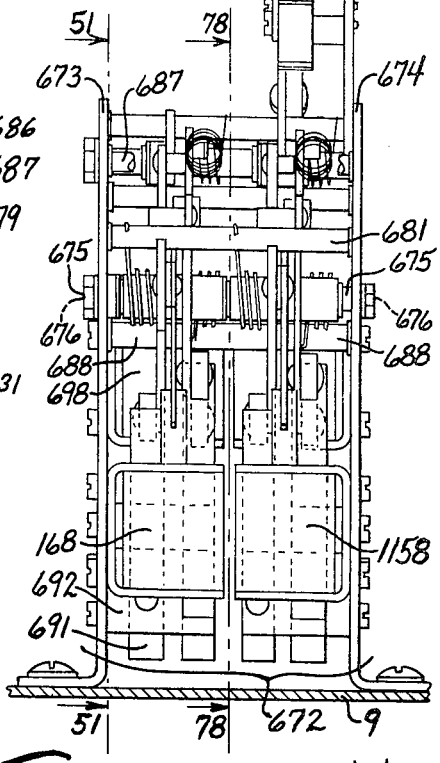

FIG. 50 is a full right side view of the forward and reverse tape cycling assembly 672, a left side view of which is included in FIG. 49.

Figure 51:
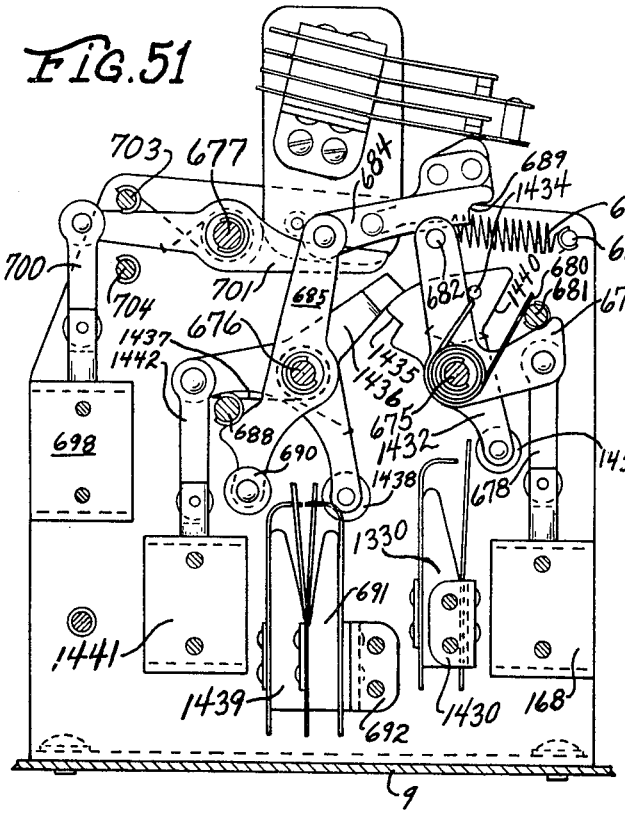

FIG. 51 is a sectional front view of the forward and reverse tape cycling assembly shown in FIG. 50. taken on line 51—51 (FIGS. 49 and 50).

Figure 52:
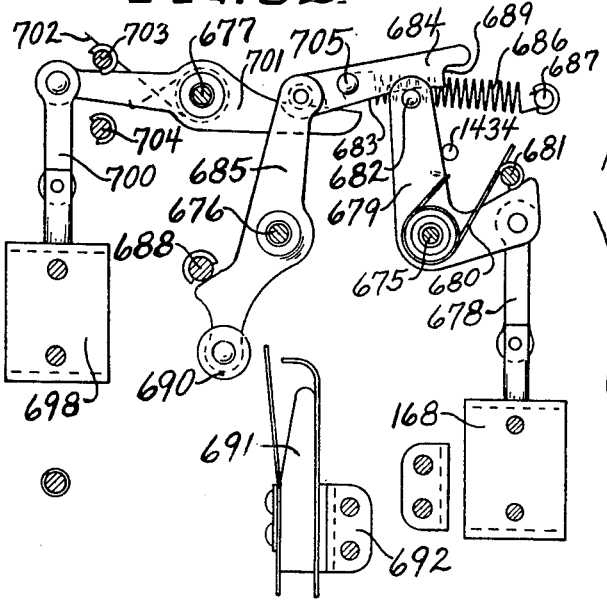

FIG. 52 is a sectional front view of the forward tape cycling mechanism, also shown in FIG. 51, but with some of the parts of this assembly omitted for clarity.

Figure 53:
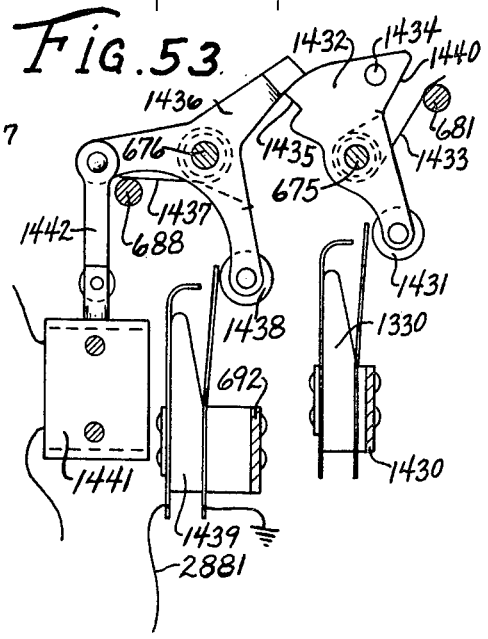

FIG. 53 is a front view of some of the forward tape cycling mechanism shown in FIG. 51 and omitted from FIG. 52.

Figure 54:
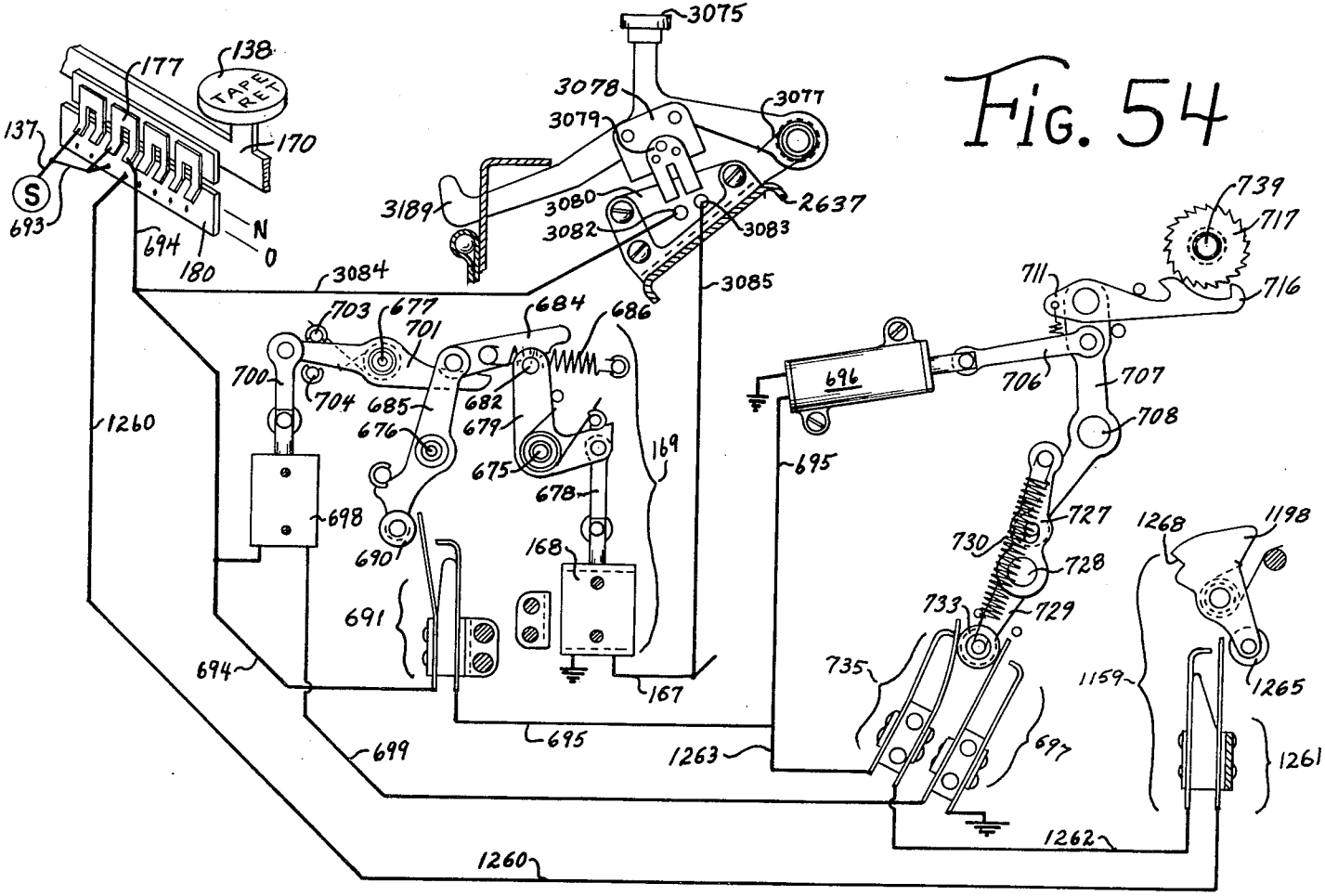

FIG. 54 is a schematic wiring diagram of the forward main-punch tape feeding circuit.

Figure 55:
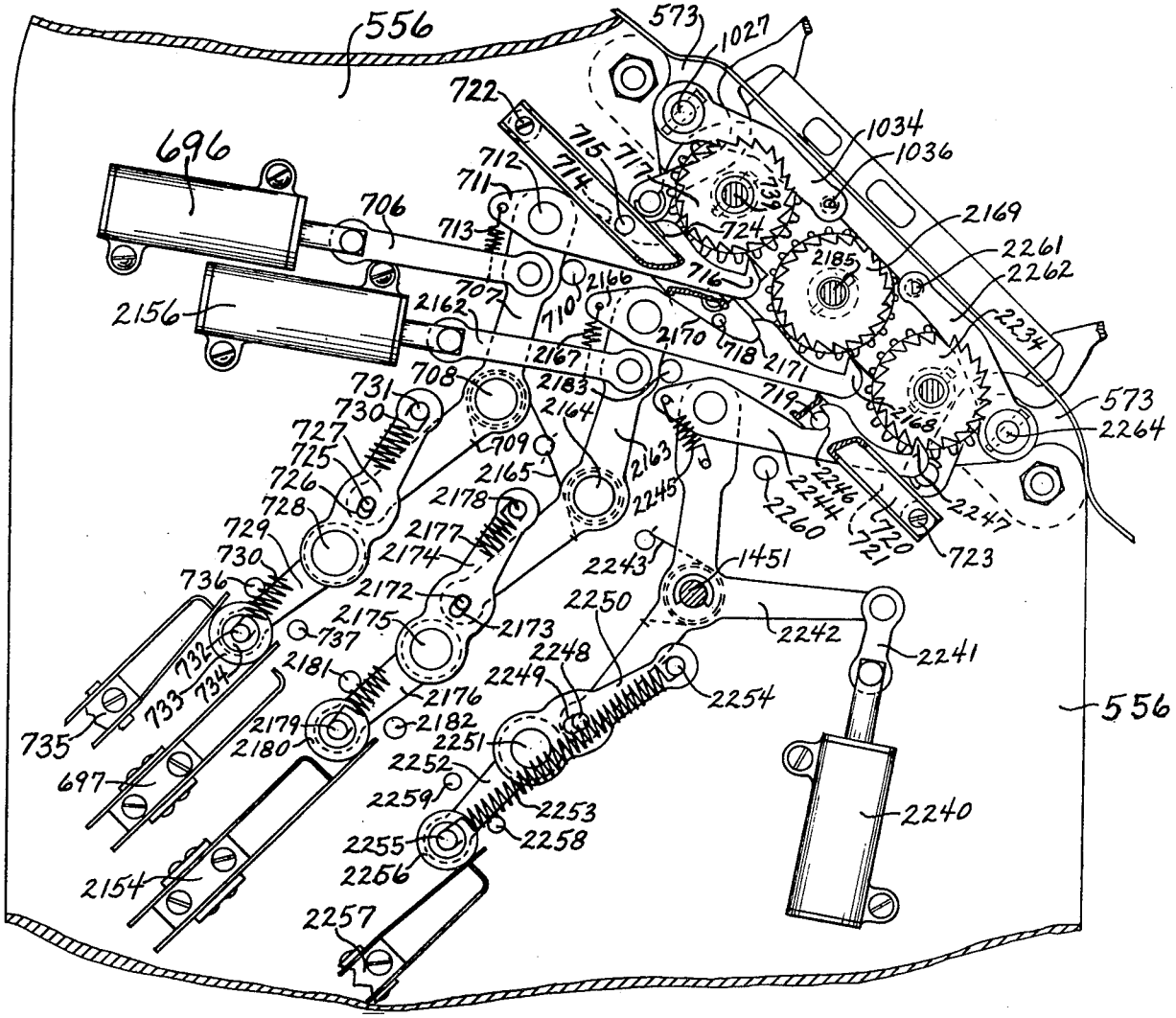

FIG. 55 is a fragmentary sectional elevation of the punch assembly, taken on line 55—55 (FIG. 36).

Figure 56:
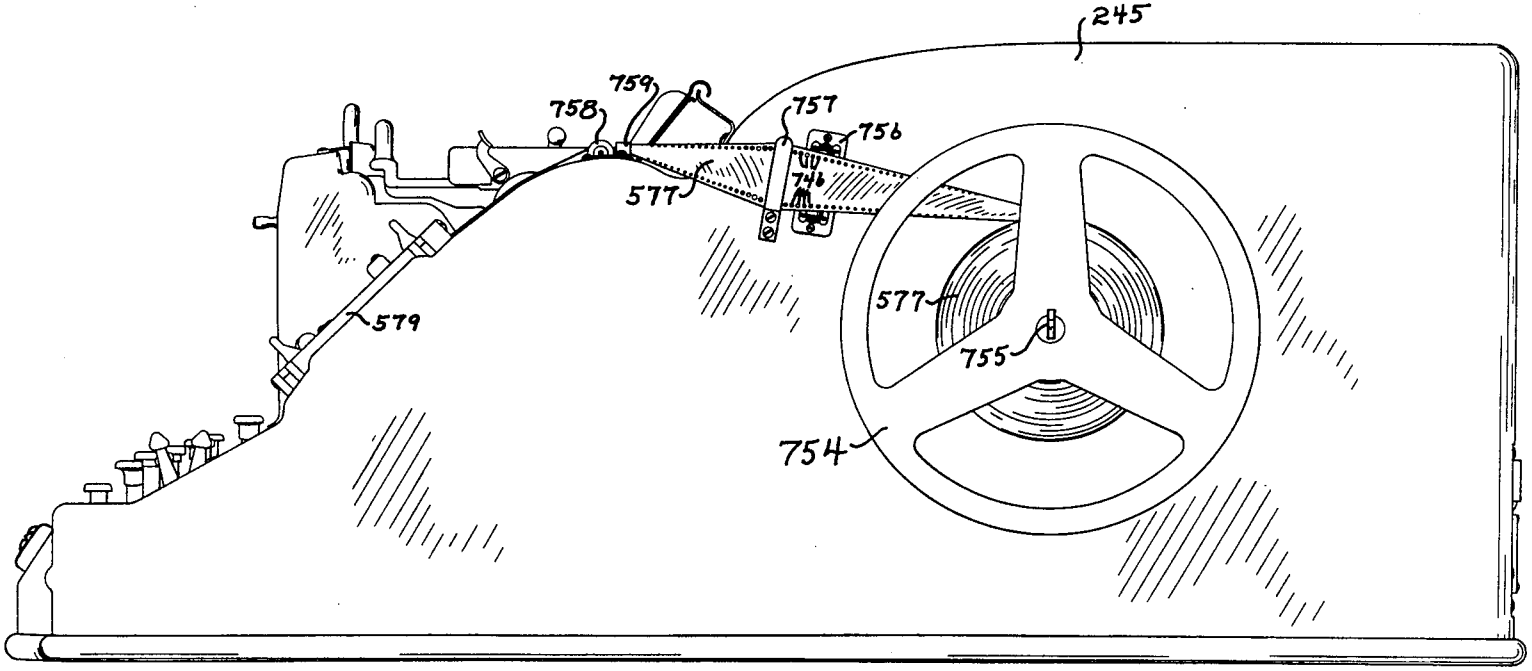

FIG. 56 is a reduced scale full right side elevational view of the machine.

Figure 57:
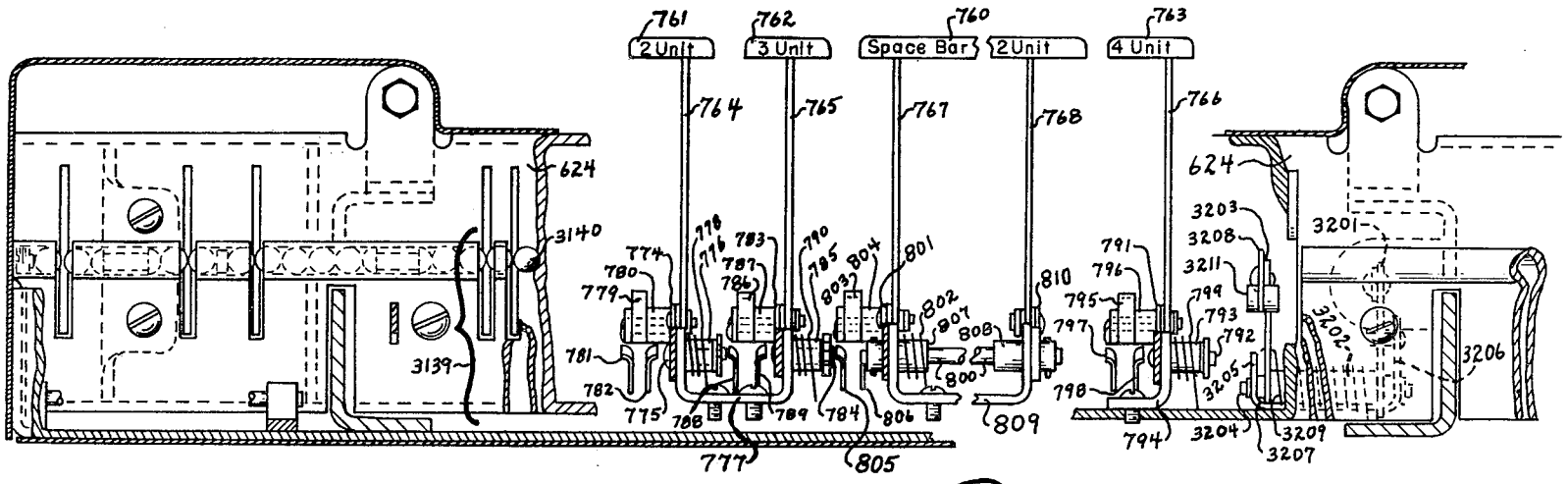

FIG. 57 is a condensed fragmentary front view, taken generally on line 57—57 (FIG. 3), showing primarily the space keys.

Figures 4, 5:
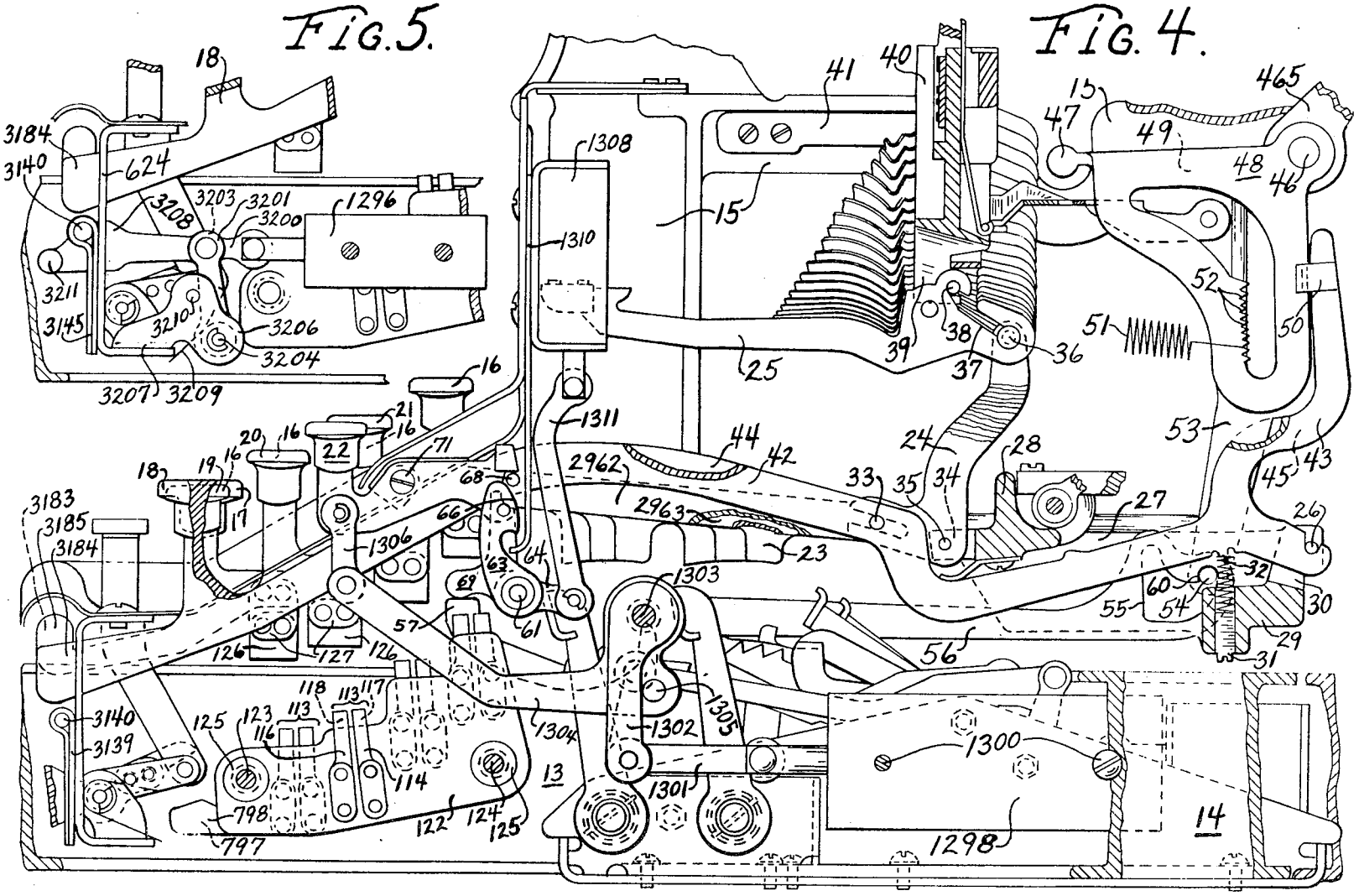
FIG. 4 is a fragmentary right sectional view of the machine taken on line 4–4, FIG. 2, showing primarily the internal parts and modifications of the standard typewriter, and electrical contacts under the character keys, but omitting some of the parts shown in FIG. 5 for clarity.
FIG. 5 is a fragmentary view showing parts omitted from FIG. 4.
Figure 58:
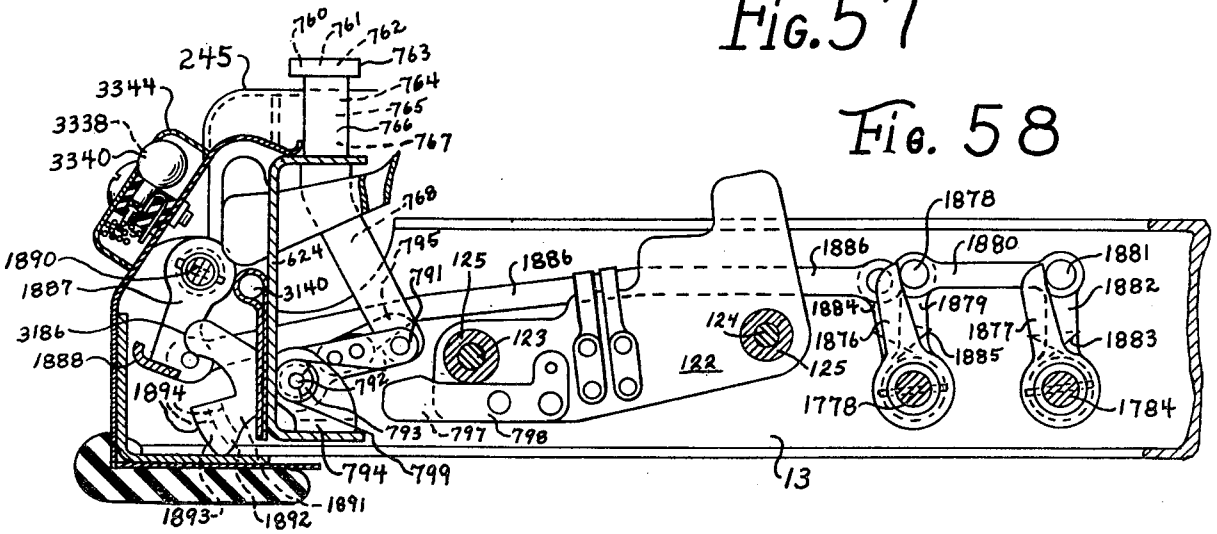

FIG. 58 is a fragmentary right side view of the space keys, and including some of the space key locks and some of the mechanism shown in FIG. 4.

Figure 59:
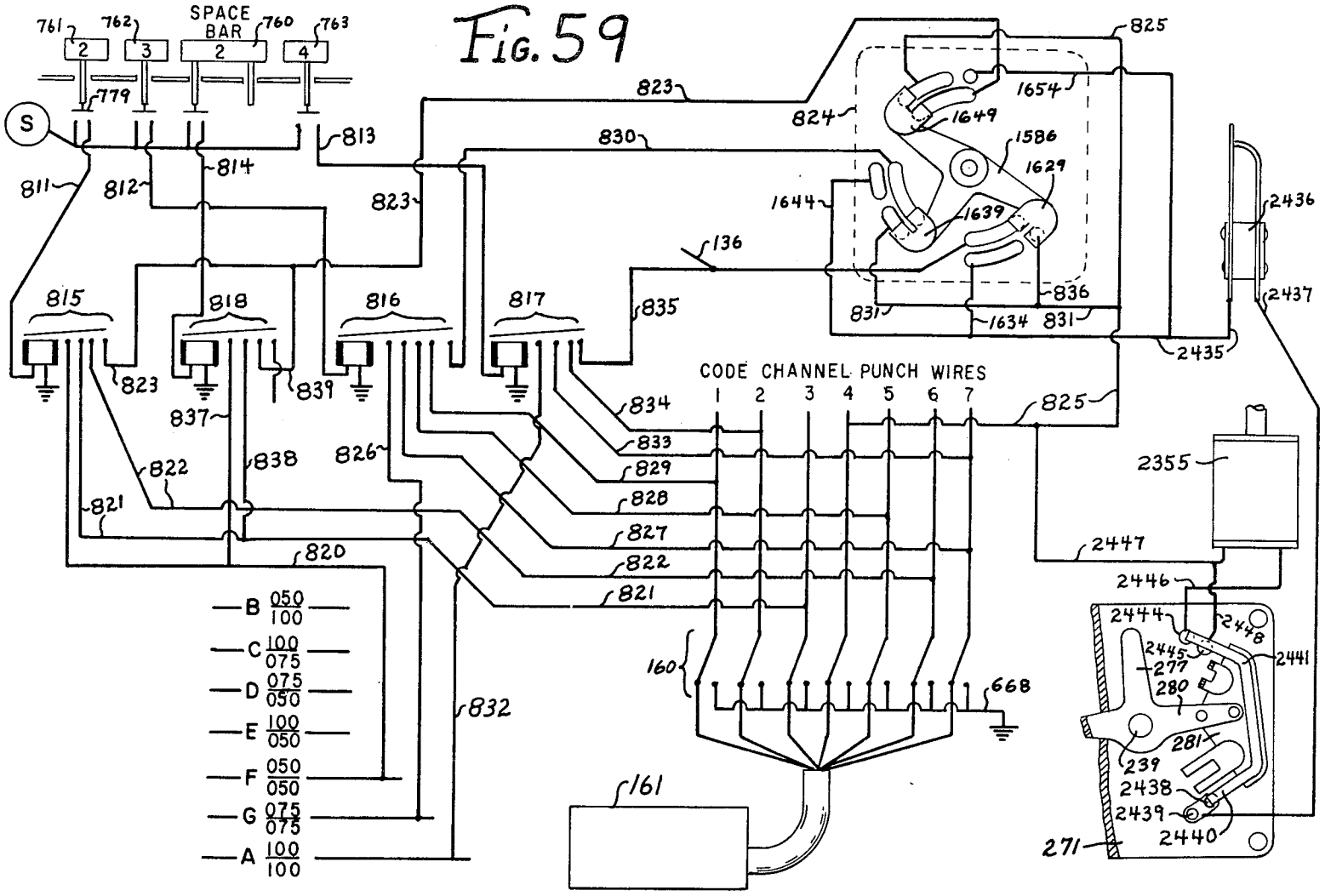

FIG. 59 is a schematic wiring diagram showing the space key circuits.

FIG. 60 is a fragmentary view showing the space key relays and their mounting, with a protective cover 819 (FIG. 45) cut away to show the relays thereunder.

FIG. 61 is a fragmented front sectional elevation of the word space counter, taken on or about line 61—61 (FIG. 18), showing primarily means for counting 17 to 160 word spaces.

Figure 62:
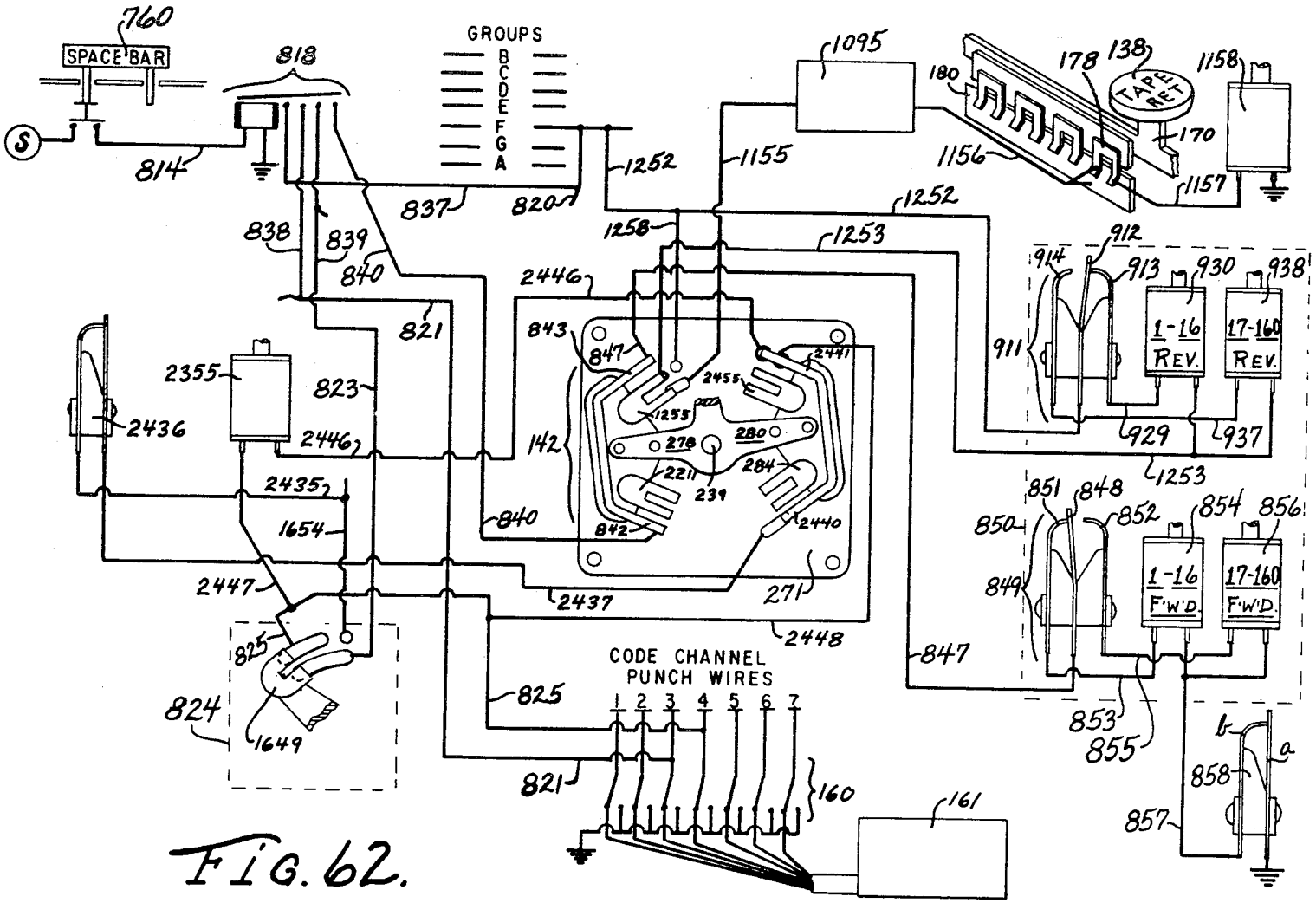

FIG. 62 is a schematic during diagram, showing particularities of the circuit for word space bar and for word space counting.

FIG. 63 is a front sectional elevation of a word space counter, taken generally on line 63—63 (FIG. 18), showing primarily a front view of a brush carrier member and forward counting switch.

FIG. 64 is a front sectional elevation of the word space counter, taken generally on line 64—64 (FIG. 18), showing primarily electrical contacts with which the brushes in FIG. 63 cooperate.

Figure 65:
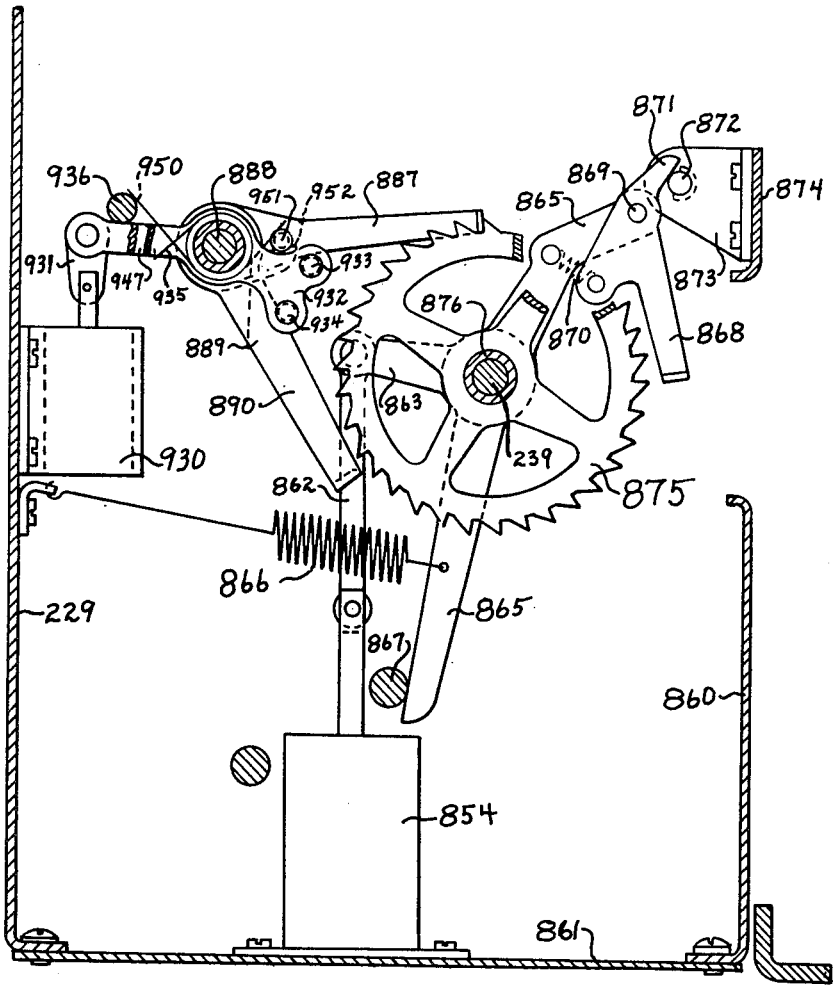

FIG. 65 is a front sectional elevation of the word space counter, taken generally on line 65—65 (FIG. 18), showing primarily means for counting 1 to 16 word spaces.

Figure 66:
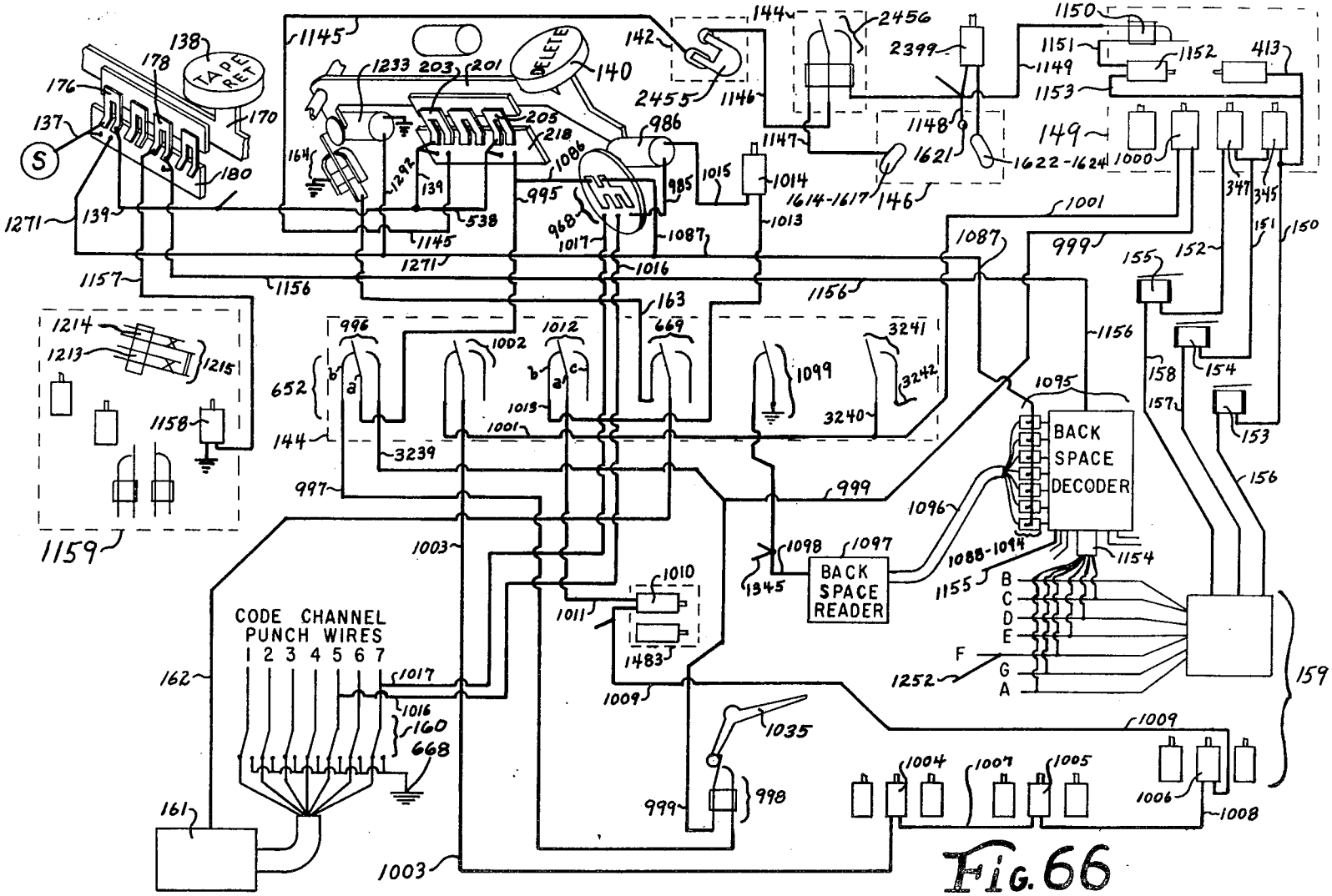

FIG. 66 is a schematic wiring diagram, showing primarily delete key and tape return key circuits, and other automatically initiated circuits involved with back spacing, deleting and reverse tape handling operations.

Figure 67:
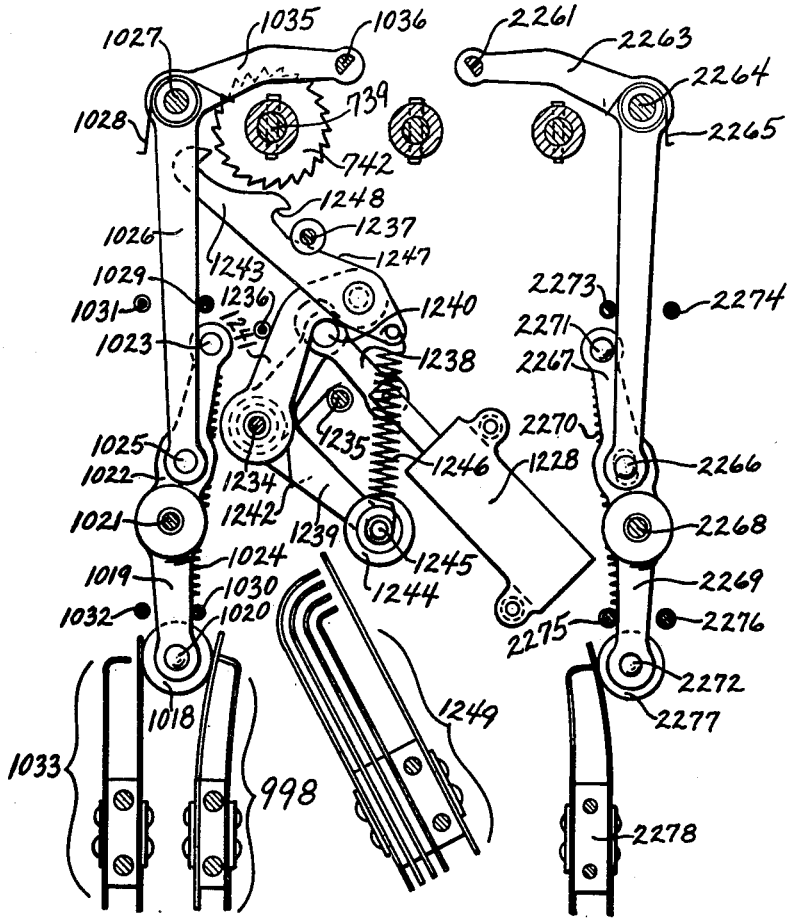

FIG. 67 is a left sectional elevation of part of the tape handling assembly, taken generally on line 67—67 (FIG. 36), and showing primarily slack tape controlled switch means, reverse tape feeding means and the delete switch.

Figures 15, 16:
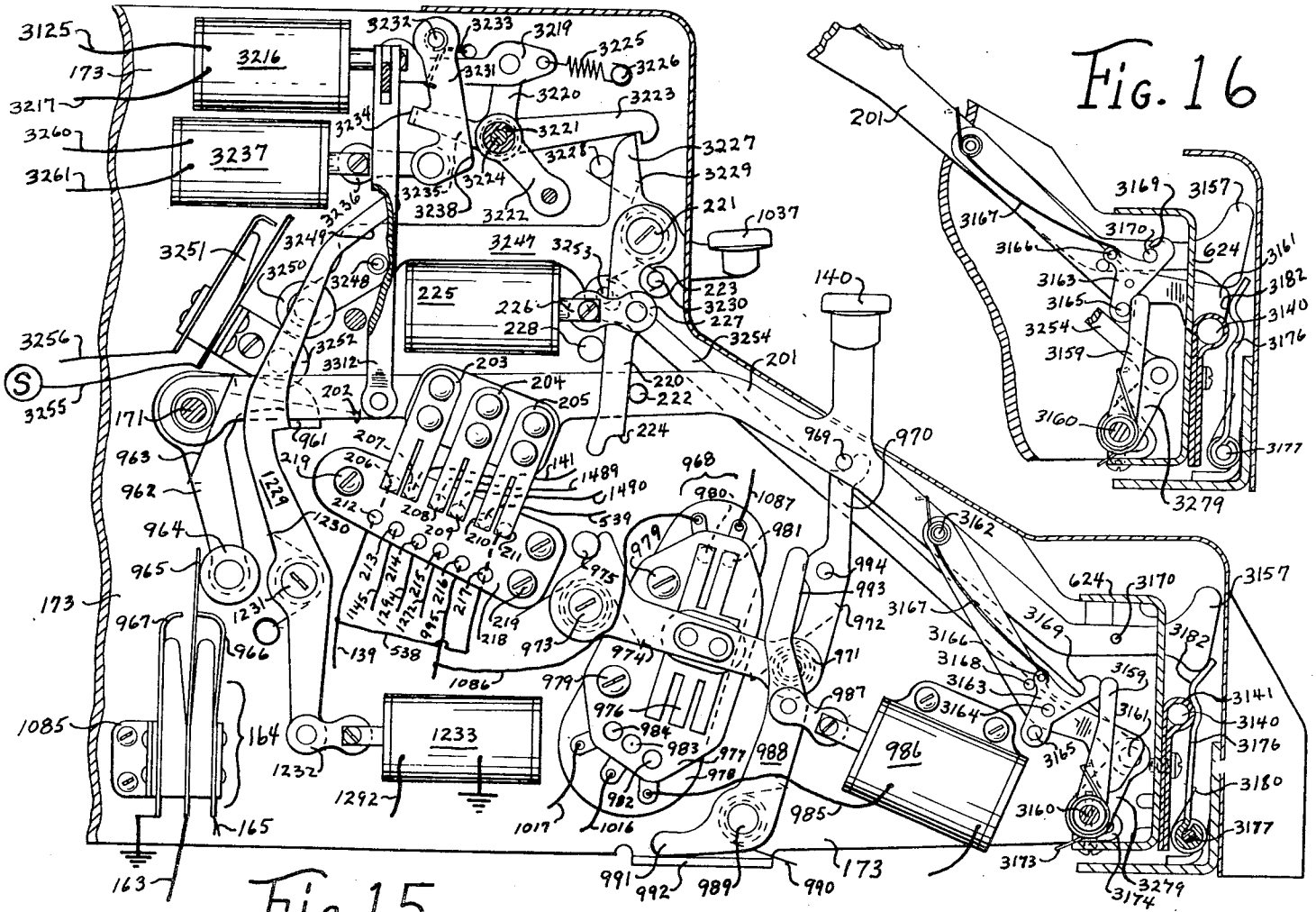
FIG. 15 is a fragmentary sectional left side elevational view, taken generally on line 15—15, FIG. 3, showing primarily the delete key.
FIG. 16 is a fragmentary view illustrating the operated positions of some of the parts shown in FIG. 15.
Figures 68, 69:
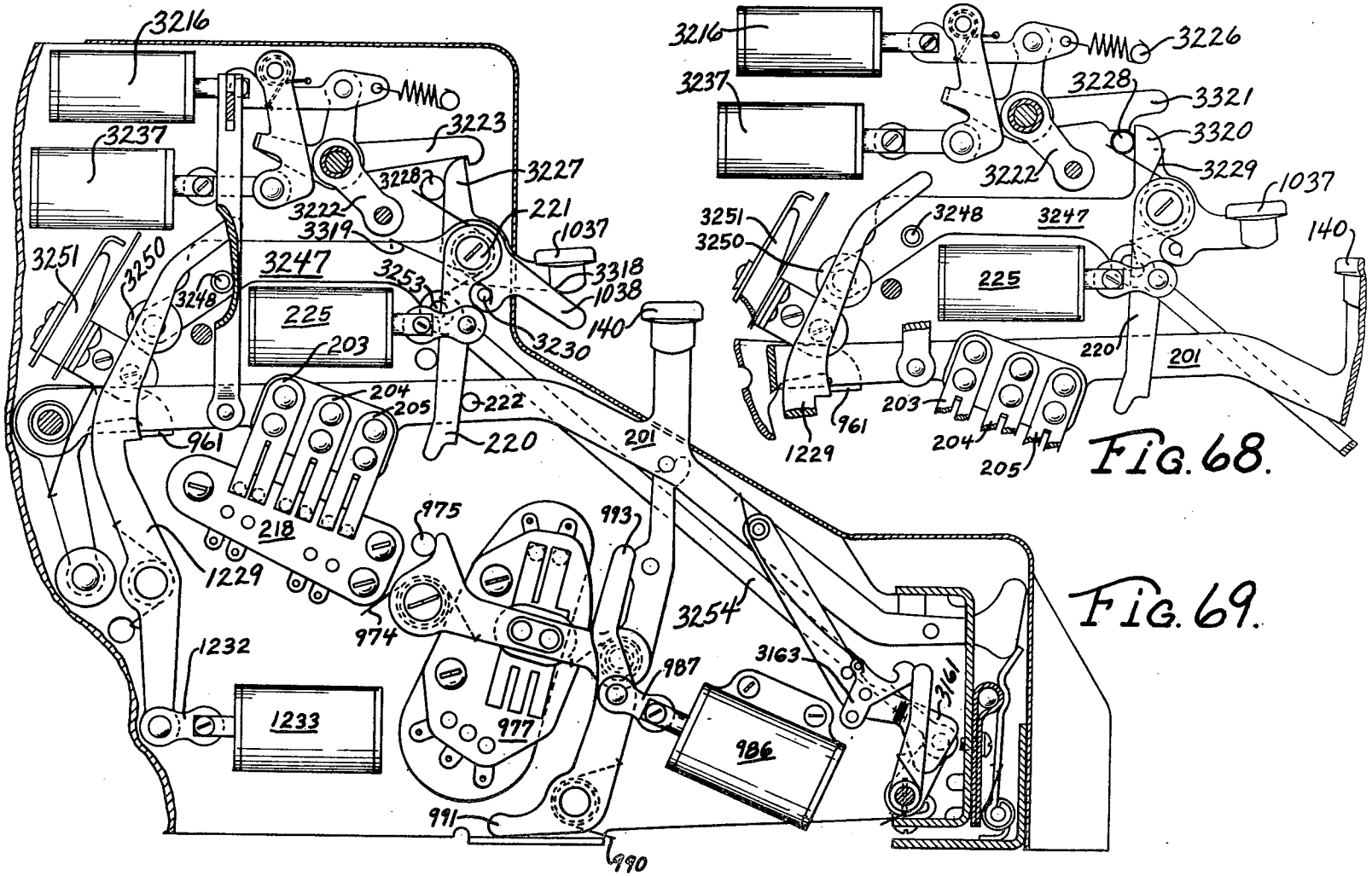

FIG. 68 is a fragmentary left side view, showing primarily a modification of the backspace release key 1037 shown in FIG. 15.

FIG. 69 is a fragmentary sectional left side elevational view, taken generally on line 15—15, FIG. 3 showing another modification of the back space release key 1037.

Figure 70:
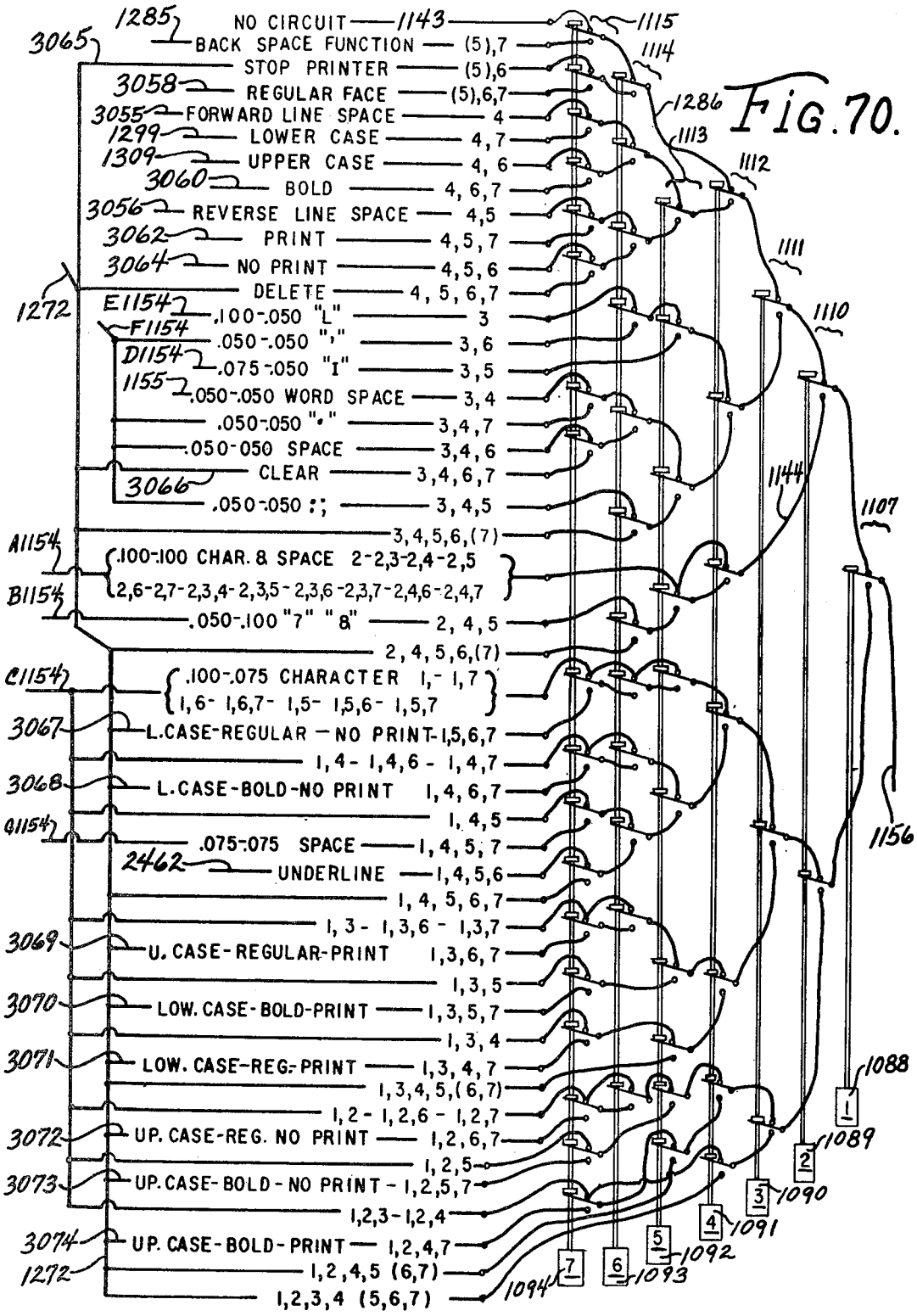

FIG. 70 is a schematic diagram of the back space decoder.

Figures 71, 72:
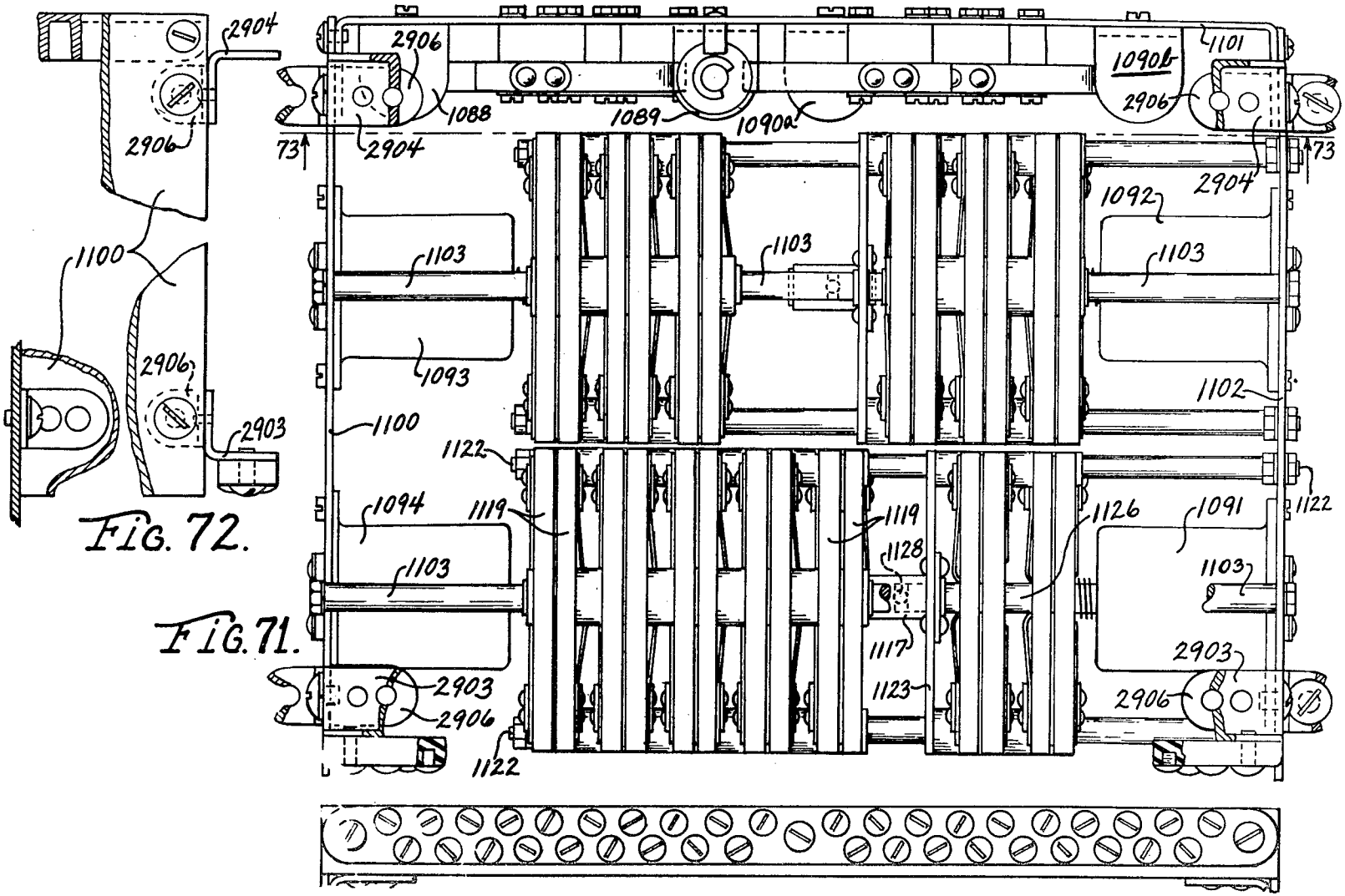

FIG. 71 is a detailed top view of the back space decoder with some of the parts fragmented for clarity.

FIG. 72 is a fragmentary left side view of the mechanism shown in FIG. 71, showing primarily the mounting and support branches for the back space decoder.

Figures 73, 74, 75:
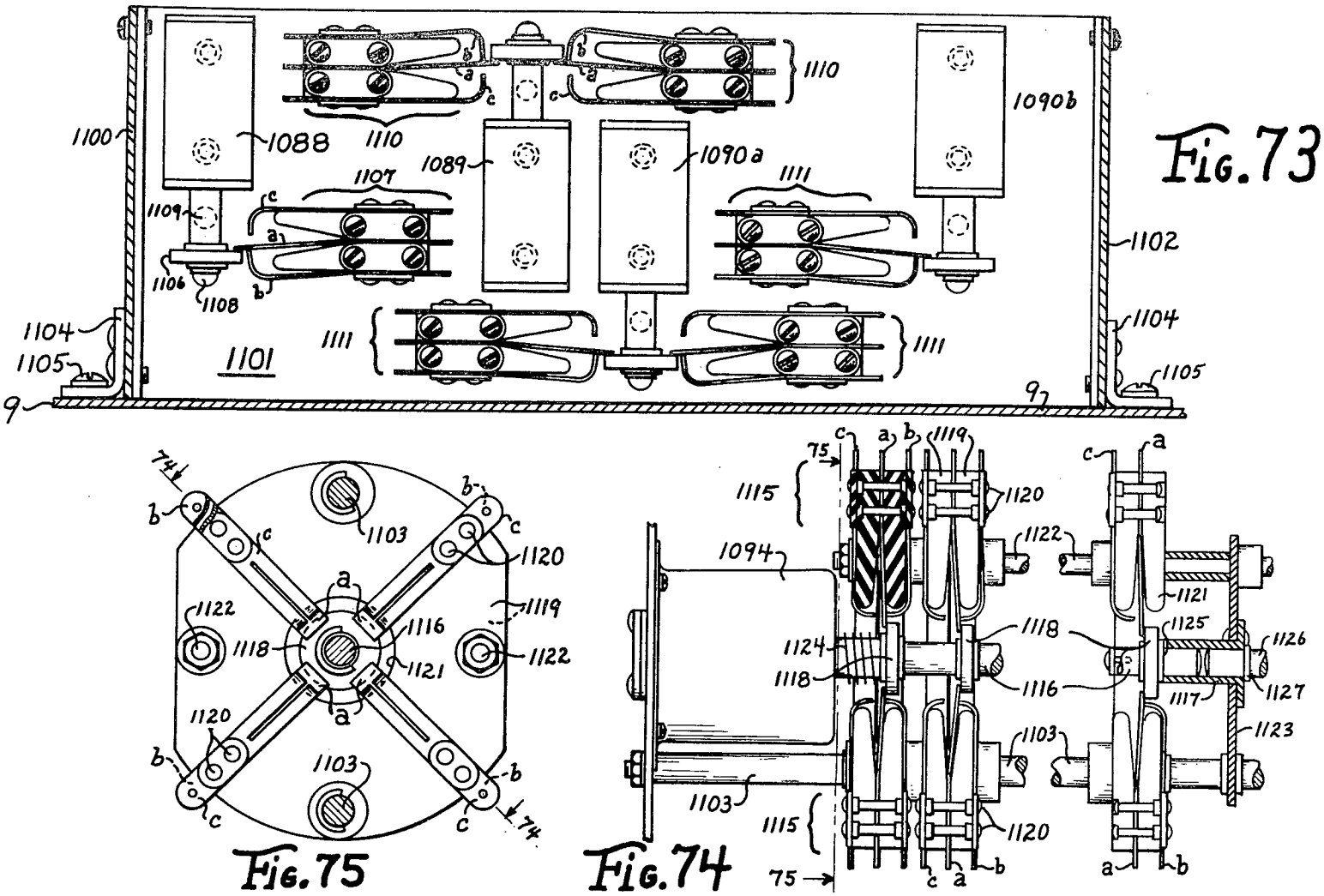

FIG. 73 is a front sectional view of the back space decoder taken on line 73—73 (FIG. 71).

FIG. 74 is a condensed fragmentary view of part of the mechanism shown in FIG. 71 with some of the decoder switch means sectioned on line 74—74 (FIG. 75).

FIG. 75 is a fragmentary sectional view of the decoder switch means taken for example on line 75—75 (FIG. 74).

FIG. 76 is a fragmentary front view showing greater detail of some of the mechanism shown also in FIG. 23.

FIG. 77 is a fragmentary front view of some of the mechanism found also in FIG. 23, but the mechanism shown here is in operated position.

Figure 78:
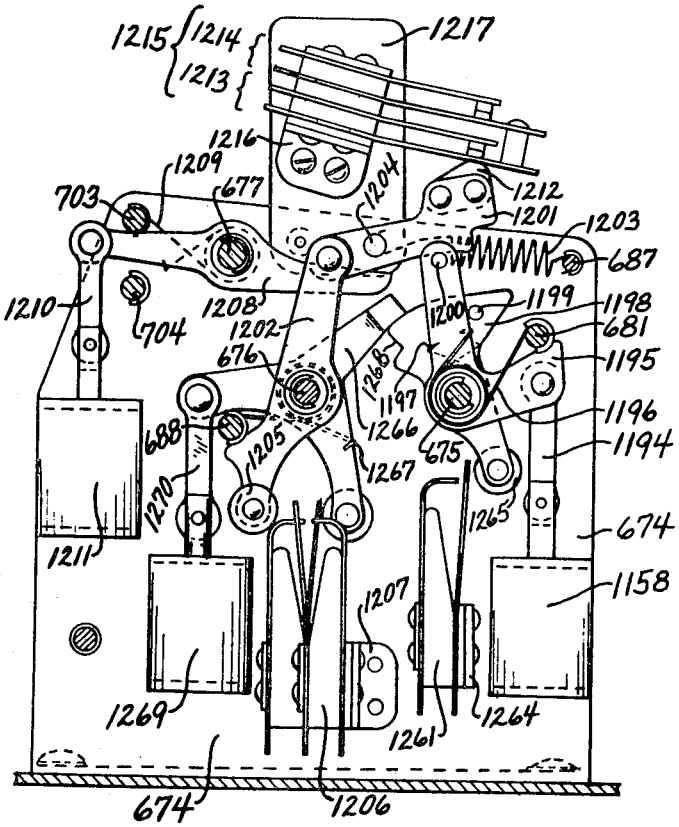

FIG. 78 is a front sectional view of the reverse tape cycling mechanism, as seen from line 78—78 (FIG. 50) and as also shown in the background of FIG. 51.

Figure 79:
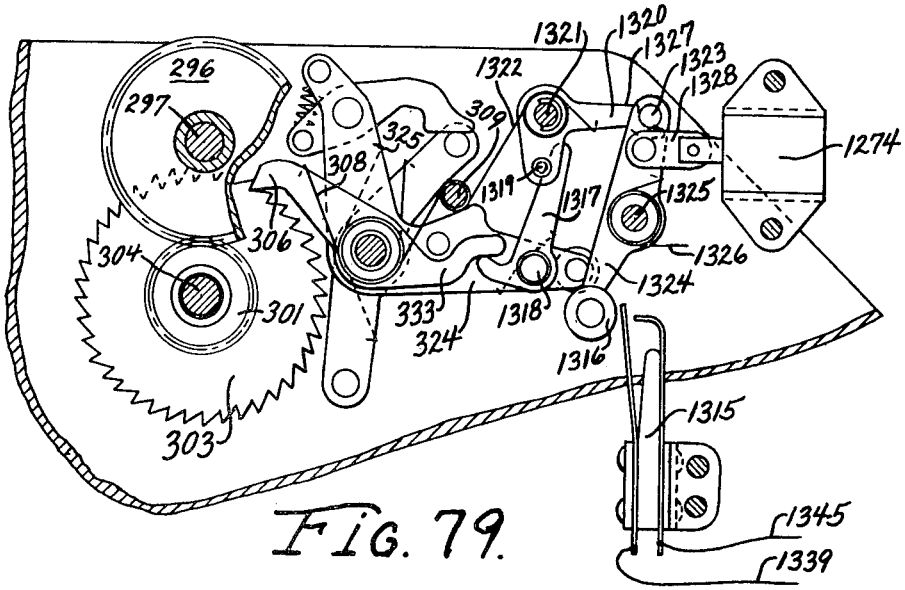

FIG. 79 is a fragment of the carriage escapement mechanism shown in FIG. 23, showing primarily the main detent means and carriage return switch means with greater clarity.

Figure 80:
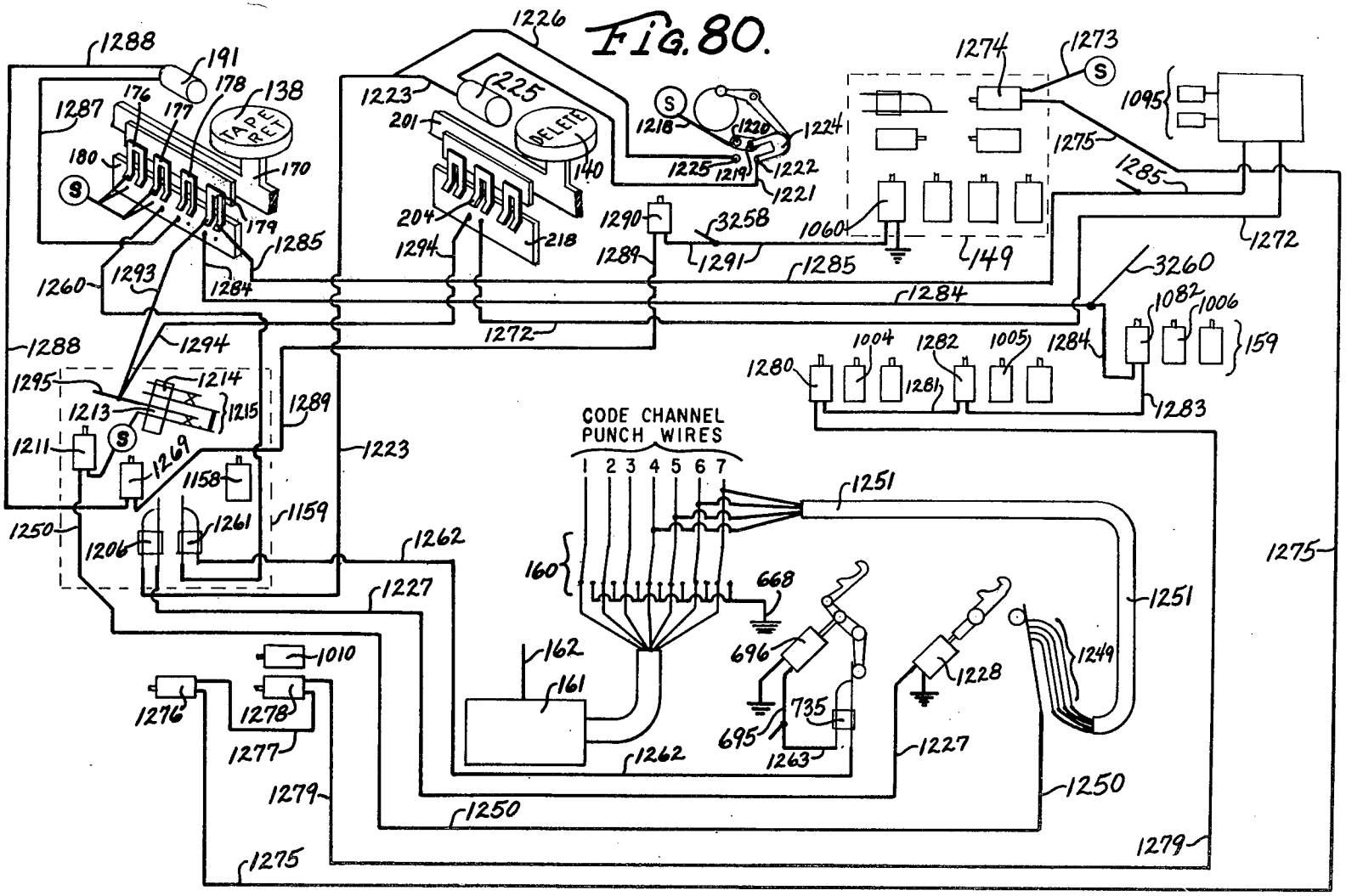

FIG. 80 is a schematic wiring diagram showing primarily tape return circuits and other normalizing circuits that are employed following deleting operations.

Figure 81:
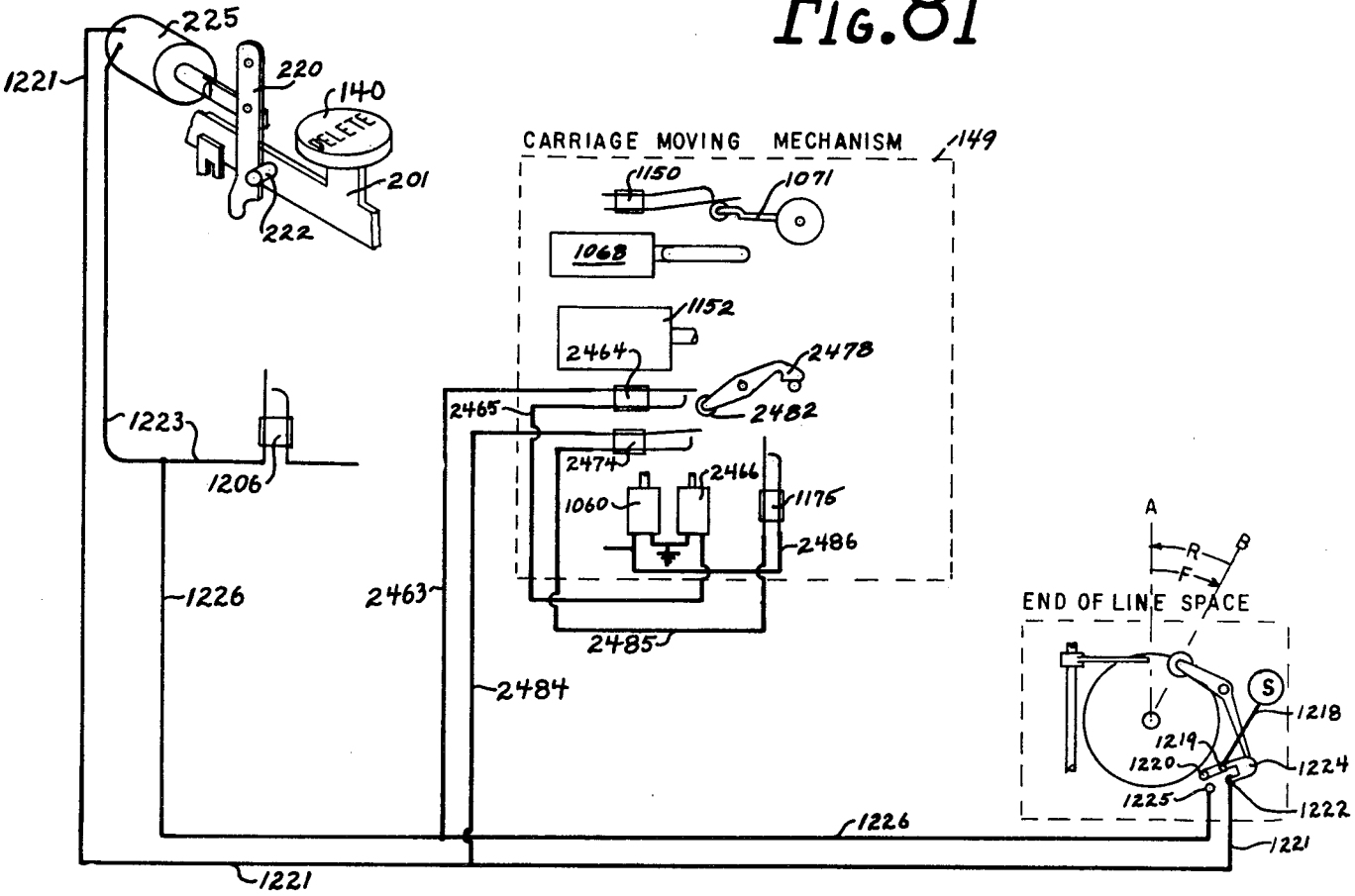

FIG. 81 is a schematic wiring diagram showing primarily some of the circuitry for preventing the occurrence of a word space, a nut space or an underline mark at the end of a justifiable line.

Figure 82:
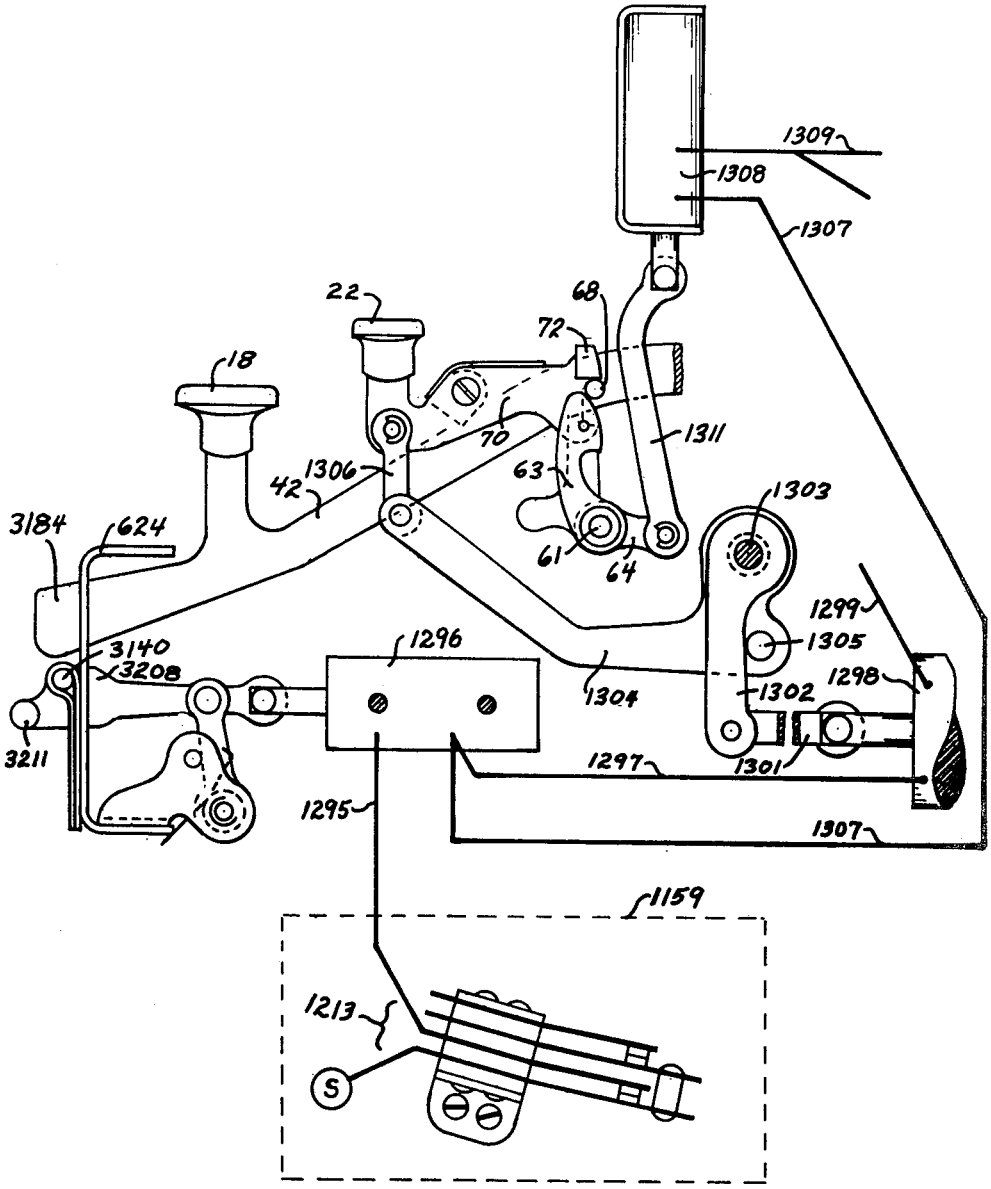

FIG. 82 is a schematic wiring diagram showing some of the circuitry involved with the Clear Key and the Conditioning Key.

Figure 83:
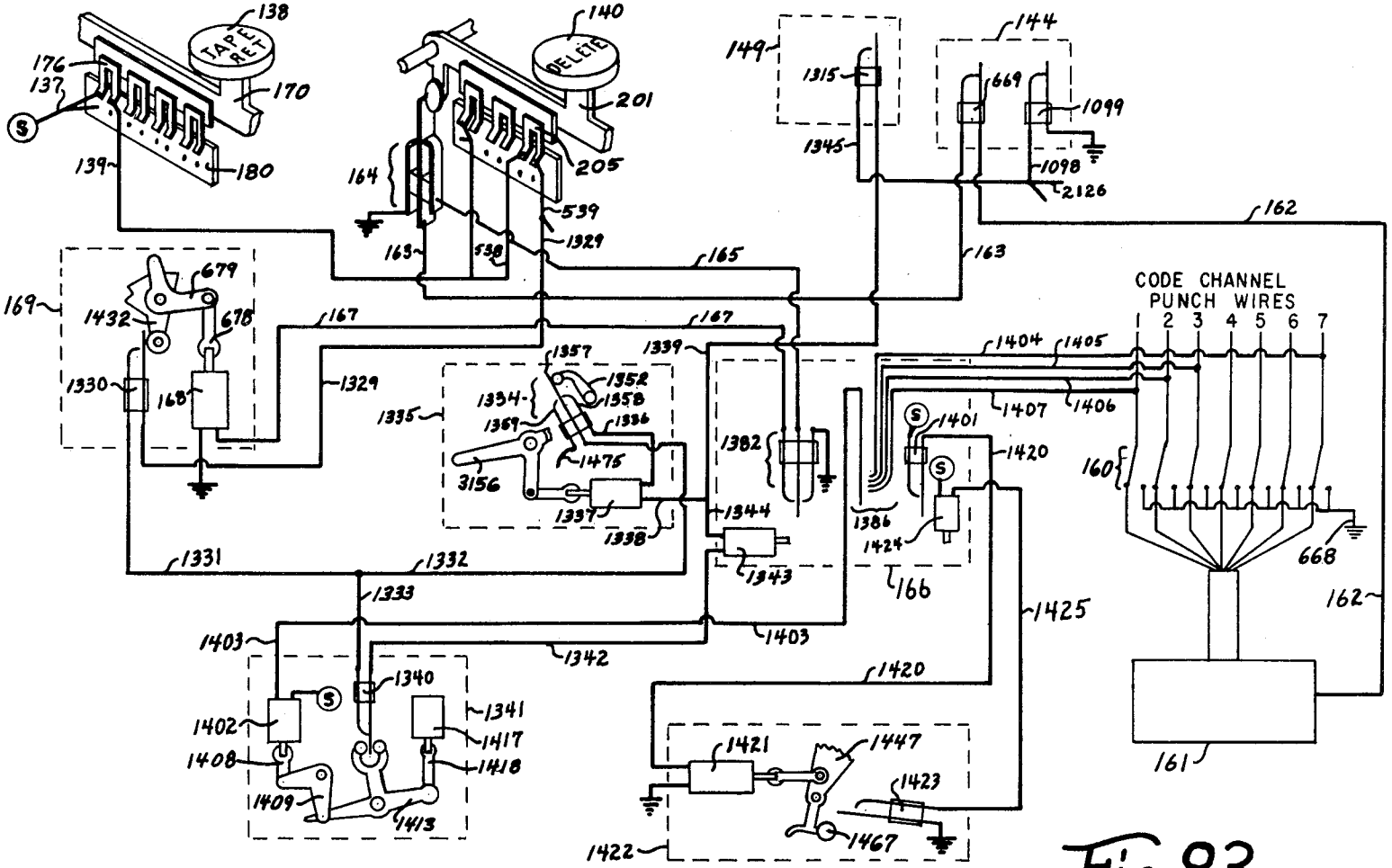

FIG. 83 is a schematic wiring diagram of the preliminary carriage return circuits, including the carriage return encoding arrangement.

Figure 84:
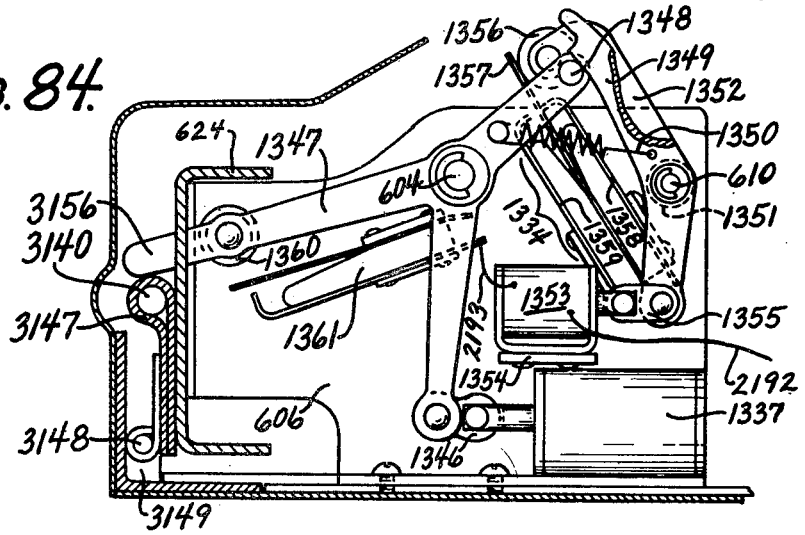

FIG. 84 is a right side fragmentary view of the keyboard ball-lock interposer mechanism, as seen from line 84—84, FIG. 44.

Figure 85:
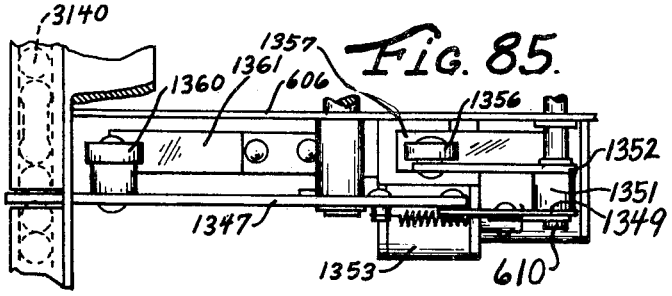

FIG. 85 is a fragmentary top view of the mechanism shown in FIG. 84 with the cover removed.

Figure 86:
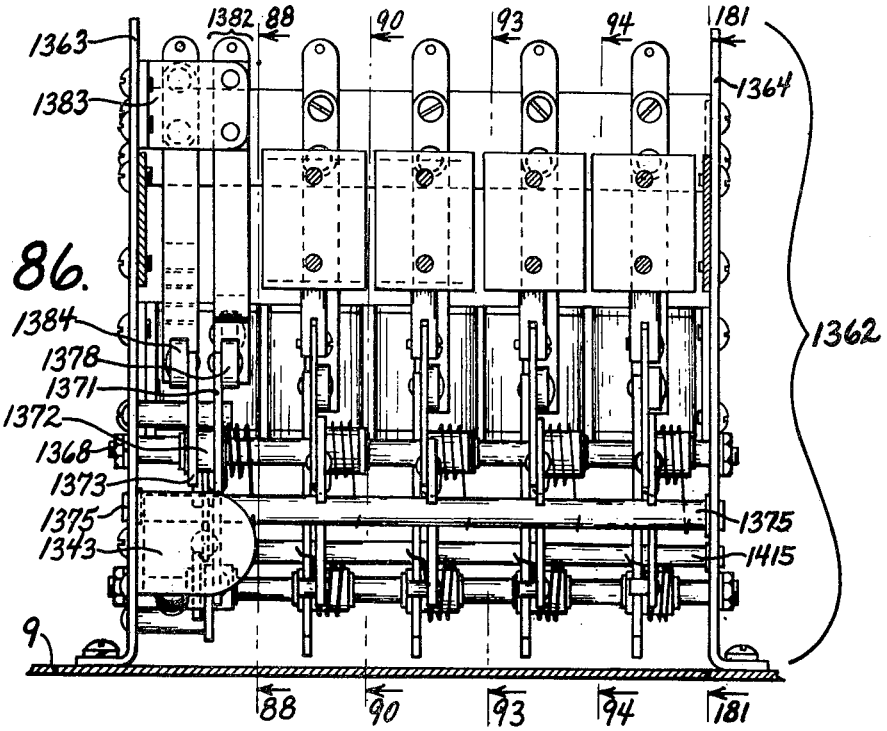
Figure 87:
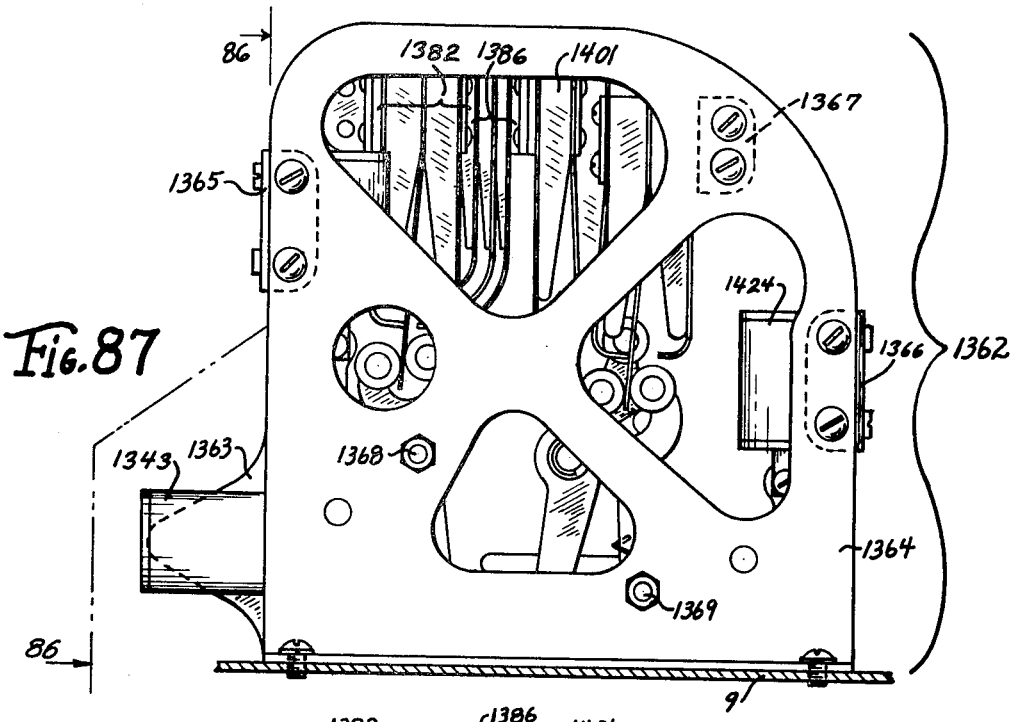
Figure 88:
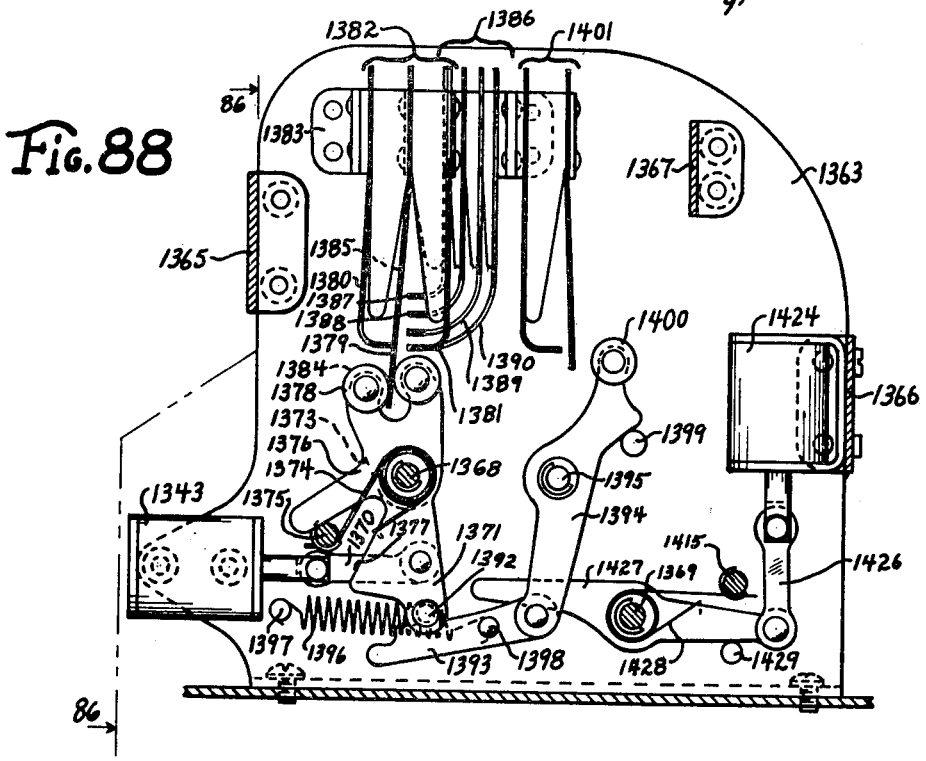

FIG. 86 is a fragmentary front view of a cycling control assembly 1362 as viewed from line 85-86, FIGS. 87 and 88, shown also in FIGS. 1 and 49, with minor parts removed for clarity.

FIG. 87 is a right side elevation of the assembly 1362 shown in FIG. 49.

FIG. 88 is a right sectional view of the end of line cycling control, as viewed from line 88—88, FIG. 86.

FIG. 89 is a top view of the switches shown in FIG. 88.

FIG. 90 is a sectional elevation of circuit breaker 1341, as viewed from line 90—90, FIG. 86.

Figure 91:
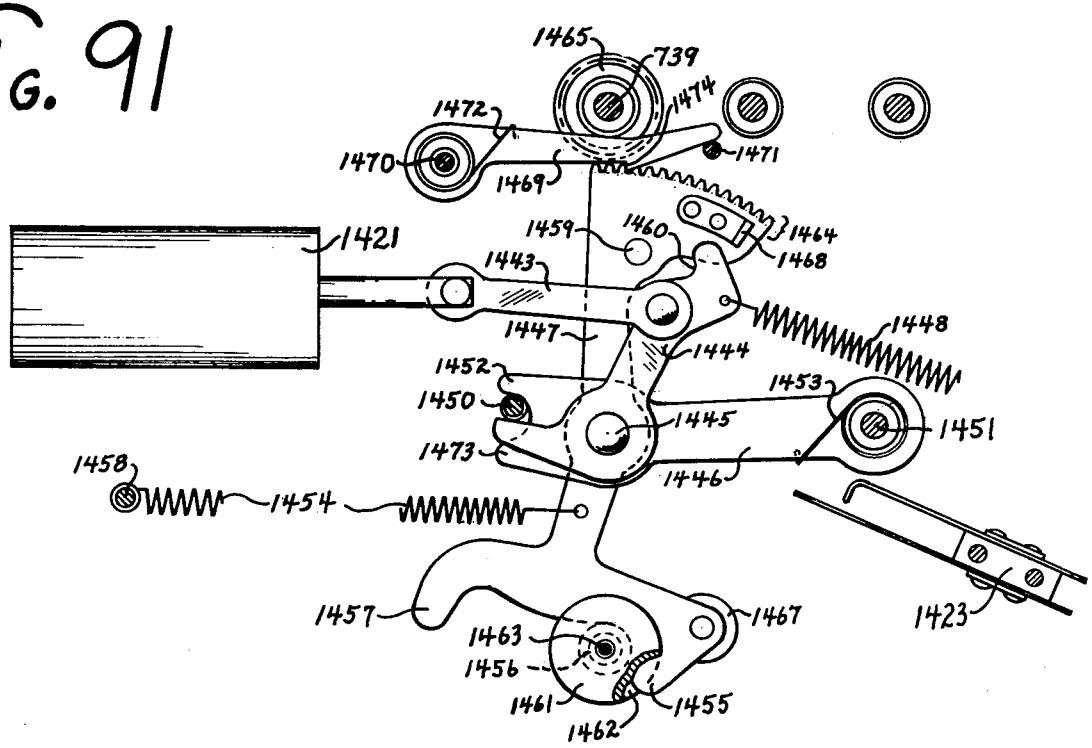

FIG. 91 is a section view of the end of line tape feed mechanism as viewed from line 91—91, FIG. 36.

Figure 92:
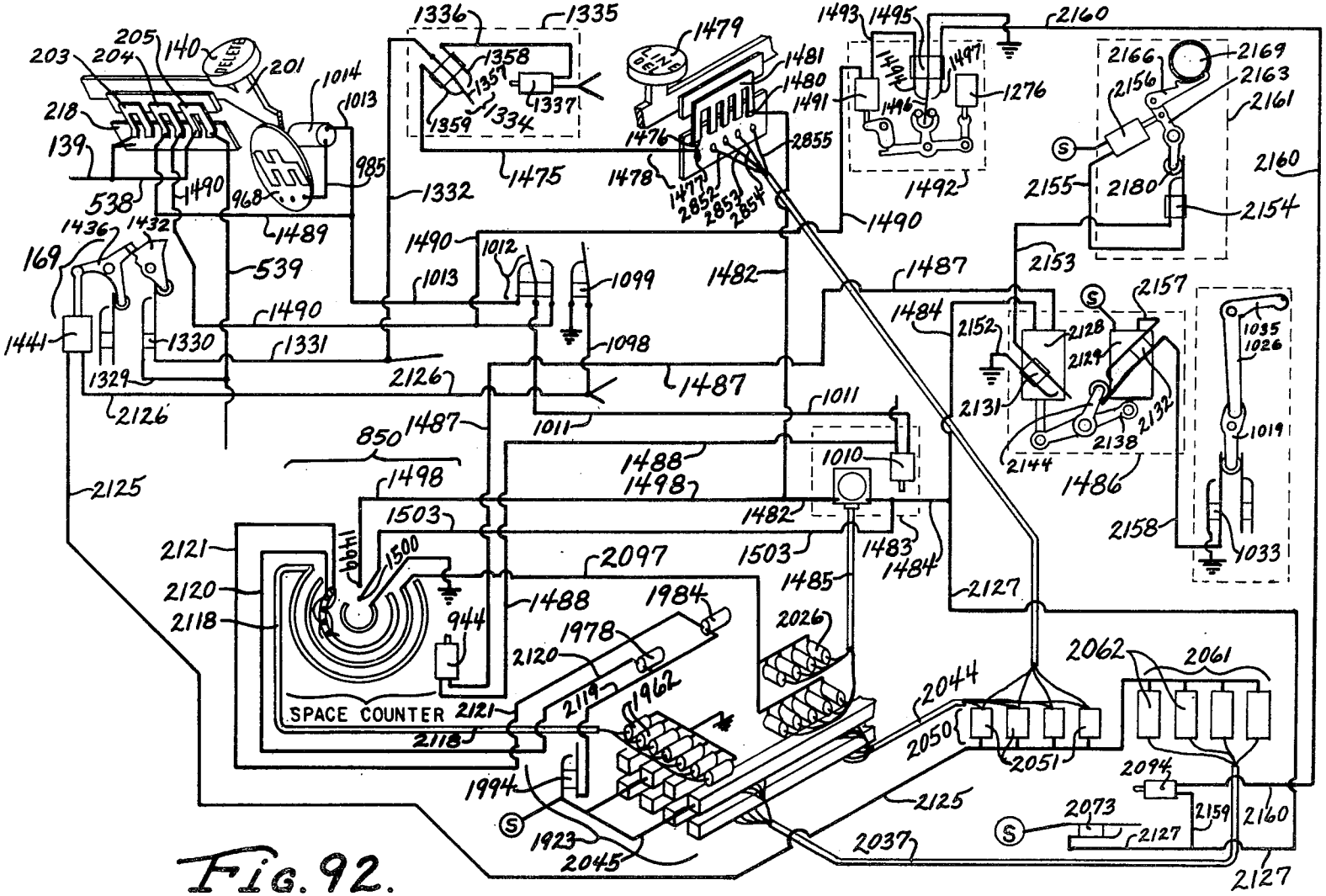

FIG. 92 is a schematic wiring diagram showing primarily the justifying dividing and encoding circuits.

FIG. 93 is a sectional elevation of the clearing sequence control as viewed from line 93—93, FIG. 86.

FIG. 94 is a sectional elevation of the no-punch backspacing sequence control 3244 as viewed from line 94—94, FIG. 86.

FIG. 95 is a fragmentary top view of the left margin control means shown also in FIG. 96.

FIG. 96 is a fragmentary front view of the mechanism shown in FIG. 95.

FIG. 97 is a left side view of the mechanism shown in FIG. 96.

FIG. 98 is a fragmentary right side view of some of the mechanism shown in FIG. 95 and 96, and additionally showing the full carriage return switch.

FIG. 99 is a fragmentary left sectional elevation of the right margin control means taken on line 99—99, FIG. 101.

FIG. 100 is a fragmentary top view of the right margin control means shown also in FIGS. 99 and 101, with certain parts removed for clarity.

FIG. 101 is a fragmentary front elevation of the right margin control means shown in FIG. 100.

FIG. 102 is a fragmentary top view of some of the mechanism shown in FIG. 101.

FIG. 103 is a fragmentary top view of some of the mechanism shown in FIG. 101.

Figure 18:
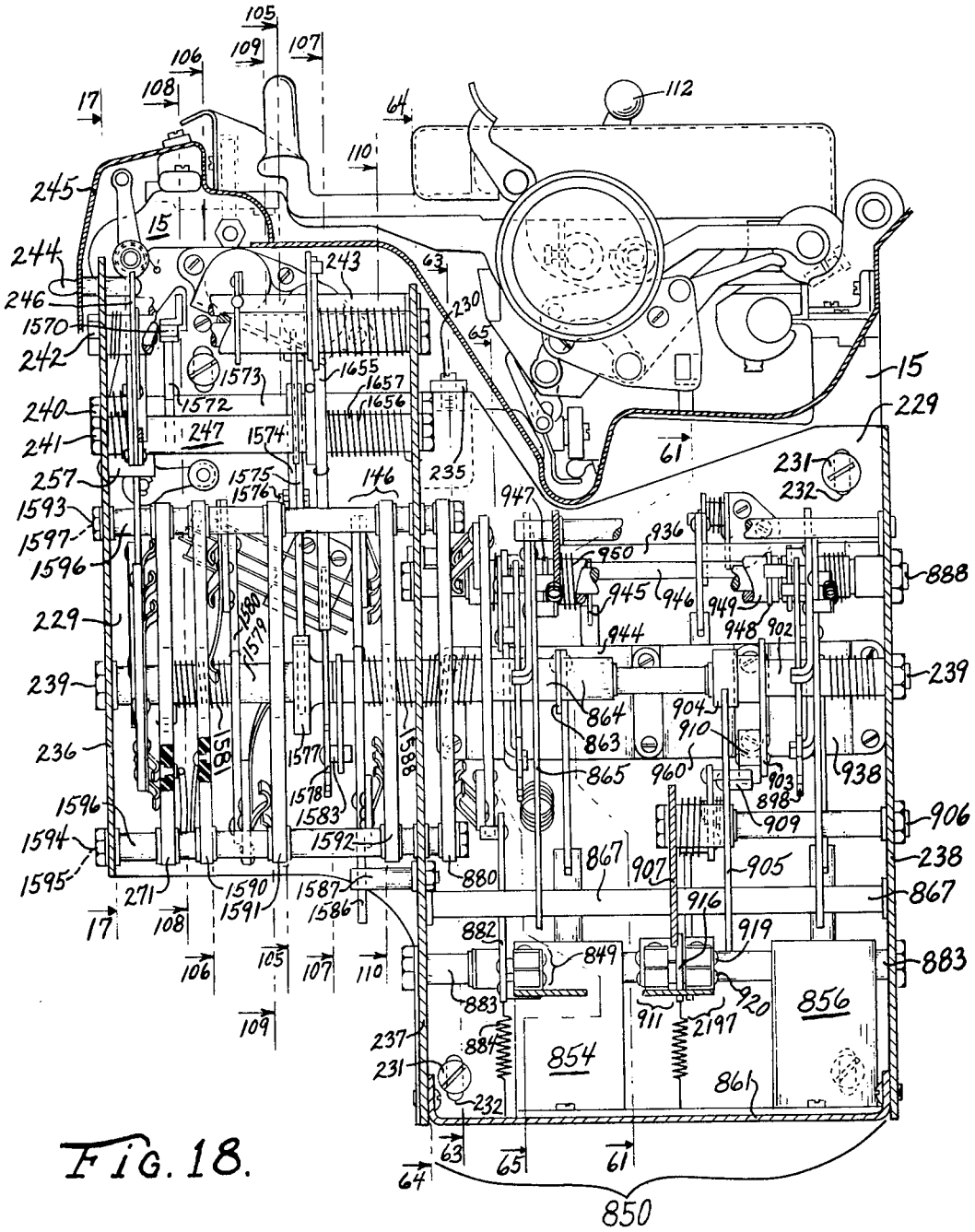
FIG. 18 is a fragmentary right sectional elevation of the machine taken generally on line 18—18, FIG. 2, and showing primarily the amount left in line mechanism and portions of the standard typewriter in the background.
Figure 104:
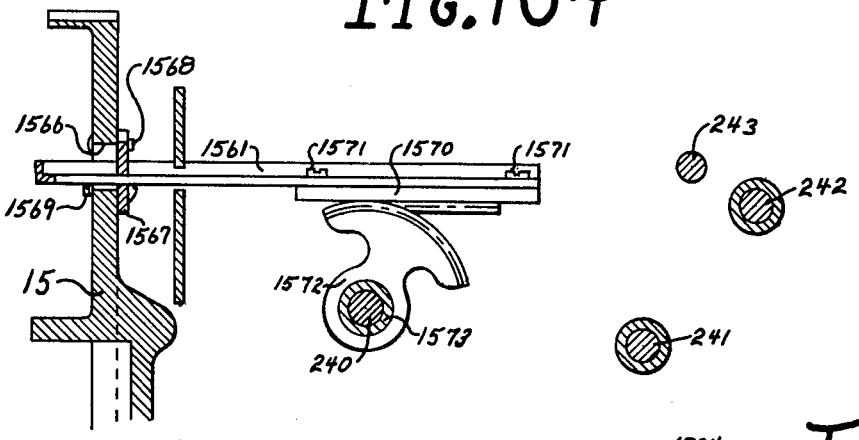

FIG. 104 is a fragmentary sectional view showing only the physical connection between the right margin means and the amount left in the line measuring mechanism, as seen from line 17—17 (FIG. 18).

Figure 105:
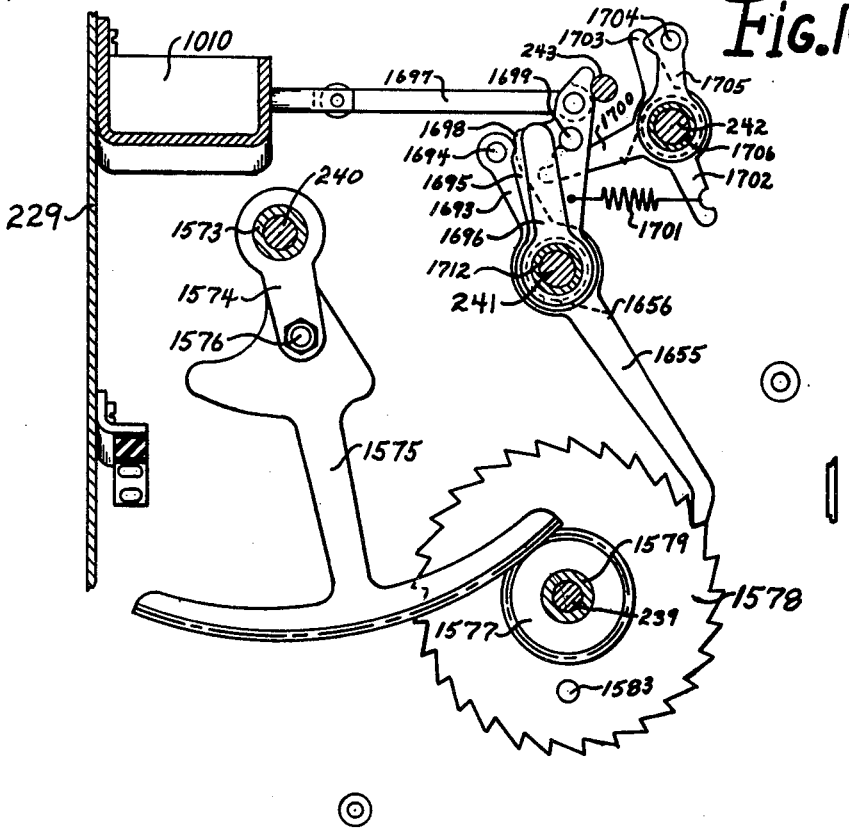

FIG. 105 is a sectional view, with parts removed for clarity, taken on line 105-105 (FIG. 18) and showing primarily the motivating and detent means for the amount left in line measuring means.

Figure 106:
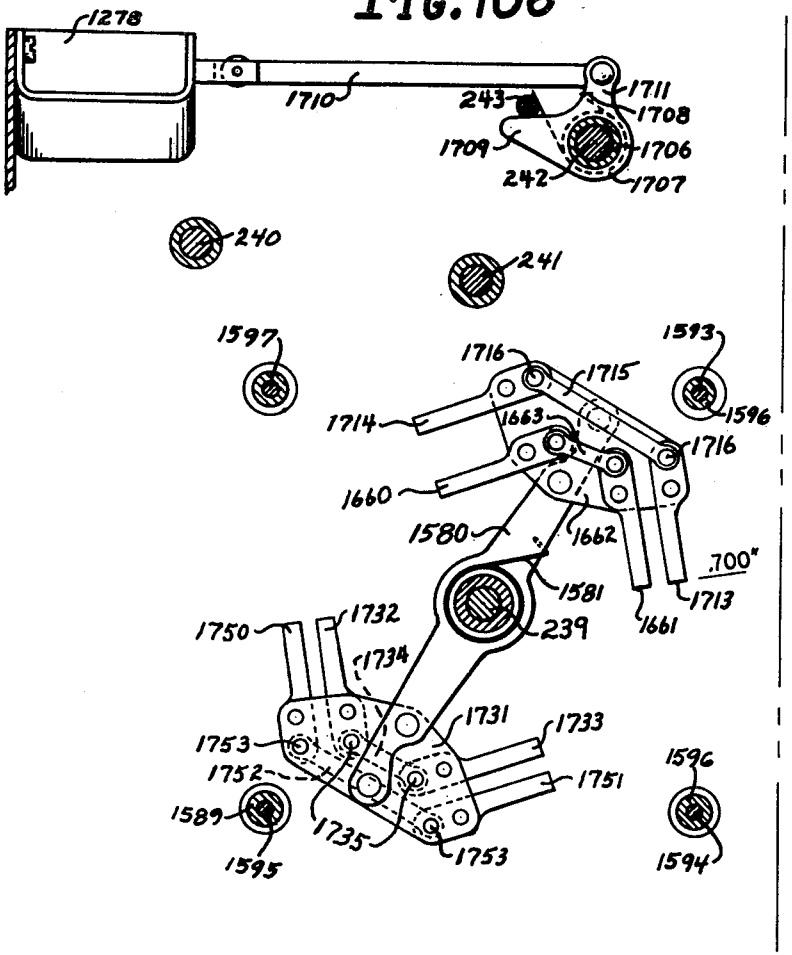

FIG. 106 is a section view of the amount left in line mechanism, shown from line 106—106 (FIG. 18), with parts removed for clarity.

Figure 107:
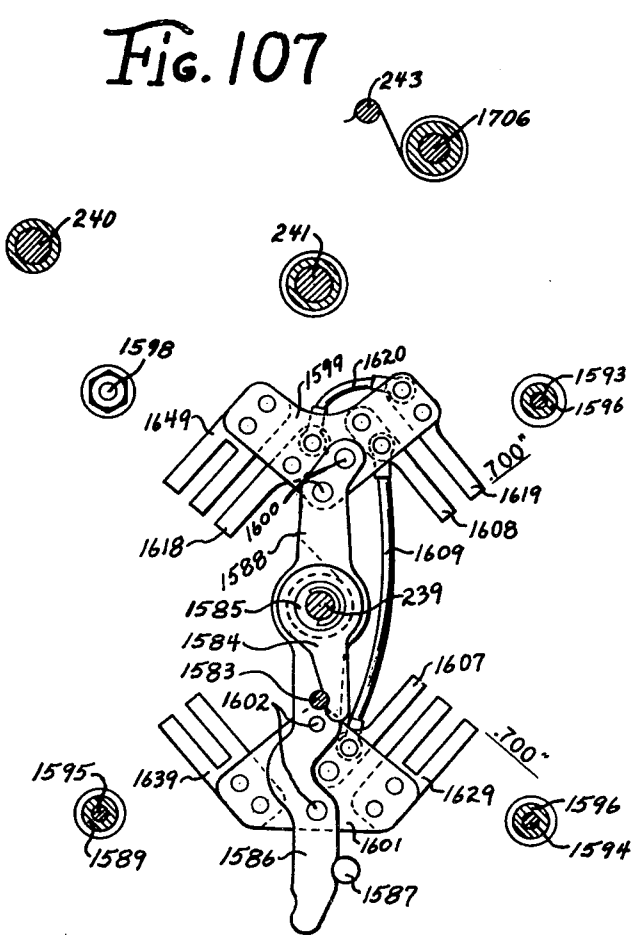

FIG. 107 may be described the same as FIG. 106 above, but it is taken on line 107—107 (FIG. 18)

FIG. 108 is a view of a commutator structure in the end of line mechanism, taken on line 108—108 (FIG. 18).

FIG. 109 is a fragmentary view of a commutator structure in the end of line mechanism, taken on line 109—109 (FIG. 18).

FIG. 110 is a view of a commutator structure in the end of line mechanism, taken on line 110—110 (FIG. 18).

Figure 111:
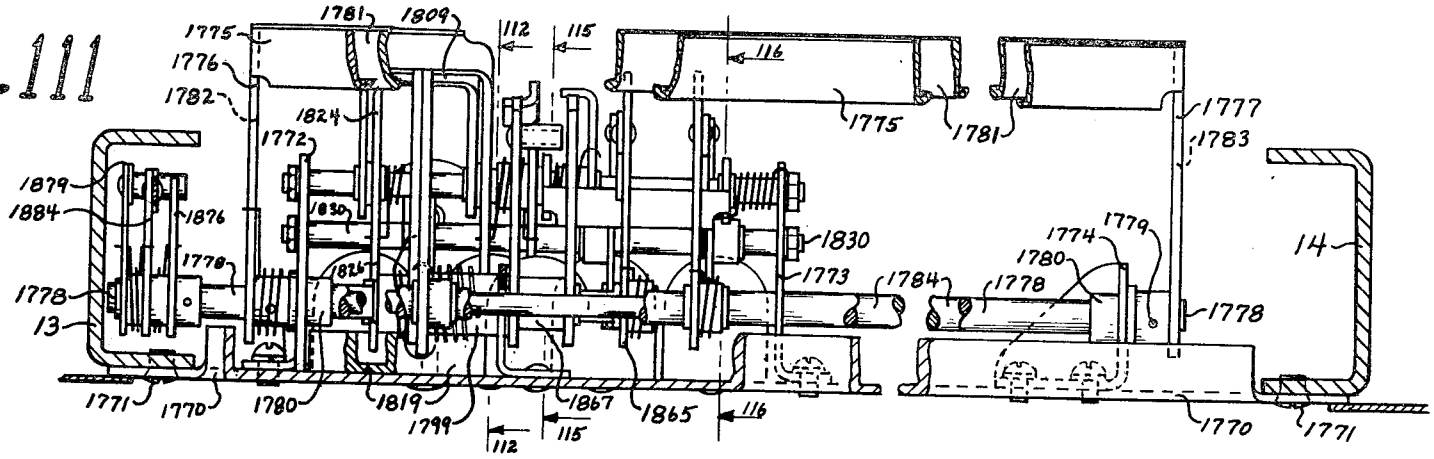

FIG. 111 is a fragmentary front elevational view of the differential key lock mechanism.

Figure 112:
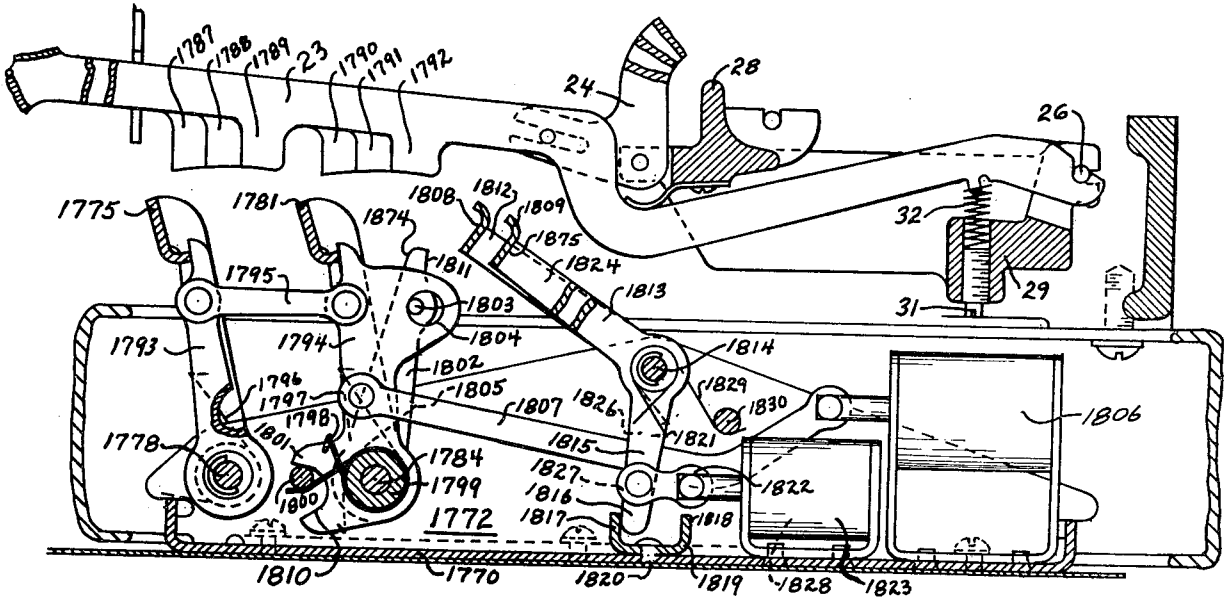
Figure 113:
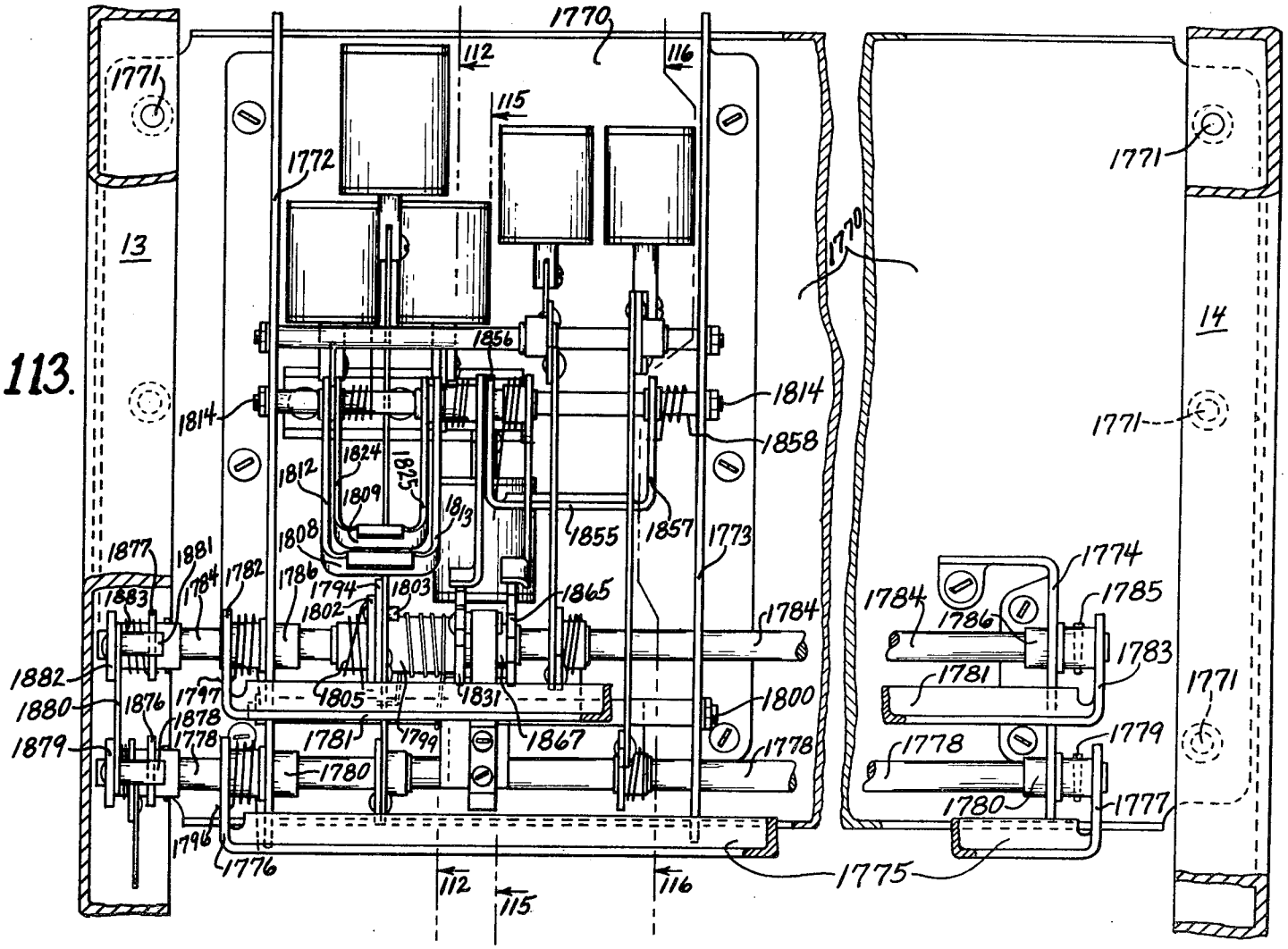

FIG. 112 is a fragmentary right sectional view, taken on line 112—112, FIGS. 111 and 113, showing primarily key lock indexing means for the differential key locks and including fragments of character keys and the main typewriter.

FIG. 113 is a top view of the differential key lock mechanism shown in FIG. 111 and including fragments of the base frame of the machine to which the differential key lock mechanism is secured.

Figure 114:
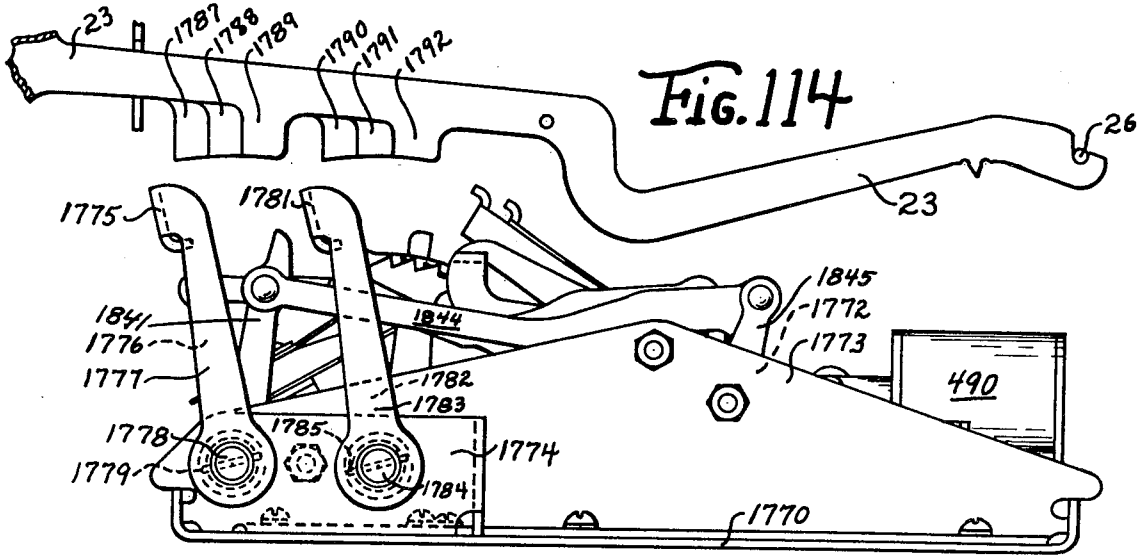

FIG. 114 is a full right side view of the differential key lock mechanism and including fragments of character keys in positions relative to the differential key lock mechanism.

Figure 115:
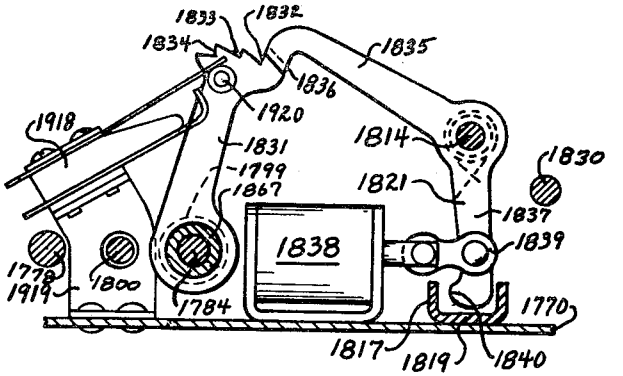

FIG. 115 is a sectional right elevation of a detent means for the differential key locks, as viewed from line 115—115, FIGS. 111 and 113.

Figure 116:
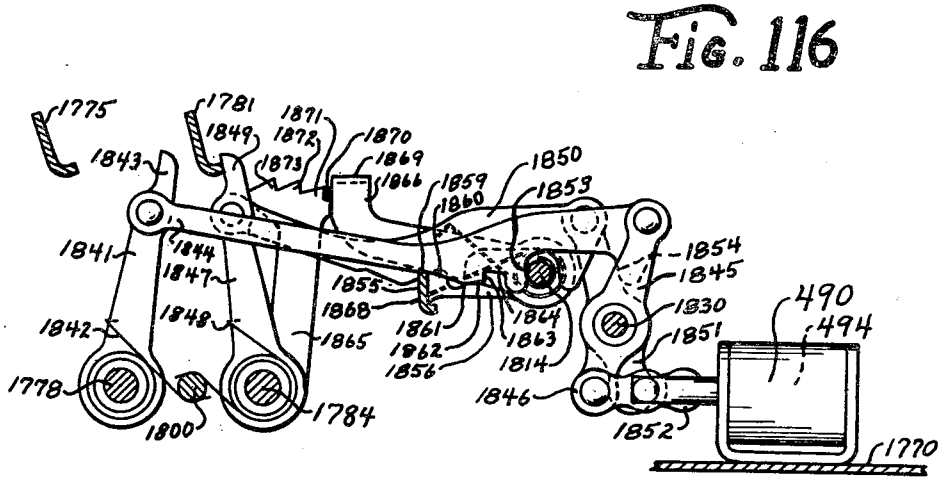

FIG. 116 is a sectional right side elevational view, taken generally on line 116—116, FIGS. 111 and 113, showing primarily an over-rotation preventing ratchet means for the indexing means shown in FIG. 112, and showing upper and lower case controls for the key lock mechanism.

Figure 117:
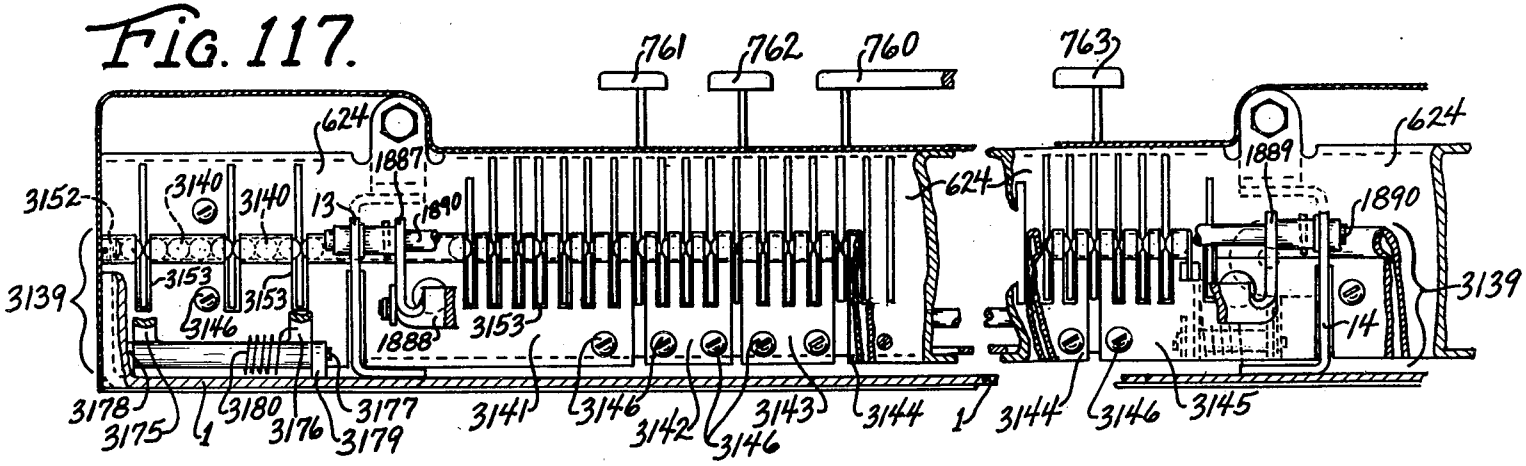

FIG. 117 is a reduced fragmentary front view of approximately the left half of the general key lock mechanism as viewed from in front of the machine with the cover and other parts cut away for clarity.

Figure 118:
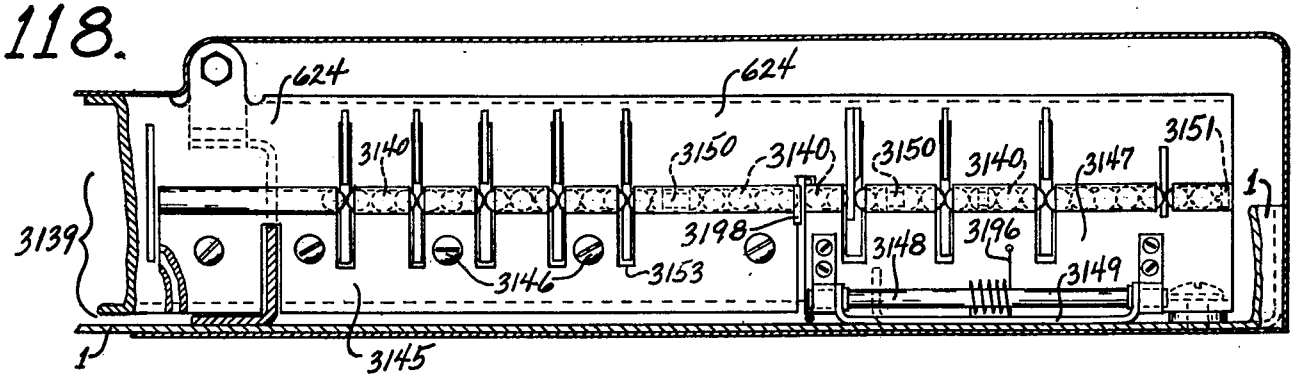

FIG. 118 is a reduced fragmentary front view of approximately the right half of the general key lock mechanism as viewed from in front of the machine with the cover and other parts cut away for clarity.

Figure 119:
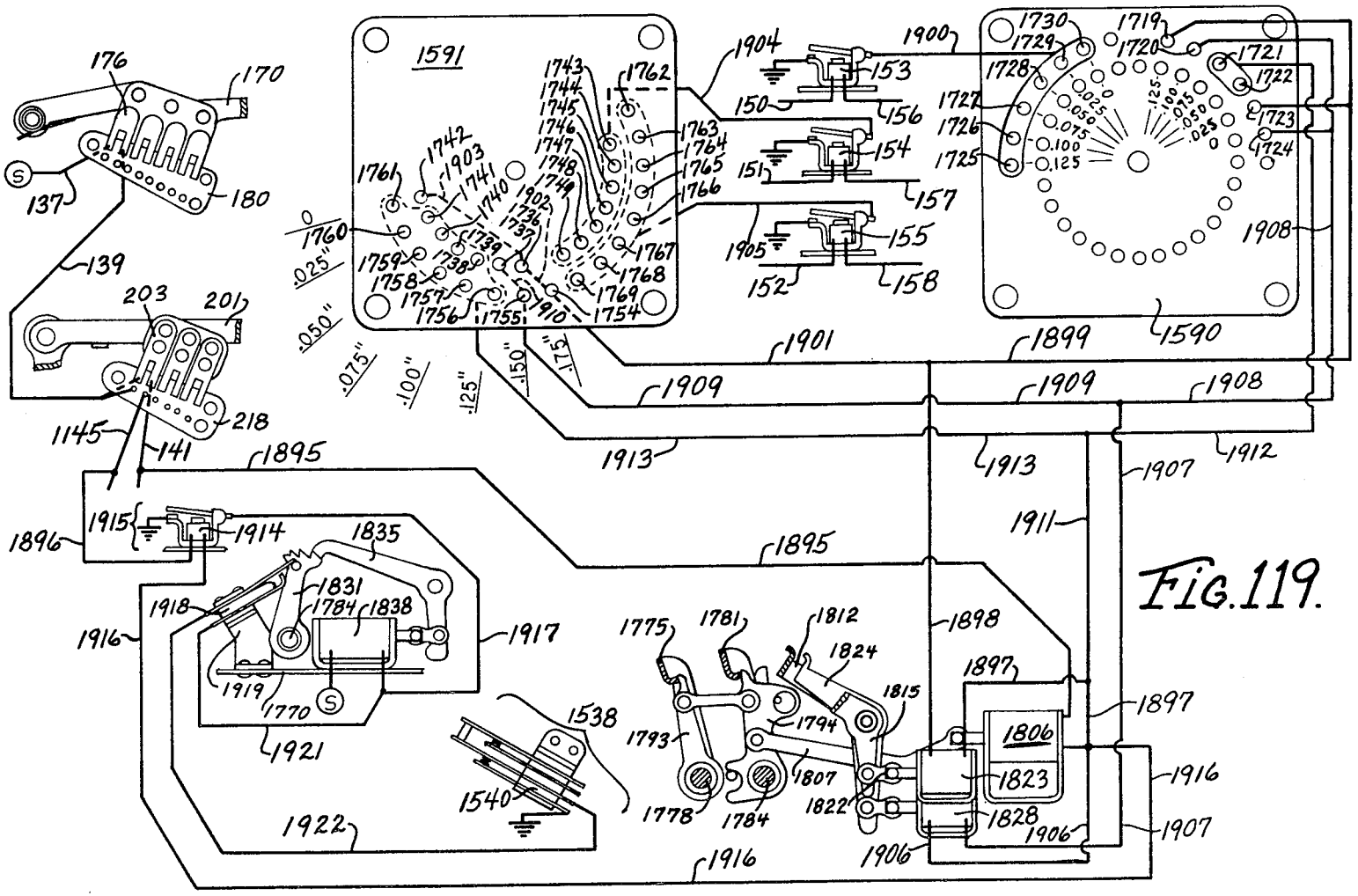

FIG. 119 is a schematic wiring diagram of the differential key lock control circuitry.

Figure 120:
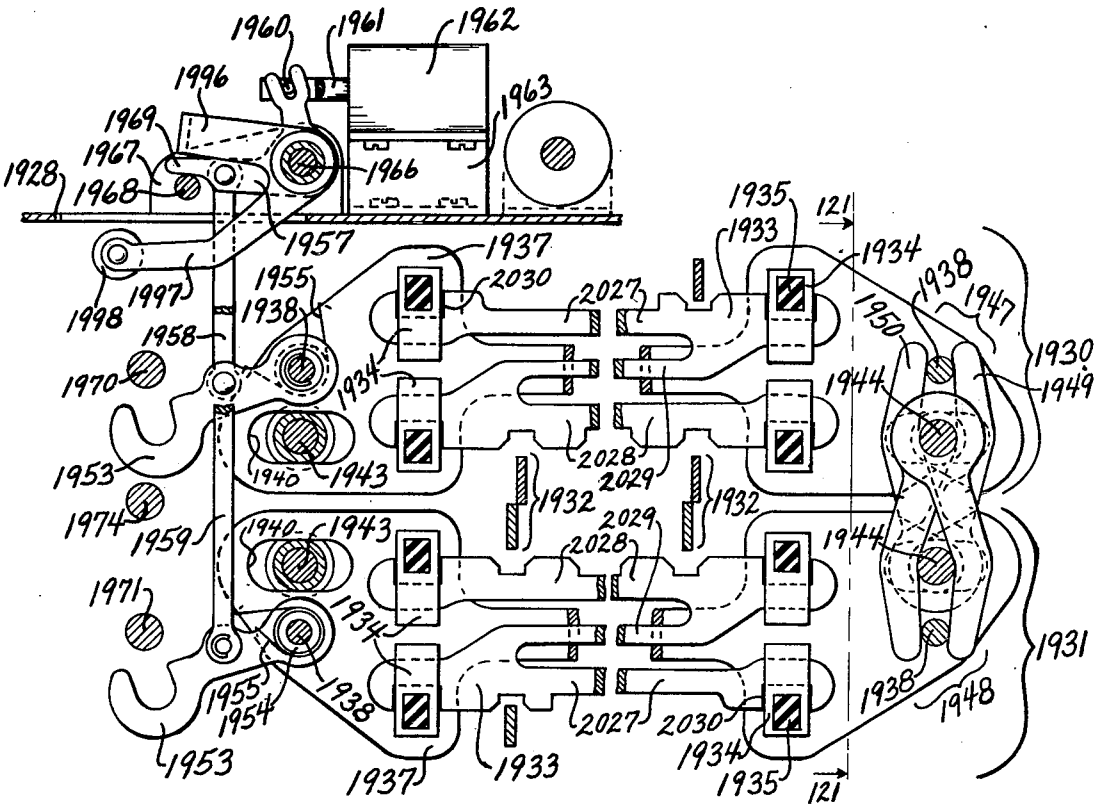

FIG. 120 is a condensed fragmentary sectional front view, taken substantially on line 120—120 (FIGs. 124 and 125), with parts omitted for clarity and showing particularly the details of the dividing plate assemblies and their selecting means.

Figure 121:
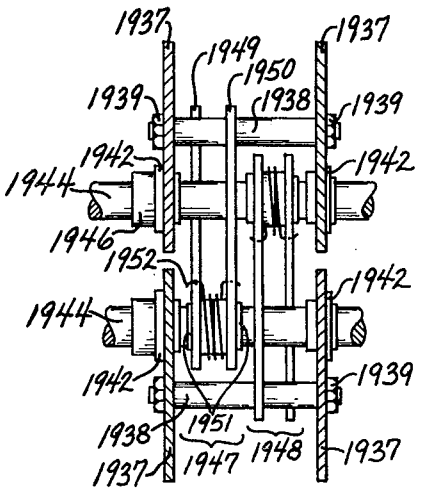

FIG. 121 is a fragmentary sectional view of the dividing plate assembly centralizers shown in FIG. 120 as seen from line 121—121 therein.

Figure 122:
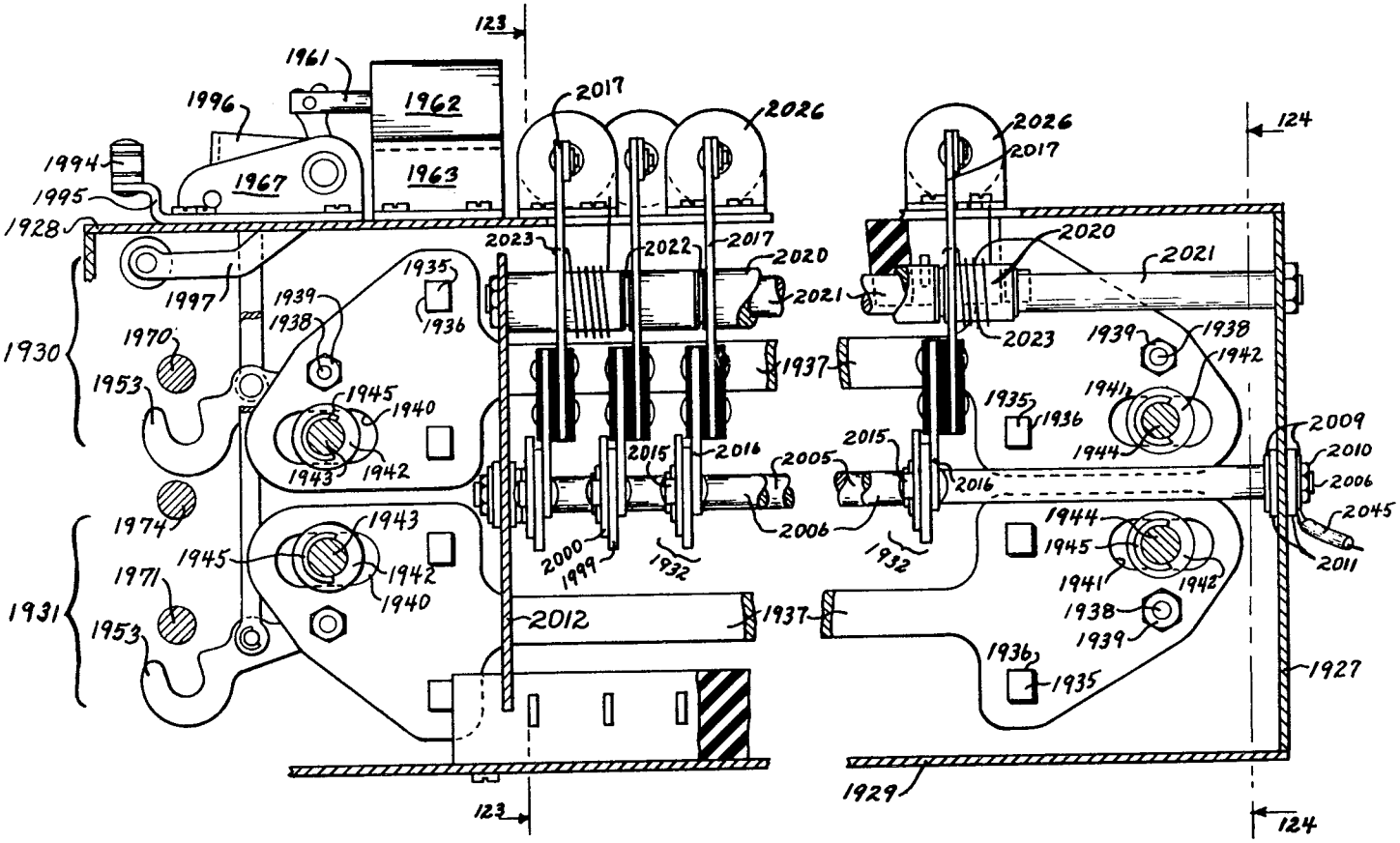

FIG. 122 is a condensed fragmentary sectional front elevation of the dividing and encoding mechanism as viewed from line 122—122 (FIG. 123) with parts removed for clarity.

Figure 123:
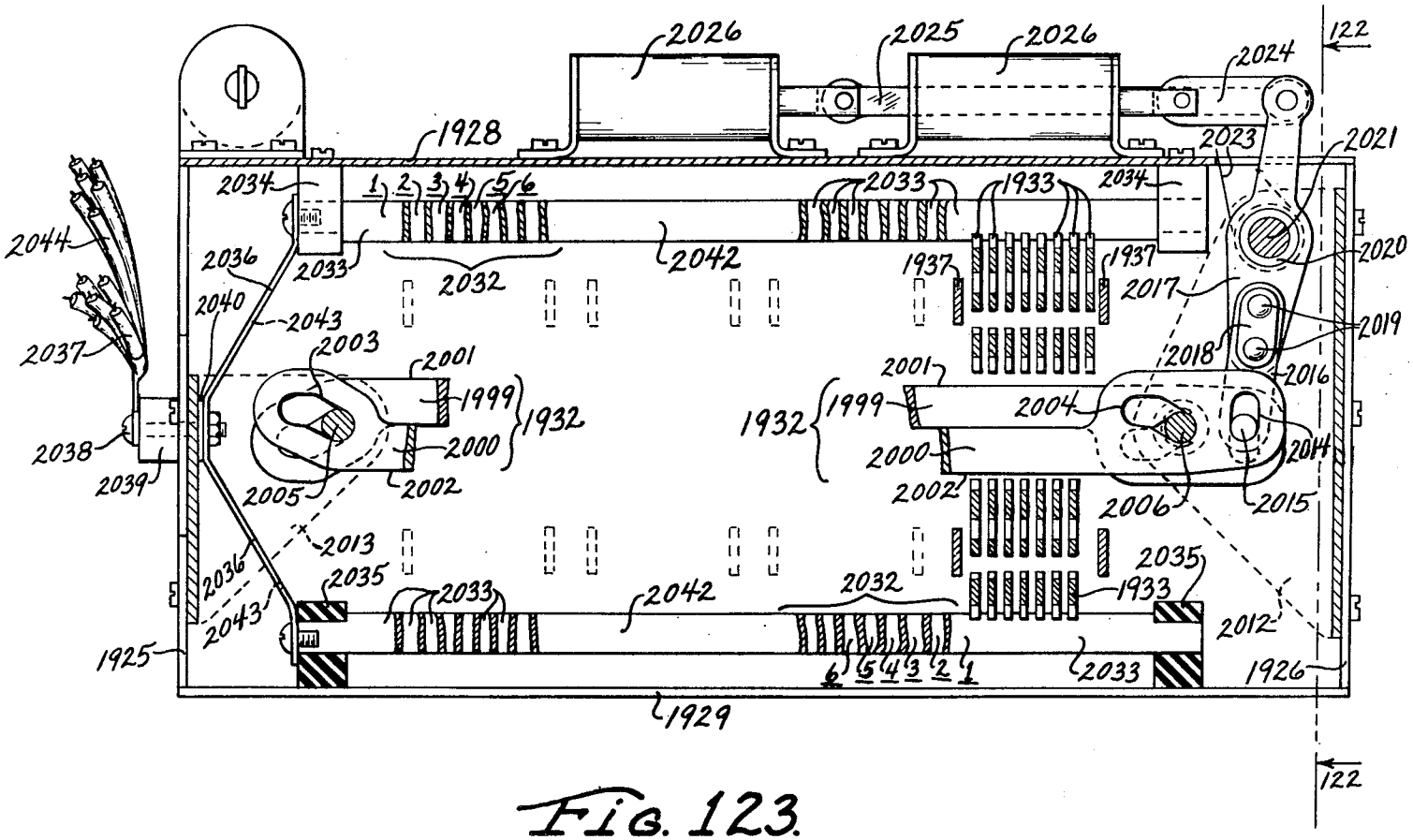

FIG. 123 is a fragmentary left sectional view of the dividing and encoding mechanism, with parts removed, taken substantially on line 123—123 (FIG. 122).

Figure 124:
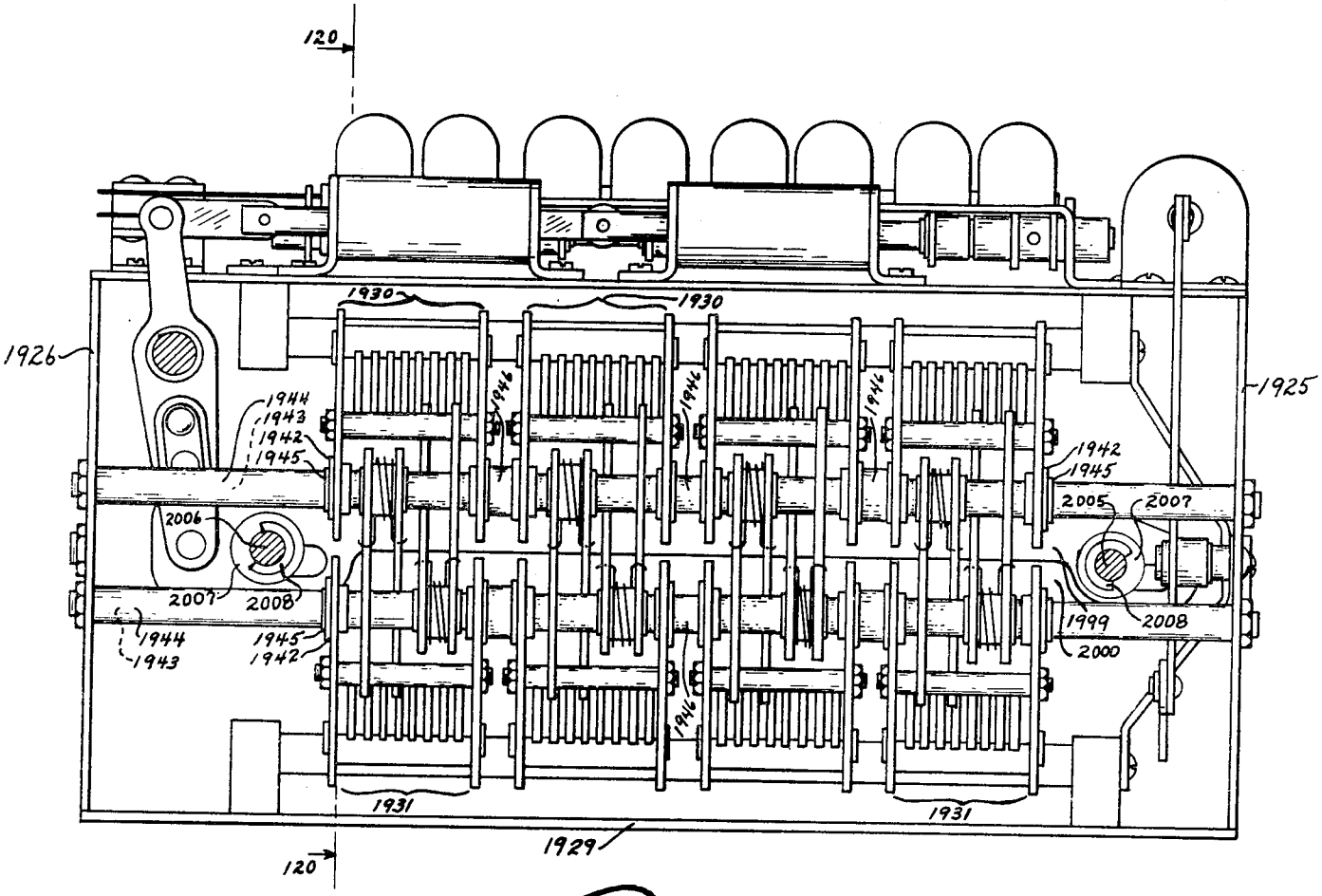

FIG. 124 is a full right sectional elevation of the dividing and encoding mechanism as viewed from line 124—124 (FIG. 122).

Figure 125:
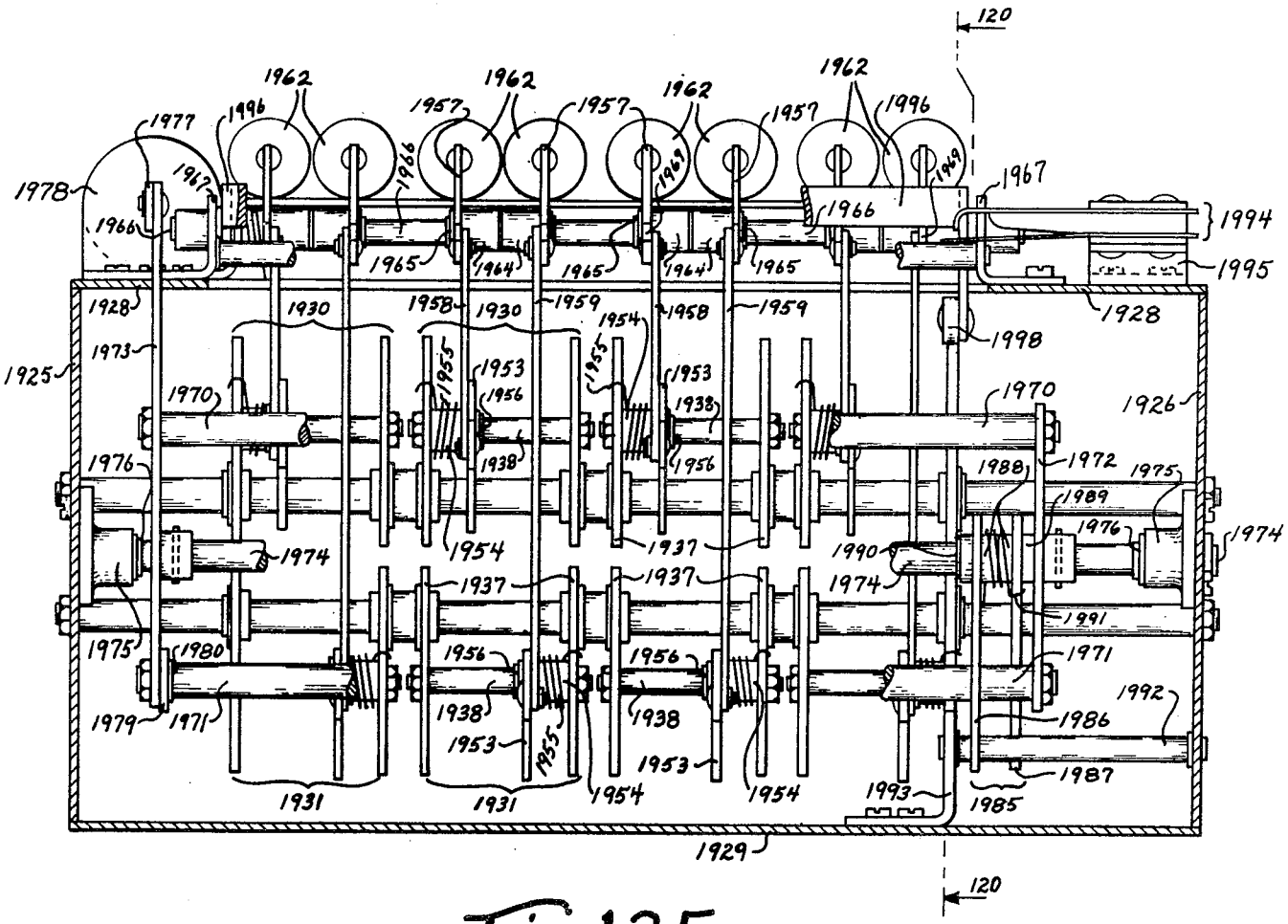

FIG. 125 is a full left fragmentary sectional view of the dividing and encoding mechanism as seen from the left of FIG. 120, and with the dividing plates removed for clarity.

Figure 126:
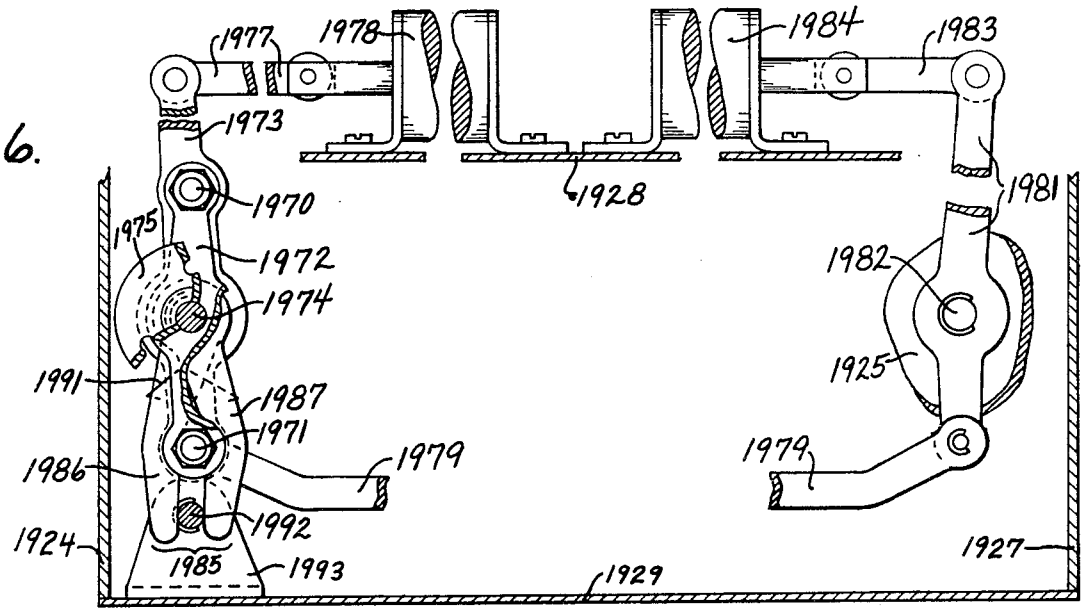
Figure 128:
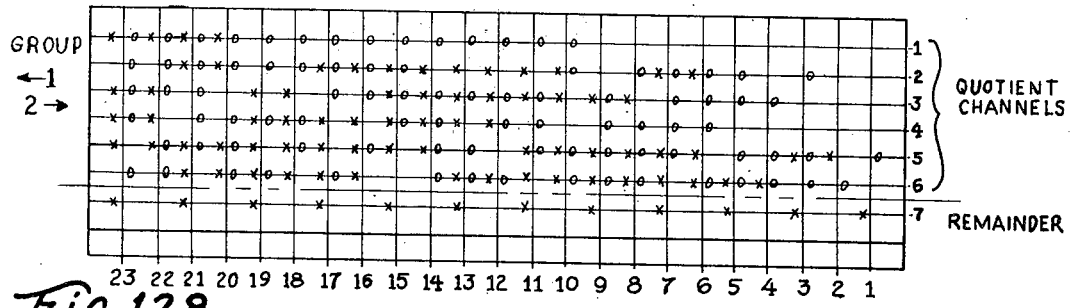
Figure 129:
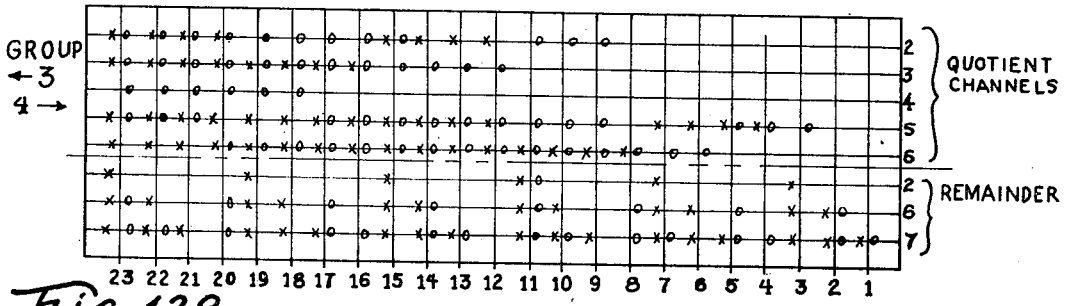
Figure 130:
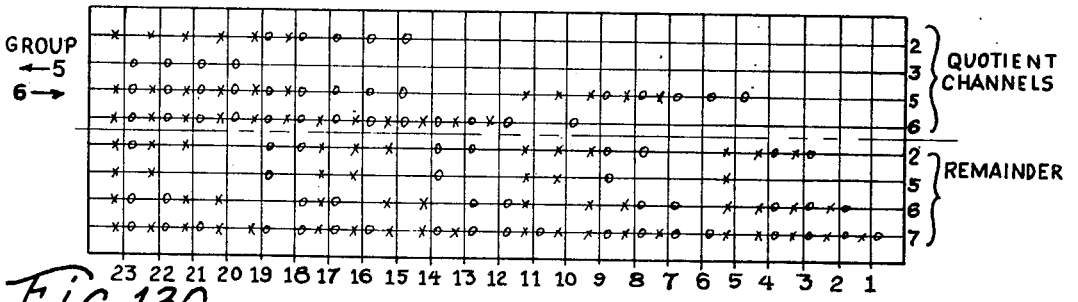
Figure 131:
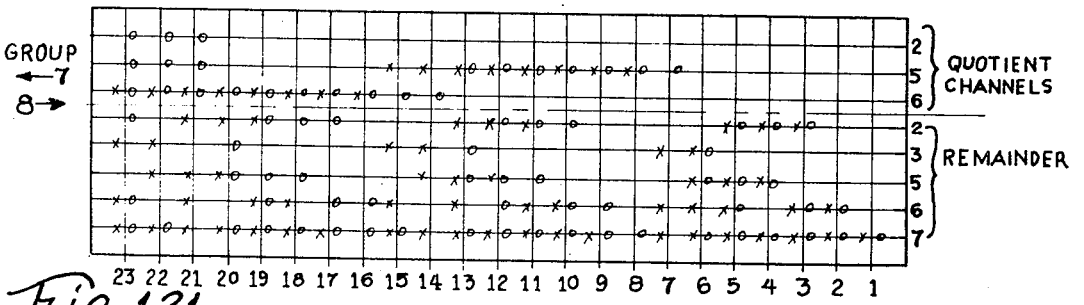
Figure 132:
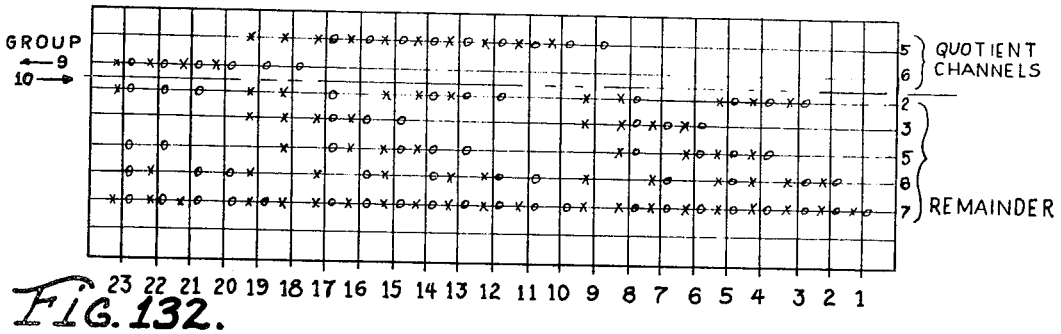
Figure 133:
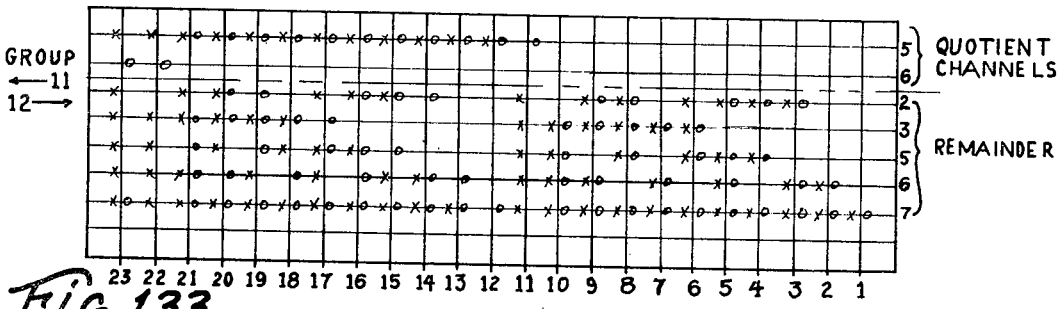
Figure 134:
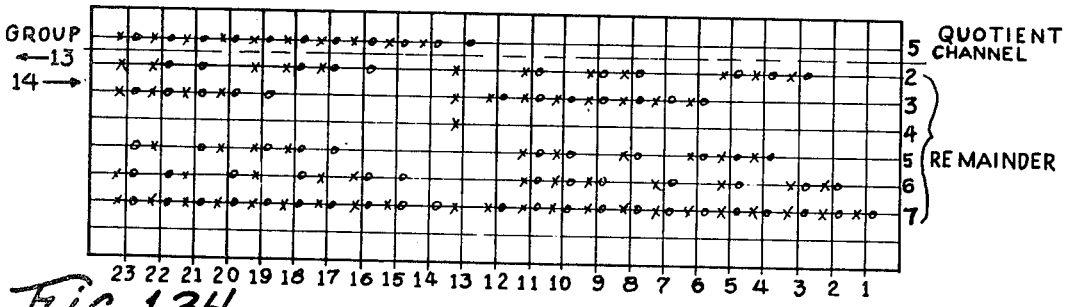
Figure 135:
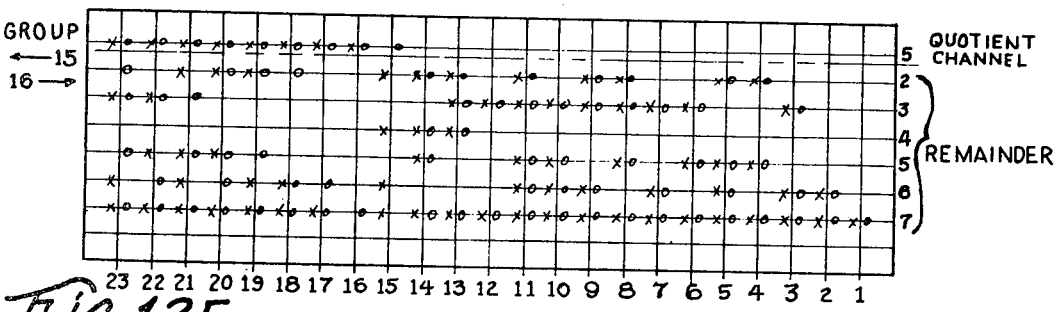

FIG. 126 is a condensed fragmentary view of main motivating mechanism for the dividing and encoding mechanism and showing greater details of this mechanism which is also included in FIG. 125.

Figure 127:
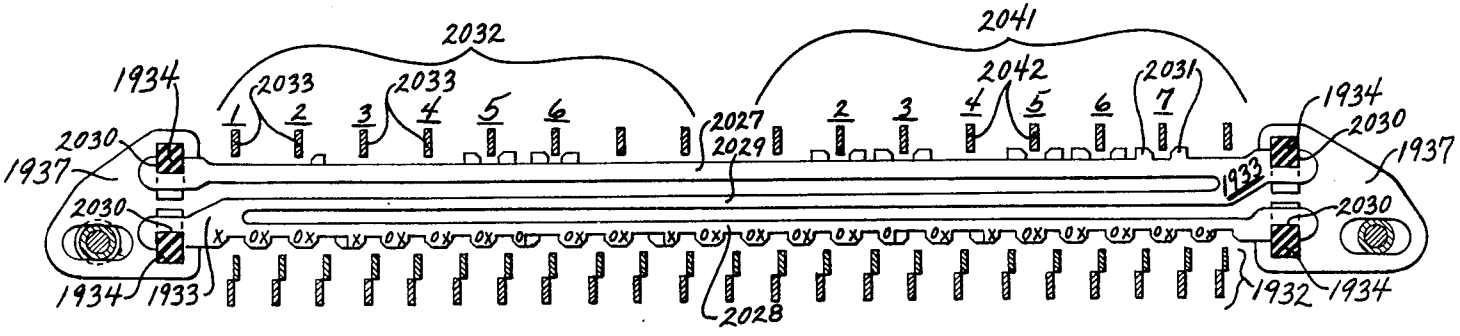

FIG. 127 is a reduced scale view of one of the dividing and encoding plate assemblies with a foreground frame plate removed and including sectioned members that cooperate with the assembly.

FIGS. 128–135 are schematic representations, each indicating a dividing and encoding plate assembly and the plates included therein.

Figure 136:
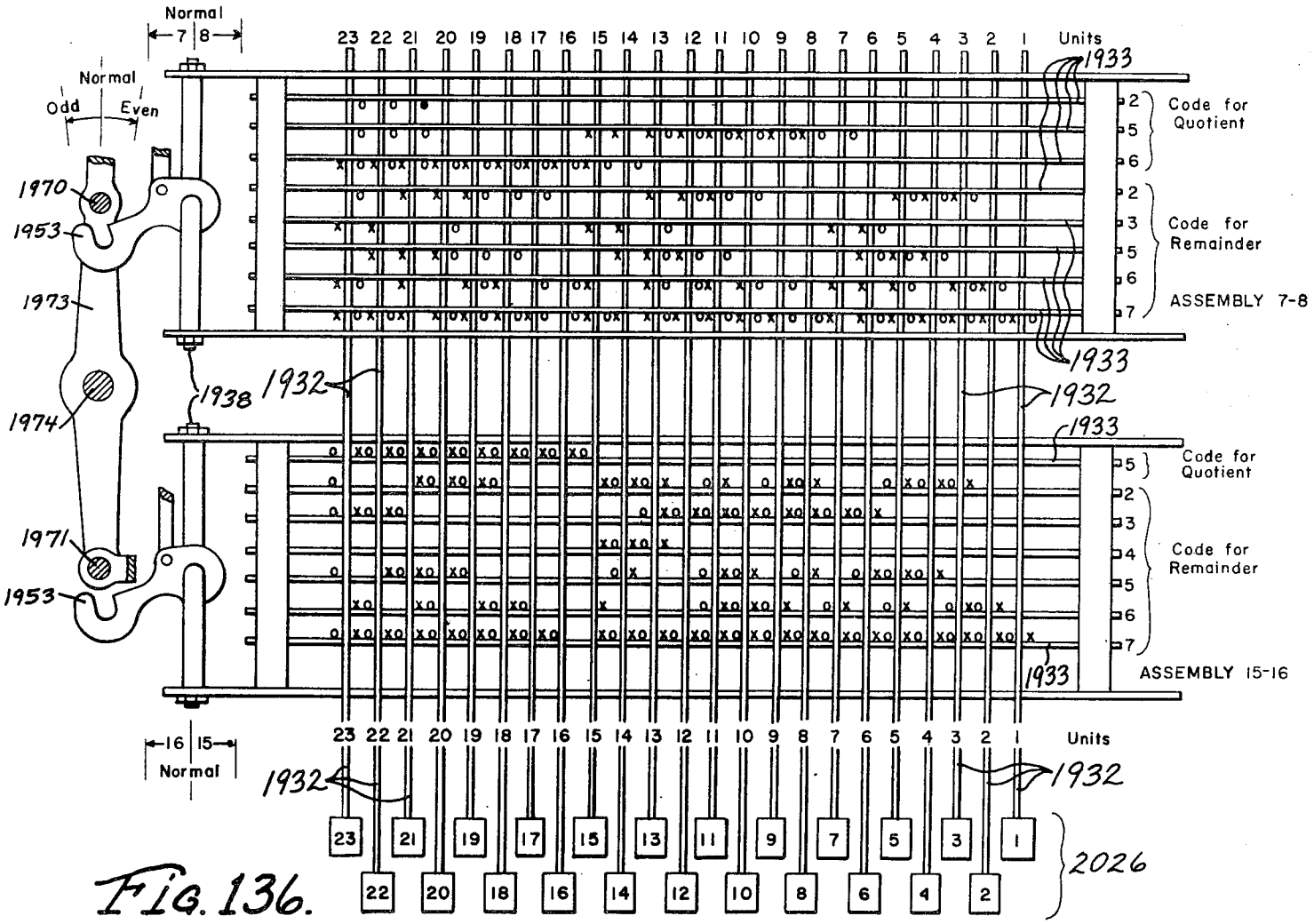

FIG. 136 is a schematic representation of an upper and a lower dividing and encoding plate assembly, and including representations of their selecting and motivating means, and including unit slide means representations that cooperate with the plates in the assemblies.

Figure 137:
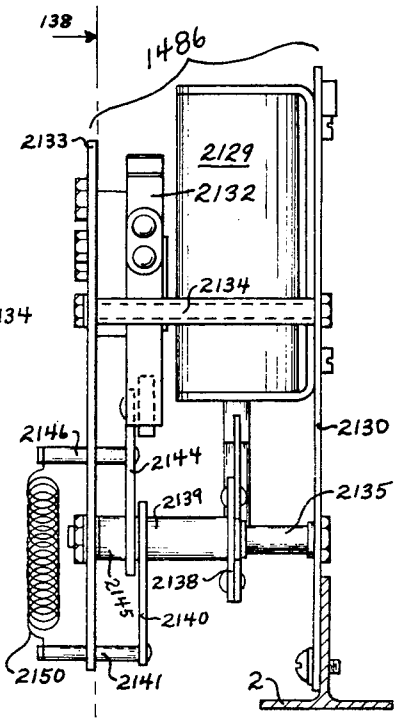

FIG. 137 is a full size left side elevation of the justifying punch tape feed control switch means 1486, included in reduced scale in FIG. 1 and likewise indicated in FIG. 2.

Figure 138:
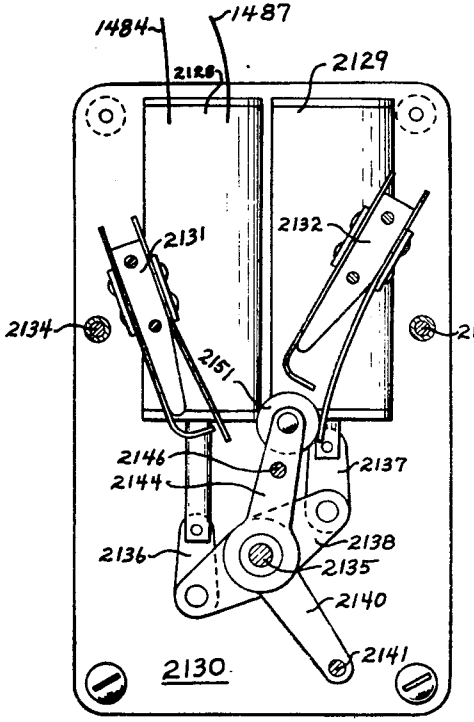

FIG. 138 is a sectional elevation of the switch means shown in FIG. 137 as viewed from line 138—138 therein.

Figure 139:
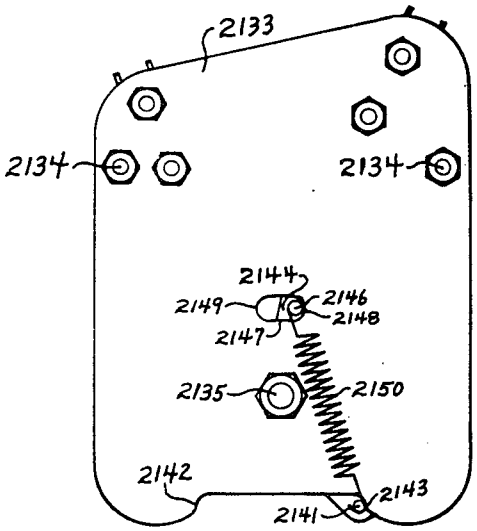

FIG. 139 is a view of a frame plate and mechanism as viewed from the left of FIG. 137.

Figure 140:
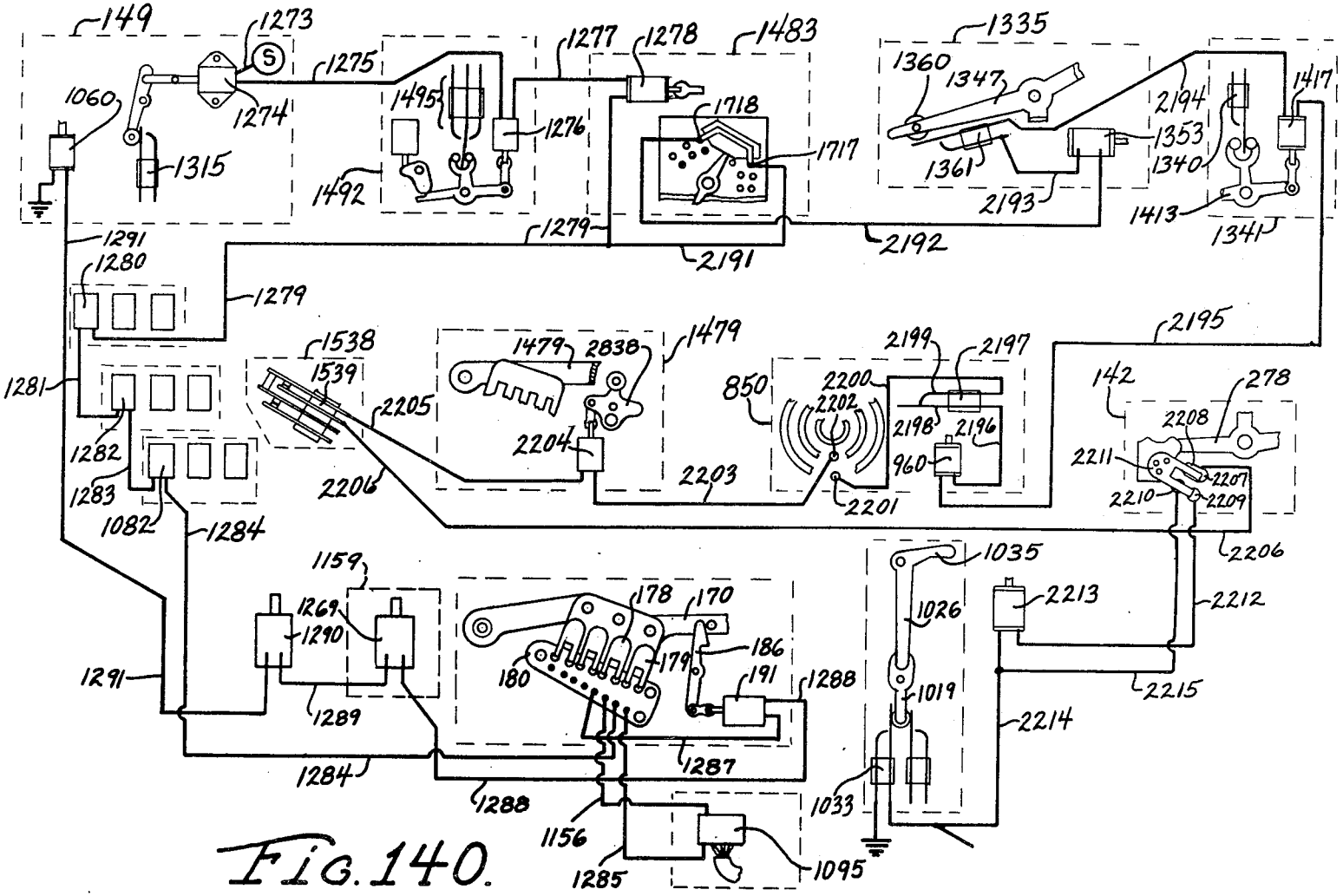

FIG. 140 is a schematic wiring diagram showing primarily restoring circuits that are effective after deleting and after carriage return operations.

Figures 141, 142:
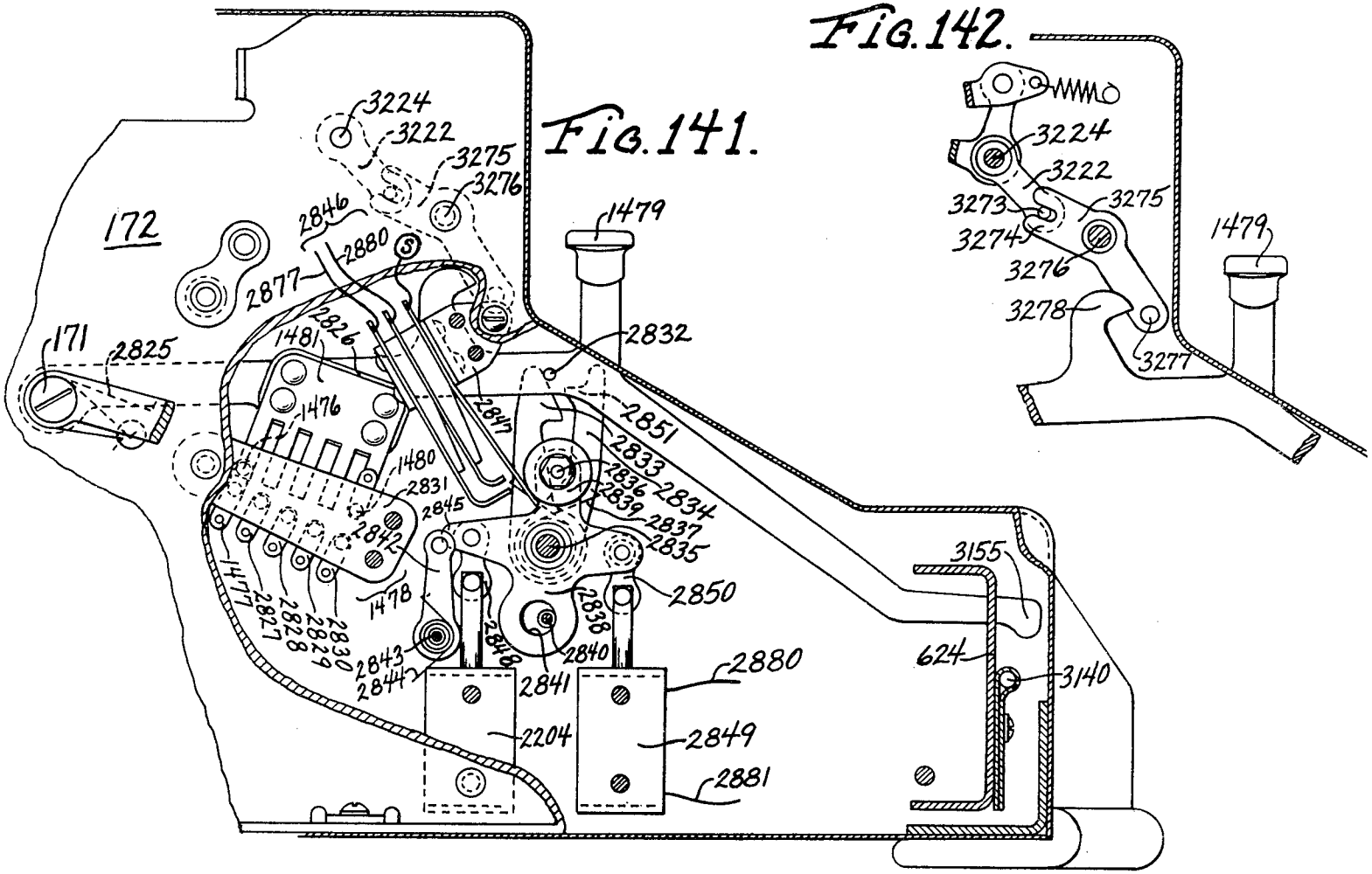

FIG. 141 is a fragmentary left side elevation of the line delete key as viewed generally from the left side of the key board (FIG. 3) with parts cut away for clarity.

FIG. 142 is a fragmentary left side view showing greater detail of some of the parts also shown in FIG. 141.

Figure 143:
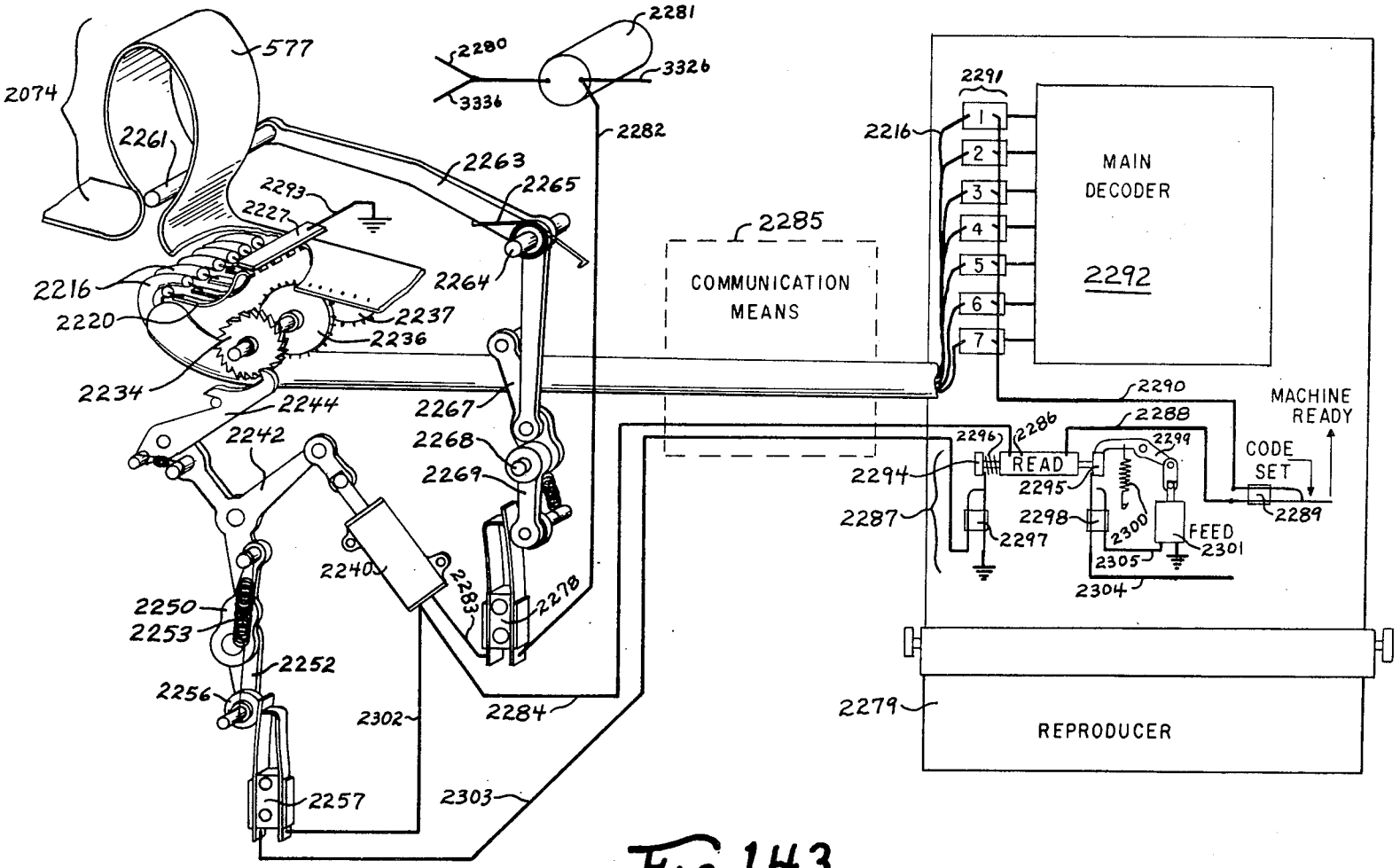

FIG. 143 is a schematic drawing of the main code reader, the reproducing machine and the wiring for coordinating the operations thereof.

Figure 144:
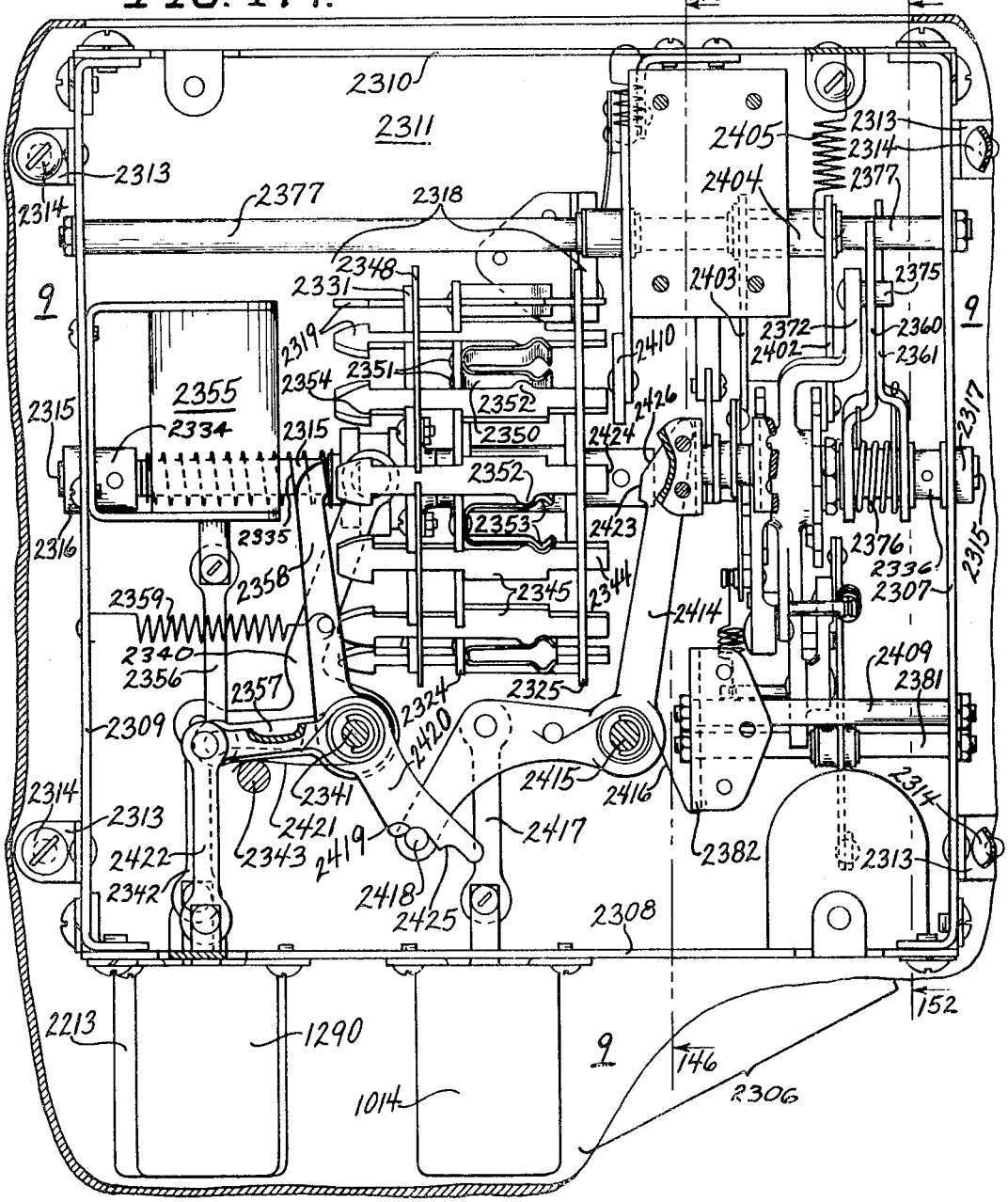

FIG. 144 is a fragmented top view of the space at end of line preventing mechanism 2306 (FIG. 45) showing all of the mechanism of this assembly with the top frame plate of the assembly removed for clarity.

Figure 145:
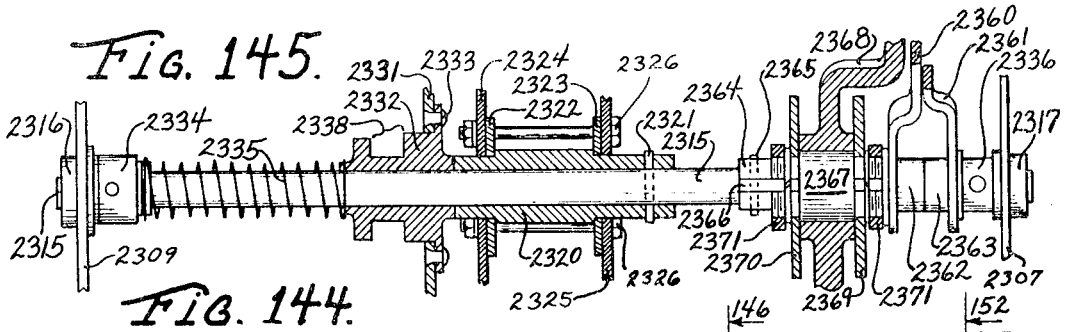

FIG. 145 is a fragmentary sectional view of the main shaft of the mechanism shown in FIG. 144.

Figure 146:
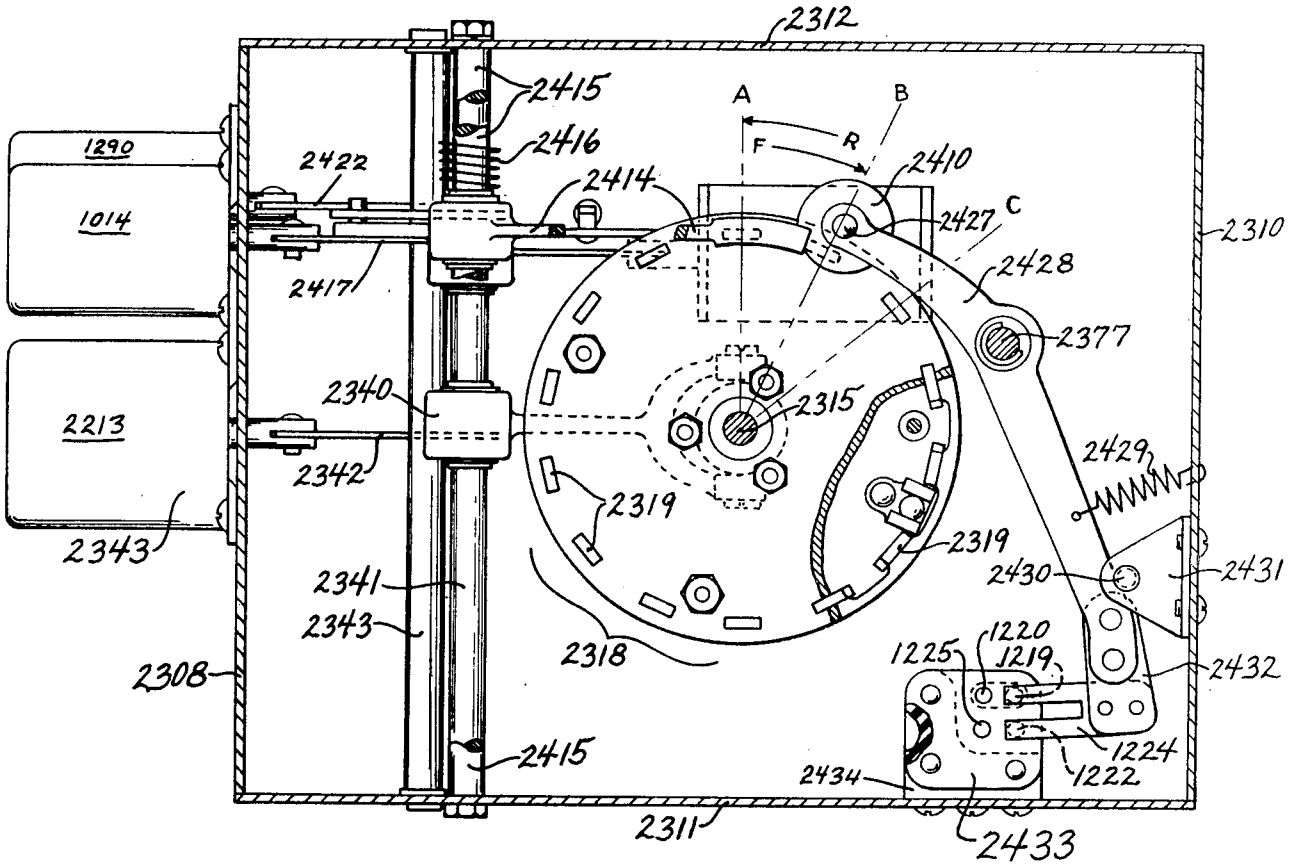

FIG. 146 is a fragmentary right sectional view taken generally on line 146—146 (FIG. 144) with some parts removed for clarity.

Figure 147:
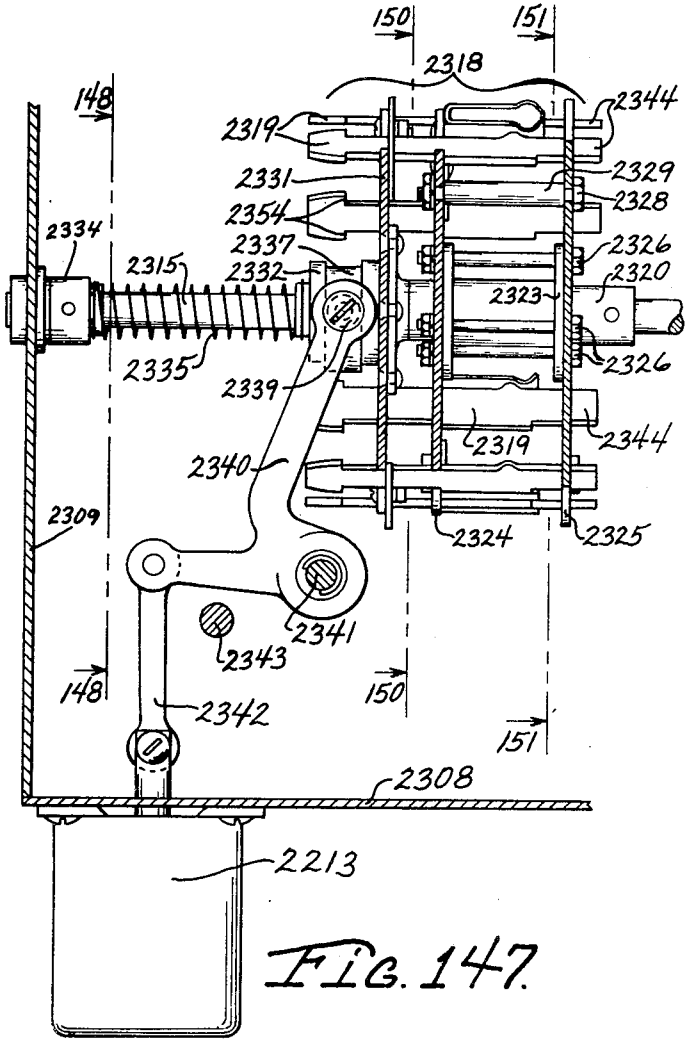
Figure 148:
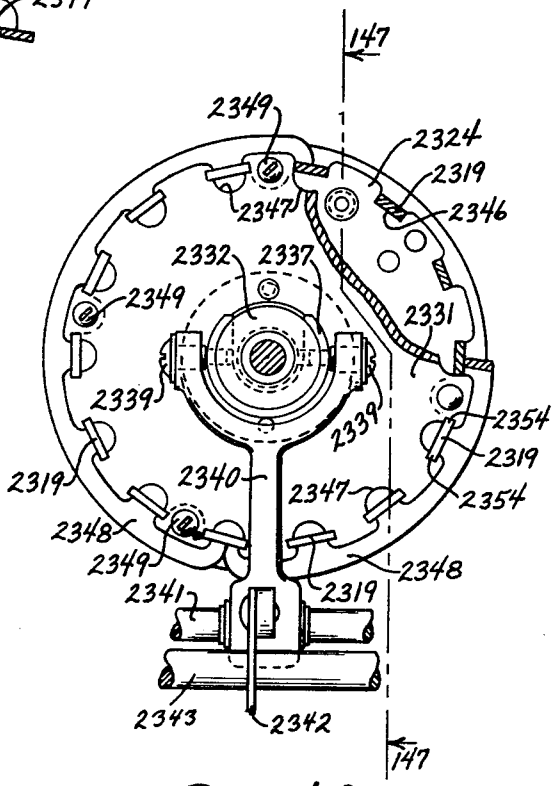

FIG. 147 is a fragmentary sectional view of the pinwheel assembly 2318 (FIGS. 144 and 146) as seen generally from line 147—147 (FIG. 148).

FIG. 148 is a fragmentary sectional view of the mechanism shown in FIG. 147 as viewed from line 148—148 therein.

Figure 149:
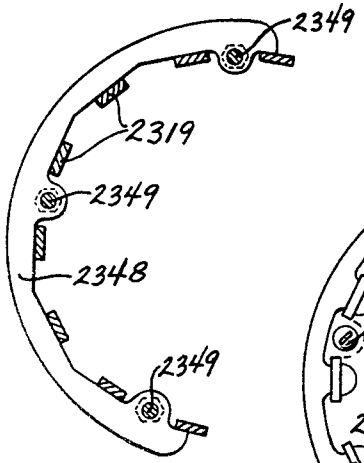

FIG. 149 is a fragmentary view, showing more clearly one of the parts included in FIG. 148.

Figure 150:
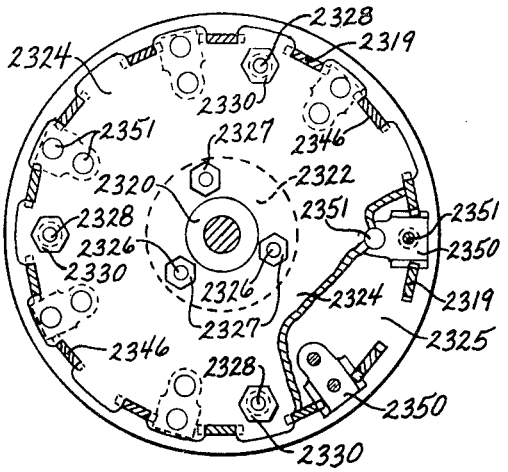

FIG. 150 is a fragmentary sectional view of the pinwheel assembly 2317 shown in FIG. 147 as viewed from line 150—150 therein.

Figure 151:
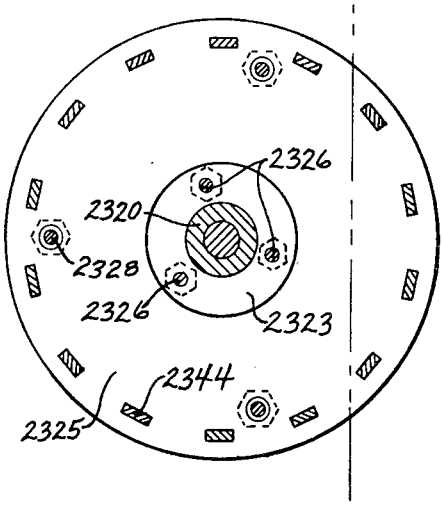

FIG. 151 is a sectional view taken on line 151—151 (FIG. 147).

Figure 152:
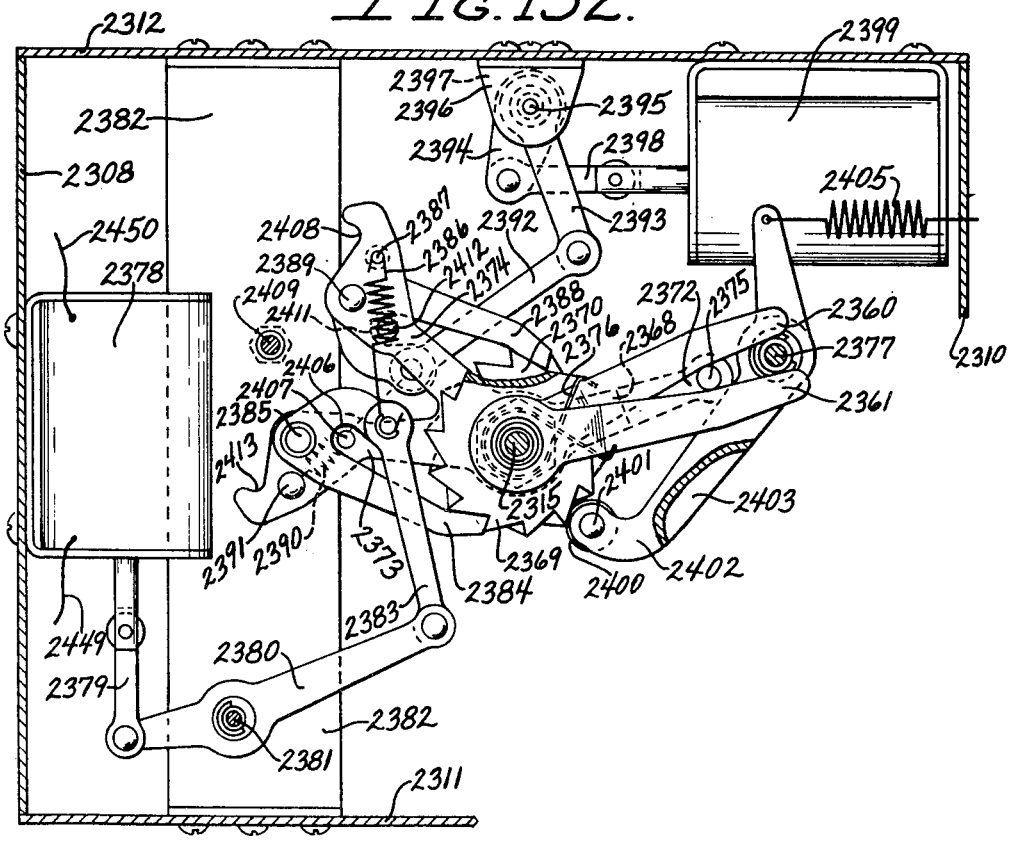

FIG. 152 is a fragmentary sectional view taken generally on line 152—152 (FIG. 144).

Figure 153:
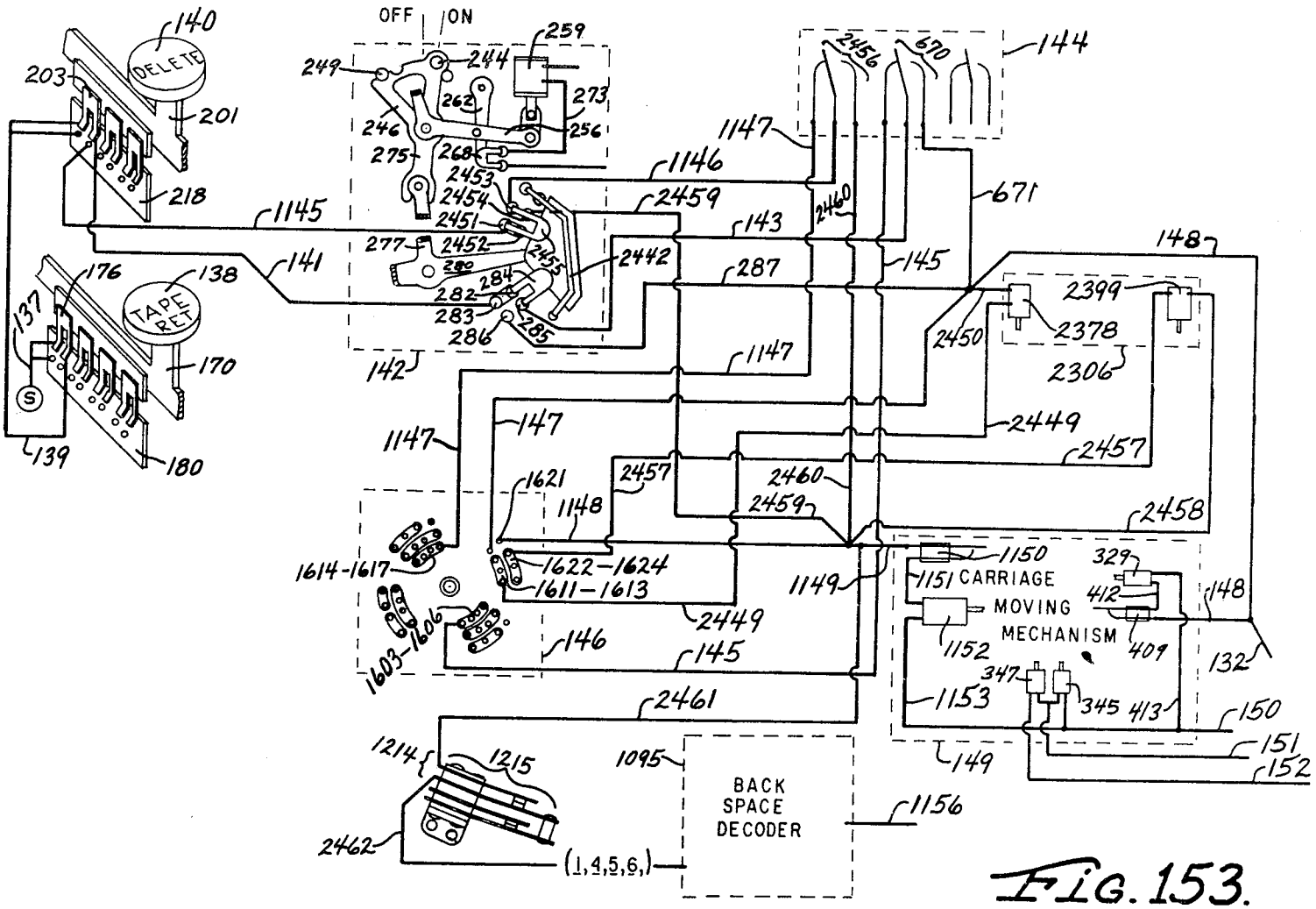

FIG. 153 is a schematic wiring diagram showing primarily the circuitry for at times operating the motivating solenoids shown in FIG. 152.

Figure 154:
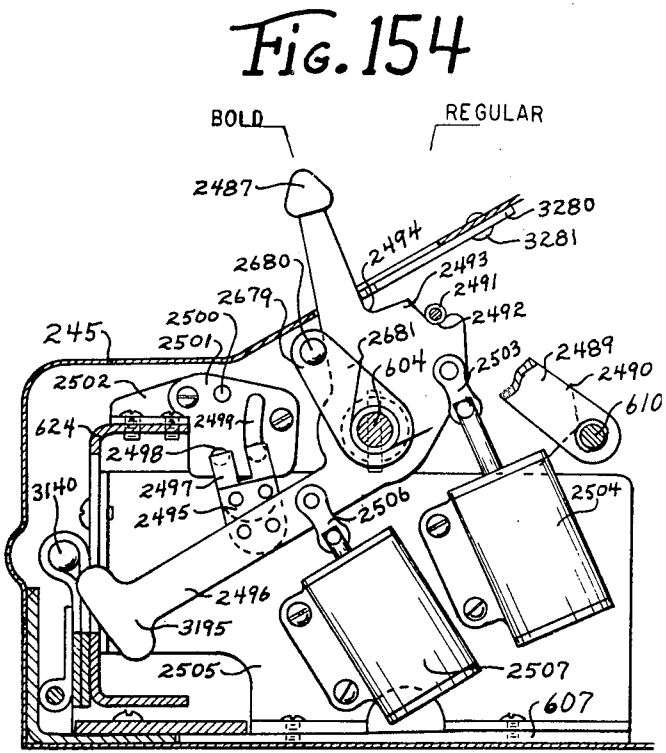

FIG. 154 is a fragmented sectional view of the bold and regular function control key as seen from line 154—154 (FIGS. 3 and 44).

Figure 155:
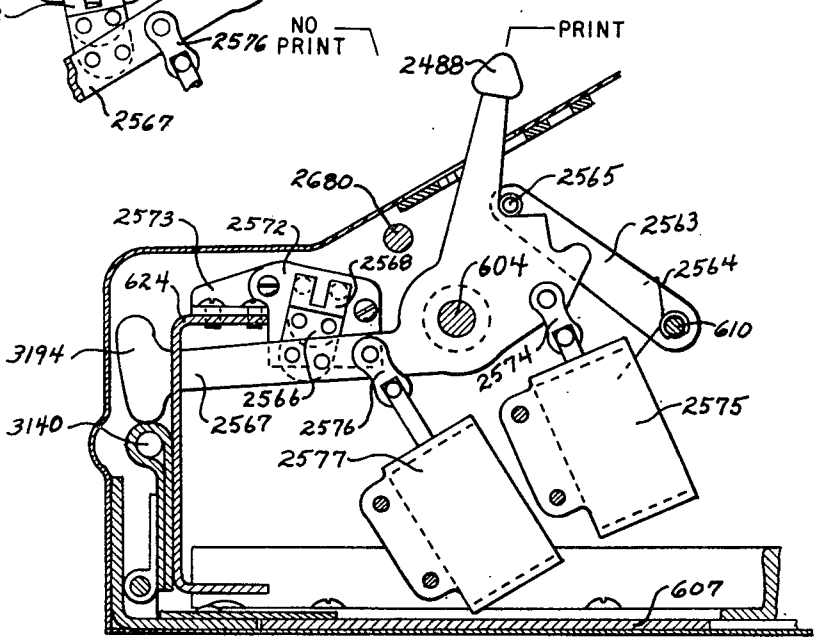

FIG. 155 is a sectional view of the print and no print function control key as seen from line 155—155 (FIGS. 3 and 44).

Figure 156:
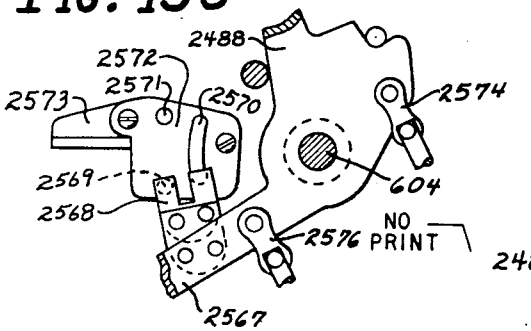

FIG. 156 is a fragmented view of some of the mechanism in FIG. 155 showing the key in an operated position.

Figure 157:
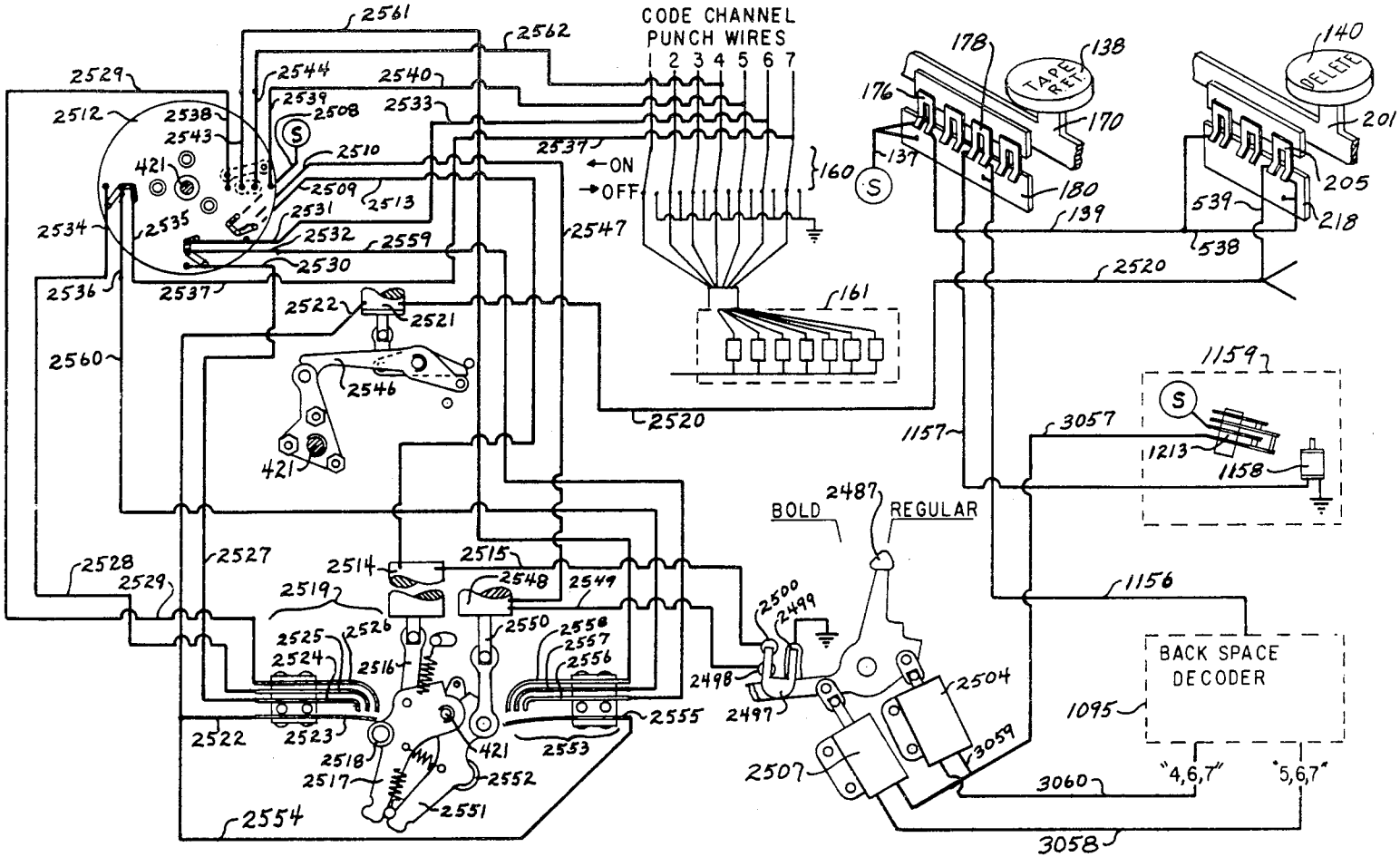

FIG. 157 is a schematic wiring diagram showing circuitry that is involved with the bold and regular function control key.

Figure 158:
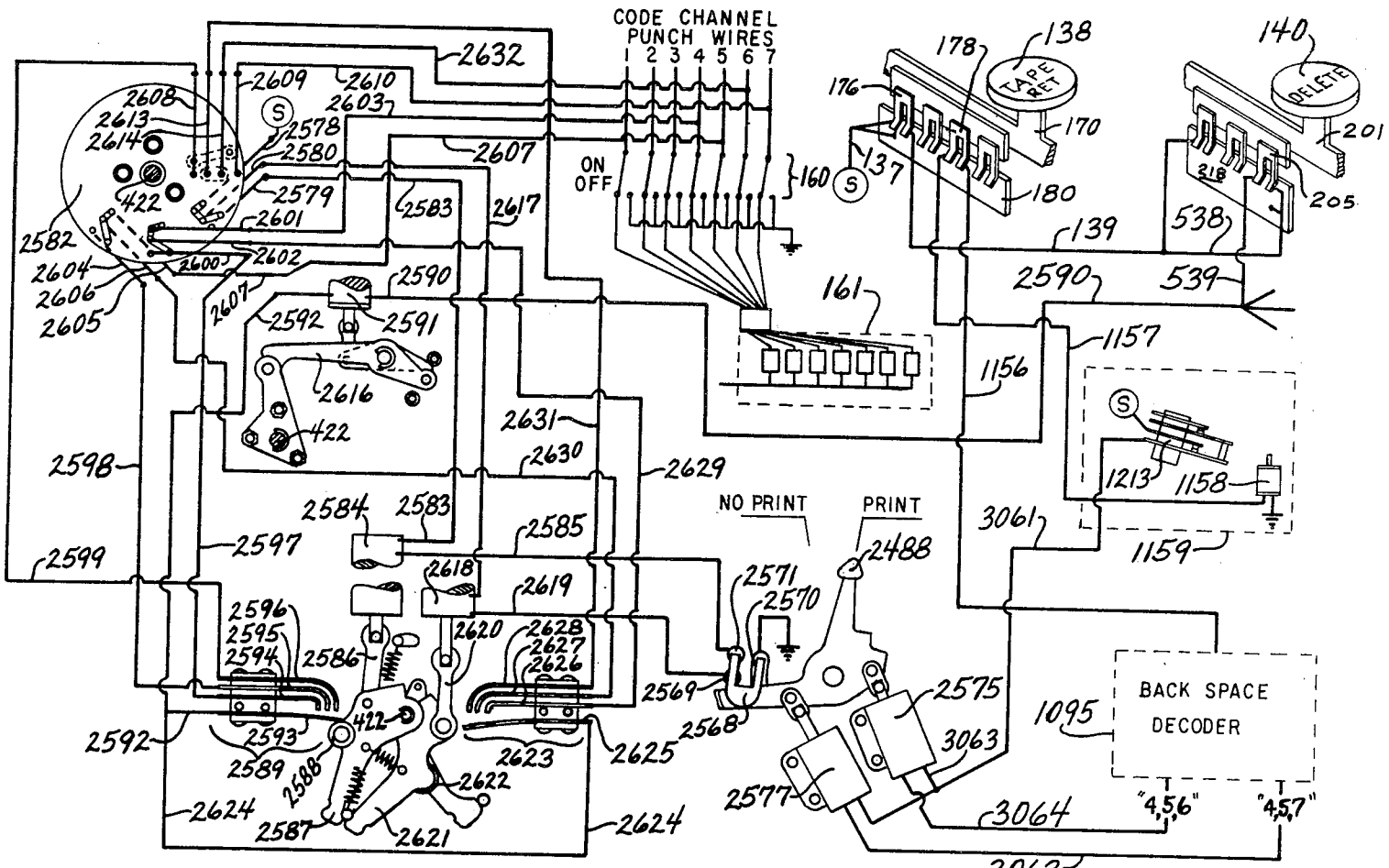

FIG. 158 is a schematic wiring diagram showing circuitry that is involved with the print and no print function control key.

Figure 159:
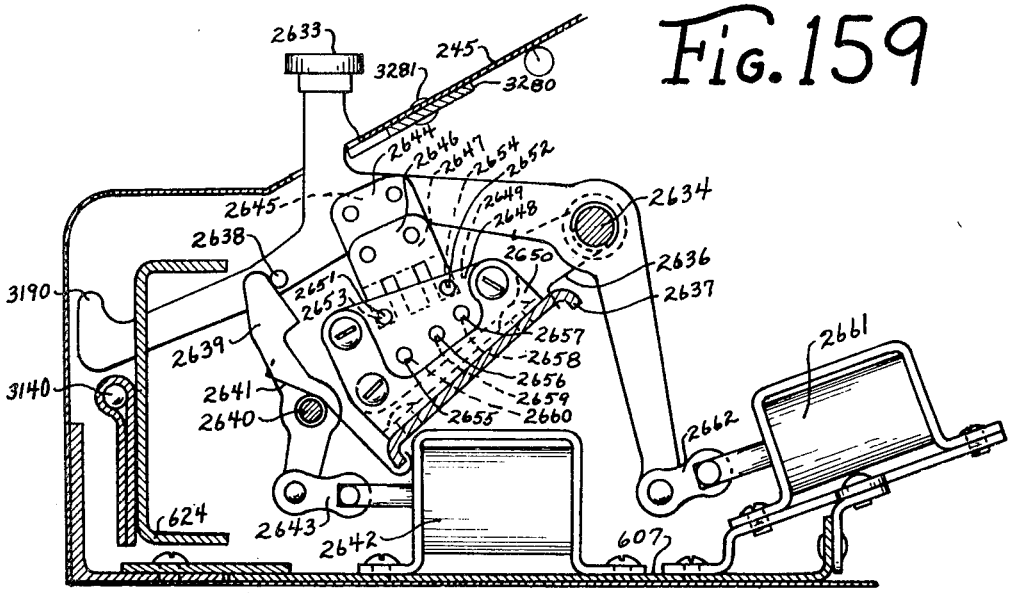

FIG. 159 is a fragmentary right sectional view of the Clear Key as viewed from line 159—159 (FIG. 44).

Figure 160:
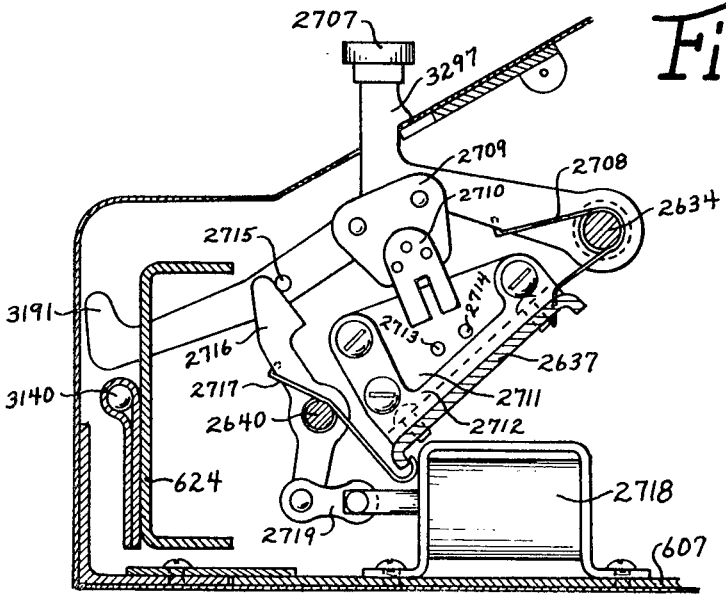

FIG. 160 is a sectional right side view of the condition Key as viewed from line 160—160 (FIG. 44).

Figure 161:
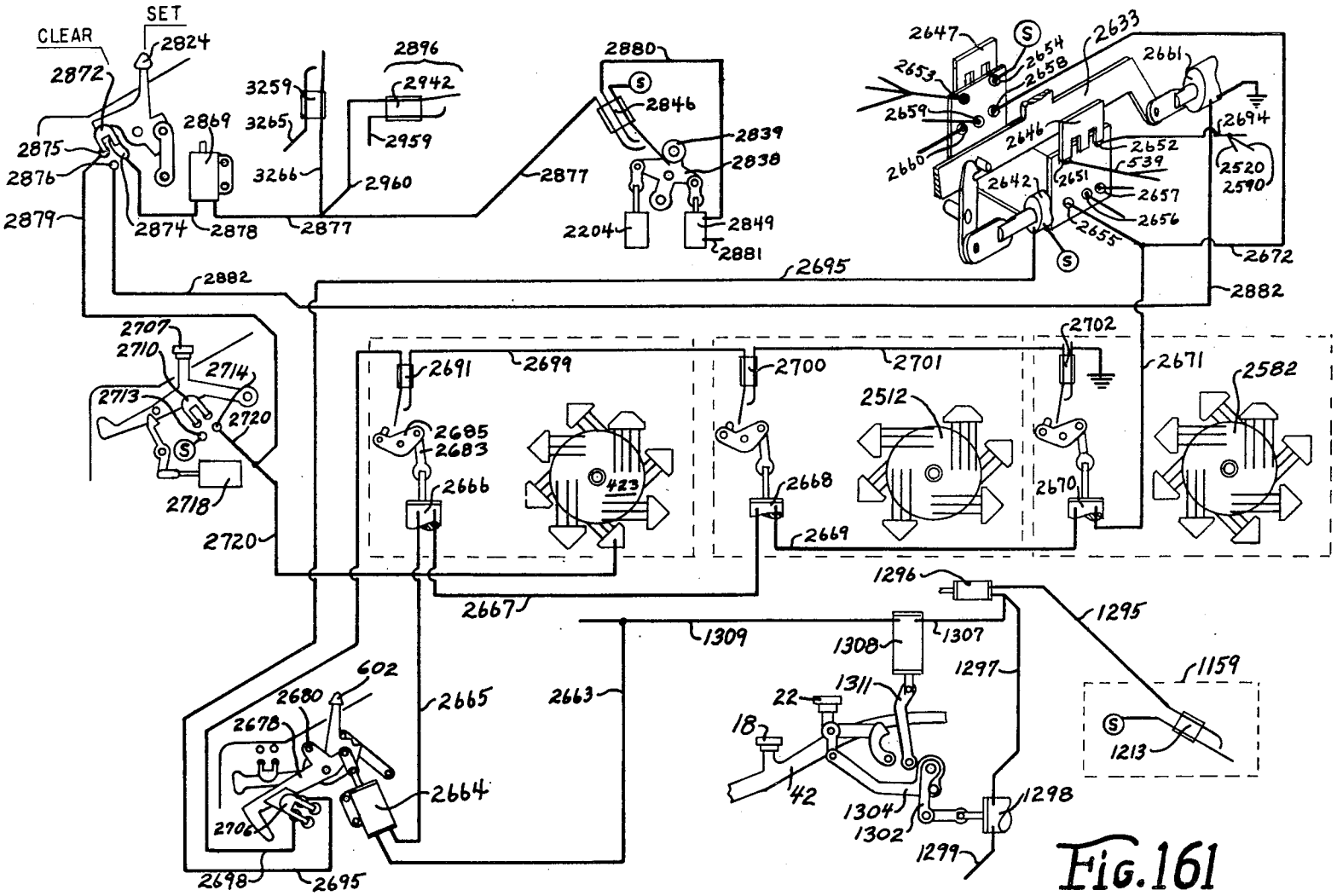

FIG. 161 is a schematic wiring diagram showing some of the motivating and controlling circuitry involved with the Clear Key.

Figure 162:
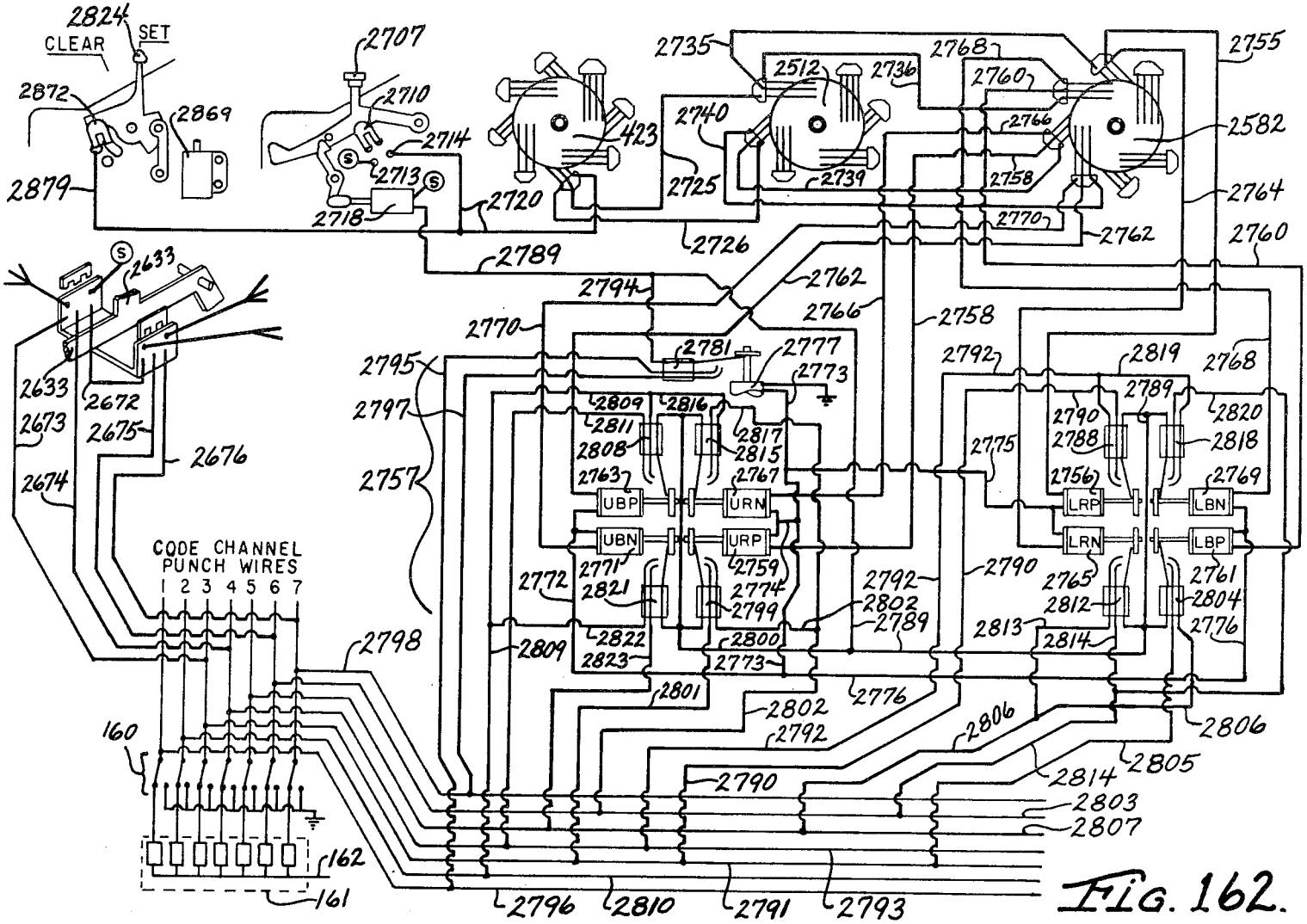

FIG. 162 is a schematic wiring diagram showing some of the circuitry for the Clear Key and the circuitry for the Condition Key.

Figure 163:
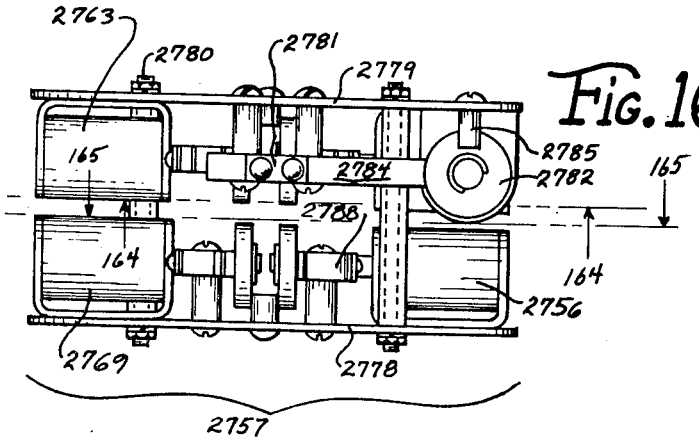

FIG. 163 is a top view of the Condition Encoding mechanism 2757 located as indicated in FIG. 2.

Figure 164:
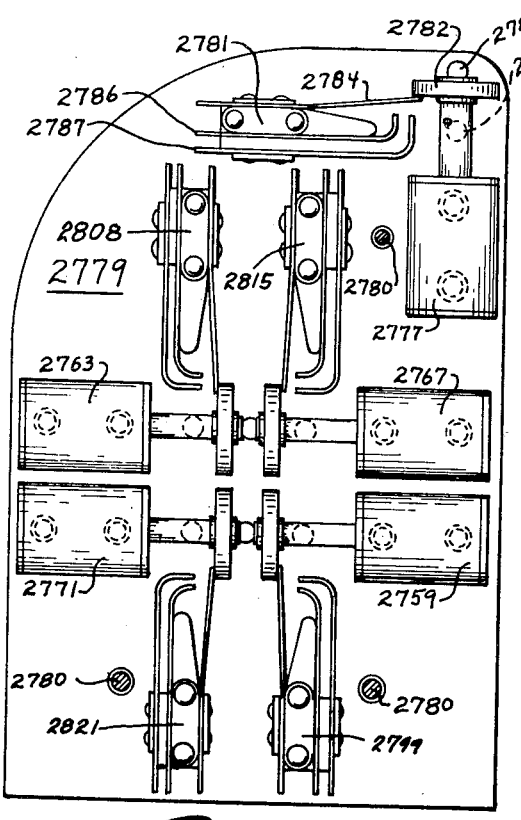

FIG. 164 is a sectional front view of the Condition Encoding mechanism as viewed from line 164—164, FIG. 163.

Figure 165:
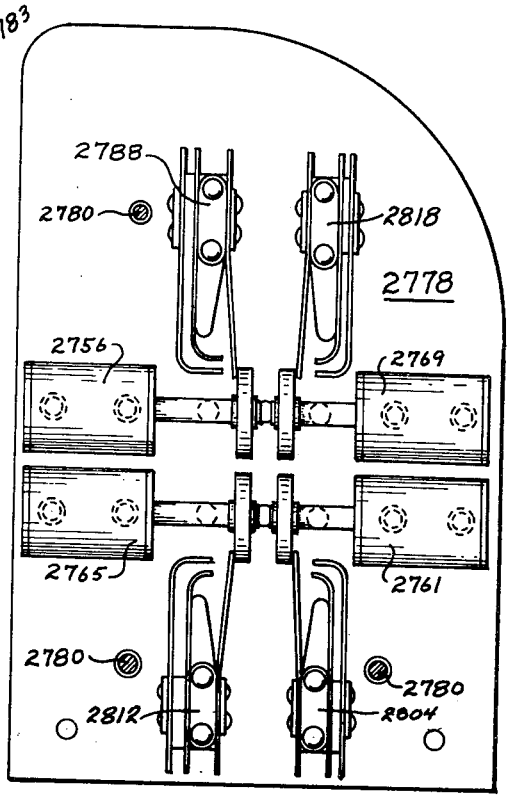

FIG. 165 is a rear sectional view of the Condition Encoding mechanism taken on line 165—165, FIG. 163.

Figure 166:
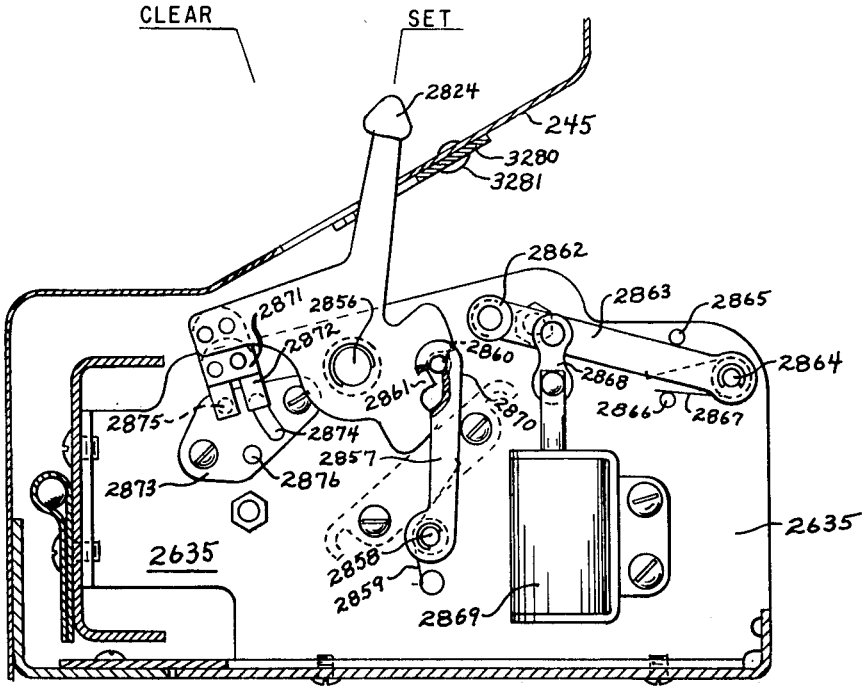

FIG. 166 is a right sectional view of the keyboard as seen from line 166—166 (FIG. 44) and showing particularly the "Clear-Set" Key.

Figure 167:
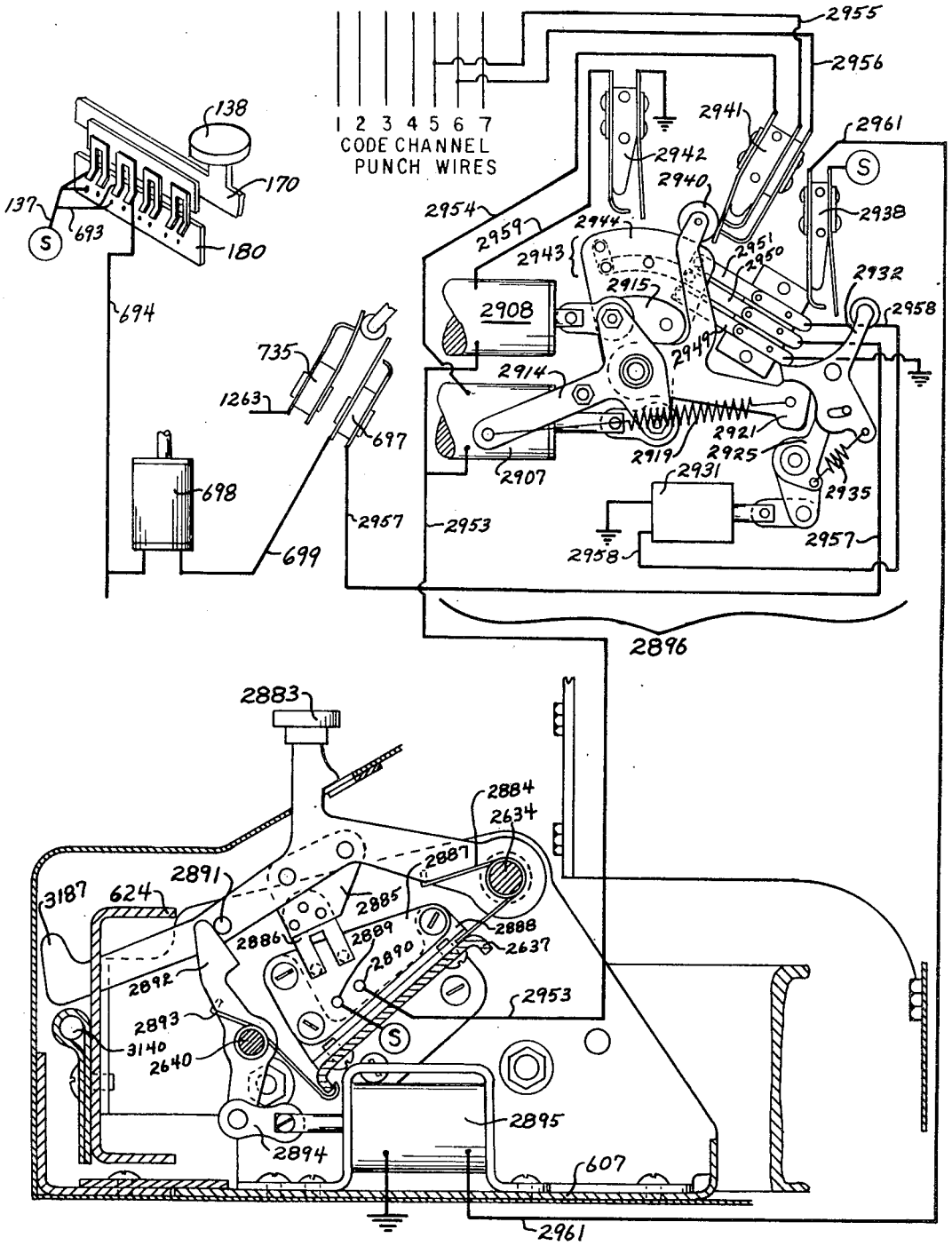

FIG. 167 is a generally schematic wiring diagram of the stop printer circuits, but it also includes a fragmentary detailed sectional right side view of the stop printer key taken generally on a line 167—167 (FIG. 44).

Figure 168:
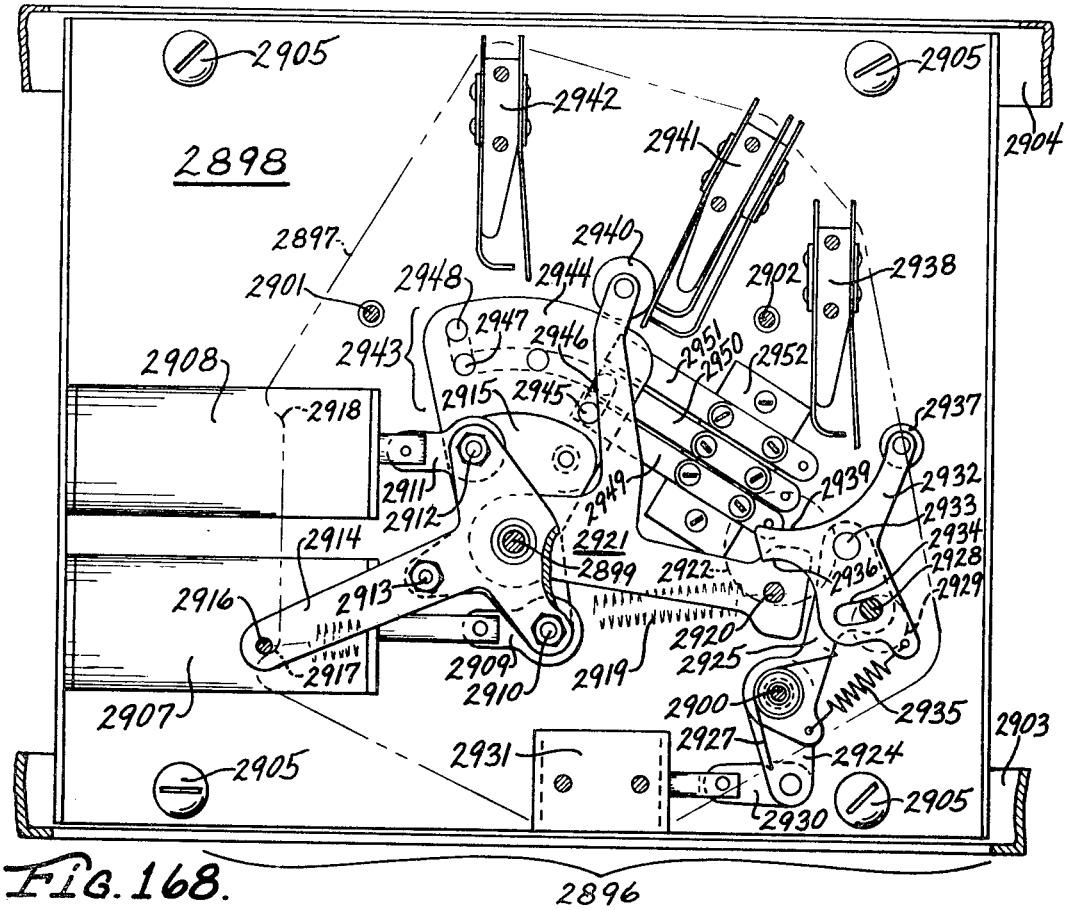
Figure 169:
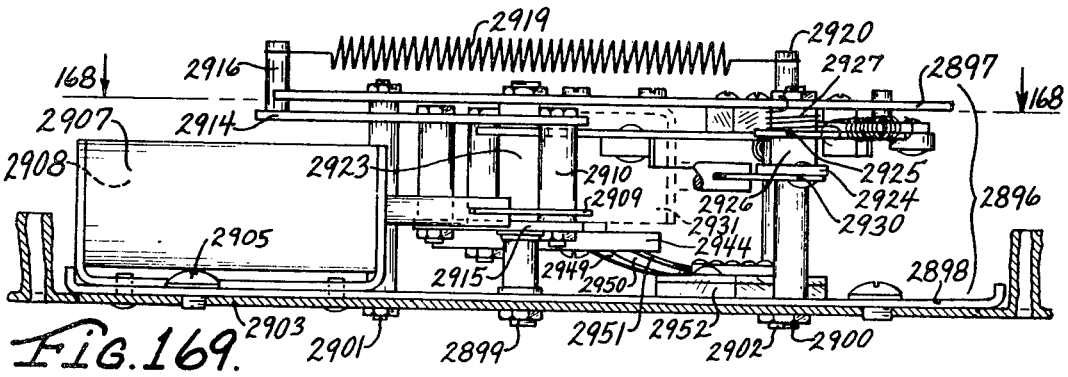

FIG. 168 is a fragmentary sectional top view of the stop printer circuit control mechanism as seen from line 168—168 (FIG. 169).

FIG. 169 is a detailed front elevation of the stop printer circuit control mechanism shown in FIG. 168.

Figure 170:
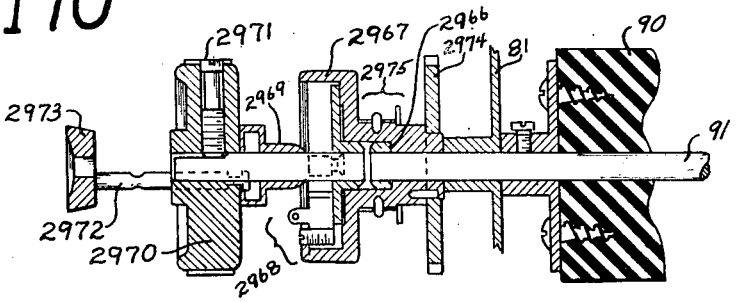

FIG. 170 is a fragmentary vertical sectional view of the left end of the upper carriage platen, showing primarily the fractional line spacing clutch and the manual platen control knob.

Figure 171:
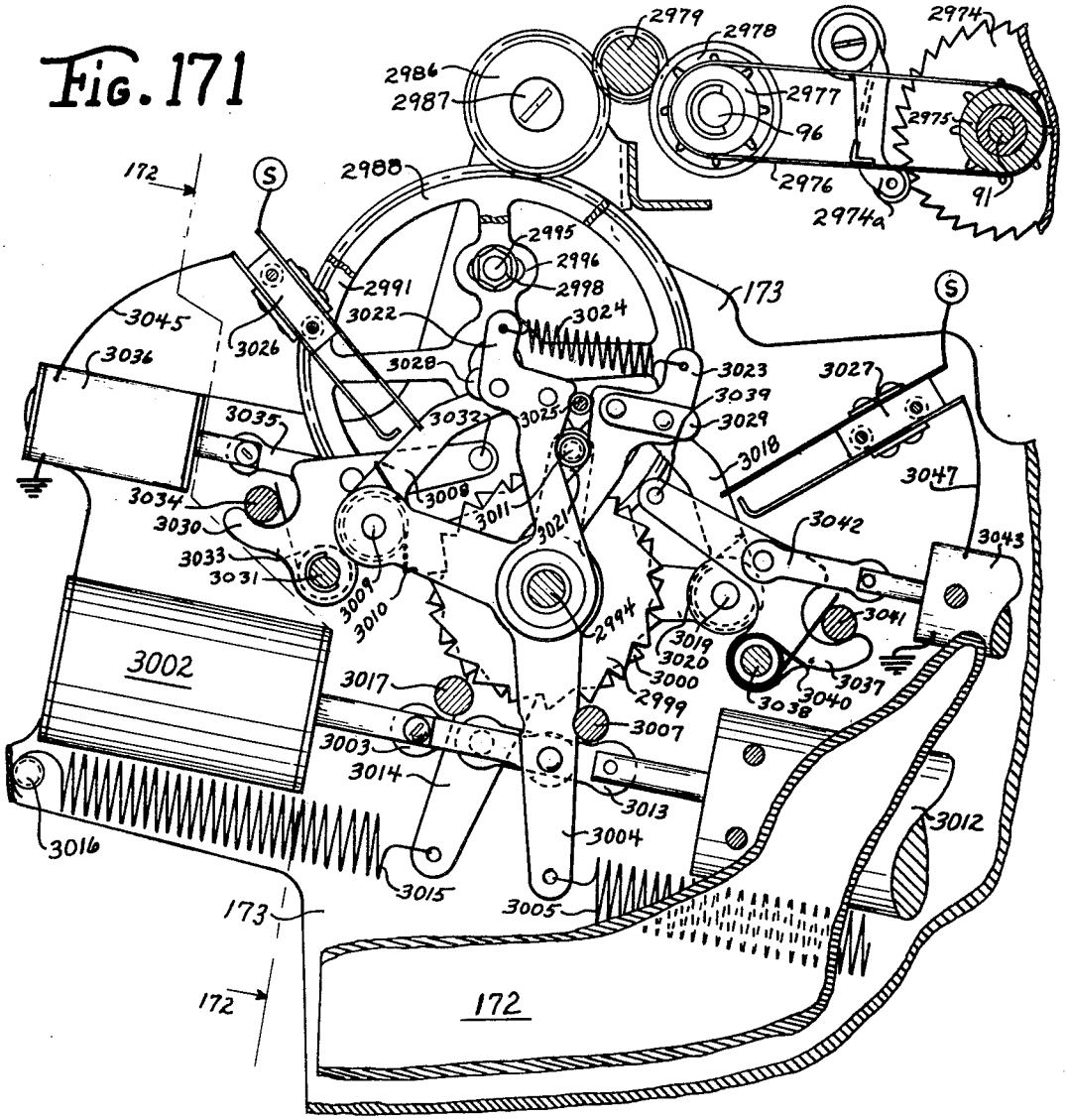

FIG. 171 is a fragmentary left side view of some of the mechanism shown in FIG. 1, showing primarily greater detail of the automatic line spacing mechanism.

Figure 172:
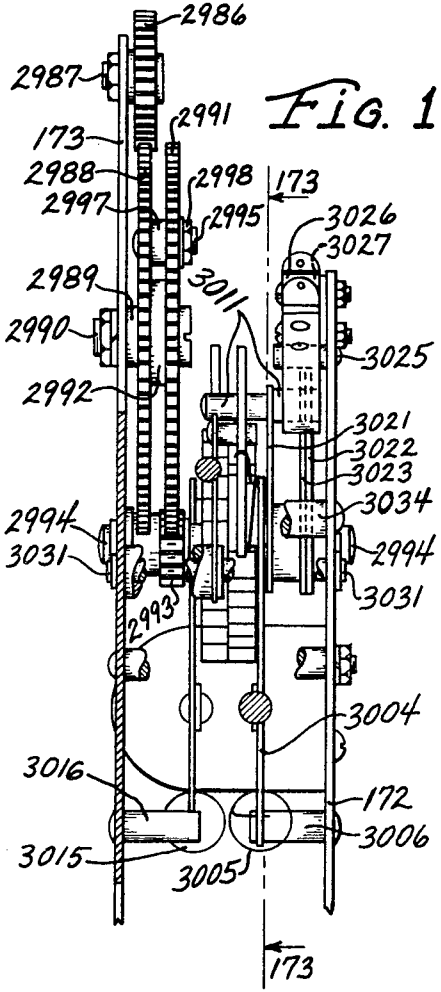

FIG. 172 is a sectional generally rear view of the line spacing mechanism, as viewed from the left of FIG. 171 and from line 172—172 therein, with a few parts omitted for clarity.

Figure 173:
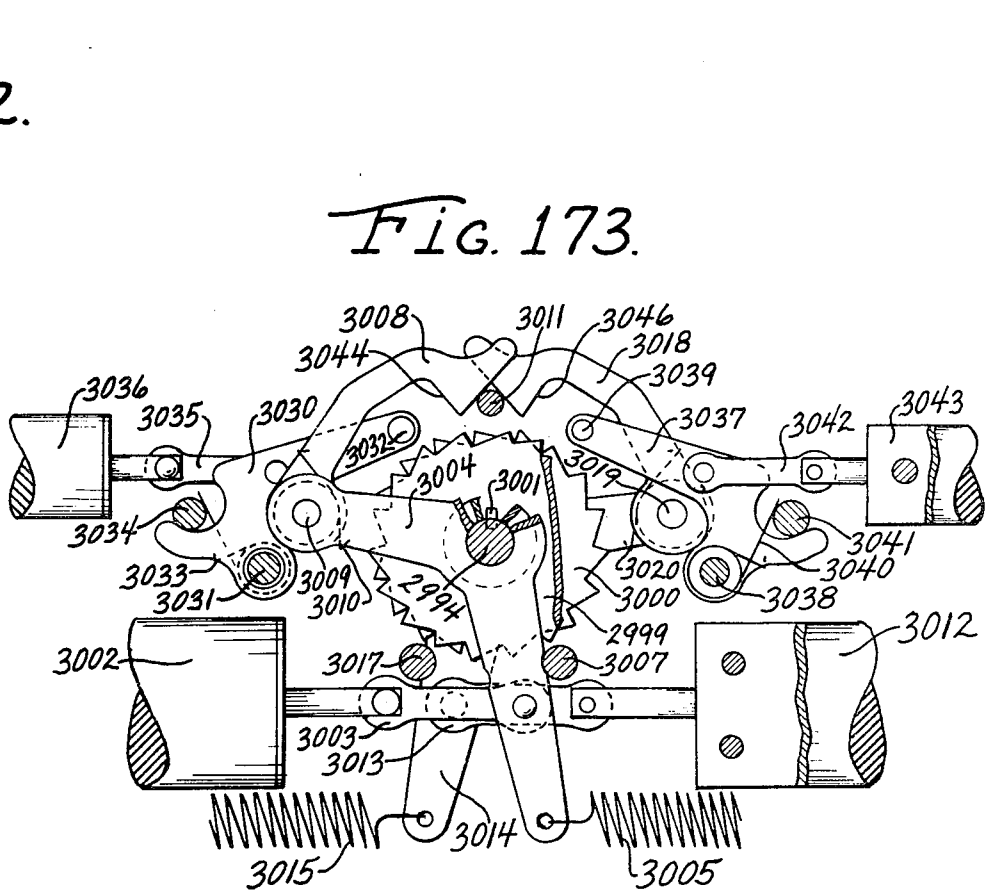

FIG. 173 is a fragmentary sectional view of mechanism shown in FIG. 172 as seen from line 173—173 therein.

Figure 174:
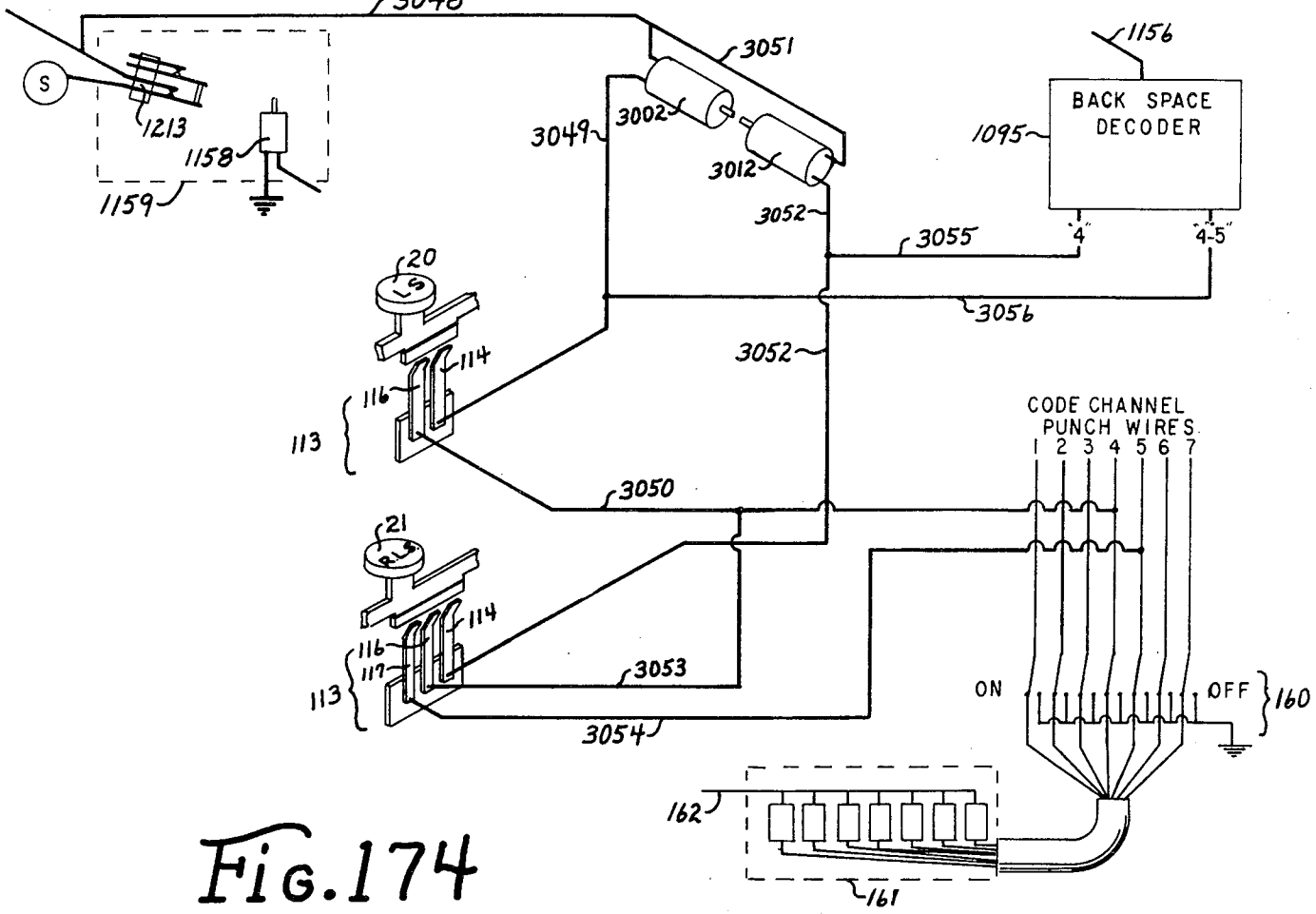

FIG. 174 is a schematic wiring diagram of the extra forward and reverse line spacing circuits.

Figure 175:
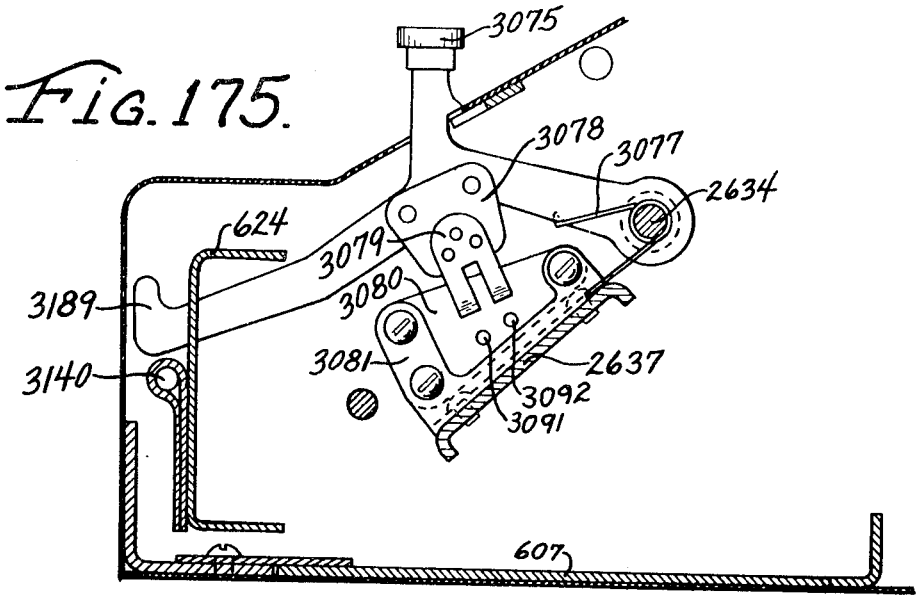

FIG. 175 is a fragmentary right sectional view of the tape feed key 3075 taken on line 175—175 (FIG. 44).

Figure 176:
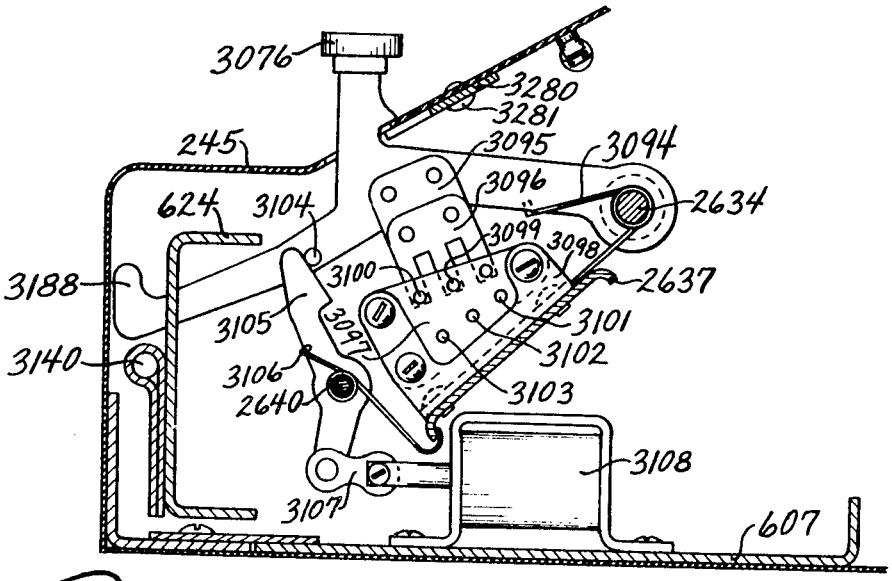

FIG. 176 is a fragmentary right sectional view of the 12 step tape feed key 3076 taken on line 176—176 (FIG. 44).

FIG. 177 is a schematic wiring diagram showing part of the consecutive tape feed circuitry.

FIG. 178 is a schematic wiring diagram showing part of the 12 step tape feed circuitry.

Figure 179:
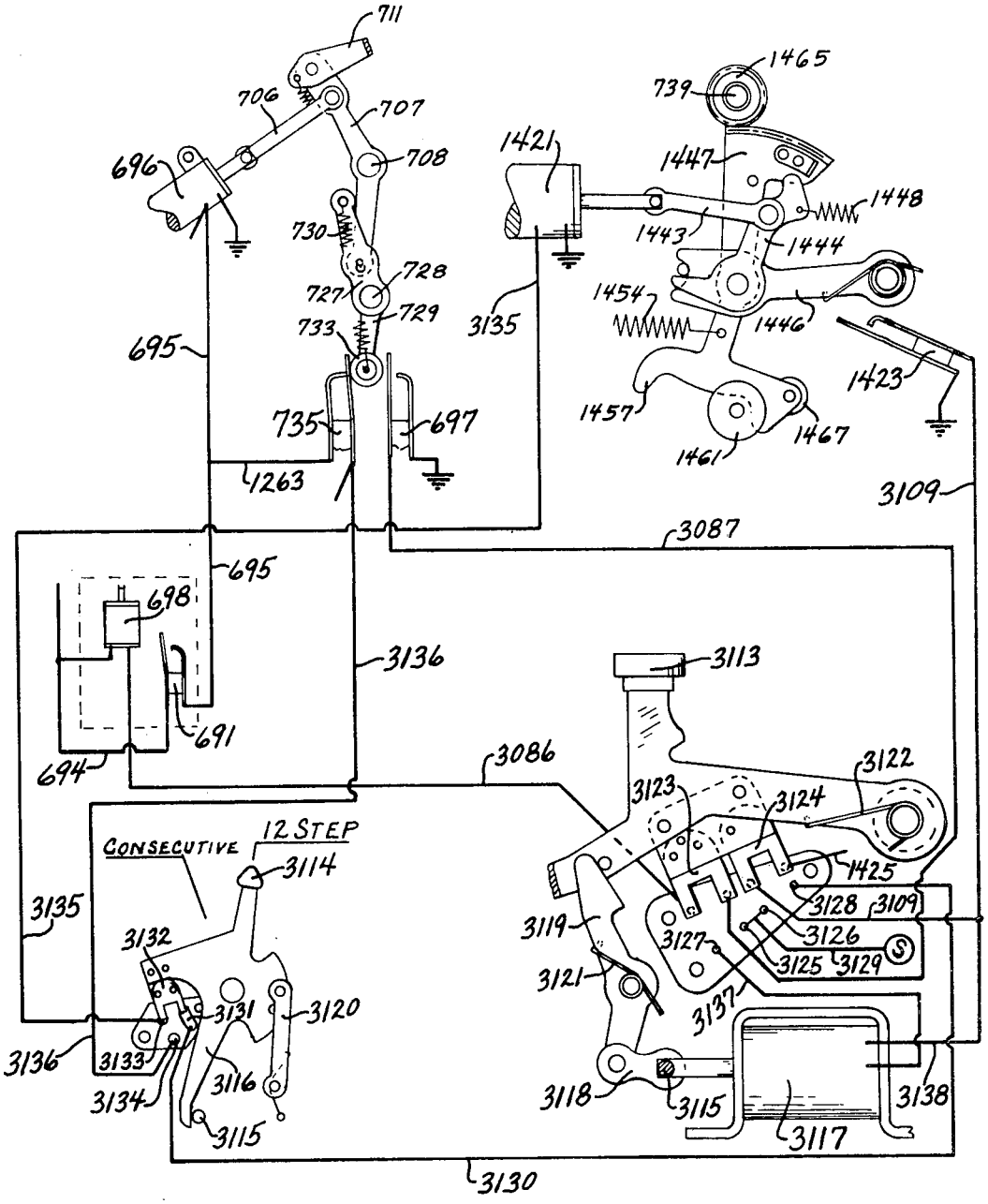

FIG. 179 is a schematic wiring diagram showing modified tape feed circuitry.

Figure 180:
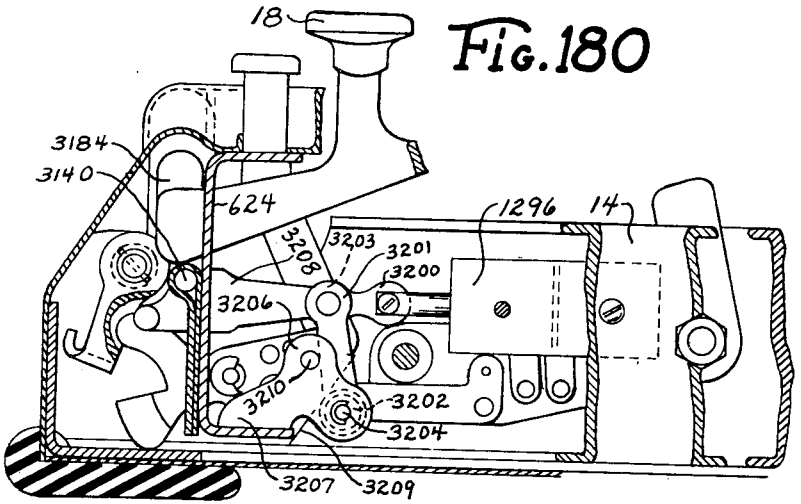

FIG. 180 is a fragmentary view of some of the general key-lock mechanism.

Figure 181:
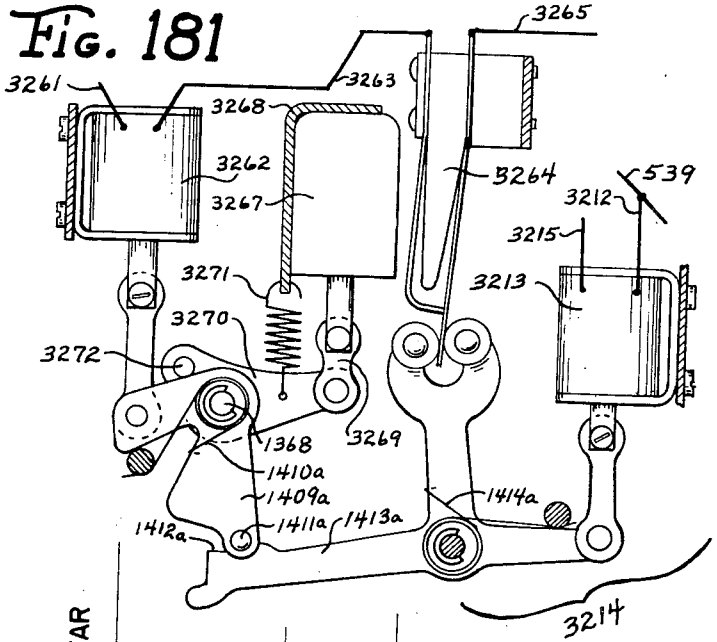

FIG. 181 is a sectional elevation of the punches-on circuit breaker as viewed from line 181—181, FIG. 86.

Figure 182:
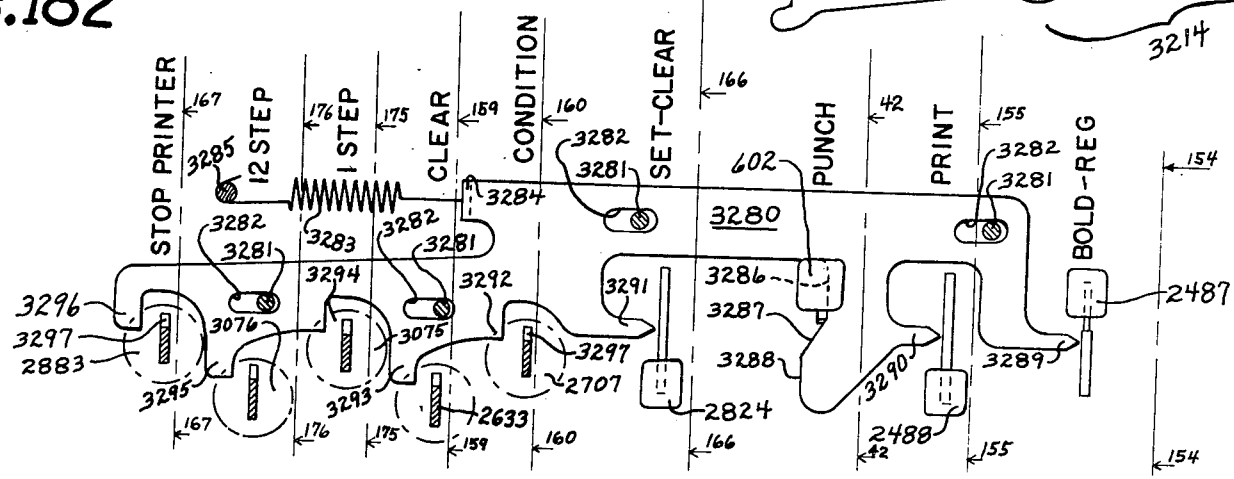

FIG. 182 is a fragmentary plane view of a key lock mechanism, for locking several of the function keys that are located at the right of the keyboard (FIG. 3), as seen from above the keyboard with the cover and other parts cut away for clarity.

FIG. 183 is a fragmentary front view of the type arm segment and other related parts including a print preventing means.

FIG. 184 is a fragmentary right sectional view taken generally on line 184—184 (FIG. 183).

FIG. 185 is a full sized fragmentary left side view of some of the mechanism shown in reduced scale in FIG. 1, showing primarily greater detail of the print preventing means.

Figure 186:
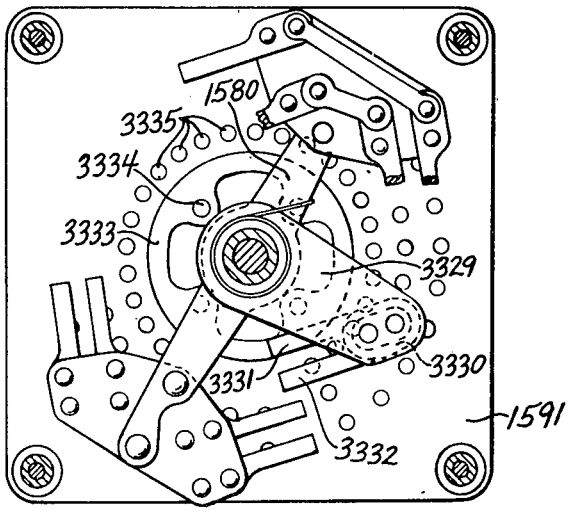

FIG. 186 is a fragmentary sectional view, taken on line 106—106 (FIGS. 18 and 187), showing some of the structures shown in FIGS. 106 and 109 and including further structure of an end of line signal switch means.

Figure 187:
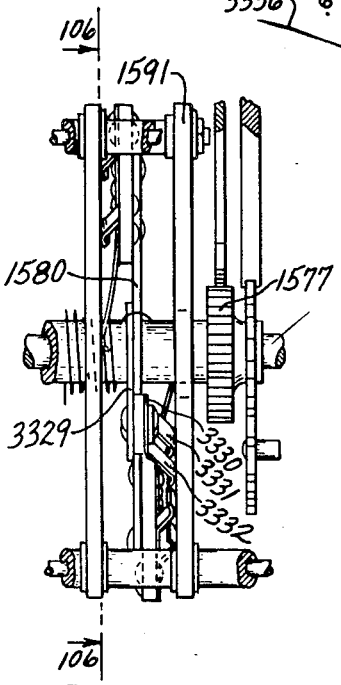

FIG. 187 is a fragmentary view of part of the mechanism shown in FIG. 18 and including a right side view of further mechanism shown in FIG. 186.

Figure 188:
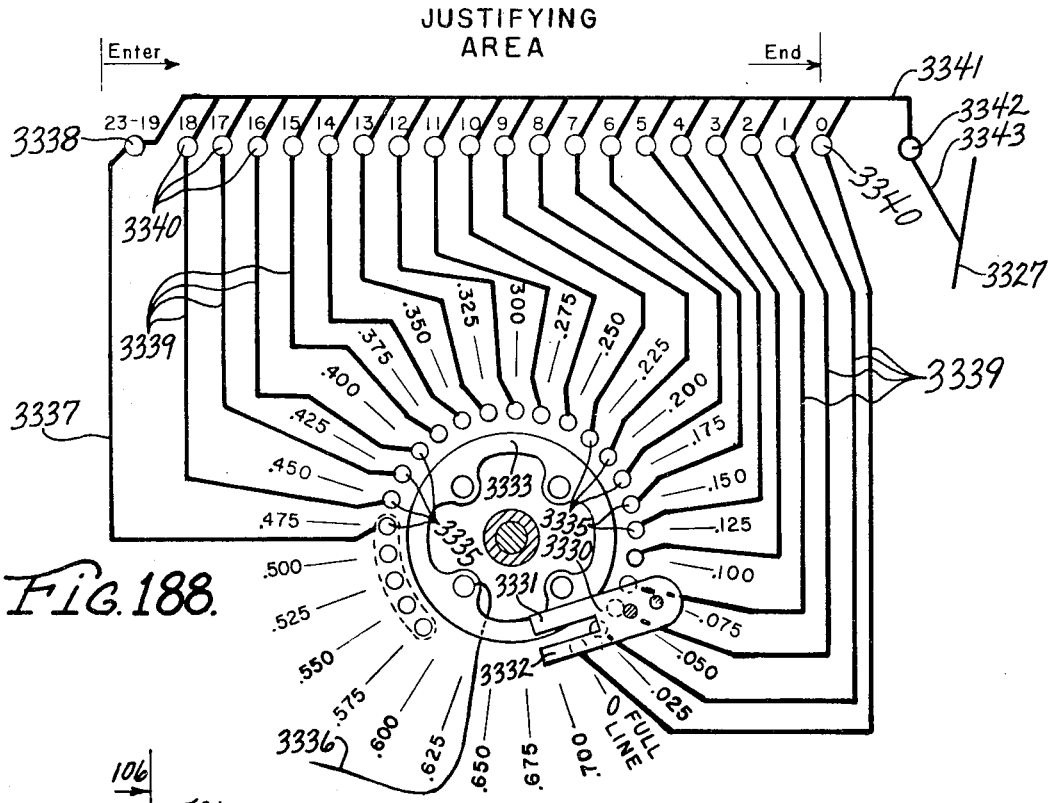

FIG. 188 is a schematic wiring diagram of the end of line signal means.

The following Charts "A"–"E" are referred to occasionally in the detailed description, and they are listed here so they may be readily found.

CHART A

DIFFERENTIAL CHARACTER AND WORD SPACING

| Groups | Carriage Movement | | Different sized characters combined on related keys, and Spaces unaffected by case shift. |
|---|---|---|---|
| A. | Upper Case | .100" | " # $ % ? & ( ) * W M and .100" nut space. |
| | Lower Case | .100" | 1 2 3 4 5 6 8 9 0 w m |
| B. | UC | .050" | ' |
| | LC | .100" | 7 |
| C. | UC | .100" | Q E R T Y U O P A S D F G H J K Z X C V B N |
| | LC | .075" | q e r t y u o p a s d f g h j k z x c v b n |
| D. | UC | .075" | I |
| | LC | .050" | i |
| E. | UC | .100" | L |
| | LC | .050" | l |
| F. | UC | .050" | : - / and .050" Nut space, and Space Bar. |
| | LC | .050" | ; , . |
| G. | UC | .075" | .075" nut space. |
| | LC | .075" | |

NOTE:
The above includes all of the character keys, except the underline key which does not cause carriage movement.

CHART B

CHARACTER AND SPACE KEY CODES

| Alphabet | Code | Numerals | Code |
|---|---|---|---|
| A | 124 | 1 | 2 |
| B | 157 | 2 | 23 |
| C | 147 | 3 | 24 |
| D | 126 | 4 | 25 |
| E | 12 | 5 | 26 |
| F | 127 | 6 | 27 |
| G | 134 | 7 | 245 |
| H | 135 | 8 | 234 |
| I | 35 | 9 | 235 |
| J | 136 | 0 | 236 |
| K | 137 | | |
| L | 3 | | |
| M | 246 | Punctuation | |
| N | 167 | ( , ) | 36 |
| O | 17 | ( ; ) | 345 |
| P | 123 | ( . ) | 347 |
| Q | 1 | Spaces | |
| R | 13 | .050" Nut Space, | 346 |
| S | 125 | .075" Nut Space, | 1457 |
| T | 14 | .100" Nut Space, | 247 |
| U | 16 | Word Space(Space Bar) | 34 |
| V | 156 | | |
| W | 237 | | |
| X | 146 | | |
| Y | 15 | | |
| Z | 145 | | |
| Underline | 1456 | | |

CHART C

JUSTIFICATION CODES

| QUOTIENT | CODE THEREFOR | REMAINDER | CODE THEREFOR |
|---|---|---|---|
| 1 | 5 | 1 | 7 |
| 2 | 6 | 2 | 67 |
| 3 | 256 | 3 | 267 |
| 4 | 356 | 4 | 257 |

CHART C-continued

JUSTIFICATION CODES

| QUOTIENT | CODE THEREFOR | REMAINDER | CODE THEREFOR |
|---|---|---|---|
| 5 | 2356 | 5 | 2567 |
| 6 | 2346 | 6 | 357 |
| 7 | 2345 | 7 | 367 |
| 8 | 2456 | 8 | 2357 |
| 9 | 3456 | 9 | 2367 |
| 10 | 1256 | 10 | 3567 |
| 11 | 1345 | 11 | 23567 |
| 12 | 1346 | 12 | 37 |
| 13 | 1356 | 13 | 2347 |
| 14 | 13456 | 14 | 2457 |
| 15 | 1234 | 15 | 2467 |
| 16 | 1235 | | |
| 17 | 1236 | | |
| 18 | 1245 | | |
| 19 | 1246 | | |
| 20 | 12456 | | |
| 21 | 12345 | | |
| 22 | 12356 | | |
| 23 | 12346 | | |

CHART D

FUNCTION CODES

| FUNCTION | CODE |
|---|---|
| Carriage return | 1237 |
| Line Delete | 3457 |
| Clear (Normal) | 3467 |
| Line space | 4 |
| Rev. Line space | 45 |
| Upper case | 46 |
| Lower case | 47 |
| No Print | 456 |
| Print | 457 |
| Bold face | 467 |
| Delete, any code & | 4567 |
| Stop printer | 56 |
| Back space func | 57 |
| Regular face | 567 |

CHART E

CONDITION CODES

| | |
|---|---|
| (1) Lower case, Regular face and Print, | 1,3,4,7 |
| (2) Upper case, Regular face and Print, | 1,3,6,7 |
| (3) Lower case, Bold face and Print, | 1,3,5,7 |
| (4) Upper case, Bold face and Print, | 1,2,4,7 |
| (5) Lower case, Regular face and No-print, | 1,5,6,7 |
| (6) Upper case, Regular face, and No-print, | 1,2,6,7 |
| (7) Lower case, Bold Face and No-print, | 1,4,6,7 |
| (8) Upper case, Bold Face and No-print, | 1,2,5,7 |

TOPICAL INDEX

General Description
Objects
Figure Descriptions
Charts
Topical Index
Detailed Description 1. General Frame Members
2. Standard Typewriter
3. Character Key Switches
4. Character Key Circuits
5. Tape Return Key Structure
6. Delete Key Structure
7. Justifying On-Off Key
8. Justifying Key Switch Means
9. Carriage Moving Mechanism
10. Upper-Lower Case Switch Means
11. Case Switch Shifting and Encoding Means
12. Main Punch Mechanism, and Code Punching And Reading Assembly Framework -continued

TOPICAL INDEX

General Description
Objects
Figure Descriptions
Charts
Topical Index
Detailed Description 13. Punch Control Key Arrangement
14. Forward Main-Punch Tape Feeding
15. Space Keys and Their Circuits
16. Word-Space Counter Structure
17. Back Spacing and Deleting
18. Control-tape Return
19. Deleting Tape Return and Deleted Codes
20. Deleting Case-Shift Codes
21. Carriage Return
22. Secondary Line Terminating Circuit
23. Left Margin Adjustment
24. Adjustable Right-hand Margin Means
25. Amount Left In Line Mechanism
Amount Left In the Line Commutator
Amount Left In Line Commutator Circuits
Commutators For Differential Key-locks
26. Differential Key-Lock Mechanism
27. Dividing and Encoding Mechanism For Justifying
28. Justifying Punches and Their Operation
29. Full Carriage Return Restoring Circuit
30. The Main Reader
31. Space At End of Line Prevented
32. Bold-Regular and Print-No Print Functions and Encoding
33. The Clear Key And It's Functions
34. Condition Encoding and Key Therefor
35. Line Delete
36. Stop Printer
37. Extra Line Spacing, Encoding And Platen Rotating
38. Deleting Functions
39. Tape Feed Keys
40. General Key Locks
41. No-Punch Operation Of The Machine
42. Punches-off Key-Locks and Back-Space Print Preventing Means
43. Electrical Supply And Connections
44. Justifying Area Signal

DETAILED DESCRIPTION

In the preferred form of the invention, the mechanisms of the composing machine are assembled together as one unit, as shown in FIG. 1. However, many of the components are wire connected to the other components and they could just as well be housed in a separate cabinet, in a typewriter desk, or in other container or containers, without departing from the spirit of the invention. The unified construction is preferred, since this construction avoids extension cords or at least avoids electrical connection means which would be uncoupled and recoupled each time the machine were moved. Thus, the unified construction avoids, to a greater extent the possibility of loose connections due to wear or mistreatment of the electrical couplings, and thus it leads to greater dependability.

1. GENERAL FRAME MEMBERS

The composing machine is assembled about a sturdy four sided base 1 (FIGS. 1 and 2), which is preferably made of angle stock formed of one or more pieces. A centrally located transverse T-shaped member 2, in an inverted attitude, is fitted between and secured at its ends to the side rails of the base 1. Another transverse T-shaped member 3, similarly inverted and parallel to T-shaped member 2, is located rearward from T-shaped member 2 and it is secured to the side rails of the base 1 in the same manner. A solid sheet 4, fitting the dimensions of the base 1, is secured in any convenient manner to the under side of the base 1 for protecting the machine from dust or any other foreign matter upon which it may be set. Suitable resilient material 5 (FIG. 1) is secured under the four sides of the base 1 for insulating sound and vibration from the table, desk or other work surface on which the machine may be placed. This material is continuous and forms a barrier for preventing things such as pencils from being accidentally moved under the machine. Pieces 6 and 7 of resilient material may be placed under solid sheet 4 and secured therethrough to the T-shaped members 2 and 3, providing more solid central machine support. The resilient material, being yieldable at all points or relatively high pressure, also serves to absorb slight unevenness of the desk or other supporting furniture on which it may be pressed and thus it provides stable support for the machine frame.

An elevated frame portion, or upper frame assembly 8 as it may be called, for supporting various mechanisms as will be explained, is comprised of a shelf member 9 with four legs 10 (FIG. 2) secured to its corners and depending therefrom. Shelf member 9 (FIG. 1) may be formed like a pan with weight bearing upturned edge portions 11 on its four sides. The upper ends of the legs 10 may be secured to the shelf member 9 as by welding for example, and the lower ends may be secured to the base 1 as by machine screws 12 (FIG. 2).

Two channel members 13 and 14, in spaced positions parallel to the sides of the base 1, are secured at their forward ends to the front rail of the base 1 and at their rearward ends to the transverse T-shaped member 2. A standard typewriter frame 15 is assembled on the channel members 13 and 14 and it is secured thereto in any well known manner.

2. STANDARD TYPEWRITER

A standard office typewriter (Underwood #5) is selected to illustratively indicate that any commercially developed typewriter may be adapted for use as a component in the combinations disclosed herein. Reasonably, therefore, the well known parts of the selected typewriter are explained briefly and all modifications thereof and additions thereto are described in detail.

Other commercially developed typewriters can be employed in place of the selected strictly mechanical Underwood #5. Motor driven typewriters having a spinning drive roll and latch-controlled cam drive arrangements and other self powered types can be employed for performing the operations of typing and handling the paper the same as those performed herein by manual or electromechanical drive means, without departing from the spirit of the invention. The selected typewriter is equipped with a shiftable paper carriage, but it will become apparent that any typewriter, including those with shiftable imprinting means or other means for coordinating characters and spaces on a print receiving means to compose a line of text instead of the illustrated shiftable carriage, may be incorporated by one schooled in the art without departing from the spirit of the invention.

The keyboard, within the standard typewriter frame 15 (FIG. 2) of the illustrated embodiment, is comprised of a nearly standard arrangement of keys shown in FIG. 3. Modifications and additional control keys will be described under appropriate headings hereinafter.

Normal character keys 16 are adapted to be actuated for accordingly imprinting the appropriate character and for causing the paper carriage to be moved the appropriate letter space amount, which movement being differentially variable and corresponding to the particular key 16 and the upper or lower case condition of the machine.

Shift keys 17 and 18 are arranged and actuatable in the well known manner for case shifting.

An underline key 19 is actuated for imprinting an underline mark in both upper and lower case conditions of the machine, but it does not cause carriage movement as do the normal character keys 16. A word may be underlined by an alternate use of first the underline key 19 and the normal character keys 16 in the proper order of printing the word and for accordingly moving the carriage, without back-spacing the carriage for underlining the word.

A line space key 20 does not cause longitudinal carriage movement, but it is actuated for causing forward line space rotation of the platen in the composing machine and for causing forward line space encoding and, therefore, corresponding control in the reproducer. A reverse line space key 21 is actuated manually for causing reverse line space rotation of the platen and for causing reverse line space encoding.

A shift lock 22, as is customary, is actuated for holding the machine in upper-case condition until a shift key 17 or 18 is actuated for releasing the shift lock 22.

A normal character keys 16 and the underline key 19 are carried by key levers 23 (FIG. 4) which, when actuated, operate bell-cranks 24 and type arms 25 through a well known type-actuating arrangement.

The rearward ends of the key levers 23 are fulcrumed on a transverse rod 26 which is rigidly held by a frame 27. The frame 27 consists of two transverse portions 28 and 29, the left and right ends of which are secured to the inner sides of the typewriter frame 15 in the usual manner. The rear transverse portion 29 carries upwardly extending comb like furcations 30 which are drilled to receive the transverse rod 26.

The key levers 23 are assembled between furcations 30 which maintain the rearward ends of the key levers 23 in their proper spaced relation. Adjusting screws 31 are threaded in rear transverse portion 29. Springs 32 between each key lever 23 and its adjusting screw 31 provide the desired tension for returning the keys 16, 19 and the type actuating arrangements.

A headed stud 33 is fixed to the side of each key lever 23. The forward extensions of the bellcranks 24 are bifurcated to receive the studs 33 of their related key lever 23 and the heads of the headed studs 33 guide the bellcranks 24 in juxtaposed relationship with their respective key levers 23.

The forward transverse portion 28 of frame 27 has forwardly extending comb like furcations 34, which maintain the bellcranks 24 in their proper spaced relation and support a rod 35 on which the bellcranks 24 support headed studs 36. The headed studs 36 are received by slots 37 in the type arms 25 and the heads of the headed studs 36 guide the upwardly extending arms of the bellcranks 24 in proper juxtaposed relationship with their respective type arms 25.

The type arms 25 are arranged in a well known semi-circular fashion, being hung on a semi-circular bent fulcrum rod 38, and they are assembled in slots 39 formed in a type arm segment frame 40 which supports the fulcrum rod 38. The frame 40 is secured to a transverse support member 41, which in turn is secured to the inner left and right (not shown here) sides of the typewriter frame 15.

Whenever a character key 16 or the underline key 19 is depressed, its key lever 23 pivots downwardly about the transverse rod 26, the lever 23 compresses its spring 32 slightly, and the headed stud 33, is swung downward. The downward movement of headed stud 33, acting on the bifurcation in the forward extension of the bellcrank 24, causes the bellcrank 24 to pivot counterclockwise about the rod 35. Counterclockwise movement of bellcrank 34 causes it headed stud 36 to move forward, and acting on the forward side of slot 37, moves the type arm 25 clockwise to perform the usual printing procedure of striking the ink ribbon and the paper against the platen 90 (FIG. 3). When the depressed key 16, 19 is allowed to return, the reverse directions for returning the printing mechanism are assured by the spring 32 (FIG. 4) assisted by the effect of gravity on the type arm 25 and the leverages developed by the type arm 25 and bellcrank 24.

The typewriter chosen for illustrative purposes is the well known kind wherein the platen 90 (FIG. 3) is shiftable up or down under control of the case shift keys 17 and 18. However, a typewriter wherein the type arm segment assembly is moved in relation to the platen for case shifting purposes could just as well be used without departing from the spirit of the invention.

The shift key 18 (FIG. 4) is carried by a key lever 42, which is fulcrumed at its rearward end on the rod 26, and it is urged upwardly to normal position by one of the springs 32. Key lever 42 has a vertical arm 43 adapted for affecting a case shifting bail arrangement which will be explained presently.

The shift key 17, located to the left of the character key group, is carried by a key lever 44. This key lever 44 has the same general characteristics as those described for key lever 42 above. Key lever 44 has a vertical arm 45 like arm 43 on key lever 42, and key lever 44 is also pivoted on rod 26 and it is urged to return by a spring 32.

The case shifting bail arrangement is a four sided frame which is mounted for turning about the axis of a transverse longitudinal torque rod 46, which is the rearward side of the standard typewriter frame 15. The opposite forward side of the standard typewriter frame 15 may be raised and lowered for shifting the platen 90 (FIG. 3) in the paper carriage upward and downward for the well known case shifting purposes. This case shifting bail arrangement is comprised of a transverse bail rod 47, (FIG. 4) the torque rod 46 which is journalled at its ends in the sides of the standard typewriter frame 15, a right side member 48 which is fixed to the right end of transverse bail rod 47 and fixed to the torque rod 46 near its right end, and a left side member 49 secured to the left end of transverse bail rod 47 and to the torque rod 46 near its left end.

The vertical arms 43 and 45 of the shift key levers 44 are arranged in engaging alignment with the rear edges of the side members 48 and 49, respectively, and they are constructed to contact the respective side members 48 and 49 at a point below the journalled shaft formed by torque rod 46. Forward movement of either arm 43 or 45, in response to depression of the respective shift key 17 or 18, causes the case shifting bail arrangement to turn clockwise for raising its transverse bail rod 47 to upper case position.

A guide means 50 is provided on each of the side members 48 and 49 for assuring proper alignment of the respective arms 43 and 45. The guide means 50 are assembled through slots in their respective members 48 and 49 and they are pressed firmly to the sides of the members 48 and 49 in a U-shape so as to form a bifurcation within which the respective arm 43 or 45 is guided in engaging alignment with the side member 48 or 49.

Depression of the shift key 18 moves the key lever 42 and its arm 43 counterclockwise about rod 26. This movement of arm 43 shifts the case shifting bail arrangement clockwise about the axis of torque rod 46 and raises the transverse bail rod 47 to its upper case position. Depression of shift key 17 accomplishes the same result through its key lever 44, arm 45 and the case shifting bail arrangement. Elevation of transverse bail rod 47 causes the platen 90 to be elevated to upper case position through well known means to be found in the carriage and which means will be more fully explained later.

The weight of the platen 90 and carriage borne means by which the paper carriage platen 90 is moved upward is, to a large extent, counterbalanced by a spring 51. The spring 51 is connected to the side member 48 at a point below torque rod 46, and the other end of the spring 51 is anchored to the standard typewriter frame 15 in the usual manner not shown here. The effectivity of the spring 51 may be varied by hooking the spring 51 in any of the several notches 52, which are differentially arranged with respect to torque rod 46 on side member 48. The angle of the spring's force as well as the resulting leverage on the case shifting bail arrangement can thus be altered to acquire the desired shift key finger pressure assist.

A locking means is provided for preventing the case shifting bail arrangement from being pivoted out of the lower case position unless a shift key 17 or 18 is operated. For this purpose, the side member 49 has a depending arm 53, which supports a rightwardly extending stud 54. The stud 54 extends through an opening 55 in the rearward end of a detent 56. The detent 56 is carried by a rearward extension of a pivotal member 57 (FIG. 6), which is fulcrumed on a stud 58. The stud 58 is secured to the inner left side of the typewriter frame 15. A torsion spring 59 is anchored to typewriter frame 15 and assembled about the bearing hub of pivotal member 57. The free end of the torsion spring 59 is connected to the rearward extension of pivotal member 57, and it urges the pivotal member 57 and detent 56 clockwise. The configuration of opening 55 (FIG. 4) provides a blocking surface 60, which lies in the path of stud 54 when the bail arrangement is in the lower case position and the detent 56 is in its clockwise position as shown. Counterclockwise movement of the detent 56 raises the blocking surface 60 out of effective position, and only then can the bail arrangement and, therefore, the platen 90 be moved to upper case position.

The blocking surface 60 of the detent 56 is rendered ineffective for blocking when a shift key 17 or 18 is operated. This is accomplished by an arrangement including a transverse shaft 61, which is journalled at its ends in the typewriter frame 15. A generally vertical cam member 62 (FIG. 7) is secured to the transverse shaft 61 near the left end thereof. A vertical cam lever and hook member 63 is secured to the transverse shaft 61 near the right end of the transverse shaft 61. The members 62 and 63, and another member 64, which will be referred to later, are secured together on transverse shaft 61 so that these members 62, 63 and 64 move in unison. The rearward edges of members 62 and 63 carry cam surfaces 65 and 66, respectively, which extend upwardly and forwardly. Normally, the upper extremes of these surfaces lie against pins 67 and 68, which are fixed to and extend leftwardly and rightwardly, respectively, from the shift key levers 44 and 42, respectively. The vertical cam member 62 has a forwardly extending arm 69, which overlies the forward end of the pivotal member 57 (FIG. 6). Whenever the shift key lever 42 is pivoted downward, its pin 68 (FIG. 7) in cooperation with cam surface 66 moves the unit comprising members 61–64 counterclockwise about the axis of transverse shaft 61. The same action takes place when the shift key lever 44 and its pin 67 are moved downwardly. Whenever the members 61–64 are turned counterclockwise, the arm 69 rocks the pivotal member 57 (FIG. 6) counterclockwise for elevating the detent 56 and raising its blocking surface 60 (FIG. 4) clear of the stud 54. The blocking surface 60 is raised to its ineffective position at or about the time the operated shift lever 42 and 44 and its arm 43 or 45 begins to move the case shifting bail arrangement to the upper case position as described.

The machine may also be shifted to upper case condition by manual or automatic operation of the shaft lock 22. The shift lock 22 of this exemplary machine is mounted on the forward part of a rockable member 70 (FIG. 7) which is pivotally secured to the right side of the shift lever 42 as by a pivot bolt 71. The rearward part of rockable member 70 has a vertical extension 72, which is bent over 180° to extend downward. A lower edge 73 of this extension normally rests on top of the pin 68 for controlling the clockwise at rest attitude of the rockable member 70. The attitude is constantly urged by the rearward extension of a flat spring 74, which presses lightly downward on the top edge of rockable member 70 at a point rearward of the pivot bolt 71. The forward edge of flat spring 74 presses against the upper edge of the shift lever 42 (FIG. 6) at a point rearward of the pivot bolt 71. The forward edge of flat spring 74 presses against the upper edge of the shift lever 42 (FIG. 6) at a point forward of bolt 71. A bent over tab 75 on the left side of the flat spring 74 is held in position against the left side of shift lever 42 by a nut (not shown) on the left end of bolt 71. A stop surface 76 (FIG. 7) is located on the rearward part of rockable member 70 and is in engaging alignment with the stud 68. When rockable member 70 is in its normal clockwise rest position, the stop surface 75 is angularly spaced from stud 68 for allowing limited counterclockwise rocking of rockable member 70 about its pivot bolt 71. When the shift lock 22 is depressed, it first causes the rockable member 70 to rock counterclockwise against the tension of light spring 74 until the stop surface 76 contacts the stud 68, and then it causes the shift lever 42 to move downward shifting the machine to the upper case condition as previously described.

Customarily, the machine is locked in the upper case condition, when the shift lever 42 is moved downward by operation of the shift lock 22. Under this condition, when the shift lever 42 moves downward, the pin 68 acts against cam surface 66 and causes the hook member 63 to turn counterclockwise as explained. The pin 68 is moved beyond the extent of cam surface 66 at or about the time the shift lever 42 reaches upper case position. A latch surface 77 on the hook member 63 is located at the lower extent of the cam surface 66 and it is adapted to latch over the pin 68, when the shift lever 42 is lowered to its upper case position. The latching action is assured by the torsion spring 59 (FIG. 6), which urges the members 57, 62, 64, transverse shaft 61 and the hook member 63 clockwise to the latching position. The machine is thus held in the upper case position until the hook member 63 is again pivoted counterclockwise. The shift lock 22 may be released by depression of the shift key 17, which lowers shift lever 44 and its pin 67 (FIG. 7) as explained. The pin 67 acts on cam surface 65, turning vertical cam member 62, transverse shaft 61, and the hook member 63 counterclockwise to remove the latch surface 77 from the latching position, and allowing the shift lever 42 to return upward to its lower case position. The machine is then free to return to the lower case condition as the shift key 17 (FIG. 6) is again returned to normal position.

The latching surface 77 is ineffective, when the shift lever 42 is moved downward by depression of the shift key 18 (FIG. 6). A short stud 78 is secured to the hook member 63 at a point above the latch surface 77. The stud 78 (FIG. 7) extends leftward beyond the lower edge 73 on the vertical extension 72 of the rockable member 70. A vertical edge surface 79, on the vertical extension 72, extends upward from the forward end of the lower edge 73. When the shift lever 42 is moved downwardly by depression of its shift key 18 (FIG. 6), the hook member 63 is pivoted counterclockwise as previously described, and the stud 78 is swung forwardly of the downward travel of the vertical edge surface 79. Upon full depression of shift lever 42, the vertical edge surface 79 stands in the path of clockwise movement of the stud 78 and therefore it prevents the latching movement of the hook member 63.

When the shift lock 22 is depressed and the rockable member 70 rocked clockwise, as previously described, the lower edge surface 73 is elevated so the stud 78 can pass under the vertical edge surface 79 and allow the hook member 63 to latch onto the stud 68 as previously described.

The well known paper carriage of the typewriter illustrated herein, by way of example, is comprised of a generally rectangular shaped transversely movable main carrier or carriage 80 (FIG. 1) and a vertically shiftable platen carrier 81, which is guided in the main carrier.

A pair of bearings 82 (FIGS. 1 and 8) are secured at spaced points to the rearward side of the main carrier 80. The bearings 82 are fitted to a transverse rail 83, along which the bearings 82 slide as the carriage is moved from side to side. A pair of rail supporting portions 84 extend rearward from the rail 83 and they are secured to the typewriter frame 15, in a conventional manner, for rigid support of the transverse rail 83. The forward part of the carriage is supported by a wheel 85 (FIG. 8), which is mounted for turning on a headed axle stud 86. The stud 86 extends rearward through the wheel 85 and is securely threaded into the front of the main carrier 80. The wheel 85 rolls upon a transverse rail 87 which is secured at its ends to the left and right sides of the typewriter frame 15. A carriage borne finger 88 extends forwardly under a transverse beam 89, which is secured at its ends to the left and right sides of the typewriter frame 15. The bottom side of the transverse beam 89 is a smooth plane surface, which is situated to provide only a running clearance above the forward end of the carriage borne finger 88, for allowing the finger 88 to move from side to side throughout such movement of the carriage and for preventing the front of the main carrier 80 from being lifted out of the horizontal position otherwise determined by the transverse rail 87 and the wheel 85.

The vertically shiftable platen carrier 81 (FIGS. 1 and 8) is comprised of left and right end plates which lie in vertical planes, and transverse members (not shown) connecting the two end plates to form a rigid frame. The specific construction of the transverse members, the compression rollers and other parts which guide the paper around the platen, form no part of the invention and are not described in detail. A usual platen 90 (FIG. 3) is mounted for rotation between the platen carrier end plates, (FIGS. 1 and 3) which are provided with bearings for the platen axle 91 (FIG. 3) extending therethrough and through the platen 90. The platen 90 is secured to its axle 91 in any well known manner for rotation therewith.

In the illustrated embodiment, the platen carrier 81 (FIG. 8) is mounted for being raised and lowered in relation to the main carrier 80 for case shifting; upper and lower case, respectively. In order to maintain the platen carrier 81 parallel in both positions, two pairs of generally parallel links are used. A lower pair of links 92, one link for each end of the platen carrier 81, are pivotally connected at their forward ends to the platen carrier 81 as at 93 and their rearward ends to the main carrier 80 as at 94. An upper pair of links, or arms, 95 are secured at their rearward ends to a torque shaft 96 for turning therewith. The torque shaft 96 is mounted for turning in two spaced bearings 97 on the main carrier 80. The forward ends of the links 95 are shaped like saddles in which studs 98 rest. One such stud 98 is secured to and extends leftwardly and rightwardly from each respective platen carrier end plate. The links 95 and the shaft 96 hold the platen carrier 81 and the platen longitudinally horizontal, while the lower links 92 maintain the generally parallel position of the platen carrier 81 in upper and lower case positions.

A torsion spring (not shown) is connected to the torque shaft 96 and to the main carrier 80 for tending to turn the shaft and raising the forward ends of the links 95 to maintain coupled relation of the saddles and studs 98, and also for partially overcoming the weight of the platen 90 and platen carrier 81 to aid in raising the platen 90 for upper case shifting thereof.

A wheel 99 and a follower plate 100 are connected to the transverse members of the platen carrier 81 for holding the platen carrier 81 in upper and lower shifted positions as controlled by the case shifting bail arrangement. The wheel 99 is situated to ride on the top of the transverse bail rod 47 throughout the side to side movements of the carriage, while the follower plate 100 slides along the bottom of the bail rod 47, directly under the wheel 99, and prevents the wheel 99 from being moved upwardly away from the bail rod 47. By the just described wheel 99, follower plate 100 and platen 90 carrier 81, the platen is shifted up or down in unison with the case shifting bail rod 47 for positioning the platen 90 in either upper or lower case position, respectively, as when a shift key 17 or 18 (FIG. 3) is operated or released, respectively, as explained.

The carriage 80 is moved leftwardly during normal forward operations by a spring means 101 (FIGS. 9 and 10) which is identical to the spring means in the standard Underwood typewriter that is arbitrarily selected as a component of the novel composing machine disclosed herein. Therefore, the following brief description of the spring means is believed to be sufficient for a thorough understanding to one schooled in the typewriter field.

The spring means 101 is comprised primarily of a clock type torsion spring 102 (FIG. 9) the inner end of which is anchored to a hub 103 which in turn is anchored to a bracket 104. The bracket 104 is secured to the left rear corner of the typewriter frame 15, in the usual position, as by screws 105. The hub 103 is adjustably rotatable on a center bolt 106 secured to the bracket 104 and its degree of adjustment and, therefore, the tension of the torsion spring 102 is held by an adjustment means not shown herein. The outer end of the torsion spring 102 is connected to a spring casing 107 which is formed like a spool on its outer periphery. The torsion spring 102 is wound so as to exert counterclockwise force on the casing 107, as indicated by the arrow. One end of a flexible tape 108 is connected as at 109 to the spring casing 107 and it is wound clockwise thereabout. The other end of the flexible tape 108 is connected to the carriage by a stud 110 secured to the bottom of the right hand bearing 82 (FIG. 10) so as to constantly urge the bearing and therefore the carriage leftwardly. A carriage moving mechanism, to be described later, provides the control for incremental leftward movement of the carriage during forward operations for characters and spaces, and it moves the carriage rightward for back spacing operations against the tension of the spring means 101. The carriage is manually movable rightward, against the tension of the spring means 101, for carriage return as will also be explained.

To return the carriage, the operator merely moves the usual lever 111 (FIG. 3) rightward, as indicated by the arrow "R", for normal one, two or three line space rotation of platen 90, by well known mechanism, controlled by the position of a presettable button 112, and for thereafter returning the carriage. In respect to carriage return, the above is customary as far as the immediately affected mechanism is concerned and as far as the operator is concerned. However, this operation excites novel automatic mechanism in the machine for locking keys, for punching a carriage return code in the control tape, for performing justifying operations, etc., as will be explained later herein.

3. CHARACTER KEY SWITCHES

Depression of any one character key 16 (FIG. 4), at the bottom of its stroke when imprinting on the paper carriage occurs as explained, closes a set 113 of electrical switch blades for controlling carriage movement and for punching a code, both appropriate to the operated key.

To facilitate understanding of the switch arrangement, under each of the above mentioned character keys 16, and under space keys to be described later, a chart showing particular grouping of the keys as indicated according to the amount of carriage movement for each key in an associated group, in upper case and in lower case, is shown herebelow and also in "Chart A" among the Charts "A"–"E" to be found immediately following the Figure Descriptions hereinabove.

CHART A

DIFFERENTIAL CHARACTER AND WORD SPACING

| Groups | Carriage Movement | | Different sized characters combined on related keys, and Spaces unaffected by case shift. |
|---|---|---|---|
| A. | Upper Case | .100" | " # $ % ? & ( ) * W M and .100" nut space. |
| | Lower Case | .100" | 1 2 3 4 5 6 8 9 0 w m |
| B. | UC | .050" | ' |
| | LC | .100" | 7 |
| C. | UC | .100" | Q E R T Y U O P A S D F G H J K Z X C V B N |
| | LC | .075" | q e r t y u o p a s d f g h j k z x c v b n |
| D. | UC | .075" | I |
| | LC | .050" | i |
| E. | UC | .100" | L |
| | LC | .050" | l |
| F. | UC | .050" | : - / and .050" Nut space, and Space Bar. |
| | LC | .050" | : , . |
| G. | UC | .075" | .075" nut space. |
| | LC | .075" | |

Note:
The above includes all of the character keys, except the underline key which does not cause carriage movement.

One switch blade 114 (FIG. 4), for example, for each key 16 is connected by a wire 115 (FIG. 11) to another on the group in which the particular key is listed in the chart above. The wires for the groups "A"-"G" are individually employed to cause the proper amount of carriage movement, as will be explained in connection with the carriage moving mechanism and the upper lower case switch means.

Other switch blades 116, 117 and 118, in each set 113 (FIG. 4), are connected as by wires 119, 120, and 121, (FIG. 11) respectively, with the appropriate code channel punch wires (1–7) that are employed for causing punching of the code that corresponds with the operated key. More or less switch blades 116–118 may be employed to accomodate the code for a particular key, it being necessary merely to have one such blade for each channel in the code.

By referring to the "CHARACTER AND SPACE KEY CODES" (Chart B) below and also among the charts "A"-"E" that follow the Figure Descriptions, it can be seen that all character keys, except the underline key, require three channels or less. Therefore, most keys require the four blades 114, 116, 117 and 118 or less.

CHART B

CHARACTER AND SPACE KEY CODES

| Alphabet | Code | Alphabet | Code |
|---|---|---|---|
| A | 124 | O | 17 |
| B | 157 | P | 123 |
| C | 147 | Q | 1 |
| D | 126 | R | 13 |
| E | 12 | S | 125 |
| F | 127 | T | 14 |
| G | 134 | U | 16 |
| H | 135 | V | 156 |
| I | 35 | W | 237 |
| J | 136 | X | 146 |
| K | 137 | Y | 15 |
| L | 3 | Z | 145 |
| M | 246 | Underline | 1456 |
| N | 167 | | |

Numerals

| Code | Code |
|---|---|
| 1 | 2 |
| 2 | 23 |
| 3 | 24 |
| 4 | 25 |
| 5 | 26 |
| 6 | 27 |
| 7 | 245 |

CHART B-continued

| | |
|---|---|
| 8 | 234 |
| 9 | 235 |
| 0 | 236 |

Punctuation

| | |
|---|---|
| ( , ) | 36 |
| ( ; ) | 345 |
| ( . ) | 347 |

Spaces

| | |
|---|---|
| .050" Nut Space, | 346 |
| .075" Nut Space, | 1457 |
| .100" Nut Space, | 247 |
| Word Space (Space Bar) | 34 |

Figure 11:
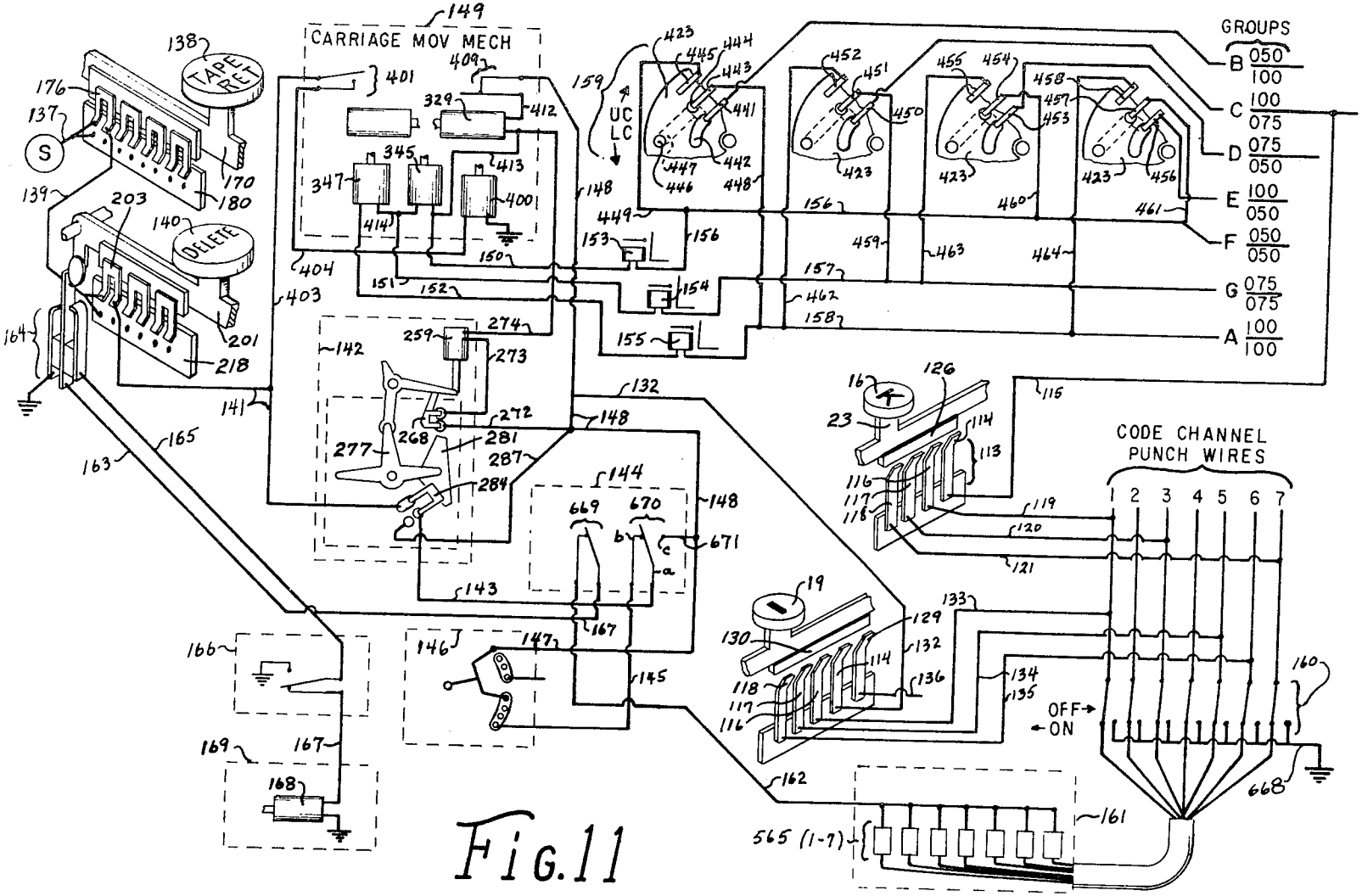
FIG. 11 is a schematic wiring diagram, showing primarily the circuitry for a normal character key under various circumstances.

For example, the letter key "K" has a code of channels 1, 3 and 7, as shown on the Chart B, therefore, its switch must include all four blades 114, 116, 117 and 118, as shown schematically in FIG. 11. Furthermore, in respect to the letter "K", it can be seen that upon operation of the key and closing of blade 114 with blades 116–117, the wire 115 and the carriage movement control wire "C" is connected with wires 119, 120 and 121 and the Code Channel punch wires 1, 3 and 7. In this manner, the control for a group "C" carriage movement as shown on the "DIFFERENTIAL CHARACTER AND WORD SPACING" (Chart A), and the control for punching the code 1, 3, 7, for the letter "K" as indicated in the "CHARACTER AND SPACE KEY CODES" (Chart B) are established.

For a further example, the key "E" (Chart B) has only a two channel code, namely channels "1" and "2", and thus its switch 113 (FIG. 4) requires only three blades, such as 114, 116 and 117 (FIG. 11). By referring to the Chart B, it is seen that the letter "L" has a single channel code, namely channel "3", therefore it needs only two blades, such as 114 and 116 (FIG. 11).

In respect to the further examples above, by referring to the Chart A, it can be seen that the letters "E" and "L" are in group "C" and "E", respectively. Since the letter "E" is in the "Group C", the same group as the letter "K" discussed above, its blade 114 (FIG. 11) may be connected in turn by the wire 115 to the "C" group carriage moving control wire "C". However, since the letter "L" is in "Group E" on the Chart A, its blade 114 (FIG. 11) is connected by a wire 115 to the "E group" carriage moving control wire "E".

Figure 12:
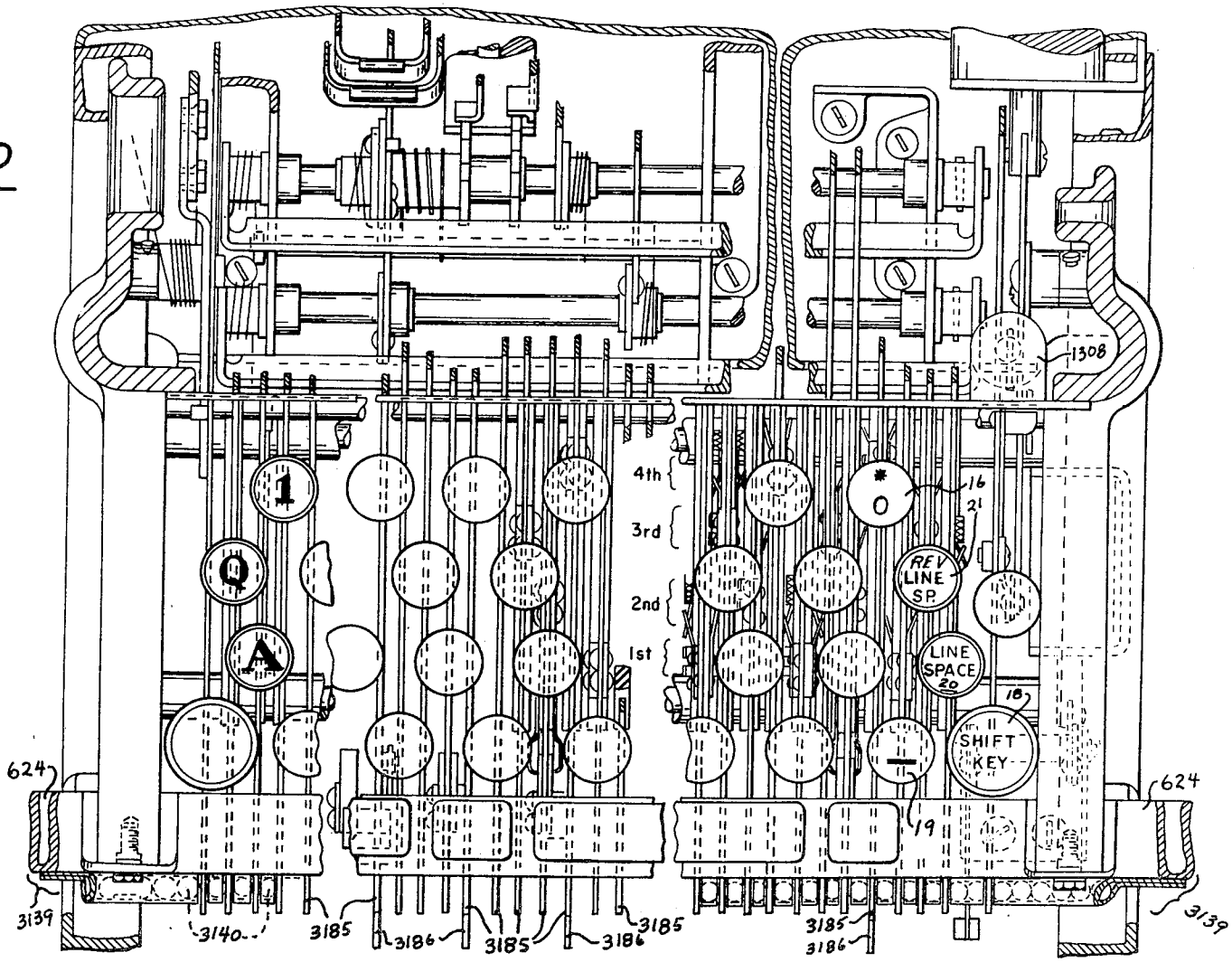
FIG. 12 is a fragmentary condensed top view of the typewriter keyboard and the differential key lock mechanism.

Thus, a detailed description of a four bladed switch 113 will suffice for all characters except the Underline key, which will be described later. The blades 114, 116, 117 and 118 for each switch 113 (FIG. 4) are mounted on an insulator 122 in any well known manner sufficient to insulate them from each other and the rest of the machine. The insulators 122 are mounted parallel to each other on two transverse parallel support rods 123 and 124. The left and right ends of the rods 123 and 124 are secured to the main frame channel members 13 and 14, in any well known manner. Suitable spacers, such as spacers 125, on the transverse parallel support rods 123 and 124, situate the insulators 122 transversely under their respective keys, in a well known manner. The individual switches 113 are arranged in 1st, 2nd, 3rd and 4th echelons, as shown in FIGS. 4 and 12, on their insulators 122 in such a way that they do not interfere with each other. The spacers, such as spacers 125, also provide room for the wires 115, 119–121 (FIG. 11), which connect with the blades 114, 116, 117, 118, as explained, between adjacent insulators 122.

Depending conductors 126 (FIG. 4) are preferably riveted to insulators 127, which in turn are secured to respective character key levers 23 and which insulators 127 prevent passage of current from the conductors to the keys 16. Each conductor 126 is located on its respective key lever 23 in such a position that it engages the blades 114, 116, 117, 118 of switch 113, which is associated with the key 16, upon depression of the key 16, as explained.

The underline key 19 (FIG. 12) does not cause carriage movement, in this embodiment, as mentioned previously. However, it does cause imprinting of an underline mark and it does cause punching of a code on the tape. For the last mentioned function of punching the code, the underline key 19 has a switch 128 (FIG. 13), which is like the switches 113 (FIG. 4), except that it has five blades instead of four or less. The switch 128 (FIG. 13) has the previously described blades 114, 116, 117 and 118 and one more blade 129 required to accommodate a four channel code. Also, a conductor 130 has a rearward extension 131, for contacting the blade 129. The rearward extension 131 and the blade 129, which is displaced rearwardly on its insulator 122, do not interfere with the adjacent switches 113 (FIG. 4), since the switch 128 (FIG. 13) for the underline key 19 is located generally in the "1st" echelon (FIG. 12) of switches 113 (FIG. 4) while the switch 113 for the reverse line space key 21 (FIG. 12), immediately to the right of the underline key 19, and the switch 113 (FIG. 4) for the "*/0" key 16 (FIG. 12), immediately to the left, are located in the "3rd" and "4th" echelons, respectively.

By referring to the "CHARACTER AND SPACE KEY CODES" (Chart B) above and also among the charts found following the Figure Descriptions, it can be seen that the suggested underline key code is 1, 4, 5, 6. A lead-in wire 132 (FIG. 11) is connected to the underline key blade 114, while wires 133, 134 and 135 are connected to blades 116, 117 and 118, respectively. The wires 133, 134 and 135 lead to the "CODE CHANNEL PUNCH WIRES" 1, 5 and 6, respectively, for causing punching of the corresponding channels of the code. A wire 136 is connected to the blade 129, and it leads through a circuit, which leads to the 4 channel punch wire as will be described later. In the preferred embodiment, the 4 channel code bit circuit involves a control means which prevents termination of a justifiable line when an underline mark, a word space or a nut space is the last text information encoded. The underline 4 channel code bit circuit will be described later in connection with the involved control means.

4. CHARACTER KEY CIRCUITS

Since the character key circuits are relatively complex, due to various conditions, a most normal path of the current will first be described briefly. The control keys and mechanisms through which the current travels, will be referred to briefly, and the order in which the various control keys and mechanisms are introduced will later serve as a general outline for detailed descriptions of these various parts.

Upon depression of any character key 16 (FIGS. 3 and 11) and the consequent closing of its switch 113 (FIG. 4), as explained, the current travels from a source (S) and a wire 137 (FIG. 11) to a normally closed switch means under a tape return key 138.

Normally, the tape return key 138 is not operated and the character key circuit passes therethrough without incidence. However, when the tape return key 138 is operated, as required after deleting, to advance deleted tape 577 through the main punches 567 (FIG. 38) as will be explained, the character key circuit is broken thereby for preventing coding on the tape 577 and carriage movement that might otherwise be effected by misuse of a character key 16 (FIG. 11) during tape return.

From the tape return key switch, the circuit normally continues via a wire 139 and the normally closed switch under control of a delete key 140. Operation of the delete key 140 renders the normal character key circuit ineffective, thus preventing normal forward operations during deleting and automatic back-spacing operations, as will be explained.

The circuit normally continues via a wire 141, between the delete key 140 and a justifying on-off key and commutator mechanism 142. Normally, the commutator mechanism 142 is in "on" condition for controlling the machine to code for justifying and for directing the character key circuit, among others, so that it may perform features of the justifying system. When the commutator mechanism 142 is in "off" condition, the character key circuit is directed to avoid performance of some of the justifying operations, as will be explained.

When the justifying on-off key and commutator mechanism 142 is in normal "on" position, it directs the character key circuit through a wire 143 to a punch control key arrangement 144. Normally, punch control key arrangement 144 is in punch "on" condition, in which it permits punching of the codes for the text and for justifying information. In "off" condition, the punch control key arrangement 144 alters various circuits to avoid punching of the codes for the text and to avoid normal operation of justifying mechanism.

When punch control key arrangement 144 is in normal punch "on" condition, it directs the character key circuit via a wire 145 to a control commutator means 146 for preventing occurence of a space or underline at the end of a justified line, as will be explained. The control commutator means 146 automatically becomes effective only when a line has progressed to less than 0.700" from the right margin, as will be explained.

Normally, the control commutator means 146 directs the character key circuit through wires 147 and 148 to a carriage moving mechanism 149, which responds to the character key circuit and thereby moves the carriage appropriately for the operated character key 16.

Wires 150, 151 and 152, leading from the carriage moving mechanism 149, are individually employed for controlling the carriage moving mechanism 149 to move the carriage two (0.050"), three (0.075") or four (0.100") units, respectively, to accomodate the operated one of the keys 16.

The wires 150, 151 and 152 lead to relays 153, 154 and 155, respectively, provided for operating a differential key lock mechanism when the carriage nears the end of a line, as will be explained.

Wires 156, 157 and 158 connect the relays 153, 154 and 155, respectively, with an upper-lower case snap switch means 159, which together with the selectivity of the operated character key 16, determines which one of the wires 150, 151 and 152 will be employed.

The character key group wires "A"–"C" lead from the upper-lower case snap switch means 159, as discussed previously, and these are the wires to which the character key wires 115 are connected, as described. Thus, the character key circuit passes through the upper-lower case snap switch means 159, the employed group wires "A"–"G", the wire 115, and the blade 114 engaged under the operated character key 16 as described. At this point, the circuit divides and is directed from the blade 114, through the blades 116–118 (for example) engaged under the operated key 16, and through the wires 119–121 (for example) to the appropriate "code channel punch wires" 1–7, which correspond to the code for the operated key 16 as described.

The circuits that may pass through the code channel punch wires 1–7 normally lead through individual switches in a group 160 of such switches, which are part of the Punch Control Key Arrangement 144 as will be explained, and on to respective individual solenoids in a main punch mechanism 161 for punching the code for the operated key 16 on the code medium as will be explained.

A common ground wire 162, for the main punch solenoids 565, directs the circuit to a normally closed single throw switch 669 in the punch control key arrangement 144. The arrangement is such that, when the arrangement 144 is set for "no-punch" and the single throw switch 669 is open, the punch mechanism 161 will not operate, even though current passes through an operated key 16 as will be explained later.

Normally however, the character key circuit passes through the arrangement 144, and, via a wire 163, it is directed to a double-throw time delay switch 164 under the delete key 140, which will be described later.

Normally, the circuit travels through double-throw time delay switch 164 and a wire 165 to an end of line tape feed control means 166, which is brought into play for altering the circuit only at the very end of a line, as will be described.

During the normal typing of the majority of a line, the character key circuit impulses travel through the line tape feed control means 166 and a wire 167 to a solenoid 168, and to ground in a forward tape cycling control means 169. Thus, the solenoid 168 operates the forward tape cycle control means 169 to advance the control tape 577 one step for each impulse through the character key circuit, all as will be explained more fully hereinafter.

5. TAPE RETURN KEY STRUCTURE

The tape return key 138 is located on the extreme left of the keyboard as shown in FIG. 3, near the delete key 140. These two keys 138 and 140 are arranged conveniently near each other to minimize hand travel, since the tape return will be used to feed the deleted tape through the main punches 567 (FIG. 38), immediately after the delete key 140 (FIG. 3) is used, as will be more readily understood after further description of the system and of the several components.

Tape return key 138 is carried by a lever 170 (FIG. 14), which is pivoted at its rearward end on headed rod 171. Headed rod 171 extends rightwardly through lever 170, through a hole therefor in a vertical frame plate 172 (FIGS. 1 and 2) and a threaded end thereof is screwed into a frame plate 173. A torsion spring 174 (FIG. 14) is assembled about the axis of headed rod 171, and it is anchored in a hole 175 in vertical frame plate 172 while its other end is connected to the lever 170 for urging the lever 170 counterclockwise to the illustrated normal position.

The frame plates 172 and 173 (FIG. 2) are parallel to each other, and they are secured to the base frame member 1, and 2 and to the typewriter frame 15, respectively, in any well known manner.

Four switch blades 176, 177, 178 and 179 (FIG. 14) are insulated from each other and from the lever 170, but they are otherwise secured to the lever 170 in any well known manner. The lower bifurcated ends of the blades 176, 177, 178 and 179 are pressed rightwardly to normally engage a row "N" of contacts, when the tape return key 138 and its lever 170 are in normal position. When the tape return key 138 and lever 170 are depressed to operated position, the blades 176–179 are each engaged with respective pairs of contacts in a row "O". The contacts in rows "N" and "O" are secured in an insulator 180. An insulator 181 is provided for insulating the wire terminal ends of the contacts from the vertical frame plate 172. Machine screws 182, extending through holes therefor in insulators 180 and 181, secure the insulators to the vertical frame plate 172.

A leftwardly extending stud 183 is secured to the lever 170, and it normally overlies a cam surface 184 and a latch surface 185 on a pawl 186. Pawl 186 is provided for holding the tape return key 138 and its lever 170 in operated position until the tape 577 is returned, following a deleting operation as will be explained later. Pawl 186 is pivoted on a shouldered machined screw 187, secured in vertical frame plate 172 in a usual manner. A torsion spring 188, wound about screw 187 and a hub 189, is connected to pawl 186 for urging the pawl clockwise where the upper end of cam surface 184 normally lies against stud 183. The torsion spring 188 is also anchored on a stud 190, which is secured to vertical frame plate 172. Upon operation of the lever 170, stud 183 coacts with cam surface 184 and rotates the pawl 186 counterclockwise, until the latch surface 185 swings clockwise over the stud 183 as the pawl 186 returns under tension of its spring 188 at about the time lever 170 reaches operated position. The stud 190 is situated to positively stop lever 170 at a bit past operated position. Thus, the pawl 186 holds the lever 170 in operated position, and it holds the lever in this position until the deleted and back-spaced tape is fed forwardly through the main punches 567 (FIG. 38) as will be explained.

The circuitry for automatically releasing the tape return key 138 (FIG. 14) will be explained later. However, the releasing mechanism will be explained now. A solenoid 191 is secured to vertical frame plate 172 by a bracket 192 and screws 193. The solenoid's armature 194 is connected by a link 195 to a depending arm 196 of the pawl 186. Operation of the solenoid 191 draws its armature 194 and link 195 forwardly, and thus rotates arm 196 and pawl 186 counterclockwise for removing the latch surface 185 from above the stud 183. In this manner, the lever 170 is released to return to the illustrated normal position, under tension of its spring 174. Counterclockwise movement of the pawl 186 is limited by stud 190 after the pawl is unlatched. Upon deenergization of solenoid 191, pawl 186 is returned by its spring 188. A forwardly extending portion 197 of the lever 170 is provided for cooperating with a ball-lock arrangement, which permits operation of the tape return key 138, only when no other conflicting key is operated, as will be explained later.

As previously described, a character key circuit normally travels from a source (S) and a wire 137 (FIG. 11) to a normally closed switch means under the tape return key 138. This normally closed switch means and its connections in the circuit will now be described. Wire 137 is connected to two contacts 198 and 199 (FIG. 14), located in the rows of contacts "N" and "O", respectively. A contact 200, adjacent to contact 198 in the row "N", is connected to the wire 139. The arrangement is such that, normally with the tape return key 138 in the illustrated position, the character key circuit travels via wire 137, contact 198, blade 176, contact 200 and continues via wire 139, as described.

Operation of the tape return key 138 and its lever 170 disengages blade 176 from the contacts 198 and 200, and thus the character key circuit through wire 139, described above, is rendered inoperative until the tape return key 138 is restored.

The remaining contacts in rows "N" and "O" will be described further in connection with their respective circuits.

6. DELETE KEY STRUCTURE

The delete key 140 (FIGS. 11 and 15) is located to the right of the tape return key 138 (FIG. 3), which was just described above.

Delete key 140 is carried by a lever 201 (FIG. 15), which is pivoted at its rearward end on the rod 171. A torsion spring 202, anchored in any well known manner, is assembled about rod 171 and connected to lever 201 for urging the lever to the illustrated normal position.

Three switch blades 203, 204 and 205 are secured to the lever 201, but they are insulated from the lever and from each other in a well known manner. The lower bifurcated ends of blades 203, 204 and 205 are pressed rightwardly to engage respective pairs of contacts 206, 207, 208, 209, 210 and 211, when the delete key 140 and its lever 201 is in the illustrated normal position. When the delete key 140 is depressed and its lever 201 is accordingly pivoted clockwise about rod 171 to operated position, the blades 203, 204 and 205 are disengaged from the contacts 206–211, and they are engaged with respective pairs of contacts 212, 213, 214, 215, and 216 and 217.

The contacts 206–217 are secured on an insulator 218 in any well known manner and the insulator 218 is secured on frame plate 173 as by screws 219.

The character key circuit wire 139 is connected with contacts 212 and 206, and the wire 141 is connected with contact 207. Thus, when the delete key 140 is not operated and the lever 201 is in normal position, as shown, the normal character key circuit is completed between wires 139 and 141, as described, by contact 206, blade 203 and contact 207. Moreover, it can be seen that the circuit through wire 141 is rendered ineffective by depression of the delete key 140, and the resulting clockwise pivoting of lever 201 and disengagement of blade 203 from the contacts 206, 207.

The utility of the contacts 208–217 will be explained later, in connection with the various circuits involved therewith.

Upon depression of the delete key 140, the lever 201 is held in operated position by a pawl 220. This holding action is momentary, it being only sufficient to assure completion of a cycle of back-space reading, back-spacing and deleting as will be described later.

Pawl 220 is pivoted on a machine screw 221, secured in frame plate 173, and it extends downwardly to the rear of a pin 222, which is secured to lever 201. A torsion spring 223 is connected to the pawl 220 for normally urging the pawl counter-clockwise against the pin 222. When the delete key 140 and lever 201 are operated, the pin 222 is moved downward to a point where latch surface 224 moves forward as the pawl 220 is moved forward by torsion spring 223. Thus the latch surface 224 holds pin 222 and lever 201 in operated position for the remainder of the cycle.

At the end of each delete cycle, the pawl 220 is reciprocated to release the lever 201. However, if the operator holds the delete key 140 in operated position, the pawl 220 is moved by its torsion spring 223 to relatch the lever 201 at the beginning of an ensuing cycle.

At the end of each delete cycle, a solenoid 225 is momentarily energized, by a circuit to be described later, for reciprocating the pawl 220. Solenoid 225 is secured to frame plate 173 in any well known manner. Armature 226 of solenoid 225 is connected by a link 227 to the pawl 220. A stop 228 is secured to frame plate 173 for limiting clockwise operation of pawl 220 in releasing position. The arrangement is such that energization of solenoid 225 draws armature 226, link 227 and the pawl 220 rearward until the pawl contacts stop 228, in which position latch surface 224 is disengaged from pin 222. At this point, if the operator has removed his finger from the delete key 140, the lever 201 is released to the action of return spring 202 and all deleting cycles stop, as will be explained. However, if the operator still holds the delete key 140 in operated position, at the time solenoid 225 is deenergized, the torsion spring 223 returns pawl 220 to latching position, where latch surface 224 overlies pin 222, for an ensuing operation.

Further mechanism, switches and circuits involving the delete key 140 will be explained later, when they may be appreciated more fully.

7. JUSTIFYING ON-OFF KEY

The justifying on-off key mechanism 142 (FIG. 11) will now be described, and, at the end of this portion of the specification, the manner in which the character key circuit is normally completed between wires 141 and 143 will be explained.

Though the justifying on-off key mechanism 142 (FIG. 17) may be considered a separate entity, it is incorporated, for convenience, with what is called an amount left in line mechanism assembly, shown generally in FIG. 18. The main framework of this assembly, showing the support for the Justifying On-Off Key etc., will be described first.

A frame plate 229 (FIGS. 2 and 18) of this amount left in line mechanism assembly is adjustably secured to the standard typewriter frame 15. This frame plate 229, and the assembly supported thereby, is vertically adjustable and the position of adjustment is determined by an adjustment screw 230 for providing proper engagement of a right margin means operated rack 1570 (FIG. 18) which is mounted in the main typewriter assembly, and a gear segment 1572 mounted in this amount left in line mechanism assembly as will be explained later. Upon adjustment of frame plate 229, the frame plate is secured to the main typewriter assembly frame 15, as by several bolts 231 (FIG. 18), assembled through vertically elongated holes 232 and screwed into threaded holes therefor in the main typewriter frame 15.

The adjustment screw 230 is assembled through a threaded hole therefor in a bent over tab portion 233 (FIG. 2) which extends leftwardly sufficiently to situate the screw 230 over a horizontal portion 234 of the typewriter frame 15. The tab portion 233 may be reinforced by any suitable angle bracket for strengthening the tab portion 233 and providing more thickness for threads engaging the screw 230. A lock nut 235 on screw 230 may be tightened down on tab portion 233 for holding the screw after its adjustment.

A front plate 236 (FIGS. 2 and 18), a center plate 237 and a back plate 238 are situated vertically and perpendicularly to frame plate 229, and they are solidly fixed to plate 229 in any known manner.

A main support shaft 239 (FIGS. 2, 17 and 18) is secured to plates 236, 237 and 238 (FIGS. 2 and 18) for maintaining the plates in proper spaced parallel relation and for supporting parts of the therein contained mechanism as will be explained. Shorter shafts 240–243 (FIGS. 17 and 18) are fixed to plates 236 and 237 (FIG. 18) in any known manner for supporting portions of the mechanisms and maintaining these plates in parallel relation to each other. Other small shaft and frame members, which form a part of this amount left in line mechanism assembly's structure, will be introduced later, as they become more significant.

A justifying key 244 (FIGS. 17 and 18) is provided for permitting the operator to determine whether the reproduced copy will be justified or not, for the production of newspaper copy for an informal letter, respectively, for example. When the justifying key 244 is in the "On" position, mechanism are normally controlled to count word spaces, to register the amount left in a line and to punch justifying information upon return of the carriage. When the justifying key 244 is in the "Off" position, word spaces are not counted and the amount left in the line mechanism, though it may be actuated with the carriage, it is not utilized, and no justifying information will be punched in the tape, as will be explained.

Since an accurate count of word spaces and measuring of the amount left in the line is required for justifying and since the justifying key 244 is manipulative for rendering the mechanisms for accounting for this information effective or ineffective, a locking means is provided for preventing manipulation of the justifying key 244 between the time when the line is started and when the line is complete and the carriage is returned. This locking means is rendered effective simultaneously with the first carriage moving operation in the line. Accordingly, as will be explained, manipulation of the justifying key 244 is prevented following the first occurrence of carriage movement in the line. The locking means, thus rendered effective, will remain effective until the carriage is fully returned, as will be explained later.

Figure 17:
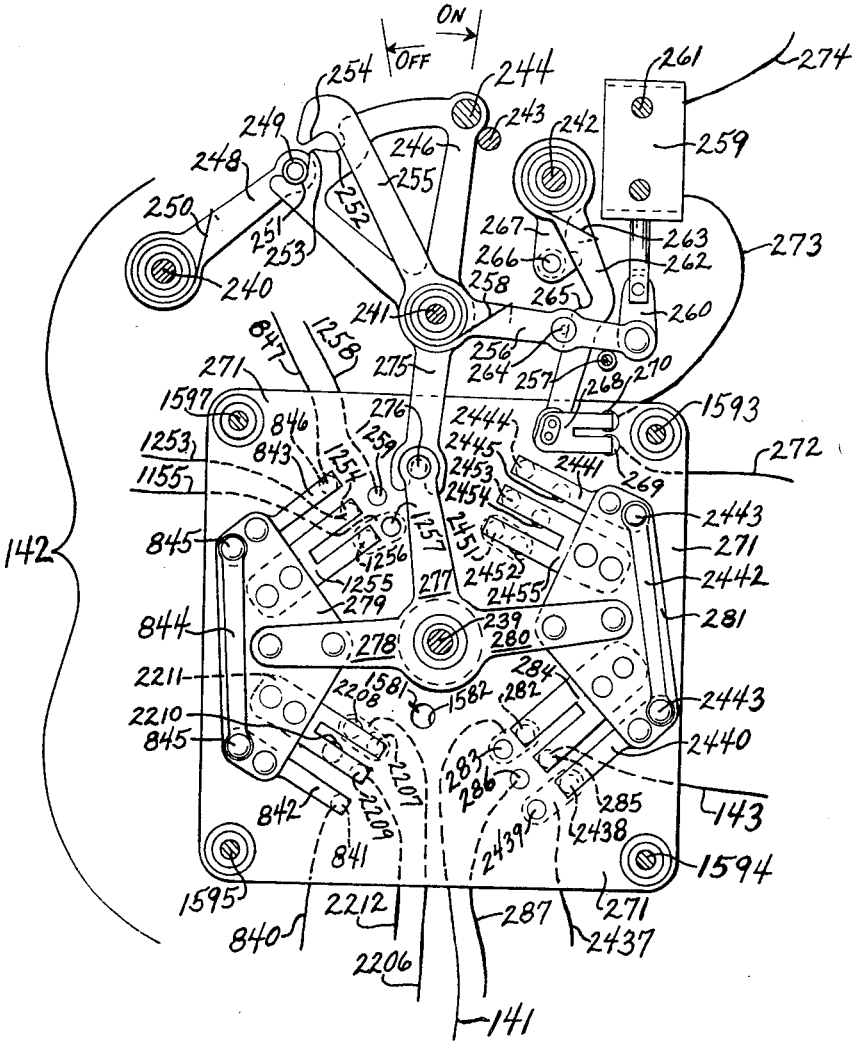
FIG. 17 is a front sectional elevational view of the justifying on-off key mechanism taken generally on line 17—17, FIG. 18.

The justifying key 244 (FIGS. 3, 17 and 18) extends forwardly through clearance holes therefor in the front plate 236 and a general cover 245 (FIGS. 3 and 18), so as to be accessible for manipulation by the operator. Justifying key 244 (FIG. 17) is secured to an integral member 246 which is secured on the forward end of a sleeve 247 (FIG. 18) that is pivoted on shaft 241 (FIG. 17). The justifying key 244 is normally in the justifying "On" (clockwise) position, as shown, and it is shiftable to the indicated justifying "Off" (counterclockwise) position.

A yieldable detent 248, with roller means 249 extending forwardly from the upper end thereof, is pivotally mounted on shaft 240. A torsion spring 250, assembled on the pivot hub of detent 248, is anchored at one end, and it is connected at its other end to the detent for urging the detent and its roller 249 clockwise against integral member 246. When the justifying key 244 and its integral member 246 are in the illustrated "On" position, the roller means 249 lodges in an indentation 251 on integral member 246 for tending to keep the member 246 and justifying key 244 in that position. Similarly, when the justifying key 244 and integral member 246 are shifted to the indicated "Off" position the roller means 249 lodges in indentation 252 on integral member 246 for tending to keep the member 246 and justifying key 244 in the "Off" position. A raised point 253, between indentations 251 and 252 on integral member 246, coacts with roller means 249, so as to tend to keep the integral member 246 and its justifying key 244 in either the "On" or "Off" position, and to move the justifying key 244 and integral member 246 to the nearest one of these positions, by the tension of spring 250, in the event that the justifying key 244 is not fully manually moved to one of the positions. When the justifying key 244 and its integral member 246 are shifted from one position to the other, the raised point 253 first moves the roller 249 counterclockwise against the tension of spring 250 and, after midpoint of the movement, the spring 250 returns the detent 248 and its roller 249 clockwise. From the foregoing, it can be seen that the justifying key 244 may be manually shifted whenever the roller 249 is permitted to move, as described. It should be noted that the justifying key 244 could not be shifted if the roller 249 were not permitted to yield counterclockwise, as described.

A locking means is provided for preventing the counterclockwise yielding of roller 249, at times when the justifying key 244 should not be shifted and when such shifting might bring about incorrect justification, or no justification to be more precise. This locking means is comprised of a blocking surface 254 on a lock 255. Lock 255 is pivoted on shaft 241, and it is normally held in the clockwise position shown, with its rightwardly extending arm 256 resting against a return stud 257 which is fixed on front plate 236 (FIG. 18). A torsion spring 258, anchored in any well known manner, is connected to arm 256 for urging the lock 255 clockwise to returned position.

When the lock 255 is pivoted counterclockwise, its blocking surface 254 is shifted over roller 249 for blocking counterclockwise movement of the roller 249 out of the indentation 251 or 252, and thus the justifying key 244 is locked in either the "On" or the "Off" position, respectively.

The means for pivoting the lock 255 counterclockwise to effective position is comprised of solenoid 259 and a link 260, pivotally connected to the armature of the solenoid 259 and the extremity of arm 256. The solenoid 259 is in a circuit for performing the first carriage moving operation in a line, as will be explained, for operating the lock 255 to become effective at that time. Solenoid 259 is secured to front plate 236 (FIG. 18), however the solenoid 259 is not shown in this figure since it would obstruct much of the mechanism. The solenoid 259 (FIG. 17) is secured to the front plate 236 by screws 261 assembled through suitable holes therefor in the front plate 236 and screwed into threaded holes in the frame of the solenoid 259.

A latch 262, provided for holding the lock 255 in effective position, is pivoted on shaft 242, and it is urged clockwise toward latching position by a torsion spring 263 which is anchored in a well known manner and connected to latch 262. Upon return of the carriage 80, the latch 262 is moved to the unlatched counterclockwise position shown and, thereafter, the lower extremity of the latch 262 returns to rest against a pin 264 secured on arm 256. Upon first movement of the carriage 80 and operation of solenoid 259, as discussed, latching surface 265 slides under pin 264 as torsion spring 263 rotates the latch 262 clockwise at the time the lock 255 reaches effective position. Thus, lock 255 is held in effective position, by latch 262, until the line is complete and the carriage 80 is returned.

Upon return of the carriage 80, a pin 266 secured on a member 267 is swung counterclockwise about shaft 242, as will be explained later, to contact and rotate latch 262 counterclockwise for removing latch surface 265 from under pin 264 and permitting torsion spring 258 to return the lock 255 clockwise to the normal position shown.

From the above, it can be seen that the justifying key 244 can be manipulated, when the carriage 80 is fully returned, but it can not be manipulated after the occurrence of a carriage movement for the next line. The circuits and other related mechanisms for operating the solenoid 259 to lock the justifying key 244 and for operating member 267 and pin 266 to release the latch 262 will be explained in greater detail elsewhere herein.

A switch means for controlling the solenoid 259 to operate only once, simultaneously with the first carriage movement in each line, is comprised of a blade 268, which is insulated from but otherwise secured on the lower extremity of latch 262, and of a pair of contacts 269 and 270 which are fixed on an insulating contact support plate 271 to be fully described later. At present, it is sufficient to know that the insulating plate 271 is stationary in the machine.

In the illustrated normal position of latch 262, the blade 268 connects the contacts 269 and 270. Thus, when carriage movement is first effected, current passes via the wire 148 (FIG. 11 as explained), and further via a wire 272, the contact 269 (FIG. 17), the blade 268, contact 270, a wire 273, solenoid 259 and via a wire 274 (FIG. 11) leading to the carriage moving mechanism 149 as will be explained. As soon as solenoid 259 (FIG. 17) has rendered lock 255 effective, latch 262 operates disengaging blade 268 from the contacts 269, 270 to deenergize the solenoid 259. The circuit thus broken remains broken until the carriage 80 is fully returned, as will be more fully explained. Counterclockwise rotation of latch 262 to returned position restores blade 268 into registration with contacts 269, 270 to complete the circuit for an ensuing operation as described.

8. JUSTIFYING KEY SWITCH MEANS

The above described justifying key structure is provided for operating the switch means which controls the machine for justifying "On" or "Off" conditions.

A bifurcated downwardly extending arm 275 of member 246 embraces a stud 276 on the end of an upwardly extending arm of a switch blade support member 277, which is pivoted on shaft 239.

Member 277 has a leftwardly extending arm 278 with an insulator 279 secured thereon, and an opposing arm 280 with an insulator 281 secured thereon. The insulators 279 and 281 carry generally annularly oriented switch blades, which will be individually identified later and which are pressed rearwardly in tensioned contact with contact support insulating plate 271 for selective engagement with generally flush contacts therein situated appropriately radially in relation to shaft 239. The position and identification of the contacts will be particularly described later.

At present it is sufficient to understand that the contact support insulating plate 271 and the contacts therein are stationary, while the member 277 and the switch blades thereon are shiftable clockwise, from the illustrated justifying "On" position to the justifying "Off" position, upon counterclockwise manipulation of the justifying key 244 and the integral member 246. Likewise, when the justifying key 244 is again shifted clockwise, the switch blade member 277 is returned counterclockwise to the illustrated justifying "On" position.

It may be recalled that the character key circuit normally passes through wire 141 (FIG. 11), through the justifying key arrangement 142 and wire 143. The means for conducting this part of the circuit through the justifying key arrangement 142 will now be described.

Wire 141 is connected with interconnected contacts 282 and 283 (FIG. 17), which are secured on contact support insulating plate 271. A bifurcated blade 284 is secured on the insulator 281, and, in the illustrated "On" position of the parts, the bifurcated blade 284 is engaged with the contact 282 and a contact 285 which is secured on contact support insulating plate 271. When the justifying key 244 is shifted to "Off" position, the blade support member 277 and insulator 281 are shifted clockwise, as described, for shifting the bifurcated blade 284 off of the contacts 282 and 285, and for shifting the bifurcated blade 284 into engagement with the contact 283 and a separate contact 286 that is also secured on contact support insulating plate 271. Thus, when the justifying key 244 and its switch means are in "On" position, as shown, and the machine is operated in a forward direction for any character or space, current travels through wire 141, contact 282, bifurcated blade 284, contact 285 and on through wire 143 (FIG. 11) that is connected to contact 285 (FIG. 17).

When the justifying key 244 and its switch means is shifted to "Off" position, the altered circuit is directed through wire 141, contact 283, bifurcated blade 284, contact 286, and on through a wire 287 which is connected to contact 286 and the wire 148 (FIG. 11) that leads to the carriage moving mechanism 149. Thus, the altered circuit avoids the punch control key arrangement 144 and control commutator means 146, but it still completes the circuit to the carriage moving mechanism.

From the above, it can be seen that the character key circuit is directed through wire 148, whether or not the justifying key 244 is in "On" or "Off" position. Thus, the parallel circuit through wire 272, contacts 269, 270 (FIG. 17), wire 273, solenoid 259 and wire 274 is effective for locking the justifying key 244 in either "On" and "Off" position, upon first forward operation of the carriage moving mechanism 149 as described.

Detailed description of the punch control key arrangement 144 (FIG. 11) and the control commutator means 146 will be deferred for the present since they in themselves are quite complex and they involve other circuits and mechanism that would be hard for the reader to understand at this stage of disclosure. The general outline of the normal character key circuit will now be picked up at the intersection of wires 148 and 287, where wire 148 leads to the carriage moving mechanism 149.

9. CARRIAGE MOVING MECHANISM

The carriage moving mechanism 149 is comprised of the spring means 101 (FIG. 9), previously described, for providing force for forward movement of the carriage 80, and of forward differential controlling and differential back-space motivating mechanism, commonly referred to as the carriage moving mechanism 149 (FIG. 11) which is located for the most part between vertical plates 288 and 289 (FIG. 2). These vertical plates 288 and 289 are held in proper parallel spaced relation by support shafts or rods, to be explained later, extending between the vertical plates 288 and 289 and secured thereto. The forward plate 288 is secured to the back plane surface of the standard typewriter frame 15, as by screws 290 (FIG. 19), and the rearward plate 289 is secured to the inverted T-shaped frame member 2 as by screws 291.

As previously described, the carriage 80 is mounted for lateral movement in respect to the main typewriter as is customary in such machines. A gear toothed rack 292 is mortised into and pressed between two identical plates 293 (FIGS. 1 and 8) secured on the left and right ends of the carriage main carrier 80 for transverse movement therewith.

A gear 294 (FIGS. 10 and 19) is constantly meshed with the gear toothed rack 292, and thus it is always rotated counterclockwise as when the carriage 80 is shifted leftwardly during forward operations and it is rotated clockwise as when the carriage 80 is returned and as when back-spacing occurs. The gear 294 is secured on the forward end of a sleeve 295 (FIG. 10), and a gear 296 is secured on the rearward end of the sleeve 295. The transmission unit thus formed of gear 294, sleeve 295 and transmission gear 296 is pivotally mounted on a rod 297, which extends forwardly through a hole therefor in a support frame 298 and which extends rearwardly to where it is secured to rearward plate 289 (FIG. 20) by any well known means.

The support frame 298 (FIG. 10) is secured to the transverse portion 28 of the typewriter frame 15 as by screws 299 (FIGS. 10 and 19) and it is secured to typewriter frame 15 by screws 300. The support frame 298 and mechanism carried thereon, together with the differential space carriage moving mechanism 149 (FIG. 11) the structure of which is shown particularly in FIGS. 10, and 20–27, replaces the customary singular character space escapement mechanism of the Underwood typewriter herein used by way of example.

The transmission gear 296 (FIG. 20) is constantly meshed with a gear 301 which is secured on the forward end of a sleeve 302. A ratchet wheel 303 is secured on the rearward end of sleeve 302. The ratchet unit, formed of gear 301, sleeve 302 and ratchet wheel 303, is rotatably mounted on a rod 304, which is secured to forward and rearward plates 288 and 289.

From the above, it should be recalled that the spring means 101 (FIG. 9) constantly tends to shift the carriage leftwardly in the forward direction. This tendency, applied to the carriage borne rack 292 (FIG. 19), as explained, urges the transmission gears 294 and 296 counterclockwise. Thus, the transmission gear 296 (FIG. 23) normally urges the ratchet unit, including gear 301 and ratchet wheel 303, clockwise in the forward direction. Therefore, while following the succeeding description, it should be remembered that clockwise rotation of the ratchet unit results in corresponding forward operation of the carriage 80, and vice-versa.

The ratchet wheel 303 is provided with teeth 305 (FIG. 24), the circular pitch of which is such that one tooth movement of the ratchet wheel 303 results in one unit (0.25") movement of the carriage as this movement is transmitted to or from the ratchet wheel 303 by the rack 292 (FIG. 10), transmission gear 294, sleeve 295, gears 296 and 301, and sleeve 302 (FIG. 20). The ratio among these gears provides for precise movement of the carriage 80 through control of the teeth 305 (FIG. 24), which are sufficiently larger than the unit movement of the carriage to permit differentiation among the units of movement.

A detent 306 is pivotally mounted on a rod 307, and it is normally engaged with the teeth 305 for preventing the ratchet wheel 303 from rotating clockwise and thereby normally preventing the carriage from moving leftwardly under the urging of the usual motivating spring 102 as explained. The rod 307 (FIG. 21) is secured at its forward and rearward ends to forward and rearward plates 288 and 289, respectively, in a usual manner. A torsion spring 308 (FIG. 24) is connected to detent 306 for urging the detent 306 into engagement with the ratchet wheel 303, and it is anchored on rod 309 which is secured between forward and rearward plates 288 and 289 (FIG. 21) in a usual manner.

A pawl 310 (FIG. 24), pivoted on a member 311 as by a suitable rivet 312, is also normally engaged with the ratchet wheel 303 under light tension of a spring 313 secured to the pawl 310 and the member 311. An edge surface 314, on member 311, normally rests against a tab 315, which in turn normally rests against a stop rod 316. The rod 316 (FIG. 20) is secured between forward and rearward plates 288 and 289. The member 311 (FIG. 24) and a member 317 are pivoted on the rod 304, and a light torsion spring 318 connected between the members 311 and 317 urges the member 311 counterclockwise against the tab 315 and rod 316, as explained, and it urges the member 317 clockwise toward its illustrated rest position. Rest position of member 317 is determined by clockwise engagement of a tab 319, on the member 317, with a stop surface 320 (FIG. 23) on a rearward extension 321 (FIG. 10) on an upstanding boss 322 of the support frame 298.

It should now be readily understood that disengagement of the detent 306 (FIG. 24) from ratchet wheel 303 will permit the carriage 80 to move leftwardly under power of its spring 102, as explained, and, when this occurs, the pawl 310 and member 311 are driven clockwise by the ratchet wheel 303 against the tension of light spring 318 and that it would only be required to provide selective means for arresting member 311 upon movement proportional to the letter space value of characters and spaces in order to control the forward movement of the carriage 80. Mechanical electrical means for disengaging the detent 306 will now be described.

A pair of bellcranks 323 and 324 (FIG. 25) are pivotally mounted on the shaft 307 to the rear of pawl 306 (FIG. 24). The bellcranks 323 and 324 are urged in contra directions, by a torsion spring 325 (FIG. 25), to their rest positions against the rod 309. The upwardly extending arm of bellcrank 324 carries a pivoted hook 326, which is constantly urged clockwise by a spring 327 connected to the arm and the pivoted hook 326. The upwardly extending arm of bellcrank 323 carries preferably a roller 328, which, underlying a rightward extension of the hook 326, normally supports the pivoted hook 326 in counterclockwise position against the tension of spring 327. A solenoid 329 (FIG. 21), secured on the rearward plate 289, is connected by a link 330 (FIG. 25) to the lower arm of bellcrank 323.

During normal forward operations, the solenoid 329 is energized each time a character or space key is depressed, as will be fully described later. Energization of solenoid 329 pulls link 330 rightwardly to rock bellcrank 323, counterclockwise and to latch its roller 328 on the pivoted hook 326. The counterclockwise rocking of bellcrank 323 loads a torsion spring 331, which is connected to the bellcrank 323 and anchored on rod 309. When the depressed key 16 is restored sufficiently to clear the type arm 25 from the platen 90 and the contacts under the keys 16 are opened as explained, the solenoid 329 is deenergized and the loaded spring 331 rotates bellcrank 323 clockwise from the operated position. The clockwise return operation of bellcrank 323 swings its roller 328, pulling the engaged pivoted hook 326 and bellcrank 324 clockwise. During clockwise operation of bellcrank 324, a stud 332 on the rightwardly extending arm of the bellcrank 324 contacts a rightwardly extending portion 333 (FIG. 24) of the detent 306 for rotating the detent clockwise and out of engagement with the ratchet wheel 303 against the light tension of spring 308. The detent 306 and bellcrank 324 (FIG. 25) are held in clockwise operated position until pivoted hook 326 is disengaged from roller 328, as will be described.

It will be recalled that the liberation of ratchet wheel 303 (FIG. 24) permits the carriage 80 to transverse leftwardly, rotating ratchet wheel 303, pawl 310 and member 311 clockwise. The means for arresting member 311 at one of its differential angular extents, which corresponds to the letterspace value of the depressed character or space key, will now be described.

Figures 9, 10:
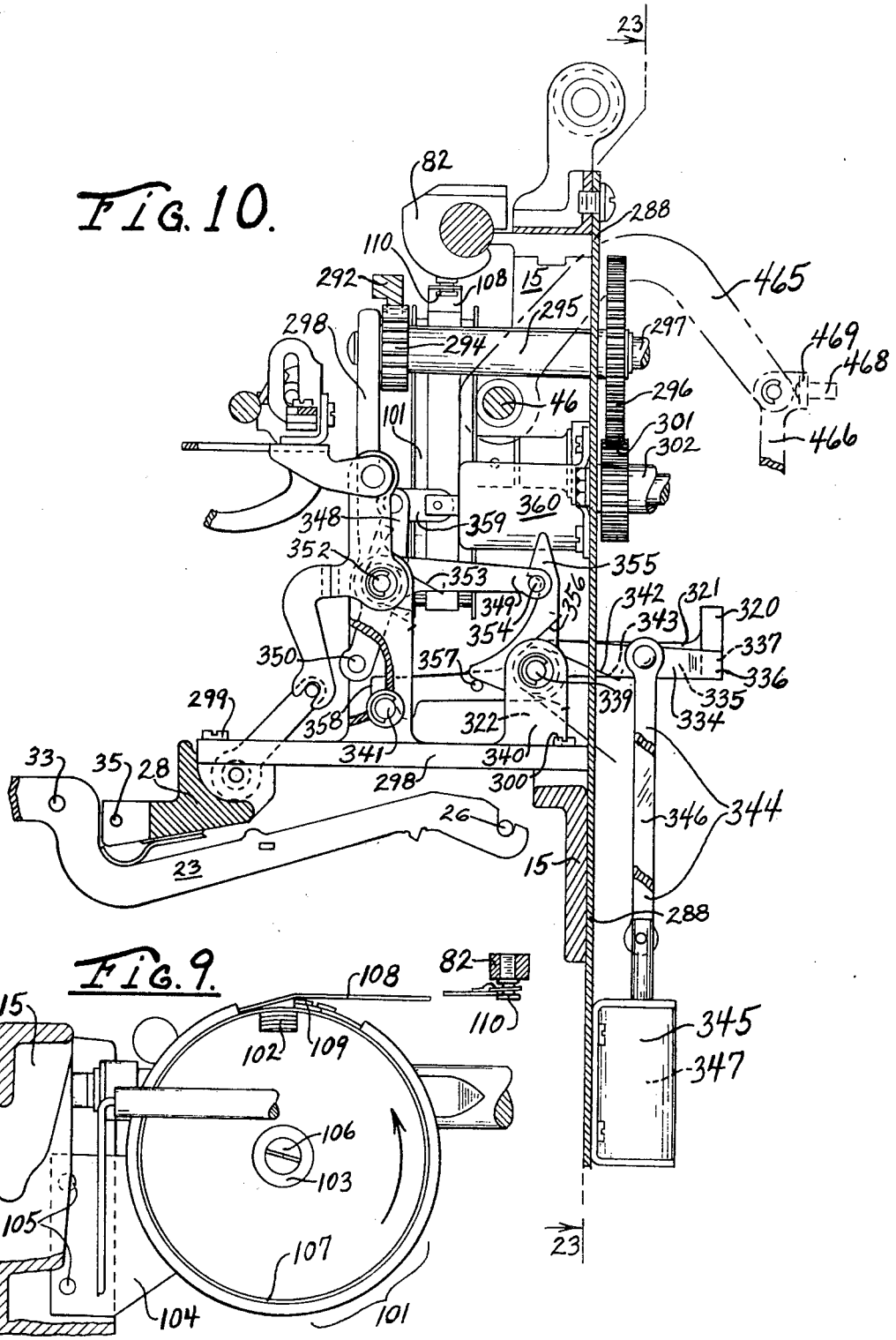
FIG. 9 is a front view of the main carriage moving spring means and showing its mounting on a fragment of the standard typewriter frame and including a piece of the carriage.
FIG. 10 is a fragmentary right sectional view of some of the mechanism shown in FIG. 19, taken generally on line 10—10 (FIG. 19), showing primarily a portion of the carriage moving mechanism.

Two movable stops 334 and 335 (FIGS. 10 and 23) normally stand in effective position with surfaces 336 and 337, respectively thereon, standing in engaging alignment with clockwise movement of a surface 338 (FIG. 24) on member 311. These two movable stops 334 and 335 are pivotally mounted on a supporting shaft rod 339 (FIG. 10), which is supported in the boss 322 and a boss 340 on support frame 298, and they are rotatable clockwise to ineffective positions where their surfaces 336 and 337 are out of engaging alignment below the arcuate path of the surface 338 (FIG. 24) on the member 311. When in their effective positions, the stops 334 and 335 (FIG. 23) are preferably arranged to bear on the left adjacent stop surface 337 and 320, as shown in FIG. 23, when pressure is applied on the right side of the particular stop 334 or 335. That is, the left edge of stop 335 is juxtaposed the lower part of the stationary stop surface 320, and the left edge of stop 334 is juxtaposed the surface 337 on stop 335. With the movable stops 334 and 335 situated as just described, the arresting shock received on the right side of either adjustable stop 334 or 335 is transmitted to the stationary frame extension 321 with practically no effect on the bushings of the stops 334 and 335 or on their supporting shaft 339 (FIG. 10). In this particular embodiment, two movable stops 334 and 335 are employed although more or less may be utilized in accordance with the number of letter space values that may be provided. The width of these adjustable stops 334 and 335 and the circular pitch of the ratchet wheel 303 may also be less or greater than that indicated to provide different letter space movements of the carriage 80 without departing from the spirit of the invention. However, as here arranged, stop 334 is normally first in order to arrest member 311 (FIG. 24) upon a rotation equivalent to two units (0.050") of carriage movement. Withdrawal of stop 334 (FIG. 23) out of the path of surface 338 (FIG. 24) permits the member 311 to rotate an additional unit; that is, stop 335 (FIG. 23) is then first in order to arrest member 311 (FIG. 24) upon rotation equivalent to three units (0.075") of carriage movement. Withdrawal of both stops 334 and 335 (FIG. 23) permits member 311 (FIG. 24) to travel the equivalent of four units (0.100") where the stationary stop surface 320 (FIG. 23) on stationary frame extension 321 is effective to stop member 311 (FIG. 24).

From the above, it can be seen that the stationary stop surface 320 (FIG. 23) and the movable stops 334 and 335 in normal position cooperate for limiting the carriage movement to two units, that operation of movable stop 334 from normal position permits movable stop 335 to control for three units of carriage movement and operation of both stops from normal position permits stationary stop surface 320 to control for four units of carriage movement. The stop surfaces 335, 337 and 320 are radial in respect to shaft 304 and in effective positions of the stops they coincide with the surface 338 (FIG. 24) for providing a substantial contact surface for stopping members 311 in the appropriate corresponding positions.

In order to properly situate the movable stops 334 and 335 in their normal effective positions, the stops 334 and 335 (FIG. 10) extend forwardly from pivot shaft 339 to lie on top of a stop rod 341, and the stops are urged counterclockwise in normal positions by torsion springs 342 and 343 respectively connected to the stops and anchored on the support frame 298. The left and right ends of the stop rod 341 are secured in the support frame 298, as also shown in FIG. 19. The means for operating the movable stops 334 and 335 to their ineffective positions will now be described.

A link 344 (FIG. 10) is pivotally connected to the stop 334 rearward of the pivot shaft 339, and to the armature of a solenoid 345. Similarly, a link 346 is connected to the stop 335 and to a solenoid 347. The solenoids 345 and 347 are secured to the forward plate 288 (FIGS. 10 and 23) by any well known means. The arrangement is such that, upon operation of solenoid 345, the solenoid pulls link 344 downward, rotating stop 334 clockwise to ineffective position against the tension of return spring 342. Also, when both solenoids 345 and 347 are operated, solenoid 345 renders stop 334 ineffective, as just described, and solenoid 347 pulls link 346 downward for rotating the stop 335 clockwise to ineffective position against tension of its return spring 343 and thus both stops 334 and 335 are rendered ineffective.

It will be recalled that detent 306 (FIG. 24) is withdrawn from ratchet wheel 303 upon deenergization of solenoid 329 (FIG. 25). Since the solenoids 345 and 347 (FIG. 23) are at times energized in differential combination with solenoid 329 to control the carriage movement and since at such times their deenergization is concurrent with that of solenoid 329 detaining means are provided for holding the operated stop 334, or the stops 334 and 335 as the case may be, in operated ineffective position until the member 311 (FIG. 24) is moved against the controlling effective stop as explained. This detaining means will now be explained.

A bail arangement is formed of a leftside bellcrank 348 (FIG. 19) and a rightside bellcrank 349, which are secured together by a bail 350 and a central sleeve 351. The sleeve 351, and therefore the bail arrangement, is pivotally mounted on a rod 352 secured in holes therefor in support frame 298. The bail arrangement is urged counterclockwise, from the illustrated normal position shown in FIG. 10, by a torsion spring 353 connected to the bellcrank 349 and to the support frame 298. A stud 354 in the rearward arm of bellcrank 349 is normally latched down by a pawl 355 for holding the bellcrank 349 in the illustrated normal clockwise position. The pawl 355 is pivotally mounted on shaft 339 and it is urged counterclockwise to latching position by a torsion spring 356 connected to the pawl 355 and the support frame 298. The pawl 355 has a forwardly extending finger overlying a stud 357 secured in the forward extension of stop 334. The arrangement is such that upon clockwise operation of stop 334 as explained, the stud 357 rotates the pawl 355 clockwise for disengaging the stud 354 and bellcrank 349 and permitting the bail 350 to move counterclockwise under the influence of its spring 353. From the above, it should be understood that no action involving the movable stops 334 and 335, the pawl 355 and the bail 350, occurs when the carriage 80 moves two units (0.050"). However, when the carriage moves three units (0.075"), the stop 334 is operated as explained, and the bail 350 is released as explained to swing counterclockwise over the forward extension of stop 335, which is still in normal effective position, and to swing under the forward extension of operated stop 334 for holding the stop in ineffective position for a time after the solenoid 345 is deenergized. When the carriage moves four units (0.100"), both stops 334 and 335 are operated to ineffective positions, as explained, and the bail 350 is released to swing under the forward extension of the operated stops 334 and 335 for holding both stops 334 and 335 in ineffective position after the solenoids 345 and 347 are deenergized.

The latching surface of pawl 355 is such that it will release the stud 354, and therefore the bail 350, just prior to full operation of the stop 334. However, a forward most end surface 358, on both stop 334 and 335, prevents full counterclockwise operation of the bail 350 until the operated stop 334, or stops 334 and 335, are fully operated. Thus, the bail 350 is free to snap to locking position as soon as the stop or stops fully move to operated position.

Restoration of the locking bail 350 and the differential stops 334 and 335 will now be described. An upwardly extending arm of the left bail member 348 is connected by a link 359 to a solenoid 360, which in turn is secured to the forward frame plate 288. At an appropriate time, as will be described later, the solenoid 360 is energized pulling the link 359 rearward and rotating the bail arrangement clockwise against the tension of its spring 353. This movement of the bail arrangement disengages the bail rod 350 from beneath the withdrawn stop or stops 334 and 335, and it swings the bail stud 354 below the hook formation of detent 355, whereupon the detent 355 returns to the illustrated latching position under tension of its spring 356. As the bail 350 is swung forwardly, the released stop or stops are returned by their springs 342 and 343.

Since the bail arrangement is released only when the required carriage movement is greater than the narrowest character space, as explained, the circuit through solenoid 360 is also closed only when the carriage movement is greater than the narrowest character or space as will be described, presently.

The means for controlling the energization of solenoid 360 will now be explained. A hook 361 (FIG. 24) is pivotally mounted on member 311 as at 362, A spring 363 connected to a stud 364 on the hook 361 and to a stud 365 on the member 311, urges the hook counterclockwise to the position shown, where the stud 364 rests against the edge of member 311. A stud 366 is located in clockwise engaging alignment with hook 361, and it is secured on the upper end of a member 367 which is pivoted at its lower end on a rod 368. The rod 368 is secured at its forward and rearward ends to the forward and rearward frame plates 288 and 289 (FIGS. 20 and 23) respectively. The member 367 (FIG. 24) is normally urged against a tab 369, on a bellcrank 370, by a torsion spring 371 connected between the member 367 and the bellcrank 370. The bellcrank 370 is also pivoted on rod 368. A rod 372 is secured to forward and rearward frame plates 288, 289 (FIG. 20), and it extends between lower and upper furcations 373 and 374 (FIG. 24) respectively. The furcations 373 and 374 on bellcrank 370 extend rightwardly, and, in cooperation with rod 372, serve to limit the angulation of the bellcrank 370. A torsion spring 375, connected to the bellcrank 370 and the rod 372 normally urges the bellcrank counterclockwise to normal position where the lower furcation 373 contacts the rod 372. An insulation disk 376 is secured to the generally depending arm of the bellcrank 370. This insulation disk 376 is situated in engaging alignment with a switch 377 which is mounted on a bracket 378 secured to the rearward frame plate 289 (FIG. 20). In the normal position of the bellcrank 370 (FIG. 24), the switch 377 is open, but upon clockwise rotation of the bellcrank 370, the insulation disk 376 contacts and closes the switch 377 just prior to the time furcation 374 contacts the rod 372. Counterclockwise rotation of the bellcrank 370 permits the switch 377 to open. The relationship between stud 366 and hook 361 is such that, when member 311 is rotated clockwise the equivalent of two teeth of the ratchet wheel 303 (as for two unit, 0.050" carriage movement) and it is arrested by stop 334 (FIG. 23) as explained, the travel is insufficient to cause hook 361 to latch onto the stud 366. However, rotation of member 311 (FIG. 24) more than two teeth, but less than three teeth will cause hook 361 to cam over the stud 366 for engaging the stud 366 upon counterclockwise return movement of member 311. As hook 361 cams over the stud 366, the hook 361 is rotated clockwise sufficiently to elevate a depending finger 379 over a roller 380, on the rod 372, as the member 311 rotates clockwise. Thereafter, when the hook 361 is latched on to stud 366 and the member 311 returns counterclockwise, the depending finger 379 coacts with the roller 380 to rotate hook 361 clockwise for releasing the stud 366. The arrangement is such that, upon the equivalent of three or four teeth (for three or four units) clockwise movement of member 311, the hook 361 is latched onto the stud 366 and the depending finger 379 is lowered clockwise in engaging alignment with roller 380, and, when the member is then returned clockwise as will be explained, the hook 361 acts upon the stud 366 for rotating the member 367, spring 371 and bellcrank 370 and its insulator disk 376 clockwise against the switch 377 to close the switch before the furcation 374 comes to rest against rod 372, The switch 377 remains closed for an instant, while the spring 371 is stretched and the depending finger 379 coacts with the roller 380 for rotating the hook 361 and thus releasing the stud 366. Upon release of stud 366, the switch 377 automatically opens as the spring 375 rotates the bellcrank 370 and member 367 counterclockwise to the position shown.

The switch 377 is wired in the same circuit with solenoid 360 (FIG. 10). Thus, when the switch 377 is closed, the solenoid 360 operates to swing the bail 350 from under the forward extension of the operated stop 334, or the operated stops 334 and 335 as the case may be, as explained, for permitting the stop or stops to be returned by their respective springs 342 and 343. Since the bail arrangement is thus swung clockwise, its stud 354 is lowered into position where it is latched in the illustrated normal position when the released stops return at the end of an operation.

For leftward (forward operation) carriage movement, as previously described, detent 306 (FIG. 24) is disengaged from ratchet wheel 303 by a stud 332 when the stud carrying bellcrank 324 (FIG. 25) coupled with bellcrank 323 is rotated clockwise by means of spring 331. It will also be recalled that stud carrying bellcrank 324 is held in that clockwise position until hook 326 is disengaged from roller 328. While stud carrying bellcrank 324 is held in the clockwise position, a rearwardly extending stud 381 in the leftward extension of hook 326 is held close under a rightwardly extending arm 382 (FIG. 26) of a bellcrank 383, as shown in phantom. Bellcrank 383 is pivoted on rod 297. Clockwise rotation of bellcrank 383 and the resulting counterclockwise rocking of hook 326 (FIG. 25), for disengaging the hook from roller 328 and for permitting stud carrying bellcrank 324 to restore, is accomplished in the following manner.

A roller 384 (FIG. 26), on a depending arm 385 of the bellcrank 383, is constantly engaged with a curved member 386, which is pivoted at 387 on the member 311. A stud 388 on curved member 386 normally abuts the edge of member 311 for limiting the counterclockwise rotation of the bellcrank 383 beyond the position shown. A spring 389 connected to the bellcrank 383 and anchored to a rod 390 (FIG. 22) urges the bellcrank 383 and member 386 (FIG. 26) to the positions shown and controlled by the stud 388 as just described. Member 386 is also formed with a projection 391 normally protruding leftward ahead of the stop surface 338 on member 311. The curved surface 392 of member 386, in normal position of the member, is formed on a common radius about rod 304, on which member 311 rotates. Therefore, as member 311 rotates clockwise and roller 384 rolls on surface 392, bellcrank 383 is not moved. However, just prior to contact of the surface 338 with the effective stop 334, 335 or 321 (FIG. 23), the projection 391 (FIG. 26) engages the surface 336, 337 or 320 (FIG. 23) on the effective stop and, as a member 311 (FIG. 26) continues clockwise, curved member 386 is rotated counterclockwise about its pivot 387. This counterclockwise rotation of curved member 386 causes its surface 392 to shift the roller 384 leftward, and thus rotates bellcrank 383 clockwise. Clockwise rotation of bellcrank 383 moves the stud 381 downward, from the position shown in phantom, thereby rotating the pivoted hook 326 (FIG. 25) counterclockwise and disengaging it from the roller 328. Thus, the bellcrank 324 is permitted to return counter-clockwise under tension of spring 325. As the bellcrank 324 returns, its stud 332 is raised upward away from the rightward extension 33 (FIG. 24) of detent 306 and thus the stud 332 permits the detent to be reengaged with the ratchet wheel 303 by tension of spring 308.

Simultaneously with the reengagement of the detent 306 with the ratchet wheel 303 is just explained, the pawl 310 is automatically disengaged from the ratchet wheel 303 for permitting return of member 311 under influence of its spring 308 as will now be explained. As previously explained, early in the operation, stud 332 was rotated clockwise about rod 307 for disengaging detent 306 from the ratchet wheel 303 and initiating carriage movement. As stud 332 is moved clockwise to remove the detent from the ratchet wheel 303, it also rotates a member 393 (FIG. 27) clockwise about rod 307 on which it is mounted. The clockwise rotation of member 393 moves a surface 394 thereon out of the path of a stud 395, secured to and extending forwardly from pawl 310 (FIG. 24). With the member 393 (FIG. 27) in its clockwise position, the stud 395 (FIG. 24) travels clockwise with the pawl 310, member 311 and ratchet wheel 303 until they are stopped by the differential stops, 334, 335 as explained. Also, as explained, the stud 332 is restored upwardly when the member 311 is stopped by the effective differential stop 334, 335. In the clockwise operated position of member 311, as the stud 332 restores counterclockwise, the member 393 (FIG. 27) is permitted to follow directly counterclockwise, about the shaft 307, for engaging its surface 394 with stud 395 and for disengaging the pawl 310 (FIG. 24) from ratchet wheel 303 and permitting counterclockwise restoration of member 311. Since the clockwise force on ratchet wheel 303 is now on the end of pawl 310, a bit of counterclockwise force is exerted on member 393 (FIG. 23) to move the stud 395 at this time. To this end, a member 396 is pivoted on the rod 316 and it has an upstanding finger which is urged clockwise against a stud 397, secured on the member 393. The member 396 is urged clockwise and, therefore, the member 393 is urged counterclockwise by a torsion spring 398 connected to member 396 and to forward plate 288 (FIG. 21). The torsion spring 398 (FIG. 23) is of sufficient strength to hold the member 396, member 393, stud 395 and pawl 310 out of engagement with ratchet wheel 303 against tension of spring 313 (FIG. 24). However, since the force of spring 313 together with the clockwise force of ratchet wheel 303 exerted on the end of pawl 310 may be too much to permit torsion spring 398 (FIG. 23) to take effect at such times, a link 399 is pivotally connected to member 396 and to the armature of a solenoid 400 for ensuring disengagement of pawl 310 from the ratchet wheel 303. The solenoid 400 is secured to the forward plate 288 (FIG. 21). As will be explained, the solenoid 400 is wired in circuit with a normally open switch 401 (FIG. 23) which is secured on a bracket 402 that is secured to rearward plate 289 in any known manner. This circuit includes a wire 403 (FIG. 11) connected between the normal forward carriage movement circuit wire 141 and the switch 401, and a wire 404 connected between switch 401 and the solenoid 400 which is grounded as indicated. An insulator 405 (FIG. 26) is secured on a member 406, and it is aligned to engage the switch 401. Member 406 is pivoted on rod 390 and it has a rightwardly extending bifurcated end embracing a stud 407 which is secured on a leftwardly extending arm of the member 383. The arrangement is such that, when the carriage moves forwardly and the member 311 is rotated to its clockwise operated position, the finger 391 engages the effective differential stop for rotating the member 386 counterclockwise and rotating bellcrank 383 clockwise at the end of the forward carriage movement, as explained. When bellcrank 383 is rotated clockwise, the stud 407 on the bellcrank rotates the member 406 counterclockwise to swing the insulator 405 downward on the switch 401 to close the switch and to casue operation of the solenoid 400 (FIG. 11 and 23). Thus, as soon as the carriage is moved forward a controlled amount, the solenoid 400 is operated at the same time as the detent 306 (FIG. 24) is reengaged with the ratchet wheel 303. Operation of solenoid 400 (FIG. 23) pulls link 399 downward, rotating member 396 clockwise and positively rotating member 393 counterclockwise. Counterclockwise rotation of member 393 causes its surface 394 to move the stud 395 and thus the pawl 310 (FIG. 24) clockwise about pivot 312. This clockwise movement of pawl 310 disengages it from the ratchet wheel 303, and permits the spring 318 to restore the member 311 counterclockwise to rest position. As the member 311 returns counterclockwise, it can be seen that the stud 395 travels generally toward the rod 307 while riding on the surface 394 (FIG. 27). At the end of this return stroke, the stud 395 rises into a recess 408 as the pawl 310 (FIG. 24) returns counterclockwise under tension of its spring 313 and the pawl 310 is thus reengaged with the ratchet wheel 303.

As the member 311 returns counterclockwise away from the effective differential stop 334, 335, the member 386 (FIG. 26) and bellcrank 383 are restored by spring 389. Restoration of bellcrank 383 causes the member 406 to rotate clockwise for lifting insulator 405 away from switch 401 and thus breaks the circuit through solenoid 400. Though the solenoid 400 may be deenergized before full return of member 311, full return of the member 311 is assured since the effect of spring 398 (FIG. 23), acting on members 396 and 393, and on stud 395 and pawl 310, is stronger than that of spring 313 (FIG. 24), as previously described.

From the above, it should be understood that the just described forward differentially controlled operations are performed very rapidly, since all functions initiated during the clockwise stroke of member 311 are complete at the time the member 311 is stopped by the differential stops 334, 335 and since all functions initiated during the return stroke of the member 311 are completed precisely at the time member 311 is fully returned. Summarizing, the solenoid 329 (FIG. 23) is energized for cocking the mechanism for movement and the adjustable stops 334 and 335 (FIG. 10) are set when required for controlling the movement upon depression of a character or space key; upon release of the character or space key, the detent 306 (FIG. 24) is withdrawn from the ratchet wheel 303 and the member 393 (FIG. 27) is rotated to prevent interference of the surface 394 with the stud 395 while the stud, the pawl 310 (FIG. 24) and member 311 are driven clockwise as the carriage moves; during this forward movement, the hook 361 is latched onto stud 366 when required, and, during the last unit of clockwise movement of the member 311, the projection 391 (FIG. 26) coacts with the effective differential stop for rotating the curved member 386 counterclockwise, rotating the bellcrank 383 clockwise, moving stud 381 downward and unlatching hook 326 (FIG. 25) from the roller 328, whereupon spring 325 rotates member 324 for raising stud 332 and thereby permitting reengagement of the detent 306 (FIG. 24) with the ratchet wheel 303 for preventing further movement of the carriage and permitting member 393 (FIG. 27) to be driven counterclockwise by member 396 (FIG. 23) and solenoid 400 for applying the surface 394 (FIG. 27) against stud 395 and disengaging the pawl 310 (FIG. 24) from the ratchet wheel 303 and permitting counterclockwise return of the member 311; and, during the return stroke of member 311, the hook 361, when engaged with the stud 366 following a three or four unit carriage movement, effects closing of switch 377 to cause disengagement of the bail 350 (FIG. 10) from the differential stops 334, 335 that may have been operated, hook 361 (FIG. 24) disengages from the stud 366 upon engagement of its finger 379 with the roller 380 and, finally, the pawl 310 reengages the ratchet wheel 303 as the stud 395 rises into recess 408 (FIG. 27) and the member 311 (FIG. 24) comes to rest with its surface 314 stopping against tab 315 and rod 316. From the above, it can be seen that the carriage 80 is moved forwardly during clockwise movement of the member 311 and the mechanism is restored during counterclockwise movement of the member 311.

The manner in which the normal character key circuit operates the above described mechanism will now be described. As previously explained, the normal character key and space key circuits travel via wire 148 (FIG. 11) to the carriage moving mechanism 149. The wire 148 is connected to a normally closed switch 409 (FIG. 23). The normally closed switch 409 is mounted on the rearward end of a bracket 410, which is secured at its forward end to the forward frame plate 288. The normally closed switch 409 is normally held closed by an insulator 411 (FIG. 24) secured on the extremity of member 311. However, it can be seen that the normally closed switch 409 will open and remain open during the clockwise and counterclockwise reciprocation of the member 311 and the insulator 411 thereon. A wire 412 is connected between normally closed switch 409 and the solenoid 329 (FIG. 23), and another wire 413 is connected between the solenoid 329 and the differential stop solenoid 345 (FIG. 11). A wire 414 is connected between the differential stop solenoids 345 and 347. The two unit (0.050") circuit wire 150 is connected with the wire 413; the wire 414, and the four unit (0.100") circuit wire 152 are connected with the differential stop solenoid 347. The arrangement is such that when a key is depressed and the wire 150 is effective as determined by the upper-lower case snap switch means 159, the current passes via wire 148, the normally closed switch 409 (FIG. 24), wire 412, the solenoid 329 (FIG. 25) for forward operation cocking of the mechanism, wire 413 (FIG. 11), and on through the wire 150. Thus, when the employed key is released sufficiently to break the circuit, the solenoid 329 is deengergized and the cocked mechanism is thereby released to the effect of spring 331 (FIG. 25), which withdraws detent 306 (FIG. 24) as explained, for initiating carriage movement. During operation of the mechanism, the member 311 and insulator 411 are moved clockwise out of normal position, permitting normally closed switch 409 to open and thereby rendering the circuit ineffective until the member 311 is returned and the cycle is complete. Since this circuit runs through wires 412 and 150 (FIG. 11) and avoids the differential stop solenoids 345 and 347, the adjustable stop 334 (FIG. 23) remains in effective position as explained, carriage movement is limited to two units as the member 311 engages the surface 336 on the adjustable stop 334. As the member 311 (FIG. 24) is returned counterclockwise, the insulator 411 closes the normally closed switch 409 to render the circuit operable for an ensuing operation. In a second instance when a key is depressed and the wire 151 (FIG. 11) is effective, the current passes via wire 148, the normally closed switch 409, wire 412, the cocking solenoid 329, the wire 413, the solenoid 345 for removing the adjustable stop 334 (FIG. 23) and thus rendering the adjustable stop 335 effective, and the current continues via wires 414 (FIG. 11) and 151. In this second instance, the mechanism 149 operates in the same manner as before described except that the member 311 (FIG. 23) is controlled by contact with the surface 337 on adjustable stop 335, upon three units of carriage movement. In a third instance when a key is depressed and the wire 152 (FIG. 11) is effective, the current passes via wire 148, normally closed switch 409, wire 412, the cocking solenoid 329, wire 413, solenoid 345 (FIG. 23) for removing the adjustable stop 334 from effective position as explained, wire 414 (FIG. 11) solenoid 347 for removing the adjustable stop 335 (FIG. 23) and thus rendering the stationary stop 321 effective, and the current continues via wire 152 (FIG. 11). In this third instance, the mechanism 149 operates as before except that the member 311 (FIG. 23) is controlled by contact with surface 320 on stationary stop 321, upon four units (0.100") of carriage movement.

It should be remembered that, upon closure of switch 401 at the end of the forward stroke of the mechanism 149, current travels from source through contacts 176–179 under the key 138 (FIG. 11) in normal position, wire 139, contacts under key 140 in normal position and through wire 141, as explained, and it continues through wire 403, through now closed switch 401, wire 404 and goes to ground through the solenoid 400. Operation of solenoid 400 opens the switch 401, as described, to deenergize the just discussed circuit. By referring to FIG. 11, it can be seen that this circuit is not effective whenever the Tape Return Key 138 or the Delete Key 140 is depressed.

From the above, it is seen that the carriage moving mechanism 149 is normally operable to move the carriage 80 forwardly appropriately, under control of normal character key circuits. The carriage moving mechanism is also operable reversely for automatic differential back-spacing (deleting) movement of the carriage, but description of these operations will be deferred, pending better understanding of the machine and mechanisms that are involved in back-space control.

As previously explained, the solenoid 259 (see also FIG. 17) is operated for locking the justifying key 244, when carriage movement is first effected in a line. The wire 274, leading from solenoid 259 (FIG. 11), is also connected to wire 413 in the carriage moving mechanism 149 to complete the circuit for the solenoid 259. Thus, when the circuit 272–274 is effective which is the case following carriage return as explained, operation of the carriage moving mechanism 149 will also bring about operation of the solenoid 259. Thereafter, the circuit 272–274 is broken until the carriage is again returned as explained.

10. UPPER-LOWER CASE SWITCH MEANS

The structural details of the upper-lower case switch means 159 and the manner in which this switch means 159 selectively directs the normal character key circuits through the wires 150–152 and magnets 153–155, respectively, and through wires 156–158, respectively, will now be described.

The commutator arrangement of the upper-lower case switch means 159 is shown schematically in FIG. 11 and it is shown more particularly in FIG. 28. Comparable commutator arrangements are shown in FIGS. 29 and 30, but these will be described later. The upper-lower case commutator arrangement (FIG. 28) is constructed generally on and about a support rod 415, which is secured in parallel vertical plates 416 and 417 (FIG. 31) so as to extend therebetween and rearwardly of parallel vertical plate 417 as shown in FIG. 2. The left ends of parallel vertical plates 416 and 417 rest on the horizontal flange of an angle bracket 418, which is secured to the flanges of inverted T-members 2 and 3 so as to be part of the base frame 1. The parallel vertical plates 416 and 417 are also fastened to a frame bracket 418 by a U-shaped member 419 secured to the parallel vertical plates 416 and 417 and the frame bracket 418. Similarly, the right ends of parallel vertical plates 416 and 417 are secured to the right side of the base frame 1 by a U-shaped member 420.

The upper-lower case snap switch means 159 is one of three similar mechanisms supported by the parallel vertical plates 416 and 417. The other two mechanism are a bold-regular and a print-no print switch means, which are mounted on support rods 421 and 422, respectively, and which will be described later. However, it should be pointed out that the mechanisms of the three switch means are nearly identical and a description of the structure of one such means should suffice for the others. The differences among the three switch means involve only the circuitry and purposes of the individual switch means. The individual differences will be described under appropriate headings hereinafter, when their utility becomes apparent.

The commutator arrangement in the upper-lower case switch means 159 is comprised generally of a rotatably shiftable disk 423 (FIG. 28) and stationary brushes engaging the rotatably shiftable disk 423, as shown. The rotatably shiftable disk 423 is made of any suitable insulation material and it carries conduction contacts that are engageable with particular brushes as will be explained.

The rotatably shiftable disk 423 is mounted on a central sleeve 424 and three bolts 425 that are parallel to the central sleeve 424. The three bolts 425 are secured to a plate 426, which lies against the forward face of the rotatable shiftable disk 423 (rightward) as shown in FIG. 31. The bolts 425 extend from the plate 426 (FIG. 28), through the rotatably shiftable disk 423 and through spacers 427, which are assembled on each of the bolts 425. The spacers 427 (FIG. 31) extend rearwardly (leftwardly as shown) between the rotatably shiftable disk 423 and a member 428, which is also mounted on the central sleeve 424. Another spacer 429 is assembled on each of the bolts 425 between the member 428 and another identical member 430 (FIG. 33), which is also mounted on the rearward ends of bolts 425 and on the central sleeve 424. From the above, it can be seen that tightening of nuts 431 on the rearward ends of bolts 425 draws the member 430, spacers 429 (FIG. 31), member 428, spacers 427, rotatably shiftable disk 423 and the plate 426 (FIG. 28), which is integral with central sleeve 424, together in an assembly pivoted on support rod 415. The unit thus formed generally of rotatably shiftable disk 423, member 428 (FIG. 33) and member 430 is shiftable counterclockwise to the illustrated normal lower case position, indicated by line L.C., and clockwise to upper case position, indicated by line U.C.

The mechanism for shifting the just described commutator unit will be explained later. However, at the moment, it is sufficient to understand that the commutator disk 423 (FIG. 28) is positioned in the illustrated counterclockwise lower case position when the machine is in lower case condition and it is shifted to the clockwise position when the machine is in upper case condition.

There are four identical insulators 432, 433, 434 and 435 each of which carries three brushes, for accomodating the normal character key circuits. The insulators 433 and 435 are inverted in respect to the insulators 432 and 434, so that the brushes on adjacent insulators are alternately situated to contact opposite sides of the commutator disk 423. The alternate arrangement of the insulator and brush assemblies makes it possible to have eight such assemblies cooperating with the relatively small commutator disk 423, without interference among the brushes and the contacts on the commutator disk 423. The other four illustrated brush assemblies are not utilized in the character key circuits and will be described later in connection with the circuits in which they are involved.

Suitable spacers 436, between the inverted insulators 433 and 435 and the plate 416, together with screws 437 extending through holes therefor in the insulators and through the spacers, are screwed into the vertical plate 416 for holding these insulators 433 and 435 in the positions shown. Longer spacers 438 and screws 439 (FIG. 30) are provided for securing the insulators 432 and 434 to the vertical plate 416. Brushes, to be explained more fully, are secured to the insulators, by rivets 440, in such a way as to be insulated from each other and from the rest of the mechanism.

Referring to the Chart A located following the Figure Descriptions and FIG. 11, it can be recalled that the character groups "F", "G" and "A" require two units (0.050"), three units (0.075") and four units (0.100") of carriage movement, respectively, in both lower and upper case. Therefore, the two unit, three unit and four unit wires 156 (FIG. 11), 157 and 158, for controlling the carriage moving mechanism 149 as described, lead directly to the "F", "G" and "A" group wires, respectively, without involving the upper-lower case switch means 159. Thus, when a key in group "F", "G" or "A" is operated as explained, the carriage is moved appropriately, regardless of the case condition of the machine. However, since the characters in groups "B", "C", "D" and "E" require a different amount of carriage movement in upper case than in lower case, their circuits must be controlled by the upper-lower case switch means 159. The circuits for Groups "B"-"E" will now be described.

The character "Group B" wire is connected to a brush 441, which is secured on insulator 432 (FIG. 28) by rivets 440 as explained. The brush 441 engages an elongated contact 442, on the commutator disk 423, in both the illustrated counterclockwise lower case position and the clockwise upper case position of the commutator disk 423. A brush 443, on insulator 432, is situated to engage a contact 444, on commutator disk 423, only in the illustrated counterclockwise position of the commutator disk 423, while a brush 445, on insulator 432, is situated to engage a contact 446, on the commutator disk 423, only in the clockwise upper case position of the commutator disk 423. The contacts are in the form of heads of rivets, which extend through holes therefor in the commutator disk 423 and which are riveted over on a conductor plate, like plate 447. The plates 447, for each set of contacts, conductively interconnect their respective contacts on the opposite side of the commutator disk 423 from the engageable heads of the rivets. However, returning particularly to the brushes on insulator 432 and the circuitry for "Group B" (FIG. 11), the arrangement is such that current may be conducted through brush 443, contact 444, a plate 447, contact 442 and brush 441, when the commutator disk 423 is in the illustrated lower case position, and current may be conducted through brush 445, contact 446, plate 447, contact 442 and brush 441 when the commutator disk 423 is in the clockwise upper case position. Thus, it may be said that the brushes 443 and 441 are interconnected and thus rendered effective only when the commutator disk 423 is in lower case position, and the brushes 445 and 441 are interconnected and rendered effective only when the commutator disk 423 is in upper case position, all as indicated in FIG. 11. A wire 448 is connected to the brush 443 and the four unit (0.100") wire 158. A wire 449 is connected between the brush 445 and the two unit (0.050") wire 156. When the machine is in lower case and brushes 441 and 443 are effective, as explained, and when the key in "Group B" is operated, the carriage is controlled to move four units by the circuit running through the four unit wire 158, wire 448, the effective brushes 443 and 441, the "Group B" wire and the operated key switch 113. However, when the machine is in upper case and the commutator disk 423 is shifted clockwise to its upper case position, as explained, operation of the key in "Group B" causes a two unit carriage movement by the circuit directed through two unit wire 156, wire 449, the now effective brushes 445 and 441, the "Group B" wire and the operated key switch 113.

Since the brushes on insulators 433, 434 and 435 (FIG. 28) and the related contacts on commutator disk 423 function in the same manner as those described in connection with insulator 432, the previous structural details will aid in understanding the succeeding description. Thus, in consideration of brushes 450, 451 and 452 on insulator 433, brushes 451 and 450 (FIG. 11) are effective when the commutator disk 423 is in the counterclockwise lower case position, and brushes 452 and 450 are effective when the commutator disk 423 is shifted clockwise to its upper case position. Considering brushes 453, 454, and 455 on insulator 434 (FIG. 28), brushes 454 and 453 (FIG. 11) are effective when the commutator disk 423 is in counterclockwise lower case position, and brushes 455 and 453 are effective when the commutator disk 423 is in clockwise upper case position. Finally, considering brushes 456, 457 and 458 on insulator 435 (FIG. 28), brushes 457 and 456 (FIG. 11) are effective when commutator disk 423 is in clockwise upper case position.

When the machine is in lower case, from the above, it can be seen that operation of individual keys in the groups "C", "D" and "E" complete circuits through the upper-lower case switch means 159 as follows: A key in "Group C" will complete a circuit through the three unit (0.075") wire 157, a wire 459 connected between wire 157 and brush 451, the effective brushes 451 and 450, the "Group C" wire, and the wire 115 and the switch 113 for the letter "k" as shown here by way of example: A key in "Group D" completes a circuit through the two unit (0.050") wire 156, a wire 460 between the wire 156 and brush 454, the effective brushes 454 and 453, the "Group D" wire and the key switch 113. A key 16 in "Group E" completes a circuit through the two unit (0.050") wire 156, a wire 461 between wire 156 and brush 457, effective brushes 457 and 456, the "Group E" wire and the operated key switch 113. Thus, as can be determined from the above and by referring to Chart A (After the Figure Descriptions), all lower case requirements are satisfied.

When the machine is in upper case and commutator disk 423 (FIG. 11) shifted clockwise to its upper case position, the circuits for groups "C", "D" and "E" keys are as follows: Operation of a "Group C" key completes a circuit through the four unit (0.100") wire 158, a wire 462, now effective brushes 452 and 450, the "Group C" wire, and, as here shown for example, the wire 115, and the switch 113 under the character key "K" as previously explained; A "Group D" key will complete a circuit through the three unit (0.075") wire 157, a wire 463, the now effective brushes 455 and 453, the "Group D" wire and the operated key switch 113; A "Group D" key will complete a circuit through the four unit (0.100") wire 158, a wire 464, now effective brushes 458 and 456, the "Group E" wire, and the operated key switch 113.

From the above and by referring to the Chart A, it can be seen that operation of any character key 16 will cause the proper carriage movement under the determinative control of the Upper-Lower Case Switch Means 159 just described, regardless of the predisposed upper-lower case condition of the machine.

11. CASE SWITCH SHIFTING AND ENCODING MEANS

Since the case switch means 159 and its shifting requirements, just described, are fresh in mind and since the case switch means is such an important part of the character key 16 circuit control, we now deviate from the general outline of character key circuitry, set forth in Topic 4, sufficiently to describe the control motivating and encoding means for the case switch means 159.

As previously explained, the case shifting bail arrangement, comprised of parts 46–49 (FIG. 4), is situated as shown for lower case and it is shiftable clockwise about the axis of rod 46 for upper case. A generally rearwardly extending lever 465 is secured on the torque rod 46 of the bail arrangement, so as to rotate therewith. The lever 465 (FIG. 19) is located leftwardly from bail member 48, and it extends rearward beyond the forward plate 288. As shown in phantom in FIG. 10, a depending link 466 is pivotally connected on the end of lever 465. The lower end of link 466 is connected to the armature of a solenoid 467 (FIG. 32), which is secured to the rearward plate 289. A stud 468 (shown in phantom, FIG. 10) is secured on a bent over tab 469 on the upper end of link 466. The stud 468 extends rearwardly from the tab 469 and through an elongated hole 470 (FIG. 32) in a rightwardly extending arm of a bellcrank 471. The bellcrank 471 is pivoted on a stud 472, which is secured on the rearward plate 289. A contractile spring 473 is connected to a forwardly extending stud 474 on the depending arm of bellcrank 471 and to a forwardly extending stud 475 on the rearward plate 289. An insulation disk 476, on the depending arm of bellcrank 471, is provided for engaging and closing a lower case switch 477 and an upper case switch 478, when the machine is in lower case and upper case conditions, respectively, as will be explained. The lower-case and upper-case switches 477 and 478 are secured to rearward plate 289, in any well known manner. The arrangement is such that, upon operation of shift keys 17 (FIG. 4), 18 or shift lock 22, the bail arrangement 46–49 is rotated clockwise, as explained, and, since the lever 465 is secured on the torque rod 46 of the bail arrangement 46–49, the lever 465 is also swung clockwise. Clockwise operation of lever 465 (FIG. 10) moves the link 466 and its stud 468 downward. Downward operation of stud 468, acting on the lower end of elongated hole 470 (FIG. 32), rotates bellcrank 471 clockwise. At about the midpoint of operation of the shift key linkage, the axis of contractile spring 473 is shifted to the left of stud 472, whereupon the contractile spring 473 snaps the bellcrank 471 and its insulator 476 clockwise against the upper case switch 478 for closing the switch. At the end of this clockwise operation of bellcrank 471, the upper end of elongated hole 470 is brought close to the stud 468 then substantially in its lowest position. Similarly, when the machine is returned to lower case condition, the lever 465 (FIG. 10) is returned counterclockwise, returning the stud 468 upward. Upward movement of the stud 468, now acting on the upper end of the elongated hole 470 (FIG. 32), returns the bellcrank 471 counterclockwise. As the axis of contractile spring 473 now shifts to the right of stud 472, the contractile spring 473 snaps the bellcrank 471 counterclockwise, as permitted by elongated hole 470, for closing the lower case switch 477 as shown. From the above, it is seen that lower case switch 477 is closed only when the machine is in lower case condition, and the upper case switch 478 is closed only when the machine is in upper case condition.

The lower case and upper case switches 477 and 478 are cooperatively associated with brushes 479 (FIG. 28), 480 and 481, mounted on an insulator 482, and with related contacts on the commutator disk 423. The insulator 482 is secured to plate 416, and the brushes thereon cooperate with contacts on commutator disk 423, in exactly the same manner as those described above in connection with insulators 432–435. Therefore, at this point, it should suffice to point out that the brushes 480 and 481 are conductively connected by contacts on commutator disk 423 and thus they are effective only when the commutator disk 423 is in the illustrated counterclockwise lower case position, and similarly the brushes 479 and 481 are effective only when the commutator disk 423 is shifted clockwise in its upper case position.

The brush 479 is connected to the lower case switch 477 (FIG. 32) by a wire 483 (FIG. 35), and brush 480 is connected to upper case switch 478 by a wire 484. Brush 481 is connected to a source of power "S" by a wire 485. The arrangement is such that, when bellcrank 471 is in lower case position L-C and lower case switch 477 is closed and when commutator disk 423 is in the counterclockwise lower case position as shown, passage of current from the source (S) and wire 485 to the wire 483 and lower case switch 477 is not possible because the brush 479 is ineffective under these specific conditions. However, when the machine is then shifted to upper case and bellcrank 471 is shifted to its U-C position as explained, an upper case shift circuit is completed as will now be described.

When bellcrank 471 closes upper case switch 478, a circuit is complete from the source and wire 485, the effective brushes 481 and 480 and related contacts on commutator disk 423 which is momentarily held in lower case position as will be described, wire 484, the now closed upper case switch 478, a wire 486 connected between upper case switch 478 and solenoid 467 and through the solenoid 467. Though at this point the machine is in upper case condition or at least nearly so, the solenoid 467 is thus energized to pull the link 466 downward and to fully operate the lever 465 (FIG. 10) for assuring full shift of the case shifting bail arrangement 46–49 under finger pressure on the shift keys 17, 18 or shift lock 22 (FIG. 4) as explained. The upper case shift circuit continues via a wire 487 (FIG. 35) connected between solenoid 467 and a solenoid 488, through solenoid 488 provided for shifting the case snap switch means 159 to upper case as will be explained, a wire 489 between solenoid 488 and a solenoid 490, and to ground through solenoid 490 in a differential key lock mechanism for rendering an upper case key lock arrangement operable as will be described. This upper case shift circuit is broken as the commutator disk 423 shifts clockwise to upper case position as a result of energization of the solenoid 488, in a manner to be explained presently.

Assume now that the commutator disk 423 is shifted clockwise to upper case position, rendering brush 480 ineffective and rendering brushes 481 and 479 effective as explained. When the bellcrank 471 is returned to its illustrated L-C position upper case switch 478 is permitted to open and lower case switch 477 is closed as explained, completing the lower case circuit which is as follows: Leading from source "S" and wire 485, the currents travels momentarily through effective brushes 481 and 479 while the commutator disk 423 is detained in upper case position, on through wire 483, now closed lower case switch 477, a wire 491 between lower case switch 477 and a solenoid 492, the solenoid 492 for returning the case snap switch means 159 to lower case as will be explained, on through a wire 493 and to ground through a solenoid 494 in the differential key lock mechanism for rendering a lower case key lock arrangement operable as will be explained later. This lower case shift circuit is broken as the commutator disk 423 returns counterclockwise to lower case position, when brush 479 is rendered ineffective, as a result of operation of solenoid 492, as will be explained.

The mechanism operated by solenoid 488 and 492 for effecting case shifting of the commutator disk 423 will now be described. The solenoids 488 and 492 are secured on the rearward face (leftward as viewed in FIG. 31) of plate 417 in a well known manner. A link 495 (FIG. 34) is pivotally connected to the armature of solenoid 488 and to a member 496, which is pivoted on rod 415. Another identical member 497 is pivoted on rod 415, but it is inverted in respect to the member 496. A link 498 is pivotally connected to the member 497 and to the armature of solenoid 491. A contractile spring 499 is connected to the members 496 and 497 for urging the lower ends of the members together against opposite sides of a stud 500. The stud 500 is secured on the lower end of a member 501, which is pivoted on rod 415. A contractile spring 502 is connected to the remote end of stud 500 (FIG. 31) and to a stud 503, which extends forwardly through a limit hole 504 (FIG. 34) and through a hole therefor in the member 430 (FIG. 33) and it is secured in member 428. When the axis of contractile spring 502 (FIG. 34) is to the left of rod 415, as shown, the spring urges member 501 clockwise to rest against a stop stud 505, and it also urges stud 503 counterclockwise about rod 415 against the leftward extent of limit hole 504. Thus, the unit formed of the stud 503, members 428 and 430 (FIG. 33) and the commutator disk 423 (FIG. 28) is urged to move and stay in the counterclockwise lower case position, as shown and indicated by the line L-C (FIG. 33). When the stud 500 (FIG. 34) is swung counterclockwise as will be explained and the axis of contractile spring 502 is shifted to the right end of limit hole 504, the unit formed of stud 503, members 428 and 430 (FIG. 33) and commutator disk 423 (FIG. 28) is urged to move and stay in the clockwise upper case position indicated by line U-C (FIG. 33). A member 506 (FIG. 34) is pivoted on rod 415, between the members 501 and 496 (FIG. 31), and it is normally urged counterclockwise, as will be explained, it is stopped in this direction position by an edge surface 508 on member 506. A stud 509, secured on the upper end of member 501, extends therefrom beyond engaging alignment by nibs 510 and 511, on members 496 and 497, respectively. In normal relation of these parts, the nibs 510 and 511 are approximately equally spaced on opposite sides from the stud 509, to provide movement of the respective member 496 or 497 in advance of contact of its nib 510 or 511 with the stud 509 as will be explained. An insulator 512 and an insulator 513 are secured on members 496 and 497, respectively, in arcuate engaging alignment with switches 514 and 515, respectively, secured on plate 417. The arrangement is such that upon shifting the machine to upper case, upon the closing of upper case switch 478 (FIG. 35) and energization of solenoid 488 as explained, the solenoid 488 pulls link 495 (FIG. 34) upward, rotating member 496 counterclockwise and away from stud 500 against the tension of spring 499. In this manner, the member 496 and its insulator 512 are shifted ahead of the rest of the mechanism. When nib 510 engages the stud 509, the member 501 is then moved positively counterclockwise, with the member 496, initially against the tension of contractile spring 502. Finally, when the axis of contractile spring 502 is definitely to the right of rod 415, the stud 500 engages surface 508 on member 506 for stopping member 501 in its counterclockwise position. At about this same time, the insulator 512 closes the switch 514 and a surface 516, on member 496, engages stop stud 507 for limiting the advanced swing of the member 496. As a result of closing switch 514, the solenoid 488 is automatically deenergized as will be explained. Deenergization of solenoid 488 permits spring 499 to return member 496 sufficiently clockwise, away from stop stud 507 and against stud 500, for allowing the switch 514 to open. A time-delay detent 517 (FIG. 33) is provided, in this instance, for preventing the immediate clockwise swing of stud 503 to the rightward end of limit hole 504 (FIG. 34), and for thus allowing the circuit through switch 514 sufficient time to perform its functions as will be explained. The detent means will now be described.

Detent 517 (FIG. 33) is pivoted on a rod 518, which is secured to and supported by plates 416 and 417 (FIG. 31) in any well known manner. A torsion spring 519 (FIG. 33) is connected to the detent 517 and anchored on a stud 520, which is secured on plate 417 (FIG. 31), for urging detent 517 (FIG. 33) counterclockwise on top of the stud 503. A latching projection 521 on detent 517 extends downward along side of stud 503 in either the L-C or U-C position of the stud 503, for normally holding the stud in its instant position. A stud 522, secured in the rightwardly extending arm of the detent 517, underlies a member 523 which is pivoted on rod 518. A stud 524 is secured on plate 417 (FIG. 31) and it overlies the member 523. A torsion spring 525 (FIG. 33) is connected to the member 523 and to stud 520 for urging the member counterclockwise against stud 524. A link 526 is pivotally connected to a leftwardly extending arm of member 523 and to the armature of a solenoid 527, which is secured on plate 417 (FIG. 31). The arrangement is such that, upon closure of switch 514 (FIG. 34), the solenoid 527 (FIG. 33) is energized, as will be explained, for pulling link 526 upward and rotating member 523, stud 522 and the detent 517 clockwise to withdraw the latching projection 521 out of the arcuate path of stud 503. In the instant situation, since the stud 500 (FIG. 35) is now shifted counterclockwise and since the axis of contractile spring 502 is now rightward of rod 415 as explained, liberation of stud 503 permits the contractile spring 502 to shift the unit including stud 503 and commutator disk 423 clockwise to upper case position where brushes 480 and 481 are rendered ineffective, as explained, and the upper case shift circuit through upper case switch 478, and solenoids 467, 488 and 490 is broken.

When the machine is conditioned for upper case as just described and it is again shifted to lower case, the bellcrank 471 is returned to the illustrated L-C position where it again closes lower case switch 477, as explained. The instant this occurs, the lower case shift circuit is complete and solenoids 492 and 494 are energized as explained. Solenoid 492 then pulls link 498 (FIG. 34) upward, rotating member 497 clockwise and away from stud 500 against tension of spring 499. In this manner, the member and insulator 513 are shifted clockwise ahead of the rest of the mechanism. When nib 511 engages stud 509, the member 501 is moved clockwise, initially against tension of contractile spring 502, followingly in respect to member 497. When the axis of contractile spring 502 is again definitely shifted to the left of rod 415, the member 501 engages stop stud 505, and, at about the same time, the insulator 513 closes switch 515 and a surface 528 on member 497 engages stop stud 505 for limiting the action. As a result of closing switch 515, solenoid 492 is automatically deenergized as will be explained. Deenergization of solenoid 492 permits spring 499 to return member 497 counterclockwise against stud 500 as shown to permit the switch 515 to open. However, before solenoid 492 is deenergized and switch 515 is opened, the circuit through the switch and solenoid 527 (FIG. 33), as will be explained, operates solenoid 527, which disengages detent 517 from stud 503 as explained for permitting the unit including stud 503 (FIG. 35) and commutator disk 423 to shift counterclockwise from upper case position (U-C) to lower case position (L-C) under influence of contractile spring 502.

The case shift detent and code punching circuit will now be described. The timing and effectiveness of these circuits is determined by the switches 514 and 515, and two sets of brushes cooperating with contacts on commutator disk 423. One set of three brushes, 529, 530 and 531 (FIG. 28), are secured on an insulator 532. Except for the angulation in respect to commutator disk 423, the construction and arrangement of these brushes, the contacts with which they cooperate and the supporting insulator is identical with those associated with insulators 432–435 and 482 described above. In this instance, it should suffice to note that brushes 530 and 531 are effective only when the commutator disk 423 is in the illustrated counterclockwise lower case position, and brushes 529 and 531 are effective only when commutator disk 423 is in its clockwise upper case position. The other set is comprised of four brushes, 533, 534, 535 and 536, which are secured on an insulator 537. The insulator 537 is the same as the other insulators, 432, 433, etc., except that it is fashioned to accommodate the four brushes instead of three. The contacts on the commutator disk 423, relative to the four brushes, are similar to the other contacts on the disk; they being interconnected and arranged however to render brushes 533 and 534 effective only when the commutator disk 423 is in its illustrated counterclockwise lower case position, and to render brushes 535 and 536 effective only when the disk 423 is in its clockwise upper case position.

When the commutator disk 423 is detained in lower case position, when the machine is shifted to upper case and the solenoid 488 (FIG. 35) is operated as described, the switch 514 is closed as described. Under these conditions, closure of switch 514 initiates the following circuit. Current from source S and wire 137 passes through contacts under the tape return key 138 not depressed as explained, and via wire 139 to the delete key 140. The wire 139 is joined by a wire 538 (FIG. 15) which is connected with the contacts 217 and 211. Thus, the circuit normally travels the wires 139 and 538, contact 211, bifurcated blade 205, contact 210 and a wire 539 connected between contact 210 and solenoid 527 (FIG. 35). The circuit operates solenoid 527 for withdrawing detent 517 and permitting delayed shifting of commutator disk 423 as described. The circuit continues via a wire 540, connected to a blade 541 of switch 514. In closed condition of the switch 514, its blade 541 is engaged with its blades 542 and 543, thus parallel circuits for punching the upper case code (channels 4 and 6) are created. The 4-channel code circuit travels via blade 542, a wire 544, effective brushes 530 and 531, a wire 545 connected with the 4-channel punch wire and the main punch mechanism 161 for punching a 4-channel punch hole in the tape as will be explained. Simultaneously, the 6-channel code circuit travels via blade 543, a wire 546, effective brushes 533 and 534, a wire 547 connected with the 6-channel punch wire and the main punch mechanism 161 for punching the 6-channel hole in the tape as will be explained. Thus, the main punch mechanism 161 is controlled to punch the upper case code 4, 6.

Since the travel of the main punch mechanism 161 and the work load on the main punch solenoids is less than the travel of detent 517 and the work load on the solenoid 527, the momentary detention of the commutator disk 423 in lower case position provides sufficient time for punching the case shift code. However, when the case shift code is punched and the solenoid 527 releases the detent 517 from the stud 503, the commutator disk 423 is shifted clockwise to upper case position as explained. This shift of the commutator disk 423 and the contacts thereon breaks the continuity between brushes 530 and 531, and between brushes 533 and 534 for permitting restoration of the 4, 6 code punches as will be explained and for permitting restoration of detent 517 against stud 503, now in upper case position, as explained. This shift of the disk 423 also breaks continuity between brushes 480 and 481 for deenergizing the upper case shift circuit through the now closed upper case switch 478 as explained.

When the commutator disk 423 is detained in upper case position, when the machine is then returned to lower case and the solenoid 492 is operated as described, the switch 515 is closed as described. Under these conditions, closure of switch 515 initiates the following circuit. Current travels from source S and wires 137, 139, 538 and 539, solenoid 527 as before, wire 540 and a wire 548 connected to a blade 549 of the switch 515. In closed condition of the switch, its blade 549 is engaged with its blades 550 and 551, thus parallel circuits for punching the lower case code (channels 4 and 7) are created. The 4-channel code circuit travels via blade 550, a wire 552, now effective brushes 529 and 531, the wire 545, the 4-channel punch wire and the main punch mechanism 161 for punching the 4-channel punch hole in the tape. Simultaneously, the 7-channel code circuit travels via blade 551, a wire 553, the now effective brushes 535 and 536, a wire 554 connected with the 7-channel punch wire and the main punch mechanism 161 for punching the 7-channel hole in the tape. Thus, the main punch mechanism 161 is controlled to encode the lower case code 4, 7.

When the lower case code has been punched and the detent 517 is operated by the solenoid 527 to release the stud 503, the commutator disk 423 is shifted counterclockwise back to the illustrated lower case position as explained. This return of the disk 423 and the contacts thereon breaks the continuity between the brushes 529, and 531, and between brushes 535 and 536 for permitting restoration of the 4, 7 code punches as will be explained, and for permitting restoration of detent 517 against stud 503, now in lower case position as shown and explained, respectively. This return of the disk 423 also breaks the continuity between the brushes 479 and 481 for deenergizing the lower case shift circuit through the now closed lower case switch 477 as explained.

In conclusion, it may be stated generally that an appropriate case shift code is punched and the Upper-Lower Case Switch Means 159, discussed in Topic 10, is shifted to control for proper differential carriage movement in response to character key operations that may follow, upon a case shift of the machine.

Returning to the general outline, in Topic 4, but deferring the detailed description of the switches 160 for the moment, we will now describe the detailed structure of the main punch mechanism 161 (FIG. 11).

12. MAIN PUNCH MECHANISM, AND CODE PUNCHING AND READING ASSEMBLY FRAMEWORK

The encoding and code reading mechanisms shown herein as exemplary are of a punched tape variety, however, magnetic tape, cards, dots for optical reading and other forms of encoding and reading arrangements may be substituted without departing from the spirit of the invention, in a broad sense. However, the disclosed arrangement includes many novel features in the arrangement of text encoding, delete reading, justification encoding main reading for reproduction purposes, and code media handling, as well as novel features involving mechanism for punching tape, reading the same and for tape handling, that are here disclosed specifically.

The main punch mechanism 161 is one of a number of interconnected cooperating code punching, tape handling and code reading mechanisms included in a major sub assembly, preferably located on the extreme right side of the machine and supported on or about three vertical frame plates 555 (FIG. 2), 556 and 557. This major assembly could just as well be a separate self-supporting unit, connected to the machine only by wires without departing from the spirit of the invention. However, in the preferred form these vertical frame plates 555, 556 and 557 are secured to a transverse forward supporting angle member 558 and a rear angle member 559, in any known manner. The left ends of transverse supporting angle members 558 and 559 are supported on an angle member 560 and they are secured directly thereto as by screws 561. The forward end of angle member 560 is secured to base frame 1 and its rearward end is secured to inverted T-member 2 in any known manner. The rightward ends of angle members 558 and 559 are secured to the right side of base 1, as by screws 562. The vertical frame plates 555, 556 and 557 (FIG. 36) are further held in their proper parallel spaced relations by several bolts 563 with suitable spacers 564 thereon between the plates.

The main punch mechanism 161 (FIG. 11) is comprised primarily of seven solenoids 565-1 through 565-7 (FIG. 37), associated levers 566-1 through 566-7, and pin type punches 567-1 through 567-7. The hyphenated suffixes identify the related code channel of each of these parts. The solenoids 565 (1–7) are secured on a plate 568, which is secured to and extends between vertical frame plates 556 and 557 (FIG. 36) as shown. A link 569 (FIG. 37) is pivotally connected to the armature of each of the solenoids 565 and to the rearward and (leftward as shown) of its respective lever 566. The levers 566 (-1, 3, 5, and 7) are pivoted on a rod 570, and the levers 566 (-2, 4 and 6) are pivoted on a rod 571. The grouping of solenoids 565 (-1, 3, 5 and 7) and the mounting of their respective levers 566 (-1, 3, 5 and 7) on rod 570 certain distances from the punches 567, and grouping of solenoids 565 (-2, 4 and 6) and the mounting of their respective levers 566 (-2, 4 and 6) on rod 571 certain proportionally greater distances from the punches 567 provides an arrangement where the ratios between a solenoid 565 and its punch 567 and the travel of all solenoids 565 and punches 567 are substantially the same in all cases. Rod 570 and 571 are secured on and extend between vertical frame plate 557 and the vertical frame plate 556 (FIG. 36) in a well known manner. A link 572 (FIG. 37) is pivotally connected on the forward end of each of the levers 566. The lower end of each of the punches 567 (1-7) is bent over to form a single trunnion which extends through a hole therefore in the upper end of its respective link 572, as is customary in usual pin type punches. The punches 567-1 through 567-7 are guided in closely fitting holes therefor in a machined casting 573, which is secured between vertical frame plates 557 and 556 (FIG. 36) on bolts 574 and 575 that extend through holes therefor in the plates and the casting. The upper ends of links 572 (FIG. 38) are guided and held in engagement with the trunnions on the lower ends of the punches by comb-like projections 576 between the links 572 on the bottom of machined casting 573.

The control tape (code medium) 577 (FIGS. 37 and 38) normally travels from left to right on a smooth plate surface 578 on top of the machined casting 573. A hinged cover 579, in its illustrated normal closed position, overlies the control tape 577 and provides only running clearance for the control tape 577 thereunder and above the smooth plane surface 578. The control tape 577 is guided further, against transverse rightward movement, by vertical surfaces 580 and 581 (FIGS. 37, 38 and 39) on standing hinge portions 582 and 583, respectively, of machined casting 573. The control tape 577 is guided on its left side by surfaces 584 and 585 (FIG. 39) on the right side of upstanding portions 586 and 587 (FIG. 40), respectively, of the machined casting 573. The hinged cover 579 is pivoted on axially aligned hinge pins 588 and 589 (FIGS. 37–40), screwed into machine casting portions 582 and 583, respectively and extending through holes therefor in these portions and the right side of the hinged cover 579 as best seen in FIG. 39. The left side of hinged cover 579 (FIGS. 39 and 40) is normally held down by pawls 590 and 591 pivoted at their lower ends on studs 592 and 593 (FIG. 40), respectively, which are secured on vertical plate 556. Torsion springs 594 and 595, anchored in a known manner, are respectively connected to the pawls 590 and 591 for respectively urging the pawls clockwise and counterclockwise to their latching positions. Two pawls 590 and 591 are used to prevent release of the hinged cover 579 by accidental operation of one of the pawls. However, if it is necessary to remove a control tape 577 and put another control tape 577 in the assembly for example, the operator must first shift both pawls 590 and 591 counterclockwise and clockwise, respectively, and rotate the hinged cover 579 clockwise as viewed from the front (from the right in FIG. 40) about its pivots 588 and 589 to open the punch assembly. To close the punch assembly, the operator need only rotate the cover counterclockwise until the pawls 590 and 591 again latch over the hinged cover 579 as shown.

The upper paper cutting ends of the punches 567 (FIG. 38) normally extend to within a short distance below the smooth plane surface 578 of the machined casting 573. The upper extremities of the punches 567 extend into holes therefor in an insulating block 596, which is inlaid in the top of machined casting 573 so that its top smooth plane surface is flush with surface 578. Insulating block 596 is held in its recess by flush-top screws 597 threaded into holes therefor in the machined casting 573, as shown. Insulating block 596 will be more fully described hereinafter in connection with a back-space reader.

Punch receiving die holes 598, one for each of the punches 567, extend through the lower half of the hinged cover 579, each for receivng its respective channel punch and the resulting waste punched from the control tape 577.

The "Code Channel Punch Wires" 1–7 (FIG. 11) are connected with solenoids 565-1 through 565-7 (FIG. 37), respectively. When a circuit is completed through any of these wires as explained, the respective solenoids 565 are operated, each pulling its respective link 569, rotating the connected lever 566 counterclockwise, elevating its link 572, and pushing its punch 567 upward through the tape 577 and depositing the blanked out waste in the die hole 598. When the upper end of a punch 567 has entered the hole 598 only sufficiently to lodge the waste in the hole 598, a surface 599 on the respective lever 566 contacts a stop rod 600 to limit the just described punching action. The stop rod 600 extends between the vertical frame plates 557 and 556 (FIG. 36) and it is secured thereto in any known manner.

When an operated solenoid 565 (FIG. 37) is deenergized, a spring 601, connected to its lever 566 and anchored in a well known manner, returns the just described mechanism to the position shown where the lever 566 rests against the top of stop rod 600 and its punch 567 is withdrawn from the hole 598 it punched in the control tape 577.

Normally, when a code is punched by the main punches 567 and the punches 567 are withdrawn as just described, the control tape 577 is automatically shifted rightwardly one station as will be described later.

It will later become apparent that incorporation of the main punch mechanism 161 in closely arranged stations in a unified assembly with a back space code reader 1097 and related automatic back-spacing and deleting systems, with separate justifying punches, and with a main reader provides many novel advantages and novel fully automatic features not previously anticipated in the art.

13. PUNCH CONTROL KEY ARRANGEMENT

This punch control key arrangement 144 (FIG. 11) is comprised primarily of two major components, namely a punch key 602 (FIGS. 3, 42, 43 and 44)and a punch control relay 603 (FIGS. 45, 46 and 47). In the punch "on" condition of the punch control key arrangement 144, the composing machine is prepared to code for operation of the reproducing machine, and, in punch "off" condition of the arrangement, the composing machine is prepared to operated alone similar to an ordinary typewriter, without encoding for operation of the reproducing machine.

The structure of the punch key 602 (FIGS. 42 and 43) will now be described. The punch key 602 is pivotally mounted on a shaft 604, which is pivotally supported on vertical plates 605 and 606 (FIG. 44). The vertical plates 605 and 606 are secured to a bottom plate 607 which is secured at its left end to another vertical frame plate 608. Vertical plate 606 is secured on base frame 1 for supporting plate 606 and for supporting the rightward end of the bottom plate 607. Vertical frame plate 608 is secured to main frame channel member 14 in any known manner. The punch key 602 is normally pivoted clockwise to "on" position as shown in FIG. 42, but it may be manipulated counterclockwise to "off" position as shown in FIG. 43. The punch key 602 may be manipulated to either "on" or "off" position, and it may be automatically shifted to "on" position in machine clearing operations as will be explained later.

A yieldable detent 609 (FIGS. 42 and 43) is provided for holding the punch key 602 in either "on" or "off" position. Yieldable detent 609 is pivoted on a rod 610, secured on vertical plate 605 and plate 606 (FIG. 44). A torsion spring 611 (FIG. 42), anchored in any known manner, is connected to the yieldable detent 609 for urging the detent counterclockwise against the punch key 602. A roller 612 on the remote end of the detent 609 is urged against the punch key 602 at all times. In the illustrated position of the punch key 602, the roller 612 is urged into recess 613 on punch key 602 for holding the punch key in "on" position. As the punch key 602 is manipulated counterclockwise, a projection 614 on the key acting on the roller 612 causes yieldable detent 609 to rotate clockwise against tension of torsion spring 611, until the punch key 602 is moved beyond midpoint, at which time the detent 609 acts to aid movement of the punch key to its full "off" position where roller 612 lodges in a recess 615 on the key as shown in FIG. 43. When the punch key 602 is returned clockwise, the opposite takes place and the roller 612 is again lodged in recess 613.

An insulator 616 is secured on a forwardly extending arm 617 of the punch key 602, and an upwardly extending bifurcated conductor 618 is secured on insulator 616 so as to be insulated from arm 617. The bifurcations of conductor 618 are pressed leftward against a contact 169 and a conductor strip 620 when the punch key 602 and its forwardly extending arm 617 are in "off" position as shown, and they are pressed against a contact 621 and the conductor strip 620 when the punch key 602 is in clockwise "on" position as shown in FIG. 42. The punch control key arrangement 144 is such that current may be conducted through conductor strip 620, conductor 618 and contact 621 when the punch key 602 is in "on" position as in FIG. 42, and that current may be conducted through conductor strip 620, conductor 618 and contact 619 (FIG. 43) when the punch key 602 is in "off" position.

An insulator 622 supports conductor strip 620 and contacts 619 and 621, and it insulates them from a bracket 623 on which the insulator 622 is secured in any known manner. Bracket 623 is secured on an upper horizontal flange of a channel member 624, which extends across the front of the machine as shown best in FIG. 2. The righward end of channel member 624 is secured to the base frame 1 as at screw 625. The leftward end of the channel member 624 is secured to plate 172 as by screws 626, and between the ends the channel member 624 is secured to the typewriter frame 15 as by screws 627. The channel member 624 will be discussed further in connection with a keyboard ball-lock arrangement to be described later.

The structure of the punch control relay 603 (FIGS. 45, 46 and 47) will now be described. The relay mechanism is supported by a horizontal frame member 628, having an upturned left side portion 629 and a right portion 630. Member 628 (FIGS. 45 and 47) is secured to a bracket 631, which in turn is secured on the upper ends of the vertical plates 416 and 417 as shown.

A ratchet-cam wheel 632 (FIGS. 46 and 47) is rotatably mounted on a stud 633, secured on portion 629. A lever 634 is also pivoted on stud 633 so as to rotate concentrically with ratchet-cam wheel 632. A drive pawl 635 is pivoted on lever 634 at 636 (FIG. 47), and it is urged counterclockwise against ratchet-cam wheel 632 by a contractile spring 637, connected to the pawl 635 and anchored in a known manner. The contractile spring 637 is so situated as to not only urge the drive pawl 635 against the ratchet-cam wheel 632 but also to urge the lever 634 counterclockwise to normally rest against return stud 638, which is secured on frame portion 629. A detent 639 is pivoted on return stud 638, in a plane to the left of the pawl 635 as shown in FIG. 46. A torsion spring 640 is anchored on portion 629 and connected to the detent 639 for urging the detent 639 into engagement with wheel 632 (FIG. 47) for normally holding the ratchet-cam wheel against counterclockwise rotation. A link 641 is pivotally connected to lever 634 and to the armature of a solenoid 642, which is secured to portion 629. The arrangement is such that, upon operation of solenoid 642, link 641 is pulled downward, rotating lever 634 clockwise until it is stopped by a stud 643 at the end of its operation. During clockwise operation of lever 634, the pawl 635 rotates the ratchet-cam wheel 632 one step, ratcheting the detent 639 into the next notch on the ratchet-cam wheel 632 at the end of the operation. Then, upon deenergization of solenoid 642, the detent 639 holds the ratchet-cam wheel 632 and the contractile spring 637 returns the lever 634 counterclockwise, ratcheting pawl 635 out of one notch and into the succeeding notch located one step counterclockwise from the first.

A horizontal bail 644 is secured on upper ends of a left side lever 645 (FIG. 46) and a right side lever 646. The lower ends of the levers 645 and 646 are secured on a torque resisting rod 647, which is pivoted on frame portions 629 and 630. A roller 648 is carried by bail 644, and it is held in alignment with ratchet-cam wheel 632 by sleeve type spacers 649 and 650 and a tubular insulator 651 which are also carried by the bail 644 between the levers 645 and 646. A plurality of switches 652 (FIGS. 46 and 47) are secured on a transverse channel bracket 653 which is secured at its ends to frame portions 629 and 630. A general description of one of the switches 652 should suffice for all at the moment, there being for the most part no difference in structure.

The switches 652, for the most part, are single pole, double throw switches having a central spring blade "a" which is tensed rearward against the insulator 651. The tension of blades "a" constantly urges the bail 644 and the roller 648 thereon clockwise against the ratchet-cam wheel 632, as best shown in FIG. 47. The ratchet-cam wheel 632 has major radius surfaces 654 and minor radius notches 655 (roller receiving notches) arranged on its periphery in alternate stations relative to roller 648. In the illustrated normal punch "on" position of the ratchet-cam wheel 632, one of its major radius surfaces 654 holds the roller 648, bail 644 and insulator 651 counterclockwise against the tension of blades "a", and the blades "a" are held in engagement with blades "b" of the switches 652. When the ratchet-cam wheel 632 is rotated one step as explained, the blades "a" disengage from blades "b" and engage blades "c" as the blades "a" move the insulator 651, bail 644 and the roller 648 clockwise and the roller enters a notch 655. When the wheel 632 is operated another step clockwise, it cams the roller 648 counterclockwise, and therefore the bail 644, insulator 651 and the blades "a" are also shifted counterclockwise to disengage the blades "a" from blades "c" and reengage them with the blades "b" as shown.

The general circuitry and operation of the punch control key arrangement 144 will now be described. A punch-on, punch-off phase control switch 656 (FIG. 46 and 48), which is one of the switches 652 described above, is wire connected between the contacts 619 and 621 (FIG. 43) and the solenoid 642 (FIG. 47). A source of power "s" (FIG. 48) is connected to conductor strip 620 by a wire 657. A wire 658 is connected to contact 621 and the blade "c" of the switch 656. A wire 659 is connected between contact 629 and blade "b" of the phase control switch. A wire 660 is interconnected with blade "a" of the phase control switch 656 and the solenoid 642, which is grounded as indicated. Assume now that the punch key 602 is in the clockwise "on" position, as shown in FIG. 42, and that the roller 648 (FIG. 47) is resting on one of the major radius surfaces 654 as shown. The circuit through engaged conductor strip 620 (FIG. 48) and contact 621, and wire 658 is broken, under this condition, since the switch 656 is shifted to engage blades "a" and "b", and to disengage blade "c" as shown in FIG. 47. Now assume that the punch key 602 (FIG. 48) is shifted to "off" position as shown here. Current will now travel through wire 657, conductor 620, contact 619, wire 659, engaged blades "b" and "a" in switch 656, wire 660 and the solenoid 642 for advancing the ratchet-cam wheel 632 (FIG. 47) one step as explained.

At the end of this step of the ratchet-cam wheel 632, the roller 648 drops off of major radius surface 654 and into a notch 655, thus permitting the blade "a" to disengage from blade "b" and to engage with blade "c", as explained and as shown in FIG. 48. When the phase control switch 656 is thus shifted, the circuit through wires 657, 659 and 660, and solenoid 642 is broken for permitting the contractile spring 637 (FIG. 47) to return the pawl 635 and engage it in the succeeding notch on ratchet-cam wheel 632 as explained. At this point, all of the switches 652 are in the punch "off" condition as shown in FIG. 48.

If the punch key 602 is then shifted to the "on" position, since blades "a" and "c" in phase control switch 656 are now engaged, current will travel from source through wire 657 plate 620, contact 621, wire 658, blades "c" and "a", wire 660 and it goes to ground through the solenoid 642 for advancing the ratchet-cam wheel 632 (FIG. 47) as explained. However, since the solenoid 642 is now being operated to shift the ratchet-cam wheel 632 and to cam the roller 648 out of one of the notches 655 and since the circuit now on through blades "a" and "c" would be broken by the camming action before the solenoid were 642 was fully operated, a holding circuit is provided for assuring full operation of the solenoid 642 when it is being operated to shift the relay mechanism to punch "on" condition, as will now be described.

The holding circuit is comprised primarily of a common normally open switch relay 661 and a normally closed switch 662. The normally open switch relay 661 is secured on frame member 628 in a convenient manner as shown. The normally closed switch 662 is secured on frame portion 629 in a known manner, and it is situated in engaging alignment with an insulator 663 on the remote end of lever 634. The arrangment is such that, upon full operation of lever 634, the insulator 663 opens the normally closed switch 662, and the insulator permits the switch 662 to close when the lever 634 returns as explained. However, when the punch key 602 (FIG. 48) is shifted to "on" position and the initial circuit passes through blades "c" and "a", wire 660 and the motivating solenoid 642 as explained, a parallel circuit picks up its source from wire 660 and it travels via a wire 664, the magnet of holding relay 661, a wire 665 and goes to ground through normally closed switch 662. Energization of the magnet in holding relay 661 closes the relay switch and renders effective the holding circuit, which picks up its source from wire 658 and traveling via a wire 666 goes through the now closed switch in holding relay 661, continues through a wire 667, the wire 660 and goes to ground through the solenoid 642 for causing the solenoid to complete its operation. The holding relay 661 remains operated, even after the solenoid 642 is operated sufficiently to break the circuit through the blades "a" and "c" in phase control switch 656 as explained, because the circuit now passing through wire 658, and wire 666, and the switch in holding relay 661 also goes through the wire 664 and the magnet in holding relay 661, the wire 665 and goes to ground through the normally closed switch 662 as long as the normally closed switch 662 remains closed. As soon as the solenoid 642 is operated sufficiently for the momentum of the motivated link 641 (FIG. 47), lever 634, and pawl 635 to carry the ratchet-cam wheel 632 the final amount of its step, the insulator 663 engages the normally closed switch 662 and opens the switch positively as the lever 634 is stopped by stud 643. As soon as normally closed switch 662 is opened, the circuit, contact 621, wire 658 , wire 666, the switch in holding relay 661, wires 667, 660 and 664, the relay magnet, wire 665 is now broken by the opened switch 662. This permits the holding relay 661 to release its switch and thus break the holding circuit, through the relay switch, wires 667 and 660, and the solenoid 642. Thus, the motivated solenoid 642 is deenergized, following a shift to punch "on" condition, and the mechanism is restored by contractile spring 637 (FIG. 47) as shown and described.

As just described, the punch control relay 603 is enslaved to operate to "on" and "off" positions in conformity with and under control of the punch key 602 (FIG. 43). From the above, it will also be clear to one schooled in the art that, even if the current at the source (S) and wire 657 (FIG. 48) were turned off at the time the punch key 602 were manipulated, from one position to the other, the punch control relay 603 will operate and assume the condition dictated by the key 602 as soon as the source is again turned on.

The group of individual switches, 160 (FIG. 11) previously mentioned, are included in the plurality of switches 652 (FIG. 48) in the punch control relay 603. In the "on" position of the switches 160, as clearly shown in FIG. 11, the main punches 161 (1-7) operate for encoding as previously described. However, when the punch control key arrangement 144 is in "off" condition as shown in FIG. 48, the blades "b" and "a" of the switches 160 are disconnected for rendering the main punch mechanism 161 ineffective, and the blades "a" and "c" are connected for maintaining the effectiveness of the code channel punch wires and the carriage moving mechanism 149 (FIG. 11), which precedes the punch mechanism 161 in the character key circuits, as described.

The normal circuit ground wire 162 for the main punch solenoids 565 is connected to blade "a" of a switch 669, which is one of the switches 652 in the punch control relay 603, and the wire 163 is connected to blade "b" of the switch. The switch 669, though not necessary in the embodiment as shown (in view of switches 160), is provided for completely isolating the main punch mechanism 161 from all other circuits, when the punch control key arrangement 144 is "off". However, when the punch control key arrangement 144 is "on" and blades "a" are engaged with their respective blades "b" in the switches 160 and in switch 669, the current that may pass through the code channel punch wires, the switches 160 and the main punch mechanism 161, and the common ground for the punch solenoids 565 (1-7) will travel through wire 162, switch 669 and wire 163 as previously described.

As previously explained, the normal character key circuit travels the wire 143 (FIG. 11), the punch control arrangement 144 and a wire 145. The wire 143 is connected to blade "a" of a switch 670 (FIG. 48), which is one of the switches 652 in the punch control key arrangement 144, and the wire 145 (FIG. 11) is connected to blade "b" of this switch. When the punch control arrangement 144 is "on", as indicated here, the character key circuit may travel through wire 143, through engaged blades "a"and "b" of switch 670 and it continues through wire 145 as explained. However, when the punch control key arrangement 144 is "off", as indicated in FIG. 48, the character key circuit that may travel through wire 143 (FIG. 11), as explained, is now directed through engaged blades "a" and "c" of the switch 670 and, by a wire 671 connected to blade "c" and wire 148, the current flows through wire 148 without involving the control for no space at end of justified line commutator 146. Thus, when the punches 161 (1-7) are not operable, the mechanism controlled by justified line commutator 146 will not be operated, as will be explained. There is no concern as to whether or not a space occurs at the end of a line, when the main punches 161 (1-7) are not operable and the line therefore will not be reproduced. Other switches 652 (FIGS. 47 and 48) not yet specifically mentioned, are included in the relay 603 (FIG. 47) of the punch control key arrangement 144 (FIG. 48), and they will be disclosed hereinafter in connection with the circuits that they control.

14. FORWARD MAIN-PUNCH TAPE FEEDING

The normal character key circuits and other circuits, to be explained, that pass through wire 163 (FIG. 11) will find ground in the delete key switch 164, the end of line tape feed control 166 or the forward tape cycle control 169, depending on the circumstances. However, the most normal ground circuit for the main punch mechanism 161 passes through the wire 162, the punch control key arrangement 144, wire 163, switch 164, wire 165, the end of line tape feed control 166, wire 167 and it goes to ground through the solenoid 168 for operation of forward tape cycle control 169 as previously mentioned. The forward tape cycle control 169 will now be described.

The forward tape cycle control 169 and a reverse tape cycle control, which will be described later in connection with deleting operations, are included in an assembly 672 (FIGS. 1, 49 and 50), and these controls are nearly identical so the description of one should serve largely to describe the other.

The framework of assembly 672 is comprised primarily of a vertical front plate 673 (FIGS. 49 and 50) and a parallel rear plate 674, and rods 675 (FIGS. 50 and 51), 676 and 677 (FIGS. 49 and 51) secured to the plates and extending therebetween. The plates 673 and 674 (FIGS. 49 and 50) are secured to the shelf member 9 in a known manner.

The solenoid 168 (FIG. 11) for operating the forward tape cycle control 169 is secured to the front plate 673 (FIG. 50) in a known manner. A link 678 (FIGS. 51 and 52) is pivotally connected to the armature of solenoid 168 and to a bellcrank 679, which is pivoted on the rod 675. A torsion spring 680 is connected to bellcrank 679 and it is anchored on a rod 681. The torsion spring 680 urges bellcrank 679 counterclockwise to normally rest against rod 681, which is secured to vertical front plate 673, and parallel rear plate 674 (FIG. 50). The upwardly extending arm of bellcrank 679 (FIG. 52) carries a rearwardly extending stud 682, which normally underlies a surface 683 on a pawl 684. The pawl 684 is pivoted on a lever 685, which is pivoted near its center on rod 676. A contractile return spring 686 is connected to pawl 684 and a rod 687, which is secured between plates 673, 674 (FIG. 50). The angulation of contractile return spring 686 (FIG. 52) is such that it not only urges pawl 684 clockwise against rearwardlly extending stud 682 but it also urges the lever 685 clockwise to normally rest against a rod 688 secured between plates 673, 674 (FIG. 50). The arrangement is such that, upon operation of solenoid 168 by the main punch ground circuit and wire 167 (FIG. 11) as described, the solenoid pulls link 678 (FIG. 52) downward and thus rotates the bellcrank 679 clockwise against tension of torsion spring 680. Near the end of this action, the rearwardly extending stud 682 moves rightward beyond the surface 683, and a latching surface 689 on pawl 684 is shifted down into engaging alignment with the stud 682 as the pawl 684 is shifted clockwise by torsion spring 686. Then, when the main punch circuit is broken and solenoid 168 is deenergized, the torsion spring 680 returns bellcrank 679 counterclockwise and the rearwardly extending stud 682, acting on surface 689, shifts the pawl 684 and lever 685 counterclockwise in respect to rod 676 against the relatively light tension of torsion spring 686. Upon counterclockwise shifting of lever 685, an insulator 690 on the lower end of the lever closes a switch 691. Switch 691 is secured on a bracket 692, which is secured to front plate 673 (FIG. 50). Thus, normally, following operation of a key 16 (FIG. 11) for example and thus following operation of the main punch mechanism 161 and of solenoid 168 as explained, the circuit through the punch solenoids 565 (1-7) and solenoid 168 is broken as the key 16 begins its return stroke. Then rapidly at the beginning of the key's 16 return stroke, while the operated punches 161 are also returning, the solenoid 168 is returned and switch 691 (FIG. 52) is automatically closed, as just explained.

Closure of switch 691 causes the punched tape 577 to be fed one step forwardly out of the main punches 161 as will now be explained. A wire 693 (FIG. 14) is connected to wire 137 and to two contacts (not numbered), one in row "N" and one in row "O" (FIGS. 14 and 54), both contacts being in selective engaging alignment with the left furcation of the switch blade 177. A wire 694 is connected with a contact (not numbered), in row "N", and engageable by the right hand furcation of blade 177 when the lever 170 is in the illustrated normal position. The wire 694 (FIG. 54) is also connected with one side of the switch 691 which is connected, by a wire 695, with a solenoid 696, which is provided for advancing the tape 577 as will be explained presently. Thus, upon closure of switch 691, current travels from source (S) and wires 137 and 693 through blade 177, wire 694, switch 691, wire 695 and it goes to ground through solenoid 696. Also, as will be explained presently, a normally open switch 697 is closed as solenoid 696 completes its operating stroke. Closure of normally open switch 697 permits current to travel from the wire 694, as described, through a solenoid 698, a wire 699 and to ground through the switch 697. Operation of solenoid 698 restores the forward tape cycle mechanism 169 to normal as will now be described.

The solenoid 698 is secured on front plate 673 (FIG. 50). A link 700 (FIG. 52) is pivotally connected to the armature of solenoid 698 and to a lever 701, which is pivotally supported near its center on rod 677. A torsion spring 702, connected to lever 701 and to a rod 703, urges the lever clockwise to normally rest against rod 703. Another rod 704 is provided to limit counterclockwise rotation of the lever 701. The rightward end of lever 701 underlies a stud 705 on pawl 684. The arrangement is such that, upon operation of solenoid 698, the solenoid pulls link 700 downward for rotating lever 701 counterclockwise against the tension of spring 702. When lever 701 is thus rotated, its rightward end engages the stud 705 and rotates the pawl 684 counterclockwise against the tension of spring 686 for elevating the surface 689 above stud 682 and thus permitting clockwise return of lever 685 under tension of spring 686. Return of lever 685 permits switch 691 to open and to break the circuit through solenoid 696 (FIG. 54), and thus the solenoid is permitted to be returned. When solenoid 696 is returned, as will be explained, the switch 697 will open for deenergizing solenoid 698. Whereupon, torsion spring 702 (FIG. 52) restores lever 701 to the position shown. At this point, a main punch forward tape cycle is complete.

The structure of the main punch forward stepping tape feed mechanism will now be explained. The solenoid 696 (FIG. 54) is secured on sub assembly frame plate 556 (FIG. 55). A link 706 is pivotally connected to the armature of solenoid 696 and to a bellcrank 707. Bellcrank 707 is supported on pivot 708, secured on frame plate 556. A torsion spring 709 is anchored in a known manner and it is connected to bellcrank 707 for urging the bellcrank clockwise normally against a return stud 710 secured on frame plate 556. A drive pawl 711 is pivoted at 712 on the upper end of bellcrank 707, and it is urged counterclockwise by a contractile spring 713 connected to the drive pawl 711 and anchored for convenience on link 706. A cam surface 714 on drive pawl 711 normally rests against a stud 715 for holding a hook end 716 on the pawl out of engagement with a ratchet 717, so the ratchet may be rotated by other means, to be described, without interference by the drive pawl 711. The stud 715, together with identical studs 718 and 719, are secured to parallel channel members 720 and 721. The studs extend rightward into holes therefore in plate 556 (FIG. 40) for additional rigid positioning of the studs 715, 718 and 719. The channel members 720 and 721 are spaced apart and away from plate 556 by suitable washers and spacers on screws 722 and 723 that extend through the ends of the channel members and that are secured in threaded holes therefor in plate 556. The drive pawl 711 (FIG. 55) is guided, between channel members 720 and 721, for generally rectilinear movement in alignment with the ratchet 717. The arrangement is such that, upon operation of solenoid 696, the solenoid and link 706 rotate bellcrank 707 counterclockwise against tension of return spring 709. Sequentially, during counterclockwise operation of the bellcrank 707, pawl 711 is shifted leftward and, aided by spring 713, the hook portion 716 engages a tooth on ratchet 717 as the cam surface 714 is moved away from stud 715, and the drive pawl 711 rotates the ratchet clockwise (as viewed here from the left) one tooth extent whereupon a hook-like stop surface 724 on the pawl engages the stud 715 for limiting the travel and preventing overrotation. One clockwise step of ratchet 717 causes one forward step of the control tape 577 (FIG. 38) as will be explained presently.

A stud 725 (FIG. 55) on the lower extremity of bellcrank 707 is assembled in an elongated hole 726 in a lever 727. Lever 727 is supported on a pivot 728, which is secured on plate 556. A lever 729 is also supported on pivot 728. A contractile spring 730 is hooked on studs 731 and 732 that are secured in the oppositely extending remote ends of the levers 727 and 729, respectively. An insulator 733 is assembled on stud 732 and it is held against lever 729 by a flange 734 on the stud. The switch 697 and a switch 735 are secured on plate 556 in alignment to be selectively engaged by insulator 733. In the illustrated normal position, the axis of contractile spring 730 is generally, above the center of pivot 728, where spring 730 urges lever 729 clockwise against a stud 736 secured on plate 556 and where the insulator 733 holds switch 735 closed and permits switch 697 to be open as shown. Upon operation of solenoid 696 and bellcrank 707 as explained, the stud 725 is swung counterclockwise for rotating lever 727 clockwise. At about the midpoint of the operation, the axis of contractile spring 730 passes below the center of pivot 728 and thereafter, upon the increasing leverage attitude of the spring, and contractile spring 730 snaps the lever 729 counterclockwise against a limit stud 737, which is secured on plate 556. In this position of the lever 729, the insulator 733 permits switch 735 to open and it closes switch 697 for signalling completion of the forward step of the operation.

Upon closure of switch 697 (FIG. 54), the solenoid 698 is operated for normalizing the forward tape cycle mechanism 169, and for opening switch 691 and deenergizing solenoid 696, as explained.

When solenoid 698 (FIG. 55) is deenergized, the return spring 709 returns the bellcrank 707 clockwise against stud 710, where cam portion 714 on pawl 711 holds the hook end portion 716 free of the ratchet 717 explained, where stud 725 returns the snap switch arrangement to the position shown and where the switch 735 is again closed and switch 697 is again opened for deenergizing solenoid 698 (FIG. 54). The just described mechanism is thus operated and returned to normal, for each forward step of the control tape 577.

The ratchet 717 (FIG. 55) is secured on the left end of a hub 738 (FIG. 36), which is pinned or otherwise secured on a shaft 739. A sprocket wheel 740 is secured on the other end of hub 738 so as to rotate with the hub, the ratchet 717 and the shaft 739. Shaft 739 is rotatably mounted in a hole therefor in the casting 573 (FIG. 38) and in a bushing 741 (FIG. 36) pressed into a hole therefor in plate 555. A ratchet 742, hub 743 and a sprocket 744 are secured together to form a unit that is identical with ratchet 717, hub 738 and sprocket 740, but the unit ratchet 742, hub 743 and sprocket 744 is assembled on shaft 739 in a reverse direction on the opposite side of casting 573. The hub 743 is also pinned or otherwise secured on the shaft 739 for rotation therewith. The sprockets 740 and 744 have only a running clearance between opposing machined left and right side surfaces of casting 573, and they therefore maintain the proper axial position of the shaft 739. The sprockets 740 and 744 each have pin type teeth 745 (FIG. 40) extending radially from their periphery, and the number and angulation of the teeth preferrably correspond to that of the teeth on ratchet 717 (FIG. 55). The teeth on the sprockets 740 and 744 are provided for fitting into holes 746 (FIG. 56) therefore in the edges of the control tape 577, and they thus feed the control tape 577 from one station to the next or they hold the control tape 577 at positive stations in the punch mechanism 161.

Rotation of the sprockets 740 and 744 (FIG. 36), the ratchets 717 and 742 and the shaft 739 is yieldably held in positions corresponding to step-by-step stations of the control tape 577 (FIG. 38) by a yieldable detent means 747 (FIG. 41), which cooperates with the sprocket 744. The yieldable detent means 747 is comprised primarily of a ball 748, a spring retaining cup 749, and expansive spring 750 and a spring retaining screw 751. The ball 748 and cup 749 are assembled in a hole therefor in the punch assembly's hinged cover 579, the hole being generally radial in respect to sprocket 744. Expansive spring 750 is constantly pressed between the spring retaining cup 749 and screw 751, which is screwed into an upper threaded portion of the hole. Of course, the spring retaining cup 749 is therefore pressed down against the ball 748. The hole for the detent means 747 is not drilled all the way through to the bottom of hinged cover 579, so the bottom of the hole prevents the ball 748 from dropping out of hinged cover 579, when the hinged cover 579 is opened up as explained. However, a milled arcuate slot 752 in the bottom of the hinged cover 579 permits the cover to be closed in the position shown while it also permits the sprocket 744 to be rotated and its teeth 745 to coact with the ball 748. An arcuate slot, like slot 752, is also provided for clearance of the teeth 745 on the sprocket 740 (FIG. 40). When the shaft 739 and the parts thereon are rotated, one of the teeth 745 (FIG. 41) on sprocket 744 presses the ball 748 upward in the hole against tension of the expansive spring 750 until the sprocket 744 has moved half step and then the ball 748 is pressed down by the spring between the next pair of teeth 745, and this occurs for each step of the sprocket 744. In this manner, the shaft 739 is yieldably held in angular positions of rotation corresponding to steps of control tape 577.

When the control tape 577 (FIG. 38) is fed forwardly (rightwardly as shown), by the main punch tape feed mechanism 161, the control tape 577 slides under the hinged cover 579 and above the surface 578, as explained, and the control tape 577 for the text of the line is accumulated in a loop 753. When the line is complete, the justifying information is punched in the control tape 577 ahead of the line accummulated in loop 753, so the justifying information will be read first when the text for the line is read as the line is typed by the reproducing machine as will be explained more fully hereinafter.

When the control tape 577 is fed forwardly throughout the main punches 567 and under the hinged cover 579 described, it is drawn down over the machine's general cover 245 (FIG. 56) from a customary tape supply spool 754, and it flows generally leftwardly as shown here from the right side of the machine. The tape supply spool 754 is rotatably mounted on a spindle 755 which is secured on the machine cover 245 in any known manner. The control tape 577 is fed forwardly past a roller assembly 756 that is secured on the right side of the machine cover 245. The control tape 577 is held against the roller of the assembly 756 by a guide member 757 secured on the machine cover 245. Another roller assembly 758 and a guide member 759, like assembly 756 and member 757 respectively, are secured on top of the cover 245 for directing the control tape 577 in proper alignment for being drawn under the punch cover 579.

15. SPACE KEYS AND THEIR CIRCUITS

A word space bar 760 (FIG. 3), and two, three and four unit nut space keys 761, 762 and 763, respectively, are provided in a convenient arrangement across the front of the keyboard as shown. The space bar 760 is used for normal word spacing, and the nut space keys 761, 762 and 763 are used in instances where the designated space is desired and where it is desired that this space remain unaffected by justifying in the reproducing machine.

The space key shanks 764 (FIGS. 576 and 58), 765 and 766 for the nut space keys 761, 762, and 763, respectively, are identical, and they are identical to the two shanks 767 and 768 for the elongated space bar 760. The shanks 764–768 are guided vertically in slots 769–773 (FIG. 2), respectively, in the upper horizontal flange of the channel member 624 (FIG. 58).

The lower end of the shank 764 (FIG. 57), of the two unit key 761, is pivotally connected to the rearward end of a lever 774. A pivot stud 775 is secured on the lever 774, and it extends rightwardly where it is supported in a bearing 776. Bearing 776 is secured on an upturned tab of a bracket 777, which is secured on the lower flange of channel member 624. A torsion spring 778, anchored in a known manner, is connected to lever 774 for raising the rearward end of the lever 774 and therefore the two unit key 761 to the illustrated normal position. A conductor 779 and an insulation spacer 780 are secured on the left side of lever 774 so as to space and insulate the conductor 779 from the lever 774. The spacing of the conductor from the lever is such that the conductor is situated in alignment to squeeze between a pair of electrical contacts 781 and 782, which yield slightly to receive the conductor 779. Contacts 781 and 782 will be discussed further hereinafter.

The structure of keys 762 and 763 are the same as that of the two unit key 761, the parts being identified as follows. Shank 765 for the three unit key 762 is pivotally connected to a lever 783, stud 784 on lever 783 is pivoted in bearing 785, the bearing is secured on a tab of the bracket 777, a conductor 786 and a spacer 787 are secured to lever 783 so that the conductor may be squeezed between contacts 788 and 789, and a torsion spring 790 is provided for urging the arrangement to normal position as shown. The shank 766 (FIGS. 57 and 58) for four unit key 763 is pivotally connected to lever 791, stud 792 on the lever is pivoted in bearing 793, the bearing is secured on a bracket 794 which is secured on the lower flange of channel member 624, a conductor 795 and a spacer 796 (FIG. 57) secured to lever 791 so that the conductor 795 may be squeezed between contacts 797 and 798 (FIG. 58), and a torsion spring 799 is provided for urging the arrangement to normal position as shown.

The arrangement for the space bar 760 (FIG. 57), is substantially the same as those for keys 761–763, except that a torsion bar 800 is included for keeping the elongated space bar 760 parallel to the base 1. The shank 767 is pivotally connected to a lever 801 which is secured on the left end of the torsion bar 800. A torsion spring 802 is connected to lever 801 for urging the arrangement to normal position as shown. A conductor 803 and insulating spacer 804 is secured to the side of lever 801, so that the conductor 803 may be squeezed between contacts 805 and 806 upon operation of the space bar 760. The left and right ends of torsion bar 800 are respectively mounted on bearings 807 and 808, which are secured on respective upturned tabs on a bracket 809. The bracket 809 is secured on the lower flange of channel member 624. Shank 768 is pivotally connected on the rearward end of an idler arm 810, the forward end of which is secured on the right end of the torsion bar 800. From the above, it can be seen that the torsion spring 802, acting through lever 801, torsion bar 800 and idler arm 810, normally holds the conductor 803 and the space bar 760 in ineffective elevated position, and, upon downward pressure anywhere along the length of the space bar, the torsion spring 802 will yield to the pressure for lowering the conductor 803 into engagement with the contacts 805 and 806. Also, the torsion spring 802 restores the conductor 803 and space bar 760 to ineffective position, when the bar is released.

The pairs of contacts 781, 782, 788, 789, and 805, 806 are all like the pair of contacts 797, 798 (FIGS. 4 and 58), and each pair of contacts are secured on respective left and right sides of one of the insulators 122 that is appropriately aligned with the respective conductors 779 (FIG. 57), 786, 803 and 795. With the above description in mind, it can be seen that, upon operation of a space key 760–763, its conductor is swung clockwise (FIGS. 4 and 58) to engage its contacts and thus to conduct current therebetween, and, upon release, of the space key 760–763, the conductor is again swung counterclockwise to ineffective position as the key 760–763 is also restored.

One contact from each pair, namely contacts 781 (FIG. 57), 788, 797 and 805 for example, are connected to a source (S) of power, and the other contact from each pair, namely contacts 782, 789, 798 and 806 for example, are respectively connected by wires 811 (FIG. 59), 812, 813 and 814 to magnets to relays 815, 816, 817 and 818, which correspond to the nut space keys 761, 762 and 763 and the space bar 760 respectively. The magnets of the relays 815–818 are grounded as indicated in any convenient manner.

The relays 815–818 are each of a customary type having a plurality of contacts, to which wires are connected and which contacts are conductively interconnected for transmitting current thereamong, when the relay is operated by energization of its magnet. These relays 815–818 (FIG. 60) are arranged in a group, and they are secured for convenience on the plate 557. The relays 815–818 may be additionally protected by a cover 819, which may be secured on plate 557 (FIG. 45) as shown.

Upon depression of two unit nut space key 761 (FIG. 59), its conductor 779 completes a circuit from a source (S) and directs the current through wire 811 for operating relay 815. The relay 815 completes a circuit through the "Group F" wire and a wire 820, leading to the relay 815. As previously explained, current traveling through the "Group F" wire causes the carriage moving mechanism 149 (FIG. 11) to move the carriage two units, which is appropriate for two unit nut space key 761 (FIG 59).

The code, which must be punched for representing the two unit nut space, is 3, 4, 6. It should be noted that each of the codes for the space keys 760–763 includes a 4 channel code bit, and the circuit for this code bit in each case is employed when required for preventing the occurence of a space at the end of a justified line, which occurance would otherwise destroy the justifying effect. However, operation of the two unit relay 815, as explained, directs the current from the "Group F" wire and wire 820 through wires 821, 822 and 823, which are connected to contacts in the two unit relay 815. Wire 821 is also connected to the 3 code channel punch wire, thus the main punch mechanism 161 is normally caused to punch the 3 channel code bit as explained. Wire 822 is also connected to the 6 code channel punch wire and the current therethrough causes the main punch mechanism 161 to punch the 6 channel code bit as explained. The wire 823 (for the 4 channel code bit) is connected between a contact in relay 815 and a communtator portion 824, which is actually incorporated with the communtator means 146 (FIG. 11) in mechanism for measuring an amount left in a justifiable line and which will be explained later. For the moment, it is sufficient to state that normally the commutator portion 824 (FIG. 59) directs the current from wire 823 through a wire 825, which leads to the 4 code channel punch wire for causing the main punch mechanism 161 to punch the 4 channel code bit as explained. Thus, it is seen that, normally when the two unit space key 761 is depressed and the relay 815 is operated as explained, the carriage 80 is caused to move two units (0.050) and the resulting circuit through "Group F" wire and wire 820 is directed by the relay 815, through the wires 821 and 822 for punching the 3 and 6 code bits, and through wires 823 and 825 for punching the 4 code bit. Summarizing further, it may be said that depression of two unit space key 761 normally causes the carriage to be moved two units, and it causes its code 3, 4, 6 to be punched by the main punch mechanism 161, as described.

Similarly, when the three unit space key 762 is operated, the relay 816 is automatically operated, as explained for causing a three unit (0.075") carriage movement and for punching the three unit space code 1, 4, 5, 7. A wire 826 is connected to the carriage movement "Group G" wire and to one of the contacts in relay 816. Wires 827, 828 and 829 are connected to separate contacts in the relay 816 and to the 7, 5 and 1 code channel punch wires, respectively. A wire 830 is connected to one of the contacts in relay 816 and to the commutator portion 824, which normally as will be explained, later, directs the current therefrom through a wire 831 connected to wire 825 and thus connected to the 4 code channel punch wire. From the above, upon operation of relay 816, as explained, the carriage is moved three units by the circuit through "Group G" wire, the wire 826 and the relay 816, and the main punch mechanism 161 is operated to punch the code bits 1, 5, 7 by the circuits running through wires 829 and 828 and 827, respectively, while the 4 channel code bit is punched by the main punch mechanism 161 and the circuit normally running through wire 830, the commutator portion 824, wire 831, wire 825 and the 4 code channel punch wire. Thus, the carriage 80 is moved appropriately and the code 1, 4, 5 7 is punched each time the three unit space key 762 and its relay 816 is operated.

When the four unit space key 763 is operated, the relay 817 is automatically operated, as explained, for causing a four unit (0.100") carriage movement and for punching the four unit space code 2, 4, 7. To this end, a wire 832 is connected to the carriage movement "Group A" wire and to a contact in the relay 817. Wires 833 and 834 are connected to separate contacts in the relay 817, and to the 7 and 2 code channel punch wires respectively. A Wire 835 is connected to one of the contacts in relay 817 and to the commutator portion 824, which normally as will be explained later, directs the current therefrom through a wire 836. The circuit that travels through wire 836 continues through the wires 831, 825 and the 4 code channel punch wire. From the above, it can be seen that upon operation of relay 817 as explained, the carriage 80 is moved four units by the circuit through "Groug A" wire, the wire 832 and the operated relay 817, and the main punch mechanism 161 is operated to punch the code bits 2, 7 by the circuits running through wires 834 and 833, respectively, while the 4 channel code bit is punched by the main punch mechanism 161 and the circuit normally running through wire 835, commutator portion 824, wire 836, wire 831, wire 825 and the 4 code channel punch wire. Thus, the carriage is moved appropriately and the code 2, 4, 7 is punched each time the four unit space key 763 and its relay 817 are operated.

When the space bar 760 is operated, the relay 818 is automatically operated, as explained, for causing a two unit (0.050") carriage movement, for punching the word space code 3, 4, and for normally counting the occurence of the work space for justifying purposes. For convenience, a wire 837 is here shown connected between a contact in relay 818 and the wire 820, which is connected to the "Group F" wire as explained. A Wire 838 (FIGS. 59 and 62) is connected to a contact in relay 818 and to the wire 821, which leads to the 3 code channel punch wire as explained. A wire 839 is connected to a contact in the relay 818 and, as here shown for convenience, to the wire 823, and this part of the circuit normally runs through wires 839 and 823, the commutator portion 824, wires 825 and the 4 code channel punch wire. Thus, the carriage 80 is moved appropriately two units and the word space code 3, 4 is punched each time the space bar 760 and its relay 818 are operated.

At this same time, a space counting circuit is normally made effective by the relay 818 for counting the word space. Thus, for justifying purposes, a wire 840 is connected to a contact in the relay 818 and to a contact in the justifying key commutator mechanism 142 (FIG. 62), and the circuit thus originated is normally used for word space counting, as will now be explained.

The justifying key 244 determines whether or not the space counting circuit will be effective. When the justifying key 244 (FIG. 17) is in the normal illustrated "On" position, the machine is conditioned for counting the occurence of word spaces. To this end, the wire 840 (FIG. 62) leading from a contact in the word space relay 818, as described, is connected to a contact 841 (FIG. 17) on the insulator 271. A switch blade 842, which under the justifying "on" condition is in conductive engagement with contact 841, is riveted to insulator 279. A blade 843, also riveted to insulator 279, is connected to the blade 842 by a conductor strip 844 and conductor rivets 845 through the strip, the insulator and the blades. In justifying "on" condition, the blade 843 is in engagement with a contact 846 on insulator 271. Contact 846 is connected by a wire 847 (FIG. 62) to a blade 848 of a single pole, double throw, selector switch 849 in a word space counter 850.

At this point, it should be explained that the word space counter 850, in the particular embodiment, is constructed to count up to sixteen word spaces for justifying purposes, and it is constructed to count beyond sixteen word spaces in order to keep track of the actual number of such word spaces, which may occur in a long line, in the event there is involvement with automatic back spacing and deleting, which may again reduce the number of word spaces to a number less than sixteen, as will be explained more fully hereinafter. It should also be pointed out that a machine may be constructed to count more or less word spaces for justifying purposes, without departing from the spirit of the invention.

The structural details of the word space counter 850 will be described later. However, the forward counting circuitry, initiated by the space bar 760 as described and running through the word space counter, will be continued now.

When there are fifteen or less word spaces in a line, the blade 848 is engaged with a blade 851. However, simultaneously with the actual counting of a sixteenth word space the blade 848 is shifted out of engagement with blade 851 and into engagement with a blade 852, by mechanism in the word space counter 850 to be described later.

A wire 853 is connected to the normally effective blade 851 and to a solenoid 854, which is provided for counting the first sixteen word spaces as will be described. A wire 855 is connected to the blade 852 and to a solenoid 856, provided for counting the seventeenth to the greatest possible number of word spaces that could occur in a line, which number is 160 in this embodiment. A wire 857 is connected to the solenoids 854 and 856, and to a blade b of a switch 858, which is one of the switches 652 (FIG. 48) in the punch control relay 603 (FIG. 45) previously described. The blade a (FIG. 62) of switch 858 is grounded in a usual manner. In the normal punch "on" condition. the blade a of switch 858 is engaged with the blade b but, in the punch "off" condition, the blade a is disengaged from the blade b as shown in FIG. 48 and as explained in connection with the other switches 652.

Under certain conditions, when the justifying key 244 (FIG. 17) is in "on" position, when the punch control key arrangement 144 (FIG. 48) is in "on" condition, and when the space bar 760 (FIG. 62) and its relay 818 are operated as descrbed, the space counting circuit is effective and it runs from the relay 818, through wire 840, the effective justifying key commutator 142 and through the wire 847 leading to the word space counter 850. When the previously counted number of word spaces is less than sixteen, the circuit travels through the switch 849 and wire 853 for operating the solenoid 854 to count the word space, and it goes to ground through wire 857 and the switch 858. When the previously counted number of word spaces is more than fifteen, the space counting circuit travels through the switch 849 and wire 855 for operating the solenoid 856 to count the word space, and it goes to ground through wire 857 and the punch control switch 858. Thus, it can be seen that, under normal circumstances, the occurrence of a word space is counted under control of the just described circuit. However, if the justifying key 244 (FIG. 17) is shifted to "off" position and its switch means, including insulator 279, is shifted as explained, the space counting circuit is rendered ineffective, since the blades 842 and 843 are then disengaged from the contacts 841 and 846. It may be recalled that shifting of the justifying key 244 is prevented by lock 255 once a line is partly composed, as described. Therefore, as long as the punches 161 are rendered effective, either all word spaces in a line will be counted, or they will not be counted, depending upon the preset position of the justifying key 244 at the beginning of a line.

Furthermore however, the space counting circuit may be rendered ineffective at any time, when the punch key 602 (FIG. 48) is shifted to "off" position and the switch 858 is open as described.

16. WORD-SPACE COUNTER STRUCTURE

The word-space counter 850 (FIGS. 2 and 18) is located for convenience between the plates 237 and 238, at the right of the standard typewritter assembly 15. The forward counting selector switch 849 (FIG. 62) is secured on a bracket 859 (FIG. 63) which is secured on a stationary plate 860. The forward end of stationary plate 860 (FIG. 2) is secured to the plate 237, in a known manner, and the rearward end of plate 860 is likewise secured to plate 238 (FIG. 61). The forward counting solenoids 854 and 856 (FIG. 62) are secured on a bottom plate 861 (FIG. 18), which is secured to the plates 237 and 238. For further rigidity, the plate 861 is also secured to the plates 229 and 860, as shown in FIGS. 61, 63 and 65.

The solenoid 854 (FIG. 65), which is operable for counting the first sixteen word-spaces as previously mentioned, and its ratchet accummulating means will now be described. A link 862 is pivotally connected to the armature of solenoid 854 and to a leftwardly extending lever 863. This lever 863 is secured on a sleeve 864 (FIG. 18), which is pivoted on the rod 239. A lever member 865 is secured on the foremost end of the sleeve 864. Thus, lever 863, sleeve 864 and member 865 may be pivoted only as a unit on the rod 239. A contractile spring 866 (FIG. 65) is anchored in a convenient manner and it is connected to a lower part of lever member 865 for urging the member clockwise to normally rest against a stop rod 867. Stop rod 867 (FIG. 18) is secured in a convenient manner on plates 237 and 238. A pawl 868 (FIG. 65) is pivoted, at 869, on the upper end of lever member 865, and it is urged clockwise by a contractile spring 870 connected to the pawl and the member. In normal position of the parts, pawl 868 is held to counterclockwise position, against the light tension of contractile spring 870, by a finger 871 on the pawl coacting with a stationary rod 872. The stationary rod 872 is supported by a bracket 873, which is secured on a plate 874 (FIG. 61), and by the plate 238. Plate 874 is secured to plate 238, as shown, and to the plate 237 (FIG. 2), in a similar manner.

A ratchet wheel 875 (FIG. 65) is secured on the rearward end of a sleeve 876, which is rotatably mounted on the shaft 239. A brush carrier member 877 (FIG. 63) is secured on the forward end of sleeve 876 (FIG. 65), so as to rotatable in unison with the sleeve 876 and the ratchet wheel 875. A torsion spring 878 (FIG. 63) is connected to brush carrier member 877 so as to urge the member counterclockwise to the illustrated normal zero representing position. Torsion spring 878 extends forwardly, about shaft 239, through a clearance hole 879 (FIG. 64) in a commutator contact insulator 880, and it is anchored in a known manner to plate 237 (FIG. 18). In the illustrated zero representing position of brush carrier member 877 (FIG. 63), the lower end of the member is stopped against a stud 881, secured on an upper arm of a bellcrank 882. Bellcrank 882 is pivoted on a rod 883, which is secured on a plate 237 (FIG. 18) and on plate 238. A spring 884 (FIG. 63) is anchored on plate 861 and it is connected to the bellcrank 882 for urging the bellcrank clockwise against the stop rod 867. A pair of insulated studs 885 and 886, secured on the rightwardly extending arm of bellcrank 882, embrace the center blade 848 of the switch 849 so as to control the throw of the switch. Normally as shown, the blade 848 is held in engagement with blade 851, for operation of the solenoid 854 (FIG. 62) to count the occurrence of word spaces, as explained.

Normally, a detent 887 (FIG. 65) is engaged with the ratchet wheel 875 for a times holding a previous count position of the ratchet wheel. Detent 887 is pivoted on a rod 888, the ends of which are secured to plates 237 and 238 (FIG. 18). A relatively weak torsion spring 889 (FIG. 65) is connected to the detent 887 for urging the detent clockwise against the ratchet wheel 875 and for thus holding the ratchet wheel against counterclockwise reverse rotation. However, upon clockwise forward step-by-step operation of the ratchet wheel 875, as will be explained, the detent 887 is cammed counterclockwise against the tension of spring 889 by each passing tooth and the spring returns the detent therebehind as shown.

The torsion spring 889 is also connected to a half-step escapement pawl 890, which is pivoted on rod 888, for urging the pawl counterclockwise into engagement with the ratchet wheel 875. However, the escapement pawl 890 is normally held in a clockwise position, out of engagement with the teeth on the ratchet wheel, as will be explained in connection with reverse, or subtractive, counting of word spaces which may occur during deleting.

Normally, upon each operation of the space bar 760 (FIG. 62), the solenoid 854 is operated, as explained, for counting occurrence of the word space. When solenoid 854 (FIG. 65) is operated, its armature pulls link 862 downward, rotating members 863, 865 counterclockwise. Whereupon the finger 871 is moved away from rod 872 and spring 870 rotates pawl 868 to ratchet over a tooth on ratchet wheel 875. At this point, the motivating means for counting a word space (1–16) is cocked for counting. Thus, when the space bar 760 (FIG. 62) is released, and when the relay 818 and solenoid 854 are deenergized, the spring 866 (FIG. 65) rotates the lever member 865, pawl 868, the engaged ratchet wheel 875, sleeve 876 and member 877 (FIG. 63) one step clockwise against tension of the return spring 878 for counting the word space. Near the end of this clockwise action, the detent 887 (FIG. 65) again falls into the illustrated holding position and the finger 871 coacts with the rod 872 for rotating pawl 868 clear of the teeth on ratchet wheel 875, as lever member 865 comes to rest against rod 867. This action may occur as many as sixteen times for counting as many word spaces that may occur in a given time.

At the end of a fifteenth operation for any given line, a surface 891 (FIG. 63) on member 877 is brought clockwise up to the stud 881, but the bellcrank 882 is not moved and the switch 849 is not shifted. Therefore, counting of a sixteenth word space may occur as described. However, when the solenoid 854 (FIG. 65) is deenergized for a sixteenth time, the cocked mechanism operates and the surface 891 (FIG. 63) shifts the stud 881 and bellcrank 882 counterclockwise, against tension of spring 884, for shifting the switch 849 at the same time that the brush carrier member 877 is shifted into the sixteenth word space representing position. When the switch 849 is thus shifted, as long as the line progresses forward, the solenoid 854 (FIG. 62) is shifted, the solenoid 856 is operated to count additional word spaces that may occur in excess of sixteen, as explained. The mechanism operated by solenoid 856 (FIG. 61) will now be described.

A link 892 is pivotally connected to the armature of solenoid 856 and to a member 893, which is pivoted on rod 239. Member 893 supports a drive pawl 894, which is urged clockwise, toward effective position by spring 895. A torsion spring 896 is connected to member 893, and it is anchored on plate 238 in a known manner, so as to urge member 893 clockwise to rest againt rod 867. In rest position of member 893, a finger 897 on pawl 894 rests against rod 872 for normally holding the pawl out of engagement with a ratchet wheel 898. Normally a detent 899 is engaged with the ratchet wheel 898 for holding the ratchet wheel in a possible previous count position. Detent 899 is pivoted on rod 888, and a light tension torsion spring 900 is connected to the detent for urging the detent 899 clockwise against the ratchet wheel 898 and for thus holding the ratchet wheel 898 against counterclockwise reverse rotation. The spring 900 is also connected with a half step escapement pawl 901. The operation of the escapement pawl 901 will be explained later in connection with reverse, or subtractive, counting of word spaces in excess of sixteen.

The mechanism operated by solenoid 856, in FIG. 61, thus far described for counting word spaces in excess of sixteen is similar to that described for counting the first sixteen word spaces and shown in FIG. 65. Since the two mechanisms function in the same manner, in view of the first described mechanism, it should be sufficient to say now that energization and deenergization of solenoid 856 (FIG. 61) causes the ratchet wheel 898 to be advanced clockwise one tooth, where it is held by detent 899. However, the accummulating arrangement in FIG. 61 has a larger capacity and it is different structurally from that previously described. The accummulating means for the 17–160 word counting mechanism will be described now.

The ratchet wheel 898 is secured on a sleeve 902 (FIG. 18) which is rotatably mounted on rod 239. A support member 903 is secured on the approximate longitudinal center of the sleeve 902 and a gear 904 is secured on the forward end of the sleeve 902. Thus the parts 898, 902, 903 and 904 may only be rotated as a unit, on the rod 239. The gear 904 is meshed with a gear 905, which is rotatable on a rod 906. The rod 906 is secured at its rear to plate 238, while the rod's front end is secured to a bracket 907 which in turn is secured to the plate 860 (FIG. 61). A torsion spring 908 is connected to the bracket 907 and to the gear 905 for urging the gear clockwise, and, by virtue of the engaged gears, the unit comprising gear 904, member 903 and ratchet wheel 898 is urged counterclockwise.

A stud 909 is secured on gear 905 and it extends rearward to at times engage a stop member 910, which is secured on the support member 903. The stud 909 (FIG. 18) extends rearward into the plane of stop member 910 as shown, but it does not extend sufficiently to interfere with the support member 903. In normal restored position of the parts as shown in FIG. 61, the stud 909 is urged clockwise about rod 906, as explained, and it radially blocks the counterclockwise return rotation of stop member 910 and the support member 903 on rod 239. Thus, it may be seen that the stud 909 and stop member 910 approach each other in generally perpendicular arcuate paths until they stop each other and the connected parts at zero position upon restoration of the accummulating means for the 17–160 word counting mechanism. Similarly, when forward counting begins, the stud 909 and stop member 910 move generally perpendicularly away from this point of intersection.

For illustrative purposes, in the exemplary embodiment, the greatest column width is eight inches and the word space counter 850 is constructed to count 160 word spaces, which is the total possible number of 0.050" word spaces that could be encoded in one line. Since the illustrated machine is capable of encoding a blank line space by a single depression of the line space key 20 (FIG. 3) as will be explained more fully, it would be ridiculous for an operator to encode a full line of word spaces in order to produce a blank line. However, the word space counter 850 is arbitrarily designed to accommodate a full line of word spaces, since it would be difficult to determine what lesser amount might be desirable for a particular purpose, and since it is conceivable that a machine might be produced without a line space key. It should be noted that the capacity of the word space counter 850 could be increased or decreased without departing from the spirit of the invention. Likewise, the number of word spaces counted for justifying purposes could be more or less than sixteen, without departing from the spirit of the invention.

In the illustrated preferred form, the incremental spacing of the teeth on ratchet wheel 898 (FIG. 61) and the ratio of gears 904 and 905 is such that for the total possible word space counting operations from 17 to 160, inclusive, (actually 144 total possible increments) the ratchet wheel 898 is rotated substantially $4\frac{1}{4}$ revolutions while gear 905 is rotated approximately 19/20 of a revolution. The ratio is such that, toward the end of the revolution of gear 905, the stud 909 passes a second point of intersection of its arcuate path and the arcuate path of stop member 910 before the stop member 910 passes through that point, therefore interference of stud 909 and member 910 will not occur in foward counting operations and it will occur in back spacing or in clearing the accummulating mechanism only when the mechanism is restored to the illustrated neutral position.

A switch 911 (FIGS. 61 and 62) is provided for controlling reverse word space counting, which occurs during deleting, or back spacing, operations as will be explained. The details of wiring will be described later; however, the structural details and the mechanism for controlling the switch will be explained now.

The switch 911 is comprised of a central blade 912, a normally effective blade 913 and a normally ineffective blade 914, and the switch is mounted on a bracket 915 (FIG. 61), which is secured on the plate 860. A pair of levers 916 and 917 are secured together to form a bellcrank unit 918, which is pivoted on rod 883. A pair of insulated studs 919 and 920 are secured on lever 916, and they are spaced only sufficiently to embrace the otherwise free end of central blade 912. The studs 919,920 are provided for controlling the central blade 912, while insulating the blade from the controlling lever 916. A spring 921 is connected to lever 916 and the plate 861 for urging the bellcrank unit 918 clockwise and for at times shifting the switch 911. However, normally, the bellcrank unit 918 is held in the illustrated counterclockwise position by a stud 922. Stud 922 is secured on one end of a lever 923, which is pivoted near its center on a stud 924. Stud 924 is secured on gear 905. A torsion spring 925 is anchored on gear 905 and it is connected to lever 923 for urging the lever counterclockwise. A rearwardly extending stud 926 is secured on the upper end of lever 923, which is mounted on the forward side of gear 905 as shown. In the illustrated normal cleared position of the parts, a finger 927 on stop member 910 is pressed against stud 926 for holding the lever 923 in its clockwise position where the stud 922 holds the bellcrank unit 918 counterclockwise for holding the central blade 912 in engagement with normally effective blade 913, as shown. The arrangement is provided for utilizing the relatively large incremental movement of ratchet wheel 898, corresponding to the distance between the teeth on the ratchet wheel, to supplement the very small incremental movement of gear 905, in order to differentiate positively between the cleared position and a single counterclockwise incremental step of gear 905 to the seventeen word space representing position of the gear.

The just described arrangement is such that, upon operation of ratchet wheel 898 one step clockwise, the finger 927 is withdrawn rapidly clockwise away from stud 926 while the torsion spring 925 rotates the lever 923 counterclockwise. Lever 923 is thus rotated until the stud 926 comes to rest on a surface 928 on gear 905, at which point the stud 922 is swung away from lever 917 and the spring 921 rotates the unit 918 to disengage blade 912 from engagement with normally effective blade 913 and into engagement with normally ineffective blade 914. In clockwise position of bellcrank unit 918, its lever 917 rests against rod 867, and switch 911 is shifted to indicate that more than sixteen word spaces are counted. The arcuate path of stud 926 is such that it rests on surface 928 in the arcuate path of finger 927, even when the stud 924 and the gear 905 are shifted counterclockwise one step to the seventeen word space representing position. Thus, when the ratchet wheel 898 is released for restoration, as will be explained, the ratchet wheel 898, member 903 and gear 904 are returned counterclockwise as the spring 908 restores gear 905, and the finger 927 coacts with the stud 926 and restores the lever 923, unit 918 and switch 911 to the position shown.

Summarizing for a moment, the switch 911 is normally shifted as shown and the blades 912 and 913 are normally effectively engaged as shown, and this is the condition whenever the number of word spaces counted are sixteen or less. Further, when the number of word spaces counted are seventeen or more, the gear 905 is shifted one or more increments respectively counterclockwise and the switch 911 is shifted so that the normally effective blade 913 is ineffective and blades 912 and 914 are effectively engaged as explained.

The normally effective blade 913 (FIG. 62) of switch 911 is connected by a wire 929 to a reversing solenoid 930, which is provided for incrementally reversing the mechanism shown in FIGS. 65 and 63 whenever the word space counter 850 stands at sixteen or less and a word space is deleted during the back spacing operations as will be explained. The solenoid 930 (FIG. 65) is secured on plate 229, and its armature is connected by a link 931 to an escapement control lever 932, which is pivoted near its center on rod 888. A pair of rearwardly extending studs 933 and 934 are secured on lever 932 at spaced points near the right end of the lever. Stud 933 is situated under the pawl 887 and stud 934 is spaced therefrom and against half step pawl 890 for normally holding pawl 890 out of engagement with the teeth on ratchet wheel 875. A torsion spring 935 is connected to lever 932 and it is anchored on a rod 936 for urging the lever clockwise to normally rest against the rod. Rod 936 is secured at its ends to plates 237 and 238 (FIG. 18). From the above, it can be seen that operation of solenoid 930 (FIG. 65) pulls link 931, rotates lever 932 and its studs 933 and 934, and the studs respectively rotate the pawl 887 out of engagement with a tooth on ratchet wheel 875 and permits the spring 889 to rotate half step pawl 890 into engagement with ratchet wheel 875 between teeth thereon. It should be noted that pawl 890 will engage the ratchet wheel 875 before the pawl 887 is fully disengaged from the ratchet wheel. Consequently, when pawl 887 is pivoted clear of the ratchet wheel 875, the spring 878 (FIG. 63) rotates the lever 877 and the ratchet wheel 875 (FIG. 65) reversely (Counterclockwise) until the ratchet wheel is stopped at a mid-step position by half step pawl 890. Upon deenergization of solenoid 930, the spring 935 restores the lever 932, whereupon the stud 933 permits spring 889 to restore pawl 887 between teeth on the ratchet wheel 875 and stud 934 removes pawl 890 from the ratchet wheel. When pawl 890 releases the ratchet wheel 875, the ratchet wheel is free to move from the just mentioned mid-step position to the next counterclockwise full step position. In this manner the lever 877 (FIG. 63) and the ratchet wheel 875 (FIG. 65) are rotated a full step counterclockwise , for deducting one word space from those counted, each time the solenoid 930 and its escapement means are reciprocated.

When the word space counter 850 has accumulated seventeen or more word spaces, the switch 911 (FIG. 61) has been shifted for rendering normally effective blade 913 ineffective and for making blades 912, 914 effective, as explained. The normally ineffective blade 914 is connected by a wire 937 (FIG. 62) to a second reversing solenoid 938, which is provided for incrementally reversing the 17–160 word space counting mechanism in FIG. 61, as may be required during deleting operations. The reversing solenoid 938 (FIGS. 18 and 61) is secured on plate 229 in any known manner, and a link 939 (FIG. 61) is pivotally connected to the armature of the solenoid 938 and to a second escapement control lever 940, which is pivoted on the rod 888. A torsion spring 941 is connected to the escapement control lever 940 and to rod 936 for normally holding the lever 940 against the rod 888 as shown. In normal position of lever 940, a stud 942 on the lever permits full engagement of the pawl 899 with the ratchet wheel 898 and a stud 943 on the lever holds the half-step pawl 901 out of engagement with the ratchet wheel. When seventeen or more word spaces have been counted during forward operations of the machine and then a word space is deleted during back spacing operations, an electrical impulse of suitable duration, as well be explained will be directed through the switch blades 912, and 914, wire 937 (FIG. 62) and the reversing solenoid 938 for operating the solenoid. When solenoid 938 (FIG. 61) is energized, the armature pulls link 939 downward, rotates escapement control lever 940 counterclockwise, and the stud 942 lifts pawl 899 out of engagement with ratchet wheel 898 while the stud 943 permits spring 900 to engage the half-step pawl 901 with the ratchet wheel 898. As pawl 899 moves clear of the involved tooth on ratchet wheel 898, the spring 908 rotates gear 905 clockwise, and this rotates gear 904 and the connected stop member 903 and ratchet wheel 898 a portion of a step counterclockwise as controlled by half-step pawl 901. Upon deenergization of reversing solenoid 938, the torsion spring 941 returns the escapement control lever 940 clockwise for permitting return of pawl 899 by spring 900 and the control lever 940 withdraws half-step pawl 901, and the rotatable accumulator members, under tension of spring 908, are reversed the remainder of a step as controlled by pawl 899. Thus, it can be seen that the 17–160 word space counting means, just described, may be reversed incrementally, one step at a time, by operation of reversing solenoid 938. However, when the gear 905 is returned to, or is otherwise in, the illustrated position, the switch 911 is conditioned, as explained and shown, for rendering the reversing solenoid 938 inoperable and rendering the solenoid 930 (FIG. 62) effective for deleting operations as explained.

When a line is complete and encoding for justifying is complete as will be explained later herein, the word space counter 850, shown particularly in FIGS. 61, 63 and 65, must be cleared (Restored as shown) in order to be ready to accumulate for representing the word spaces of an ensuing line. Means for clearing the word space counter 850 will now be described. A clearing solenoid 944 (FIGS. 18 and 61) is secured on the plate 229, and a link 945 is pivotally connected to the armature of the clearing solenoid and to a bail like rod 946. The forward end of rod 946 is secured to a clearing lever 947 (FIG. 65) and the rearward end of the rod is secured to an identical clearing lever 948 (FIG. 61). Both clearing levers 947 and 948 (FIG. 18) are secured on respective ends of a sleeve 949, which is pivoted on rod 888. Thus, the unit consisting of rod 946, clearing levers 947 and 948 and sleeve 949 is mounted for rotation on the rod 888. A torsion spring 950 is connected to the clearing lever 947 (FIG. 65) for urging the unit normally clockwise against the rod 936. A rearwardly extending stud 951 is secured on detent 887 and it overlies a rightwardly extending finger 952 on clearing lever 947. Similarly, a stud 953 (FIG. 61) is secured on detent 899, but extends forwardly to overlie a finger 954 on clearing lever 948. The arrangement is such that energization of clearing solenoid 944 pulls link 945 and rod 946 downward, and the finger 952 (FIG. 65) coacts with stud 951 for disengaging detent 887 from ratchet wheel 875. In this case, when the detents 887, 889 are disengaged for the purpose of clearing, the half-step pawl 901 is held disengaged as shown by the escapement control lever 940 and its spring 941, and the half-step pawl 890 (FIG. 65) is held disengaged as shown by escapement control lever 932 and its spring 935. When detent 887 is disengaged and pawl 890 is held disengaged, the ratchet wheel 875 and the directly connected brush carrier member 877 (FIG. 63) are restored counterclockwise by return spring 878, and thus any number of word spaces that may have been accumulated are cleared from the 1-16 space counter mechanism 850. At the same instant, when detent 899 (FIG. 61) is disengaged and pawl 901 is held disengaged, the ratchet wheel 898, member 903 and gear 904 are free to return counterclockwise, while the spring 908 restores the gear 905 clockwise, as explained, thus any number of word spaces that may have been accumulated therein are cleared from the 17-160 space counter mechanism.

In order to assure full restoration of both the 1-16 and the 17-160 mechanism, the just described clearing arrangement is held is clearing position until the machine is in proper condition for starting a new line. The circuitry for this safety feature can not be fully appreciated at this time, but the means for temporarily holding the clear condition in the word space counter 850 will now be described.

When the clearing solenoid 944 is operated and the bail rod 946 is swung downward in operated position, as explained, a latch 955 shifts over the rod for holding the mechanism in operated position. Latch 955 is pivoted on a stud 956, which is secured on a bracket 957. Bracket 957 is secured on the plate 229. A torsion spring 958 is anchored on the bracket and it is connected to latch 955 for urging the latch counterclockwise to latch on rod 946 when the rod is lowered as explained. A link 959 is pivotally connected to a rightwardly extending arm of latch 955 and to the armature of a solenoid 960, which is secured on plate 229 as shown best in FIG. 18. When the machine's carriage 80 is fully returned, when the word space counter 850 is fully restored, and when other mechanisms are fully restored in preparation for starting a new line, all as will be explained more fully, the solenoid 960 (FIG. 61) is operated for releasing the operated word space counter clearing means. Operation of solenoid 960 pulls link 959 downward, rotating latch 955 clockwise, against tension of spring 958, for shifting the latch to ineffective position, whereupon spring 950 (FIG. 65) restores the clearing means and permits spring 889 to restore detent 887 and permits spring 900 (FIG. 61) to restore detent 899. Thereafter, when solenoid 960 is deenergized as will be explained, the spring 958 returns the latch counterclockwise against the side of rod 946, as shown, ready to latch when clearing occurs again.

17. BACK SPACING AND DELETING

In this machine, backspacing or controlled rightward traverse of the carriage is used only for deletion of subject matter (Characters and spaces) previously set into the machine and recorded on the tape 577. Backspacing or deleting as it may be called herein, is done automatically as controlled by the punched tape for consecutively moving the carriage rightwardly in accordance with the last encoded bit on the tape, so that no variations will exist between the forward movement of the carriage and the backspace movement thereof. During such operations, the punched tape 577 is fed backwardly through a delete reading device which controls the carriage 80 to move reversely the amount that it was moved forwardly for any character or space code read by the backspace reading device. Since backspacing is controlled by the last code or consecutive codes punched in the tape previously, there can be no error in what is deleted and the amount the carriage is moved reversely. Therefore, upon completion of backspacing or deleting, the carriage 80 will be aligned with the position it was in before the last deleted character was typed. Also, as the punched tape 577 is being fed reveresely, delete punch holes are punched on top of the code being deleted, thereby rendering this code ineffective for controlling reproduction of this deleted matter. The delete code punch holes are channels 4, 5, 6, and 7, and whenever any code including the holes 4, 5, 6, and 7, are read by the main reading device for controlling the reproducer, the main reading device merely causes cycling of the punched tape to bypass such deleted codes. Whenever a typist, operating the composing machine, realizes that she made a mistake, she need only depress the delete or backspace key 140 which causes, as previously mentioned, the tape 577 to be fed backwardly and deleted and the backspace reading device 1097 and the control mechanism operated thereby causes the carriage to move backward accordingly as may be required for deletion of characters and spaces. Consecutive cycles of backspacing operations continue as long as the backspace or delete key 140 is held depressed by the operator, the key being automatically held depressed until each cycle is complete.

In addition to deleting characters and spaces, the backspace reading device 1097 and the deleting process will also eliminate functions such as shift to upper or lower case, to bold or regular and to print or no print. Also, during the backspacing when the backspace reading device 1097 reads a shift to lower case, the machine automatically shifts to upper case so as to be in the position or condition it was in before the machine was first shifted to lower case, also the opposite takes place when a shift to upper case is read, the machine is automatically shifted into lower case. Accordingly, in much the same manner, when a bold and regular print or no print code is read, the machine is conditioned oppositely to the code read and being deleted.

Backspacing to permit corrections, automatically deletes affected material codes, on occasions readjusts justifying data and appropriately steps the carriage reversely, and handles the punched tape 577 automatically. Characters, spaces and functions are back spaced and deleted automatically in the composing machine without the operator's having to operate any corresponding character, space, or function keys, other than to depress the delete key 140 (FIG. 3).

Backspacing is a term used herein generally for characterizing reverse operations, such as back spacing the carriage, reversing the word space counter 850, and performing opposite functions from those previously encoded, as required to properly operate the composing machine during deleting operations. Deleting, in a specific sense, refers to punching of a delete code (channels 4, 5, 6, 7) by the main punches 161 in a station on the tape 577 where a code had already been punched, and, thus, the previously encoded information may be in a sense eliminated or, more particularly, and previously encoded material will be rendered ineffective and will be ignored when the deleted code is read during the reproducing operations. In a general sense, deleting may be considered as the entire process of back spacing and the rendering of corresponding codes ineffective.

It should be recalled that the main punch mechanism 161 (FIG. 11) is operated for encoding each normal forward operation of the machine, and thereafter in sequence the control tape 577 is shifted forwardly one step by operation of solenoid 696, (FIG. 55) for shifting the punched code out of the main punch mechanism 161 and for shifting clear, unpunched, tape 577 into the main punch station of the punch assembly. Thus, normally, following each text and function series of forward operations, there is clear tape 577 in the main punch mechanism 161.

When the delete key 140 (FIG. 15) is depressed, a back space function code (Channels 5 and 7) is punched by the main punch mechanism 161, just before the series of deleting operations begin, as will be explained. The tape 577 is then stepped reversely one step for each succeeding code, to be deleted, as will be explained. When the delete key 140 is permitted to restore, a deleted code remains in the main punch mechanism 161 and the back space function code is situated reversely one or more steps out of the main punch mechanism 161, depending upon the number of deleting operations that have been performed as will be explained. From the above, it will be seen that the deleted codes and the back space function code must be shifted forwardly through the main punch mechanism 161, in order to provide clear tape 577 again in the main punch mechanism 161, so forward encoding may again begin. The tape return key 138 (FIG. 14) is provided for returning the tape 577 forwardly, following deleting operations, and the back space function code (5, 7) is automatically shifted one step forward of the main punches 961, as will be explained. Also, as will be explained, the back space function code causes the tape return key 138 to be released and the machine to be normalized upon full return of the tape. This general explanation is given in order that the reader may better appreciate the importance of the back space function code, as the description proceeds.

When the delete key 140 (FIG. 15) is depressed, a number of switches thereunder are shifted, primarily for rendering normal forward operation circuits ineffective and for rendering back spacing and deleting circuits effective, as will now be described.

Upon depression of the delete key 140, switch blades 203, 204 and 205 are disengaged from respective pairs of contacts 206, 207; 208, 209 and 210, 211, as explained. Thus, the forward carriage moving circuit, normally running through wire 141 and the forward motion solenoid 329 (FIG. 11) in the carriage moving mechanism 149 previously described, is rendered ineffective. Likewise, the case shifting circuit, normally effective through the wire 539 (FIG. 15) and the case shift encoding means shown generally in FIG. 35, is rendered ineffective. However, the case switch shifting means remains operable, by the circuits that run through wire 485, switches 477 and 478, and solenoids 488 and 492, for appropriately operating the case switch means and thereby controlling differential carriage movements during deleting operations as will be explained.

When the delete key 140 (FIG. 15) is fully depressed and in latched position, as described, the switch blade 203 is engaged with contacts 212 and 213 for rendering a reversing circuit effective, and switch blade 205 is engaged with contacts 216 and 217 for rendering a back space function and delete conditioning circut effective and also for rendering an automatic back space reader circuit available as required during back spacing sequences, as will be explained.

Also, upon depression of the delete key 140, the key lever 201 acts upon a tab 961 on a bellcrank 962, which is pivoted on rod 171. A torsion spring 963, connected to lever 201 and to bellcrank 962, normally urges the bellcrank counterclockwise so that tab 961 on the bellcrank rests against the bottom of the lever 201. An insulator 964 is secured on the lower arm of the bellcrank 962, and it is situated in engaging alignment with the center blade 965 of the switch 164. Normally, center blade 965 is engaged with a blade 966 for providing continuity between wires 163 and 165, which are respectively connected to the blades. When the delete key 140 is depressed, its lever 201 acts on tab 961, rotating bellcrank 962 and its insulator 964 clockwise against blade 965. This action breaks the continuity between blades 965 and 966 and, thus, eliminates any possibility of current passing through wire 165 and the forward tape feed controls 166 and 169 (FIG. 11). When the lever 201 (FIG. 15) is latched in operated position, as described, the center blade 965 is fully engaged with a blade 967, which is connected to ground as indicated. Thus, forward feeding of the tape 577 is avoided, while the main punch mechanism 161 (FIGS. 11 and 66) are still provided with a ground, through wire 162, arrangement 144, wire 163 and the shifted switch 164, for punching the back space function code (Channels 5, 7) and the delete code (channels 4, 5, 6, 7) in the sequence of operations as will be explained.

A switch means 968 (FIG. 66), operable upon depression of the delete key 140, is provided for causing the punching of the back-space function code and then, in sequence, for completing a back-space reader circuit as will now be described. A stud 969 (FIG. 15) is secured on the key lever 201. A pawl 970 is normally latched under the stud 969, as shown. The lower end of the pawl is pivoted on a lever 971, and a torsion spring 972 is connected to the pawl and the lever for urging the pawl 970 counterclockwise into engagement with the stud 969. Lever 971 is pivotally mounted on a stud 973, which is secured on plate 173, and a torsion spring 974 is connected with lever 971 and it is anchored in a known manner for urging the lever counterclockwise. A stud 975 is secured on plate 173, in a position for stopping the lever 971 in the illustrated position where the pawl 970 is free to latch on the stud 969 when the lever 201 is returned upward to the position shown. A conductor 976 is insulated from the otherwise secured on lever 971 so as to be shifted with the lever about pivot stud 973. A contact supporting insulator 977 and a terminal insulator 978 are secured on plate 173 by screws 979, which extend through holes therefor in the insulators and which are screwed into threaded holes therefor in the plate 173. The upwardly extending bifurcated end of conductor 976 is flexed to normally engage a pair of contacts 980 and 981 carried by insulator 977. Three downwardly extending furcations of conductor 976 normally merely engage the insulator 977. However, when the lever 971 is shifted clockwise to operated position, as will be explained, the conductor 976 engages three contacts 982, 983 and 984, which are carried by insulator 977. The contact 982 is connected, by a wire 985, with a solenoid 986, which is secured on plate 173. A link 987 is pivotally connected to the armature of solenoid 986 and to a generally vertical lever 988, which is pivoted on a stud 989. Stud 989 is secured on plate 173. A torsion spring 990 is connected to lever 988 and to plate 173 for urging the lever counterclockwise to its illustrated rest position where a projection 991 on the lever 988 rests on a bent over tab 992 on the bottom of plate 173. In normal position of lever 988, a generally radial surface 993 on the lever lies rearward of and in engaging alignment with a stud 994 secured on pawl 970.

Upon depression of the delete key 140 and its lever 201, the stud 969 moves the pawl 970 downwardly, rotating the lever 971 clockwise against the tension of torsion spring 974. As lever 971 rotates clockwise, the conductor 976 thereon is first shifted off of the contacts 980 and 981, thus breaking continuity therebetween, and, near the end of the depression when the stud 222 is in position to be latched by pawl 220 as explained, the conductor 976 is engaged with the contacts 982, 983 and 984 for completing a circuit thereamong and through wire 985 and solenoid 986 as will be explained hereinafter. Operation of solenoid 986 pulls link 987 for rotating lever 988 clockwise against tension of spring 990. When lever 988 is rotated clockwise, its generally radial surface 993 shifts stud 994 forward, rotating pawl 970 to disengage it from stud 969. Upon disengagement of pawl 970 from stud 969, spring 974 restores lever 971 counterclockwise, first disengaging conductor 976 from contacts 982–984 and then engaging the conductor 976 with the contacts 982–984, the circuit through wire 985 and solenoid 986 is broken, and the spring 990 restores the lever 988 and thus permits the spring 972 to rotate the pawl 970 slightly counterclockwise against the forward side of stud 969, then still in operated position. Finally, when the operator permits the delete key 140 to restore and when the deleting cycle is complete, the pawl 220 is released from stud 222 and spring 202 restores the key lever 201 and stud 969 to the illustrated position where the pawl 970 is restored to latched position, as shown, under the influence of spring 972. From the above, it can be seen that lever 971 is rotated clockwise for an initial phase and, due largely to operation of solenoid 986, it is automatically returned for the remaining phase of deleting operations, when the delete key 140 is depressed.

The initial phase of deleting operations will now be described. When the delete key 140 is depressed and the contacts 982, 983 and 984 are engaged by conductor 976 as described, a circuit provided for causing punching of the back space function code (5, 7) by the main punch mechanism 161 and for conditioning the machine for back spacing and deleting operations is rendered effective. The current for this circuit travels from a source (S) of power via wire 137 (FIG. 66), through contacts under the tape return key 138 in normal position as explained, continues through wires 139 and 538 (FIG. 15), contacts 217, 216 and blade 205 now in operated position, and it continues through a wire 995, which is connected to contact 216 and to a blade "a" of a switch 996 (FIG. 66) in the group of switches 652 of the punch control relay 603 (FIG. 45) previously described. This circuit travels through the punch control relay 603 several times, in order to prevent fugitive current, since some of the wires are used in other circuits that are also controlled by the punch control relay 603 and that are effective under various circumstances to be described later. However, this initial delete circuit is effective only when the switch 996 (FIG. 66) is in "on" position as shown, and the current from wire 995 passes through blades "a" and "b" of the switch and it continues through a wire 997 to a switch 998, which is provided for determining whether or not there is a supply of encoded tape 577 in the back space reader as will be explained. Switch 998 is closed whenever work has been done, encoded and the tape 577 fed accordingly forwardly through the main punch mechanism 161, for any given line, as will be explained. Since deleting is possible and possibly necessary only after work, including a mistake, is done during composition of a line, it may be said that the switch 998 is normally closed when the delete key 140 is utilized. The structure of switch 998 and that of a slack tape sensing means for controlling the switch will be described later. However, normally the initial delete circuit continues through switch 998 and a wire 999 leading to a solenoid 1000, which is provided for locking the carriage moving mechanism 149 and thereby locking the carriage 80 against manual return during deleting operations, as will be explained. The circuit, which operates the solenoid 1000 continues via a wire 1001, via a switch 1002 among the switches 652 in the punch control relay 603 (FIG. 45), and via a wire 1003 which leads to a solenoid 1004. Solenoid 1004 and a solenoid 1005 in a print-no print and a bold-regular switch means, previously mentioned and to be described, and a solenoid 1006 in the upper-lower case switch means 159, previously described in part and to be more fully described presently, respectively, are similar in structure and function, and all three solenoids 1004, 1005 and 1006 are operated simultaneously in the initial deleting circuit now under discussion. The solenoids 1004 and 1005 are interconnected in this circuit by a wire 1007, and the solenoids 1005 and 1006 are likewise connected by a wire 1008. Since the solenoids 1004, 1005 and 1006 in their respective switch means are similar, and since the upper-lower case switch means 159 has been described previously in considerable detail, the structural details of the solenoid 1006 will be described first, immediately following this general description will serve to describe the structures of the others. A wire 1009 is connected to the solenoid 1006 and a clearing solenoid 1010 in a mechanism that records the amount left in a line for justifying purposes, as will be explained. For the moment, it should be sufficient to know that operation of solenoid 1010 prepares the mechanism to operate reversely, followingly, as the carriage is back spaced during deleting operations. A wire 1011 carries the circuit from the solenoid 1010 to a switch 1012, which is normally conditioned as shown for directing the circuit through a wire 1013. The wire 1013 is also connected to a solenoid 1014, operable for deleting in a means for preventing occurrence of a space at the end of a justifiable line as will be described later. A wire 1015 is connected to the solenoid 1014 and to solenoid 986, which in turn is connected by the wire 985 to the contact 982 (FIG. 15). Since the lever 971 is operated and the conductor 976 is engaged with contacts 982–984 for the initial phase as explained, the initial delete circuit passes through solenoid 986, wire 985, contact 982, conductor 976, and the two contacts 983 and 984. Wires 1016 and 1017 are respectively connected to the contacts 983 and 984 and to the main punch mechanism 161 (FIG. 66), specifically connected to the punch solenoids 565-5 (FIG. 37) and 565-7, respectively, for causing punching of the back space function code (Channels 5 and 7). The initial phase circuit continues via the wire 162 (FIGS. 11 and 66), switch 669, wire 163 and goes to ground through the shifted switch 164 (FIG. 15) as explained. Thus, the initial delete circuit causes the punch mechanism 161 (FIGS. 11 and 66) to punch the back space function code (5, 7), without shifting the tape 577, and the solenoid 986 (FIGS. 15 and 66) to punch the back space function code (5, 7), without shifting the tape 577, and the solenoid 986 (FIGS. 15 and 66) is operated to break the circuit and to permit the lever 971 (FIG. 15) to return counterclockwise to the position shown, as explained.

The structural details of switch 998 (FIGS. 66 and 67), and that of a slack tape sensing means for controlling the switch, will now be described.

The switch 998 (FIGS. 45 and 67) is supported on the right side of plate 557 (FIG. 45) and its electrical components are insulated from the plate in a known manner. The switch 998 is held closed, as shown, by an insulator 1018 (FIG. 67), whenever operations for a presently being typed line are encoded, as will be explained. Insulator 1018 is secured on a lever 1019 by a stud 1020, in a known manner. Lever 1019 is pivoted on a stud 1021, which is secured on plate 557 (FIG. 45). Another lever 1022 (FIG. 67), extending generally opposite to lever 1019, is also pivoted on stud 1021. A stud 1023 is secured on the free end of lever 1022, and a contractile spring 1024 is hooked onto stud 1023 and onto the remote end of stud 1020 to form a snap switch means. A stud 1025 extends through an elongated hole therefor in lever 1023, and it is secured on a bellcrank 1026 which is secured on a pivoted rod 1027. A torsion spring 1028 is secured to bellcrank 1026 and it is anchored in a well known manner for urging the bellcrank to normally rest against a stop stud 1029. In this illustrated position of the bellcrank 1026, its stud 1025 so positions the lever 1022 that the spring 1024 rotates the lever 1019 against a stop stud 1030, where the insulator 1018 holds switch 998 in closed condition. When the bellbrank 1026 and rod 1027 are rotated against tension of spring 1028, away from stud 1029 and toward limit stud 1031, the stud 1025 rotates lever 1022 to the point where the axis of spring 1024 is on the opposite side of stud 1021 and the spring 1024 rotates lever 1029 away from stop stud 1030 and against a stop stud 1032. The studs 1029–1032 (FIG. 45) are secured on plate 557. When lever 1019 (FIG. 67) is shifted against stud 1032, the insulator 1018 closes a switch 1033 and it permits switch 998 to open. Conversely, when the lever 1019 is returned against stud 1030, the insulator 1018 closes the switch 998 and it permits switch 1033 to open, as shown.

The rod 1027 is pivoted in and extends through a hole therefor in the machined casting 573 (FIG. 55). A generally forwardly extending arm 1034 is secured on the left end of rod 1027, and it is similar in shape to a parallel arm 1035 (FIG. 67) of the bellcrank 1026. A bail rod 1036 is secured on and it extends between the ends of arms 1035 and 1034 (FIG. 55). The bail rod 1036 is located in the area where the text for a line may be accumulated in a loop 753 (FIG. 38) as explained, and it is situated above the plane 578 on machined casting 573 whenever coded tape 577 for the text of a line is accumulated in a loop as shown. Whenever a loop 753 is eliminated, whether by feeding of the tape 577 forwardly as when a line is completed and a new line is not started or by feeding the tape 577 reversely as during deleting, both as will be explained later, the tape 577 is drawn down in a straight line on plane 578. When this occurs, the tape 577 moves the bail rod 1036 downward rotating rod 1027 clockwise. Clockwise rotation of rod 1027 and bellcrank 1026 (FIG. 67), against tension of spring 1028, operates the recently described snap switch arrangement for opening switch 998 and closing switch 1033.

From the above, it should be understood that switch 998 is open, whenever there is no previously encoded tape 577 in the area of the bail rod 1036, and, therefore, no tape 577 is available to be back spaced. When this is the condition and the operator mistakenly depresses the delete key 140 (FIG. 15) for no apparent reason, the initial delete circuit will not operate, since the switch 998 (FIG. 66) is open under this condition, and the solenoid 986 will not operate and the back space function code (5, 7) will not be punched by the current which would otherwise pass through wires 1016, 1017 as described. Since the deleting sequences would not begin, the latch 220 (FIG. 15) would not be operated in sequence to release the key 140, and the key 140 would have to be released manually by operation of a back space release key 1037 (FIGS. 3, 15, and 68) or by operation of a delete key release lever 1038 (FIG. 69) as will be described under Topic 42.

As explained, the initial delete circuit normally continues from switch 998 (FIG. 66), through the wire 999, to the solenoid 1000 for locking the carriage moving mechanism 149 and therefore the carriage against manual return during deleting operations. This locking means will now be described.

The solenoid 1000 (FIG. 23) is secured on plate 288 in a known manner. A link 1039 is pivotally connected to the armature of solenoid 1000 and to a rightwardly extending arm of a member 1040, which is pivoted on a rod 1041. Rod 1041 is secured on plates 288 and 289 (FIG. 22) in a known manner. Bail rods 1042 and 1043 (FIGS. 23 and 27) are secured on a member 1044, that is pivoted on rod 1041 and they extend rearward to where they are secured on a companion bail member 1045, which is also pivoted on rod 1041. A pawl 1046 is pivoted on rod 1041, between member 1040 and bail member 1045, and a downwardly and leftwardly extending finger 1047 of the pawl 1046 generally underlies the rod 1042 and it is urged thereagainst by a torsion spring 1048 which is connected to finger 1047 and to rod 1043. A finger 1049, on the member 1040, similarly underlies the bail rod 1042. Thus, normally when the link 1039 is pulled downward, it rotates the member 1040, and its finger 1049 acts on bail rod 1042 and rotates the unit formed of members 1044 and 1045, and rod 1042 and 1043 clockwise about rod 1041. When this occurs, the spring 1048 normally rotates pawl 1046 clockwise followingly in respect to rod 1042. Thus, normally when link 1039 is pulled downward, the pawl 1046 is rotated clockwise, into engagement with ratchet wheel 303 (FIG. 23), for preventing manual return of the carriage by blocking counterclockwise rotation of the ratchet wheel 303.

When the bail unit including bail rod 1042 is rotated clockwise to operated position as just described, a pawl 1050 latches onto rod 1042 for positively holding the bail unit in operated position and for therefore yieldably holding the pawl 1046 in effective position. At the same time, pawl 1050 latches the bail unit including bail rod 1042 in operated position, a tab 1051 (FIGS. 23 and 27) on a member 1052 latches under the finger 1049 for holding the member 1040 and link 1039 in operated position during deleting operations. The member 1052 is mounted on a pivot rivet 1053 (FIG. 27), which is secured on a downwardly extending finger 1054 of the pawl 1050. A torsion spring 1055 is connected to the tab 1051 and to a stud 1056 for urging the member 1052 clockwise against a hub 1057 on the pawl 1050 and thereby further urging the pawl 1050 clockwise to latching position under rod 1042 for preventing manual carriage return and for latching the tab 1051 under the finger 1049 for holding the mechanism in reverse condition.

Pawl 1050 is pivoted on a stud 1058, which is secured on plate 288 (FIG. 22). The stud 1056 is also secured on plate 288. A link 1059 (FIG. 23) is pivotally connected to a leftwardly extending arm of pawl 1050 and to the armature of a solenoid 1060 which is secured to plate 288. The solenoid 1060 is operated for rotating pawl 1050 and tab 1051 counterclockwise, against tension of spring 1055 until the finger 1054 is stopped by stud 1056, where pawl 1050 is released from bail rod 1042 and the tab 1051 is moved out from under finger 1049. Solenoid 1060 is operated, as will be explained, for restoring the mechanism to forward operating condition when deleting operations are concluded. Upon release of rod 1042 (FIG. 27), a torsion spring 1061 connected to bail member 1044 and to the rod 390, returns the rod 1042 and pawl 1046 counterclockwise to the illustrated ineffective position.

When the machine is conditioned for deleting, when solenoid 1000 (FIG. 23) is operated, and when pawl 1046 is engaged with ratchet wheel 303 for preventing manual return of the carriage, as explained, the carriage can not be readily manually operated reversely. However, since the carriage moving mechanism 149 must operate reversely during deleting operations, the pawl 1046 must be withdrawn momentarily in the sequence of back spacing operations, at the time ratchet wheel 303 is operated controlled amounts reversely.

The means for disengaging the pawl 1046 synchronously with back space operations of the carriage moving mechanism 149 will now be described. A bellcrank 1062 (FIGS. 22 and 27) is secured on a forward end of a sleeve 1063 and a lever 1064 is secured on the rear end of the sleeve. Sleeve 1063 is pivoted on the rod 1041. The unit thus formed of bellcrank 1062, sleeve 1063 and lever 1064 (FIG. 27) is urged clockwise, by a torsion spring 1065 connected to the lever 1064 and to rod 390. A stud 1066 is secured on the rightward extending arm of bellcrank 1062, and it lies under and normally angularly displaced from pawl 1046 so as to permit engagement of the pawl with the ratchet wheel 303 (FIG. 23). A link 1067 is pivotally connected to the upwardly extending arm of bellcrank 1062 and to the armature of a solenoid 1068, which is secured to plate 288. When the carriage moving mechanism 149 is conditioned for back spacing and pawl 1046 is engaged with ratchet wheel 303 for preventing reverse operation of the ratchet wheel as explained, the solenoid 1068 is energized each time the carriage moving mechanism 149 operates to move the carriage reversely. Operation of solenoid 1068 pulls link 1067, rotating bellcrank 1062 and lever 1064 counterclockwise. Counterclockwise rotation of bellcrank 1062 swings the stud 1066 (FIG. 27) up against the pawl 1046 for rotating the pawl out of engagement with ratchet wheel 303 (FIG. 23). At about the time pawl 1046 is rotated against rod 390 and clear of the ratchet wheel 303, a stud 1069 on lever 1064 is shifted leftward of a surface 1070 on a latch 1071.

Latch 1071 is provided for holding the lever 1064, bellcrank 1062 and the pawl 1046 counterclockwise, so that the pawl is disengaged from the ratchet wheel 303 only during each actual back space operation of the ratchet wheel. The latch 1071 is operated to control reengagement of the pawl 1046 with the ratchet wheel 303, in sequence, as soon as the ratchet wheel is operated reversely, as will be explained later.

The initial phase delete circuit continues from the solenoid 1000 (FIG. 66) and wire 1001, switch 1002, wire 1003, and solenoid 1004–1006, as described. The solenoids 1004 and 1005, in a print control switch means and a bold-regular switch means, respectively, both of which will be described later, are similar in purpose and construction to the solenoid 1006, which will now be described and which conditions the Upper-Lower Case switch means 159 for back spacing operations.

The solenoid 1006 (FIG. 33) and the mechanism operated thereby is provided for rendering the time-delay detent 517 ineffective, during back spacing and deleting operations, so the Upper-Lower Case switch means 159 described in Topic 10 will immediately respond to the Case Switch Shifting Means (Topic 11), since the time delay required in forward operations is not necessary in back spacing operations.

Solenoid 1006 (FIG. 31) is secured to plate 417 in a known manner. A link 1072 (FIG. 33) is pivotally connected to the armature of solenoid 1006 and to a depending arm 1073 of a member 1074, which is pivotally mounted on rod 518, rightward of member 523 (FIG. 31). The member 1074, like the member 523 (FIG. 33), overlies the stud 522 on the detent 517. A stud 1075 in the lower end of arm 1073 normally overlies a surface 1076 on a hook 1077. The hook 1077 is pivotally mounted on a stud 1078 which is secured to plate 417 (FIG. 31). A torsion spring 1079 (FIG. 33) is connected to the hook 1077 and it is anchored on a stop pin 1080, which is secured in the plate 417 (FIG. 31), so as to urge the surface 1076 (FIG. 33) of the hook against the stud 1075. A link 1081 is pivotally connected to a depending arm of the hook 1077 and to the armature of a solenoid 1082, which is secured to the plate 417 (FIG. 31).

The arrangement is such that upon operation of solenoid 1006 (FIG. 33) the link 1072 is pulled leftward, rotating member 1074 clockwise. This operation of member 1074 acting on stud 522, accordingly rotates detent 517 to ineffective position clear of pin 503 as previously explained. At about the time detent 517 reaches ineffective position, the pin 1075 is engaged by latching surface 1083 on the hook 1077 for holding the detent in effective position during deleting operations.

When the machine is normalized after deleting operations are complete, the solenoid 1082 is energized, as will be explained later, to pull link 1081 and rotate hook 1077 clockwise against pin 1080, in which position the latching surface 1083 of the hook releases the pin 1075. When this occurs, a torsion spring 1084 connected to the arm 1073 and to the stud 524, returns the member 1074 to restore the detent 517 counterclockwise to effective position.

As explained, the initial delete circuit continues from solenoid 1006, via wire 1009 (FIG. 66), to the clearing solenoid 1010 in a mechanism for recording the amount left in a line for justifying purposes. The solenoid 1010 and the mechanism affected thereby will be described later in connection with controls for justifying. The initial delete circuit is continued from solenoid 1010 via the wire 1011, as explained previously. The wire 1011 is connected to a blade "a" in the switch 1012, which is one of the switches 652 (FIGS. 46 and 47). The punch control relay 603, in its normal condition (punch on), holds the blades "a" against blades "b" as explained. In punch off condition of the relay 603, the blade "a" is disengaged from the blade "b" as explained, for rendering the circuit ineffective. However, the circuit normally passes through engaged blades "a" and "b" and the wire 1013 (FIG. 66), which leads to solenoid 1014, wire 1015 and the solenoid 986 as explained.

The initial phase circuit continues through solenoid 986, wire 985, switch 968, wires 1016 and 1017, punch mechanism 161 for encoding the back space function code (5, 7), wire 162, switch 669, wire 163 and goes to ground through switch 164, as explained.

The switch 164 is supported by a bracket 1085 (FIG. 15), which is secured to plate 173, in a position so the blade 965 is operable by the insulator 964 under control of the delete key 140, as previously explained.

When solenoid 986 is energized, it disengages pawl 970 from lever 201 as explained. Whereupon, the spring 974 restores lever 971 counterclockwise to the position shown. At this time, conductor 976 disengages from contacts 982–984 for breaking the initial phase delete circuit, and the conductor 976 engages the contacts 980 and 981, as described, for rendering the back space reader circuit as effective. The reader circuit will now be described.

This reader circuit is now complete from a source (S) via wire 137 (FIG. 66), through contacts under the tape return key 138 in the normal position, via wire 139 and wire 538 to contact 217 (FIG. 15) under the delete key 140. Thence, it travels through switch blade 205 now in operated position, contact 216, wire 995 and wire 1086 connected between the wire 995 and the contact 980 in switch means 968. The current now passes through the restored conductor 976, contact 981 and a wire 1087, which is connected to the contact 981 and to each of seven code channel related operating solenoids 1088–1094 (FIG. 66) in a back space decoder 1095.

Solenoids 1088–1094 are each relative to a code channel. Each solenoid is connected by a wire 1096 with a respective sensing device in a back space reader 1097 to be described later. The back space reader 1097 controls the back space decoder 1095 by allowing the current to operate only those solenoids 1088–1094 which correspond with the code then being felt by the reader 1097, as will be explained. The current from the operated solenoids passes through the reader sensing devices and the significant punch holes in the tape 577 as will be described, and it goes to ground via a wire 1098 and a switch 1099, which is one of the punch control relay switches 652. The reader circuit, just described, will remain on, until the back space decoder 1095 has operated and the control tape 577 has been shifted reversely, removing the code from the sensing means as will be described.

The back space decoder 1095 will now be described. The decoder 1095 is shown schematically in FIG. 70, and the structural details thereof are shown primarily in FIGS. 71–75.

The back space decoder 1095 is contained generally within a frame consisting of vertical plates 1100, 1101 and 1102 (FIG. 71). The rearward plate 1101 is secured at its ends to the parallel left and right side plates 1100 and 1102, respectively. Four identical rod 1103, two of which are shown in FIGS. 71 and 75, are secured at their ends in a known manner to plates 1100 and 1102 (FIG. 71) for maintaining the plates rigidly parallel and for supporting parts within the back space decoder 1095. The side plates 1100 and 1102 are secured on the shelf member 9 (FIG. 73) as by angle brackets 1104 and screws 1105.

The solenoid 1088 (FIGS. 70, 71 and 73), relative to the first code channel, is secured to rear plate 1101 (FIG. 73) in a known manner. An insulator 1106 is secured, in a known manner, on the extremity of the armature in solenoid 1088. A single-pole double-throw switch 1107 is secured on plate 1101. A common blade a of switch 1107 normally holds insulator 1106 and the armature of solenoid 1088 in extended position, where insulator 1106 is stopped by a stud 1108 secured on plate 1101. The blade a is also normally engaged with blade b of the switch. Upon energization of solenoid 1088, its armature and insulator are retracted for disengaging blade a from blade b and for engaging blade a with a blade c of the switch 1107, whereafter the insulator 1106 is stopped in operated position by a stud 1109 secured on rearward plate 1101. Upon deenergization of the solenoid, the blade a returns the armature and insulator to normal position, and it disengages from blade c and reengages blade b. The mechanism described in this paragraph is operable in response to reading of code channel 1 as will be explained.

The part of the back spacer decoder 1095 related to code channel 2 will now be described. The solenoid 1089, for code channel 2, is like solenoid 1088, except that it operates two switches which are both marked 1110 (FIGS. 70 and 73) for convenience. The arrangement is such that the blades a (FIG. 73) in switches 1110 normally engage their related blades b, and, upon operation of solenoid 1089, both of these blades a are disengaged from their blades b and they are engaged with the blades c. Upon deenergization of solenoid 1089, the related blades a return to condition the switches 1110 as shown.

The back-space decoding mechanism 1095 related to code channel 3 will now be described. The solenoid 1090, shown schematically in FIG. 70, is in reality comprised of two identical solenoids **1090*a* and 1090*b* (FIG. 73), like solenoids 1088 and 1089, for greater uniformity among the parts in the preferred form or the invention. The solenoids 1090*a* and 1090*b* operate simultaneously as one for shifting three switches 1111. These solenoids are likewise deenergized simultaneously for permitting the switches 1111 to restore at the same time to the condition shown. Hereinafter, whenever reference is made to solenoid 1090 (FIG. 70), it should be taken to mean solenoids 1090*a* and 1090*b* (FIG. 73**) and vice versa.

The solenoids 1091–1094 (FIG. 70), which are relative to code channels 4–7, respectively, are provided for operating respective groups of switches 1112–1115. As indicated schematically, the arrangement of these solenoids and switches is the same in principle as those provided for channels 1–3. However, in order to include the indicated larger number of switches in a relatively small space, while providing adequate clearance between electrical components, the structure of these mechanisms are quite different from those described above.

The solenoids 1091 and 1092 are secured to plate 1102 (FIG. 71), in respective axial alignment with solenoids 1094 and 1093 which are secured to plate 1100, as shown. A description of one of the solenoids 1091–1094 and the respective switches 1112–1115 (FIG. 70) should serve to describe the others. The structure of solenoid 1094 and its switches is here selected as exemplary.

The armature or armature extension 1116 (FIG. 74) of solenoid 1094 extends righward and the end thereof is slidably supported in a stationary bearing 1117. A suitable plurality of insulators 1118 (FIGS. 74 and 75) are secured on the armature extension 1116, in a known manner, so as to shift unitarily with the armature. The insulators 1118 are appropriately spaced along the armature for operating the blades a of all of the switches 1115 (FIG. 70). However, to save space, where a large number of such switches are required, four of these single-pole double-throw switches 1115 (for example) are supported on one insulating assembly. The blades a are sandwiched between two insulating disks 1119, which are identical except that they are reversed back to back. The blades b and c are assembled on the outer discoidal faces of the disks 1119, and a unit formed of as many as four of each of the blades a, b, and c and the two insulating disks 1119 is secured together by four pair of rivets 1120 as shown. The rivets are insulated in a known manner from the blades through which they extend, thus the blades are insulated one from the other. A clearance hole 1121, in each of the insulating disks 1119, permits the blades b and c to turn toward the blade a as shown and it permits travel of the respective insulator 1118 therein.

Each pair of insulating disks 1119 is located about the axis of armature 1116 and in a position, longitudinally in respect to the normal position of the armature, so that the blades a each normally contact, or substantially contact, the respective insulator 1118 and they effectively engage their blade b.

The disks 1119 are provided with holes for a pair of rods 1103, on which the disks are mounted, and the disks are held in position longitudinally on these rods, in any known manner. The disk assemblies are also further held rigidly in their respective planes by two rods 1122 (FIGS. 71 and 75) which extend through holes therefor in the disks 1119 and in the frame plate 1102 (FIG. 71). The rods 1122 are secured to the plate 1102 and the disks are held in their positions therealong, in any known manner.

The bearing 1117 (FIG. 71) is rigidly secured, in a known manner, in a hole therefor in a plate 1123. The plate 1123 is supported on rods 1103 and 1122, as are the disks 1119 as described above.

An expansive spring 1124 (FIG. 74) is assembled on the armature 1116, between the solenoid 1094 and the left most insulator 1118, for urging the armature assembly rightward, as shown, where a clip 1125 in an annular groove on the armature abuts the end of bearing 1117 for stopping the armature in the illustrated normal rightward position.

The arrangement is such that, upon operation of solenoid 1094 for example, the armature 1116 and its insulators 1118 are shifted leftward for shifting the free ends of all blades a of switches 1115 out of engagement with the blades b and into engagement with blades c of these switches. Upon deenergization of the solenoid 1094, the spring 1124 returns the armature and by the predisposed tension of blades a they disengage from blades c and reengage the blades b as shown.

The action and the parts associated with solenoid 1093 (FIG. 71) are exactly like that described for solenoid 1094. The parts associated with solenoids 1091 and 1092 are the same, but the parts are reversed and the action opposite. For example, armature 1126 of solenoid 1091 extends leftward and the end thereof is slidably mounted in the rightward portion of the bearing 1117 (FIG. 74). Also, a clip 1127 in an annular groove on armature 1126 abuts the rightward end of bearing 1117 for stopping the armature in its normal leftward position.

From the above, it should be understood that selective operation of the solenoids 1088–1094 (FIG. 70) will cause the respective switches 1107, 1110, 1111, 1112, 1113, 1114 and 1115 to be shifted, while any non-shifted switches remain generally effective in their normal condition. It should also be apparent that more or less solenoids and respective switches may be employed to accomodate a different number of code channels.

Since the armatures 1116 and 1126 (FIG. 74) are mounted end to end in the same bearing 1117, operation and return of one and/or the other would create a vacuum and pressure, respectively, within the bearing. To reduce or to eliminate the occurrence of vacuum and pressure, as may be desired, one or more vent holes 1128 (FIG. 71) are drilled through the cylindrical wall of the bearing 1117. In order to minimize noise and shock of operation, the vents may be restricted as desired so that the arrangement serves as a dampening dash-pot for controlling the operation and return of both armatures 1116 and 1126. Also, a one way valve could be employed in the vent so the dampening would be effective only in one direction.

As described previously, each of the solenoids 1088–1094 is connected by a wire 1096 (FIG. 66) with a respective sensing device in the back-space reader 1097. The back-space reader 1097 will now be described.

The seven wires 1096 (FIG. 40) are collected as in a wire-loom 1129, and the wires and loom are supported by a clip 1130 connected thereto and to stud 719, to the left of plate 556. The wires 1096 emerge from the loom and turn rightward, where they are further supported by a collecting bracket 1131. The bracket extends between plates 556 and 557 and it is secured thereto in a known manner. The collecting bracket 1131 is provided for holding the wires clear of the moving parts in the punch mechanism 161. The wires 1096 (FIG. 38) extend upward through individual holes therefor in the machined casting 573. The stripped ends of wires 1096 are individually held in conducting engagement with code channel related sensing springs 1132 which are major components of the back space reader 1097 (FIG. 66). The stripped ends of wires 1096 (FIG. 38) are bent over in individual grooves in the top of an insulator block 1133 and the sensing springs 1132 are assembled in channel related notches in the edge of an insulator 1134 so as to hold the sensing springs 1132 in alignment with their respective wires. A couple of machine screws 1135 are assembled in holes therefor in casting 573 and insulator 1133, and they are tightened into threaded holes in insulator 1134 for solidly holding the insulators, springs and wire ends together on the casting as shown.

The upper ends of the sensing springs 1132 are guided in milled comb-like furcations 1136, on the insulator block 596, which guide the otherwise free ends of the sensing springs 1132 in their channel related positions. The upper ends of the springs 1132 are bent over on a radius so as not to catch in the code punch holes but so as to feel through the code punch holes that may be in registration therewith. The ends of the sensing springs 1132 normally are pressed against the bottom of the control tape 577, which insulates the springs from a conductor plate 1137 that is common to all the springs and above the tape 577.

The plate 1137 is embraced on its top and its edges by an insulator 1138, which is inlaid the underside of the punch cover 579 a shown. A terminal plate 1139 is spaced from the top of the cover plate 579 by an insulator 1140. One or more rivets 1141, conductively engaged with plates 1137 and 1139, extend through holes therefore in these plates, the insulators 1138 and 1140, and the cover plate 579 from which they are also insulated in a known manner, for securing the parts solidly in place as shown.

The arrangement is such that, when a code punch hole in the control tape 577 is shifted one step beyond (rightward of) the main punch mechanism 161 as occurs in a normal forward cycle of operations as explained, the curved upper end of the channel related sensing spring 1132 contacts the plate 1137 through the hole in the control tape 577. Thus, normally when the back space sensing circuit is rendered effective as explained, the last punched code, which was automatically shifted one step out of the main punch mechanism 161 and into the back space reader 1095, will control the circuit to operate the appropriate one or more solenoids 1088–1094 (FIG. 71), and it will travel through the effective wires 1096 (FIG. 38), through the related sensing springs 1132 and the punch holes, through the plate 1137, rivets 1141 and terminal plate 1139. The wire 1098 (FIGS. 39 and 66) is connected to the back space reader terminal plate 1139 (FIGS. 38 and 39) for continuing the back space reader circuit as described previously.

The otherwise exposed terminal plate 1139 and the top of rivets 1141 (FIG. 38) may be protected as by an insulating cover 1142 (FIGS. 37, 39 and 40) secured to the punch cover 579, in a known manner as shown.

The back space decoder's control of reverse carriage movement, delete punching and reverse tape movements that are involved in deleting characters, and nut spaces that are not to be altered for justifying purposes, will now be described. The peculiarities of deleting word spaces (space bar spaces) that may be altered for justifying purposes, in this examplary embodiment, will be discussed particularly later, when the controls for justifying encoding are better understood.

When no decoder solenoid 1088–1094 (FIG. 70) is operated and the switches 1107 and 1110–1115 are all in the indicated condition, "no circuit" (indicated at FIG. 70) is effective through the decoder 1095, since a normally engaged contact 1143 is not connected in any effective circuit. The contact 1143 could even be eliminated, without departing from the spirit of the invention, since the nullifying effect would be the same. However, operation of one or more of the solenoids 1088–1094 will operate a respective one or more of the switches 1107, 1110–1115, as explained, for rendering effective one of the circuits indicated at the left of FIG. 70.

Seven code channels are employed, in this particular embodiment, in order to accomodate characters, spaces, functions and justifying encoding requirements. The normal geometric expansion of a similar seven channel code selection network would provide a progression of 2, 4, 8, 16, 32, 64, 128, distinct circuits of which 96 are used. However, as will become more apparent hereinafter, no justifying codes will pass through the back space reader 1097, and the back space decoder 1095 need not accomodate these codes. Also, for deleting purposes, it is not necessary to differentiate among the characters and spaces within each of the groups A–G (Chart A, that follows the Figure description hereinabove) but, instead, it is to perform the appropriate automatic differential back spacing of the carriage for each respective character and space. By referring to the characters in each of the groups in the Chart A and the codes therefor in the Chart B, it can be seen that all of the codes in a group will be accommodated by one of the circuits indicated at the left of FIG. 70. Therefore, since a considerably fewer number of circuits are required, a number of switches are by-passed and may be eliminated. For example, there is one final stage switch 1107, two switches 1110, but there are only three switches 1111 (where otherwise there might be four as explained); one switch 1111 being eliminated by substitution of a wire 1144 that is connected between a contact in one switch 1110 and the center pole of one of the switches 1112. Other stages are by-passed in a similar manner as shown.

When a character or nut space code, requiring reverse carriage movement, is sensed by the back-space reader 1097 (FIG. 66) and the code related one or more solenoids 1088–1094 are operated as described, a circuit is completed through the back space decoder 1095. This circuit travels from a source (S) through wire 137, the tape return key 138 in normal position, the wire 139 (FIG. 15), the contact 212, the blade 203 on the delete key 140 in operated position as explained, through the contact 213, a wire 1145 (FIG. 66), and normally through commutator 142, a wire 1146, punch control relay 144, a wire 1147, commutator 146 and wires 1148 and 1149 (to be described later). The wire 1145 is connected to the contact 213 (FIG. 15) and the wire 1149 (FIG. 66) is connected to a switch 1150 in the carriage moving mechanism 149 which involves primarily the switch 1150, a wire 1151 between the switch 1150 and a solenoid 1152, the solenoid 1152 which cocks the carriage 80 moving mechanism 149 to move the carriage reversely, and a wire 1153 between the solenoid 1152 and the wire 413 which is also employed in the normal forward circuit as explained.

The switch 1150 is normally closed, and it remains closed until the solenoid 1152 is fully operated to cock for reverse movement of the carriage 80 as will be explained, and the carriage 80 is moved in reverse direction.

Continuing with the back space decoder 1095 controlled circuit, the current normally passes through wires 1145–1149, switch 1150, wire 1151, solenoid 1152, wire 1153, and the wire 413. At this point, the reverse circuit through wire 413 may travel one of three courses: namely, (1) through the wire 150, relay 153, wire 156, the upper-lower case circuit changer 159 and one of the group wires A–G; (2) through differential stop solenoid 345, wire 151, relay 154, wire 157, circuit changer 159 and one of the wires A–G; or (3) through the differential stop solenoids 345 and 347, wire 152, relay 155, wire 158, circuit changer 159 and one of the wires A–G, for two, three or four units of carriage movement, respectively, as controlled by the circuit changer 159 and as determined by the back space decoder 1095.

It can be seen that the circuit and mechanism of the reversing circuit between wire 413 and the group wires A–G are the same as those described previously for the forward circuit shown in FIG. 11. Thus, the number of units that the carriage is reversed during back spacing operations are each the same as they were during the previous forward operations. The character keys 16 (FIG. 11), as well as the other encoding keys on the keyboard, are not manipulated during automatic back spacing and deleting operations. Instead, by wires 1154 (FIG. 66), the group wires are individually connected to certain significant first stage switches of the back space decoder 1095. The wires 1154 actually maintain the group wire designations and merely connect the group wires appropriately with the back space decoder. In order to facilitate following individual circuits through the back space decoding arrangement, the wires 1154 in FIG. 70 are given a letter prefix, which corresponds with the "Group" designation for each of the characters and spaces as shown in the "Chart A" that can be found following the Figure description hereinabove. The only exception to this pertains to the "Space Bar" (word space) circuit, which enters the back space decoder 1095 via a wire 1155 to be described later. Other circuits that run through the back space decoder 1095 will be discussed later. However, an effective circuit travels through the operated back space decoder 1095 and continues via a wire 1156 (FIG. 66) which is connected between the center pole of final stage switch 1107 (FIG. 70), and two contacts, one in row "O" (FIG. 14) and one in row "N", under the tape return key 138. Thus, the back space circuit travels through wire 1156, blade 178 in the illustrated normal position, and to another contact in row "N" and through a wire 1157 connected thereto as shown. The other end of wire 1157 is connected to a solenoid 1158 (FIG. 66) in a back space tape cycling mechanism 1159. The solenoid 1158 is grounded in a convenient manner as shown.

The structural details of the carriage moving mechanism's back spacing arrangement will now be described.

As explained previously, the reversing or back spacing circuit within the carriage moving mechanism 149 (FIG. 66) involves the normally closed switch 1150 (FIG. 23), wire 1151 and solenoid 1152, as well as the differential stop control mechanism also used in forward operations. The switch 1150 is supported on and it is insulated from a bracket 1160, which is secured on frame plate 289. The normally closed switch is normally held closed by an insulator 1161 secured on the first end of latch 1071 as shown. Latch 1071 (FIGS. 20 and 76) is secured on the rearward end of a sleeve 1162, which is pivoted on the rod 297. A level 1163 is secured on the forward end of sleeve 1162. A torsion spring 1164 is connected to latch 1071 and to frame plate 289 (FIG. 20) for urging the unit formed of the latch, the sleeve 1162 and the lever 1163 (FIG. 76) counterclockwise toward latching position. However, in normal position of the parts, the latch 1071 is held in ineffective position as shown.

The solenoid 1152 (FIGS. 20, 22, and 23) is secured on frame plate 298. A link 1165 is pivotally secured to the armature of solenoid 1152 and to a member 1166 (FIGS. 20 and 76), which is pivoted on the rod 304. A relatively heavy torsion spring 1167 is connected to the member 1166 and to the frame plate 289 (FIG. 20) for returning member 1166 counterclockwise to normal position where it is stopped against the rod 316 (FIG. 76) as shown. In normal position of member 1166, a stud 1168 secured in an upper extension of member 1166 holds the level 1163, sleeve 1162 and latch 1071 in the illustrated ineffective position.

Another member 1169, which carries the previously mentioned tab 315 on its lower end, is also pivoted on rod 304. A torsion spring 1170 connected between members 1166 and 1169, urges the latter clockwise against the pin 1168. Thus, when the member 1166 is pivoted clockwise, the member 1169 is also caused to follow under tension of spring 1170, and, when member 1166 is permitted to restore, the spring 1167 drives member 1166 counterclockwise and the pin 1168 thereon drives member 1169 back to the illustrated normal position where tab 315 rests against rod 316.

As previously described, the solenoid 1000 (FIG. 23) is operated by the initial circuit, as deleting operations are initiated. As also explained, this operation moves link 1039 downward and rotates member 1040 clockwise.

A rearwardly extending stud 1171 is secured on link 1039, and the stud is embraced by the bifurcated end of a member 1172, as shown clearly in FIG. 76. An insulator 1173 is secured on a depending arm 1174 of member 1172 and the insulator holds a switch 1175 (FIG. 23) in closed condition in normal position of the member. Switch 1175 is secured on a bracket 1176 which is secured on plate 288 in a known manner. In operated position of member 1172, the switch 1175 is permitted to open, as will be explained later. Member 1172 (FIG. 76) is secured on the forward end of a sleeve 1177, and a lever 1178 is secured on the rearward end of the sleeve. The unit formed of parts 1172, 1177 and 1178 is pivoted on a rod 1179, which is secured on and which extends between plates 288 and 289 (FIG. 22). In normal position of the parts, a stud 1180 (FIG. 76) on the remote end of lever 1178 coacts with a pawl 1181 as will be explained. Pawl 1181 is pivoted on member 1166 and it is normally rotated clockwise and held in the illustrated position by stud 1180. A contractile spring 1182, connected between a stud 1183 on pawl 1181 and to a stud 1184 on member 1166, urges the pawl counterclockwise. An insulator 1185 is secured on the remote end of member 1166, and a normally open switch 1186 is situated in engaging alignment with clockwise swing of the insulator 1185. Switch 1186 is supported by a bracket 1187, which is secured on frame plate 289 (FIGS. 20 and 23) in a known manner. The switch 1186 will be closed by the insulator 1185 (FIG. 77), when the mechanism is fully cocked for a back space operation, as will be explained.

When the link 1039 (FIG. 23) and stud 1171 are moved downward at the beginning of deleting operations, as explained, the stud 1171 (FIG. 76) rotates the member 1172, sleeve 1177 and lever 1178 clockwise for moving the stud 1180 away from pawl 1181. The movement of lever 1178 is sufficient to lower stud 1180 beyond interference with clockwise and return operation of member 1166 and its insulator 1185, as seen best in FIG. 77. When stud 1180 is moved away from pawl 1181, the spring 1182 FIG. 76) rotates the pawl counterclockwise to effective position where its stud 1183 is stopped by the rightward edge of member 1166.

When the link 1039 (FIG. 23) and member 1040 are operated as explained, a link 1188, pivotally connected to member 1040 and to a member 1189, is shifted leftward, and the member 1189 is rotated clockwise about shaft 307 (FIG. 27) on which it is mounted. A torsion spring 1190 is connected to member 1189 and it is anchored on rod 309 for normally holding member 1189 counterclockwise, holding link 1188 rightward, holding member 1040 against rod 390, and link 1039 upward, in the positions shown in FIG. 23. Clockwise rotation of member 1189 shifts the pin 397 and its member 393 clockwise for removing the surface 394 out of the path of stud 395 on pawl 310, during back spacing operations of the mechanism.

Operation of the back space decoder 1095 (FIG. 66), under control of the back space reader 1097 when a character or a space code on the control tape 577 is sensed by the back space reader 1097, causes a circuit through wire 1149, switch 1150, wire 1151, solenoid 1152, wire 1153, and the differential stop arrangement under control of the circuit changer 159 and the decoder 1095 to be rendered effective, as described.

Operation of the solenoid 1152 (FIG. 23) pulls the link 1165 (FIG. 76) leftward for rotating the member 1166 clockwise against the tension of strong spring 1167. Clockwise rotation of member 1166 and its stud 1168 permits the spring 1164 (FIG. 77) to lower the latch 1071 against stud 1069, and it permits the member 1169 (FIG. 76) to follow clockwise in contact with stud 1168 under tension of substantial spring 1170. As member 1169 rotates clockwise, its tab 315, acting on surface 314 (FIG. 24), shifts the member 311 clockwise while the pawl 310 passes over two, three or four teeth on ratchet wheel 303 (FIG. 77), in preparation for shifting the ratchet wheel 303 counterclockwise (reversely) and thus moving the carriage 80 reversely two, three or four units, respectively, upon return of the member 311 as will be explained. The amount that member 311 is permitted to rotate clockwise during the cocking action is determined by the effective differential stop 334, 335 or surface 320 (FIG. 23), which are controlled the same for these back space operations as for the forward operations described previously. Regardless of which of the differential stops is effective during a given back spacing operation, the stopping of the member 311 thereagainst also stops the tab 315 (FIG. 77) and its member 1169, while member 1166 is rotated more than enough to shift member 311 (FIG. 23) against the four unit stop surface 320. When member 311 is stopped, the spring 1170 (FIG. 76) yields to permit full clockwise movement of member 1166. At about the time member 1166 is moved sufficiently to cock the carriage moving mechanism 149 for a four unit reverse carriage movement for example as just described, the insulator 1185 engages the switch 1186, and, as the insulator closes the switch, the pawl 1181 latches on to a stud 1191 (FIG. 77) which is secured on the lower end of the member 317. Closure of switch 1186 signals the end of the cocking action, as will be explained. Latching of pawl 1181 with stud 1191 completes the cocking action and thereby couples the members 317 and 1166 together for unitary rotation of the members as the member 1166 returns counterclockwise under tension of heavy spring 1167 (FIGS. 76 and 77). As explained, the link 1039 (FIG. 23) is held in operated position by member 1040, finger 1049 and the tab 1051 on member 1052, until the link 1059, the pawl 1050 and member 1052 are operated by solenoid 1060.

As will be explained, the solenoid 1060 is operated after all deleting operations are concluded. Therefore, the link 1039 and its stud 1171 will be held in operated position until all deleting operations are concluded. Thus, the stud 1171 is held in operated position, as shown in FIG. 77, and the stud 1180 will not be raised to engage pawl 1181 and thus the pawl may remain engaged with the stud 1191 for coupling the members 1166 and 317 together throughout a plurality of successive back spacing cycles.

When the carriage moving mechanism 149 is fully cocked as explained and shown particularly in FIG. 77, the insulator 1185 closes the switch 1186 for completing a circuit that runs through the normally closed switch 1150 (FIG. 23), a wire 1192 connected between the switch 1150 and the solenoid 1068 and the switch 1186, which is grounded in a convenient manner as indicated. When the solenoid 1068 is thus operated for disengaging the pawl 1046 from ratchet wheel 303 and for thus permitting counterclockwise (reverse) rotation of the ratchet wheel, the stud 1069 is locked in operated position by latch 1071, as explained. As latch 1071 shifts counterclockwise to latch stud 1069, the insulator 1161 permits the switch 1150 to open for breaking the circuits through wires 1151 and 1192. From the above, it can be seen that the back space decoder circuit that runs through the switch 1150 (FIG. 66), wire 1151, reversing solenoid 1152 etc., as well as the circuit that runs through the switch 1150 (FIG. 23) wire 1192, solenoid 1068 etc. are broken as soon as the carriage moving mechanism 149 is cocked for a back space operation. It should also be remembered that the pawl 1046 is held in ineffective position, by stud 1066 (FIG. 27), members 1062 and 1064, and latch 1071 (FIG. 23), during actual reverse operation of the ratchet wheel 303.

When the solenoid 1152 is deenergized as just described, the heavy spring 1167 (FIG. 77) shifts the member 1166 and the latched member 317 counterclockwise. The tab 319 on the member 317 contacts the member 311, and moves it and its pawl 310 counterclockwise four, three or two units of movement, depending on the differentially controlled cocked position of member 311, back to normal position. This return movement of the pawl 310 drives the ratchet wheel 303 and the carriage 80 geared thereto reversely a corresponding number of units. Thus, it is seen that the carriage is moved reversely a number of units corresponding to that associated with the character or space code sensed by the back space reader 1097 (FIG. 66).

As the member 1166 (FIG. 77) begins its counterclockwise driving return stroke, its insulator 1185 permits the switch 1186 to open for further rendering the circuit through solenoid 1068 (FIG. 23), and the now open switch 1150 ineffective. Near the end of the counterclockwise return stroke of member 1166 (FIG. 76), its stud 1168 reengages lever 1163, and rotates the lever and latch 1071 clockwise to disengage surface 1070 from stud 1069. Thereupon, spring 1065 restores lever 1064, bellcrank 1062 and pin 1066 clockwise, and thus permits spring 1048 (FIG. 27) to restore pawl 1046 clockwise into blocking engagement with ratchet wheel 303 (FIG. 23) at the end of the back spacing operation of the carriage 80 for preventing manual return of the carriage at this time.

Incidentally, as latch 1071 is restored clockwise, as just explained, the insulator 1161 closes switch 1150 for rendering the solenoids 1152 and 1068 operable in a possible ensuing operation. However, since the back space tape cycling mechanism 1159 (FIG. 66) operates for shifting the control tape 577 as will be explained upon opening of the switch 1150 and breaking of the decoder circuit, the solenoid 1152 will not be operated again during the concluding cycle. Likewise, the solenoid 1068 (FIG. 23) will not operate again until and unless the switch 1186 is again closed in a possible ensuing cycle of operations.

During possible consecutive back space carriage movements, the members 1166 (FIG. 77), 1169 and 317 remain coupled together, by the hook 1181 as shown and described, so that these members and the member 311, which is embraced between the tabs315 and 319 are rotated clockwise by the solenoid 1152 (FIG. 23) and they are rotated counterclockwise by the relatively strong back space motivating spring 1167 (FIG. 77) as described.

As described, the circuit through switch 1150 (FIG. 23), cocking solenoid 1152 and the differential stop solenoids 345 and 347 (FIG. 66) when required is broke, following the cocking action, to cause deenergization of solenoid 1152 and thus to permit the spring 1167 (FIG. 77) to take effect and drive member 311 counterclockwise for causing the back spacing operation. By referring to FIG. 66, it can also be seen that breaking of the circuit deenergizes solenoid 345, or solenoids 345 and 347, as the case may be for restoration of the differential stops 334, 335. As explained in connection with forward operations of the machine, the pawl 355 (FIG. 10) is operated by the stud 357 on stop 334, whenever the stop or the stops 334 and 335 are operated, to release stud 354 and permit spring 353 to swing bail 350 under the operated stop or stops 334, 335 for holding them in operated position. This occurs also in back spacing operations, although the holding of the stops 334, 335 in operated position at this time is not really necessary, since the member 311 (FIG. 23) is moved counterclockwise away from effective stops when the solenoids 345 and 347 are deenergized in back spacing operations. However, since the bail 350 (FIG. 10) may be shifted to effective position, restoration of the bail 350 must be performed to permit return of operated stops before a succeeding operation can be performed. Thus, in back spacing operations, the same as described for forward operations, the hook 361 (FIG. 23) is latched on to stud 366, whenever the stop 334 is operated and the member 311 is rotated clockwise an amount corresponding to three or four units. Under these conditions, counterclockwise return of member 311, under influence of heavy spring 1167 (FIG. 77) as explained, causes hook 361 (FIG. 24) to rotate members 367 and 370 clockwise for closing switch 377. Closure of switch 377 causes operation of solenoid 360 (FIG. 10), to swing bail 350 clockwise to free operated stops and to latch stud 354 of the bail arrangement on pawl 355 at the end of each operation as explained.

When the operator permits the delete key 140 to restore, when the key is automatically released near the end of a final cycle of deleting operations and when the cycling ceases as will be explained, the carriage moving mechanism 149 remains in condition for back spacing; the pawl 1181 (FIG. 77) remains engaged with stud 1191, the member 393 (FIG. 23) is held in ineffective position and the pawl 1046 remains in effective position for preventing manual return of the carriage, 80 all under control of pawl 1050 and tab 1051 in latching position. At this point, if the operator finds that further deleting operations are desirable, he may depress the delete key 140 again for initiating further back spacing and deleting operations as before, but he can not return the carriage 80 for starting a new line because the pawl 1046 remains effective. This feature is provided because the control tape 577 is not yet returned and the machine is not conditioned if the operator finds that sufficient back spacing and deleting is accomplished, he may depress the tape return key 138 for causing return of deleted codes through the main punch mechanism 161 as will be explained, and for restoring the carriage moving mechanism 149 to nornal condition. For performing the later operation, the solenoid 1060 is operated during a tape return cycle of operations, as will be described later. However, it will be seen that upon operation of the solenoid, it pulls link 1059 for rotating pawl 1050, its member 1052 and the tab 1051 to release the bail 1042 and the finger 1049 of member 1040. Whereupon, the spring 1061 (FIG. 27) returns members 1044 and 1045 and the bail 1042 counterclockwise for rendering the pawl 1046 ineffective as explained. At the same time, as tab 1051 moves out from under finger 1049, the spring 1090 returns member 1189 counterclockwise, link 1188 rightward, member 1040 back against rod 390 and it pulls the link 1039 upward to the illustrated position. Upward movement of link 1039 and its stud 1171 (FIG. 76) rotates the members 1172 and 1178 counterclockwise for pressing the stud 1180 against the pawl 1181 and releasing the pawl from stud 1191 (FIG. 77). Whereupon, the member 317 is restored clockwise, by spring 318 (FIG. 24), to normal position where tab 319 (FIG. 23) is stopped against the surface 320 as shown. When this occurs the carriage moving mechanism 149 is said to be in normal condition.

As described, the reverse cocking circuit travels through the components 1149–1153 (FIG. 66), through the wire 413 and at times through solenoids 345 and 347, and selectively through components 150–158, as controlled by circuit changer 159, the effective one of the wires 1154 and the operated back space decoder 1095. Also, as explained, this circuit passes through wires 1156 and 1157, and the solenoid 1158 in the cycling mechanism 1159. The back space tape cycling mechanism 1159 will now be described.

The solenoid 1158 is secured on the plate 674 (FIGS. 50 and 78) in the forward and reverse tape cycling assembly 672 (FIG. 49). The reverse tape cycling mechanism 1159 shown particularly in FIG. 78 is very similar to the forward tape cycling mechanism shown in FIGS. 51 and 52 and described previously. A link 1194 (FIG. 78) is pivotally connected to the armature of solenoid 1158 and to a bellcrank 1195, which is pivoted on rod 675. A torsion spring 1196 urges the bellcrank 1195 counterclockwise to normally rest against rod 681. Another torsion spring 1197, connected bellcrank 1195 and a member 1198, urges the member 1198 counterclockwise about rod 675 on which it is mounted. The spring 1197 normally holds a stud 1199 on member 1198 against the bellcrank 1195. A stud 1200 on the bellcrank normally holds a pawl 1201 in elevated position as shown. Pawl 1201 is pivotally supported on a member 1202, which is pivoted on rod 676. A contractible spring 1203, connected between rod 687 and a stud 1204 on pawl 1201, urges the pawl clockwise, and it urges the member 1202 clockwise to normally rest aginst rod 688. An insulator 1205 is secured on the lower end of member 1202, and a normally open switch 1206 is supported clockwise from the insulator and in engaging alignment therewith. Switch 1206 is insulated from a bracket 1207 and it is secured thereto as shown. Bracket 1207 is secured on plate 674. A lever 1208 underlies the stud 1204 and it is pivoted near its center on rod 677. A torsion spring 1209 is connected to lever 1208 and rod 703 for urging the lever clockwise, normally against the rod and spaced away from the stud 1204. A link 1210 is pivotally connected to the left end of lever 1208 and to the armature of a solenoid 1211, which is secured to the plate 674. An insulator 1212 is secured on the free end of pawl 1201, and, in normal position of the pawl, the insulator holds a pair of switches 1213 and 1214 closed as shown. Switches 1213 and 1214 are combined in a double switch means 1215 which is secured on a bracket 1216 that in turn is secured on a plate 1217 and the plate 1217 is secured on plate 674.

Since the solenoid 1158 is in the decoder circuit with the back space decoder 1095 (FIG. 66) as described, the solenoid 1158 is operated each time the back space decoder 1095 is operated for deleting purposes. Energization of solenoid 1158 pulls link 1194 (FIG. 78) for rotating bellcrank 1195 clockwise against tension of relatively strong spring 1196. When this occurs, bellcrank 1195 pushes stud 1199 and member 1198 clockwise, until the member strikes rod 681 for limiting the action. Greater utility of member 1198 will be described later, when its use will be more significant. However, at the moment it is sufficient to know that the pawl 1201 latches onto the stud 1200 at about the time member 1198 strikes rod 681 and bellcrank 1195 is stopped thereby. Thus, the back space tape cycling mechanism 1159 is cocked to operate. As pawl 1201 is rotated clockwise about its own pivot by spring 1203 to latch onto stud 1200, the insulator 1212 permits switches 1213 and 1214 to open for breaking certain deleting circuits that will be described later.

When the delete circuit is broken, as when the switch 1150 (FIG. 66) in carriage moving mechanism 149 is opened to deenergize solenoid 1152 and to thus initiate the reverse carriage movement as explained, the solenoid 1158 is likewise deenergized to permit operation of the back space tape cycling mechanism 1159. When solenoid 1158 is deenergized, the spring 1196 (FIG. 78) rotates bellcrank 1195 counterclockwise and stud 1200 pushes engaged pawl 1201 leftward, against tension of relatively light spring 1203, for rotating member 1202 counterclockwise and for closing switch 1206.

Closure of switch 1206 causes the control tape 577 to be shifted reversely one step through the back space reader 1097, so the next code may be read by the back space reader in the event the delete key 140 is held down through another cycle and so the previous code (the code controlling the current cycle) is returned into the main punch mechanism 161 where it will be deleted (punched to include the delete code, channels 4, 5, 6, 7) in the remaining part of the current cycle as will be described.

The circuits for automatically releasing the delete key 140, and for reversely stepping the control tape 577 through the back space reader 1097 and the main punches 161 will now be described. A wire 1218 (FIGS. 80 and 81) is connected to a source of power (S) and to interconnected contacts 1219 and 1220 to be described later. A wire 1221 is connected to a contact 1222 and to the solenoid 225. A wire 1223 is connected between solenoid 225 and the switch 1206.

As will be described later in greater detail, the contacts 1219 and 1222 are normally engaged by a blade 1224 to be described later, for conducting current therebetween. However, when a line has progressed into the justifying area and a space is the last bit of text encoded, the blade 1224 is shifted off of contacts 1219 and 1222 for avoiding the solenoid 225 and for therefore enforcing another sequence of deleting operations in order to eliminate a space or an underline mark at the end of the line in the justifying area. When the blade 1224 is shifted off of contacts 1219 and 1222, it is shifted on to contacts 1220 and 1225 as will be described, for making current available from the power source (S), wire 1218, contacts 1220 and 1225 and the engaged blade 1224, and a wire 1226 connected between contact 1225 and the wire 1223.

Normally, however, closure of switch 1206 (FIG. 80) completes a circuit that runs from the source of power (S) through the wires 1218 and 1221, through the solenoid 225 for releasing the delete key 140 as explained, through wire 1223, through now closed switch 1206, through a wire 1227 connected between switch 1206 and a solenoid 1228, and the current operates solenoid 1228 for shifting the control tape 577 one step reversely, and goes to ground as indicated.

Operation of the solenoid 225 (FIG. 15) unlatches the pawl 220 from pin 222 for permitting counterclockwise restoration of the lever 201 and delete key 140 under tension of the spring 202.

When the lever 201 is restored, the bellcrank 962 is detained momentarily in operated position by a detent 1229. Upon operation of lever 201 and bellcrank 962, as explained, the detent latched onto tab 961 on the bellcrank 962 under tension of a torsion spring 1230 connected to the detent and to plate 173. The detent 1229 is pivoted on a machine screw 1231 which is secured in a hole therefor in plate 173. A link 1232 is pivotally connected to the lower end of detent 1229 and to the armature of a solenoid 1233 which is secured on plate 173. At an appropriate time, during tape return operations to be explained presently, the solenoid 1233 will be operated to release the detent 1229 from the tab 961.

Reverse operation of the control tape 577 by solenoid 1228 (FIG. 80) will now be described. The solenoid 1228 (FIG. 45) is secured on the tape handling assembly frame plate 557. A machine screw 1234, and three studs 1235–1237 (FIG. 67) are secured on frame plate 557 (FIG. 45) in a known manner. A link 1238 (FIG. 67) is pivotally connected to the armature of solenoid 1228 and to an upper arm of a bellcrank 1239 as by a rivet 1240 secured on the bellcrank. Bellcrank 1239 is pivoted on screw 1234. A lever 1241 is also pivoted on screw 1234. A torsion spring 1242 is connected to bellcrank 1239 and to stud 1235 for urging the bellcrank counterclockwise. A reverse direction drive pawl 1243 is pivoted on the free end of lever 1241. An insulator 1244 is carried by a stud 1245, which is secured on the lower arm of bellcrank 1239. A contractile spring 1246 is connected to stud 1245 and to pawl 1243 for urging the pawl clockwise against stud 1237 and for urging the lever 1241 clockwise against the cylindrical head of rivet 1240. In the illustrated normal position of the parts, spring 1242 urges the bellcrank 1239 and the head of rivet 1240 against lever 1241, which is thereby urged against stud 1236. In this position, a camming surface 1247 on pawl 1243 coacts with stud 1237 for holding the pawl counterclockwise clear of the reverse stepping ratchet wheel 742 with which the pawl 1243 is aligned.

As previously explained, the solenoid 696 (FIG. 55) is operated to rotate the shaft 739 clockwise and to shift the control tape 577 (FIG. 38) rightward one step for each forward operation of the machine. Thus, it holds that the shaft 739 must be merely rotated counterclockwise to shift the tape 577 leftward one step for each delete operation. Shaft 739 (FIG. 67) is rotated counterclockwise step by step as follows. When solenoid 1228 is energized as explained, link 1238, rivet 1240 and bellcrank 1239 are operated against tension of spring 1242, while spring 1246 pulls pawl 1243 and causes the lever 1241 to follow clockwise in engagement with rivet 1240. As pawl 1243 begins to move, its surface 1247 permits the spring 1246 to rotate the pawl clockwise into engagement with the reverse stepping ratchet wheel 742. Thereafter, the pawl 1243 rotates the ratchet wheel 742 and shaft 739 one step counterclockwise. At the time the shaft 739 is rotated one step, a hooked stop surface 1248 on pawl 1243 engages the stud 1237 for limiting the action of the pawl and preventing overrotation of the ratchet wheel 742 and of the shaft 739. At this point the code on the control tape 577 (FIG. 38) that was read by the sensing springs 1132 earlier in the back spacing cycle of operations is returned in alignment with main punches 567. Also at about this time, the insulator 1244 (FIG. 67) engages a delete switch 1249, which is secured on plate 557 (FIG. 45) in a known manner. After the control tape 577 is back spaced on step as just explained, the solenoid 1228 operates a bit further and spring 1246 (FIG. 67) is stretched while insulator 1244 closes the switch 1249, whereupon the stud 1235 limits clockwise rotation of bellcrank 1239. Closure of switch 1249 causes the delete code (channels 4, 5, 6, 7) to be punched along with the code now in the main punches 567 (FIG. 38), and it causes the solenoid 1211 (FIG. 78) to be operated for breaking the back space tape cycling circuit through switch 1206, as will now be described.

Closure of switch 1249 (FIG. 67) completes a circuit that runs from a source of power (S), through the solenoid 1211 (FIG. 80) in the back space tape cycling mechnism 1159, through a wire 1250 connected between solenoid 1211 and switch 1249, through now closed switch 1249, through four wires 1251 connected between switch 1249 and the code channel punch wires 4, 5, 6, 7, and the circuit continues through the main punch mechanism 161 as described for punching the delete code (4, 5, 6, 7). This delete code circuit continues through the wire 162 (FIG. 66) the punch control switch 669, wire 163 and it goes to ground through the switch 164 that is still held in operated position by detent 1229 (FIG. 15).

Operation of solenoid 1211 (FIG. 80) pulls link 1210 (FIG. 78) and rotates lever 1208 against tension of spring 1209 until the lever is stopped by rod 704. This action causes the lever to lift stud 1204 and unlatch the operated pawl 1201 from the stud 1200 whereupon spring 1203 pulls pawl 1201 rightward rotating member 1202 against rod 688 and permitting switch 1206 to open. As the pawl 1201 shifts rightward over stud 1200, the insulator 1212 closes the switches 1213 and 1214.

Opening of switch 1206 deenergizes the solenoids 225 and 1228 (FIG. 80). Deenergization of solenoid 225 (FIG. 15) permits the spring 223 to shift the pawl 220 counterclockwise against the stud 222 as shown, or to rotate the pawl to shift the surface 224 over the stud 222, depending upon whether the operator permitted the delete key 140 to restore at or before the solenoid was energized as explained, or he held the key depressed to be latched for an ensuing deleting operation, respectively. Deenergization of solenoid 1228 (FIG. 67) permits the spring 1242 to restore bellcrank 1239, rivet 1240 and lever 1241 counterclockwise, until the lever is stopped as shown against stud 1236. At this point the carriage moving mechanism 149 is in normal position, and the surface 1247 is on stud 1237 for holding pawl 1243 clear of ratchet wheel 742, as shown, so the ratchet wheel, shaft 739 and the control tape 577 may be stepped freely by other means as explained.

As bellcrank 1239 is restored to position, as just explained, its insulator 1244 permits the delete switch 1249 to open for breaking the circuit therethrough. Breaking this circuit deenergizes the solenoid 1211 (FIG. 80) in the back space tape cycling mechanism 1159 and deenergizes the delete punch solenoids in the main punch mechanism 161. Deenergization of solenoid 1211 (FIG. 78) permits spring 1209 to restore lever 1208 against rod 703 and clear of the stud 1204. Deenergization of the delete punch solenoids, 565-4 (FIG. 37), 565-5, 565-6 and 565-7, permits their respective springs 601 to restore the operated punches 567 (4-7) down through the control tape 577 to normal position.

At this point, providing the operator permitted the delete key 140 (FIGS. 15 and 80) to restore when the solenoid 225 was operated to automatically release the key and when the solenoid 1228 (FIGS. 80 and 67) was operated to shift the control tape 577 as described, all automatic back space cycling would cease. A new cycle of deleting operations will not begin, under this condition, primarily because return of the delete key lever 201 (FIG. 15) and its switch blade 205 has broken the circuit between wires 538 and 995, 1086, and consequently the back space decoder 1095 (FIG. 66) and the back space reader 1097 are rendered inoperable before the succeeding code is delivered into the back space reader 1097. However, if the operator held the delete key 140 in operated position at the time the solenoid 225 (FIG. 80) was operated to release the key, a succeeding deleting cycle would begin as soon as the reverse tape feed solenoid 1228 operates sufficiently to deliver the next code into the back space reader 1097. If this occurs, deenergization of solenoid 225 in cycle permits relatching of the delete key in operated position, as explained, for a succeeding cycle of operations, and the back space reader circuit remains effective through the wires 538 (FIG. 66) 1086, 1087, decoder solenoids 1088–1094, the back space reader 1097, etc. for initiating a back spacing and deleting cycle of operations, as described previously. Thus, it is seen that one back spacing and deleting cycle or a plurality of such succeeding cycles of operations may be performed at the discretion of the operator.

When a series of successive delete cycles of operations are performed, the initial circuit which causes punching of the back space function code (5, 7) as explained is closed only once, following depression of the delete key 140 and prior to the first cycle of reading and deleting as described. The following cycles of reading and deleting are performed successively, as described, without involving the initial circuit. However, if the delete key 140 (FIG. 15) is permitted to restore following deleting operations as explained, the pawl 970 will latch on to stud 969 as shown, and, if the delete key 140 is then depressed again, deleting operations including the initial circuit would be initiated as described. In this case, the back space function code (5, 7), punched as a result of the initial circuit, will be punched with a deleted code standing in the main punches 567, instead of the back space function code being punched in clear tape 577 as before. However, the deleted code standing in the main punches 567 includes the delete code (4, 5, 6, 7) and the punching of the back space function code (5, 7) therewith is of no consequence.

Back spacing and deleting of word spaces will now be described. When the word space code (channels 3, 4)

is read by the back space reader 1097, the operations are the same as for any two unit character or the two unit nut space as described, except that one normally be deducted from the amount accummulated in the word space counter 850. Of course, this deducting operation is necessary only when the justifying key 244 is set for justifying and the word space was counted therefore during the forward (encoding) operations.

Normally, when the back space reader 1097 (FIG. 66) senses a code (in this instance, the word space code 3, 4), the back space decoder solenoids (particularly, solenoid 1090 and 1091 (FIG. 70)) are energized, in the manner hereinbefore, explained, for completing a particular circuit for back spacing and deleting the word space. This circuit leads from a source (S) through the tape return key 138 in normal position, the delete key 140 is operated position, and normally through wires 1145 (FIG. 66), 1146, 1147, 1148 and 1149, through the carriage moving mechanism 149 for shifting the carriage reversely two units, through the wire 150, and the circuit changer 159, which in this instance does not alter the circuits, all as explained previously. The circuit continues from the circuit changer and the two unit group "F" wire, not via one of the wires 1154 as before described but via a wire 1252 connected between the group "F" wire and the switch 911 (FIG. 62) in the word space counter 850. When the number of word spaces counted is less than 17, the circuit continues via blades 912 and 913, wire 929 and solenoid 930 for deducting one in the word space counter 850 as described. When the number of word spaces counted is more than 16, the circuit travels through the blades 912 and 194, the wire 937 and solenoid 938 for similarly deducting one in the word space counter 850. Thus, it is seen that one is deducted in the word space counter 850, regardless of the amount previously accummulated. The circuit continues from either the solenoid 930 of the solenoid 938 via a wire 1253, connected to both of the solenoids and to a contact 1254 (FIG. 17) in the justifying on-off switch means 142.

The contact 1254 is secured on the insulating contact support plate 271 in a position where it is normally engaged by a bifurcated blade 1255. The blade 1255 is secured on insulator 279, which is secured on member 277 as described. The blade 1255 also normally engages a contact 1256 on the plate 271. A contact 1257 is conductively connected with contact 1256 in a known manner, and it is situated to be engaged by the blade 1255 when the justifying control key 244 and member 277 are shifted to "off" condition as described. However, in the illustrated normal "on" position of justifying control key 244 and member 277, the blade 1255 is in position for conducting current between contacts 1254 and 1256. The wire 1155 is connected to interconnected contacts 1256, 1257, and to the back space decoder 1095 (FIGS. 62 and 66), particularly to the "Word Space 3, 4" circuit (FIG. 70) which is rendered effective by operation of solenoids 1090, 1091 as explained.

From the above, it can be seen that the reverse word space circuit not only back spaces the carriage 80 two units as described, but the circuit also travels through the group "F" wire (FIG. 62), the wire 1252, normally through the switch 911, the solenoid 930 or 938 for deducting one from the amount accumulated in the word space counter 850, the wire 1253, the justifying switch means 142 in normal condition, the wire 1155, the back space decoder 1095 operated according to the word space code (3, 4) the wire 1156, the tape return key 138 in normal condition, the wire 1157 and it goes to ground through the solenoid 1158 in the back space tape cycling mechanism 1159 (FIG. 66). It should be remembered that this circuit is broken at switch 1150 when the carriage moving mechanism 149 is fully cocked to reverse the carriage two units and this causes the carriage movement and simultaneously, upon deenergization of solenoid 1158 in the back space tape cycling mechanism 1159, the control tape 577 is back spaced and in sequence the code (in this case the word space code 3,4) is deleted as described.

When the justifying control key 244 (FIG. 17) is in "off" position and word spaces are not counted during forward operations as described, there is no need to deduct in the word space counter 850 (FIG. 62) during deleting operations. Thus, under this condition, the word space counter 850 is bypassed when the back space decoder 1095 operates to decode a word space, as will be discussed now. A bypass wire 1258 is connected between wire 1252 and a contact 1259 (FIG. 17) on the insulation plate 271. Contact 1259 is situated radially from shaft 239 and contact 1257 and arcuately in respect to contact 1254. When the justifying control key 244 is shifted to "off" position and member 277 is rotated to its clockwise position as described, the blade 1255 is shifted off of contacts 1256 and 1254 for rendering the reverse space counting arrangement ineffective, and the blade 1255, is shifted into conductive engagement with contacts 1257 and 1259. Thus, when a word space is decoded and back spaced as described, the circuit between the wires 1252 and 1155 (FIG. 62) avoids the word space counter 850. The circuit then travels wire 1252, wire 1258, contact 1259 (FIG. 17), blade 1255, contact 1257 and wire 1155, but the rest of the circuit remains the same as described previously.

The above back spacing and deleting description particularly covers a deleting of the character and space codes, but it will also serve generally to describe the deleting of other codes which will be covered particularly later in connection with descriptions of their specific code representing functions and related mechanisms.

18. CONTROL-TAPE RETURN

In the preferred form, the tape return key 138 (FIG. 14) must be manually operated, following deleting operations when the operator has decided that he has deleted a sufficient amount, in order to cause return of the deleted codes and the back space function code now on the control tape 577 (FIG. 38) forwardly (rightwardly) through the main punches 567, so clear tape will again be available for further forward encoding operations, and in order to otherwise restore the machine to normal after deleting operations, as will now be described.

Incidentally, key locking means are provided for preventing operation of any other key at the time the delete key 140 is in operated position, and key locking means are provided for preventing operation of any key, except the delete key 140 or the tape return key 138, immediately following restoration of the delete key 140, as will be explained later.

When the tape return key 138 (FIG. 14) is operated clockwise, its blade 176 is disengaged from contacts 198 and 200, as explained, for rendering all normal forward and reverse circuits leading from the source (S) and wires 137 and 139 ineffective. Likewise, operation of blade 177 renders the circuit through wire 694 and switch 691 (FIG. 54) ineffective for causing normal forward step by step operation of the control tape 577, and it renders the circuit through wire 694, solenoid 698, wire 699 and switch 697 ineffective for sequential operation of the forward tape cycling mechanism as described. Similarly, operation of the blade 178 (FIG. 14) renders ineffective the portion of the decoder circuit that normally runs through wire 1157 and the solenoid 1158 (FIG. 66) in the back space tape cycling mechanism 1159.

Operation of the tape return key 138 provides a circuit for returning deleted tape 577 forwardly through the main punches 567. This circuit travels from a source of power (S) through the wires 137 and 693 (FIG. 14), through the two contacts in row "O" that are now engaged by blade 177 in operated position, and through a wire 1260 one end of which is connected to one of the just mentioned contacts. The other end of wire 1260 (FIGS. 54 and 80) is connected to a switch 1261, which is closed only when deleting has just been performed and the back space tape cycling mechanism 1159 has been operated, as will soon be explained more fully. A wire 1262 is connected between the switch 1262 and the switch 735 which is normally closed and which snaps open at the end of each single step operation of the back space tape cycling mechanism 1159 that feeds the tape through the main punches 161 as explained. A wire 1263 is connected to solenoid 696 as explained.

The switch 1261 and its controlling part of back space tape cycling mechanism 1159 will now be described. Switch 1261 is secured on a right angle bracket 1264 (FIG. 78), which is secured on plate 674 in a known manner. As previously described, the member 1198 is pivoted on rod 675, and it is urged counterclockwise by light spring 1197. Stud 1199 on member 1198 normally rests against member 1195 as shown. An insulator 1265 is secured on the lower end of member 1198, and it is aligned with switch 1261 for closing the switch upon clockwise operation of the member 1198 and for permitting the switch 1261 to open as shown upon counterclockwise operation of the member. Member 1198 is held in clockwise operated position to indicate that deleting operations have been performed. To this end, a detent 1266 is pivoted on rod 676 and it normally lies against the top of member 1198. A torsion spring 1267 is anchored on rod 688 and it is connected to detent 1266 for urging the detent clockwise against the member 1198. The arrangement is such that upon a back spacing operation and energization of the solenoid 1158, the bellcrank 1195 rotates the member 1198 clockwise against rod 681, as described. As member 1198 rotates clockwise, the insulator 1265 closes switch 1261 and the detent 1266, under tension of spring 1267, drops into a notch 1268 on member 1198 just prior to engagement of the member 1198 with rod 681. Thus, the detent 1266 holds member 1198 in operated position for holding the switch 1261 closed after a single or the first back spacing operation. In other words the switch 1261 is thus held closed immediately after any and all deleting operations.

As will be explained presently, a solenoid 1269 is operated, during tape return operations, to release switch 1261. Solenoid 1269 is secured on plate 674. A link 1270 is pivotally connected to the armature of the solenoid 1269 and to a leftwardly extending arm of detent 1266 which arm overlies rod 688. When tape return operations are terminating, as will be described, the solenoid 1269 is operated to pull link 1270 and to rotate detent 1266 counterclockwise out of notch 1268 against tension of spring 1267 until stopped by rod 688. Whereupon, member 1198 is restored by spring 1197 for permitting switch 1261 to open and for thereby terminating tape return cycling.

However, from the above, it can be seen that the tape shifting circuit through the operated tape return key 138 (FIG. 54), closed switch 1261, alternately closed and opened switch 735 and solenoid 696, as explained, will remain effective, generally speaking until switch 1261 is opened. When solenoid 696 operates to shift the tape 577 forwardly one step, the switch 735 is opened, by the action of the snap switch mechanism pivoted generally on stud 728 (FIG. 55) as described. Opening of switch 735 breaks the circuit through solenoid 696, whereupon the snap switch mechanism again closes the switch 735 as explained. In this manner, by repeated operations of solenoid 696, the deleted codes on the control tape 577 (FIG. 38) are returned step by step forwardly through the main punches 567 and the back space sensing springs 1132, and, finally in this manner, the back space function code is shifted forwardly into the back space sensing springs 1132.

As the deleted codes are returned through the back space sensing springs 1132, the back space decoder solenoids are operated in response thereto in the same manner as before described. However, since the forward and reverse circuits are rendered ineffective by operation of the tape return key 138 as described and still further since the delete circuits in the back space decoder 1095 are not connected for causing any operations, reading of each deleted code and the resulting operation of the back space decoder 1095 is of no consequence. Following return of the deleted code or codes, the back space function code (Channels 5, 7) is returned through the main punches 567 and into the back space reader 1097 (FIG. 66), whereupon the back space decoder 1095 is operated to cause the back space function, which function is to terminate tape return operations and to normalize the machine.

The tape return reader circuit and the back space function circuit rendered effective as a result of reading the back space function code will now be described.

The tape return reader circuit travels from a power source (S) through wire 137 (FIG. 14), through contact 199, blade 176 now in operated position, the engaged second contact in row "O", a wire 1271 connected between the second contact and the wire 1087 (FIG. 66), wire 1087, the decoder solenoids and back space reader 1097 as described, wire 1098 and to ground through switch 1099. By this circuit, the solenoids 1088–1094 are momentarily and selectively operated each time a deleted code (including channels 4, 5, 6, 7) is read, during tape return operations, but, since a wire 1272 (FIG. 70) leading to each of the delete circuits through the back space decoder 1095 is not connected to any source (S) at this time as will be described, the delete code and wire 1272 does not cause any operations. However, the control tape 577 is shifted step by step forwardly through the back space reader 1097 by the action of solenoid 696 (FIG. 80) under control of the switch 735 as described, and, when the back space function code (5,7) is read, the back space decoder 1095 is operated to complete the back space function circuit.

The back space function circuit, which is primarily a restoring circuit, travels from a power source (S) through a wire 1273 leading to a solenoid 1274 in carriage moving mechanism 149, it operates solenoid 1274 to restore an arrangement that is operated whenever the carriage moving mechanism 149 is operated reversely or the carriage 80 is returned any amount as will be explained later, it continues through a wire 1275 connected between solenoid 1274 and a solenoid 1276 for restoring a clearing circuit breaker to be described later, it continues via a wire 1277 between solenoid 1276 and a solenoid 1278, it operates solenoid 1278 for restoring the mechanism previously operated by solenoid 1010 in the amount left in the line mechanism during the initial circuit of deleting operations as will be described, and it continues via an interconnected wire 1279, a solenoid 1280, a wire 1281, a solenoid 1282, a wire 1283, the solenoid 1082 and a wire 1284 for restoring mechanisms operated by the solenoids 1004, 1005 and 1006 as will be described. The wire 1284 leads to a contact in row "O" (FIG. 14) as shown. A wire 1285 is connected to a companion contact in row "O" and also to a contact in row "N" as shown. However, the back space function circuit continues through wire 1284, blade 179 in operated position and through wire 1285. The wire 1285 carries the circuit to the back space function (code 5, 7) terminal in the now operated back space decoder 1095 (FIG. 80). Thus, the circuit continues via wire 1285 (FIG. 70) through an operated decoder switch 1115, and it is directed through a series of switches 1114, 1112, 1111, 1110 and 1107 and all in normal condition.

It may be noted that the back space decoder reader control solenoids 1092 and 1094 are operated in response to the reading of the back space function code 5, 7, but that, in a preferred form as shown, the back space decoder solenoid 1094 and its switch 1115 are the only parts effectively operated for tape return purposes. In this form, a wire 1286 is connected between back space function circuit siwtches 1114 and 1112 and no 5 channel switch 1113 is involved in the circuit. This is done to reduce the number of switches 1113 in the back space decoder 1095, and it is permissible because the single channel 7 code is for a justification code (particularly the 1 unit remainder code as shown in Chart C among the Charts that follow the Figure descriptions), and justification codes are punched ahead of the codes for each line and they are punched only when the line is completed, as described. Thus, no justification code is ever in a position to be back spaced, and the 7 channel code alone may be used for back spacing purposes to identify the back space function code 5, 7.

The back space function circuit continues from switch 1107 via wire 1156 (FIG. 66) to a contact in row "O" (FIG. 14) that is now engaged by blade 178 in operated position, it goes through blade 178 and a companion contact in row "O", and it goes through a wire 1287 connected to the companion contact. The other end of wire 1287 is connected to the solenoid 191. Thus, the circuit travels through wire 1287 and operates the solenoid 191 for releasing the operated tape return key 138 as explained previously. A wire 1288 is connected between solenoid 191 and the solenoid 1269 (FIG. 80) in the back space tape cycling mechanism 1159. Thus, the back space function circuit continues through wire 1288 and operates solenoid 1269 (FIG. 78) for opening the switch 1261 and for thereby terminating return of the tape 577 when the back space function code (5, 7) is in the back space reader 1097. It should be understood that clear tape 577 is in the main punches 567 (FIG. 38) at this time, when the back space function code is read by sensing springs 1132 and the tape return feeding is terminated. The back space function circuit continues via a wire 1289 (FIG. 80), connected between solenoid 1269 and a solenoid 1290, it goes through 1290, a wire 1291 connected to 1290 and to the solenoid 1060, and it goes to ground through solenoid 1060. Operation of solenoid 1290, in a means to be described later for preventing an inadvertent occurrence of a word space at the end of a justifiable line, restores a pin resetting (delete) means that was rendered effective by operation of solenoid 1014 (FIG. 66) in the initial phase circuit upon depression of the delete key 140. Similarly, the solenoid 1060 (FIG. 23) is operated to restore the carriage moving mechanism 149 to the illustrated normal forward operation condition, to render the manual carriage return preventing pawl 1046 ineffective, to restore the member 393 and to release pawl 1181 from member 317 as explained previously.

When the tape return key 138 is depressed, at the same time the tape return reader circuit running through wire 1271 (FIG. 66) is made effective, current running through a wire 1292, connected to wire 1271 and to solenoid 1233, and going to ground through solenoid 1233 (FIG. 15) operates the solenoid for restoring the switch 164. The solenoid 1233 rotates detent 1229 clear of table 961, against the tension of spring 1230. Whereupon, spring 963 restores bellcrank 962 counterclockwise, until tab 961 comes up against lever 201 in returned position, for permitting restoration of switch 164 to the normal condition shown. In this manner, the forward tape cycle control 169 (FIG. 11) is again rendered operable after deleting operations upon return of the control tape 577.

The solenoids 1274 (FIG. 80), 1276, 1278, 1280 and 1282, operated upon completion of the back space function circuit as explained, and the separate mechanisms operated by these solenoids will be described later when their significance may be better appreciated.

It may be recalled that the detent 517 (FIG. 33) was rendered ineffective by operation of solenoid 1006 in the initial delete circuit. As described previously, the solenoid 1082 in the upper-lower case switch means 159 (FIG. 33) to effective normal position. In this manner, the upper-lower case switch means is normalized by the back function circuit, following deleting operations at the end of tape return operations.

19. DELETING TAPE RETURN AND DELETED CODES

It is understandable that an operator may, on occassion, delete and return he tape 577, and then find that another error, in the previously encoded work closer to the beginning of the line, should also have been deleted. In a situation like this, the operator need only depress the delete key 140 again, and hold it down until the first back space function code is deleted, until the previously deleted codes are again run through the process and until the further deletions are accomplished in the same manner as before. However, since the deletion of the back space function code and the previously deleted codes require no corresponding reverse conditioning of the machine, their circuits leading to the back space decoder 1095 (FIG. 66) are different from those described previously.

Upon a second depression of the delete key 140, to accomodate the just mentioned situation, a new back space function code is punched, the back space reader circuit is made effective, and tape handling and the deleting operations are performed as before described.

During these deleting operations, when the previous back space function code (5, 7) is sensed by the back space reader 1097, the back space decoder solenoids 1092 and 1094 (FIG. 70) are operated for rendering effective a circuit through the wire 1285 as before described. However, this time the circuit originates in a source (S) made available by the normally closed switch 1213 (FIG. 78) in the back space cycling mechanism 1159 (FIG. 80). A wire 1293 is connected between the switch 1213 and a contact in row "N" (FIG. 14), which contact is now engaged by blade 179 in the illustrated normal position as shown. Thus, it can be seen that the circuit travels from the source (S) and switch 1213 (FIG. 80), through wire 1293, blade 179 (FIG. 14) and wire 1285 (FIG. 80), and then as described for characters and spaces it continues through the operated back space decoder 1095, wire 1156 (FIG. 66), blade 178 (FIG. 14) in normal position, wire 1157 (FIG. 66) and to ground through solenoid 1158 in the back space tape cycling mechanism 1159. Upon full operation of the solenoid 1158 (FIG. 78) the switch 1213 opens, as described, for deenergizing the circuit including the solenoid 1158. Whereupon, in the previously described manner, the control tape 577 is back spaced and the main punch mechanism 161 operated to punch the delete code (4, 5, 6, 7) and to thus delete and render ineffective the previous back space function code (5, 7) that was just sensed by the back space reader 1097.

In order to maintain continuity in deleting operations any and all previously deleted codes must be cycled through the back space reader 1097 and main punch mechanism 161, and therefore current is led to the delete wire 1272 (FIG. 70) in the following manner. A wire 1294 (FIG. 80) is connected between the switch 1213 in the back space tape cycling mechanism 1159 and the contact 214 (FIG. 15). The delete wire 1272 is connected to the contact 215. As described, contacts 214 and 215 are situated to be engaged by blade 204, when the blade is in operated position. Thus, when the delete key 140 is operated and a previously deleted code is sensed and the back space decoder 1095 (FIG. 80) is operated accordingly, current will pass through the normally closed switch 1213, wire 1294, wire 1272 (FIG. 70), an effective delete circuit through the back space decoder 1095 (FIG. 66), wire 1156, blade 178 (FIG. 14) in the illustrated normal position, wire 1157 and it goes to ground through the solenoid 1158 (FIG. 66) in the back space cycling mechanism 1159. As described, operation of solenoid 1158 causes switch 1213 to open, whereupon solenoid 1158 is deenergized to continue the cycle and bring about back spacing of the tape 577 and deleting of the code. Of course, in this case, deletion of the code is of no consequence, since the code now in the main punch mechanism 161 was deleted previously, but it provides continuity of the deleting operations.

From the above, it can be seen that restoration of the delete key 140 (FIG. 80) breaks the circuit between wires 1294 and 1272, and no current wil pass through the back space decoder 1095 as a result of decoding the delete code during tape return operations, as described previously. Thus, during tape return operations, the back space function code circuit, through wires 1293, 1285, etc., is the only circuit that passes through the back space decoder 1095, and this circuit is for restoring the machine and terminating tape return operations as described.

20. DELETING CASE-SHIFT CODES

As described hereinbefore, normal operation of a shift key 17, 18 causes an upper case code (4, 6) to be punched in the control tape 577; this not only indicates that the machine is shifted to upper case condition at this time but it also indicates that the machine was in lower case condition prior to this operation. As also described, return of the shift key 17, 18 causes a lower case code (4, 7) to be punched, and this indicates that the machine was in upper case condition prior to this operation. Understandably therefore, the machine must be automatically operated to assume just the opposite condition whenever either of these upper case (4, 6) and lower case (4, 7) codes is read during deleting operations, since the control tape 577 is then fed reversely through the back space reader 1097. To this end, when a lower case code (4, 7) is read by the back space reader 1097 (FIG. 66), means for shifting the machine to upper case condition is automatically operated, under control of the back space decoder 1095. Similarly, when an upper case code (4, 6) is read, means for shifting the machine to lower case condition is automatically operated.

The circuitry and mechanism for automatically shifting the machine to upper case condition, when the lower case code (4,7) is read by the back space reader 1097 will now be described.

A wire 1295 (FIG. 80) is connected to the normally closed switch 1213 in the back space tape cycling mechanism 1159 and to a solenoid 1296 (FIG. 82) which is provided for rendering a ball lock arrangement ineffective for preventing automatic operation of the shift lever 42 (FIG. 4) during deleting operations as will be explained later. A wire 1297 (FIG. 82) is connected between the solenoid 1296 and a solenoid 1298, which is provided for shifting and locking the machine in upper case condition as will be explained presently. A wire 1299 is connected between solenoid 1298 and the lower case terminal (4, 7) (FIG. 70) which becomes effective upon operation of the solenoids 1091 and 1094 as explained.

The structure and function of solenoid 1296 (FIG. 82) will be described more particularly later in connection with a key operated and key controlling ball lock arrangement. At the moment, it is sufficient to know that the solenoid 1296 is operable for momentarily permitting operation of the shift key lever 42 (FIG. 4) as may be required during deleting and clearing operations.

The solenoid 1298 is secured to the channel member 14 as by screws 1300, in a known manner. A link 1301 is pivotally connected to the armature of solenoid 1298 and to the lower end of a member 1302, the upper end of which is pivoted on a stud 1303. Stud 1303 is secured on the lower inside of the typewriter frame 15 in a known manner. The rearward end of a member 1304 is also pivoted on stud 1303. A stud 1305 is secured on member 1304, and, in the illustrated normal clockwise position of the member, it engages the rearward edge of the member 1302. A link 1306 is pivotally connected to the forward end of member 1304 and to the shift key lock member 70 (FIGS. 6 and 7) at a point forward of the bolt 71 as shown. The arrangement is such that, upon operation of solenoid 1298 (FIG. 4), the link 1301 is pulled rearward, rotating member 1302 against stud 1305 for rotating member 1304 counterclockwise. This operation of member 1304 pulls link 1306 downward for operating the shift lock 22 (FIG. 7) and its shift key lock member 70. As previously explained, operation of the shift lock 22 first causes the shift key lock member 70 to be rotated counterclockwise until the surface 76 engages the stud 68, and thereafter it operates the shift lever 42 and locks it and the machine in upper case condition. The shift lever 42 is locked down and the machine locked in upper case condition, when the latch surface 77 on hook member 63 latches over pin 68 near the end of the operation, as previously explained.

From the above, it can be seen that back space reading of the lower case code (4, 7) and the consequent operation of the back space decoder 1095 brings about an automatic shift of the machine to upper case condition. The complete circuit for causing this shift runs from a source (S) and normally closed switch 1213 (FIG. 82), via wire 1295, operates solenoid 1296, continues via wire 1297, operates the solenoid 1298 for operating the shift lock member 70 as just described, via wire 1299, goes through the back space decoder 1095 now operated according to reading of the lower case code 4, 7 (FIG. 70) as explained, and the circuit continues through wire 1156, through contacts under the tape return key 138 (FIG. 66) in normal position, through wire 1157 and the solenoid 1158 in the back space tape cycling mechanism 1159 the same as for back spacing any other code. Thus, the typewriter is shifted and locked in upper case condition. To complete the upper case conditioning of the machine, the upper-lower case circuit changer 159 must also be shifted to upper case as explained. Thus, at about the time the typewriter is shifted to upper case, the bellcrank 471 (FIG. 35) is snapped clockwise to close switch 478, as previously described. When this occurs, the circuit through the wire 485, blades 481 and 480, wire 484, switch 478, wire 486, solenoid 467, wire 487, solenoid 488, wire 489 and solenoid 490 is made effective for operating the solenoids 467, 488 and 490 to assure full shift of the typewriter to upper case condition, to snap disk 423 clockwise as described and to shift differential key locks to upper case condition as will be explained, respectively. Upon shifting of disk 423 clockwise, the blade 480 is rendered ineffective as described, and the circuit through wire 484 etc., is broken. Upon full operation of the solenoid 1158 (FIG. 80), the switch 1213 is opened as described and the back space tape cycling mechanism 1159 operates to bring about back spacing of the control tape 577 and deleting of the lower case code (4, 7), the same as for any other code, as described.

The circuitry and mechanism for automatically shifting the machine to lower case condition, when the upper case code (4, 6) is read by the back space reader 1097, will now be described.

A wire 1307 (FIG. 82) is connected to solenoid 1296 and to a solenoid 1308, which is provided for shifting the typewriter to lower case condition as will be described. A wire 1309 is connected to solenoid 1308 and to the upper case (4, 6) terminal (FIG. 70) that is made effective by operation of the back space decoder 1095 in response to reading of the upper case code (4, 6).

The solenoid 1308 (FIG. 4 and 12) is secured on a plate 1310, which is secured on the vertical front portion of the typewriter frame 15 in a known manner. A link 1311 (FIG. 4) is pivotally connected to the armature of solenoid 1308 and to the rearward end of the member 64 (FIG. 6).

The arrangement is such that, upon operation of the back space decoder 1095 according to the upper case code (4, 6), current flows from a source (S) and normally closed switch 1213 (FIG. 82), wire 1295, solenoid 1296, wire 1307 and the solenoid 1308 for pulling link 1311 (FIG. 4) upward and rotating member 64 (FIG. 6) counterclockwise to disengage the latching surface 77 from pin 68 and to thus permit the typewriter to restore to lower case position as explained. The circuit continues from solenoid 1308 (FIG. 82) via wire 1309, through the upper case circuit (4, 6) (FIG. 70) in the operated back space decoder 1095, via wire 1156 (FIG. 66), contacts under the tape return key 138 in normal position, wire 1157, and the solenoid 1158 in back space tape cycling mechanism 1159. Upon return of the typewriter to lower case condition, the bellcrank 471 (FIG. 35) is restored counterclockwise for closing switch 477, as explained. Whereupon, the circuit through wire 485, now effective blades 481 and 479, wire 483, switch 477, wire 491, solenoid 492, wire 493 and solenoid 494, and thus operates the solenoid 492 for shifting the case switch means disk 423 counterclockwise to lower case position, as previously described. At this same time, the solenoid 494 operates to condition key locks for lower case condition, as will be explained later. As the case switch means disk 423 shifts to lower case position the blade 479 is rendered ineffective, as described, for breaking the circuit through wire 483. Upon full operation of the solenoid 1158 (FIG. 35), the switch 1213 is opened as described and the back space tape cycling mechanism 1159 operates to bring about spacing of the control tape 577 and deleting of the just read upper case code (4, 6), the same as for any other code, as described.

21. CARRIAGE RETURN

The well known carriage return lever 111 (FIG. 1 and 3) is pivoted on a vertical stud 1312, which is secured in main carrier or carriage frame 80. The carriage return lever 111 is normally situated against a stop 1313 (FIG. 3) on the carriage frame 80 and it may be manually rotated counterclockwise (rightward against a similar limit stop 1314 for line spacing the platen 90, and then upon reaching its rightward limit it may be pushed further rightward for returning the carriage, 80 all in the customary manner. At the moment, it is sufficient to known that platen 90 is rotated 1, 2 or 3 increments (line spaces) forwardly, depending upon the present position of the normal line-space control button 112 (FIGS. 1 and 3). The line spacing that occurs with carriage return may be referred to as normal line spacing, which is thus differentiated from extra forward and reverse line spacing that may be coded and is automatically performed upon operation of the "Line Space" and "Reverse Line Space" keys 20 and 21 (FIG. 3), respectively.

When the carriage 80 is manually shifted rightwardly (returned) one or more units (0.025" or more), in the normal manner mentioned above, a switch 1315 (FIG. 23) is closed for normally causing the carriage return code (1, 2, 3, 7) to be punched in the control tape 577, by the main punch mechanism 161 in a series of automatic operations and for locking the keyboard keys against further manual operations as will be explained presently.

The structural details and means for closing the switch 1315 will now be described. The switch 1315 is secured on the frame plate 288 in any known manner. The switch 1315 is normally open as shown and it is situated in alignment with an insulator 1316 for being closed thereby as will be explained.

As previously described, the ratchet wheel 303 is normally urged clockwise and it is permitted to rotate clockwise different amounts for corresponding forward differential carriage movements. As also explained, the detent 306 (FIGS. 23, 24 and 79), under light tension of spring 308, normally holds the ratchet wheel 303 and therefore the carriage against forward direction movement. From the foregoing, therefore, it can be seen that rightward (return) movement of the carriage, 80 as by carriage return lever 111 (FIG. 3), will cause the ratchet wheel 303 (FIG. 79) to rotate counterclockwise and the detent 306 will ratchet over the teeth of the ratchet wheel.

As the carriage is shifted the first unit (0.025") of movement in the return direction, the detent 306 is cammed clockwise, by a tooth on the ratchet wheel 303, against tension of spring 308. Upon this clockwise rotation of the detent 306, its rightwardly extending portion 333 rotates a bellcrank 1317, aligned therewith, counterclockwise. Bellcrank 1317 is pivoted at 1318 on the bellcrank 324, which is normally held against rod 309 by relatively strong spring 325. An upwardly extending arm of the bellcrank 1317 is aligned for operating a stud 1319 secured on a downwardly extending portion of a pawl 1320. The pawl 1320 is pivoted on a rod 1321, which is secured between the frame plates 288, 289 (FIG. 23) is any known manner. A torsion spring 1322 (FIG. 79) is anchored on rod 309 and it is connected to pawl 1320 for normally urging the pawl counterclockwise into engagement with a stud 1323, which is secured on the upper end of a member 1324. Member 1324 is pivoted on stud 1325, which is secured on plate 288 (FIG. 23). A torsion spring 1326 is anchored on plate 288, in any known manner, and it is connected to member 1324 (FIG. 79) for urging the member and its stud 1323 counterclockwise normally against pawl 1320. The insulator 1316 is secured on the lower end of member 1324.

The arrangement is such that, upon the first incremental counterclockwise (return) movement of the ratchet wheel 303, the detent 306 is cammed clockwise about rod 307 and the bellcrank 1317 is rotated counterclockwise thereby about its pivot 1318 as explained. Such rotation of bellcrank 1317 presses stud 1319 leftward for rotating pawl 1320 clockwise against tension of spring 1322. Clockwise rotation of pawl 1320 disengages it from the stud 1323 and permits the spring 1326 to rotate the member 1324 counterclockwise for pressing its insulator 1316 to close switch 1315 and for swinging its stud 1323 over a surface 1327 on pawl 1320 for holding the pawl in operated position. Thereafter, as the ratchet wheel 303 may be rotated further in counterclockwise return direction, the detent 306 will be ratcheted without the added resistance of bellcrank 1317 and pawl 1320.

A line 1328 is pivotally connected to the member 1324 and to the armature of the solenoid 1274, which is secured on plate 288 (FIG. 23) in a known manner. The solenoid 1274 is part of a restoring circuit, which was mentioned previously and which will be described later when the circuit will be readily understood. However, when the solenoid 1274 is operated, the link 1328 (FIG. 79) is pulled rightward, rotating member 1324 clockwise to the illustrated restored position against tension of spring 1326 for opening switch 1315 and for permitting spring 1322 to relatch pawl 1320 on stud 1323 as shown. The occurrence of this restoring operation will be described later.

When the carriage 80 is returned one or more units, the switch 1315 is snapped closed, as just described, for completing a carriage return circuit. The "carriage return circuit originates in a source, of power, passes through the tape return and delete keys 138 and 140 in normal position and wires 137, 139, 538 and 539 (FIG. 35), the same as for the upper lower case circuits described previously. However, the carriage return circuit follows a wire 1329 (FIG. 83), connected between the wire 539 and a switch 1330 in the forward tape cycling control 169. Switch 1330 (FIGS. 51 and 53) is closed only when forward operations for a line have been performed, as will be explained. When switch 1330 is closed, the carriage return circuit travels therefrom via a wire 1331 (FIG. 83). The wire 1331 is connected to two wires 1332 and 1333, through both of which the carriage return circuit passes. Wire 1332 is also connected to a switch 1334 in a general key lock mechanism 1335, to be described. A wire 1336 is connected between switch 1334 and a solenoid 1337, which is operable for locking all key board keys against operation as will be explained. A wire 1338 is connected between solenoid 1337 and another wire 1339. The circuit will travel through wire 1336, solenoid 1337 and wire 1338 only as long as it takes the solenoid 1337 to lock the keys, at which time the switch 1334 will break this part of the circuit as will be described.

The part of the carriage return circuit that is sustained for the complete cycle passes through the wire 1333. Wire 1333 is connected to a normally closed switch 1340 in a carriage return circuit breaker 1341 to be described. A wire 1342 is connected between the switch 1340 and a solenoid 1343 in the end of line tape control 166. A wire 1344 is connected between solenoid 1343 and the wire 1339. This portion of the circuit, through wire 1333, switch 1340, wire 1342, solenoid 1342 and wire 1344, will remain effective until the solenoid 1343 is operated to cause end of line tape control 166 to operate for controlling the punching of the carriage return code (1, 2, 3, 7) and until the circuit breaker 1341 is operated to open switch 1340 as will be described.

The wire 1339 is connected to the switch 1315 (FIG. 79), which is closed upon return of the carriage 80 as previously described. A wire 1345 is connected between switch 1315 and the wire 1098 (FIG. 83), which leads to ground through normally closed switch 1099 in the punch on-off control relay 144 as previously described.

From the above, it can be seen that normally upon return of the carriage 80 and closing of switch 1315, the solenoid 1337, in the general key lock mechanism 1335, and the solenoid 1343, in the end of line tape control 166, are immediately energized for operating their respective mechanisms.

The general key lock mechanism 1335, shown particularly in FIGS. 84 and 85, will now be described. The solenoid 1337 (FIG. 83) is secured on the vertical plate 606 (FIG. 44), for convenience on the extreme right of the keyboard, in any known manner. A link 1346 (FIG. 84) is pivotally connected to the armature of solenoid 1337 and to a downwardly extending arm of a ball-lock interposer 1347, which is pivoted on the shaft 604. The ball-lock interposer 1347 extends forwardly through a suitable guidance slot therefor in the channel member 624. The sides of the slot (not numbered) serve to guide the ball lock interposer transversely, while the top and bottom of the slot respectively limits the clockwise rotation of the ball-lock interposer in the illustrated normal position and limits the counterclockwise rotation of the ball-lock interposer in operated position. The ball locks per se will be described later under the heading "GENERAL KEY LOCKS", however, for the present, it is sufficient to know that the interposer, only in operated position, causes the ball-lock to prevent operation of all of the critical keys on the keyboard.

A stud 1348, secured on the upwardly and rearwardly extending arm of the ball-lock interposer 1347, normally blocks a detent 1349 in clockwise ineffective position. A contractile spring 1350, connected between the detent and the interposer 1347, urges the detent 1349 counterclockwise against the stud 1348 and it urges the interposer clockwise to normal position. The detent 1349 is secured on the rightward end of a sleeve 1351 (FIG. 85) and a lever 1352 is secured on the other end of the sleeve, and these members form a unit pivoted on the rod 610. Thus, the entire unit, parts 1349, 1351 and 1352, is urged counter-clockwise about rod 610 by spring 1350 (FIG. 84).

A restoring solenoid 1353 is supported on an angle bracket 1354, which is secured on plate 606 in any known manner. A link 1355 is pivotally connected to the armature of solenoid 1353 and to a downward extending arm of detent 1349. Solenoid 1353 is energized for rotating the detent 1349, sleeve 1351 and lever 1352 to the illustrated ineffective clockwise position against the tension of spring 1350 as will be explained.

An insulator 1356 is secured on the end of the lever 1352, and it is situated in alignment with a center blade 1357 of the switch 1334 which is a single pole double-throw type. Switch 1334 is secured on frame plate 606 in any known manner. In normal position of the parts, center blade 1357 is conductively engaged with a blade 1358, and, upon operation of the center blade 1357, the center blade 1357 is disengaged from blade 1358 and it is conductively engaged with a blade 1359 of the switch 1334 for normally initiating the automatic justifying sequences of operations to be described later.

An insulator 1360 is secured on ball-lock interposer 1347 in any known manner, and it is situated in engaging alignment with a normally open switch 1361, which is secured on plate 606 in any known manner. Switch 1361 is in a restoring circuit, which includes the solenoid 1353 and which will be described later. At the moment, it is sufficient to know that the switch 1361 is closed by the insulator 1360 only when the interposer 1347 is in operated position for locking the keys on the keyboard.

From the above, it can be seen that upon returning the carriage 80 any amount over one unit and upon energization of solenoid 1337, as explained, the solenoid pulls link 1346 and thus rotates the interposer 1347 counterclockwise to operated position against tension of return spring 1350. At about the time the interposer 1347 reaches its operated position, the keyboard keys are locked against operation and the switch 1361 is effectively closed, the detent 1349 shifts counterclockwise under tension of spring 1350 to latch stud 1348 and interposer 1347 in operated position. At the detent 1349 shifts in its latching motion, the lever 1352 rotates counterclockwise therewith as explained. Whereupon, the insulator 1356 on the lever shifts the center blade 1357 out of engagement with blade 1358 and into engagement with blade 1359. Thus, when the solenoid 1337 is fully operated, the part of the carriage return circuit that passed through wire 1336 (FIG. 83), solenoid 1337 and wire 1338 is broken at blade 1358, and the circuit through wire 1332 and blade 1357 is shifted to blade 1359 for justifying purposes as will be explained.

The solenoid 1343 and the end of line tape control 166 will now be described. The end of line tape control 166 is included in an assembly 1362 (FIGS. 49 and 87), which is comprised of left and right frame plates 1363 and 1364 (FIG. 86), respectively, which in turn are secured to frame plate shelf member 9 (FIGS. 1 and 49) in any known manner. Frame plates 1363 and 1364 (FIGS. 87 and 88) are secured together as a unit by support members 1365, 1366 and 1367 secured at their ends to the plates, in any known manner, and likewise by support rods 1368 and 1369.

Solenoid 1343 (FIGS. 86 and 88) is secured on frame plate 1363 in any known manner. A link 1370 (FIG. 88) is pivotally connected to the armature of solenoid 1343 and to a member 1371. Member 1371, a sleeve 1372 (FIG. 86) and another member 1373 are secured together as a unit, which is pivoted on rod 1368. A torsion spring 1374 (FIG. 88) is anchored on a rod 1375, which is connected to and extends between frame plates 1363 and 1364 (FIG. 86). Torsion spring 1374 (FIG. 88) is connected to member 1371 for urging the unit 1371–1373 to be rotated clockwise as will be explained, it being stopped in operated position by engagement of a surface 1377 on member 1371 with the rod 1375.

A pair of insulators 1378 are secured on bifurcated upper ends of member 1371, and they embrace and thereby control a blade 1379 while insulating the blade 1379 from the member 1371. In the illustrated normal position of the parts, the insulators 1378 assure engagement of the blade 1379 with a blade 1380, and, when the unit 1371–1373 is rotated clockwise to operated position, the insulators 1378 disengage blade 1379 from blade 1380 and then they engage blade 1379 with a blade 1381. The blades 1379–1381 are secured together and insulated one from the other in any known manner to form a switch 1382. Switch 1382 (FIG. 86, 88 and 89) is supported on a bracket 1383, which is secured on plate 1363 as shown.

A pair of insulators 1384 (FIGS. 86 and 88), identical with insulators 1378, are secured on bifurcated upper ends of the member 1373. Insulators 1384 embrace a blade 1385 of a normally open switch 1386 (FIGS. 88 and 89), which is provided for controlling punching of the carriage return code (1, 2, 3, 7) by the main punch mechanism 161 as will be explained. The blade 1385 (FIG. 89) and blades 1387, 1388, 1389 and 1390 are secured together and insulated one from the other to form the switch 1386 which is insulated from and secured to a bracket 1381, all in any known manner. Bracket 1391 is secured on plate 1363 of the assembly. Upon clockwise rotation of the unit 1371–1373 (FIG. 88), the blade 1379 is first disengaged from blade 1380, and then it is engaged with blade 1381 and, at this later time, the blade 1385 is engaged with blades 1387–1390 (FIG. 89), whereafter the surface 1377 (FIG. 88) engages rod 1375 in full operated position of the unit. The circuits through switches 1382 and 1386 (FIG. 83) will be described presently.

A stud 1392 (FIG. 88) is secured on the lowermost end of member 1371, and it normally overlies a pawl 1393 and holds the pawl in unlatched position as shown. Pawl 1393 is pivoted on the lower end of a member 1394, which is pivoted near its center on a stud 1395 secured on plate 1363. A contractile spring 1396 is anchored on plate 1363 as at stud 1397, and it is connected to pawl 1391 at stud 1398 situated below the pivot of the pawl so as to urge the pawl clockwise against the stud 1392, to urge the pawl leftward and thus to urge the member 1394 clockwise to the illustrated normal position where it rests against a stop stud 1399 secured on plate 1363 as shown. An insulator 1400 is secured on the upper end of member 1394, and it is aligned for closing a normally open switch 1401 upon counterclockwise operation of the member 1394 as will be explained.

Upon return of the carriage 80 and energization of solenoid 1343 (FIG. 83) as described, the solenoid 1343 pulls link 1370 (FIG. 88) rotating the unit 1371–1373 clockwise against the tension of spring 1374. At about the time the switch 1382 is shifted and switch 1396 is closed as described, the pawl 1393 latches on to stud 1392, under tension of spring 1396, and the unit 1371–1373 is then stopped by engagement of surface 1377 with rod 1375. At this point, switch 1382 being shifted, switch 1386 being closed and the pawl 1393 being latched on stud 1392, the end of line tape feed control 166 (FIG. 83) may be cocked for further automatic cycling control.

The circuit for controlling punching of the carriage return code (1, 2, 3, 7), by the main punch mechanism 161, resulting from closure of switch 1386 will now be described. This circuit originates in a source of power (S) and goes through a solenoid 1402 in the carriage return circuit breaker 1341. The circuit continues through a wire 1403 and the now closed switch 1386, all connected in circuit as indicated. The closed switch 1386 transmits the current from the blade 1385 (FIG. 89) through the blades 1387–1390, and respectively connected wires 1404–1407 (FIG. 83), which are also connected to related code channel punch wires and the respective solenoids in the main punch mechanism 161 for punching the carriage return code (7, 3, 2, 1) (1, 2, 3, 7). The ground circuit from the main punch solenoids now, normally, travels through wires 162 and 163, the switch 164 in normal condition, wire 165 and it goes to ground through the now shifted switch 1382. Since the switch 1382 is shifted at this time as explained, the carriage return punch circuit does not pass through the wire 167 and the solenoid 168 and the forward tape control mechanism 169 is not cycled. It is not necessary for the just encoded carriage return punch holes to be shifted out of the main punch mechanism 161 at this instant, since the control tape 577 is about to be shifted forwardly through the punches 161 an end of line amount which is sufficient to permit the carriage return code to enter the main reader M.R. (FIG. 38) as will be described.

The carriage return circuit breaker 1341 (FIG. 83) will now be described. The solenoid 1402 is secured on support member 1365 (FIG. 90). A link 1408 is pivotally connected to the armature of the solenoid 1402 and to a member 1409 which is pivotally mounted on rod 1368. A torsion spring 1410 is anchored on rod 1375, and it is connected to member 1409 for normally urging the member counterclockwise against rod 1375 as shown. A stud 1411, secured on the lower end of member 1409, normally overlies a surface 1412 on a triggerable member 1413 for thereby holding triggerable member 1413 in its counterclockwise position against tension of a torsion spring 1414. Spring 1414 is connected to triggerable member 1413, and it is anchored on a rod 1415 which is secured at its ends on plates 1363 and 1364 (FIG. 86). A pair of insulators 1416 (FIG. 90) are secured on the upwardly extending arm of member 1413 and they are situated to normally hold the switch 1340 in closed condition as shown. Switch 1340 is secured on the support member 1367, so as to be insulated therefrom, in any known manner. A recocking solenoid 1417 is secured on support member 1366. A link 1418 is pivotally connected to the armature of solenoid 1417 and to the rightward arm of member 1413. The recocking solenoid 1417 is energized, as will be explained later, for rotating member 1413 counterclockwise against rod 1415 and thus for restoring the mechanism to the illustrated normal position.

Returning to operation of solenoid 1402, this pulls link 1408 and rotates member 1409 clockwise against rod 1375 and in opposition to spring 1410. Just prior to full clockwise operation of member 1409, the stud 1411 moves leftward of surface 1412 for permitting torsion spring 1414 to operate triggerable member 1413 clockwise a limited extent determined by engagement of a finger 1419 on triggerable member 1413 with the under side of stud 1411 then also in operated position. As triggerable member 1413 thus rotates clockwise, the insulators 1416 open the switch 1340 and this breaks the circuit through switch 1340 (FIG. 83), wire 1342 and solenoid 1343 in the line tape feed control 166.

When solenoid 1343 (FIG. 88) is thus deenergized, the torsion spring 1374 restores the unit 1371–1373 counterclockwise to its illustrated normal position. As the unit 1371–1373 is restored, it opens the carriage return code switch 1386 and restores the normal main punch ground circuit by restoring the switch 1382. Since the pawl 1393 is now latched onto stud 1392, as explained, the counterclockwise return of unit 1371–1373 pushes the pawl 1393 rightward against tension of spring 1396. Rightward movement of the pawl 1393 rotates member 1394 and causes the insulator 1400 to close switch 1401 for completing an end of line tape feed circuit. This circuit, derived from a source (S), goes through the new closed switch 1401 (FIG. 83), a wire 1420 and goes to ground through a solenoid 1421, which are connected in the line tape feed circuit. The energized solenoid operates an end of line tape feed mechanism 1422, the structure of which is shown in FIG. 91. This line tape feed mechanism 1422 operates the sprocket wheels 740 and 744 (FIG. 36), as will be explained, to feed the control tape 577 forwardly through the main punches 567 (FIG. 38) the equivalent of twelve steps in the exemplary embodiment, in one motion which is sufficient to permit entry of the just punched carriage return code into the main reader (M.R.) and which provides sufficient uncoded space on the control tape 577 to permit parting of the control tape 577 between lines without danger of destroying the codes for either a previous or succeeding line. At the conclusion of this end of line tape feed operation, a switch 1423 (FIG. 91) is closed, as will be described later. Closure of switch 1423 (FIG. 83) provides a ground for a circuit which travels from a source, goes through a solenoid 1424, a wire 1425 and the closed switch 1423.

Solenoid 1424 (FIG. 88) is secured on support member 1366, and a link 1426 is pivotally connected to the armature of the solenoid and to a member 1427 which is pivoted near its center on rod 1369. A torsion spring 1428 is anchored on rod 1415 and it is connected to member 1427 for urging the member clockwise to normally rest against stop stud 1429 as shown. The left end of member 1427 overlies stud 1398, but it is normally elevated from the stud, as shown, so as not to interfere with the previously described operations of the pawl 1393. However, when the line tape feed mechanism 1422 (FIG. 83) completes its operation and the switch 1423 is closed at this time as mentioned above, the solenoid 1424 is energized. Operation of solenoid 1424 (FIG. 88) pulls link 1426 and rotates member 1427 counterclockwise, against tension of spring 1428, until the member is stopped by rod 1415. As member 1427 is thus rotated, it engages stud 1398 in operated position and it unlatches pawl 1393 from stud 1392 which is now in its counterclockwise returned position as explained. As pawl 1393 is thus unlatched, the spring 1396 pulls pawl 1393 leftward and rotates member 1394 back against stud 1399, and this permits switch 1401 to open. As switch 1401 (FIG. 83) opens, the solenoid 1421 is deenergized for return of line tape feed mechanism 1422 as will be explained further.

The structure of switch 1330, in the forward tape cycling mechanism 169, will now be described. Switch 1330 (FIGS. 51 and 53) is secured on a bracket 1430, which is secured on plate 673 (FIG. 50) in any known manner. Normally open switch 1330 (FIG. 53) is aligned with an insulator 1431, which is secured on a member 1432. Member 1432 is pivoted on the rod 675, and it is urged counterclockwise by a torsion spring 1433 which is connected to the member 1432 and anchored on rod 681. Normally, a pin 1434 secured on member 1432 is stopped against the bellcrank 679 as shown in FIGS. 51 and 52.

From the above it can be seen that operation of the solenoid 168 and clockwise operation of bellcrank 679, as described, will push pin 1434 rightward and it will thus rotate member 1432 (FIG. 53) clockwise against tension of spring 1433. However, this clockwise rotation of member 1432 will occur upon only the first operation of solenoid 168 (FIG. 51), which operation occurs upon the first encoding operation for a given line, since the member 1432 is held in operated position for the duration of the line. To this end, member 1432 is equipped with a notch 1435 (FIG. 53), situated to cooperate with a pawl 1436, for holding the member 1432 in operated position. Pawl 1436 is pivoted on rod 676 and it is urged clockwise against member 1432 by a torsion spring 1437 which is anchored on stop rod 688 and connected to the pawl 1436. Pawl 1436 is equipped with an insulator 1438, which is aligned with a normally open switch 1439 secured on bracket 692. The arrangement is such that operation of solenoid 168 (FIG. 51), bellcrank 679, stud 1434 and member 1432 closes switch 1330, permits pawl 684 to latch on to pin 682, and permits pawl 1436 to rotate clockwise under tension of spring 1437 (FIG. 53) as the pawl 1436 latches into notch 1435. As the pawl 1436 latches into the notch, the insulator 1438 is swung leftward closing the switch 1439. Just after the switch 1330 is closed, after the pawl 1436 latches the member 1432 in operated position and switch 1439 is closed, and after the pawl 684 (FIG. 51) latches on stud 682, a surface 1440 (on member 1432) engages the rod 681 for limiting the described operation of the solenoid 168.

A clearing solenoid 1441 is provided for restoring the switches 1330 and 1439 to normal open condition when justifying encoding for a line is complete, as will be explained later. However, the structure and operation of the solenoid will be explained now. Solenoid 1441 is secured to plate 673 (FIG. 50) in any known manner. A link 1442 (FIG. 53) is pivotally connected to the armature of solenoid 1441 and to the pawl 1436. Operation of solenoid 1441 pulls link 1442 and returns pawl 1436 against tension of spring 1437, until the pawl 1436 is stopped against rod 688. At which time, switch 1439 is opened and pawl 1436 is lifted out of notch 1435 for permitting return of member 1432, and thus switch 1330 is opened. In this manner, the normal forward tape cycling mechanism is restored upon operation of solenoid 1441.

The structure of the end of line tape feed mechanism 1442 (FIG. 83), including solenoid 1421 and switch 1423 will now be described. The solenoid 1421 (FIG. 36) and the switch 1423 are secured to the punch assembly frame plate 555, in any known manner. A link 1443 (FIG. 91) is pivotally connected to the armature of solenoid 1421 and to a member 1444. Member 1444 is pivoted on a stud 1445, which also extends through a hole therefor in a support member 1446 and which is secured on a gear segment 1447. A contractile spring 1448 is connected to the member 1444 for uring the member clockwise about its pivot. The contractile spring 1448 is anchored on a stud 1449 (FIG. 36) secured on plate 555. Spring 1448, acting on member 1444 (FIG. 91) and on a stud 1450, shifts pivot 1445 downward to the segment disengaged position shown. The stud 1450 is secured on plate 555 (FIG. 36). Member 1446 (FIG. 91) is pivoted on a rod 1451, which is secured between plates 555 and and 556 (FIG. 36) in any known manner. A finger 1452 (FIG. 91) on member 1446 coacts with the stud 1450 to limit the disengagement operation. A torsion spring 1453 is connected to member 1446 and to plate 555 (FIG. 36) for urging the member 1446 clockwise from the illustrated position and for engaging segment 1447 (FIG. 91) as will be explained. A contractile sagment return spring 1454 is connected to segment 1447 for urging the segment clockwise to normal position shown, where a finger 1455 on the lower end of segment 1447 engages a stop 1456. Another finger 1457 is provided for engaging the stop 1456 for limiting the counterclockwise rotation of segment 1447 in operated position. Spring 1454 is anchored on a stud 1458, which is like stud 1449 (FIG. 36) and which is likewise secured on plate 555. A stud 1459 (FIG. 91) is secured on segment 1447, and it is situated in engaging alignment with a surface 1460 on member 1444. Normally, the surface 1460 stands in spaced relation from the stud 1459, as shown, to provide a certain amount of movement of the member 1444 before the stud 1459 and segment 1447 are moved thereby as will be explained more fully.

The lower end of segment 1447 is guided between a pair of washers 1461 and 1462 that are secured on either side of the stop 1456. The stop and the washers are secured on a stud 1463, which in turn is secured in any known manner on plate 555 (FIG. 36). The segment 1447 (FIG. 91) is so guided by the washers 1461 and 1462 and it is so carried by member 1446 that teeth 1464 on the segment 1447 are in engaging alignment with the teeth of a gear 1465.

Gear 1465 (FIG. 36) is secured on a hub 1466, which is secured on the shaft 739 so as to rotate therewith. Thus, the gear 1465 and hub 1466 rotate with and may be operated for rotating the shaft 739, gear 717, hub 738, sprockets 740 and 744, hub 743 and gear 742 a plurality of increments for shifting the control tape 577 accordingly.

An insulator 1467 (FIG. 91) is secured on the lower end of segment 1447 for closing the switch 1423 upon full counterclockwise operation of the segment 1447. At about the time switch 1423 is closed, when the segment 1447 is engaged with gear 1465 and when the segment is fully operated, a tab 1468, secured on the segment 1447 latches under a pawl 1469 for detaining the segment in operated position during disengagement of the segment 1447 from the gear 1465 as will be explained. Pawl 1469 is pivoted on a shouldered bolt and nut arrangement 1470, which is secured on plate 555 (FIG. 36). The pawl is urged clockwise to normally rest on a stop stud 1471 (FIG. 91), which is secured on plate 555 (FIG. 36). A torsion spring 1472 is anchored on plate 555 and it is connected to pawl 1469 for urging the pawl clockwise (FIG. 91).

The arrangement is such that, upon operation of solenoid 1421, link 1443 is pulled for rotating member 1444 away from stud 1450, and this permits spring 1453 to rotate member 1446 clockwise for raising pivot 1445, member 1444 and segment 1447 to radially engage teeth 1464 with gear 1465. Thus, the segment 1447 and gear 1465 are fully engaged before the segment is rotated to drive the gear. At the time teeth 1464 are properly meshed with the gear 1465, a finger 1473 on support member 1446 engages stud 1450 to maintain running clearance between the engaged teeth. At about the time the teeth are engaged as described, the surface 1460 engages stud 1459 for thereafter rotating the segment 1447 together with the member 1444, against the tension of spring 1454. This counter-clockwise rotation of the segment rotates the gear 1465 clockwise for accordingly rotating the shaft 739, and the sprockets 740, 477 (FIG. 46) to advance the control tape 577 (FIG. 38) through the main punches 567 sufficiently for the just punched carriage return code to be permitted to enter the main reader M.R. which is located at station MR and which will be described later. However, prior to feeding of this amount of tape 577 through the justifying punches 2046 and 2047 as will be described, the tape 577 fed through the main punches 567 is accummulated in loop 753 as previously described. At any rate, it can be understood that the tape 577 fed through the main punches 567 following carriage return is fed sufficiently for the last code to reach the main reader M.R. for controlling the reproducing machine, so the reproducing machine can complete its work regardless of whether or not the composing machine is operated further for encoding succeeding lines.

At about the time switch 1423 (FIG. 91) is fully closed by insulator 1467 and the finger 1457 engaged stop 1456, the tab 1468 latches leftward of a nib 1474 on pawl 1469 for preventing direct return of segment 1447 at the end of the operation. Closure of switch 1423 causes solenoid 1424 (FIG. 83) to be operated for opening switch 1401 as described. When switch 1401 opens, solenoid 1421 is deenergized to permit restoration of end of line tape feed mechanism 1422.

Deenergization of solenoid 1421 (FIG. 91) permits the tension of spring 1448 and the inherent leverage of member 1444 to act on stud 1450 and to shift the pivot 1445 downward. Pivot 1445 thus shifts segment 1447 radially away from gear 1465 and returns member 1446 counterclockwise against tension of spring 1453. Initially, in the return operation, the pawl 1469 and the latched tab 1468 prevent spring 1454 from restoring the segment 1447 until the teeth 1464 are disengaged from the gear 1465. Thus, the segment and spring 1454 are prevented from possibly turning the gear 1465 reversely during this return operation. However, as soon as the spring 1448 and member 1444 have shifted the segment 1447 and teeth 1464 clear of the teeth on gear 1465, the tab 1464 is shifted clear of nib 1474, thus permitting the spring 1454 to restore segment 1447 clockwise to the position shown, where switch 1423 is open and finger 1455 is arrested by stop 1456.

When switch 1423 is permitted to open, the solenoid 1424 (FIG. 83) is deenergized to permit restoration of member 1427 (FIG. 88), away from stud 1398 and against return stop 1429 under tension of spring 1428. Thus, restoration of the end of line tape control is complete.

22. SECONDARY LINE TERMINATING CIRCUIT

The secondary line terminating circuits may be taken to include all of the justifying encoding and restoring circuits that may operate automatically upon return of the carriage. However, only the simplest of such terminating circuits will be described now and such further circuitry will be expanded under other headings hereinafter.

The secondary line terminating circuit to be described now will only be effective when the line has not progressed into the justifying area near the right margin or when no word spaces have been counted; which situations are common, for example, when a paragraph is concluded midway in a line, or after the first word in a line, respectively.

The instant circuit includes a wire 1475 (FIG. 92) connected between the blade 1359 of switch 1334 and a pair of interconnected contacts 1476 and 1477 of a switch 1478 under a line delete key 1479 to be described. For the present, it is sufficient to know that the contact 1476 is normally conductively connected with a contact 1480 by a blade 1481. A wire 1482 is connected between contact 1480 and an amount left in the line measuring mechanism 1483 to be described later. In normal condition of amount left in line measuring mechanism 1483, the circuit through wire 1482 is directed by the amount left in line measuring mechanism 1483 to a wire 1484, as will be described for avoiding justifying operations. The amount left in line measuring mechanism 1483 remains in normal condition, until a line has progressed into the justifying area near the right margin. When the line has progressed into the justifying area, the amount left in line measuring mechanism 1483 will direct the circuit from the wire 1482 through an appropriate one of 23 wires 1485 for controlling a computing an justifying encoding mechanism to be described later. The other end of wire 1484 is connected to a tape feed control switch means 1486 for controlling tape handling mechanism to feed the encoded tape 577 for the text of the line through the justifying punches 2046, 2047 as will be described. A wire 1487 is connected between the tape feed control switch means 1486 and the clearing solenoid 944, provided for clearing the word space counter 850 as previously described. A wire 1488 is connected between the solenoid 944 and the clearing solenoid 1010 in the amount left in line measuring mechanism 1483. The solenoids 944 and 1010 are operated to clear the word space counter 850 or the amount left in line measuring mechanism 1483, respectively, when the line has not extended into the justifying area or there has been no spaces counted respectively.

This circuit normally continues from solenoid 1010, through the wire 1011, switch 1012 in normal condition and wire 1013. However, at this time, the solenoid 1014 and wire 985 will not be effective since the keys are locked against operation and delete key 140 and switch 968 are not operated. The circuit does continue via a wire 1489 which is connected between the wire 1013 and the contact 208 (FIG. 15). Normally, as described, the blade 204 conductively connects the contacts 208 and 209, and the presently discussed circuit passes therethrough. A wire 1490 is connected between contact 209 and a solenoid 1491 (FIG. 92) in a clearing sequence control 1492, that is shown particularly in FIG. 93. Clearing sequence control 1492 is very similar to and operates the same as breaker 1341 (FIG. 90), described previously, and it is similar to a control shown in FIG. 94 to be described later. A wire 1493 (FIGS. 92 and 93) is connected between solenoid 1491 and a normally effective blade 1494 of a switch 1495. Switch 1495 is a single-pole double-throw switch, the center blade 1496 of which is grounded and blade 1496 is normally engaged with blade 1494, as shown, for completing the circuit. Upon operation of solenoid 1491, the blade 1496 is shifted away from blade 1494, for breaking the just described circuit, and it is engaged with another blade 1497 of switch 1495 for completing a restoring circuit as will be explained later.

When there are no word spaces counted at the time switch 1334 (FIG. 92) is shifted as described, there will be no justifying and the circuit will include a space counter zero circuit that will parallel the above described zero circuit where it passes through the amount left in line measuring mechanism 1483. This zero space counter circuit will now be described. A wire 1498 is connected between the wire 1482 and a zero contact 1499 (FIG. 64), which is secured on the commutator contact insulator 880 in the word space counter 850. A matching contact 1500, on the insulator 880, is normally conductively connected with the zero contact 1499 by a blade 1501 (FIG. 63), which is supported by an insulator 1502 secured to the blade 1501 and to the member 877. Thus, in normal zero representing position of member 877, the brush 1501 is engaged only with the contacts 1499 and 1500 (FIG. 92) for conducting current therebetween. A wire 1503 is connected to the contact 1500 and to the wire 1484. Thus, when no word spaces are counted and the secondary line terminating circuit occurs as explained, the circuit is complete between wires 1482 and 1484, via wire 1498, zero contact 1499, brush 1501 (FIG. 63), contact 1500 (FIG. 64) and wire 1503 (FIG. 92), regardless of the condition of the amount left in line measuring mechanism 1483.

23. LEFT MARGIN ADJUSTMENT

An adjustable left margin means is provided for arresting the rightward traverse of the carriage in any preselected one of a plurality of returned positions, and an adjustable right margin means is provided for differentially locking the test composing keys to prevent their characters or spaces from overrunning the right margin. The margin means are manually adjustable to different lateral positions for providing various column positions and widths. The various positions of the margin means are arranged to always provide a column width that is evenly divisible by 0.025", which is one unit as described.

The left margin stop 1504 (FIG. 3) comprises primarily a frame block 1505 (FIGS. 95, 96 and 97), a detent 1506, the transverse rail 87, a pointer 1507 (FIGS. 3 and 97), and a bellcrank 1508 (FIG. 95). The frame block 1505 (FIGS. 95 and 97) is formed with a portion 1509 which extends rearward and which partially surrounds the transverse rail 87, forming a bearing thereon, to prevent pivoting of the frame block 1505 about its major support sleeve 1510. The frame block 1505 is thus supported to be manually adjustable leftwardly or rightwardly on the transverse rail rod 87 and sleeve 1510, from one margin position to another.

The transverse rail 87 is secured, at its ends in any known manner, to the typewriter frame 15 (FIG. 95) as previously explained. The sleeve 1510 is similarly secured at its ends to frame 15, so as to be solid therewith.

Transverse rail 87 has ratchet teeth 1511, the vertical portions of which are differentially engageable by detent 1506, for controlling the lateral positions of this margin stop 1504.

Detent 1506 is pivoted on a pivot bolt 1512 (FIG. 97), which is secured in a threaded hole therefor in the bottom of frame block 1505. A small expansive spring (not shown) is held in counter-bored holes 1513 in the detent 1506 and frame block 1505 for urging the detent into engagement with the teeth 1511 (FIG. 95) on transverse rail 87.

The pointer 1507 (FIGS. 96 and 97) is secured on the front of frame block 1505 as by screws 1514, and it extends upwardly in front of a graduated scale 1515 (FIG. 3) for indicating the left margin position. The graduated scale 1515 is secured on the machine's cover in a customary manner.

The stop 1504 may be adjusted by gripping a forwardly extending knob 1516 and a tab 1517. Knob 1516 is part of the detent 1506 (FIGS. 96, 97) and the tab 1517 is part of the pointer 1507 as shown. As the knob is pressed toward the tab, the detent 1506 rotates about pivot bolt 1512 (FIG. 97) and withdraws the detent 1506 from the teeth 1511 (FIG. 95), whereupon the stop 1504 may be shifted in the customary manner.

The carriage borne finger 88 (FIGS. 8 and 99) is situated to be stopped by a surface 1518 (FIGS. 95, 97) on frame block 1505 for limiting the return of the carriage at the left margin position in the usual manner. However, for restoring certain mechanism upon full return of the carriage, the finger 88 (FIG. 99) operates the bellcrank 1508 (FIG. 95) in the last bit of this carriage return movement. Approximately in the last unit (0.025") of carriage return, the carriage borne finger 88 (FIG. 99) contacts a nose 1519 (FIG. 95) on bellcrank 1508 and rotates the bellcrank clockwise about its pivot bolt 1520, which is secured on the frame block 1505. A light tensioned spring 1521 is connected to the bellcrank 1508 and it is anchored on a return stop 1522 that is fixed on block 1505. The spring 1521 is provided for normally holding the bellcrank 1508 against stud stop 1522 as shown. However, clockwise rotation of the bellcrank 1508 and a pin 1523, on the rightward arm of the bellcrank, shifts the pin forwardly for moving a horizontal bail rod 1524 forwardly in the machine. The bail rod 1524 is secured at its right and left ends on a lever 1525 and a lever 1526 (FIG. 1) respectively. Lever 1526 is secured on the left end of a rod 1527 and lever 1525 (FIG. 96) is integral with a hub 1528 secured on the right end of the rod 1527. The rod 1527 is rotatably mounted in the stationary sleeve 1510.

A depending lever 1529 is secured on the right end of hub 1528. Upon clockwise operation of bellcrank 1508 (FIG. 95), the pin 1523 pushes bail 1524 forward for rotating the lever 1525 (FIG. 98), hub 1528 and lever 1529 counterclockwise, and for operating a 'carriage return switch' as will now be described.

A torsion spring 1530 (FIGS. 95, 96 and 98) is connected to lever 1529 and it is anchored on plate 229 (FIG. 98) for normally holding the lever and rod 1527, bail 1524, etc. in normal clockwise position, in which the lever 1529 rests against a stud 1531 secured on plate 229. With this in mind, it can be seen that the spring 1521 (FIG. 95) and stud 1531 (FIG. 98) could be just as well omitted without altering the action of the parts. However, the use of spring 1521 (FIG. 95) is preferred to prevent any rattling of bellcrank 1508, while the stud 1531 (FIG. 98) normally provides a nominal running clearance between pin 1523 and bail 1524 (FIG. 95).

A stud 1532 (FIG. 98), secured on one arm of a bellcrank 1533, is assembled in the bifurcated lower end of lever 1529. Bellcrank 1533 is mounted on a pivot stud 1534, which is secured on frame plate 229. A contractile spring 1535 is connected on the end of stud 1532, and it is anchored on a stud 1536 secured on plate 229. An insulator 1537 is secured on another arm of bellcrank 1533, and it is aligned for engaging a compound switch 1538. Switch 1538 is actually comprised of two normally open switches 1539 and 1540 that are secured on plate 229 in any known manner. An insulation block 1541 is secured between the generally movable blades of the switches 1539 and 1540, so when one switch is closed by insulator 1537 the other switch is likewise closed. Also, when the insulator 1537 is snapped away from switch 1539, both switches are permitted to open.

From the above, it can be seen that return of the carriage and the carriage 80 borne finger 88 (FIG. 99) against the nose 1519 (FIG. 95) and the surface 1518, as explained, rotates bellcrank 1508 clockwise, presses pin 1523 against bail 1524 for moving the latter forward, and rotates levers 1525 and 1529 (FIG. 98) counterclockwise. This motion of lever 1529 moves stud 1532 rightward, rotating bellcrank 1533 clockwise. At about the time insulator 1537 contacts switch 1539, the centerline of spring 1535 moves to the right of pivot stud 1534 so that spring 1535 snaps the bellcrank 1533 fully clockwise for snap closing of the compound switch 1538 at about the time the carriage 80 is fully returned to the left margin.

In normal forward operation of the machine, when the carriage is again moved leftward, the carriage borne finger 88 (FIG. 99) is moved away from nose 1519 (FIG. 95) and the bellcrank 1508 is permitted to restore, while the spring 1530 (FIG. 98) returns the levers 1525 and 1529 clockwise to the positions shown. During this restoring action, the bail 1524 (FIG. 95) and bellcrank 1508 are not only restored, as shown, but the bellcrank 1533 (FIG. 98) is restored as shown for permitting the compound switch 1538 to open. From the above, it can be seen that the full carriage 80 return switch 1538 is closed only when the carriage is fully returned to the left margin stop 1504 (FIG. 3). Compound switch 1538 is closed for causing restoration of certain mechanisms after return of the carriage, 80 and these restoration operations will be discussed later.

24. ADJUSTABLE RIGHT HAND MARGIN MEANS

The right hand margin means in the composing machine is manually presettable for determining the right hand margin of the lines and thus the column. Actually, it is settable for determining the corresponding extent to which the line will normally be extended during automatic typing of the justified line in the justifying reproducer.

The right hand margin means indicates the absolute end of each line and therefore establishes a right margin. However, as the line is composed and the carriage approaches the end of the line, a portion of the right hand margin means is contacted by the carriage at 0.700" before the indicated end of the line and this portion is moved by the carriage, as the carriage moves, to transmit corresponding movement to the amount left in the line mechanism. This transmitted movement actuates the amount left in the line mechanism proportionally, as will be explained, to control the machine for proper encoding of justifying information. By the transmitted movement, the right hand margin means and therethrough the final movements of the carriage actuates the amount left in the line mechanism for representing the amount less than 0.600", that is 0.575" or less, corresponding to the final position of the carriage in respect to the setting of the right hand margin means and for accordingly controlling a dividing mechanism, which in turn controls the justifying encoding means.

The right hand margin means also actuates the amount left in the line mechanism 1483 for controlling differential key locks for locking 0.100" keys (such as M, W and numbers) when the carriage 80 is less than 0.100" from the indicated right margin, for locking 0.075" keys (a, b, c, etc.) when there is less than 0.075" left in the line, and for locking "0.050" keys (i, period, comma etc.) when there is less than 0.050" in the line. This statement holds true even though there are, in most instances, different sized characters for a key in upper and lower case, since the key locks are comprised of both upper and lower case locks which are appropriately rendered effective when a case shift is accomplished. Thus, the composing machine can never type and be operated to code for characters and spaces that would extend beyond the preselected position of the right hand margin means, as will be explained more extensively elsewhere in the specification.

The right hand margin means also actuates the amount left in the line mechanism 1483 for normally controlling a space at the end of a line preventing mechanism to operate step by step for each movement of the carriage 80 when there is less than 0.700" remaining in a line, and for normally controlling the space at the end of a line preventing mechanism 2306 to record occurrence of 4 unit nut spaces when there is less than 0.700" in the line, to record 3 unit nut spaces when there is less than 0.675" in the line, and to record 2 unit nut spaces and 2 unit word spaces when there is less than 0.650" in the line.

Thus, as expressed in different terms above, the right hand margin means is presettable to indicate the margin, thereupon to be operated by the carriage 80 to correspondingly actuate the amount left in the line mechanism 1483 for registering the amount that is left in the justifying area for justifying encoding purposes for controlling the differential key locks and for rendering effective the space at the end of a line preventing mechanism, when the line extends near the right margin of the column and justifying encoding is to be effected.

The structure of the right hand margin adjustment means and the linkage for operating the amount left in the line mechanism will now be described.

A rod 1542 (FIG. 99), preferrably square in cross-section, is secured to the left and right sides of the typewriter frame 15 (FIGS. 100 and 95, respectively) in any known manner. A main adjustment means block 1543 (FIGS. 99, 100 and 101) is supported on the sleeve 1510 so as to be slidably adjustable therealong parallel to the path of carriage movement.

The upper part of the block 1543 extends rearward in the form of an extension 1544 (FIGS. 99 and 100) which serves as a bearing on the upper plane surface of rod 1542. A rightward portion of the lower edge of the adjustment means block extends rearward in the form of an extension 1545 (FIGS. 99 and 101) bearing upwardly on the lower plane surface of rod 1542. Thus, the extensions 1544 and 1545 and the rod 1542 serve to maintain the illustrated generally horizontal attitude of the block 1543, and they prevent the block from rotating on sleeve 1510, while they permit the adjustment means block 1543 to be adjusted along the sleeve.

A detent 1546 (FIG. 102) is pivotally mounted on block 1543 and it is adapted to engage notches 1547, in the forward face of the stationary rod 1542, for maintaining particular adjustment of the adjustment means block 1543 and thus the right margin means. The attitude of the notches 1547 and the detent 1546 are such that they positively prevent leftward movement of the block 1543 and yieldably prevent rightward movement of the block, when the detent is engaged with a notch, but the detent may be easily removed from a notch to permit adjustment of the margin means to another notch and corresponding right margin position.

A bolt 1548 (FIG. 99), having a head at its upper end and a shoulder portion immediately thereunder, is threaded into the upper extension 1544 and screwed down so that the shoulder is tight against the adjustment means block 1543. Bolt 1548 has a smooth pivot pin portion extending downward through the detent 1546 (FIG. 102) and extending through a hole therefore in the lower extension 1545 of the block. Thus bolt 1548 provides the pivot connection between the detent 1546 and the block 1543. A spring 1549, between the rearward wall of the block 1543 and the detent 1546 and being lodged in recesses therein, urges the detent 1546 clockwise into engagement with the aligned notch 1547 for normally holding the right hand margin means in the preselected position.

A manipulative lever 1550, integral with detent 1546, extends generally forward from the lower edge of the detent to facilitate counterclockwise pivoting of the detent out of engagement with a notch 1547. The lever 1550, together with a tab 1551, is also provided to aid in moving the right hand margin means transversely to the various margin positions.

A pointer 1552 (FIG. 99) is secured in any known manner to the adjustment means block 1543 and it extends upward to indicate the final margin line on the scale 1515, which is secured on the cover as explained. The lower end of the pointer 1552 is integral with the finger tab 1551 situated to the right of the manipulative lever 1550. The arrangement of the finger tab 1551 and the lever 1550 is such that by pressing the lever and the tab between his fingers the operator may easily disengage the detent 1546 (FIG. 102), as described, and move the right margin means to another margin position.

A slidable plate 1553 (FIGS. 99, 100 and 101) lies on the top plane surface of block 1543 and the extension 1544. The shoulder portion under the head of bolt 1548 and a corresponding portion of a bolt 1554, also threaded into the block extension 1544, are fitted into an elongated slot 1555 (FIG. 100) for guiding the plate 1553 while permitting the plate 1553 to be moved longitudinally from right to left and return in relation to the block 1543. The leftward end of the slot and the shoulder portion of the bolt 1554 serve also as a return stop for arresting the plate 1553 in the normal position shown, as when the carriage is returned after completion of a line and as the plate 1553 returns rightward as will be explained. The heads of the bolts 1548 and 1554, of course, serve to properly hold the plate down in position on its support surface. The extent of the slot 1555 is sufficient to permit the plate 1553 to be moved 0.700" (plus clearance) to the left from the position shown.

A lug 1556 extends upward from plate 1553 and a rightward surface 1557 of the lug is situated so as to be merely contacted by the carriage borne finger 88 (FIG. 99), on the carriage 80, when the carriage is 0.700" from the preselected right margin position indicated by the pointer 1552. As the machine is operated to continue the line and the carriage moves to less than 0.700" of the end of the line, the carriage borne finger 88 moves the lug 1556 and slides the plate 1553 directly therewith. Thus, the plate 1553 is positioned to indicate the position of the carriage 80, whenever the carriage is within 0.700" of the absolute end of the line.

The left end of plate 1553 (FIG. 101) extends downward, beyond and below the end of block 1543, and then it extends rightward. The lower rightward extension of the plate 1553 carries a pawl 1558, which is pivotally connected to the lowest surface of the plate 1553, as at 1559.

The pawl 1558 (FIG. 103) extends rightward from its pivot 1559, and normally it is hooked onto one of a plurality of lugs 1560 on a transversely slidable member 1561. The arrangement is such that the pawl 1558 is in contact with the rightward edge of a particular one of the lugs 1560 on the slide member 1561, when detent 1546 (FIG. 102) is engaged with a notch 1547 as shown and the right margin means is in a corresponding position as described and when the slide plate 1553 is in its normal rightmost position.

In the normal position of the parts as shown, an upstanding pin 1562 (FIG. 103), fixed on pawl 1558 to the right of pivot 1559, lies in front of the end of detent 1546 as shown in FIG. 102. A depending pin 1563 (FIG. 101), fixed on a forwardly and leftwardly extending arm of pawl 1558, serves to connect a spring 1564 with the pawl. The rightward end of the spring 1564 is anchored to the block 1543 as by depending stud 1565. The effect of the spring 1564 is to urge the pawl 1558 and the plate 1553 rightward to normal position and to urge pawl 1558 (FIG. 103) counterclockwise into engagement with slide member 1561. When the operator manipulates lever 1550 (FIG. 102) to pivot detent 1546 counterclockwise for disengaging the detent 1546 from a notch 1547 in preparation for moving the right margin means as described, the end of the detent 1546 acts on the pin 1562 (FIG. 103) for pivoting the pawl 1558 clockwise out of engagement with slide member 1561, against the tension of spring 1564 (FIG. 101) so that the right margin means may be moved to another selected position without affecting the slide member 1561. Upon release of the lever 1550 by the operator, the spring 1549 (FIG. 102) returns the detent 1546 clockwise as explained and the spring 1564 (FIG. 101) returns the pawl 1558 counterclockwise as explained. Upon release of lever 1550, the operator should exert slight leftward pressure on the finger tab 1551 (FIG. 99) to assure that the right margin means is properly in the desired position where its detent 1546 (FIG. 102) is solidly lodged in the respective notch 1547.

The relatively situated notches 1547 and lugs 1560 (FIG. 100) are identically spaced and the distances therebetween may be any amount that is commensurated with a 0.025", which corresponds with one unit of measure as described.

From the above, it can be seen that the movement of the carriage 80 and the carriage borne finger 88 (FIG. 99), acting against lug 1556, is transmitted to the lug, the plate 1553 (FIG. 101), the pawl 1558 and the slide member 1561, whenever the carriage is within 0.700" of the absolute end of the line. In this manner, the final position of the carriage 80, in respect to the end of the line, is registered by the final position of the slide member 1561.

The slide member 1561 is assembled through clearance holes 1566 (FIGS. 1 and 104) in the left and right sides of the main typewriter frame 15, and it is slidably supported in identical bearing plates 1567 secured on both sides of the frame. Each bearing plate 1567 is accurately positioned as by two pilot pins 1568, fixed in the frame 15 and extending through locating holes therefore in the bearing plate 1567, and each plate is fixed to the frame as by screws 1569, for example.

The rightward end of the transverse slide member 1561 (FIG. 104) extends well beyond the typewriter frame 15 and it is equipped with means for connecting the slide means to the amount left in the line mechanism 1483, as will be explained.

25. AMOUNT LEFT IN LINE MECHANISM

As explained above, slide member 1561 is moved transversely leftwardly with the carriage 80, whenever the carriage moves within 0.700" of the right margin, which is determined by the preselected position of the right margin means. Thus the slide member 1561 is usually moved leftwardly to a position corresponding to the final position of the carriage 80, where the slide member 1561 is detained momentarily when the carriage is returned, as will be explained. The motion is transmitted into the Amount Left In the Line Mechanism 1483 by the linkage and motivating gearing shown primarily in FIGS. 104 and 105.

Near the rightward end of slide member 1561, a rack 1570 is secured to the slide member as by screws 1571 so as to be carried by the slide member and moved directly therewith. A gear segment 1572 is meshed with rack 1570 so as to be rotated counterclockwise, when slide member 1561 is moved leftwardly, and the slide member 1561 is returned rightward when the segment is rotated clockwise as will be explained.

Segment 1572 is fixed on the forward end of a sleeve 1573, which is pivotally mounted on the shaft 240 (FIG. 18). As explained previously, the shaft 240 is fixed on frame plates 236 and 237 of the assembly, which is adjustably set to properly mesh segment 1572 and the rack 1570 (FIG. 104) and which adjustment is properly determined by adjustment screw 230 (FIG. 18).

The rearward end of sleeve 1573 carries a lever 1574 fixed thereto for rotation therewith. A gear segment 1575 is pivotally mounted on rearward extension of the sleeve 1573 and it is clamped to the lever 1574 by adjustment bolt and nut arrangement 1576 so as to be rotated directly with the lever. The adjustment bolt and nut arrangement 1576 (FIG. 105) permits angular adjustment of the segment 1575, in relation to lever 1574, so that the segment may be set in normal position at the same time the lever 1574, segment 1572 (FIG. 104), rack 1570, slide member 1561 and the margin means (described previously) are also in normal rest position.

Once the adjustment nut and bolt arrangement 1576 (FIG. 105) is set to properly lock the segment 1575 to the lever 1574, the segment 1575 will be moved to correspond to the position of the carriage 80, whenever the carriage is within 0.700" of the right margin. To this end, when the carriage moves to less than 0.700" of the right margin, the member 1561 (FIG. 104) is shifted leftward accordingly as explained, moving rack 1570 leftwardly and rotating the segment 1572, sleeve 1573 (FIG. 105) and segment 1575 counterclockwise, each from normal 0.700" representing position to a position representing the position of the carriage. The segment 1575 has a noticeably larger radius than segment 1572 (FIG. 104) so that the per unit movement at the pitch line of segment 1575 (FIG. 105) is significantly larger than the 0.025" per unit movement of the carriage and the identical movement of the segment 1572 (FIG. 104) at its pitch line. This makes it possible for the amount left in line mechanism 1483, operated by the segment 1575 (FIG. 105), to properly distinguish between adjacent operated positions of the segment 1575 and the right margin means operated directly by the carriage 80.

The segment 1575 is meshed with a gear 1577, which together with a ratchet wheel 1578 are fixed on the rearward end of a sleeve 1579 for rotation therewith. A rotary switch blade support lever 1580 (FIG. 106) is fixed on the forward end of the sleeve 1579 (FIG. 18) so as to rotate and be positioned as a unit with the sleeve 1579, gear 1577 and ratchet wheel 1578.

A torsion spring 1581, assembled about shaft 239, is connected at its rearward end to the lever 1580 (FIG. 106) for urging the unit consisting of the lever 1580, the sleeve 1579 (FIG. 105), gear 1577 and ratchet wheel 1578 counterclockwise to the normal returned position shown. When the carriage 80 is returned and the slide member 1561 (FIG. 104) is thus permitted to be returned, and when return of ratchet wheel 1578 (FIG. 105) is permitted by release of its detent means as will be explained, the spring 1581 (FIG. 106), as explained, returns gear 1577 (FIG. 105) counterclockwise and the segment 1575, lever 1574, sleeve 1573, segment 1572 (FIG. 104) clockwise and thus returns the slide member 1561 rightward to normal rest position. The forward end of spring 1581 (FIG. 18) is anchored, in any well known manner, as by being hooked into a hole 1582 (FIG. 17) in the contact support plate 271.

A return stud 1583 (FIGS. 18 and 105), for controlling the return position of the just described mechanism, is fixed on the rearward face of ratchet wheel 1578. The stud 1583 is normally urged counterclockwise against a depending arm 1584 (FIG. 107), fixed on the forward end of a sleeve 1585. Sleeve 1585 is mounted on shaft 239. A switch blade support member 1586 is also secured to the sleeve, a bit to the rear of arm 1584, and the unit formed of arm 1584, sleeve 1585 and member 1586 is normally pressed counterclockwise by stud 1583 to normal return position, where a lower portion of member 1586 is stopped against a return stop 1587. Thus, the return stop 1587 determines the normal at rest position of the entire rotatable portion of the amount left in the line measuring mechanism 1483. The return stop 1587 (FIG. 18) is secured on the forward face of frame plate 237, in any known manner.

A torsion spring 1588, connected at its forward end to member 1586 and at its rearward end to frame plate 237 in any known manner, normally urges the member 1586 (FIG. 107) clockwise against stud 1583. However, the spring 1588 is lighter in tension than the return spring 1581 (FIG. 106), but it is sufficiently strong to rotate the unit consisting of member 1586 (FIG. 107), sleeve 1585 and arm 1584 followingly clockwise in a forward direction of operation, when the stud 1583 and the ratchet wheel 1578 (FIG. 105) is so operated as explained.

From the above, it can be seen that when the ratchet wheel 1578 is rotated clockwise, from normal 0.700" representing rest position as explained, the stud 1583 is swung clockwise and the unit 1584–1586 (FIG. 107) is rotated accordingly clockwise from normal rest position under tension of spring 1588. As the carriage moves closer to the end of the line, the member 1586 turns clockwise only until it reaches 0.625" representing position, at which time the lower extension of member 1586 comes to rest against stationary spacer 1589, which will be described fully hereinafter. At times when the carriage 80 is moved closer to the end of the line, the stud 1583 merely moves farther clockwise and away from the arm 1584, and the member 1586 remains at its 0.625" representing position. When the stud 1583 is again returned counterclockwise as explained, the stud returns the mechanism counterclockwise to the normal position, where the depending extension of member 1586 is stopped by stud 1587 as shown.

At this point it might be helpful to mention that the switch blade or brush support lever 1580 (FIG. 106) at its illustrated upper end carries switch blades, which are adapted to press forwardly against the rearward face of a contact support plate 1590 (FIG. 18) to be explained more fully hereinafter and as shown. The lower end of lever 1580 (FIG. 106) carries switch blades, which are adapted to press rearward against the forward face of a contact support plate 1591 (FIG. 18). Both ends of lever 1586 (FIG. 107) carry switch blades or brushes, which press rearward against the forward face of a contact support plate 1592 (FIG. 18) and which together with the contacts are part of the commutator portion 824 (FIG. 59) that is incorporated with commutator means 146 (FIGS. 11 and 18) as previously mentioned. The specific structure and significance of these switch blades and the contacts will be more fully described hereinafter. However, the manner in which these support plates are secured in the assembly will now be described.

The contact support plate 271 (FIG. 17), previously mentioned in connection with the justifying on-off key; the plate 1590 (FIG. 108), plate 1591 (FIG. 109) and plate 1592 (FIG. 110), just mentioned hereinabove in connection with the amount left in the line measuring mechanism 1483 now specifically under discussion; and the commutator contact insulator 880 (FIG. 64) described more particularly in connection with the word space counter control circuits are all secured in the machine, respectively, from front to back in positions shown clearly in FIG. 18. These plates 271, 1590, 1591, 1592 and 880 are supported on three horizontal rods 1593, 1594 and 1595 (FIG. 17), which are secured in holes therefore in the plates and in the frame plate 236 (FIG. 18) and frame plate 237 in any well known manner. Suitable spacers such as spacers 1596, assembled on the rods between the contact plates and the frame plates, maintain the contact plates in their proper spaced relation shown in FIG. 18. The sleeve spacer 1589 (FIG. 107) is similar to spacers 1596, as well as serving as a stop for member 1586 as previously described.

A shorter horizontal rod 1597 (FIG. 18) is secured to the frame plate 236 and it extends rearward through the upper left hand corners of contact plates 271 (FIG. 17), 1590 (FIG. 109) with spacers thereon and between the plates for holding the corners of these contact plates. Another short rod 1598 (FIG. 110) extends through frame plate 237 (FIG. 18), and, together with suitable spacers thereon in front of and behind the frame plate 237 secures the upper lefthand corners of contact plates 1592 (FIG. 110) and 880 (FIG. 64) to the frame plate 237. The short rods are generally axially aligned, but they are sufficiently short to avoid the area in which the gear segment 1575 (FIGS. 18 and 105) operates and thus they do not obstruct counterclockwise and clockwise operation of the segment. Thus, the contact plates 271 (FIG. 18), 1590, 1591, 1592 and 880 are held rigidly in place as shown.

The contact support plate 1592 and its switch blade support member 1586, which are included in the previously mentioned commutator portion 824 (FIG. 59), is the first controlling arrangement to become effective in the amount left in the line measuring mechanism, when the carriage approaches the right hand margin. The commutator portion 824 is provided for controlling a means for preventing termination of a justifiable line when a word space, nut space or an underline mark is the last thing encoded in a line, as will be described later under an appropriate heading. However, the structure of commutator portion 824 will now be described.

An insulator 1599 (FIG. 107) is secured on the upper arm of member 1586 as by rivets 1600. Another insulator 1601 is secured on the lower arm of member 1586 as by rivets 1602.

The arrangement of brushes and contacts for controlling forward direction operations of a pin carrier 2318 in a space or underline at the end of a line preventing mechanism 2306 will be explained, now. Interconnected contacts 1603, 1604, 1605 and 1606 (FIG. 110) on the plate 1592 are situated to be engaged by a brush 1607 (FIG. 107) secured to insulator 1601, when the lever 1586 is in its 0.700", 0.675", 0.650" and 0.625" positions, respectively, indicated in FIG. 110. Brush 1607 (FIG. 107) is connected to a brush 1608 by a wire 1609 for conducting current from one brush to the other. Brush 1608 is secured to insulator 1599 and it extends to normally be engaged with a contact 1610 (FIG. 110), on plate 1592, when the lever 1586 (FIG. 107) is in its normal 0.700" at-rest position. Upon clockwise operation of member 1586, the brush 1608 disengages from contact 1610 (FIG. 110) and it successively engages interconnected contacts 1611, 1612 and 1613 as the stud 1583 (FIG. 107) and the carriage, as explained, assumes the 0.675", 0.650" and 0.625" positions, respectively.

This arrangement of contacts and brushes 1603–1613 (FIGS. 110 and 107) is provided for conducting current for performing forward operations of a pin carrier wheel 2318, and for rendering operable forward step-by-step operations of the space or underline at the end of a line preventing mechanism 2306 only after the line has progressed to less than 0.700" from the right margin. The space at the end of a line preventing mechanism 2306 will be described later under an appropriate heading.

The arrangement of brushes and contacts for controlling reverse, or delete, operations in the space or underline preventing mechanism 2306 will now be described. Interconnected contacts 1614, 1615, 1616 and 1617 (FIG. 110) on plate 1592, brush 1618 (FIG. 107) and brush 1619 on insulator 1599, and a wire 1620, interconnecting the two brushes; and contact 1621 (FIG. 110) and interconnected contacts 1622, 1623 and 1624, on plate 1592 in positions corresponding to 0.700", 0.675", 0.650" and 0.625", respectively, for the reversing circuits, are arranged similarly to those for forwarding circuits that were just described above. The reversing circuits are not effective during forward operation, but they become effective upon depression of the delete key 140 (FIG. 11) for automatic back spacing as explained elsewhere herein.

The commutator portion 824 (FIG. 59), involving the space keys 760–763, the underline key 19 and their four channel code bits as mentioned previously, is shown schematically here in FIG. 58, and its details are included in FIGS. 107 and 110. The commutator 824 (FIG. 59) is used for controlling prevention of the occurrence of a space or an underline mark at the end of a justified line and the involved circuitry will be described later in connection with the feature. However, the structural details of this commutator portion 824 of the amount left in the line mechanism 1483 will now be described.

The wire 835, leading from the relay 817, is joined by the underline key wire 136 (FIG. 11), and contacts 1625, 1626, 1627 and 1628 (FIG. 110) mounted on insulating support plate 1592.

Normally, as described, member 1586 (FIG. 107) is situated as shown. A bifurcated brush 1629 is secured on insulator 1601 and, in normal position of member 1586, the brush 1629 is in engagement with contact 1628 (FIG. 110) and also with a contact 1630 on support plate 1592. Contact 1630 is connected by the wire 836 (FIG. 59) leading to the four channel code punch wire and the four channel main punch solenoid 565-4 as described. Thus, normally, when the four unit space key 763 or the underline key 19 is utilized, its circuit passes through wire 835 (FIG. 110), contact 1628, brush 1629 (FIG. 107) contact 1630 (FIG. 110) and through wire 836 to the four channel main punch solenoid for punching the four channel code bit and for completing the code for the four unit space key 763 or the underline key 19, as the case may be. However, when the carriage 80 stands at less than 0.700" (0.675" or less) and four unit space key 763 is operated, the carriage will be advanced to within the justifying area (less than 0.600") and the circuit must be altered to record the occurrence of this space, as will now be described. The four channel circuit is also altered in the same manner to record the occurrence of an underline mark, which extends 0.100" and will extend into the justifying area under this condition, even though the carriage is not moved following the printing and encoding for the underline.

When the carriage 80 stands at 0.675", 0.650" or 0.625" and less, the member 1856 (FIG. 107) is in a corresponding position, one, two or three clockwise steps, respectively, from normal position as described, and the brush 1629 is engaged with a contact 1631 (FIG. 110), 1632 or 1633, respectively, on support plate 1592. The contacts 1631, 1632 and 1633 are interconnected and collectively connected by a wire 1634 to a space recording circuit to be described later.

The three unit space key four channel code bit circuit is directed through wire 830 (FIG. 59) to the commutator portion 824 as described. The wire 830 (FIG. 110) is connected to interconnected contacts 1635, 1636, 1637 and 1638 on insulator 1592. A bifurcated brush 1639 (FIG. 107) is carried by insulator 1601 on lever 1586. Normally, brush 1639 engages contact 1638 (FIG. 110) and a contact 1640 on support plate 1592. A contact 1641 on support plate 1592, located on step clockwise from contact 1640, is interconnected with contact 1640. Interconnected contacts 1642 and 1643 are located two and three steps, respectively, from contact 1640, on plate 1592. The arrangement is such that the bifurcated brush 1639 (FIG. 107) is engaged with contacts 1638 and 1640 (FIG. 110), respectively, under the normal condition when the carriage has not moved closer than 0.700" from the right margin and the member 1586 (FIG. 107) is in normal position against stop 1587 as described. As the carriage 80 moves closer to the end of the line and member 1586 is moved clockwise accordingly as explained, the brush 1639 engages contacts 1637 and 1641 (FIG. 110) at the 0.675" position, it engages contacts 1636 and 1642 at the 0.650" position, and it engages and remains engaged with contacts 1635 and 1643 at 0.625" position and, as the carriage moves even closer to the right margin and member 1586 (FIG. 107) is stopped against spacer 1589 as previously described.

The interconnected contacts 1640 and 1641 (FIG. 110) are connected by a wire 831 (FIG. 59) with the circuit which leads directly to the four channel code punch solenoid, as shown, while interconnected contacts 1642 and 1643 (FIG. 110) are connected by wire 1644 in circuit with the wire 1634 (FIG. 59) and the circuit for recording the occurrence of a space or underline. From the above, it can be seen that when the line has not progressed beyond 0.700" or 0.675" from the right margin, as indicated in FIG. 110, and a three unit space is operated, the circuit through the operated key 762 will pass by wire 830 to the interconnected contacts 1635–1638 and, in this instance, the current will travel through contacts 1638 or 1637, the brushes 1639 (FIG. 107), the contact 1640 or 1641 (FIG. 110), and the wire 831 and the circuit leading to the four channel code punch solenoid as shown in FIG. 59. However, when the line has progressed to 0.650" or 0.625" and closer to the right margin, when a three unit (0.075") space would extend the line into the justifying area (within 0.600" of the right margin) and when the three unit space key 762 is operated, the four channel code bit circuit from the three unit space key wire 830 (FIG. 110) leads to contacts 1636 and 1635, and passes through the bifurcated brush 1636 (FIG. 107), the contacts 1642 or 1643 (FIG. 110), and via wire 1644, which joins wire 1634 (FIG. 59) and the circuit for recording the space or underline in the space at end of the line preventing mechanism 2306 as described for the four unit space above.

The two unit (0.050") space key arrangement is much the same, except that the circuit for recording the space in the space end preventing mechanism 2306 does not become effective until the line has progressed to at least 0.625" from the right margin. The two unit space arrangement accomodates both the word space bar 760 and the two unit nut space key 761. The four channel code bit circuit from both the word space bar 760 and the two unit nut space key 761 (relays 818 and 815, FIG. 59) travels through wire 823 to interconnected contacts 1645, 1646, 1647 and 1648 (FIG. 110) on insulation plate 1592. A bifurcated brush 1649 (FIG. 107) is carried by insulator 1599 on member 1586. In the normal illustrated position of member 1586, brush 1649 is engaged with contact 1648 (FIG. 110) and with a contact 1650 which is also on support plate 1592, in the 0.700" representing position. Contact 1650 is interconnected with contacts 1651 and 1652 on plate 1592 in the 0.675" and 0.650" representing positions, respectively. The wire 825 connects the interconnected contacts 1650, 1651 and 1652 with the circuit that leads to the four channel code bit solenoid, the same as do the wires 831 and 836 (FIG. 59) previously described. A separate contact 1653 (FIG. 110), on support plate 1592, is located in the 0.625" representing position. A wire 1654 connects contact 1653 with the space recording means the same as do wires 1634 and 1644 (FIG. 59), as will be describe hereafter in greater detail. The arrangement is such that, when member 1586 (FIG. 107) is in normal position, the bifurcated brush 1649 is engaged with contacts 1648 and 1650; that, when the line extends to 0.675" from the right margin and member 1586 (FIG. 107) is positioned accordingly as described, the brush 1649 is engaged with contacts 1647 and 1651 (FIG. 110); and that, when the line extends to 0.650", the brush 1649 is engaged with contacts 1646 and 1652. Thus, normally and when the line extends to the 0.700" position and when the line extends to the 0.675" or to the 0.650" positions, the four channel code bit circuit via wire 823 (FIG. 59) from either the two unit space bar 760 or the two unit nut space key 761 will be joined by the engaged interconnected contacts and the brush 1649 to the wire 825 and the circuit leading to the four unit code bit punch solenoid. However, when the line extends to 0.625" or less from the right margin and member 1586 (FIG. 107) is positioned accordingly, as described, with brush 1649 on contacts 1645 and 1653 (FIG. 110) and when the space bar 760 (FIG. 59) or two unit nut space key 761 is operated, the four channel code bit current will travel via wire 823, contacts 1645 (FIG. 110) and 1653 to the space recording means.

In the above manner, the space recording means (to be described later) is controlled by the amount left in the line mechanism commutator portion 824 (FIG. 59), to record the occurrence of a space whenever such a space will extend into the justifying area.

Amount Left in the Line Commutator

The means for registering the amount that may be left in a justifiable line (amount left in the line), for justifying purposes, will now be described.

As described, the slide member 1561 (FIG. 104) is shifted leftwardly, the segments 1572 and 1575 (FIG. 105) are rotated in a counterclockwise direction, the gear 1577, ratchet wheel 1578, sleeve 1579 and switch blade support lever 1580 (FIG. 106) are rotated clockwise against the tension of return spring 1581, as the carriage moves for extending a line to within 0.700" of the right margin. During these forward movements of the parts, a detent 1655 (FIG. 105) ratchets over the teeth of ratchet wheel 1578 and engages the teeth of the ratchet wheel so as to hold the ratchet wheel 1578 and the mechanism rotated therewith in the final unit extent representing position. A light torsion spring 1656, assembled about a hub 1657 (FIG. 18) of the detent 1655, is connected to the detent and to plate 237 in any known manner, for urging the detent 1655 (FIG. 105) clockwise against the ratchet wheel 1578.

As explained elsewhere, justifying computation and punching of the justifying codes occur when the carriage is returned. The detent 1655 is thus provided for maintaining the registration, representing the final extent of the line, while the computing and coding takes place. The computing and coding are accomplished simultaneously and they are accomplished instantaneously since they are operated electrically as will be explained. Actually, the computing and justifying encoding will take place while the carriage is being returned, as will become more apparent later. Whenever back spacing (deleting and automatic reverse direction operation of the carriage) takes place and when justifying encoding is complete and when the justifying key 244 is preset in the off position, the detent 1655 is rotated counterclockwise about the fixed shaft 241, on which the detent 1655 is mounted, for releasing the ratchet wheel 1578 and thus permitting the mechanism to follow reversely as the carriage 80 is back spaced and to return to normal position, respectively, under the tension of spring 1581 (FIG. 106) as explained. The means for releasing the detent 1655 from the ratchet wheel 1578 will be explained later.

The switch blades, or brushes on the upper end of support lever 1580 are sprung forwardly to engage the rearward face of insulation plate 1590 (FIG. 108), and to selectively engage the contacts thereon and extending through the insulation plate 1590. A continuous contact ring 1658 is secured to the rearward face of the insulation plate 1590 by rivets 1659, extending through the ring 1658 and the plate. Brushes 1660 and 1661 (FIG. 106), carried by the upper arm of lever 1580, are respectively arranged to contact the continuous contact ring 1658 (FIG. 108) and the contacts on plate 1590 that comprise the intermediate circle of contacts and that are immediately outside the ring. Brushes 1660 and 1661 (FIG. 106) are fixed to an insulator 1662, which in turn is secured to the upper arm of lever 1580. A conductor strip 1663 interconnects the brushes 1660 and 1661, so as to complete a circuit from the continuous contact ring 1658 (FIG. 108), brush 1660 (FIG. 106), the strip 1663, brush 1661 and the contact engaged by brush 1661 in the intermediate ring of contacts on plate 1590 (FIG. 108).

In the illustrated normal position of lever 1580 (FIG. 106), which position corresponds to 0.700" from the right margin as explained, the brush 1661 is engaged with a contact 1664 (FIG. 108) on plate 1590. As the line extends to points closer than 0.700" of the right margin, the lever 1580 (FIG. 106) is shifted clockwise and the brush 1661 engages contacts 1665 (FIG. 108), 1666, 1667 and 1668 as the line extends to 0.675", 0.650", 0.625" and 0.600" from the right margin, respectively. Since, at these extents, the line has not yet extended to within the justifying area (within 0.600" of the right margin as explained), justification of the line will not take place and the contacts 1664–1668 are interconnected so that a common circuit therethrough will remain as what may be considered normal in these positions of the brushes. Similarly, when the line is completely filled out and there is no need to alter the extend of the line in order to justify, the circuit is again returned to normal where the brush 1661 (FIG. 106) is engaged with a contact 1669 (FIG. 108) in the "full line" position on the plate 1590. The full line contact 1669 is also interconnected with the contacts 1664–1668 so that the normal circuit will also be effective when the line is perfectly filled out. However, when the line extends a lesser extent into the justifying area, the brush 1661 (FIG. 106) will be shifted to engage individual contacts 1670, 1671, 1672, . . . 1690, 1691 and 1692 as the line extends to 0.575", 0.550", 0.525", . . . 0.075", 0.050" and 0.025", respectively, from the right margin. These individual contacts 1670–1692 are selectively engageable by the brush 1661 (FIG. 106) for accordingly controlling the justifying computing and encoding means to operate in accordance with the amount left in a justifiable line.

Amount Left In Line Commutator Circuits

When an operator completes a line and he voluntarily returns the carriage, the switch 1315 (FIG. 83) located in the carriage moving mechanism 149 is automatically closed, as explained, by the first unit of return movement of the carriage 80. This switch 1315 is closed for rendering a series of circuits effective for performing line terminating processes, which may include justifying and therefore may include operations controlled by the amount left in a line measuring commutator mechanism 1483 (FIG. 92). When the carriage 80 is manually returned, a preliminary circuit is automatically completed as explained, primarily for locking the keyboard keys to prevent further operations of the machine until after justifying encoding and until after the carriage is fully returned, and for cocking the end of line tape feed control 166 (FIG. 83) and causing the control to initiate punching of the carriage return code by the main punch mechanism 161, all as described. This preliminary circuit does not involve the amount left in the line commutator, but it is altered by the keylocking function to include a secondary line terminating circuit, which does include the amount left in the line commutator as explained. The preliminary circuit runs from a source of power (S) through wire 137, the tape return key 138 in normal position, wire 139, the delete key 140 in normal position, wires 539 and 1329, and through switch 1330 which is closed upon first operation of the forward tape cycling mechanism 169, as described. At this point, the circuit divides into two preliminary parallel circuits, one through wires 1331 and 1332 for assuring full operation of the general key lock mechanism 1335, as described, and for thus locking keyboard keys against operation, and the second through wires 1331 and 1333 for assuring full operation of the end of the line tape feed control 166 and a resulting punching of a carriage return code, as described.

The first parallel circuit travels from the switch 1330, as explained, through blade 1358 of the switch 1334, which blade is engaged when the ball locks are ineffective for locking the keyboard keys. This first circuit continues through the solenoid 1337 for rendering the ball locks effective for locking the keys, through the carriage moving mechanism switch 1315 which is closed upon return of the carriage and runs to ground through the punch key switch 1099 in normal "on" position, as described. When the key lock mechanism 1335 is fully operated and thus fully effective for locking the keys against operation, the ball lock's switch 1334 is shifted to break the just described first parallel circuit, by disengagement of the above blade. When the switch 1334 is shifted, a second blade 1359 is engaged to initiate the secondary line terminating and justifying circuit as explained. The second parallel preliminary circuit leads from switch 1330 in the forward tape cycling mechanism 169, as explained, and it travels via wires 1331 and 1333 and it continues through a switch 1340 which is normally closed in the carriage return punch circuit breaker 1341, and through the solenoid 1343 for cocking the end of line tape feed control 166. This second parallel circuit continues from the solenoid 1343 and joins the first parallel circuit and continues therewith through the carriage moving mechanism 149's switch 1315 which is closed upon return of the carriage and runs to ground through the switch 1099 in normal position as described.

When the cocking solenoid 1343 in the end of line tape feed control 166 is fully operated by the just described second parallel circuit, the line tape feed control 166 closes the carriage return main punch switch 1386 for causing punching of the carriage return code and for breaking the second parallel circuit. The circuit rendered effective by closing of the carriage return switch 1386 runs from a source of power (S), through the solenoid 1402 for tripping the carriage return punch circuit breaker 1341 and opening the switch 1340 therein for breaking the above described second parallel circuit, through the then closed carriage return switch 1386, the main punch mechanism 161 for punching the carriage return code, continues through the punch key switch 669 in normal "on" position, the switch 164 in normal condition and goes to ground through the shifted switch 1382 in the cocked line tape feed mechanism 166.

As soon as the tripping solenoid 1402 in the carriage return punch circuit breaker 1341 is operated, the line tape feed mechanism 166 snaps to open its switch 1340 and thereby break the second parallel circuit and thus to deenergize the cocking solenoid 1343 in the end of line tape feed control 166. Deenergization of the solenoid 1343 permits the end of line tape feed mechanism 166 to break the circuit through the carriage return switch 1386 and thus deenergizing the tripping solenoid 1402 in the carriage return punch circuit breaker 1341 and deenergizing the operated main punch mechanism 161. Thereafter, following justifying encoding and full return of the carriage 80 as will be described, the recocking solenoid 1417 in the carriage return punch circuit breaker 1341 is operated to restore this main punch mechanism 161. The end of line tape feed control 166 is restored upon full operation of the end of line tape feed 1422 and the solenoid 1424 as explained.

When the key lock mechanism 1335 is operated, the secondary line terminating circuit is directed through wire 1475 (FIG. 92), switch 1478, wire 1482 and it leads directly to both the amount left in the line commutator and to the word space counter 850, as previously explained.

The wire 1482, which carries the circuit to the amount left in the line commutator, is secured to contact ring 1658 (FIG. 108) by a customary terminal and one of the rivets 1659. As explained, normally when the line has not extended to a point less than 0.700" from the right margin, the brush 1661 (FIG. 106) rests on the contact 1664 (FIG. 108). When this is the condition, and similarly when the line has progressed to 0.675", 0.650", 0.625", 0.600" or when the line is completely filled out ("Full Line") and the brush 1661 rests on contacts 1665, 1666, 1667, 1668 or 1669, respectively, justifying operations are not required, as explained, and the current will pass through the contact ring 1658, brush 1660, (FIG. 106), strip 1663, brush 1661 and the appropriate one of the interconnected contacts 1664–1669 (FIG. 108). These interconnected contacts are connected by the wire 1884 (FIG. 92) leading directly to the switch 1486, as explained, without involving any justifying processes. The switch 1486 is thus operated to cause movement of the control tape 577, that is prepared for the line, out of the encoding area of the punch mechanism assembly, and thus the line is terminated without there being any justifying codes punched. However, when the line has progressed to within the justifying area but is not fully filled out, the brush 1661 (FIG. 106) rests on the appropriate one of the contacts 1670–1692 (FIG. 108) and the amount left in the line commutator is conditioned to control the justifying encoding mechanism. A wire 1485 (FIG. 92) leads from each of the contacts 1670–1692 (FIG. 108) to a corresponding solenoid, to be described, in the dividing and justifying encoding mechanism. Thus, when the line has progressed to any extent from 0.575" to 0.025" of the right margin and justifying is initiated as described, the amount left in the line commutator is in condition for controlling the dividing and encoding mechanism to operate appropriately.

Since, prior to return of the carriage, 80 a recorded amount left in a line may be increased, due to back spacing, the pawl 1655 (FIG. 105) is rendered ineffective during deleting operations and thus the amount left in the line mechanism 1483 may follow the carriage 80 as the carriage is operated reversely, as described. The pawl 1655 is also disengaged from the ratchet wheel 1578, as to be ineffective, following justifying operations, when the amount registered is no longer needed, in order to permit clearing of the amount left in the line mechanism 1483. Similarly, when the justifying key 244 (FIG. 18) is in the "off" position and justifying information is not required, the pawl 1655 (FIG. 105) is rendered ineffective for detaining the amount left in the line mechanism 1483 in any registered position. The mechanism for disengaging the pawl 1655 on these occasions will now be described.

The detent 1655 is pivoted on fixed shaft 241, as described, and it is urged clockwise by spring 1656 so as to normally engage ratchet wheel 1578. An upwardly extending arm 1693 of the detent 1655 supports a forwardly extending stud 1694, which passes beyond the planes and to the left of members 1695 and 1696. Member 1695 is pivoted on fixed shaft 241, and it is urged clockwise about the shaft as will be explained. The upper end of member 1695 normally rests against fixed shaft 243. A link 1697 is pivotally connected to the upper end of member 1695 and to the armature of the solenoid 1010, which retracts its armature and pulls the link 1697 leftwardly for rotating member 1695 counterclockwise when the solenoid 1010 is energized. When member 1965 is thus rotated, its leftward projection 1698 contacts and moves the stud 1694 and thus pivots the stud, arm 1693 and the detent 1655 counterclockwise about fixed shaft 241 so as to make the detent ineffective as explained. Solenoid 1010 is secured to the plate 229, and it is energized momentarily at the beginning of deleting operations, and also after justifying operations, as will be explained.

Member 1695 is equipped with a rearwardly extending stud 1699 overlying a pawl 1700 which is pivoted on the shaft 242. The pawl is provided for latching onto the stud 1699 and thereupon holding member 1695 in counterclockwise operated position until the back spacing or clearing operations, as the case may be, are completed, as will be explained.

A contractile spring 1701, connected at its ends to member 1695 and to a lower arm 1702 of pawl 1700, urges member 1695 clockwise to rest against rod 243, and it urges pawl 1700 upward in latching direction against stud 1699.

An upwardly extending arm 1703 of pawl 1700 lies just to the left of stud 1704 fixed in the upper end of a member 1705. Counterclockwise rotation of member 1705, about the axis of shaft 242, causes the stud 1704 to contact the arm 1703 and to rotate tha pawl 1700 for releasing the stud 1699 and permitting clockwise restoration of member 1695 from operated position under the tension of spring 1701.

The member 1705 is fixed on the rearward end of a sleeve 1706, which is pivoted on shaft 242. A bellcrank member 1707 (FIG. 106) is secured to sleeve 1706, intermediate the ends of the sleeve 1706. A torsion spring 1708 is connected to member 1707 for urging the member clockwise to rest with a leftward arm 1709 against fixed shaft 243. A link 1710 is pivotally connected to an upwardly extending arm 1711 of member 1707 and to the armature of the solenoid 1278. The depending arm 267 (FIG. 17) is secured on the forward end of the sleeve 1706 (FIG. 105) and this arm is rotated counterclockwise, together with the sleeve 1706 and member 1705, for releasing the latch means 262 (FIG. 17) and rendering the justifying control key 244 again operable, as explained hereinbefore, when the carriage 80 is returned and the functions for the line are complete.

From the above, it can be seen that upon energization of solenoid 1278 (FIG. 106) the link 1710 is pulled leftward, rotating the unit formed of bellcrank 1707, sleeve 1706, member 1705, (FIG. 105) and member 267 (FIG. 17) counterclockwise about shaft 242 against the tension of spring 1708 (FIG. 106). Upon deenergization of solenoid 1278, the spring 1708 rotates the unit clockwise to the normal position, controlled by fixed rod 243, as shown. The solenoid 1278 is momentarily energized when the carriage is fully returned and all functions for a line are complete, and also when the tape return key 138 is depressed following back spacing and the deleted tape 577 is automatically fed forwardly through the main punches 567 (back space function is read).

The member 1696 (FIG. 105) is provided for coacting with the stud 1694, and for holding the detent 1655 in its counterclockwise ineffective position while the justifying control key 244 (FIG. 17) is set in the "off" position. Member 1696 (FIG. 105) is fixed on the rearward end of a sleeve 1712, which is pivoted on fixed shaft 241. The forward end of sleeve 1712 is fixed to the justifying key member 246 (FIG. 17). The unit thus formed of the justifying key member 246, sleeve 1712 (FIG. 105) and member 1696 is shiftable counterclockwise from the normal illustrated "on" position when the justifying key 244 (FIG. 17) is moved to the justifying "off" position. When the justifying control key 244 is again shifted to the "on" position, the justifying key member 246, sleeve 1712 (FIG. 105) and member 1696 are rotated clockwise for permitting the spring 1656 to pivot the detent 1655 into effective engagement with the ratchet wheel 1578.

As previously explained, the detent 1655 is normally effective for holding the amount left in the line mechanism 1483 in operated position when the justifying control key 244 is in "on" position, and as just explained above, the detent 1655 is rendered ineffective for holding the amount left in the line mechanism 1483 in operated position when the justifying control key 244 is in the "off" position. As described previously, the justifying key switch means renders the justifying circuits, including those controlled by the amount left in the line mechanism 1483 ineffective for controlling justifying operations, when the justifying control key 244 is in "off" position. Therefore, there is no need for holding any amount that may be registered in the amount left in the line mechanism, 1483 when the justifying control key 244 is in "off" position. Thus, since the detent 1655 is rendered ineffective by the justifying key 244 in "off" position, there is no need for operating the detent 1655 to clear for each line or to operate the detent during back spacing, as described for normal operations, as previously described, when the justifying control key 244 is "off". This results in elimination of unnecessary operations.

Commutators For Differential Key-Locks

The commutator arrangement in the amount left in the line mechanism 1483 for the 0.050" key lock control will now be described.

Switch blades 1713 (FIG. 106) and 1714 are secured on insulator 1662, which is secured on the normally upwardly extending arm of the rotary switch blade support lever 1580, and the blades extend generally oppositely from the insulator 1662, in clockwise and counterclockwise directions, respectively. Blades 1713 and 1714 are connected by conductor strip 1715, and by rivets 1716 through the strip, blades and the insulator 1662. The free ends of the blades are directed slightly forwardly to engage the rearward face of the contact support plate 1590 (FIG. 18) and certain contacts thereon as will now be explained.

Normally, as illustrated and explained, lever 1580 (FIG. 106) stands at the 0.700" from the right margin representing position. In this normal position, the ends of blades 1713 and 1714 are engaged with contacts 1717 and 1718 (FIG. 108), respectively, for completing an end of line clearance circuit which becomes effective when the machine is normalized and the carriage 80 is fully returned, as explained elsewhere herein.

As the carriage advances closer than 0.700" from the full line position, the lever 1580 (FIG. 106) moves clockwise from the position shown and blades 1713 and 1714 disengage from contacts 1717 and 1718 (FIG. 108), respectively. Since there are no contacts on contact support plate 1590 for a considerable distance clockwise from contact 1717, no circuits are immediately completed by these blades. In fact, as will become apparent, no significant contact is made until the lever 1580 (FIG. 106) achieves the 0.125" representing position. As the lever advances near the end of the line, the blade 1713 first effectively engages a contact 1719 (FIG. 108) at the 0.125"0 position, and successively thereafter it engages contact 1720 at 0.100" position, contact 1721 at 0.075" position, contact 1722 at 0.050" position, contact 1723 at 0.025" position, and contact 1724 at "Full Line" position of the lever assembly. Similarly, the blade 1714 (FIG. 106) engages contact 1725 (FIG. 108) at 0.125" position, and as it continues clockwise it successively thereafter engages contacts 1726–1730 at 0.100"–0" representing positions, respectively. Contacts 1725–1730 are preferably interconnected, by any well known means, so as to be like a continuous strip. The arrangement is such that current may pass through the conductively connected blades 1713 and 1714 (FIG. 106), and the thereby contacted pairs of contacts 1719, 1725 (FIG. 108); 1720, 1726; 1721, 1727; 1722, 1728; 1723, 1729, and 1723, 1730, when the switch blade support lever 1580 (FIG. 106) is in the 0.025", 0.100", 0.075", 0.050", 0.025" and the Full Line positions, respectively.

The commutator arrangement for the 0.075" key-lock control will now be described. An insulator 1731, similar to insulator 1662 described above, is secured to the lower end of switch blade support lever 1580 in the position shown. Switch blades 1732 and 1733, which extend respectively clockwise and counterclockwise, are secured in insulator 1731 and these blades are connected by conductor strip 1734 and rivets 1735 secured through the blades, the strip and the insulator. Blades 1732 and 1733 press rearward against the forward face of contact support plate 1591 (FIG. 109), as explained, and the ends of the blades are situated to at times engage contacts in the smaller radius arc of contacts on contact support plate 1591. In the normal 0.700" representing position of lever 1580 (FIG. 106), discussed previously, the blades contact no significant contacts, nor do they contact any significant contacts during the initial clockwise steps of the switch blade support lever 1580. However, when the switch blade support lever 1580 is moved clockwise, as explained, to the 0.150" position, the blade 1732 rests on a contact 1736 (FIG. 109). Further clockwise movement of the switch blade support lever causes successive engagement of blade 1732 (FIG. 106) with contacts 1737–1742 (FIG. 109), as the switch blade support lever 1580 moves the blade in its 0.125" to zero (end) positions, respectively. Likewise, when the switch blade support lever 1580 (FIG. 106) is in 0.150" representing position, the blade 1733 is on contact 1743 (FIG. 109), and as the switch blade support lever moves further clockwise the blade successively engages contacts 1744–1749, in 0.125" to the zero (end) positions, respectively, on the insulator plate 1591. The contacts 1743–1749 are interconnected, and the arrangement is such that current may pass through the blades 1732, 1733 (FIG. 106) and the strip 1734, when the blades engage the pairs of contacts 1736, 1743; 1737, 1744; 1738, 1745; 1739, 1746; 1740, 1747; 1741, 1748; and 1742, 1749; respectively, in the 0.150" to end positions, respectively.

The commutator arrangement for the 0.100" key-lock control will now be described. Blades 1750, 1751 (FIG. 106) are secured to insulator 1731, and they extend generally clockwise and counterclockwise, respectively. The blades are connected by conductor strip 1752 and rivets 1753, secured through the strip, the blades and the insulator. The free ends of the blades 1750 and 1751 press rearwardly against the forward face of support plate 1591 (FIG. 109) for at times engaging contacts in the outer ring thereof on the support plate. Normally, and during the initial clockwise steps of the lever and blade arrangement, the blades do not significantly engage any contacts. However, when the switch blade support lever 1580 (FIG. 106) is moved clockwise, as explained, to the 0.175" position, the blade 1750 effectively engages a contact 1754 (FIG. 109), and, upon further clockwise movement of the switch blade support lever, the blade successively engages contacts 1755–1761 in the 0.150" to 0 (end of line) positions, respectively. At the same respective times, blades 1751 (FIG. 106) effectively engages contacts 1762–1769 in the 0.175" to 0 (end of line) positions, respectively. Contacts 1762–1769 are interconnected, by any known means, to a common wire, as will be explained. The arrangement is such that blades 1750 and 1751 (FIG. 106) respectively and successively engage the pairs of contacts 1754, 1762 (FIG. 109); 1755, 1763; 1756, 1764; 1757, 1765; 1758, 1766; 1759, 1767; 1760, 1768, and 1761, 1769, when the lever 1580 (FIG. 106) is in the 0.175" to 0 (End of Line)positions, respectively.

26. DIFFERENTIAL KEY-LOCK MECHANISM

Since the last described commutators control differential key-locks and since these locks are a major automatic and positive enforcer of good typing practice important for justifying, the end of line differential key locks will be described, now before actual justifying and encoding operations are described.

As previously described, the carriage movements are divisible into units of 0.025", and such movements are always 0.100", 0.075" or 0.050" in the preferred composing machine. Accordingly, when the carriage is within 0.075" of the predetermined right margin line, the 0.100" characters, the underline key 19, and the 0.100" nut-space key 763 should not be used. Further, when the carriage is within 0.050" and 0.025" of the right margin, the 0.075" and 0.050" character and word space keys, respectively, should not be used. Therefore, differential printing and space key locks are provided for preventing undesirable operation of respective keys, under the above circumstances. It should also be noted that the differential key locks will never block operation of a key when its character or word space will still fit into the line.

The differential key lock mechanism is almost entirely supported on a horizontally disposed frame plate 1770 (FIGS. 111, 112 and 113), the ends of which are secured to the under side of the left and right main frame channel members 13 and 14 (FIG. 111), respectively, as by screws 1771. Since the frame channel members 13 and 14 support the main typewriter frame 15 (FIG. 2), as previously explained, it can be understood that the plate 1770 (FIGS. 112 and 114) supports the key lock mechanism directly under the character key levers 23 as shown.

Basically, the key lock mechanism is comprised of (1) a key lock indexing means (shown particularly in FIG. 112) for at times determining the position of an operable one or two bail type key locks as a line is extended to certain limits; (2) a detent means (FIG. 115) for holding the indexing means in operated position, and (3) selectively operable upper and lower case control means, shown in FIG. 116, for selectively rendering upper and lower case bail locks operable and effective as permitted by the indexing means for differential locking control of character and space keys in conformity with the upper and lower case condition of the machine. A differential word and nut space key lock bail arrangement, shown in FIG. 58, is linked with the character key lock mechanism for operation therewith, and this arrangement may be considered a fourth basic component of the differential key lock mechanism. The just mentioned four basic components will now be described, generally in the order given above.

The main framework of the differential key lock assembly is comprised of a vertical left frame plate 1772, FIGS. 111–113; a right frame plate 1773 (FIGS. 111, 113 and 114), which is identical to plate 1772; and a rightmost frame bracket 1774. The plates and bracket 1772–1774 (FIGS. 111 and 113) are situated generally parallel to each other and they are secured to the horizontal plate 1770 in any known manner to form a rigid support for the differential key lock mechanism.

A lower case bail 1775 (FIGS. 111, 113 and 114), which is operable and thus may become effective only when the machine is in lower case condition as will be explained, is secured at its left and right depending end portions 1776 and 1777, respectively, to a horizontal transverse shaft 1778 as by pins 1779. The transverse shaft 1778 extends through holes therefor in frame plates 1772, 1773 and bracket 1774, and it is pivotally supported in bushings 1780 (FIGS. 111 and 113) secured in the holes in vertical left frame plate 1772 and bracket 1774.

An upper case bail 1781 (FIGS. 111, 113 and 114), which is identical to lower case bail 1775 but which is operable to become effective only when the machine is in upper case condition as will be explained, is secured at its left and right depending end portions 1782 and 1783, respectively, to a horizontal transverse shaft 1784 as by pins 1785. The transverse shaft 1784 extends through holes therefor in frame plates 1772, 1773 and bracket 1774, and fixed in the holes in vertical left frame plate 1772 and bracket 1774.

Normally, the bails 1775 and 1781 stand in the ineffective counterclockwise positions shown in FIG. 114, and, when the carriage 80 moves to a position where an additional 0.100" character or an underline mark will not fit in a line, the lower case bail 1775 or the upper case bail 1781 depending on the instant case condition of the machine, is rotated one step clockwise to a first operated position where it blocks further operation of 0.100" character keys and the underline key 19. Similarly, when the carriage 80 is in a position where a 0.075" character or 0.050" character will not fit in the line, the operable bail is rotated incrementally two or three steps, respectively, from normal position to a second or third operated effective position, respectively.

As previously explained, each normal character key lever 23 is normally selectively operable counterclockwise about transverse rod 26 for imprinting, coding and controlling movement of the carriage 80 appropriately for the key. The underline key 19 is the same except that it does not cause carriage movement. Each key lever 23 is equipped with two depending lugs, one of which is a lug 1787, 1788 or 1789 (FIG. 112) and the other of which is a lugs 1790, 1791 or 1792. The lugs 1787, 1788 and 1789 are differentially arranged to abut the lower case bail 1775 and block operation of their respective keys 16 when the lower case bail 1775 is aligned under the lug. Each normal character key 16 and the underline key 19 that has a lower case character space value of 0.100" is equipped with a lug 1787 which is positioned and has such a lower edge extent that it will abut and be blocked by the lower case bail 1775, when in its first, second and third clockwise operated positions. Thus, operation of all 0.100" lower case character keys 16 and the underline key 19 is prevented when the carriage is operated to 0.075" or less from the right margin. All 0.075" lower case character space value keys 16 are equipped with lugs 1789 positioned to abut and be blocked by the bail 1775, only when in its third operated position. Thus, operation of 0.050" lower case character keys 16 is blocked when the carriage 80 is 0.025" from the right margin of when the line is completely filled out and the carriage is at the right margin.

From the above and since the upper case bail 1781 and its associated lugs 1790–1792 on the character keys 16 correspond with each other in the same manner as do lower case bail 1775 and lugs 1787–1789 discussed above, it can be understood that each character key 16 and the underline key 19 that has an upper case value of 0.100" will be blocked by contact of its lug 1790 with upper case bail 1781 when in its first, second and third operated clockwise positions. Likewise, 0.075" upper case character keys 16 are blocked by contact of their lugs 1791 with upper case bail 1781 when in its second and third operated positions. Also likewise, the 0.050" upper case character keys 16 are blocked by contact of their lugs 1792 with the upper case bail, only when the upper case bail 1781 is in its third operated position.

Differential actuating control means for bails 1775 and 1781 will now be described. Indexing members 1793 and 1794 are pivotally mounted on shafts 1778 and 1784, respectively, and they extend generally upwardly to the rear of and normally for engagement with their respective bails 1775 and 1781. A link 1795 is pivotally connected to the indexing members 1793 and 1794 to maintain the same particular representative positions.

Torsion springs 1796 and 1797 (FIG. 113), near the left ends of the bails 1775 and 1781, respectively, and they are anchored on the frame in any known fashion and they are connected to the respective bails for urging the bails rearward or clockwise (FIG. 112), toward the indexing members 1793 and 1794, respectively. A torsion spring 1798, which is stronger than the combined force of springs 1796 and 1797, is connected to member 1794, wound about a hub 1799 of indexing member 1794, and it is anchored under fixed rod 1800 so as to normally rotate indexing members 1793 and 1794, and consequently their respective bails 1775 and 1781 counterclockwise to the normal positions shown. The normal counterclockwise position of the parts is determined by contact of a finger 1801 on indexing member 1794 resting against the top of fixed rod 1800. Rod 1800 extends between frame plates 1772 and 1773 (FIG. 113), and it is secured to the plates in any known manner.

A lost motion member 1802 (FIG. 112) is pivotally mounted on transverse shaft 1784, immediately to the left of indexing member 1794 (FIG. 113). A rightwardly extending stud 1803 is secured to lost motion member 1802 near the upper end thereof. The stud 1803 extends through a lost motion limit hole 1804 (FIG. 112) in the indexing member 1794. A light torsion spring 1805 (FIGS. 112 and 113) is connected to members 1794, 1802, and it is only sufficiently strong as to normally rotate member 1802 counterclockwise until the stud 1803 (FIG. 112) is stopped against the forward side of the hole 1804. The arrangement is such that upon clockwise movement of indexing member 1794 and stopping of lost motion member 1802, as will be explained, indexing member 1794 is likewise immediately stopped, but, when indexing member 1794 is permitted to return counterclockwise under tension of spring 1798 and lost motion member 1802 is then stopped, indexing member 1794 is permitted to return a portion of an increment further counterclockwise until stud 1803 contacts the rearward side of lost motion limit hole 1804. This lost motion arrangement permits the use of one set of stop members for both forward and reverse differential stepping control of the differential actuating control means as will become more apparent as the specification progresses.

A solenoid 1806 is fixed to the support plate 1770, by any known means, and it is provided for causing forward stroke operation (forward, in respect to time) of the indexing means. A link 1807 is pivotally connected to control member 1794 and to the armature of solenoid 1806. Energization of the solenoid 1806 pulls link 1807 rearward, rotating members 1794 and 1802 clockwise, and member 1793 is rotated clockwise accordingly by link 1795. This forward stroke of operation may be limited to one step by an adjustable stop 1808, to two steps by adjustable stop 1809, or to a maximum of three steps by limit stop 1810 which is formed on the hub portion of indexing member 1794 and arranged to contact the bottom of stationary rod 1800 upon three clockwise steps of rotation of indexing member 1794.

Adjustable stops 1808 and 1809 normally stand withdrawn from the clockwise arcuate path of a stop surface 1811 on the upper end of lost motion member 1802, and the stops are only brought into alignment with the stop surface when required to correspondingly limit the forward stroke of operation.

Stop 1808 (FIGS. 112 and 113) is generally U-shaped, having a rearwardly extending left side portion 1812 and a similar right side portion 1813. These side portions are pivoted on a stationary shaft 1814, which is secured in frame plates 1772 and 1773 (FIG. 113). The rearward pivot end of right side portion 1813 (FIG. 112) has a downwardly directed lever extension 1815 for operating and controlling the normal and operated positions of the stop 1808. The lowermost end 1816 of extension 1815 is embraced by upturned portions 1817 and 1818 of a transverse channel member 1819, which is provided for limiting clockwise pivoting of the stop 1808 in the normal position and for limiting counterclockwise pivoting of the stop in operated position, respectively. Channel member 1819 is secured, in proper position, to frame plate 1770 as by rivets 1820. A torsion spring 1821 is connected to extension 1815 for urging stop 1808 clockwise to the normal position shown where lower-most end portion 1816 rests against channel portion 1817. A link 1822 is pivotally connected to extension 1815 and to the armature of a solenoid 1823, which is secured to frame plate 1770. Upon energization of solenoid 1823, link 1822 is pulled rearward, rotating extension 1815 and stop 1808 counterclockwise to operated position where lowermost end portion 1816 is stopped against channel portion 1818 and stop 1808 is in engaging alignment with surface 1811 of lost motion member 1802. Upon deenergization of solenoid 1823, the spring 1821 returns the parts to normal position as shown.

Stop 1809 (FIG. 113) is similar to and fits inside of stop 1808. Stop 1809 has a left side portion 1824 and a right side portion 1825 extending rearward where the ends of the two portions are pivoted on the shaft 1814. A lever extension 1826 (FIGS. 111 and 112) depends from left side portion 1824, and its lowermost portion is embraced between the upturned portions of the channel member 1819 for control of the stop 1809 in normal and operated positions, the same as that described for stop 1808 described above. A link 1827 (FIG. 112) is pivotally connected to extension 1826 and to the armature of a solenoid 1828, for moving stop 1809 to operated position. Solenoid 1828 is secured to frame plate 1770 in any known manner. A torsion spring 1829 is connected to the extension 1826 for restoring stop 1809 clockwise to its normal ineffective position. Spring 1829 is anchored to a stationary rod 1830, which is secured at its left and right ends to frame plates 1772 and 1773 (FIG. 111).

From the above, it can be seen that upon simultaneous energization of motivating solenoid 1806 (FIG. 112) and control solenoid 1823, members 1793, 1794 will be motivated clockwise and surface 1811 on lost motion member 1802 will contact the operated stop 1808, substantially at a first operated position of the indexing means. Likewise, upon energization of solenoids 1806 and 1828, the members 1793, 1794 will be operated clockwise until surface 1811 contacts stop 1809 in the second operated position. Similarly, when solenoid 1806 is energized independently of the solenoids 1823 and 1828, the adjustable stops 1808 and 1809 remain in their normal ineffective positions and the solenoid 1806 moves the indexing members 1793, 1794 to their third operated position where the stop 1810 on indexing member 1794 engages the stationary rod 1800.

When the indexing members 1793, 1794 are moved from normal to their first, second or third positions, they are held in the particular operated position, against tension of return direction spring 1798, by a detent means, which will now be described.

The hub 1799 of indexing member 1794 extends rightwardly (FIG. 113) and has a ratchet member 1831 secured thereon for unitary rotation with hub 1799 and member 1794 on the transverse shaft 1784. The ratchet member 1831 (FIG. 115) has three teeth on its upper peripheral portion. Each tooth has a radial latching surface 1832, 1833 and 1834, respectively, corresponding to the three operated positions of the unit 1794, 1799 and 1831 (FIG. 113). A detent 1835 (FIG. 115) is pivotally mounted on the stationary shaft 1814 and it extends forwardly where a leftwardly extending tab 1836 thereon overlies the ratchet member 1831. The torsion spring 1821 (FIG. 112), connected with extension 1815 of adjustable stop 1808 for urging the stop to normal position as described, is also connected with a downward extension 1837 (FIG. 115), of detent 1835 for urging the detent counterclockwise against the ratchet member 1831. The arrangement is such that, when the indexing members 1793 and 1794 (FIG. 112) and thus when the unit formed of indexing member 1794, hub 1799 and ratchet member 1831 (FIG. 115) is rotated 1, 2, or 3 steps clockwise, the respective latching surface 1832, 1833 or 1834 is latched and held by tab 1836 of detent 1835. Thus the indexing means is held in a first, second or third operated position.

The detent 1835 may be operated to release the ratchet member 1831 for controlled differential back spacing (deleting) operations, and for clearing the indexing means as when a line is completed and the machine's carriage is returned, as will be explained. A solenoid 1838 and a link 1839 pivotally connected between the armature of the solenoid and extension 1837 is provided for releasing the detent 1835 from the ratchet member 1831. Solenoid 1838 is secured to frame plate 1770 in any known manner. A stop surface 1840 on the lower end of the extension 1837, acting against the upturned portion 1817 of the channel member 1819, limits the clockwise rotation of detent 1835 in disengaged position, while the counterclockwise rotation of the detent 1835 is limited by contact of the tab 1836 with the ratchet member 1831. Energization of solenoid 1838 pulls link 1839 leftward for rotating extension 1837 and the detent 1835 clockwise to its ineffective position, and upon deenergization of solenoid 1838, spring 1821 returns detent 1835 counterclockwise into effective engagement with ratchet member 1831. Upon disengagement of detent 1835, the indexing means and the operated, and then effective locking bail 1775 or 1781 (FIG. 112) are restored to the illustrated normal position by spring 1798 as explained.

As previously described, some of the characters require and are provided with larger or smaller character space in upper case than in lower case. Also, some character keys 16 have the same character space in both upper and lower case. A complete grouping of the types of characters, in respect to the upper and lower case size characteristics, is shown in "Chart A" hereinabove in the charts that follow the Figure Descriptions.

To accommodate all of these conditions, each character key 16 is equipped with a suitable one of the lower case key locking lugs 1787, 1788, or 1789 (FIG. 112) and a suitable one of the upper case key locking lugs 1790, 1791 or 1792 for coacting with the lower case bail 1775 and the upper case bail 1781 respectively, when a line has progressed to a point where the character will no longer fit into the line. In order for only the appropriate bail to be permitted to become effective under control of the indexing means when the line extends near the end of a line, upper and lower case control means are provided. The upper case control means is comprised of mechanism operated, normally when the machine is shifted to upper case, for rendering the lower case bail 1775 inoperable and simultaneously permitting the upper case bail 1781 to become effective as permitted by the indexing means described above. The lower case control means is comprised of mechanism operated, normally when the machine is shifted to lower case, for rendering the upper case bail 1781 inoperable and simultaneously permitting the lower case bail 1775 to become effective as permitted by the indexing means. The upper case control means will now be described.

The lower end of a bail restoring lever 1841 (FIG. 116) is pivotally mounted on lower case bail shaft 1778, and it is urged clockwise, to the normal position shown, by a torsion spring 1842 which is connected to the bail restoring lever and anchored on the rod 1800. An upper end portion 1843 of the lever 1841 extends upward into engaging alignment with the lower case bail 1775 for rotating this bail counterclockwise to normal position when the lever 1841 is operated therefor. A link 1844 is pivotally connected near the upper end of bail restoring lever 1841 and to the upper end of a lever 1845. Lever 1845 is pivotally mounted near its center on the stationary rod 1830. A link 1846 is pivotally connected to the lower end of lever 1845 and to the armature of the solenoid 490, previously mentioned. The solenoid is secured to frame plate 1770 in any known manner. From the above, it can be seen that energization of solenoid 490 pulls link 1846 rearward, pivots lever 1845 counterclockwise, pushes link 1844 forward and pivots the bail restoring lever 1841 counterclockwise for restoring lower case bail 1775 to its illustrated normal position or for preventing the bail from moving out of its normal position as the case may be. When the solenoid 490 is energized and the mechanism operated as just described, the mechanism is flexibly locked in operated position as will be explained presently.

Another bail restoring lever 1847 is pivoted on upper case bail rod 1784, and it is urged clockwise from the illustrated operated position by a torsion spring 1848 connected with the bail restoring lever and stationary rod 1800. In operated position of lever 1847, the upper end 1849 of the bail restoring lever prevents upper case bail 1781 from pivoting clockwise from normal position. A link 1850 is pivotally connected to the bail restoring lever 1847 and to an upper part of an upstanding lever 1851. Lever 1851, near its center, is pivoted on rod 1830, and the lower part of the lever 1851 is connected by a link 1852 to the armature of a solenoid 494, which is secured to plate 1770. Energization of solenoid 494 moves the just described parts, generally counterclockwise about the pivots, to the illustrated positions.

The generally rearward and forward motion limits of the members 1841, 1844 and 1845 are controlled by stop projections 1853 and 1854, respectively, on link 1844 as they contact stationary shaft 1814. Identical stop projections (shown but not numbered) are formed on link 1850 for limiting the rearward and forward movements of members 1847, 1850 and 1851.

A flexible locking bail 1855 cooperates with certain configurations on links 1844 and 1850 for alternately releasing a previously operated link and its respectively connected mechanism and for holding the instantly operated link and its mechanism in operated position. The locking bail 1855 has a rearwardly extending left side portion 1856 and right side portion 1857 (FIG. 113). The rearward ends of portions 1856 and 1857 are pivoted on shaft 1814 so as to permit the main flexibe locking bail portion 1855 (FIG. 116) to reciprocate downward and upward to perform its flexible locking functions, as will now be described.

A torsion spring 1858 (FIG. 113) is anchored to the right frame plate 1773 and it is connected to the portion 1857 for urging the flexible locking bail 1855 upward against the bottom of links 1844 and 1850 (FIG. 116).

Particular contours on the bottom of links 1844 and 1850 cooperate with locking bail 1855 to provide the flexible locking feature. The contours on the links are identical, therefore, a description of one will serve to describe the other. Both contours, as they progress rearward along the bottom edge of their respective link, are comprised of a normal surface 1859, a declining cam surface 1860, a major cam point 1861, a clearance incline 1862, a latching surface 1863, and another normal surface 1864 which is in horizontal alignment with normal surface 1859. From the above, it can be seen that, when the bail restoring lever 1841 is in the illustrated clockwise position and the lever 1847 is latched in the operated counterclockwise position as shown, forward (leftward) operation of link 1844 causes its surface 1860 to rotate locking bail 1855 counterclockwise. This rotation of the bail 1855 causes the bail to move below the latch surface 1863 on link 1850, and thus the link 1850 is permitted to return rearward, and levers 1851 and 1847 are rotated clockwise under tension of spring 1848. Clockwise rotation of lever 1847 permits the upper case bail 1781 to rotate clockwise to any one of its operated positions, if and when so controlled by indexing member 1794 (FIG. 112), and thus the upper case bail is rendered operable. Further forward operations of link 1844 (FIG. 116) causes its major cam point 1861 to pivot the bail sufficiently to make positively sure that the link 1850 is released. The clearance incline 1862 permits a released link to operate the locking bail 1855, the link and its mechanism to restore prior to the instant when the cam point 1861 of the shifted link reaches the bail. The final forward operation of link 1844 moves its latch surface 1863 forward of the locking bail 1855 and thus permits the bail to rotate clockwise as explained for latching link 1844 in its forward position and locking the bail restoring lever 1841 in its counterclockwise position where it renders the lower case bail 1775 inoperable. Thereafter, upon operation of solenoid 494 which automatically occurs normally when the machine is again shifted to lower case, the link 1850 is again moved forwardly, causing its contour to actuate the locking bail 1855 for releasing the link 1844, and the link 1850 is then latched in the position shown, in the same manner as described for link 1844 discussed above.

From the above, it can be seen that, upon operation of solenoid 490, the upper case key locking bail 1781 is rendered operable and the lower case key locking bail 1775 is rendered inoperable. In a similar manner, when solenoid 494 is operated, the lower case key locking bail 1775 is rendered operable and the upper case bail 1781 is rendered inoperable.

As explained previously, when a line extends to 0.075", 0.050", or 0.025" or less from the right margin, the indexing means (FIG. 112) is operated correspondingly to its first, second or third operated position. When the indexing means is shifted to an operated position, the key locking bail 1775 or 1781 that is rendered operable, by the case control means shown in FIG. 116, will directly follow its respective indexing lever 1793 or 1794 (FIG. 112) to operated position while the other bail is held in normal position. If a case shift occurs, when the indexing means is in an operated position, the mechanism in FIG. 116 permits the bail that is held in normal position to snap into operated position against the indexing lever 1793 or 1794, (FIG. 112). Even though the spring 1798 on the indexing means is stronger than either of the bail springs 1796 or 1797 as explained, the weight and snapping action of a liberated bail 1775 or 1781 might cause the indexing means and the ratchet member 1831 (FIG. 115) to advance beyond proper position, except when the indexing means is in third operated position where rod 1800 (FIG. 112) and stop 1810 prevent over-rotation of the indexing means. In order to prevent unwarranted advancement of the indexing means, due to the snapping action of a bail during a case shift control operation, an overrotation preventing means comprised of a ratchet 1865 (FIG. 116) and a pawl 1866, is provided. This preventing means will now be described.

The ratchet 1865 is secured on rightwardly extending turned down portion 1867 (FIG. 111) of the hub 1799, which carries ratchet member 1831 (FIG. 115) and the main indexing member 1794 (FIG. 112). Thus, the indexing member 1794 (FIG. 113), hub 1799, ratchet member 1831, portion 1867 and ratchet 1865 form a solid unit pivoted on transverse shaft 1784. The ratchet 1865 (FIG. 116 is identical to ratchet member 1831 (FIG. 115), but it is assembled on the hub in reversed direction with its ratchet teeth canted in an opposing direction in respect to those on the ratchet member 1831. Pawl 1866 (FIG. 116) is pivoted on shaft 1814, and it is urged counterclockwise against the upper edge of locking bail 1855 by a torsion spring 1868 connected to the pawl and the bail. Pawl 1866 has a tab 1869, on its forward end, overlying the ratchet 1865.

In normal position of the indexing means, the ratchet 1865 is in the clockwise position shown, where tab 1869 overlies a surface 1870 on the ratchet. Whenever a case shift is performed, the link 1844 or link 1850 is moved forwardly, causing bail 1855 to pivot downwardly, as explained. When locking bail 1855 is pivoted downwardly, pawl 1866 is urged to follow by spring 1868. The leverage, between the point of contact of locking bail 1855 with pawl 1866 and the shaft 1814 and the tab 1869 and the shaft, is such that when locking bail 1855 is pivoted sufficiently to release one of the links 1844 or 1850, as explained, the tab 1869 is swung down on the ratchet 1865. Further downward movement of the bail merely stretches the spring 1868. Thus, whenever, a case shift is performed in the machine, the tab 1869 bears against ratchet 1865 in position to prevent unwarranted clockwise turning of the indexing means, precisely at the time when a bail 1775 or 1781 is liberated to assume the position determined by the indexing means. Normally, the indexing members 1793 and 1794 (FIG. 112) are against the bails 1775 and 1781 as shown under the tension of spring 1798, and there is no chance that liberation of a bail would affect the indexing means since the combined spring tension of the bails does not equal the tension of spring 1798 as explained. However, when the indexing means is advanced to its first, second or third operated position, a case shift operation and liberation of a bail 1775 or 1781, by the case shift control means shown in FIG. 116 as explained, will permit the liberated bail to snap clockwise against the indexing means. The snapping action might tend to cause the indexing means to overrotate, but this possibility is prevented by pawl 1866. In the first and second operated position of the indexing means, tab 1869 of pawl 1866 is lowered on top of a ratchet tooth 1871 or 1872, respectively, at the time the case control is operated as explained, and clockwise over-rotation of the indexing means is prevented by the tooth 1872 or a tooth 1873, respectively, since tab 1869 is then situated in blocking position just to the rear of the respective tooth. When the indexing means is in the third operated position and the case shift control is operated, as explained, tab 1869 is idly lowered on top of tooth 1873, but overrotation of the indexing means is prevented by limit stop 1810 (FIG. 112) on indexing member 1794 resting against rod 1800 as described.

As described, automatic back spacing, or deleting as it is called may eliminate normal characters or spaces from the line and accordingly the carriage is automatically back spaced to make the deleted character space or spaces again available in the line. Since the key lock means operates automatically during forward operations of the machine to prevent the line from being extended beyond the right margin, the key lock means must be automatically back spaced, on occasions when it has been brought into action, to conform with the restored space in the line. However, it is not necessary to back space the key lock means unless the line is extended to less than 0.100", before back spacing occurs.

As previously explained, lost motion member 1802 (FIG. 112) is constructed to permit the indexing means (members 1793, 1794, etc.) to move an additional portion of a step reversely (counterclockwise), under tension of spring 1798, beyond the point where lost motion member 1802 may be stopped. In the third operated position of the indexing means, the fixed stop 1810 is moved clockwise against stationary shaft 1800, as explained. In this position of the parts, the lost motion member 1802 stands just clockwise of adjustable stop 1809, there being only a clearance amount between a surface 1874 on lost motion member 1802 and a rearward face 1875 on the stop 1809 moved to operated position. If a line is completely filled out and a 0.050" normal character or space amount is back spaced, solenoid 1828 is energized for aligning surface 1875 on adjustable stop 1809 with the surface 1874 on lost motion member 1802, and simultaneously solenoid 1838 (FIG. 115) is energized to release the indexing means as explained. When this occurs, the released indexing means shifts counterclockwise under tension of spring 1798 (FIG. 112), and surface 1874 contacts surface 1875, detaining the lost motion member 1802 substantially in third operated position, while the indexing member 1794 moves a part of a step counterclockwise until the rearward side of lost motion limit hole 1804 moves against the stud 1803. When the solenoid 1828 and 1838 (FIG. 115) are deenergized, spring 1821 returns the tab 1836 of detent 1835 down, in this instance, on top of tooth 1834 of ratchet member 1831, and spring 1829 (FIG. 112) returns stop 1809 to its ineffective position. At the instant stop 1809 clears the surface 1874 of lost motion member 1802, the indexing means and its ratchet member 1831 (FIG. 115) shifts the rest of the step counterclockwise where surface 1833 contacts tab 1836. Thus, the indexing means is returned from the third to the second operated position.

Similarly to the above, when the line is completely filled out and the indexing means is in the third operated position, and when a 0.075" normal character or space is then deleted, the solenoids 1823 (FIG. 112) and 1838 (FIG. 115) are energized for rendering stop 1808 (FIG. 112) effective and for releasing the indexing means as explained. Upon release of the ratchet member 1831 (FIG. 115), the indexing means is returned by spring 1798 (FIG. 112) counterclockwise one full step and another part of a step, at which point surface 1874 on lost motion member 1802 contacts stop 1808 and the rearward side of lost motion limit hole 1804 in member 1794 contacts the stud 1803. Upon deenergization of the solenoids, spring 1821 (FIG. 115) operates detent 1835 and tab 1836 down on top of tooth 1833 and, upon clockwise movement of stop 1808 (FIG. 112) by spring 1821 above surface 1874, the spring 1798 shifts the indexing means the remaining part of the second step where tooth 1832 (FIG. 115) of ratchet member 1831 is stopped against tab 1836 of the detent 1835. Thus, the indexing means is returned from the third to the first operated position.

When a line is fully filled out and the indexing means is in the third operated position, as explained, and then a 0.100" normal character or space is deleted, the adjustable stops 1808 or 1809 (FIG. 112) are not affected. In this instance, the solenoid 1838 (FIG. 115) alone is operated to release the ratchet member 1831, as explained, and thus the indexing means is permitted to return to normal position, where stop 1801 (FIG. 112) contacts shaft 1800 as shown. Since the underline key 19 does not cause carriage movement, it does not affect the forward or reverse operation of the differential key locks.

From the above, it can be seen that the indexing means can be differentially returned from any operated position to another operated position or to normal position as required, due to back spacing operations, upon proper selective controlled operation of solenoids 1823, 1828 (FIG. 112) and 1838 (FIG. 115). Selective control of the solenoids is accomplished by commutator arrangements therefor (shown particularly in FIGS. 108 and 109) in the amount left in the line mechanism 1483. The automatic selective control of the solenoids, under all conditions, will be described presently. However, the differential word and nut space key lock bail arrangement, shown in FIG. 58, will be described first.

The 0.050" space bar 760 and the 0.50", 0.075" and 0.100" nut space keys 761–763 each have the same designated space value in both upper and lower case conditions. Therefore, there is no need for the upper-lower case control means to affect the space key locking means. The locking means for the space keys could be directly connected with the indexing means, levers 1793 and 1794 (FIG. 112), for operation therewith, without departing from the spirit of the invention. However, since the electrical contacts under the keyboard keys 760–763 are in the way of direct connection, the control for the space key locking means is connected to one side of the differential key lock mechanism in this particular embodiment.

A pair of upstanding levers 1876 and 1877 (FIGS. 58 and 113) are secured to bail shafts 1778 and 1784, respectively, for rotation with the respective bails about the axes of the shafts. It should be remembered that one of the bails 1775 or 1781 (FIG. 116), is always rendered operable by the mechanism shown here, and also, whenever the indexing means (FIG. 112) is operated as described, the operable bail is situated in a first, second or third operated position. Therefore, whenever a bail is in an operated position, the corresponding upstanding lever 1876 or 1877 (FIG. 58) is likewise in a first, second or third clockwise operated position.

A rightwardly extending stud 1878 (FIGS. 113 and 58) is secured on the upper end of a member 1879, which is pivoted at its lower end on shaft 1778. The forward end of a link 1880 is pivotally connected to the stud 1878, and the rearward end of the link is pivotally connected to a rightwardly extending stud 1881, which is secured on the upper end of a member 1882. The lower end of member 1882 is pivoted on shaft 1784. A torsion spring 1883, connected to member 1882 and upstanding lever 1877, urges the member 1882 (FIG. 58) counterclockwise where the stud 1881 normally engages the upper end of upstanding lever 1877. Normally, stud 1878 is also in engagement with the upstanding lever 1876, as shown. It can be seen from the above that, upon operation of the lower case bail and its shaft 1778 and lever 1876 clockwise to an operated position, the upstanding lever 1876 moves the parts 1878–1882 accordingly to operated position against the tension of spring 1883. Likewise, when the upper case bail, its shaft 1784 and lever 1877 are operated clockwise, upstanding lever 1877 moves the interconnected parts 1878–1882 clockwise to the corresponding operated position. Thus, the stud 1878 is always positioned in either normal position, or in a position corresponding to the position of an operated bail 1775 or 1781 (FIG. 112).

A member 1884 (FIG. 111) is pivoted on shaft 1778, between lever 1876 and member 1879 and it is urged clockwise to normally rest against stud 1878 (FIG. 58) by a torsion spring 1885 connected to members 1879 and 1884. Thus, by tension of spring 1885, member 1884 is urged to follow stud 1878, when the stud is moved clockwise to operated position, and, when the stud 1878 is moved counterclockwise, the stud moves the lever 1884 accordingly.

A link 1886 is pivotally connected to the upper end of member 1884 and it extends forward where it is pivotally connected to a left side portion 1887 of a transverse bail 1888. Bail 1888 extends rightward in front of the nut space keys 761–763 (FIG. 3) and the space bar 760. A right side portion 1889 (FIG. 117) of bail 1888 is similar to left side portion 1887 (FIG. 58). The side portions extend upward from the bail, and their upper ends are secured to a shaft 1890 for rotation therewith. The shaft 1890 (FIG. 117) is pivotally mounted on the left and right channel members 13 and 14 of the main frame 1 to permit swinging of bail 1888 (FIG. 58) counterclockwise to differential operated positions and normally clockwise to the illustrated ineffective position.

In order to avoid an unnecessary multiplicity of numbers and since the structures of the space keys 760–763 (FIGS. 57 and 58) are similar as described in topic "15". Space Keys And Their Circuits", the numbers of the parts for the 0.100" nut space key 763 (shown in the foreground in FIG. 58) will be used as exemplary in this portion of the specificiation devoted to space key locks.

A lever member 7991 (member 791 now being used as exemplary also of the members 774, 783 and 801 (FIG. 57)) at the bottom of each of the 0.050", 0.075" and 0.100" nut space keys 761–763 and one such member at the bottom of the space bar 760 are equipped with differentially arranged abutment projections. Projections 1891 for the 0.050" nut space key 761 and the space bar 760, which is also a 0.050" key as explained, extend forward only sufficiently to be blocked by the transverse bail 1888 in its third (extreme) counterclockwise operated position. A projection 1892 for the 0.075" nut space key 762 extends sufficiently to be blocked by the bail 1888 in both second and third operated positions of the bail while a projection 1893 for the 0.100" nut space key 763 extends to be blocked by the transverse bail 1888 in all three operated positions. Normally a space key may be operated and its member 791 rotated thereby as explained, without interference with the bail. However, when the transverse bail 1888 is rotated counterclockwise sufficiently to block full clockwise rotation of a projection and its member 791, the respective space key is blocked before it has been operated effectively.

Since the key locking means operates when a character or space key is operated (depressed) as will be explained, bail blocking surfaces 1894 are provided on the forward end of each of the projections 1891–1893 to prevent the transverse bail from moving in under a projection then possibly in operated position. The bail blocking surfaces 1894 are arcuate and concentric with the axis of the stud 792. If the transverse bail 1888 is moved against an operated space key 760–763, return of the key will cause the surface 1894 to move below the transverse bail 1888 and let the bail move over the projection 1891–1893, thus blocking a successive operation of that key 760–763.

From the above, it can be seen that operation of the lower or upper case bail, 1775 or 1781 respectively (FIG. 112), to the first, second or third operated position, also causes the transverse bail 1888 (FIG. 58) to be moved to the corresponding position for blocking effective operation of the 0.050", 0.075" or 0.100" space keys 761–763, respectively. Likewise, backspacing operation of an operated bail 1775 or 1781 (FIG. 112), as explained, is transmitted to the transverse bail 1888 (FIG. 58). Thus, the space keys as well as the character keys are blocked against operation, only when their space will not fit into the amount of room remaining in a line.

The manner in which the indexing means is controlled for operation by the 0.050", 0.075" and 0.100" commutators, described above, will now be described.

The current for operating the indexing means originates at a source (S) and travels through wire 137 (FIG. 119), the tape return key 138 in normal position, the wire 139, the delete key 140 in normal position, and it normally when required travels via wire 141 and a wire 1895 connected to the wire 141 and to the solenoid 1806. When the line has progressed sufficiently as explained, the solenoid 1806 performs the forward stroke operations of the indexing means as described. However, when the delete key 140 is operated, the current travels from the source (S), through the tape return key 138 in normal position as usual, but now the current is cut off from wires 141 and 1895 and it is directed to reverse key circuit wires 1145 and 1896 by the delete key in operation position.

The normal forward key lock circuits will now be described. The indexing mean's forward operating solenoid 1806 is connected with the one step limit control solenoid 1823 by a wire 1897. Solenoid 1823 is connected by wires 1898 and 1899 to the contacts 1719 and 1723 in the 0.125" and 0.025" representing positions, respectively, relative to blade 1713 (FIG. 106) as described. The interconnected contacts 1725–1730 (FIG. 119), also on plate 1590 in positions 0.125" to 0", respectively, in respect to blade 1714 (FIG. 106) as described, are connected by a wire 1900 to the 0.050" key lock circuit ground relay 153, the magnet of which is in the 0.050" circuit (wires 150, 156, FIG. 11) leading from the carriage moving mechanism 149 and which is provided for grounding wire 1900 (FIG. 119) whenever the carriage moving mechanism 149 is operated to move the carriage 0.050". The solenoid 1823 is also connected by wires 1898 and 1901 to contact 1754 on contact plate 1591 in the effective 0.175" position in respect to blade 1750 (FIG. 106) as described, and it is connected further by wires 1902 and 1903 (FIG. 119) to contacts 1736 and 1742 in the 0.150" and 0" positions respectively relative to blade 1733 (FIG. 106), as described, are connected by a wire 1904 (FIG. 119) to the relay 154, which is provided for grounding wire 1904 whenever the carriage moving mechanism 149 is operated to move the carriage 0.075". The interconnected contacts 1762-1769, in 0.175"-0" positions respectively relative to blade 1751 (FIG. 106) as described are connected by a wire 1905 (FIG. 119) to the relay 155, which is provided for grounding wire 1905 whenever the carriage moving mechanism 149 is operated to move the carriage 0.100" as described.

The forward operating solenoid 1806 is also connected with the two step limit control solenoid 1828 by a wire 1906. The solenoid 1828, in turn, is connected by wires 1907 and 1908 to the contacts 1720 and 1724 in the 0.100" and 0 positions, respectively, in plate 1590 relative to the blade 1713 (FIG. 106) as described. The solenoid 1828 (FIG. 119) is further connected by wires 1907, 1909 and 1910 to contacts 1755 and 1737, on contact plate 1591. Contact 1755 is in the 0.150" position relative to blade 1750 (FIG. 106) as described, and contact 1737 (FIG. 119) is in the 0.125" position relative to blade 1732 (FIG. 106) as described.

The solenoid 1806 (FIG. 119) is also connected by wire 1897, wire 1911 and wire 1912 to interconnected contacts 1721 and 1722 in the 0.075" and 0.050" representing positions, respectively, relative to blade 1713 (FIG. 106) as described. The wire 1911 (FIG. 119) is also connected by wire 1913 to interconnected contacts 1738-1741 and 1756-1761 on plate 1591. The contacts 1738-1741 are situated in the 0.100"-0.025" positions, respectively, relative to blade 1732 (FIG. 106) as described. Also, it may be recalled, the contacts 1756-1761 (FIG. 119) are in the 0.125" to 0 positions, respectively, relative to blade 1750 (FIG. 106).

When the carriage 80 is advanced to 0.175" from the right margin, the amount left in the line mechanism 1483 is operated accordingly, and the rotary switch blade support lever 1580 (FIG. 106) is so positioned that blades 1750 and 1751 are engaged with contacts 1754 and 1762 (FIG. 119), respectively, for conducting cuurrent therebetween. When this is the condition and any normal 0.100" (four unit) key 16 is operated, current passes through wire 1895, operates solenoid 1806 for motivating the indexing means forwardly, passes through wire 1897 and solenoid 1823 for stopping the indexing means at first operated position for thereupon locking 0.100" keys and the underline key 19 as explained, passes through wires 1898 and 1901, through contacts 1754 and 1762 and the blades engaged therewith as explained, and leads to ground through wire 1905 and relay 155, which is operated by the 0.100" carriage moving circuit as described. Thus, it is seen that the 0.100" character keys 16 0.100" space key 763 and the underline key 19 are locked against further operation in a line where the carriage 80 is caused to move from 0.175" to 0.075" from the right margin by operation of a 0.100" character or space key 763.

In instances where the carriage is advanced to 0.150" from the right margin, the switch blade support lever 1580 (FIG. 106) is so positioned that blades 1750 and 1751 are engaged with contacts 1755 and 1763 (FIG. 119), and, at the same time, blades 1732 and 1733 (FIG. 106) are engaged with contacts 1736 and 1743, FIG. 119, as described. Under this condition, when any normal 0.100" character or space key 763 is operated, current passes through wire 1895 and the forward operating solenoid 1806, through wire 1906 and solenoid 1828 for stopping the indexing means at the second operated position and for thereupon locking 0.100" keys 16 and 0.075" keys 16 against further operations as explained, it follows wires 1907 and 1909, passes through contacts 1755 and 1763 and the blades engaged therewith as explained; and it leads to ground through wire 1905 and relay 155, which is operated by the 0.100" carriage moving circuit as described. Under the instant example condition, when any 0.075" character or space key 762 is operated; current passes through wire 1895 and the solenoid 1806, through wire 1897 and solenoid 1823 for stopping the indexing means at first operated position for thereupon locking only the 0.100" keys 16 against further operation as explained; it follows wires 1898, 1901 and 1902; goes through contacts 1736, 1743 and their blades; and it goes to ground through wire 1904 and relay 154, which is operated upon preparation for 0.075" carriage movement as explained. Thus, it is seen that both 0.100" and 0.075" character and space keys 762, 763 are locked against further operation in a line where the carriage has moved from 0.150" to 0.050" from the right margin, and that only 0.100" keys are locked in a line where the carriage 80 has moved from 0.150" to 0.075" from the right margin.

In instances where the carriage 80 is advanced to 0.125" from the right margin, the switch blade support lever 1580 (FIG. 106) is so positioned that blades 1750 and 1751 are engaged with contacts 1756 and 1764 (FIG. 119), that blades 1732 and 1733 (FIG. 106) are engaged with contacts 1737 and 1744 (FIG. 119), and, at the same time, blades 1713 and 1714 (FIG. 106) are engaged with contacts 1719 and 1725, on contact plate 1590 (FIG. 119), as described. Under this condition, when any normal 0.100" key 16 is operated, current passes through wire 1895 and solenoid 1806 for operating the indexing means to the third operated position as described for locking all keys against further operation, it passes through wires 1897, 1911 and 1913, contacts 1756 and 1764, wire 1905 and passes to ground through relay 155 which is operated upon preparation for 0.100" carriage movement. Under the instant example condition, when any 0.075" key 16 is operated; current passes through wire 1895 and solenoid 1806; wire 1906 and solenoid 1828 for stopping the indexing means in the second operated position and locking 0.100" and 0.075" keys 16; it follows wires 1907, 1909 and 1910; goes through contacts 1737, 1744; and it goes to ground through wire 1904 and relay 154, which is operated for 0.075" carriage movement. Under the same condition, when a 0.050" key 16 is operated, current passes through wire 1895 and solenoid 1806; wire 1897 and solenoid 1823 for stopping the indexing means at the first operated position, where only a 0.100" keys 16 are locked; it continues through wires 1898, 1899, contacts 1719, 1725, wire 1900 and relay 153 operated upon 0.050" carriage preparations. Thus, it is seen that all 0.100", 0.075" and 0.050" keys 16 are locked against further operation in a line where the carriage moves from 0.125" to 0.025" from the right margin, that the 0.100" and 0.075" keys are locked in a line where the carriage moves from 0.125" to 0.050" and that only the 0.100" keys are locked in a line where the carriage moves from 0.125" to 0.075" from the right margin.

When the carriage 80 is at 0.100" position from the right margin and a normal 0.100" position from the right margin and a normal 0.100" key is operated, current is directed through wire 1895, solenoid 1806, wires 1897, 1911 and 1913; contacts 1757, 1765; wire 1905, and relay 155, for operating the indexing means to the third operation position and locking all keys against further operation. When the carriage is in the same 0.100" position and a 0.075" key is operated, current goes through wire 1895, solenoid 1806, wires 1897, 1911 and 1913; contacts 1738, 1745; wire 1904, and relay 154, for operating the indexing means to the third operated position and locking all keys. When the carriage is in the same 0.100" position and a 0.050" key is operated, current flows through wire 1895, solenoid 1806, wire 1906, solenoid 1828, wire 1907, wire 1908, contacts 1720 and 1726, wire 1900 and relay 153, for operating the indexing means to the second operated position and thus locking 0.100" and 0.075" keys.

When the carriage is at 0.075" position, the 0.100" keys are already locked by one of the systems described above. However, the 0.075" and 0.050" keys are still operable. Thus, when the carriage is at 0.075" and 0.075" key is operated, current passes via wire 1895, through solenoid 1806 for moving the indexing means from the first to the third operated positions for thereupon locking all keys, and it continues to ground through wires 1897, 1911 and 1913, contacts 1739 and 1746, wires 1904 and relay 154. Likewise, when the carriage is at 0.075" and a 0.050" key is operated, current passes via wire 1895 through solenoid 1806 for moving the indexing means to the third position for locking all keys, and it continues to ground through wires 1897, 1911 and 1912, contacts 1721 and 1727, wire 1900 and relay 153.

When the carriage 80 is at 0.050" position, the 0.100" and 0.075" keys are already locked as described. However, operation of a 0.050" key at this time causes current to pass via wire 1895, solenoid 1806 for moving the indexing means to the third operated position and thus locking all keys against further operation, and it goes to ground through wires 1897, 1911 and 1912, contacts 1722 and 1728, wire 1900 and relay 153.

From the above, it can be seen that the character and space keys are appropriately differentially locked against forward operations that would otherwise cause the machine to extend beyond the preset right margin. Also, it should be noted that as long as sufficient space remains at the end of a line, any key may still be operated.

The manner in which the key lock mechanism is automatically operated reversely to differentially unlock the character and space keys, as appropriate space is restored during automatic deleting (back spacing) operations, under control of the amount left in the line mechanism, will now be described.

As explained under Topic 17 hereinbefore, depression of the delete key 140 causes automatic back spacing as required under control of the back space decoder 1095, and the relays 155, 154, and 153 (FIG. 66) are appropriately operated for 0.100", 0.075" and 0.050" normal characters and spaces, respectively, the same for reverse operations as for forward operations. In other words, the relay 155 is operated when the carriage is back spaced 0.050". Also, as explained, depression of the delete key 140 (FIG. 11) breaks the circuit from source to wire 141 and directs the source to wires 1145 and 1896 (FIG. 119).

The wire 1896 is connected to the magnet 1914 of a relay 1915, and a wire 1916 is connected between the magnet 1914 and the wires 1897 and 1906. The relay 1915 is operated for providing a ground for a circuit which operates solenoid 1838 and thereby operates the key lock detent 1835 to release the ratchet member 1831 for back spacing the indexing means as described.

When relay 1915 is operated, current passes from source, through solenoid 1838 and a wire 1917, and goes to ground through the relay.

When a line has been completely filled out and back spacing of a 0.100" normal character or space occurs, the relay 155 is operated as described. When this is the situation, current passes through wire 1896, relay 1915, wires 1916, 1897, 1911 and 1913, contacts 1761 and 1769, wire 1905 and the operated relay 155. Operation of relay 1915 permits current to travel from source, through solenoid 1838 for releasing the key lock detent 1835 and permitting the indexing means to return to normal position where all keys are unlocked for operation, and it goes to ground through wire 1917 and the operated relay 1915.

When a line is completely filled out and back spacing of a 0.075" character or space occurs, the relay 154 is operated as described. When this is the situation, current passes through wire 1896, relay 1915 for releasing the indexing means as described, through wires 1916 and 1897, energizes solenoid 1823 for stopping the indexing means at the first operated position where only 0.100" keys are locked as described; it contacts 1742 and 1749, wire 1904 and the operated relay 154. Thus, the 0.050" and 0.075" keys are again rendered operable.

When a line is completely filled out and back spacing of a 0.050" character or space occurs, the relay 153 is operated. When this is the situation, current passes through wire 1896, relay 1915, wires 1916, and 1906, solenoid 1828 for stopping the indexing means in the second operated position where 0.075" and 0.100" keys are locked as described, it continues through wires 1907 and 1908, contacts 1724 and 1730, wire 1900 and the operated relay 153. Thus, only the 0.050" keys are released for operation.

When 0.025" remains in a line and a 0.100" normal character or space is deleted, current travels through wires 1896, relay 1915 for full return of the indexing means; through wires 1916, 1897, 1911 and 1913; contacts 1760 and 1768, wire 1905 and the operated relay 155. Thus, all keys are again rendered operable.

When 0.025" remains in a line and a 0.075" character or space is deleted, current travels via wire 1896, relay 1915 for full return of the indexing means, through wires 1916, 1897, 1911 and 1913, contacts 1741 and 1748, wire 1904 and the operated relay 154. Thus, all keys are again rendered operable.

When 0.025" remains in a line and a 0.050" character or space is deleted, current passes through wire 1896, relay 1915, wires 1916 and 1897, solenoid 1823 for positioning the indexing means in first operated position for the locking of 0.100" keys only, passes through wires 1898 and 1899, contacts 1723 and 1729, wire 1900 and the operated relay 153. Thus, the 0.050" and 0.075" keys are again rendered operable.

When 0.050" or more remains in a line and any normal character (0.050" or more) is deleted, the amount remaining in the line after the first back space operation will equal 0.100" (the size of the largest character) or more. Therefore, when 0.050" remains in a line and any normal character or space is deleted, current will be directed through wire 1896, relay 1915 for restoring the key locks to normal as explained, and wires 1916, 1897 and 1911. However, the circuits leading from wire 1911 differ somewhat in each case as follows: When 0.050"

remains and 0.100" is deleted, current travels from wire 1911, through wire 1913, contacts 1759 and 1767, wire 1905 and relay 155; when 0.050" remains and 0.075" is deleted, current passes through wires 1911 and 1913, contacts 1740 and 1747, wire 1904 and relay 154; and when 0.050" remains and 0.050" is deleted, current passes through wires 1911 and 1912, contacts 1722 and 1728, wire 1900 and relay 153. When 0.075" remains and 0.100" is deleted, the circuit in wires 1911 and 1913, contacts 1758 and 1766, wire 1905, and relay 155 is effective; when 0.075" remains and 0.075" is deleted, the circuit in wires 1911 and 1913, contact 1739 and 1746, wire 1904, and relay 154 is effective; and when 0.075" remains and 0.050" is deleted, the circuit in wires 1911 and 1912, contacts 1721 and 1727, wire 1900 and relay 153 is effective.

When 0.100" or more remains in a line, the keys are not locked and any back spacing that may occur is of no consequence, in respect to the key locks, since the indexing means is already (or still, as the case may be) in normal position. It can be seen that operation of relay 1915 and solenoid 1823 and 1828, when the indexing means is in normal position, has no effect and does no harm. However, it may be understood that the relay 1915 and solenoids 1838, 1923 and 1928 will not be affected by deletion of a 0.050" character or space when the carriage 80 is more than 0.125" from the right margin, since there are no contacts located counterclockwise from contact 1725 on the contact support plate 1590; by deletion of a 0.075" character or space when the carriage is more than 0.150" from the right margin, since there are no contacts counterclockwise from contact 1743 on contact plate 1591; or by deletion of a 0.100" character or space when the carriage is more than 0.175" from the right margin, since there are no contacts counterclockwise from contact 1762 on contact plate 1591.

Even though the unnecessary operations of the relay 1915 and solenoids 1838, 1823, 1828 that may occur during deleting operations when the carriage is between 0.100" and a maximum of 0.175" from the right margin are so infrequent as to be relatively unimportant and although we do not show the following structure in the preferred embodiment, we conceive a normally open switch, which is closed only when the carriage is 0.100" and less from the right margin, in the wire 1896 or 1916 (FIG. 119), for normally preventing operation of the relay 1915 and solenoids 1823, 1828 and 1838 during deleting operations and thereby preventing the unnecessary operations mentioned above. This switch could be part of one of the amount left in a line commutators, for example, and it would be closed only when the amount left in the line mechanism 1483 stood at 0.100" and less.

Restoration of the differential key locks, upon conclusion of a line, will now be described. When the differential key lock indexing means 1794 etc. (FIG. 112) and its ratchet member 1831 (FIG. 115) are in one of the three clockwise operated positions as described, a normally open switch 1918 is closed, in preparation for restoration of the differential key locks that occurs upon full return of the carriage and the consequent closure of the switch 1540 (FIG. 98).

The switch 1918 (FIG. 115) is secured on a bracket 1919 which in turn is secured on the frame plate 1770. The switch 1918 is situated so as to be normally held open, as shown, by an insulated stud 1920 which is secured on the ratchet member 1831. However, the stud 1920 moves away from the switch 1918 and thus permits the switch to close whenever the indexing means and the ratchet member 1831 is shifted clockwise in the first, second and third operated positions as described.

A wire 1921 (FIG. 119) is connected to the solenoid 1838 and to switch 1918. A wire 1922 is connected between switch 1918 and the switch 1540.

When the carriage 80 is fully returned and the compound switch 1538 (FIG. 98) is shifted by insulator 1537 as described, and when the differential key locks are operated to lock at least some of the keys and the switch 1918 (FIG. 115) is closed as described, current flows from source (S) through solenoid 1838(FIG. 119) for clearing the differential key locks, through wire 1921, the now closed switch 1918, wire 1922 and it goes to ground as indicated through the now closed switch 1540. When the ratchet member 1831 is thus released, the indexing means 1794 etc. (FIG. 112) is restored counterclockwise by torsion spring 1798 as described for unlocking the keys, and, since the ratchet member 1831 (FIG. 115) and the stud 1920 are restored counterclockwise directly with the indexing means, the switch 1918 is opened only when the differential key locks fully return to normal. As the switch 1918 is opened, during the final return step of stud 1920, the solenoid 1838 is deenergized for permitting reengagement of detent 1835 with the ratchet member 1831 under tension of torsion spring 1821.

From the above, it can be seen that the differential key locks are restored from a possible operated position, when the carriage is returned, but the solenoid 1838 (FIG. 119) is not operated when the differential key locks are already in normal position at the time the carriage is returned. The operated differential key locks are restored as just described, regardless of whether or not the machine is conditioned for justifying or punching.

27. DIVIDING AND ENCODING MECHANISM FOR JUSTIFYING

The dividing and encoding mechanism 1923 (FIG. 92) is located in the composing machine, on the lower level at the extreme rear of the machine as indicated in FIGS. 1 and 45. This dividing and encoding mechanism 1923 is housed in and mounted on a six-sided frame consisting of a left side plate 1924 (FIG. 1), a rear plate 1925, a forward plate 1926, a right end plate 1927 (FIG. 45), a top plate 1928, and a bottom plate 1929, which are secured in any known manner, and the assembly thus formed is likewise secured to the base frame 1.

In general terms the dividing and encoding mechanism 1923 comprised of five different means, which may be listed as follows:

I. Word Space Selected Dividing Means 1. 8 Dividing and Encoding Plate Groups (plate assemblies)
   a. Group centralizers
2. Dividing and Encoding Plates in each Group
   a. Odd and Even Direction Contact Nibs situated on the plates for coding the quotient and remainders.
   b. Code Bar Contact Nibs II. Justifying Units Space Amount selected and motivated Slide Means 1. 2 parallel Slide Plates in each of 23 positions
   a. Parallel Cam Angle Slots in each slide plate.

III. Dividing Group Selecting Means, word space controlled

1. Connecting Means (hooks) for connecting each selected Group to the motivating means
   a. Motivating Circuit Switch Means
2. Group Selecting Solenoids IV. Dividing Group Motivating Means 1. 1 Odd Number and 1 Even Number operating solenoid
   a. Motivating Bail Means
   b. Centralizer for the Bail Means V. Stationary Code Channel Bars The word space selected dividing means is comprised of eight groups of dividing and coding plate assemblies, designated as 1930 and 1931 in FIGS. 120 and 122. These dividing plate group assemblies 1930 and 1931 are structurally the same, except for the coding configurations on the plates. However, the group plate assemblies 1931 are inverted in respect to the assemblies 1930, so as to be equally disposed in respect to slide means 1932,, which are situated transversely between the group assemblies 1930 and 1931, and so as to make the dividing and encoding mechanism 1923 more compact.

Each of the group plate assemblies 1930 and 1931 are comprised of seven or eight dividing and encoding plates 1933 (FIG. 120), the exact number of which depends upon the codes for the involved dividend representing group. The coding configurations of the plates will be explained later. The dividing and encoding plates 1933 are situated vertically side by side, as shown in cross-section in FIG. 123, and they extend longitudinally leftwardly and rightwardly as shown in FIG. 120 and in respect to the machine. The plates 1933 are assembled in spaced vertical slots provided therefor in insulating members 1934. The vertical slots are spaced so as to hold the dividing and encoding plates 1933 in spaced relation to each other as shown in FIG. 123 and so as to insulate the plates 1933 from each other and from the rest of the machine.

There are four such support insulating members 1934 (FIG. 120) in each group assembly for supporting the plates 1933 in the group. Each insulator member 1934 has a tenon 1935 on both its forward end and rearward end, each of which tenons 1935 extends through a rectangular mortise-like hole 1936 (FIG. 122) for supporting the insulator member 1934 with its dividing and encoding plates 1933 (FIG. 120) on a pair of parallel support members 1937.

There are two support members 1937 paralleling the plates 1933 in each group, one such member 1937 (FIG. 123) to the left or rearward of the dividing and encoding plates 1933 and an identical member 1937 to the right or forward of the plates 1933 in each group. A shouldered stud 1938 (FIG. 121) extending between the support members 1937, maintains the members in their proper spaced relation. There is one such stud 1938 near the right end of each pair of members 1937 (FIG. 120) and another identical such stud 1938 near the leftward end of the pair of members 1937. The shoulders on either end of the stud 1938 (FIG. 121) maintain the support members 1937 in proper spaced parallel planes and nuts 1939, threaded on both ends of the studs, maintain the members against the shoulders on the studs and against the mortised ends of the insulator members 1934 (FIG. 120). The assembly thus formed of parts 1933, 1934, 1937, 1938 and 1939 (FIG. 122) is secured together as just described so as to be movable longitudinally together as a unit, and so as to be situated in any one of three positions, as will be explained.

Each of the parallel support members 1937 has a horizontal slot 1940 and another such slot 1941 in the left and right ends, respectively. A flanged bushing 1942 is assembled into each one of these slots, with the flange of the bushing pressing against the outer face of each of the support members 1937 in each group, as can be seen in FIG. 121.

An upper shaft 1943 (FIG. 124) is assembled through the flanged bushings 1942 in each of the four group assemblies 1930 for supporting the leftward ends of the upper groups and these shafts are secured in the rear frame plate 1925 and the forward plate 1926 and an identical lower shaft 1943 is assembled through the bushings 1942 for supporting the lower group and it is also supported in the frame plates 1925 and 1926. A similar pair of shafts 1944 are assembled through the upper and lower bushings 1942 for supporting the right ends of the group assemblies as indicated in FIG. 122, and the shafts 1944 are secured in the frame plates 1925 and 1926 (FIG. 124), in the same manner as that just described for the shafts 1943. C-shaped clips 1945 are assembled in annular grooves in the shafts 1943 and 1944 (FIG. 122) for preventing the forward most groups from moving forwardly on the shafts 1943 (leftwardly in FIG. 124), and also other clips 1945 are assembled in annular grooves in the shafts to prevent the rearward most group assemblies from moving rightward as shown. Spacers 1946 assembled on the shafts 1943 and 1944, between the intermediate groups, maintain the respective groups in their proper spaced relationship as shown.

From the foregoing and as can be seen by referring to FIG. 122, each of the groups may be moved from the illustrated normal central position to a leftward position and a rightward position, and, as will be explained elsewhere, they may be moved leftwardly from the central position for representing one value and may be moved rightward from the central position to represent another value. Movement of the groups leftward and rightward is accurately limited, in both instances, by the alternate extents of the slots 1940 and 1941 and the bushings 1942 on the shafts 1943 and 1944 on which each group assembly 1930, 1931 is mounted.

A centralizer is provided for each of the group assemblies 1930 and 1931 for returning and normally maintaining its respective group in the central position. A centralizer 1947 (FIGS. 120 and 121) is pivotally mounted on the lower stationary shaft 1944 for centralizing each related upper group assembly 1930, and another centralizer 1948 is pivotally mounted on the upper stationary shaft 1944 for centralizing each related lower group assembly 1931. The centralizers are identical except for their pivotal mountings on the upper and lower shafts, therefore a description of one centralizer should serve to describe the others. The centralizers are comprised of one lever 1949 (FIG. 121) and another identical lever 1950, each of which is equipped with a hub facing the other lever for maintaining the proper spaced relationship of the levers 1949 and 1950. The centralizers are maintained in axial position on their support shafts 1944 by C-shaped clips 1951 fixed in annular grooves therefor in upper stationary shafts 1944.

A torsion spring 1952 is assembled around the hubs of the levers 1949 and 1950 and the ends of the torsion spring 1952 are connected to the levers so as to urge them in contra-directions. The effect of the spring 1952 is such that it will urge the lever 1950 clockwise (FIG. 120) and will urge the lever 1949 counter-clockwise, so as to constantly tend to contact the stationary support shaft 1944 which the levers embrace and to constantly tend to shift the stud 1938, for the respective group assembly 1930, 1931, into vertical alignment with both of the shafts 1944, and thus tend to keep the related group assembly in the normal centralized position. However, when one of the group plate assemblies 1930 or 1931 is moved from its normal centralized position, the affected lever 1949 or 1950 will yield against the tension of torsion spring 1952 (FIG. 121), so as to permit such movement.

The exact configurations of the dividing and encoding plate 1933 will be explained in greater detail following a more thorough understanding of the selection and operation of the groups of plates and the selection and operation of the slide means 1932 for entering the factors into the dividing means.

As will be seen, the groups of plates are selected for representing an odd number or an even number of word spaces to be considered in justifying the line. The manner in which the groups are selected will now be explained.

A selecting hook 1953 (FIGS. 120 and 125) is pivotally connected to each of the upper group assemblies 1930 and to each of the lower group assemblies 1931. The selecting hooks 1953 are each equipped with a hub 1954, pivotally mounted on a respective shouldered stud 1938 which is in the leftward end of each group assembly and which is fixed to the support members 1937 in each group. As viewed in FIG. 125, it can be seen that the selecting hooks 1953 for the upper group assemblies are each equipped with a hub 1954 extending leftward from the hook and contacting the inner face of the rear support member 1937, while the selecting hooks 1953 for the lower groups have their hubs 1954 on the rightward side of the hooks for contacting the inner surface of the forward support member 1937. A torsion spring 1955 is coiled about each of the hubs 1954, and each spring is anchored to the juxtaposed support member 1937 and to its respective selecting hook for maintaining the hook normally in ineffective position, disengaged from the motivating means as shown best in FIG. 120.

The hooks 1953 are further held axially on the shouldered studs 1938 by C-shaped clips 1956 (FIG. 125) that are secured in annular grooves in the studs.

The upper hooks 1953 are each connected to a bellcrank 1957 by a link 1958 (FIG. 120), while the lower hooks 1953 are each connected by a longer link 1959 to identical bellcranks 1957. Upwardly extending arms of the bellcranks 1957 are bifurcated to receive a pin 1960 in an armature 1961 of a selecting solenoid 1962. The solenoids 1962 are secured to a stationary bracket 1963, which is secured to the top frame plate 1928. Each of the bellcranks 1957 that are associated with the upper hooks 1953 have hubs 1964 (FIG. 125) extending forwardly or to the right as shown, while the bellcranks 1957 for the lower hooks 1953 have hubs 1964 extending leftward, and these hubs with a washer therebetween hold each pair of bellcranks 1957 in spaced axial relation to each other. Each thusly, disposed pair of bellcranks 1957 are held in proper axial positions by C-shaped clips 1965 on a shaft 1966, on which the bellcranks are mounted.

Shaft 1966 is pivoted at its ends on a pair of upstanding brackets 1967, secured to the top frame plate 1928 (FIG. 120) in any known manner. Further significance of the pivotal mounting for shaft 1966 will be explained more fully later.

A stop rod 1968 is secured at its ends to the brackets 1967 in any well known manner. The stop rod 1968 underlies extensions 1969 on each of the bellcranks 1957. The purpose of the stop rod 1968 and the fingers 1969 is to hold the bellcranks 1957, links 1958 and 1959, and the connected hooks 1953 in normal position under the influence of the springs 1955. From the foregoing, it can be seen that energization of a solenoid 1962 will actuate the armature 1961 rightwardly turning the bellcrank 1957 clockwise for raising the link 1958 or 1959, as the case may be, to rotate the related selecting hook 1953 clockwise about the stud 1938, which is part of the related group assembly 1930, 1931 as described. This is done in order to select a group assembly 1930, 1931 and in so doing connect the assembly 1930, 1931 to the motivating means, which will now be described.

When an upper hook 1953 is actuated clockwise to select one of the plate assemblies 1930, the hook couples with a bail rod 1970. Likewise, when a lower hook 1953 is thus actuated to select a group plate assembly 1931, it likewise couples with a bail rod 1971. The bail rods 1970 and 1971 are secured at their forward ends to a bail member 1972 (FIGS. 125 and 126) and the rearward ends of these rods are similarly secured to a bail member 1973. The bail members 1972 and 1973 are secured to a central shaft 1974.

The central shaft 1974 of the bail unit is pivotally supported in bushings 1975 which are fixed to the rearward frame plate 1925 (FIG. 125) and to the forward frame plate 1926 in any well known manner. C-shaped clips 1976 on the central shaft 1974 and abutting the bushings 1975 prevent axial displacement of the shaft and therefore of the bail unit. Thus, it is seen that the rigid bail unit arrangement, consisting of the rods 1970 and 1971, members 1972 and 1973, and the central shaft 1974 may be operated clockwise or counterclockwise about the axis of shaft 1974, as best seen in FIG. 126. By referring to FIG. 120, it can be seen that, when a hook 1953 that is connected to one of the upper group assemblies 1930 is operated to select a group, the hook is connected with bail rod 1970, and when the bail unit is rocked clockwise the group assembly will be moved rightward, and when such a selection is made and the bail unit is moved counterclockwise about the shaft 1974, the group assembly will be moved leftward. Likewise, when a hook 1953 that is connected to a lower group plate assembly 1931 is operated to make a selection, it will couple with the bail rod 1971, so when the bail unit is rocked clockwise about the axis of shaft 1974, the selected plate assembly will be moved leftwardly, and so when the bail unit is rocked counterclockwise the selected group will be moved rightwardly.

The upwardly extending portion of bail member 1973 (FIGS. 125 and 126) is connected by a link 1977 to the armature of a solenoid 1978, which in turn is secured to the top frame plate 1928. When the solenoid 1978 is energized, it moves the link 1977 (FIG. 126) rightward, and the bail unit is operated clockwise about the axis of central shaft 1974. As will appear later, solenoid 1978 will be energized whenever an even number is selected under control of the word space counter 850.

A link 1979 is assembled onto the bail rod 1971 (FIG. 125) and it is held against the bail member 1973 by a C-shaped clip 180. The rightward end of line 1979 (FIG. 126) is pivotally connected to a lower arm of a bellcrank 1981. Bellcrank 1981 is pivotally mounted on a stud 1982, which is secured to the rear frame plate 1925. The upwardly extending arm of the bellcrank 1981 is pivotally connected to a line 1983, which is pivotally connected to the armature of a solenoid 1984, which in turn is secured to the top frame plate 1928. When solenoid 1984 is energized, it moves link 1983 leftward, and by bellcrank 1981 and link 1979, the bail unit is operated counterclockwise about the axis of shaft 1974. As will appear later, the solenoid 1984 is energized whenever an odd number is selected under control of the word space counter 850.

A centralizer 1985 (FIGS. 125, 126) is provided for holding the bail unit and connected linkages in the normal position shown in FIGS. 126. Centralizer 1985 (FIG. 125) is comprised of two identical members 1986 and 1987. These members are equipped with hubs 1988, pivotally mounted on the central shaft 1974. Hubs 1988 are juxtaposed to maintain the members in proper spaced relationship to each other. Spacing washers 1989 are assembled on the central shaft 1974, to the front and rear of the centralizer 1985, for spacing the member 1987 away from the bail member 1972 and spacing the centralizer member 1986 away from a C-shaped clip 1990 secured on the central shaft 1974. A torsion spring 1991 is assembled about the hubs and it is connected with the members 1986 and 1987 for urging the members in contradirections so as to grip the bail rod 1971 and a stationary rod 1992. Rod 1992 is secured to the front frame plate 1926 at one end while the other end of the rod is secured on a bracket 1993 which is attached to the base frame plate 1929 as shown. By opposingly gripping the movable bail rod 1971 and the stationary rod 1992, the centralizer 1985 constantly tends to centralize the bail unit with its bail rods 1970 and 1971 in vertical alignment with the central shaft 1974 and the stationary rod 1992, as shown in FIG. 126. Since the bail unit is normally centralized and since the bail rods 1970 and 1971 are positioned as shown in FIG. 120, it can be seen that the hooks 1953 are normally in position to latch on to either the rod 1970 or 1971, as the case may be.

Since current will be made available to the justifying and encoding mechanism by the word space counter 850 simultaneously for opeerating one of the selecting solenoids 1962 and one of the motivating solenoids 1978 or 1984 (FIG. 126), a means is provided for delaying operation of the involved motivating solenoid until after proper selection has been completed. To provide for this delay, a normally open switch 1994 (FIGS. 122 and 125) is included in the circuit with both of the motivating solenoids 1978 and 1984 (FIG. 126). Switch 1994 (FIGS. 122 and 125) is equipped with a mounting bracket 1995, which is secured to the top frame plate 1928. It should be recalled that, upon operation of one of the selecting solenoids 1962 (FIG. 120), the respective bellcrank 1957 is rotated clockwise, for operating the respective hook 1953 clockwise. This action connects the selected hook with the appropriate bail rod 1970 or 1971. At the time selection is surely made, normally open switch 1994 (FIG. 125) will be closed to permit operation of the appropriate even or odd number motivating bail unit about the axis of its central shaft 1974. The means for closing switch 1974 (FIG. 125) will now be described.

A bail 1996 (FIGS. 120 and 125) extends across above the leftward extensions 1969 of the bellcranks 1957 to be moved thereby when one of the bellcranks is operated. The bail 1996 is bent over on each of its ends to form two parallel portions that are secured by customary hubs and pins to the shaft 1966, which is pivotally mounted in the brackets 1967 as previously described. The bail 1996 (FIG. 120) has a downwardly and leftwardly extending arm 1997, which carries an insulator 1998 secured to the end of the arm. At about the time the selected hook 1953 is fully engaged with its bail rod 1970 or 1971, the operated bellcrank extension 1969 will have moved the bail 1996 sufficiently to elevate the insulator 1998 and close switch 1994 (FIG. 125).

The justifying unit space amount selecting and motivating slide means will now be described.

First it should be recalled that the group plate assemblies 1931 (FIG. 120) are inverted in respect to the group plate assemblies 1930 so as to be equally disposed in respect to slide means 1932, which are situated transversely between the groups 1930 and 1931. The slide means 1932 can best be seen in FIGS. 122 and 123. There are twenty-three slide means 1932, each corresponding respectively with one of the twenty-three units that may be left in a justifiable line. Each slide means 1932 is comprised of a slide plate 1999 and an identical slide plate 2000, which is inverted and juxtaposed to its companion plate 1999. All of the slide means 1932 are identical, so a description of one will suffice for all.

The slide plate 1999 has a straight edge 2001 (FIG. 123) on the top edge of the plate, and the slide plate 2000 has a straight edge 2002 on the bottom of the plate as these plates are assembled in the machine. Each of the slide plates has a cam slot 2003 near its left end, as viewed in FIG. 123, and a cam slot 2004 near its right end. These cam slots are situated generally on an angle in respect to the straight edges 2001 and 2002 so as to move the companion plate 1999 parallelly upwardly and the slide plate 2000 similarly downwardly when the plates are moved rightward (forwardly in the machine) as will be explained. The plates are mounted on a shaft 2005 extending through the slots 2003 and a shaft 2006 extending through the cam slots 2004. The slide plates are held in juxtaposition, vertically side by side, on the shafts 2005 and 2006 by washers 2007 (FIG. 124), on each side of each pair of plates for holding the slide plates in their respective positions on the shafts. The rightward ends of shafts 2005 and 2006 (FIG. 122) are turned down to form shoulders to abut washers 2009, and the ends of the turned down portions are threaded and receive nuts 2010 drawn up against other washers 2009 and insulators 2011 for solidy mounting the shafts 2005 and 2006 in right frame plate 1927 while insulating the shafts from the slide plate. The leftward end of the shaft 2006 is connected to and insulated from a bracket 2012, which is secured to the forward plate 1926 as indicated in FIG. 123. Similarly, shaft 2005 is secured to and insulated from a bracket 2013, which is secured to the rear frame plate 1925. Thus it is seen that the 23 slide means 1932 are each securely mounted side by side on the shafts 2005 and 2006 which are insulated from the frame but otherwise securely fixed in the assembly. Since it will become important, it should be noted that the direct mounting of the slide plates 1999 and 2000 on the shafts 2005 and 2006 provides for conducting current from the shafts to the plates, but since the ends of the shafts are insulated from the frame the current will not be conducted through the frame.

A vertical slot 2014 is provided in each of the slide plates 1999 and 2000, in the forward, or rightward ends of each of the plates as shown. A pin 2015 (FIGS. 122 and 123) is secured on a lever extension 2016, and the pin extends through the vertical slots 2014 (FIG. 123) of each pair of slide plates 1999 and 2000. Lever extension 2016 is secured to a lever 2017 and insulated therefrom by insulator pieces 2018 and rivets 2019, which are also insulated from the lever and the lever extension. The levers 2017 are equipped with central hubs 2020 (FIG. 122), secured thereto, and the hub portions are pivoted on a horizontal shaft 2021. The horizontal shaft 2021 is fixed in the right side plate 1927 and it is secured at its left end to the bracket 2012. The levers 2017 are held in position on the shaft 2021 by clips 2022 and suitable washers for holding the levers in alignment for engagement as described with the respective slide means 1932. A torsion spring 2023 is assembled about each central hub 2020 and it is anchored to the top plate 1928 (FIG. 123) and the free end is connected to the lever 2017 so as to urge the lever clockwise as shown, and thus to urge the slide plates rearward or leftward to normal position as shown. The upwardly extending portions of the levers 2017 each have a link 2024 or a longer link 2025 pivotally connected to its upward extremity. The shorter and longer links are provided so respective solenoids 2026, that are pivotally connected to these links, may be staggered into two rows and thus to be located axially closer together. Solenoids 2026 are secured to the top frame plate 1928 in any known manner.

Solenoids 2026 are individually selectively operable for motivating the connected and thereby associated slide means 1932 for representing the amount left in the line. Energization of solenoid 2026 pulls its link 2024 or 2025 and rotates the respective lever 2017 counterclockwise. Counterclockwise rotation of one of the levers 2017, by its lever extension 2016 and its pin 2015, shifts the respective slide means 1932 rightward. Rightward shift of a slide means 1932 causes its slide plate 2000 to be horizontally lowered on the shafts 2005 and 2006 through the effect of its cam slots 2003 and 2004. The slide plate 1999 of the operated slide means is operated at the same time and in the same manner except that it will be moved upward by its slots on the shafts 2005 and 2006. By the arrangement just described, only one pair of slide plates 1999 and 2000 will be actuated at any one time and their straight edges 2001 and 2002 will be separated, as just described, for contacting certain nibs of the dividing end encoding plates 1933 in any one operated plate assembly 1930, 1931, as will be explained further. When the operated solenoid 2026 is deenergized, the parts associated therewith are returned to the positions shown by the connected torsion spring 2023.

The general configurations common to each of the dividing and encoding plates 1933 will now be described. For a full view of a dividing and encoding plate 1933, see FIG. 127. Each dividing and encoding plate, as shown, is comprised of an elongated rigid horizontal upper edge portion 2027, a lower edge portion 2028 and an interconnecting expansive spring portion 2029 therebetween. The plates 1933 in the upper group assemblies 1930 are situated in this position, while the plates in the lower group assemblies 1931 are inverted, as indicated for the upper and lower group plate assemblies 1930 and 1931, respectively, in FIG. 120. A notch 2030 (FIG. 127), opening upwardly, in each end of the portion 2027, and such a notch, opening downwardly, in each end of the portion 2028 are provided in each plate 1933 for embracing the four insulators 1934 (FIGS. 120 and 127). The dividing and encoding plates 1933 are assembled into side-by-side slots in the insulators 1934 as previously described and the notches 2030 grip the insulators 1934 so as to situate the plates longitudinally with the insulators, and thus the plates are held securely located in their respective assembly while each plate 1933 is insulated from the assembly and the other plates 1933 therein. It should be understood that the notches 2030, being on the outside top and bottom edges of the plates, permit the portions 2027 and 2028 to yield toward each other against tension of the spring portion 2029 and thus assure good electrical contact between the inner edge portions 2028 of the plate 1933 in a selected and motivated group assembly with the straight edge 2001 or 2003 (FIG. 123) on an operated slide means 1932.

Each dividing and encoding plate 1933 is directly associated with a particular code channel in either a quotient amount encoding punch mechanism or a remainder amount encoding punch mechanism, and, whenever current is passed through a plate, the associated punch is operated to punch the corresponding code bit in the control tape 577, as will be explained. The structure in the justifying mechanism for connecting the individual plates with their respective punch wires will now be described. Each dividing and encoding plate 1933 is equipped with only one pair of contact nibs 2031 (FIG. 127), situated on the upper edge of its portion 2027 in a longitudinal position corresponding to the code channel associated with the particular plate. A group 2032 of eight code channel related bars 2033 are oriented transversely of the plates 1933, as shown, in side-by-side positions corresponding to the quotient channel code bit associated with the plates 1933 which they cross. Six of the bars 2033 are numbered 1–6. Each bar and its number designation corresponds with the related code bit channel and the punch in the quotient amount set of justifying punches. The two unnumbered bars are spares which might only be necessary for increasing the capacity or for merely changing the coding to include more channels, and these bars could be used without departing from the spirit of the invention.

Each end of each stationary bar 2033, for the upper groups of dividing and encoding plates 1933, is secured in an insulator 2034 (FIG. 123), each of which insulators is secured to the top frame plate 1928. Identical but inverted bars 2033 are secured in insulators 2035, secured to the bottom plate 1929, in positions directly below their related upper bars 2033 for accommodating the lower groups of plates. The code bit number related upper and lower bars 2033 are connected together by conductor strips 2036, each of which strips is connected by a wire 2037 to a related channel punch solenoid in a quotient amount set of punches as will be described. The wires 2037 are secured to their respective conductor strips 2036 by screws 2038 extending through holes therefor in the wire ends, an insulator 2039, plate 1925, an insulator 2040 and a threaded hole in the strips 2036 as shown. The screws 2038 are further insulated from the holes in plate 1925 in a customary manner. From the above, it can be understood that the related channel punch will be operated whenever current passes through either one of the two interconnected code channel related bars 2033.

A group 2041 (FIG. 127) of eight code channel associated bars 2042, identical in shape to the bars 2033 just described, are positioned for being contacted by the nibs 2031 of the dividing and encoding plates 1933 which represent the code bits for encoding the number of units in the dividend remainder that may result from division of the amount left in the line by the number of word spaces counted for justifying.

There are eight bars 2042, secured in the upper insulators 2034 (FIG. 123) and eight corresponding inverted bars 2042 fixed in the lower insulators 2035, in the same manner as described for the bars 2033. Each pair of upper and lower bars 2042 (FIG. 127), except for the first and last to be explained, are connected by conductor strips 2043 (FIG. 123) and wires 2044 running to their related solenoids 2051 (FIG. 92) in the remainder punch mechanism 2050. The bars 2042 (FIG. 123) that are numbered 2–7 (FIG. 127) are the only ones required for accommodating the present coding system. The first and last bars are shown as spares, for use only to increase the capacity or to be used if it is desired to change the codes to include these channels.

By referring to the Chart C below, it can be seen that code bit channels 1–6 are all that are required for encoding all of the possible quotient amounts 1–23. Likewise, channels 2–7 are all that are required for the possible remainder amounts 1–15.

CHART C

| JUSTIFICATION CODES | | | |
|---|---|---|---|
| QUOTIENT | CODE THEREFOR | REMAINDER | CODE THEREFOR |
| 1 | 5 | 1 | 7 |
| 2 | 6 | 2 | 67 |
| 3 | 256 | 3 | 267 |
| 4 | 356 | 4 | 257 |
| 5 | 2356 | 5 | 2567 |
| 6 | 2346 | 6 | 357 |
| 7 | 2345 | 7 | 367 |
| 8 | 2456 | 8 | 2357 |
| 9 | 3456 | 9 | 2367 |
| 10 | 1256 | 10 | 3567 |
| 11 | 1345 | 11 | 23567 |
| 12 | 1346 | 12 | 37 |
| 13 | 1356 | 13 | 2347 |
| 14 | 13456 | 14 | 2457 |
| 15 | 1234 | 15 | 2467 |
| 16 | 1235 | | |
| 17 | 1236 | | |
| 18 | 1245 | | |
| 19 | 1246 | | |
| 20 | 12456 | | |
| 21 | 12345 | | |
| 22 | 12356 | | |
| 23 | 12346 | | |

(This chart is also included among the charts to be found immediately following the Figure Descriptions hereinbefore).

Thus it is seen that the bars 2033 (FIG. 127), numbered 1–6, are the only bars necessarily associated with the quotient amounts, in order to accommodate the preferred code arrangement. Likewise, the bars 2042, numbered 2–7, are the only bars necessarily associated with the remainders, in order to accommodate this code arrangement.

Graphic representations of the dividing-encoding plates 1933, in their respective groups, are shown in FIGS. 128–135. The dividing and encoding plate 1933, shown in the foreground in FIG. 127, corresponds with the one indicated diagrammatically as the plate 1933 (FIG. 131) in horizontal line with "7" and designated as "remainder" plate. This plate is in the "group" that is operable for representing 7 spaces or 8 spaces, and the group is movable leftwardly (FIGS. 127 and 131) for representing the odd number 7 and it is movable rightward for representing the even number 8, as also indicated schematically in FIG. 136.

By referring to FIG. 127, it can be seen that electrical contact nibs o and x will not contact any of the slide means 1932 that remain in the normal position shown, when the group 7–8 is shifted leftwardy for representing the odd number 7 of word spaces or when the group is shifted rightward for representing the even number 8 of word spaces. All of the nibs o and x on all of the dividing and encoding plates 1933 are the same in this respect. However, when a group of dividing and encoding plates 1933 is shifted, one pair of slide means 1932 is operated, as previously explained, to contact the nibs o and x that are at the time shifted into engaging alignment with the operated slide means. When such contact occurs, current will pass through a wire 2045 (FIGS. 45 and 122) that is secured to shaft 2006, through shaft 2006, through the operated slide means 1932 (FIG. 123), the contact nibs and their dividing and encoding plates 1933, the contact nibs 2031 (FIG. 127) on the contacted plates 1933, the stationary bars 2033 and/or 2042, as the case may be, and so on for operating justifying punches that are related to the channels of the contacted plates, as will be explained.

By referring to the assembly 7–8 (FIGS. 136), it can be seen that the nibs o will be aligned with their related slide means 1932 when the assembly is shifted leftward for representing 7 word spaces counted. Likewise, the nibs x will be aligned with their related slide means 1932 when the assembly is shifted rightward for representing 8 word spaces counted.

Now that the physical structure of the slide members and the assemblies is better understood, let us assume, for a first example, that 7 word spaces are counted and 5 units are left in the line. By dividing 7 into 5 we find the quotient to be zero and there is 5 units in the remainder. The 5 units in the remainder is the only portion of the answer that is significant in this instance, as will appear. In the present example, since 7 word spaces are counted and 5 units are left in the line, the assembly 7–8 is selected and shifted leftward, and the 5th solenoid 2026 and its slide means 1932 is operated to contact the nibs o on the operated plates 1933, as previously explained. It should be noted, there are no nibs o shown immediately to the right of the 5th slide means 1932 on the plates 1933 designated as representing the channels 2, 5, and 6, which are the only channels required for representing the "codes for quotient" in this group assembly. However, there are nibs o, shown immediately to the right of the 5th slide means 1932, on the plates 1933 which represent the channels 2, 5, 6 and 7 that are designated as "code for remainder", and since these nibs o with their plates are shifted to the left, they make contact with the operated 5th slide means 1932. Thus the code 2, 5, 6, 7 is punched by the justifying punches, as will be described. By referring to the list of justifying codes in "Chart C", it can be seen that the code for 5 units left in the line is 2, 5, 6, 7, which is the code punched under control of the dividing and encoding mechanism in the example above.

For a second example, let us assume that 8 word spaces were counted and 12 units were left in a line. 8 divided into 12 equals a quotient of 1 plus a remainder of 4. To accommodate this situation, the assembly 7–8

(FIG. 136) is selected and shifted rightward, and the 12th slide means 1932 is operated, as described. When this occurs, the nibs x shown to the left of the 12th slide means 1932 are shifted rightward and engaged by that operated slide means. The nibs x thus contacted are seen to be on the dividing and encoding plates 1933 that are associated with channel 5 among the "code for quotient" plates, and the plates that are associated with the channels 2, 5, 7 among the "code for remainder" plates. Thus the control for punching the code 5 by the quotient amount justifying punches, and the control for punching 2, 5, 7 by the remainder justifying punches is established, and these codes will be punched by these punches as will be described later. By referring to the codes for justifying in "Chart C", it may be seen that the code 5 for the quotient column represents the quotient of 1, while the code 2, 5, 7 for the remainder column represents a remainder of 4. Thus, when these codes for the second example are read, the reproducing machine will be prepared to add one unit to each of the 8 word spaces in the line, and it is also prepared to add another unit to the first 4 word spaces in the line, as will be explained. In this manner, the 12 units left in the unjustified line will be added to justify the reproduced line.

In a third example, assume there are 15 word spaces and 16 units left in the line. In this case, the assembly 15–16 (FIG. 136) is selected and shifted rightward, and the nibs o on the dividing and encoding plate 1933 associated with channel 5 "code for quotient", and the plate 1933 associated with channel 7 "code for remainder" will make contact with the operated 16th slide means 1932. Thus, the code 5 and the code 7 are both established for control of the two sets of justifying punches, as will be described. By referring to the lists of codes for justifying (Chart C), it can be seen that code 5 signifies a quotient of 1 which is the number of units that will be added to each of the 15 word spaces in the line, and that code 7 signifies a remainder of 1 unit which extra unit will also be added to only the first word space in the justified line. Thus, the 15 units added to the word spaces in the line and the extra unit also added to the first word space equal 16 units, which will justify the line, in this third situation.

Similarly, by performing such further tests, it can be seen that the arrangement can accommodate all situations, and all lines having 23 or less units left at the end of the unjustified line and having one or more word spaces will be justified automatically in the first 16 or less word spaces in the reproduced justified line.

28. JUSTIFYING PUNCHES AND THEIR OPERATION

The justifying punches comprise two separate sets of mechanism, the punches of which are located one normal tape feed step apart. One set of justifying punches 2046 (FIG. 38) is provided for encoding the remainder amount, and the other set 2047 is provided for encoding the quotient amount of the division operations performed by the justifying mechanism.

The physical structure of the punches 2046 and 2047 are the same as that of the main punches 567, and all of the punches are guided in holes therefor in the casting 573. Punch receiving die holes 2048, one for each of the punches 2046, extend through the lower half of the cover 579 for receiving the respective punch and the resulting waste that is punched from the tape 577. Likewise, die holes 2049 are provided for receiving respective punches 2047 and the waste punched thereby from the tape 577.

Remainder punch mechanism 2050 (FIG. 92) is comprised primarily of solenoids 2051-1 through 2051-7 (FIG. 37) and associated levers 2052-1 through 2052-7; seven of each being shown here although only six (Channels 2–7) are required to accommodate the preferred code as previously mentioned and as indicated in "Chart C" hereinabove. The hyphenated suffixes identify the related code channel of each of these parts. The solenoids 2051-1 through 2051-7 are secured on a plate 2053, which is secured to and extends between vertical frame plates 556 and 557 (FIG. 36). A link 2054 (FIG. 37) is pivotally connected to the armature of each of the solenoids 2051 and to the rearward end (leftward as shown) of its respective lever 2052. The levers 2052-1, 2052-3, 2052-5 and 2052-7 are pivoted on a pivot rod 2055, and the levers 2052-2, 2052-4 and 2052-6 are pivoted on a pivot rod 2056. The solenoids 2051, links 2054, levers 2052, and the pivot rods 2055 and 2056 in the remainder punch mechanism 2050 are identical with those in the main punch mechanism 161 described hereinabove. Rods 2055 and 2056 are secured on and extend between plates 556 and 557 (FIG. 36) in a known manner. A link 2057 (FIG. 37) is pivotally connected on the forward (rightward) end of each of the levers 2052. The upper ends of the links 2057 are pivotally connected to their respective punches in a usual manner for such pin type punches. The upper ends of the links 2057 (FIG. 38) are guided and held in engagement with the trunion ends of the punches by comb-like projections 2058 between the links on the bottom of casting 573.

A torsion spring 2059 (FIG. 37) is connected to each of the levers 2052 and each spring is anchored in a known manner so as to constantly urge the levers clockwise against a return stop rod 2060 secured between vertical frame plates 566 and 557 (FIG. 36). In returned position of the parts, the upper ends of the justifying punches 2046 (FIG. 38) are just below and clear of the control tape 577. The channel related stationary bars 2042 (FIG. 127) of the justifying encoding mechanism are connected by their conductor strips 2043 (FIG. 123) and wires 2044 with their respective channel related solenoids 2051 (FIGS. 37 and 92).

A quotient punch mechanism 2061 is comprised primarily of solenoids 2062-1 through 2062-7 (FIG. 37) and associated levers 2063-1 through 2063-7; seven of each being shown here although only six (channels 1–6) are required to accomodate the preferred code as previously mentioned and as indicated in Chart C hereinabove. The solenoids 2062-1 through 2062-7 are secured on a plate 2064, which is secured to and extends between vertical frame plates 556 and 557 (FIG. 36). A link 2065 (FIG. 37) is pivotally connected to the armature of each of the solenoids 2062 and to the forward end (rightward as shown) of its respective lever 2063. The levers 2063-1, 2063-3, 2063-5 and 2063-7 are pivoted on a pivot rod 2066, and the levers 2063-2, 2063-4 and 2063-7 are pivoted on a pivot rod 2067. The solenoids 2062, links 2065, levers 2063, and the pivot rods 2066 and 2067 in the quotient punch mechanism 2061 and identical with those in the main punch mechanism 161 and remainder punch mechanism 2050, described above, except that they are arranged reversely in the assembly. A C-shaped link 2068 is pivotally connected on the rearward end of each of the levers 2063. The upper ends of these links are pivotally connected to their respective justifying punches 2047, and the upper ends of the links 2068 (FIG. 38) are guided and held in engagement with the trunion ends of the punches by the comb-like projections 2058.

A torsion spring 2069 (FIG. 37) is connected to each of the levers 2063 and each spring is anchored in a known manner so as to constantly urge the levers counterclockwise against a return stop rod 2070 secured between vertical frame plates 556 and 557 (FIG. 36). In returned position of the parts, the upper ends of the justifying punches 2047 (FIG. 38) are just below and clear of the control tape 577.

The channel related stationary bars 2033 (FIG. 127) are connected by their conductor strips 2036 (FIG. 123) and wires 2037 with their respective channel related solenoids 2062 (FIGS. 37 and 92).

When a circuit is completed through any of the wires 2037 and 2044 (FIG. 92), the respective solenoids 2062 and 2051 are operated; each pulling its respective links 2065 and 2054 (FIG. 37); rotating the connected levers 2063 and 2052 clockwise; elevating the links 2068 and 2057, respectively, and pushing the respective punches 2047 and 2046 upward through the control tape 577 and depositing the blanked out waste in the die holes 2049 and 2048 (FIG. 38), respectively. At the end of this punching action, a stop surface 2071 (FIG. 37) on each of the operated levers 2063 and a stop surface 2072 on each of the operated levers 2052 engages the stop rods 2070 and 2060 respectively, to limit the just described punching actions.

When operated solenoids 2062 and 2051 are deenergized, the torsion springs 2069 and 2059 return the just described mechanisms to the positions shown, where the levers 2063 and 2052 rest against the top of stop rod 2070 and 2060, respectively, and their respective justifying punches 2047 and 2046 are withdrawn from the holes they punched in the control tape 577.

When a justifying code or codes (quotient code, remainder code, or both) are punched in the tape 577 and the justifying punch or punches are withdrawn, as just described, a normally open switch 2073 (FIGS. 37 and 92) is closed for causing the encoded text for the line and the carriage return code, to be automatically fed forwardly out of the loop 753 (FIG. 38), through the justifying punch stations sufficiently for the last code (carriage return code) to enter the main reader at station M/R and the encoded tape 577 may be accumulated in a loop 2074, as will be explained later. However, the manner in which normally open switch 2073 (FIGS. 37) is closed by return of the punches will now be described.

An inverted U-shaped member 2075 normally lies on top of a surface 2076 (FIG. 38) on each of the links 2068. Depending portions 2077 and 2078 (FIG. 37), bent downward from the ends of U-shaped member 2075, are pivotally connected to lever arms 2079 and 2080, respectively. Arms 2079 and 2080 are parallel and they are secured on a sleeve 2081, which is pivoted on a rod 2082. Rod 2082 extends between and it is secured on vertical frame plates 556 and 557 (FIG. 36). A rod 2083 (FIG. 37) extends between and it is secured at its ends to the depending portions 2077 and 2078, and it is situated to normally lie transversely on top of a surface 2084 on each of the links 2057. A slot 2085 (FIG. 38), in both the depending portions 2077 and 2078 (FIG. 37) guide on the rod 2070 so as to permit movement of the U-shaped member 2075 only in a line generally parallel with the movement of the links 2068 and 2057. A torsion spring 2086 is connected to arm 2080 and to frame plate 568 for urging the lever arm assembly clockwise and pulling the U-shaped member 2075 down on the surfaces 2076 (FIG. 38) of links 2068 and pulling the bail type rod 2083 (FIG. 37) down on the surfaces 2084 of the links 2057. From the above, it can be seen that operation of any of the justifying punches will cause their links 2057 and/or 2068 to push the bail type rod 2083 and the U-shaped member 2075 upward for rotating the arm assembly 2079–2081 counterclockwise against tension of torsion spring 2086. Upon return of the punches as described, the spring 2086 rotates the arm assembly 2079–2081 clockwise and return the U-shaped member 2075 and its bail type rod 2083 down to the illustrated returned position.

A pawl 2087 is pivoted on an arm 2088, which is pivoted on a stud 2089 that is secured on vertical frame plate 557. The normally open switch 2073 normally supports an insulator 2090, secured on arm 2088, in a position where the arm is stopped against a stud 2091 which is secured on plate 557. A torsion spring 2082 is connected to pawl 2087 and to arm 2088 for urging the pawl counterclockwise against a pin 2093, which is secured on the end of arm 2079. The arrangement is such that, upon operation of any of the justifying punches 2046, 2047 as described, the pin 2093 is elevated sufficiently to permit torsion spring 2092 to latch pawl 2087 under the pin. Upon return of the operated punches as described, the pin 2093 is driven downward under tension of torsion spring 2086. This acts on the latched pawl 2087 and arm 2088 for forcing the insulator 2090 to close the normally open switch 2073.

When the line terminating functions caused by closure of switch 2073 are accomplished, a solenoid 2094 (FIG. 92) is energized, as will be explained later, for reopening the switch 2073. Solenoid 2094 (FIG. 37) is secured on vertical frame plate 557 and a link 2095 is pivotally connected to the armature of the solenoid and to the pawl 2087. Operation of solenoid 2094 pulls link 2095 and rotates pawl 2087 clockwise to unlatch the pawl from pin 2093. The clockwise swing of pawl 2087 is limited as it contacts a turned up portion 2096 of plate 2064. Upon disengagement of the pawl, switch 2073 springs open and returns the insulator 2090, lever 2088 and pawl 2087 to the illustrated position where the lever is stopped against the stud 2091.

If a line has extended into the justifying area and there are word spaces counted, the justifying punches 2046, 2047 will operate, by circuits to be described now. Upon return operation of the carriage 80 and the automatic operation of the key-lock interposer 1347 (FIG. 84) and its detent 1349, the switch 1334 is shifted to end the preliminary line terminating circuit and to initiate operation of the secondary line terminating circuit that runs through wires 1475 (FIG. 92) and 1482, as described.

When a line extends into the justifying area and there is less than 0.600" (when there are 23 units or less) left in the line, as described, the secondary line terminating circuit will pass through wire 1482, ring 1658 (FIG. 108), a brush 1660 (FIG. 106), strip 1663, brush 1661, and the contact 1670–1692 (FIG. 108) or 1669 that the brush 1661 (FIG. 106) may then be engaged with as described. When the line is perfectly filled out and the blade 1661 is on contact 1669 (FIG. 108), justifying is not required as described previously. However, when the blade 1661 (FIG. 106) is on one of the contacts 1670–1692 (FIG. 108), justifying will occur and the circuit will travel through the engaged contact and a respectively connected wire 1485 (FIG. 92) as described. The other ends of the wires 1485 are each respectively connected to one of the solenoids 2026. Thus, when current travels through one of the wires 1485, the appropriate solenoid 2026 (FIG. 123) is energized for operating the pair of slide means 1932, as described, to represent and thereby enter the number of units left in the line as a dividend in the dividing and encoding mechanism 1923 (FIG. 92).

A wire 2097 is connected to each of the solenoids 2026 and to a semicircular conductor 2098 (FIG. 64) in the word space counter's commutator. Conductor 2098 is secured on the contact insulator 880 as by rivets 2099 in a customary manner. The semicircular conductor 2098 is situated to be engaged by a bifurcated blade 2100 (FIG. 63), whenever the brush carrier member 877 is in any of the clockwise 1–16 (FIG. 64) word space representing positions previously described. The blade 2100 (FIG. 63) also engages contacts 2101–2116 (FIG. 64), secured on insulator 880, consecutively when the member is positioned clockwise in the 1–16 word space counting positions. Blade 2100 (FIG. 63) is secured on an insulator 2117 that in turn is secured on the normally lower end of brush carrier member 877. Consecutive pairs of the contacts 2101–2116 (FIG. 64) are interconnected (eight pairs in all), and each pair is respectively connected by a wire 2118 (FIG. 92) with a corresponding solenoid 1962 (FIG. 120). Thus, current will pass through wire 2097 (FIG. 64) conductor 2098, the bifurcated blade 2100 (FIG. 63) that is in a position corresponding to the number of word spaces counted, through one of the contacts 2101–2116 (FIG. 64) in a pair, through one of the wires 2118 (FIG. 92) that is connected to said pair, and through one of the selecting solenoids 1962 and goes to ground as indicated. By operation of one of the solenoids 1962, a particular dividing and encoding plate assembly 1930, 1931 (FIG. 120) is selected for operation. The selected assembly will be operated in one direction for representing the odd number of the other direction for representing the even number of the effective pair of contacts in FIG. 64 and for thus entering the number of counted spaces in the line as the divisor in the computation.

Upon full operation of the selecting solenoid 1962 (FIG. 120), its bellcrank 1957 is rotated and the bail member 1996 is rotated clockwise for elevating insulator 1998 and for thereby closing switch 1994 (FIG. 125) as described. The switch 1994 is closed for operating either solenoid 1978 (FIG. 126) or solenoid 1984, depending on whether the counted number of word spaces is even or odd, respectively, by a circuit to be described now.

A source of power (S) is connected to switch 1994 (FIG. 92), and a wire 2119 is connected to the switch and to both solenoids 1978 and 1984. A wire 2120 is connected between solenoid 1978 and the word space counter 850, and a wire 2121 is connected between solenoid 1984 and the word space counter 850. The wire 2120 is connected to interconnected even number contacts 2122 (FIG. 64), while the wire 2121 is connected to interconnected odd number contacts 2123, in the word space counter 850 as shown.

The odd number contacts 2123 are situated to be engaged by bifurcated blade 1501 (FIG. 63) when the brush carrier member 877 is in positions representing the successive odd numbers 1–15, respectively, and the successive even number contacts 2122 (FIG. 64) are situated to be engaged by blade 1501 (FIG. 63) when the member 877 is in positions representing successive even numbers 2–16, respectively. A grounded semicircular conductor 2124 (FIG. 64) is situated to be engaged by blade 1501 (FIG. 63) when the brush carrier member 877 is in any position 1–16. Thus, it is seen that, when an even number of word spaces are counted and member 877 is positioned accordingly as described and when the counted word space representing, dividing and encoding plate assembly 1930, 1931 is selected and switch 1994 (FIG. 92) is closed as described, current will travel from a source (S) through switch 1994, wire 2119, solenoid 1978, wire 2120 (FIG. 64), one of the contacts 2122, blade 1501 (FIG. 63), and it goes to ground through conductor 2124 (FIG. 64). Likewise, when an odd number of word spaces are counted and switch 1994 (FIG. 92) is closed, as described, current will travel through switch 1994, wire 2119, solenoid 1984, wire 2121 (FIG. 64), a contact 2123, blade 1501 (FIG. 63) and it goes to ground through conductor 2124 (FIG. 64).

Upon operation of an amount left in the line representing slide means 1932 (FIG. 123) by its solenoid 2026 (FIG. 92), upon selection of a word space representing plate assembly 1930 or 1931 (FIG. 120) by a solenoid 1962 (FIG. 92) and upon operation of the selected plate assembly by one of the solenoids 1978 or 1984, circuits for operating the justifying punch mechanism 2061 and 2050 to punch the codes for the quotient amount and the remainder are established, respectively, as described. The conclusion of the justifying punch circuits will now be explained. One end of a wire 2125 is connected to each of the solenoids 2062 and to each of the solenoids 2051. The other end of wire 2125 is connected to the solenoid 1441. A wire 2126 is connected between the solenoid 1441. A wire 2126 is connected between the solenoid 1441 and the wire 1098 that leads to ground through normally closed switch 1099 in the punch-control relay as described. Thus, when the dividing and encoding mechanism 1923 is fully operated, the punch circuit is effective from a source and wire 2045, through the operated dividing and encoding mechanism 1923 as described, and the circuit continues through wires 2037 and 2044, the appropriate punch solenoids 2062 and 2051, wire 2125, solenoid 1441, wires 2126 and 1098 and it goes to ground through switch 1099. Upon operation of solenoid 1441 (FIG. 53), the switch 1330 is opened as illustrated and described, for terminating the justifying punching circuit. Opening of switch 1330 (FIG. 92) breaks the circuit through the wires 1331 and 1332, the shifted switch 1334, wire 1475, switch 1478, wire 1482, amount left in line measuring mechanism 1483, the effective one of the wires 1485, the operated solenoid 2026, wire 2097, the word space counter, the selected wire 2118 and the operated solenoid 1962.

When the operated solenoid 2026 (FIG. 123) is deenergized as just described, the spring 2023 restores the operated dividing and encoding slide means 1932 as described. Upon deenergization of the operated solenoid 1962 (FIG. 92) as just described, spring 1955 (FIG. 120) restores the operated selecting hook 1953, disconnecting the hook from the bail rods 1970 or 1971 as the case may be, and, by the resulting counterclockwise return of the bellcrank 1957, the bail 1996 is freed to restore and the insulator 1998 permits the switch 1994 (FIG. 125) to open. As soon as the selecting hook 1953 (FIG. 120) is disconnected from the bail, the respective centralizer 1947 or 1948, as described, restores the operated plate assembly 1930, 1931 to the illustrated normal position. When the switch 1994 (FIG. 92) is opened, as described, the circuit through the operated solenoid 1978 or 1984 is broken and the centralizer 1985 (FIG. 26) restores the motivating mechanism as described. Upon restoration of the operated slide means 1932 (FIG. 120) and upon restoration of the operated dividing and encoding plate assembly 1930 or 1931 as the case may be, the justifying punch circuits between the slide means 1932 and the nibs on the dividing and encoding plates 1933 are broken, and thus the circuits through wire 2045 (FIG. 92), the dividing and encoding mechanism 1923, wires 2037 and 2044, the punch mechanisms 2050 and 2061, wire 2125, solenoid 1441, etc. are broken.

When the justifying punch solenoids 2051 (1–7) and/or 2062 (1–7) are deenergized, the switch 2073 is closed by the return action of the punches 2046, 2047, as described previously. A wire 2127 is connected between the switch 2073 and the wire 1484 which leads to the tape feed control switch means 1486, as mentioned previously.

The switch means 1486 is shown particularly in FIGS. 137–139. The wires 1484 and 1487 (FIG. 92) are connected to a solenoid 2128 (FIG. 138) in the switch means. Solenoid 2128 and a solenoid 2129 are secured to a plate 2130, which is secured on the frame member 2 (FIGS. 1, 2 and 137) in any known manner. The solenoids 2128 and 2129 (FIG. 138) are operable for controlling switches 2131 and 2132, as will be described. These switches are secured on a plate 2133 (FIG. 139), which is secured on two support rods 2134 and a main support rod 2135. The other ends of support rods 2134 and support rod 2135 are secured on plate 2130 (FIG. 137), to complete the general component frame structure.

Links 2136 and 2137 (FIG. 138) are pivotally connected to the armatures of solenoids 2128 and 2129, respectively, and to opposite ends of a member 2138. Member 2138 (FIG. 137) is secured on the rightward end of a sleeve 2139, which is pivoted on the rod 2135. A depending arm 2140 is secured on the other end of sleeve 2139, and the lower end of the arm carries a stud 2141. Stud 2141 extends from the arm sufficiently to reach beyond the plate 2133, which is equipped with stop surfaces 2142 and 2143 (FIG. 139) for stopping the stud 2141 in clockwise and counterclockwise positions, respectively, and thus for limiting corresponding rotation of the unit formed of parts 2138–2141 (FIG. 137). An upright member 2144 is secured on a hub 2145 which is pivoted on support rod 2135. A stud 2146 is secured on member 2144 and it extends therefrom through a hole 2147 (FIG. 139), the ends 2148 and 2149 of which stop stud 2146 and thereby limit the clockwise and counterclockwise rotation of member 2144 in the normal and operated position, respectively. A contractile spring 2150 is connected on the ends of studs 2141 and 2146 for exerting a snap action influence on the stud 2146, as will be explained further. An insulator 2151 (FIG. 138) is secured on the end of member 2144, and, in the illustrated normal position of the member, the insulator holds the switch 2132 open. Switch 2132 is disposed to close and the switch 2131 is disposed to open whenever the insulator 2151 is shifted away therefrom. Normally, the parts are held in the positions shown, where the stud 2141 is held against stop 2143 (FIG. 139) and stud 2146 is held against stop 2148 by the tension of contractile spring 2150 the centerline of which is normally to the right of pivot rod 2135 as shown.

When current passes through wires 1484 (FIG. 138) and 1487, as explained, the solenoid 2128 is energized thereby, pulling link 2136, and rotating member 2138, sleeve 2139 (FIG. 137) and member 2140 (FIG. 138) clockwise, until the stud 2141 is stopped against surface 2142 (FIG. 139). As stud 2141 and the centerline of spring 2150 moves leftward of rod 2135, the influence of the spring snaps the stud 2146 leftward against surface 2149 and, at the same time, rotates the member 2144 (FIG. 138) and the insulator 2151 away from switch 2132 and against switch 2131. Thus, upon operation of solenoid 2128, the switch 2131 is closed and the switch 2132 is permitted to close.

To restore this tape feed control switch means mechanism 1486 (FIG. 92), upon operation of solenoid 2129 as will be explained, the solenoid pulls link 2137 (FIG. 138) and rotates the unit 2138–2141 counterclockwise, back where stud 2141 is stopped against surface 2143 (FIG. 139) as shown. In this motion, as the centerline of spring 2150 is shifted to the right of the support rod 2135, the spring 2150 snaps stud 2146 clockwise against surface 2148 and thus the lever 2144 and insulator 2151 (FIG. 138) is returned clockwise, and this permits switch 2131 to open and the insulator again opens switch 2132 as shown.

One side of switch 2131 is grounded as at 2152 (FIG. 92). A wire 2153 is connected between the switch 2131 and a normally closed switch 2154. A wire 2155 is connected between the switch 2154 and a tape feed solenoid 2156, which is connected to a source of power (S). The solenoid 2156 will be consecutively energized for feeding the tape 577 with the codes therein for the line through the justifying punches 2046, 2047 and for thus eliminating the loop 753 (FIG. 37), as will be described.

A source of power (S) is connected with the solenoid 2129 (FIG. 92), and a wire 2157 is connected between the solenoid and the switch 2132. A wire 2158 is connected between the switch 2132 and the switch 1033 in the slack tape sensing means (FIG. 67), which is closed only when there is no slack tape 577 between the main punches 567 (FIG. 38) and the justifying punches 2046, 2047 as described. In other words, the switch 1033 (FIGS. 67 and 92) is closed as soon as the codes for the line are fed out of loop 753 (FIG. 38) and through the justifying punches 2046, 2047 into loop 2074.

A circuit through the solenoid 2094 (FIGS. 37 and 92) will become effective in the rapid sequences that occur following return of the justifying punches 2046, 2047. This circuit includes a wire 2159 (FIG. 92) connected between wire 2127 and solenoid 2094. Another wire 2160 is connected to the solenoid 2094, and it is connected to the blade 1497 in the clearing circuit breaker 1492.

The circuits and sequences resulting from return of the justifying punches 2046, 2047 will now be described. Upon return of the justifying punches 2046, 2047, the switch 2073 (FIG. 37) is closed, as described. This completes the circuit running from a power source (S), through switch 2073 (FIG. 92), wires 2127 and 1484, solenoid 2128 for closing both switches 2131 and 2132 (FIG. 138) as described, and it continues through wire 1487 (FIG. 92), the same as described previously for the secondary line terminating sequence under the condition where justifying encoding did not occur in a line that was short of the justifying area. Briefly, this circuit continues through solenoid 944 for clearing the word space counter 850, through wire 1488 and solenoid 1010 for restoring the amount left in line measuring mechanism 1483 as described, on through wires 1011, 1013, 1489, 1490 and the solenoid 1491 for operating the clearing circuit breaker 1492. The circuit continues to ground through wire 1493 and blades 1494, 1496 as described. When the solenoid 1941 is fully operated, the breaker 1492 operates for shifting the blade 1496 and breaking the just described circuit and for connecting the blade 1496 with blade 1497, as described.

When blade 1496 is thus shifted, the circuit from source (S) through switch 2073, wires 2127 and 2159, solenoid 2094, wire 2160 and engaged blades 1497 and 1496 operates the solenoid 2094 (FIG. 37) for releasing the switch 2073, as described, and for thus breaking the circuits through switch 2073 (FIG. 92).

Upon operation of solenoid 2128 for closing switches 2131 and 2132, the circuit through switch 2131 and wire 2153 is established as described for operating solenoid 2156, which is part of a tape feed means 2161 and which provides the motive force that feeds the tape 577 through the justifying punches 2046, 2047 out of loop 753 (FIG. 38) and into loop 2074.

Tape feed means 2161 (FIG. 92) will now be described. The solenoid 2156 (FIG. 55) is secured on plate 556, the same as solenoid 696, and it operates mechanism that is identical with that operated by solenoid 696. Thus, a more detailed understanding of the mechanism operated by solenoid 2156 may be had by referring to the detailed description of the mechanism operated by solenoid 696. However, the instant arrangement is such that, upon operation of solenoid 2156, the solenoid and its link 2162 rotate bellcrank 2163 counterclockwise about pivot 2164 against tension of return spring 2165. Sequentially, during counterclockwise operation of the bellcrank, pawl 2166 is shifted leftward and, aided by spring 2167, the hook portion 2168 engages a tooth on ratchet 2169 as the cam surface 2170 is moved away from stud 718, and the pawl rotates the ratchet clockwise (as viewed here from the left) one tooth extent, whereupon a hook-like stop surface 2171 on the pawl engages the stud 718 for limiting the travel and preventing overrotation. One clockwise step of ratchet 2169 causes one forward step of the control tape 577 (FIG. 38) as will be explained presently.

A stud 2172 (FIG. 55) on the lower extremity of bellcrank 2163 is assembled in an elongated hole 2173 in a lever 2174. Lever 2174 is supported on a pivot 2175, which is secured on vertical frame plate 556. A lever 2176 is also supported on pivot 2175. A contractile spring 2177 is hooked on studs 2178 and 2179, secured in the oppositely extending remote ends of the levers 2174 and 2176 respectively. An insulator 2180 is secured on stud 2179. The switch 2154 is secured on vertical frame plate 556 in engaging alignment with the arcuate swing of the insulator 2180. In the illustrated normal position of the parts, the axis of spring 2177 is above the center of pivot 2175, where contractile spring 2177 urges lever 2176 clockwise against a stud 2181 secured on plate 556, and where the insulator 2180 permits switch 2154 to be closed as shown. Upon energization of solenoid 2156 and bellcrank 2163 as explained, the stud 2172 is swung counterclockwise for rotating lever 2174 clockwise. At just beyond the midpoint of the operation, the axis of spring 2177 passes below the center of pivot 2175 and, therefore upon the increasing leverage attitude of the spring, the spring snaps the lever 2176 counterclockwise against a limit stud 2182, which is secured on vertical frame plate 556. In this position of the lever, the insulator 2180 opens switch 2154 for interrupting the circuit therethrough and through solenoid 2156 (FIG. 92) as described. The switch 2154 is thus snapped open at about the time the control tape 577 is shifted one step forwardly and the pawl 2166 (FIG. 55) is stopped by engagement of its surface 2171 with stud 718.

When solenoid 2156 is thus deenergized, the spring 2165 returns the bellcrank 2163 clockwise against a stud 2183, which is secured on plate 556. Upon return of the bellcrank 2163, the pawl 2166, is shifted rightward and its cam portion 2170 holds the hook end portion 2168 free of the ratchet as described, the stud 2172 on the bellcrank returns the snap switch arrangement to the position shown and the switch 2154 is again closed for an ensuing operation of the solenoid 2156 (FIG. 92). Consecutive cycles of the mechanism will continue uninterruptedly until the encoded line accumulation of tape is expelled through the justifying punches 2046, 2047 and the switch 2131 is again opened as will be described presently.

The ratchet 2169 (FIG. 36) is secured on the left end of a hub 2184, which is pinned or otherwise secured on a shaft 2185. The shaft is rotatably mounted in a hole therefor in the casting 573 (FIG. 38) and in a bushing 2187 (FIG. 36) pressed into a hole therefor in vertical frame plate 555.

A sprocket 2188 is secured on a hub 2189 which is also secured on the shaft 2185. The angulation of the sprockets 2186 and 2188 in respect to the shaft is identical, so the pins in the sprockets will register properly with holes that are directly opposite on the edges of the control tape 577. Rotation of the sprockets 2186 and 2188, the ratchet 2169 and the shaft 2185 is yieldably held in positions corresponding to step-by-step stations of the control tape 577 (FIG. 38) by a detent means 2190 (FIG. 41), which cooperates with the sprocket 2188 and which is identical to detent means 747 described above.

From the above, it can be seen that the tape 577 will be fed through the justifying punches 2046, 2047 (FIG. 38), out of loop 753 and into loop 2074, step-by-step as long as the loop 753 (FIG. 38) is eliminated and the rod 1036 is depressed by the control tape 577 as described previously, the switch 1033 (FIG. 67) is snapped closed for completing the circuit through solenoid 2129 (FIG. 92), wire 2157 and now closed switch 2132 in the tape feed control switch means 1486, and on through wire 2158 and now closed switch 1033. Operation of solenoid 2129 (FIG. 138) causes switches 2131 and 2132 to be snapped open as described. The opening of switch 2131 (FIG. 92) terminates the cyclic operation of solenoid 2156 and stops feeding of the control tape 577, and opening of switch 2132 deenergizes the operated solenoid 2129.

29. FULL CARRIAGE RETURN RESTORING CIRCUIT

At this point in the line terminating processes, the forward tape cycling control means 169 is restored and the switch 1330 is open, and the justifying punches 2046, 2047 are returned and switch 2073 is reopened. However, at this point, the switch 1315 (FIGS. 79 and 83) that was closed when the carriage 80 was first moved in the return direction remains closed, the clearing sequence control 1492 (FIG. 92) is still in operated condition, the end of line measuring mechanism 1483 is held for clearing as the carriage returns out of the justifying area, the keys on the keyboard remain locked by mechanism 1335, the carriage return circuit breaker 1341 (FIG. 83) remains in operated condition, and the word space counter's clearing means that was operated by solenoid 944 (FIG. 92) is held in the clearing condition. When the end of line measuring mechanism 1483 is returned to zero, when the word space counter 850 has returned to zero, when the carriage 80 is fully returned and when the encoded tape 577 for the just completed line is fully fed through the justifying punches 2046, 2047, the mechanisms just mentioned as being held or otherwise as being in operated condition are released and restored by circuitry that will be described now.

The above mentioned restoring circuit, like the tape return restoring circuit described previously, originates in a power source (S) and wire 1273 (FIGS. 80 and 140), and it operates solenid 1274 for opening the switch 1315 (FIGS. 79 and 83) as described. The circuit continues through wire 1275 (FIG. 140) and operates solenoid 1276 (FIG. 93) for restoring the clearing sequence control 1492 (FIG. 92) and its switch 1495 as described. The wire 1277 (FIG. 140) carries the current to solenoid 1278 (FIG. 106) for operating pawl 1700 (FIG. 105) for restoring the detent means as described and for thus restoring the end of line measuring mechanism 1483 (FIG. 92). Incidentally, since the machine is now being restored for an ensuing line, the solenoid 1278 (FIG. 106) also operates the latch means 262 (FIG. 17) for rendering the lock 255 ineffective and for rendering the justifying control key 244 operable again, as possibly desired in preparing for a new line as described.

At this point, the end of line restoring circuit deviates from the aforedescribed tape return circuit. A wire 2191 (FIG. 140) is connected between the wire 1279 and the contact 1717 (FIG. 108) which is effective only when the end of line measuring mechanism 1483 (FIG. 140) is returned in normal position as described. A wire 2192 (FIG. 108) is connected to the companion normal contact 1718 and to the solenoid 1353 (FIGS. 84 and 140). A wire 2193 is connected between solenoid 1353 and the switch 1361 which remains closed only as long as the keyboard keys are locked as described. A wire 2194 (FIG. 140) is connected between switch 1361 and the solenoid 1417 (FIG. 90) which is energized for restoring the carriage return circuit breaker 1341 as described. A wire 2195 (FIG. 140) is connected to solenoid 1417 and to the solenoid 960 (FIG. 61) provided for restoring the clearing means in the word space counter 850 as described. A wire 2196 (FIG. 140) is connected between solenoid 960 and a switch 2197, which is in normal closed condition only when the word space counter 850 is conditioned to represent a 16 word space or less as will be described presently. Wire 2196 is connected particularly to a blade 2198 of the switch 2197, and a blade 2199 of the switch is connected by a wire 2200 to a contact 2201 (FIG. 64) secured on the contact insulator 880 in the 0 word space representing position. A companion 0 representing contact 2202 is also secured on insulator 880. A wire 2203 is connected between contact 2202 and a solenoid 2204 (FIG. 140), which is provided for locking the line delete key 1479 (FIG. 141) against manipulation. Since the line is now complete, since the carriage is now returned and since a new line has not yet been started, there is no line to be deleted and therefore there is no reason to undertake any line delete operations. The line delete key 1479 and the just mentioned locking means will be described later, under an appropriate heading. A wire 2205 (FIG. 140) is connected between solenoid 2204 and switch 1539 (FIG. 98), which is closed only when the carriage 80 is fully returned as described.

A wire 2206 (FIG. 140) is connected between the switch 1539 and a pair of interconnected contacts 2207 and 2208, which are secured on the insulating contact support plate 271 (FIG. 17). A pair of individual contacts 2209 and 2210 are also secured on the plate 271. A blade 2211 is secured on the insulator 279, and the bifurcated end of the blade normally engages the contacts 2207 and 2209 for conducting current therebetween. When the justifying key 244 is shifted to "off" position as described, the blade 2211 is shifted off of contacts 2207 and 2209 and on to contacts 2208 and 2110. A wire 2212 is connected to the contact 2209 and to a solenoid 2213 (FIG. 140), which is provided for clearing a space at end of line preventing means to be described later. A wire 2214 is connected between the solenoid 2213 and the switch 1033, which is closed and provides a ground for the circuit only when the encoded tape 577 for the line is completely fed out through the justifying punches 2046, 2047 as described. A wire 2215, provided for bypassing the solenoid 2213 when the justifying key 244 is in "off" position, is connected between the contact 2210 and the wire 2214. The solenoid 2213 and its effectiveness, as controlled by the commutator mechanism 142, will be described fully hereinafter. For the moment, it is sufficient to know that the full carriage return restoring circuit, here under discussion is always effective between the wires 2206 and 2214.

The switch 2197 (FIGS. 18 and 140) may be identical to switch 911 (FIG. 61), but only the two blades 2198 and 2199 (FIG. 140) are required. However, the switch 2197, like switch 911 (FIG. 18) is secured on bracket 915 (FIG. 61) and its blade 2198 is embraced by the two insulated studs 919 and 920 (FIG. 18) which extend from both sides of member 916 as shown. As described, the bellcrank unit 918 (FIG. 61) is held in its illustrated normal counterclockwise position whenever the word space counter 850 registers 16 or less, and the stud 922 is shifted to permit spring 921 to rotate unit 918 clockwise and to open switch 2197 (FIG. 140) whenever the ratchet wheel 898 (FIG. 61) is rotated to count 17 or more. However, as described, when the word space counter is restored, the bellcrank unit 918 is in its illustrated counterclockwise position, where the insulated studs 919 and 920 hold blade 2198 in engagement with blade 2199 (FIG. 140). The contacts 2201 and 2202 are situated on insulator 880 (FIG. 64) so as to be engaged by bifurcated blade 2100 (FIG. 63) only when the brush carrier member 877 is restored to zero position. Thus, the circuit through the word space counter and wires 2195 and 2203 (FIG. 140) is complete only when the word space counter is completely restored. The machine is now conditioned for an ensuing line.

When the justifying control key 244 (FIG. 17) is in the "off" position, there will be no word spaces counted in the word space counter 850 (FIG. 62) and the justifying punches 2046 and 2047 (FIG. 38) will not be oerated, but the text for the line including the carriage return code will still be fed through the main punches 567, out of loop 753 and into loop 2074, upon return of the carriage, as will be described further hereinafter.

When the machine is set to justify, as will also be described later, the carriage 80 is blocked against return and therefore the line will not be concluded, and justifying encoding will not be performed, whenever a word space is the last bit encoded in a line that extends sufficiently to justify (i.e. the line extends into the justifying area). It can be understood that such an inadvertent use of a word space would destroy the justifying effect. However, deletion of such a word space will release the carriage for return and therefore it will release the machine for justifying encoding in the above described manner. The means for preventing the occurrence of a word space at the end of the line will be described later.

30. THE MAIN READER

Proceeding with the tape handling for a normal justification encoded line, the encoded tape 577 (including justifying codes, the encoded text for the line and the carriage return code, in that order) is now accumulated in loop 2074 (FIG. 38) ready to be served into the main reading device at station "M, R" for control of the reproducing machine. Later herein, it will become apparent that the main reader and the reproducing machine under its control according to the codes sensed by the main reader, will normally and automatically operate immediately whenever and as long as slack encoded tape is available in loop 2074.

The main reader wwill now be described. Seven wires 2216 are connected directly, in one preferred form to respective channel related operating solenoids in a main decoder in the reproducing machine not shown here. The main decoder, which is provided for controlling the reproducer to perform according to the codes read by the main reader (at M, R), will be described to a greater extent and it will be shown schematically hereinafter. In other forms of the invention, other communication means may be inserted intermediate the ends of wires 2216. These other means may include media such as teletype, radio, or any other means capable of transmitting codified impulses. In other words, the wires 2216, and the few other wires to be described later, that may connect the composing and reproducing machines may be considered broadly as communication means.

Wires 2216 are preferably collected in a loom 2217 for protection of the wires. The composing machine end of the loom 2217 may be supported where desired as by suitable straps 2218, one of which is shown secured to casting 573 by screws 2219 in threaded holes therefor in the casting. The main reader end of the wires 2216 extend upward through individual holes therefor in the casting 573, and the stripped ends of the wires 2216 are held in individual conductive engagement with code channel related sensing springs 2220. The stripped ends of the wires are bent over on top of an insulator 2221, and they together with the supported ends of the respective springs 2220 are assembled in channel aligned notches of an insulator 2222 so as to hold the springs in alignment with their respective wires. A couple of machine screws 2223 are assembled in holes therefor in casting 573, and they are tightened into threaded holes therefor in insulator 2222 for solidly holding the insulators 2221 and 2222, springs 2220 and the ends of wires 2216 together on the casting 573 as shown.

The upper ends of the sensing springs 2220 are guided in comb-like furcations 2224, on an insulator block 2225, which furcations guide the otherwise free ends of the sensing springs in their channel related positions. Block 2225 is inlaid the top of the casting 573 and it is secured in position by a couple of screws 2226, which extend through the block and which are tightened into threaded holes therefor in the top of the casting 573. The rightward ends of the sensing springs 2220 are bent over on a radius so as not to catch in the code punch holes but so as to feel through the code punch holes that may be in registration therewith. The ends of the sensing springs 2220 normally are pressed against the bottom of the control tape 577, which insulates the springs from a conductor plate 2227 that is common to all the springs 2220 and above the tape 577.

The conductor plate 2227 is embraced on its top and its edges by an insulator 2228, which is inlaid the underside of the punch cover plate 579 as shown. A terminal plate 2229 is spaced from the top of the cover plate 579 by an insulator 2230. A couple of rivets 2231, conductively engaged with plates 2229 and 2227, extend through holes therefor in these plates, the insulators 2230 and 2228, and the cover plate 579 from which the rivets are also insulated in a known manner, for securing the parts solidly in place as shown. The otherwise exposed terminal plate 2229 and the top of rivets 2231 may be protected as by an insulating cover **2231*a* (FIGS. 37, 39 and 40) secured to the punch cover plate 579** in a known manner as shown.

The arrangement is such that, when a code punch hole in the control tape 577 (FIG. 38) is shifted into station "M, R" the upper end of the channel related sensing spring 2220 contacts the conductor plate 2227 through the hole, and it completes a circuit through the channel related wire 2216 and sensing spring 2220 and through the plate 2227, rivets 2231 and plate 2229 for controlling the reproducing or slave machine according to the code sensed.

A means for step feeding the tape 577 through the main reader M.R. will now be described. A shaft 2232 is journalled in a bearing in casing 573 and in a bushing 2233 (FIG. 36) that is secured on vertical frame plate 555. A motivation ratchet 2234, a hub 2235 and a sprocket 2236 are secured together and pinned to the shaft 2232. A sprocket 2237 and its hub 2238 are also pinned to the shaft. Rotation of this arrangement is yieldably held in main reader stations of the control tape 577 (FIG. 38) by a detent means 2239 (FIG. 41), which cooperates with the sprocket 2237 and which is identical to detent means 747 and 2190.

A motivation cocking solenoid 2240 (FIG. 55) is secured on vertical frame plate 556. A link 2241 is pivotally connected to the armature of solenoid 2240 and to a bellcrank 2242. Bellcrank 2242 is pivoted on the stationary rod 1451 and a torsion spring 2243 is connected to the bellcrank. Spring 2243 is also anchored on plate 556 and it normally rotates the bellcrank counterclockwise to the illustrated returned position.

A pawl 2244 is pivoted on bellcrank 2242 and the pawl is urged counterclockwise by a spring 2245 connected to the pawl 2244 and the bellcrank 2242. A hook-like stop surface 2246 on pawl 2244 is hooked on the stud 719 to maintain the illustrated normal position of the parts. In the normal position, a drive hook portion 2247 of the pawl 2244 is solidly engaged with a tooth on the ratchet 2234 and thus it solidly holds the rotated position of the sprocket arrangement.

A snap switch operating stud 2248 is carried on the lower arm of bellcrank 2242, and the stud is assembled in a slot 2249 in a lever 2250. Lever 2250 is pivotally mounted on a stud 2251, which is secured on plate 556. A member 2252 is also supported on stud 2251. A contractile spring 2253 is connected on studs 2254 and 2255 secured on the oppositely extending ends of the lever 2250 and member 2252, respectively. An insulator 2256 is secured on stud 2255. A switch 2257 is secured on vertical frame plate 556 in the illustrated position, where it is normally held closed by the insulator 2256 although the natural tendency of the switch is to be open. Normally, the axis of spring 2253 is below the center of pivot 2251, where the contractile spring 2253 urges member 2252 counterclockwise against a stud 2258 and where the insulator 2256 holds switch 2257 closed as shown. Upon clockwise operation of lever 2252, as will be described, the lever is stopped against a stud 2259. The studs 2258 and 2259 are secured on plate 556.

Upon energization of solenoid 2240 as will be described, the solenoid pulls link 2241 and rotates the bellcrank 2242 clockwise against a limit stud 2260 which is secured on plate 556. Upon clockwise operation of the bellcrank, the pawl 2244 is shifted rightward sufficiently to ratchet the hook portion 2247 beyond one tooth on the ratchet 2234. Simultaneously, upon clockwise operation of bellcrank 2242, the stud 2248 on the bellcrank shifts the lever 2250 counterclockwise. Whereupon, the centerline of spring 2253 is shifted above the center of pivot stud 2251 and the spring snaps the member 2252 clockwise against stud 2259, swinging the insulator away from the switch 2257 and permitting the switch to open.

Upon deenergization of solenoid 2240, the torsion spring 2243 restores the bellcrank 2242 counterclockwise. Upon restoration of the bellcrank, the pawl 2244 is shifted leftward and its portion 2247 rotates the ratchet 2234 and the sprocket arrangement clockwise for advancing the control tape 577 (FIG. 38) one code space extent through the main reader station M.R. Simultaneously, of course, upon restoration of the bellcrank 2242, the contractile spring 2253 (FIG. 55) is restored below stud 2251 and it restores the member 2252 back against the stud 2258 where the insulator 2256 again closes the switch 2257 as shown.

As the reading and feeding process continues, the amount of slack control tape 577 that was stored in loop 2074 (FIG. 38) may be eliminated as in cases where the operations of the reproducing machine catch up with those of the composing machine. On such an occasion, as loop 2074 is eliminated, the control tape 577 depresses a rod 2261 for operating a tape sensing means to interrupt the reading and feeding process as will be explained presently.

The tape sensing means of which rod 2261 is a part will now be described. The parts of the tape sensing means that includes rod 2261 are identical to those of the sensing means that includes bail rod 1036 (FIG. 67) described previously, but generally speaking the parts are assembled so they work in opposite directions.

The left end of rod 2261 is secured on the end of a lever 2262 (FIG. 36) and the right end of the rod is secured on a bellcrank 2263. The lever and bellcrank are secured on the ends of a shaft 2264, which is pivoted in a hole therefor in the casting 573. When the control tape 577 (FIG. 38) is drawn down on the rod 2261, the rod, the lever 2262 (FIG. 55), the shaft 2264 and the bellcrank 2263 (FIG. 67) are rotated counterclockwise about the axis of shaft 2264, against tension of a torsion spring 2265 that is connected to the bellcrank and anchored in any known manner.

A snap switch operating stud 2266 is secured in the lower extension of bellcrank 2263, and it is assembled in a suitable hole therefor in a lever 2267. Lever 2267 is pivoted on a stud 2268, which is secured on vertical frame plate 557 (FIG. 45). A member 2269 (FIG. 67) is also pivoted on the stud 2268. A contractile spring 2270 is connected to a stud 2271 and to a stud 2272 in the remote ends of lever 2267 and member 2269, respectively. The rotation of bellcrank 2263 is limited by a pair of studs 2273 and 2274, and the rotation of member 2269 is limited by studs 2275 and 2276. The studs 2273–2276 are secured on plate 557 (FIG. 45). An insulator 2277 is secured on the stud 2272 (FIG. 67) and, in normal illustrated position of the parts, the insulator 2277 holds a switch 2278 in closed condition. Switch 2278 is secured on plate 557 (FIG. 45), and its natural tendency is to stand open.

When the loop 2074 (FIG. 38) is eliminated and control tape 577 is drawn down on rod 2261 as described, the bellcrank 2263 (FIG. 67) is rotated toward stop 2274 and its stud 2266 rotates lever 2267 clockwise. At about the time the centerline of spring 2270 passes the center of pivot stud 2268, the spring rotates member 2269 against stud 2276. When this occurs, insulator 2277 is snapped away from switch 2278 and the switch opens. As the direction of influence of spring 2270 changes, the just described travel of bellcrank 2263 and lever 2267 is limited by stud 2274. The snap switch 2278 will stand in this position normally whenever the reproducing machine has completed all work that is completely codified (i.e. line complete and carriage returned) in the composing machine.

Following the above condition, when further work is done and the tape 577 for this work is fed through the justifying punches 2046 and 2047 (FIG. 38) as described, another loop 2074 is formed and the rod 2261 is raised by the influence of spring 2265 (FIG. 67). When this occurs, bellcrank 2263 is rotated against stud 2273 and lever 2267 is returned counterclockwise. As the centerline of spring 2270 passes to the left of the center of stud 2268, the spring snaps the member 2269 clockwise against stud 2275 and the insulator 2277 is driven against the switch 2278 for closing the switch. This is the condition of this slack tape sensing means, when work is encoded ready for the main reader and the reproducing machine.

Broadly, the reader M.R. (FIG. 38) controls preliminary operations in the reproducing machine 2279 (FIG. 143) and these operations, together with resulting sequential operations and circuits, culminate in controlled operation of the main reader tape feed mechanism.

In order to more readily understand the operation of the main reader and its tape feeding mechanism, which are arranged to normally eliminate tape handling by incorporation of the punch mechanism 161 and readers together as a unit in the composing machine, the mechanism and circuits of the reproducing machine 2279 are herein shown only in simplified schematic form, in order to avoid the actual necessarily complicated structure and circuitry of the reproducing machine 2279. While the circuitry referred to herein may be oversimplification of the actual circuitry, which will be covered particularly in the copending application, Ser. No. 212,895 now U.S. Pat. No. 3,945,480 devoted to the reproducing machine, the physical structure described above and the operation of the main reader, its tape feeding mechanism and the slack tape sensor remain precisely as described herein. The many features of the invention, resulting from incorporation of main punches 567 (1-7), delete back-space reader 1097, justifying punches 2046, 2047 and main reader M.R. (reproducing machine control), together with appropriate slack-tape sensing means and other devices in one unit, will be described and claimed thoroughly as will appear herein.

As described hereinbefore, the justification codes for the quotient amount and the remainder are punched by the justifying punches 2046 and 2047 (FIG. 38) one code space increment apart. As also explained, these justifying codes are spaced ahead of the first code of the text for the line an amount equal to the distance between the justifying punches 2046 and 2047 and the main punches 567 which distance is commensurate to the normal code spacing. As also explained, the text and function codes for the line are located in consecutive increments thereafter. As further explained hereinbefore, the text for the line terminates with a carriage return code, and, upon punching of the carriage return code, the tape 577 is fed through the main punches 567 an end-of-line amount sufficient to permit the carriage return code to enter the main reader M.R. and the entire coded tape for the line is fed through the justifying punches 2046 and 2047 sufficiently for the entire coded tape for the line to enter the main reader.

The wires directly connected with the previously described tape senser, the tape feed mechanism and the main reader will now be described.

A wire 2280 (FIGS. 38 and 143) is connected to a power source (S), through a manipulative on-off switch to be described later, and to a normally closed switch 2281. The switch 2281 (FIGS. 38,39 and 40) may be in the form of a gravity affected mercury type, for example, and it is secured on the punch-reader assembly's hinged cover 579 in such an attitude as to be conductively closed only when the punch cover plate 579 is latched down in normal position as described. The arrangement is moreover such that upon disengagement of the latches 590 and 591 (FIG. 40) from the cover 579, as described, the sensing springs 1132 and 2220 (FIG. 38) will pivot the cover 579 upwardly sufficiently to break the circuit through switch 2281. The previously described circuits within the composing machine, particularly those that cause operation of the punches 567 (1-7) and the back space reader 1097, also receive their source of power (S) through this switch 2281 or another such switch as desired. Thus, to protect the mechanism and to prevent malfunction, it is seen that no circuit involving the punches or readers will be effective unless the hinged cover plate 579 (FIG. 40) is latched in proper operating position as shown and described.

A wire 2282 (FIG. 38) is connected to switch 2281 and to the switch 2278 (FIG. 143) of the tape senser. A wire 2283 is connected between switch 2278 and the solenoid 2240 (FIG. 55) of the main reader tape feed arrangement. A wire 2284 (FIG. 143), which may include a communication means 2285 intermediate its ends, is connected between solenoid 2240 and a solenoid 2286 of a feed-read switch means 2287 in the reproducer 2279. A wire 2288 is connected between solenoid 2286 and a normally closed switch 2289. A wire 2290 is connected to switch 2289 and code channel related decoder solenoids 2291 of a main decoder 2292. As mentioned before, the wires 2216 are connected between the main reader sensing springs 2220 (FIG. 143), and the communication means 2285 may be employed between the ends of these wires. A wire 2293 is connected with conductor plate 2227, as via the terminal plate 2229 (FIG. 38) and rivets 2231. The other end of wire 2293 (FIG. 143) is grounded, in any convenient manner, to complete the main reading circuit.

The feed-read switch means 2287 will now be described. The solenoid 2286 is secured in a stationary position, in any known manner. An insulator 2294 is secured on one end of the solenoid's armature and an insulator 2295 is secured on an extension of the other end of the armature. A spring 2296 is mounted on the armature between the solenoid body and the insulator 2294 for normally holding the armature and its insulators in the illustrated leftward position. A normally closed switch 2297 is secured in a stationary position in alignment with insulator 2294 for being opened thereby upon operation of the solenoid 2286. A switch 2298 is secured in position to be normally held open by insulator 2295 as shown. A latch 2299 is pivoted in a known manner on a stationary stud (not numbered). A spring 2300 is connected to latch 2299 for normally urging it clockwise against insulator 2295. A solenoid 2301 is secured in a stationary position in a known manner, and its armature is connected in a known manner to the latch 2299 for rotating the latch clockwise against tension of spring 2300 upon operation of the solenoid.

The switch 2289 is representative of one or more of such switches that may be connected in series between wires 2288 and 2290. Though only one switch 2289 is discussed herein, it can be understood that more such switches in series may be employed to accomplish the same result, that in any one such switch can be opened to break the circuit and that switch can be opened to break the circuit and that switch can then be closed to complete the circuit therethrough. However, the additional switches that may be employed would be generally the same and would be operated in the same manner as switch 2289 even though the additional switches may be involved in different sequences of operations within the reproducing machine 2279. The following description of the operation of switch 2289 will generally apply to any switch that may be employed.

The switch 2289 is normally closed, but it is opened by mechanism within the reproducer 2279, when a decoder controlled sequence of operations is successfully initiated ("code set"), and it is held open until the sequence of operations is complete and the machine is ready for the next sequence.

A manually and automatically controlled on-off switch and stop printer means (not shown here) may also be provided for interrupting the operations of the main reader circuitry and tape control, we will disregard such stop-printer means for the moment.

When the reproducing machine 2279 completes any previous code controlled operation or series of operations, the above discussed reader circuit is always made effective by closure of the switch 2289. An additional feed circuit is provided and it is rendered effective following the reading of a justifying code and resulting set-up operations, and also following a carriage return operation of the machine, when there is unpunched tape 577 in the main reader. This additional feed circuit will now be described.

A wire 2302 is connected between solenoid 2240 and the switch 2257 (FIG. 55). A wire 2303 (FIG. 143) is connected to switch 2257 and to the switch 2297 in the feed-read switch means 2287, and this wire may also include communication means 2285 intermediate its ends. The switch 2297 is also connected to a convenient ground as indicated.

When the reader circuit is rendered effective and a code is sensed, the read solenoid 2286 is energized at the same time the solenoid 2240 and the code related solenoids 2291 are energized. Upon energizing of solenoid 2286, its armature and insulators 2294 and 2295 are shifted rightwardly, against tension of spring 2296, for opening switch 2297 and permitting the switch 2298 to close. Upon full energization of solenoid 2286, the latch 2299 under tension of its spring 2300 latches on to insulator 2295 for holding the feed-read switch means 2287 in operated position. Following a first text reading operation for a line and during normal successive text code control operations the switch means 2287 will remain in operated position, as just described. However, at the end of justification code setup operations (both the quotient amount code and the remainder code) an upon completion of a carriage return operation in the reproducer 2279 current is caused to flow through a wire 2304, which leads to swtich 2298. A wire 2305 is connected between the switch 2298 and the solenoid 3201 which is grounded as indicated. Thus, following the reading of either justification code or a carriage return code from the tape 577, when the switch means 2287 is held in operated position as described and when the reproducer 2279 feeds current into wire 2304 the current passes through the now closed switch 2298, wire 2305 and it goes to ground through the solenoid 2301. Operation of solenoid 2301 disengages latch 2299 from insulator 2295, as described, whereupon spring 2296 restores the armature of solenoid 2286 leftward and the insulator 2295 opens the switch 2298 and insulator 2294 permits switch 2297 to close for rendering the feed circuit again operative as described.

The entire main reading and feeding processes will now be reviewed. Assume that the hinged cover plate 579 (FIG. 40) is latched closed and the switch 2281 is closed as described; that there is encoded tape 577 for an entire line in the loop 2074 (FIG. 143) and the sensing switch 2278 is therefore closed, and that the reproducing machine 2279 is otherwise operable. Assume further that the encoded tape for the line includes justification codes.

It should be recalled that a clear space (end of line amount) of control tape 577 is always provided following the carriage return code, in other words there is clear space on the tape between the codes for one line and the codes for the succeeding line. It should also be remembered that there is a clear space, equal to the distance between the remainder punches 2046 (FIG. 38) and the main punches 567, between the justifying codes and the first code for the text of the line.

As soon as a carriage return operation is initiated in the reproducer 2279 (FIG. 143), the switch 2289 is momentarily opened (code set) for deenergizing the solenoids 2291 and the cocking solenoid 2240 as described, and for thus permitting restoration of the decoder 2292 and the main reader feed mechanism respectively. Upon deenergization of solenoid 2240 the tape 577 is fed one step through the main reader as described. In the carriage return sequence of the reproducer 2279 the switch 2289 is again closed, but, since no code closely follows the carriage return code, the sensing springs 2220 will not complete the read circuit. When the carriage is fully returned, the current through wire 2304, now closed switch 2298 and the wire 2305 operates solenoid 2301 for releasing latch 2299 and restoring the feed-read switch means 2287 as described.

Upon restoration of feed-read switch means 2287, the switch 2298 is opened for deenergizing solenoid 2301, and the switch 2297 is closed for rendering the feed circuit effective. The effective feed circuit runs from source of power (S) through wire 2280, now closed switch 2281, wire 2282, now closed switch 2278, wire 2283, cocking solenoid 2240, wire 2302, alternately closed and opened switch 2257, wire 2303 and it goes to ground through the now closed switch 2297 which remains closed until a code is read whereby the read circuit becomes effective. The cocking or feed solenoid 2240 (FIG. 55) is thus energized, whereupon the switch 2257 is snapped open for deenergizing the solenoid 2240 and permitting the spring 2243 to advance the control tape 577 (FIG. 143) one step and again closing switch 2257 for again operating cocking solenoid 2240 as described. The tape feed mechanism is thus repeatedly operated and restored for successive step feeding of the control tape 577 through the main reader.

The reader circuit becomes immediately effective as soon as a justifying code (unusually first the quotient amount code) moves into registration with the sensing springs 2220 of the main reader. The reader circuit runs from source of power through wire 2280, switch 2281, wire 2282, switch 2278, wire 2283, feed or cocking solenoid 2240, wire 2284, solenoid 2286 for operating switch means 2287 as described, wire 2288, now closed switch 2289, wire 2290, the decoder solenoids 2291 which relate to the quotient amount code, the wires 2216, the effective sensing springs 2220, conductor 2227 and it goes to ground through the wire 2293. At the same time solenoid 2240 is energized, the solenoid 2286 is energized, to open switch 2297 and to render the feed circuit ineffective so there will be no further immediate consecutive feed operations of the solenoid 2240. At this point switch 2289 remains closed and the reader circuit is sustained while the reproducer 2279 is operated according to the code, and, remember, the tape 577 is not fed until the solenoid 2240 is deenergized. Thus, the solenoids 2240 and 2286, and the code related solenoids 2291 remain energized for a bit.

Operation of the solenoids 2291, in this instance to represent the quotient amount, affects the main decoder 2292 accordingly to control the reproducer 2279 to set up for adding the quotient amount of the justifying information to the first sixteen word spaces or less, as the case may be, in the reproduced text of the line that follows. During this set up operation of the reproducer 2279, in this instance as soon as the quotient amount is set up therein, the switch 2289 is momentarily opened for breaking the reader circuit. As the solenoid 2240 is now deenergized, the feed mechanism feeds the tape 577 one step as described, removing the just read quotient code out of the main reader and feeding the remainder code into the main reader. As the reproducer 2279 completes the registration of the quotient amount, the reproducer closes the switch 2289 so another code may be read, and, at about the same time, the solenoid 2301 is energized as described for restoring the switch means 2287 and rendering the feed circuit effective through switch 2297.

In the event there is no remainder code, due to even division of the number of units left in the line by the number of word spaces as described in connection with justifying encoding, blank tape 577 (no code) will now be in the main reader. In this case the feed circuit will take affect upon closure of switch 2297, as described, and the blank tape 577 will be fed by the feed circuit until the first text code is read.

In the event a remainder code exists and is now sensed, the read circuit immediately takes effect, and the cocking solenoid 2240, read solenoid 2286 and the code related solenoids 2291 are operated as described. Operation of solenoid 2286 are operated as described. Operation of solenoid 2286 opens switch 2297 for rendering the feed circuit ineffective, solenoid 2240 operates to cock the tape feed mechanism for a single step of the tape 577 and the code related solenoids 2291 operate the main decoder 2292 according to the remainder code. Operation of the solenoids 2291, in this instance to represent the remainder, affects the main decoder 2292 accordingly to control the reproducer 2279 to set up for adding one unit to each of the first word spaces, that correspond in number to the remainder, in the reproduced text of the line that follows. When the remainder is properly set up in the reproducer 2279, the reproducer momentarily opens its switch 2289 for breaking the reader circuit. As the solenoid 2240 is now deenergized, the feed mechanism feeds the tape 577 one step as described, removing the just read remainder code out of the main reader and feeding in a bit of the clear tape that follows the justifying codes. As the reproducer 2279 completes registration of the remainder, the reproducer closes the switch 2289 so the next succeeding code (the first code fortthe text) may be read, and, at about the same time, the solenoid 2301 is energized, as described, for restoring the switch means 2287 and rendering the feed circuit effective through switch 2297. Since there is no code now in the main reader and the sensing springs 2220 do not immediately sense a code, the read circuit will not immediately operate, even through the switch 2289 is closed. However, since the switch 2297 is now closed, the feed solenoid 2240 and snap switch 2257 will operate, as described, to feed the clear tape that always lies between the justifying codes and the first text code through the main reader.

As soon as a text code (function, letter, number, figure, space, etc.) is shifted into registration with the sensing springs 2220 the read circuit is immediately effective for operating the cocking solenoid 2240, the read solenoid 2286, and the code related decoder solenoids 2291 as before described. Operation of the read solenoid 2286 shifts the switch means 2287 to open the feed circuit switch 2297 and to latch the switch means in operated position where it remains throughout the reading of the successive text codes, since the feed solenoid 2301 is not operated following text operations of the reproducer 2279. However, operation of the main decoder 2292 and accordingly the reproducer 2279 in performance of a text operation results in the opening of the read circuit switch 2289, whereupon the feed mechanism shifts the succeeding code into registration with the sensing springs 2220 as described. As soon as the reproducer 2279 completes one text operation, it closes the switch 2289 for reading the next code now in the main reader. In this manner, the cycling of the text reading operations and the related operations of the reproducer 2279 are effected as the reproducer opens and closes the switch 2289.

Once a text code is read, the feed circuit is not again rendered effective through switch 2297 until the carriage return code is read at the end of the text. Upon reading the carriage return code, the read circuit and the main decoder 2292 cause the reproducer 2279 to return its carriage and to open the read circuit switch 2289 for effecting the normal tape feed step etc. as described. Upon full return of the carriage 80, the reproducer 2279 again closes the read circuit switch 2289 and at about the same time the reproducer feeds current through wire 2304, now closed switch 2298, wire 2305 and the feed solenoid 2301 for restoring the switch means 2287 and closing the feed switch 2297, the same as after justifying set up operations. Thus, the arrangement is again conditioned to feed the clear tape 577 that follows the carriage return code, and to read the first code for the succeeding line. The arrangement will read the next code and perform as described whether the first code for the new line is a justifying code, or as at times when the line is not to be justified, the first code for the line is a text code.

However, under the above conditions, if no succeeding line is prepared and stored in loop 2074, the slack tape sensor switch 2278 will be opened, as described, as the carriage return code is shifted out of the main reader, and thus both the feed circuit and the read circuit will be rendered ineffective until a succeeding encoded line is fed into the loop 2074 and the switch 2278 is then closed by the sensing means, as described.

31. SPACE AT END OF LINE PREVENTED

The details of the previously mentioned mechanism for recording the underlines, word spaces or nut spaces that may occur in a line after the line has been extended into the justifying area, will now be described. This mechanism, generally referred to as space at end of line preventing mechanism 2306 (FIG. 45), is shown particularly in FIGS. 144–152, and it is contained in and mounted on a unit frame assembly comprising a right side plate 2307, a forward plate 2308 (FIG. 144), a left side plate 2309, a rear plate 2310, a bottom plate 2311, and a top plate 2312 (FIG. 146), which are rigidly secured together in a known manner. Two support angle brackets 2313 (FIG. 144) are secured to right side plate 2307, near the bottom of the plate and two identical brackets are likewise secured to left side plate 2309. The unit 2306 (FIG. 45) is secured on the shelf member 9 by a screw 2314 (FIG. 144) assembled through a hole therefor in each of the brackets 2313 and secured in threaded holes therefor in shelf member 9.

A rotatable main shaft 2315 is mounted on its left end in a bushing 2316 (FIG. 145) and on its right end in a bushing 2317. Bushing 2316 is assembled in a close fitting hole therefor in plate 2309, and bushing 2317 is likewise fitted into right side plate 2307.

A pinwheel assembly 2318 (FIGS. 144, 146 and 147) is secured on the shaft 2315 for rotation therewith incrementally one step for each encoded character or space, as will be explained. The assembly 2318 includes fourteen pins 2319 that are individually shiftable from the illustrated non-representing position to a second position for representing an underline, a word space or a nut space, as will be described. A hub 2320 (FIG. 145) is assembled on main shaft 2315 and it is secured in position as by a pin 2321. A pair of discoidal flanges 2322, 2323 are secured on hub 2320, in a known manner so as to rotate with the hub. A disc 2324 (FIG. 150) is assembled on the left end of hub 2320 (FIG. 147), and a disc 2325 (FIGS. 147 and 151) is assembled on the right end of hub 2320. Bolts 2326 (three of example) are assembled in holes therefor through the disc 2325, flanges 2323 and 2322 (FIG. 150) and disc 2324, and the unit thus formed is secured together by nuts 2327 secured on the ends of the bolts. If desired, the periphery of discs 2324 and 2325 may be further stiffened by bolts 2328 assembled through holes therefor in the discs, by spacer sleeves 2329 (FIG. 147) on the bolts 2328 between the discs, and by nuts 2330 (FIG. 150) secured on the ends of the bolts for tightening the discs against the ends of the sleeves.

A clearing disc 2331 (FIGS. 147 and 148) is secured on a flange of a hub 2332 (FIG. 145) as shown by rivets 2333. Hub 2332 is slidably mounted on the main shaft 2315. A thrust collar 2334 is secured on main shaft 2315 in a known manner for abutting bushing 2316 and preventing leftward movement of the shaft. An expansive spring 2335 is assembled on shaft 2315 between the collar 2334 and the hub 2332 for urging the hub and disc 2331 rightward in normal position where the hub engages the left end of the pin wheel hub 2320 as shown. Another thrust collar 2336 is secured on shaft 2315, near the right end of the shaft, for abutting bushing 2317 as shown and for preventing rightward thrust of the shaft.

A C-shaped thrust member 2337 (FIGS. 147, 148) is assembled in an annular groove 2338 (FIG. 145) in the hub 2332. This arrangement permits the hub 2332 and clearing disc 2331 to rotate freely of member 2337 (FIG. 147), but leftward movement of member 2337 will slide hub 2332 leftward on main shaft 2315. A pair of trunnion screws 2339 (FIG. 147, 148) are secured in a yoke member 2340, and their trunnion ends extend into axially aligned holes therefor in the C-shaped thrust member 2337. Member 2340 is pivoted on a support rod 2341, which is secured at its ends to bottom plate 2311 (FIG. 146) and to top plate 2312 in a known manner. A link 2342 is pivotally connected to yoke member 2340 (FIG. 147) and to the armature of the solenoid 2213. Solenoid 2213 is secured on the outside of forward plate 2308 and its armature extends inward through a clearance hole therefor in the plate. A stop rod 2343 is situated to stop member 2340 in counterclockwise operated position, and the stop rod is secured to plates 2311 and 2312 (FIG. 146) in a known manner.

The fourteen pins 2319 (FIGS. 144 and 147) are identical one with the other, but each one is assembled reversely in respect to its longitudinal sides when compared to the pin next to it, or in other words the pins are assembled back to back with like edges toward each other. Each pin 2319 has a rightward end extension 2344, which extends through a hole therefor in the disc 2325, near the periphery of the disc as shown in FIG. 151. Each pin 2319 (FIG. 144) has a stop projection 2345 on one edge for engaging the disc 2324 and thus limiting rightward operation of the pin. Each pin 2319 (FIGS. 148 and 150) is assembled in a notch 2346 in the edge of disc 2324 for guiding the pin. Each pin 2319 is similarly assembled in a notch 2347 (FIG. 148), in the periphery of the clearing disc 2331. A pair of semicircular keeper segments 2348 (FIGS. 148, 149) are provided for guiding the pins 2319 in the notches 2347 (FIG. 148) and also in the notches 2346. The segments 2348 (FIGS. 148 and 149) are secured by bolts and nuts 2349, to the right side of clearing disc 2331, as shown in FIG. 144. Thus, it can be seen that the pins 2319 may be shifted longitudinally rightwardly and leftwardly as limited by stop projections 2345, but they are otherwise held and guided in the framework of the wheel assembly 2318. A U-shaped spring means 2350, secured at its center in every other space between the pins by a pair of rivets 2351 (FIG. 150), is provided for yieldably holding two pins 2319, that are adjacent the spring means, in either the normal or operated position as the case may be. Each of the pins is equipped with a detent point 2352 (FIG. 144) on its edge toward the adjacent spring means 2350, and the spring means has a bend 2353 (one for each adjacent pin) that cooperates with the detent point 2352 for yieldably holding the respective pin in normal and operated position. A pair of clearing shoulders 2354, near the left end of each pin 2319, overhang the sides of the respective notch 2347 (FIG. 148) of the clearing plate 2331. Thus, when the clearing plate 2331 (FIG. 144) is shifted leftward, the clearing plate 2331 engages the clearing shoulders 2354 of all operated pins 2319 and shifts them leftward to the illustrated normal position. From the above, it can be seen, that, upon operation of the clearing solenoid 2213 (FIG. 147), the solenoid pulls link 2342 and rotates member 2340 counterclockwise for shifting the hub 2332 and clearing disc 2331 leftward against tension of spring 2335 until member 2340 is stopped by rod 2343, and the disc 2331 acts on shoulders 2354 for normalizing all operated pins 2319 and thus clearing the pinwheel 2318. Deenergization of clearing solenoid 2213 permits the spring 2335 to restore the just described clearing parts to the illustrated positions.

The structural details of the means for setting the pins to represent underlines, word spaces or nut spaces will now be described. A pin setting solenoid 2355 (FIG. 144) is secured on plate 2309 as shown. A link 2356 is pivotally connected to the armature of solenoid 2355 and to a lever 2357. Lever 2357 and an arm 2358 are secured together at their vertex to form a hub which is pivoted on rod 2341 in a known manner. A contractile spring 2359 is connected to arm 2358 and to left side plate 2309, in a known manner, for urging the unit formed of the arm and lever 2357 counterclockwise to the illustrated position where lever 2357 is stopped against stop rod 2343. In each angular position of the pinwheel 2318, a pin 2319 is situated in alignment with the free end of arm 2358. When solenoid 2355 is operated as will be described, it pulls link 2356, rotates lever 2357 presses the end of the arm 2358 against the end of the aligned pin 2319, and shifts the pin rightward until the stop projection 2345 of the operated pin engages the disc 2325. At this occurs, the point 2352 of the pin moves to the right of the related bend 2353 of spring means 2350, where the point and the pin is thus yieldably held in operated position.

Detent means and means for rotating the main shaft 2315 together with the pinwheel 2318 will now be described.

A pair of identical centralizer members 2360 and 2361 (FIG. 144) are secured on hubs 2362 and 2363 (FIG. 145), respectively, and these units are assembled back to back on the shaft 2315. A hub member 2364 is secured on main shaft 2315 as by pin 2365 so as to rotate as a unit with the shaft. A keyway 2366 is formed in the surface of hub member 2364 along the entire length of the hub member 2364. A generally central journal 2367, which may be in the form of a sleeve that is machine pressed on the hub member 2364, is provided for carrying a drive pawl support member 2368 as will be explained. A reverse drive ratchet wheel 2369 is assembled on hub member 2364, against the right end of journal 2367, and it is equipped with a well known type of key fitting the keyway 2366 for assuring that the ratchet wheel 2369 turns as a unit with the hub member 2364 and therefore with the shaft 2315. A forward drive ratchet 2370, also with a key fitting the key way 2366 like ratchet wheel 2369, is assembled on hub member 2364 against the left end of journal 2367. A pair of nuts 2371 are assembled on threads therefor on the hub member 2364, and the nuts with suitable lockwashers (not numbered) are tightened against the ratchet wheels 2369 and 2370 for securing the ratchet wheels on the hub member, against the end shoulders of the journal 2367. Thus, ratchet wheels 2369 and 2370, journal 2367, nuts 2371, hub member 2364 and shaft 2315 are secured solidly together as a unit.

The drive pawl support member 2368 is freely pivoted on journal 2367, and it is comprised of three generally radial arms 2372, 2373 and 2374 (FIG. 152). Arm 2372 carries a rightwardly extending stud 2375 (FIG. 144), which extends between the centralizer members 2360 and 2361. A torsion spring 2376 is assembled about the hubs of centralizer members 2360 and 2361, and it is connected to the members for urging them opposingly against the stud 2375. At the same time, the members 2360, 2361 and the stud 2375 are angularly positioned according to a rod 2377, which is secured on plates 2307 and 2309 as shown. In this manner, the arms 2372–2374 (FIG. 152) are normally situated as shown.

A forward operation cocking solenoid 2378 is secured on plate 2308 and a link 2379 is pivotally connected to the armature of the solenoid and to a lever 2308. Lever 2380 is pivoted on a rod 2381 which is secured at its ends on plate 2307 (FIG. 144) and on a vertical plate 2382. Plate 2382 is secured on bottom plate 2311 (FIG. 152) and on top plate 2312. A link 2383 is pivotally connected to the lever 2380 and to a reversing pawl 2384, which is pivoted at 2385 on the arm 2373 of the pawl support member 2368 (FIG. 145). A contractile spring 2386 (FIG. 152) is connected to the pawl 2384 in a known manner and to a stud 2387, which is secured on arm 2374. Spring 2386 urges pawl 2384 counterclockwise against the teeth of reverse drive ratchet wheel 2369. A forward direction pawl 2388 is pivoted at 2389 on the arm 2374, and it is identical to reversing pawl 2384 but it is assembled in the reverse direction to pawl 2384. A contractile spring 2390, identical to spring 2386, is connected between forward direction pawl 2388 and a stud 2391 that is secured on arm 2373, and the spring 2390 urges pawl 2388 clockwise against the teeth of forward ratchet wheel 2370. A link 2392 is pivotally connected to pawl 2388 and to a lever 2393. Lever 2393 is secured to a lever 2394 in a known manner and the lever assembly is pivoted on a rod 2395. Rod 2395 is supported on a pair of angle brackets 2396 and 2397, which are secured to top plate 2312. A link 2398 is pivotally connected to lever 2394 and to the armature of a reverse cocking solenoid 2399, which is secured on plate 2312. A yieldable detent roller 2400 is urged against the ratchet wheels 2369 and 2370, in a manner to be described, for normally engaging the opposing inclines of the teeth of the ratchet wheels as shown and for thus yieldably holding the ratchet wheels, the main shaft 2315 and the pinwheel 2318 (FIG. 144) in a position where a corresponding one of the pins 2319 is aligned with the end of the pin setting arm 2358 as described. Roller 2400 (FIG. 152) is rotatably mounted on a rod 2401, which is secured on parallel arms 2402 and 2403. Arms 2402 and 2403 are secured on the ends of a hub 2404 (FIG. 144), which is pivoted on the rod 2377. A contractile spring 2405 is connected to arm 2402 and to rear plate 2310 for urging the roller 2400 (FIG. 152) clockwise against the ratchet wheels 2369 and 2370.

The arrangement is such that, upon operation of forward solenoid 2378, the solenoid pulls link 2379, rotates lever 2380 clockwise, pulls link 2383, and first rotates pawls 2384 clockwise about pivot 2385 to disengage the pawl from the teeth of the reverse drive ratchet 2369, while the roller 2400 detains the ratchet wheels, and then to engage a surface 2406 on the pawl with a pin 2407 which is secured on arm 2373 of the pawl support member 2368 (FIG. 145) and then to rotate the member on the journal 2367. As the member 2368 is thus rotated counterclockwise as seen in FIG. 152, the forward drive pawl 2388 ratchets over one tooth on the ratchet wheel 2370, and the pin 2375 on arm 2372 shifts the centralizer member 2360 away from rod 2377 against tension of relatively strong spring 2376. At about the time the end of pawl 2388 drops off the next counterclockwise tooth on ratchet wheel 2370, a surface 2408 on arm 2374 engages a stationary stop rod 2409 for limiting the rotation of the pawl support member 2368. At this point, and in this manner, the arrangement is cocked for clockwise foward operation of the ratchet wheels 2369, 2370 and the pinwheel 2318. The stop rod 2409 is secured, at its ends, on the plates 2382 and 2307 (FIG. 144).

Upon deenergization of solenoid 2378 (FIG. 152), simultaneously as the cocked mechanism is restored, the spring 2376 acts on centralizer member 2360, restoring the pin 2375 and drive pawl support member 2368 clockwise, and the pawl 2388 rotates the ratchet wheels 2369, 2370 and the pinwheel 2318 one step clockwise. At the same time, the spring 2386 restores the pawl 2384 into engagement with the ratchet wheel 2369 to prevent over-rotation at the end of the operation. During the initial turning of the main shaft 2315 and the parts thereon, the ratchet wheels are rotated against the resistance of the yieldable detent roller 2400 and, as the step is completed, the roller finally assists the turning action and lodges against the next pair of teeth on the ratchet wheels in the new position of the parts on main shaft 2315. As the pin 2375 is driven clockwise into the illustrated position, the centralizer member 2360 strikes the rod 2377 and the centralizer member 2361 prevents clockwise over-rotation of the pin 2375, the drive pawl support member 2368 and the pawls 2384 and 2388. At this time, as mentioned above, the pawl 2384 acting on ratchet wheel 2369 prevents clockwise over-rotation of the ratchet wheels and parts mounted on shaft 2315. In this manner, the pinwheel 2318 (FIG. 144) is rotated one step forwardly (indicated by arrow "F", FIG. 146) and a pin 2319 (FIG. 144) that may have been set rightward by arm 2358 within the cycle, to be explained more fully, would be moved upwardly as shown here and its rightward extension 2344 would be driven under a sensing wheel 2410 as the pin 2319 is driven from line "A" to line "B" (FIG. 146). The sensing wheel 2410 and the rest of its sensing means will be described later in greater detail.

During deleting operations, the reverse cocking solenoid 2399 (FIG. 152) is operable, instead of the solenoid 2378, for rotating the pinwheel 2318, as will be described later. However, upon operation of reverse cocking solenoid 2399, the solenoid pulls link 2398, rotates levers 2394 and 2393 counterclockwise, pulls link 2392, and initially rotates the pawl 2388 counterclockwise about pivot 2389 and out of engagement with the teeth of ratchet wheel 2370. During this pivoting of pawl 2388, the pawl carrying member 2368 is held stationary by the centralizer members 2360 and 2361 and spring 2376, and also the detent roller 2400 holds the mechanism mounted on shaft 2315 as explained. At about the time pawl 2388 is fully disengaged from the ratchet wheel 2370, a surface 2411 on the pawl 2388 engages a stud 2412, which is secured on arm 2374 of the pawl carrying member 2368. Thereafter, the action of the solenoid rotates the member 2368 clockwise on the journal 2367 (FIG. 145). During this clockwise rotation of the member 2368 (FIG. 152), the disengaged pawl 2388 is overlaid the next clockwise tooth on ratchet wheel 2370, the pawl 2384 ratchets clockwise over one tooth on the ratchet wheel 2369 and the pin 2375 moves the centralizer member 2361 clockwise against tension of spring 2376. During this cocking action, the roller 2400 holds the ratchet wheels and all parts on main shaft 2315 in stationary position. At about the time the end of pawl 2384 drops off of the next clockwise tooth on ratchet wheel 2369, a surface 2413 on arm 2373 engages rod 2409 for limiting the cocking action.

Upon deenergization of solenoid 2399, simultaneously as the cocked mechanism is restored, the spring 2376 rotates the centralizer member 2361, pin 2375 and the entire pawl carrying member 2368 counterclockwise, and the pawl 2384 rotates the ratchet wheels and the pinwheel 2318 (FIG. 146) counterclockwise (reversely) one step as indicated by the arrow "R". At the same time, the spring 2390 (FIG. 152) restores the pawl 2388 clockwise into engagement with the ratchet wheel 2370 to prevent over-rotation at the end of the operation. As in forward operations, the ratchet wheels are first rotated against the resistance of detent roller 2400 and, as the step passes midpoint, the roller assists the turning action and lodges against the next pair of teeth on the ratchet wheels for holding new position of shaft 2315 and the parts thereon. As the pin 2375 is driven counterclockwise from cocked position into the illustrated position as described, the centralizer member 2361 strikes the rod 2377 and the centralizer member 2360 prevents counterclockwise over-rotation of the pin 2375, the drive pawl support member 2368 and the pawls 2384 and 2388. At this time, as mentioned above, the pawl 2388 acts on ratchet wheel 2370 to prevent overrotation of the ratchet wheels and parts mounted on main shaft 2315. In this manner, the pinwheel 2318 (FIG. 146) is rotated one step reversely as indicated by arrow "R" and a pin 2319 that may have been under the sensing wheel 2410 is driven to line "A" where it is again in alignment with the end of pin setting arm 2358 (FIG. 144). Similarly, a pin 2319 that may have been set and advanced to line "C" (FIG. 146) would be returned under the sensing wheel 2410 at line "B". The significance of sensing wheel 2410 will be described later.

During the just described deleting and reversing operations of the mechanism, a pin resetting means (deleting means) is effective for resetting all previously set pins that may be progressively returned to line "A", that is returned to alignment with the pin setting arm 2358 (FIG. 144) as mentioned above. The pin resetting means will now be described.

A pin resetting member 2414 (FIGS. 144 and 146) is pivoted on a rod 2415, which is secured on bottom plate 2311 and top plate 2312 (FIG. 146). A torsion spring 2416 (FIG. 144) is connected to member 2414 and to plate 2382 for urging the member clockwise as shown. A link 2417 is pivotally connected to member 2414 and to the armature of the solenoid 1014. Solenoid 1014, is secured on forward plate 2308 and its armature extends through a clearance hole therefor in the plate. In normal position, a stud 2418 secured on member 2414 is urged clockwise against a stop surface 2419 on a latch member 2420. Member 2420 is pivoted on rod 2341 and a torsion spring 2421 is connected to the member and stop rod 2343 for urging the member 2420 clockwise against the stud 2418. A link 2422 is pivotally connected to member 2420 and to the armature of the solenoid 1290. Solenoid 1290 is secured on forward plate 2308 and its armature extends through a hole therefor in the plate.

At the outset of deleting operations, as described, the initial phase circuit thereof is momentarily effective, primarily for punching the back space function code in the control tape 577. However, this circuit passes through wire 1013 (FIG. 66), solenoid 1014 and wire 1015, as described, and it is this circuit that energizes the solenoid 1014 (FIG. 144) for locking the pin resetting member 2414 in operated position. Upon operation of solenoid 1014, it pulls link 2417 and rotates resetting member 2414 counterclockwise sufficiently to bring a surface 2423 on the member against a rightward end surface 2424 of an unset pin 2319 that is at pin setting position. At about the time surface 2423 is stopped against a rightward end surface 2424, the stud 2418 on pin resetting member 2414 is shifted counterclockwise just beyond a latch surface 2425 on latch member 2420, whereupon latch member 2420 is rotated clockwise by spring 2421 to latch the resetting member 2414 in operated position. Thus, even though solenoid 1014 is energized only momentarily as will be described, the resetting member 2414 is held in operated position during the deleting sequences. When resetting member 2414 is held in operated position and when a pin or successive pins 2319 are shifted counterclockwise from position "B" (FIG. 146) to position "A", the rightward end surface 2424 (FIG. 144) of each pin 2319 so moved will be shifted under the surface 2423 of the resetting member 2414. The rightward extension 2344 of a pin that was previously set, as described and returned to pin setting position as just mentioned, will engage a cam surface 2426 on reset member 2414, and the pin will be shifted leftward in the pinwheel 2318 by the cam surface 2426 into its normal non-representing position. Thus, the pin 2319 so returned is rendered ineffective for representing the space or underline code that is deleted during the instant deleting sequence.

Following return of the delete key 140 and resulting termination of deleting sequences, when the tape return key 138 is depressed and the back space function code (tape return) is read, the solenoid 1290 is operated, as described, for restoring the latch member 2420. Operation of solenoid 1290 pulls link 2422, and rotates latch member 2420 against tension of torsion spring 2421 until the member is stopped by stop rod 2343. Just prior to the engagement of the rod 2343 by member 2420, the latch surface 2425 disengages from stud 2418 and the spring 2416 then rotates reset member 2414 clockwise to the illustrated position where stud 2418 stops against surface 2419 as shown.

The structural details of the sensing wheel 2410 and its sensing means will now be described. Sensing wheel 2410 is rotatably mounted as at 2427 (FIG. 146) on a sensing lever 2428, which is pivoted on the rod 2377. A contractile spring 2429 is connected to sensing lever 2428 and to rear plate 2310 for urging the lever counterclockwise in normal position against a stop stud 2430 as shown. Stud 2430 is secured on an angle bracket 2431, which in turn is secured on plate 2310. An insulator 2432 is secured on the lower end of lever 2428, and the bifurcated switch blade 1224 is secured on the insulator so as to be insulated from the lever. In the illustrated normal position of the lever 2428, the blade 1224 is engaged with a pair of contacts 1219 and 1222, and, in operated position of the lever, the blade 1224 is engaged with the pair of contacts 1220 and 1225. The contacts 1219, 1220, 1222 and 1225 are secured on an insulator 2433, and the contacts 1219 and 1220 are conductively interconnected in a known manner while contacts 1222 and 1225 are separately connected to respective wires 1221 and 1226 as previously described. Insulator 2433 is secured on an angle bracket 2434, which is secured on bottom plate 2311 in a known manner. The arrangement is such that a pin 2319, previously set by arm 2358 (FIG. 144) and rotated from line "A" (FIG. 146) to line "B" in forward operations as described, will cause the sensing wheel 2410 to roll up on the pin and rotate lever 2428 clockwise against tension of contractile spring 2429 for shifting the blade 1224 off of contacts 1219, 1222 and on to contacts 1220, 1225 and for thus indicating that the last item encoded is a space or an underline. Similarly, when a previously set pin is shifted from line "C" to line "B" in deleting operations, the pin will cause the roller 2410 to rotate the sensing lever 2428 clockwise and to shift the blade 1224 in the same manner as just described, for indicating that the last effective code (not deleted) is for a space or an underline. When a pin that is not set to indicate a space or an underline is shifted from line "A" or line "C" to line "B", the spring 2429 either holes or rotates the sensing lever 2428 in the illustrated normal position and blade 1224 is held or restored to the illustrated normal position for indicating that the last effective code is not for a space or an underline.

The justifying key 244 (FIG. 17) and its control of the circuit that operates the space recorder arrangement (pin setting solenoid 2355, FIG. 144, and its parts 2356–2358) in the just described space at the end of line preventing mechanism 2306 will now be described.

It should be remembered that the codes for the space keys, including the space bar 760 and the 0.050", 0.075" and 0.100" nut space keys 761–763, each comprise a four channel code bit. Even though the underline key 19 does not cause carriage movement, its use at the end of a line should be prevented since its code would cause printing of the underline mark beyond the right hand margin in the reproducer 2279 unless a character were coded thereafter so the normal character would be printed over the underline mark in the reproducer 2279. Thus, the four channel code bit circuit for punching the underline code will be treated like those for the space codes. Particularly, the space bar word-space code is 34, the two unit nut space is 346, the three unit nut space is 1457, the four unit space code 247 and the underline code is 1456. The circuits for these fourth channel code bits are utilized for recording the occurrence of spaces and an underline mark as distinguished from the occurrence of normal characters.

When a line has progressed sufficiently for its text to extend to less than 0.700" of the right hand margin and a word-space or a nut space occurs, a circuit passing through the carriage moving mechanism 149 (FIG. 11) and shunted through the upper-lower case switch means 159 and the appropriate group wires "F", "G" or "A" is made effective by the given space key relay 815–818 (FIG. 59) and the commutator 824 in the amount left in the line mechanism 1483 for differentially rendering effective the space recorder (pin setting) mechanism in the space prevented mechanism 2306 as described. Similarly, when a line has progressed sufficiently for the text to extend to within 0.700" of the right hand margin and underline occurs, a circuit is made effective by the depressed key 19 (FIG. 11) and it runs through the preconditioned commutator 824 (FIG. 59) for at times operating the space recorder (pin setting mechanism) and the main punches 567, but this circuit avoids the carriage moving mechanism 149 and the case switch means 159. The underline circuit will now be described. The wire 132 (FIG. 11) is connected to blade 114 as described, and it is connected to the wire 148. The wire 136 that is connected to blade 129 under the underline key 19 is also connected to the wire 835 (FIG. 59) that is connected between the four unit space relay 817 and the commutator 824 as shown and described.

The arrangement is such that, upon depression of the underline key 19 (FIG. 11), its circuit is normally complete from the source of power (S) through wires 137 (FIG. 153), 139, 141, 143, 145, 147 and 148 the same as for normal characters and spaces, as described. However, the underline circuit avoids the carriage moving mechanism 149, and it continues through wire 132 (FIG. 11) and the now connected blades 114, 116, 117, 118 and 129 under the operated key 19. The current passing through blades 116, 117 and 118 continues via the respective wires 133, 134 and 135, the 1, 5, 6 code channel punch wires and so on for operating the main punch mechanism 161 to punch these channels. The current from blade 129 passes through wires 136 and 835 (FIG. 59), and commutator 824 which normally directs the current through wires 836, 831, 825 and the 4 code channel punch wire and so on for causing the main punch mechanism 161 to encode the 4 code channel. Thus the underline code 1, 4, 5, 6 is normally punched upon operation of that key 19. However, when the line has progressed to less than 0.700" from the right hand margin, the underline 4 channel circuit will pass through the commutator 824 and emerge via the wire 1634, the same as described for the four unit space, and this current will pass through a recording circuit that will now be described.

A space and underline recording circuit wire 2435 is connected to each of the wires 1634, 1644 and 1654, and to a normally closed switch 2436 which is one of the switches 652 (FIG. 46) in the punch control relay 603 that was described previously. A wire 2437 (FIG. 59) is also connected to the switch 2436 and to two interconnected contacts 2438 and 2439.

Contacts 2438 and 2439 are secured on the insulating plate 271 (FIG. 17). A switch blade 2440 is secured on the insulator 281 and a companion blade 2441 is also secured on the insulator 281. Blades 2440 and 2441 are connected as by a conductor strip 2442 and rivets 2443 secured in holes therefor in the blades, the strip and the insulator 281 as shown. A pair of separate contacts 2444 and 2445 are secured on insulating plate 271 in positions where they are selectively engageable by blade 2441. The arrangement is such that blades 2440 and 2441 engage the contacts 2438 and 2444, respectively, in the illustrated normal "on" position of the parts controlled by the justifying key 244, and the blades are engaged with contacts 2439 and 2445 when the justifying key is in its "off" position.

A wire 2446 (FIG. 59) is connected to contact 2444 and to the space recorder (pin setting) solenoid 2355 (FIG. 144). A wire 2447 (FIG. 59) is connected between solenoid 2355 and the wire 825 which is connected to the "4" code channel punch wire as described. A wire 2448, which avoids the solenoid 2355, is connected between contact 2445 and the wire 2447 for completing the "4" code channel punch circuit when the justifying key 244 (FIG. 17) is "off".

As described previously, when a line has progressed at least sufficiently for a given space to enter the justifying area at the end of the line and one of space keys 760–763 (FIG. 59) is operated, the "4" code channel punch circuit is directed by the related space key relay 815–818, through the commutator 824, and the appropriate wire 1634, 1644 or 1654, as the case may be. Also, under the same condition and upon operation of the underline key 19 as explained, the underline key's "4" code channel punch circuit is likewise directed by the wires 136 and 835, through the commutator 824 and wire 1634. Now, assuming the punch key 602 (FIG. 3) is in "on" position and the switch 2436 (FIG. 59) is closed, and assuming the justifying key 244 (FIG. 17) is in "on" position, the "4" code channel punch circuit from the effective wire 1634, 1644 or 1654 (FIG. 59) will travel through wire 2435, switch 2436, wire 2437, contact 2438, conductively connected blades 2440 and 2441, contact 2444, wire 2446, the solenoid 2355 for setting a pin 2319 (FIG. 144) to represent the instant space or underline as described, on through wire 2447 (FIG. 59), wire 825, the "4" code channel wire, the "4" channel punch solenoid in the main punch mechanism 161 and so on as described previously.

From the above, it can be seen that, upon depression of any one of the space keys 760–763, at times when the space will extend all or in part into the justifying area at the end of the line and the justifying key 244 is in "on" position and the punches 567 are operable, the carriage moving mechanism 149 is cocked for appropriate carriage movement, a pin 2319 is set to represent the space in the space at end of line preventing mechanism 2306 and the four channel code bit is punched in the tape 577, simultaneously. Under the same conditions, operation of the underline key 19 causes a pin 2319 to be set for representing the underline mark in the space at the end of the line mechanism and simultaneously the four channel code bit is punched in the tape 577. The pinwheel 2318 is thereafter rotated one step, by a different circuit to be explained later.

It is interesting to note, at this point, that the pinwheel 2318 (FIG. 144) is rotated one step for every underline mark and for very movement of the carriage, following sufficient carriage movement to extend the line or the underline mark into the justifying area, but a pin 2319 is set by the just described circuit only when an underline occurs or when the carriage movement is for a space. In this way, pins 2319 are set in the pinwheel in positions therein relative to the occurrence of underline marks or spaces, and the bypassed position, where no pins 2319 are set, correspond to normal characters that occur between spaces or over an underline mark.

When the justifying key 244 (FIG. 17) is in "off" position, the circuit described above is changed to avoid solenoid 2355 (FIG. 59) and to avoid the possibility of resulting pin setting operations. The changed circuit, resulting from depression of a space key 760–763 or the underline key 19 as previously discussed, enters the justifying key switch means via wire 2437 and the interconnected contacts 2438 and 2439. Since the justifying key switch means is now in "off" position, the current will pass through the contact 2439, brush 2440 (FIG. 17), strip 2442, brush 2441, contact 2445 and wire 2448 (FIG. 59). Thus, when the current travels through wires 2448, and 825, it normally continues directly through the four channel code bit main punch solenoid and goes to ground, without affecting the space at end of line preventing mechanism 2306.

When the punch key control switch 2436 is open, the main punches 567 are not operable, and the underline keys' and the space keys' "4" is broken by the switch, regardless of the condition of the justifying control key 244. It should be easily understood that there will be no justifying when the main punches 567 do not operate, likewise there is no concern as to whether or not a space or underline mark occurs at the end of a line, and there is no need for the "4" channel code bit circuit which is rendered ineffective by opening switch 2436.

The circuits for performing forward and reverse rotation stepping operations of the pin carrier wheel 2318 (FIG. 144) will now be described.

As previously described, both the normal forward carriage moving circuit and the underline key circuit travel from a power source (S) through wires 137 (FIG. 153), 139, 141, 143, 145, 147 and 148, and the carriage moving circuit and the underline circuit continue through switch 409 and wire 132, respectively.

The circuit will normally travel this course throughout the majority of the line, however, the stepping of the pin carrier wheel 2318 will begin only upon movement of the typewriter carriage to a point that is less than 0.700" from the right hand margin and the circuit is altered at this point to include the forward cocking solenoid 2378.

A wire 2449 is connected to the previously described interconnected contacts 1611–1613 (FIG. 110) and to the forward cocking solenoid 2378 and the wire 148 (FIG. 153). When the carriage is moved to less than 0.700" and the brushes 1607 and 1608 (FIG. 107) are moved clockwise off of contacts 1603 and 1610 (FIG. 110), respectively, and the brushes are located on one of the contacts 1604–1606 and one of the contacts 1611–1613, respectively, as described previously, the circuit through wire 145 (FIG. 153) will continue through one of the contacts 1604–1606, the brush 1607 (FIG. 107), wire 1609, brush 1608, one of the contacts 1611–1613 (FIG. 153), wire 2449, wire 2450, wire 148 and so on through the carriage moving mechanism 149, etc. for completing the circuit for normal characters and spaces or through wire 132 for completing the underline circuit as the case may be and as described. Thus, during forward operations when the line extends to less than 0.700" from the right hand margin, the solenoid 2378 is operated to prepare for a forward step of the pin wheel 2318 whenever a normal character, space or underline key is depressed. When such a forward composing circuit if broken, by return of the operated key as described, the forward cocking solenoid 2378 is deenergized and the pin carrier wheel 2318 (FIG. 144) is advanced one step as described. With this in mind, it can be seen that the pin carrier wheel is advanced this one step at the same time that the encoding main punch mechanism 161 (FIG. 11) is restored, and also at the same time the carriage moving mechanism 149 moves the carriage forwardly at times when the key being returned is a space or normal character key.

The solenoid 2378 (FIG. 153) is avoided and it is therefore inoperable when the justifying control key 244 is in the "off" position and also when the punch control key arrangement 144 is in "off" condition. When the justifying key 244 is in "off" position, the bifurcated blade 284 is moved off of contacts 282 and 285 and on to contacts 283 and 286, whereupon the forward carriage moving circuit or the underline circuit as the case may be travels through wires 141, 287 and 148, for operating the carriage moving mechanism 149 forwardly or for encoding an underline mark, respectively, as described, without affecting the solenoid 2378. Similarly, when the justifying key 244 is in "on" position but the punch control key arrangement 144 is in "off" condition as described, the solenoid 2378 is excluded from the forward carriage moving and underline circuits. Thus, when the punch control key arrangement 144 is in "off" condition, the switch 670 is shifted and the forward carriage moving circuit or the underline circuit travels through wires 141 and 143, the shifted switch 670, wires 671 and 148, and so on as described.

The reverse (delete) circuits are arranged to accommodate the reversing requirements of the space preventing mechanism 2306 in much the same manner as that provided in the forward operation circuits described above. The wire 1145 is connected to interconnected contacts 2451 and 2452 (FIG. 17) on the insulating plate 271. A pair of individual contacts 2453 and 2454 are also secured on plate 271. A bifurcated blade 2455 is secured on the insulator 281 in a known manner. The arrangement is such that, in "on" position of the justifying key 244, the blade 2455 is engaged with contacts 2451 and 2453 as shown, and that, in "off" position of justifying key 244, the blade 2455 is engaged with contacts 2451 and 2453 as shown, and that, in "off" position of justifying key 244, the blade 2455 is engaged with contacts 2452 and 2454. The wire 1146 (FIG. 66) is connected to the commutator 142 (particularly therein to the contact 2453, FIG. 153) and to the punch control key arrangement 144 (particularly therein to the center blade of a switch 2456 which is one of the switches 652, FIG. 46, in the punch control relay 603 previously described). The wire 1147 (FIG. 153) is connected to the normally effective blade of switch 2456 and to the interconnected contacts 1614–1617 in the commutator 146. The wire 1148 is connected to the contact 1621 and to the reverse circuit wire 1149 that runs to the carriage moving mechanism 149 as described. A wire 2457 is connected to the interconnected contacts 1622–1624, one of which is effective when the carriage stands at less than 0.700" as described, and to the reverse cocking solenoid 2399. A wire 2458 is connected between solenoid 2399 and the reverse circuit wire 1149. A wire 2460 is connected to the normally ineffective blade of switch 2456 and to the reverse circuit wire 1149.

In order to complete the delete underline circuit that avoids the carriage moving mechanism 149, a wire 2461 is connected between the reverse circuit wire 1149 and the normally closed switch 1214 of the double switch means 1215 (FIGS. 80 and 78). A wire 2462 (FIG. 153) is connected to the switch 1214 and to the underline terminal 1, 4, 5, 6 in the back space decoder 1095 as shown also in FIG. 70. The delete circuit through the back space decoder 1095, wires 1156 and 1157 (FIG. 66), and solenoid 1158 operates the back space tape cycling mechanism 1159, as described, for opening switch 1214 and, in this instance, for thus breaking the delete underline circuit (code 1, 4, 5, 6), (FIG. 153). Breaking of the delete circuit causes the back space tape cycling mechanism 1159 (FIG. 66) to operate for continuing the delete cycle of reversing the control tape 577 and deleting the code as described.

As previously described, the normal reverse (delete) carriage moving circuit travels from a power (S) source through wires 137 (FIG. 153), 139, 1145, 1146, 1147, 1148, 1149, switch 1150, wire 1151, reverse carriage direction solenoid 1152, and so on through the rest of the delete circuit. The delete underline circuit will normally follow the same course up to and including wire 1149, but it will then deviate from the delete carriage moving circuit and travels through wire 2461, switch 1214, wire 2462, the then effective underline terminal (1, 4, 5, 6) in the back space decoder 1095 and so on through the rest of the delete circuit. The reverse (delete) carriage moving circuit and the delete underline circuit will normally follow these just described courses. However, when the line has progressed to less than 0.700" from the right hand margin and the brushes 1618 and 1619 (FIG. 107) each stand on one of the contacts 1615–1618 (FIG. 153) and 1622–1624, respectively, as described, the normal reverse circuit through wire 1147 will continue through one of the contacts 1615–1617, the brush 1618 (FIG. 153), wire 2457, reverse cocking solenoid 2399, wire 2458, wire 1149 and so on through the carriage moving mechanism 149 etc. or the wire 2461 for deleting characters and spaces or for deleting underlines, respectively, as the case may be. Thus, the reverse cocking solenoid 2399 is operated in preparation for reverse operation of the space preventing mechanism 2306 whenever a normal character, space or an underline is deleted from a line that extends to less than 0.700" from the right hand margin. When the circuit through solenoid 2399 is broken in a manner described previously, the pinwheel 2318 (FIG. 144) is returned one step, and when the delete circuit is for a character or a space the carriage is also reversed appropriately as described.

When the justifying key 244 (FIG. 153) is in "off" position, the bifurcated blade 2455 is moved off of contacts 2451 and 2453 and on to contacts 2452 and 2454, whereupon the reverse carriage moving and the delete underline circuits travel through wire 1145, contact 2452, blade 2455, contact 2454, wires 2459, and wire 1149 and so on, as described, without affecting the reverse cocking solenoid 2399. Similarly, when the justifying key 244 is in "on" position but the punch control key arrangement 144 is in "off" condition as described, the solenoid 2399 is also excluded from the delete circuits. Thus, when the punch control key arrangement 144 is in "off" condition, the switch 2456 is shifted and the delete circuits travel through wires 1145 and 1146, the shifted switch 2456, wires 2460 and 1149, and so on as described.

From the above, it can be seen that the forward direction solenoid 2378 and the reverse direction solenoid 2399 in the space preventing mechanism 2306, are operable only when the machine is set to justify, when the punches 567 are operable, when the carriage and therefore a line stands at less than 0.700" from the right hand margin, and when a normal character, a space or an underline is encoded or deleted.

Normally, when the line has progressed to less than 0.700" of the right margin, when the delete key 140 is depressed and when a character space or underline is deleted as described, current will travel from a source (S) through wires 137, 139, 1145, 1146, 1147 and 2457, solenoid 2399 and so on. However, since the above stated condition is for a line extended to less than 0.700", the wire 1148 will not be involved at this point. Under the above condition, the current will pass through contact 1615, 1616 or 1617 (FIG. 110), the brush 1618 (FIG. 107), wire 1620 and brush 1619, and one of the interconnected contacts 1622, 1623 or 1624 (FIG. 110), depending on whether the line has progressed to 0.675", 0.650" or less from the right margin as described. Under the present condition, the reverse carriage movement or delete underline circuit will continue, by wire 2457 leading from the interconnected contacts 1622–1624, through the reversing solenoid 2399 (FIG. 153) in the space preventing mechanism 2306 for preparing to reverse the pin carrier wheel 2318 one step for each impulse and the circuit continues through wires 2458 and 1149, and through the carriage moving mechanism 149 (reverse solenoid 1152) when the code is for a normal character or space, or through wire 2461 etc. when the code being deleted is for an underline as described. Under the present condition, when each reversing impulse is terminated, the pin carrier wheel 2318 is operated one step reversely, and, only when the code being deleted is for a normal character or a space, the carriage is operated reversely an amount corresponding to the character or space as explained. When the carriage 80 is back spaced, the amount left in the line mechanism 1483 is returned counterclockwise an amount corresponding to the deleted character or space by spring 1581 (FIG. 106) as explained. Also, as explained, the stud 1583 (FIG. 107) engages arm 1584, when the carriage 80 and the amount left in the line mechanism 1483 is returned counterclockwise to 0.625" representing position. It follows then that further back spacing of characters and spaces will cause counterclockwise return direction operation of lever 1586, and the brush 1619 may then be disengaged from contacts 1624, 1623 and 1622 (FIG. 110) and further reverse stepping of the pin carrier wheel 2318 will be terminated. When the lever 1586 (FIG. 107) is reversed to the 0.700" position and further automatic deleting operations occur, the lever 1586 is stopped in normal position by stop 1587 as explained, and the reversing circuit will be again through contact 1614 (FIG. 110), brush 1618 (FIG. 107), wire 1620, brush 1619, contact 1621 (FIG. 110), and directly through wires 1148 (FIG. 153), 1149 and the carriage moving mechanism 149 or wire 2461 and the delete underline circuit as shown. Thus the pin carrier wheel 2318 is controlled, by the portion of the amount left in the line mechanism 1483 shown in FIGS. 107 and 110, to be reversed one step for each character, space or underline that may extend wholly or in part to within 0.700" of the right margin.

From the above, it should be noted that forward and reverse stepping of the pin carrier wheel 2318 is controlled to occur whenever the maximum size (0.100") character, space or the underline mark will extend to be at least in part in the justifying area, which begins at 0.600" from the right margin as described. In other words, for example, if the line has progressed to 0.675" (FIG. 110) and a 0.100" (four unit) character or space is then added, the line will be extended thereby to 0.575", which is within the justifying area, and, since at the beginning of the operation of the brush 1619 (FIG. 107) was on contact 1622 (FIG. 110) the pin carrier wheel 2318 will be stepped to represent the character or space, as explained. Similarly, for example, if a line has progressed into the justifying area and, because of certain deletions, the carriage is back-spaced to the 0.575" position and deletion of a 0.100" character or space is then called for, the pin carrier wheel 2318 will be reversely stepped as explained, since at the beginning of this deleting operation the brush 1619 (FIG. 107) is on contact 1624, (FIG. 110) as explained. At the end of this deleting operation, the brush 1619 (FIG. 107) is on contact 1622 (FIG. 110) and a succeeding deletion operation would cause one more reverse step of the pin carrier wheel 2318 beyond its starting position, but this extra reverse step is of no consequence since the line will then be out of the justifying area and all previously set pins 2319 will have been restored by the resetting means as explained elsewhere herein. If further deleting operations occur immediately thereafter, there will be no corresponding reverse stepping, since the switch blade support member 1586 (FIG. 107) is stopped at its normal at rest 0.700" position where the brush 1619 is on contact 1621 (FIG. 110), as described. If the machine is later operated forwardly sufficiently for the carriage to again enter the justifying area, stepping of the pin carrier wheel 2318 will be reinstituted in the manner previously described.

It should be remembered that, since deleting in this embodiment is performed automatically under control of the control tape 577 which is punched during forward encoding operations, back spacing is always performed exactly in conformity with the values of the characters or spaces deleted and the pin carrier wheel 2318 will always be operated reversely from any given starting position at least one step for every character, space or underline that has been extended in part, or in total, in the justifying area. The fact that there may be an extra step of the pin carrier wheel 2318, prior to the actual entry of the carriage 80 into the justifying area, is of no consequence, since setting of pins 2319 to represent spaces is more closely controlled, as described above, and no pins 2319 will be set until a space, including all of the differential spaces and including the underline mark which does not cause carriage movement but which has a width of 0.100", actually extends in part or completely into the justifying area.

The space and underline sensing circuits and their control over other mechanism will now be described. The sensing means is effective for locking the carriage 80 against manual return and it is effective for unlocking to permit such return, when a set pin 2319 (FIG. 146) is shifted from line "A" to line "B" and from line "B" to line "C", respectively, only during forward operations of the machine. It is not necessary for the locking and unlocking means to function during reverse operations because the carriage is looked against manual return during deleting and tape return operations, particularly by operation of solenoid 1000 (FIG. 23) early in the deleting sequences of operations as described. However, during deleting operations, the sensing means does control to prevent return of the delete key 140, when the operator takes his finger off of the delete key 140 and a set pin 2319 (indicating that a space or an underline is the last effective encoded bit) is in position "B" (FIG. 146) at the end of a cycle of deleting operations. In other words, if normal deleting brings a set pin 2319 from line "C" to line "B", the sensing means will cause the delete key to remain held down through another sequence of operations and it will thus insure that the space or the underline represented by the pin 2319 will also be deleted before the delete key 140 is automatically released as described.

It should be noted that the sensing means and therefore the involved circuits are not utilized unless a set pin 2319 is either moved into or out of the sensing position "B" and therefore it is not necessary to involve the sensing circuits with the amount left in the line mechanism 1483, the justifying key 244 or the punch control key circuits 144, because the setting of the pins 2319 and rotary stepping of the pinwheel 2318 are dependent on these other controls as described before.

The arrangement for locking the carriage 80 against manual return during forward operations, when a space or an underline occurs and the line has progressed into the justifying area, will now be described.

When a space or an underline occurs and the pin 2319 is set at position "A", and when the pin 2319 is then shifted to position "B" as described, the pin 2319 coacts with sensing wheel 2410 and rotates the sensing lever 2428 clockwise for shifting the blade 1224 into engagement with the contacts 1220 and 1225, and for thereby making current available from the source of power (S), through the wire 1218 (FIG. 81), contact 1220, blade 1224, contact 1225 and wire 1226, as previously described.

A wire 2463 is connected to the wire 1226 and to a normally closed switch 2464, which is secured on vertical plate 288 (FIG. 23) of the carriage moving mechanism 149. A wire 2465 (FIG. 81) is connected to switch 2464 and to a solenoid 2456 which in turn is connected to ground as indicated. The solenoid 2466 (FIG. 23) is secured on vertical plate 288. A link 2467 is pivotally connected to the armature of solenoid 2466 and to an arm 2468. Arm 2468 is secured on the rearward end of a sleeve 2469 (FIG. 22), which is pivoted on the rod 1179, and a bellcrank 2470 is secured on the forward end of the sleeve 2469. The unit formed of arm 2468, sleeve 2469 and bellcrank 2470 is urged clockwise to normal position by a torsion spring 2471 (FIG. 23) connected to the bellcrank and to the stud 1056. The just described unit is normally stopped in the illustrated position where the bellcrank 2470 engages a stud 2472 which is secured on vertical plate 288 in a known manner. An insulator 2473 is secured on bellcrank 2470 in engaging alignment with a normally open switch 2474, which is secured on plate 288 in a known manner. A stud 2475 is secured on the upward arm of bellcrank 2470, and it extends rearwardly sufficiently to be in engaging alignment with a depending finger 2476 on the bail support member 1044. A surface 2477, on a pawl 2478, normally lies above the top of stud 2475 as shown. Pawl 2478 is pivoted on the stud 1058, and it is urged clockwise by a torsion spring 2479 connected to the pawl and to the stud 1056. A stud 2480 is secured on the leftward arm of pawl 1050, and it extends forwardly and it is normally pressed against a leftwardly extending arm 2481 of the pawl 2478. An insulator 2482 is secured on the arm 2481, and it is aligned with the normally closed switch 2464.

During forward operations, when a space or underline occurs and the sensing lever 2428 (FIG. 146) is shifted clockwise for engaging the switch blade 1224 with contacts 1220 and 1225 as described, the arrangement is such that current travels from source (S) through the wire 1218 (FIG. 81), through the engaged contacts and blade, through wire 1226, wire 2463, normally closed switch 2464, wire 2465 and it goes to ground through solenoid 2466. When the solenoid 2466 (FIG. 23) is thus operated, it pulls link 2467, and rotates the unit including arm 2468 and bellcrank 2470 counterclockwise.

Upon occurrence of a space or underline and counterclockwise rotation of bellcrank 2470 as just described, the pawl 1046 is employed to prevent manual return of the carriage 80 as will now be described. Upon counterclockwise operation of the bellcrank 2470, its stud 2475 pushes finger 2476, integral members 1044 and 1045 and bail rods 1042 and 1043 clockwise about rod 1041 against tension of spring 1061 (FIG. 27). As this occurs, the spring 1048 causes the finger 1047 and the pawl 1046 to pivot clockwise followingly in respect to bail rod 1042 for engaging the pawl 1046 with the ratchet wheel 303 (FIG. 23) and for preventing carriage return, in the same manner as described previously in connection with the preparations for back spacing operations. However, in this case, the carriage moving mechanism 149 remains in forward operation condition, since the solenoid 1000, link 1039, member 1172 etc., and member 1040, link 1188, and member 1189 are not operated and they remain in normal position under tension of spring 1190. When the pawl 1046 is properly engaged with the ratchet wheel 303, the insulator 2473 has pressed the switch 2474 closed and the pawl 1050 latches clockwise under the bail rod 1042 under tension of spring 1055. As this occurs, the stud 2480 moves away from arm 2481 of pawl 2478, and the tab 1051 is swung idly over finger 1049 of member 1040 now remaining in normal position. At the time the parts are conditioned as just described, the stud 2475 moves counterclockwise to a point where a surface 2483 on pawl 2478 latches clockwise to the right of stud 2475, as the pawl 2478 snaps clockwise, its insulator 2482 is shifted against switch 2464 for opening this switch and breaking the circuit through the now fully operated solenoid 2466 (FIG. 81). Thus, upon occurrence of a space or underline during forward operations, the solenoid 2466 is operated for engaging the pawl 1046 (FIG. 23) to prevent manual carriage return, for latching the bellcrank 2470 in operated position in order to hold switch 2474 closed, and for latching pawl 2478 clockwise and opening switch 2464 to break the circuit through the solenoid 2466. In this manner, the carriage 80 is locked against manual carriage return, while the carriage moving mechanism 149 remains conditioned for forward operation.

If the above mentioned space or underline is now followed by a character, or the space or underline is deleted, the carriage will be unlocked to permit manual carriage return.

Means for unlocking the carriage to permit manual carriage 80 return, upon addition of a character will now be described. Upon addition of a character, the pinwheel 2318 (FIG. 146) is advanced one step clockwise without delivering a set pin 2319 to position "B" and the previously set pin 2319 is shifted from position "B" to position "C" as previously described. When this happens, the spring 2429 returns the sensing lever 2428 to the illustrated position, and current will then travel from source (S), through wire 1218 (FIG. 81), contact 1219, blade 1224, contact 1222, wire 1221, a wire 2484 connected between wire 1221 and the switch 2474, the now closed switch 2474, a wire 2485 connected between switch 2474 and the switch 1175 that is closed during forward operations as described, through switch 1175, a wire 2486 connected to switch 1175 and to the solenoid 1060, and it goes to ground through the solenoid 1060. Upon operation of the solenoid 1060 the solenoid pulls the link 1059 (FIG. 23) to rotate the pawl 1050 counterclockwise for releasing rod 1042 and for pressing stud 2480 down on arm 2481 and for rotating pawl 2478 counterclockwise to release stud 2475 and to move insulator 2482 away from switch 2464. Thus, switch 2464 is permitted to close again and the bellcrank 2470 is permitted to restore clockwise under tension of spring 2471 for permitting switch 2474 to open and for permitting the spring 1061 (FIG. 27) to restore the unit including members 1044, 1045, and rods 1042 and 1043. The counterclockwise return of rod 1042 returns the pawl 1046 to its normal ineffective position.

Thus, by an addition of a character (an article "a" for example), or by addition of the first of more than one character, will release the mechanism for manual return of the carriage.

Under another condition, if a line is extended to a point where a character can not be added or it is extended to a point where a word cannot be properly hyphenated and a space or underline is the last bit of text encoded, the space or underline may be deleted in order to release the carriage for manual return. Deletion of the space or underline may be performed in the manner described previously herein. Generally speaking the operator merely momentarily depresses the delete key 140 (FIG. 15) where the delete key is automatically held by pawl 220 for one full cycle of deleting operations as described, and, in this case he does not have to hold the delete key for more than one cycle, unless some function such as a case shift for example were encoded following the space. However, during the initial delete cycle, the solenoid 1000 (FIG. 23) is operated for conditioning the carriage moving mechanism 149 for the reverse direction operation of the carriage 80 and for locking the mechanism against manual carriage return, as described. However, since the mechanism is already locked to prevent manual carriage return (bail 1042 already held in operated position by pawl 1050) as a result of the operation of solenoid 2466 as described, the solenoid 1000 operates as before described, but, under this condition, as the member 1040 is rotated clockwise, the remote end of its finger 1049 engages the right side of tab 1051 and cams the tab and its member 1052 counterclockwise against tension of spring 1055. When the mechanism is fully set for reverse operation, at about the time finger 1049 engages the bail rod 1042 in operated position, the spring 1055 returns the tab 1051 clockwise under the end of finger 1049 for holding the mechanism in reverse operation condition as described. In this manner, the mechanism is conditioned for deletion of the space or underline, which deletion occurs automatically as described, and the switch 1175 is opened during the reverse and tape return operations as described, for preventing premature operation of the solenoid 1060 (FIG. 81) when the space is deleted and the pin 2319 (FIG. 146) that represents the space or underline is shifted out from under the sensing wheel 2410 (from position "B" to position "A"). When the delete cycle is complete, the delete key 140 (FIG. 81) is released by operation of solenoid 225 as described. As also previously described, following depression of the tape return key 138 (FIG. 80), a circuit running through wire 1291 and solenoid 1060 for restoring the carriage moving mechanism 149. Under the present condition, operation of the solenoid 1060 (FIG. 23) not only rotates the pawl 1050 and member 1052 counterclockwise for releasing the bail rod 1042 and finger 1049, to effect the release for manual carriage return and to release for automatic return of the mechanism to forward operation condition, respectively, as previously described, but this time the stud 2480 also acts on arm 2481 for closing the switch 2464 and rotating the operated pawl 2478 counterclockwise and elevating the surface 2483 out of the path of stud 2475 and thus permitting spring 2471 to restore bellcrank 2470 clockwise to the illustrated position where it allows the switch 2474 to open. From the above, it can be seen that the carriage moving mechanism 149 is normalized, and the switches 2464 and 1175 are closed and the switch 2474 is opened, following deletion of the space at the end of the line in the justifying area and following tape return of the deleted matter. Thus, it should be understood that the carriage cannot be manually returned, when the machine is conditioned for punching codes, when it is conditioned for justification encoding, when the line has progressed into the justifying area and when a space or underline is the last encoded bit of text, but that the carriage 80 can be manually returned at any time when the machine is conditioned for forward operation and a normal character is the last text bit encoded or a normal character code is the most recent remaining effective code.

The clearing circuit for the space preventing mechanism 2306 will now be described. This clearing circuit is actually part of the full carriage return restoring circuit, which automatically becomes effective when the machine is normalized following manual carriage return, as described previously under topic "29". From the structure described hereinbefore, it can be seen that when the justifying key 244 (FIG. 17) is in "on" condition and current is made available through the full carriage return switch 1538 (FIG. 140) and when the tape sensor switch 1033 is closed to indicate that the tape 577 for the previous line is fully fed through the justifying punches 2046, 2047 as described the current will pass through the wire 2206, contact 2207, blade 2211 in normal position contact 2209, wire 2212, solenoid 2213 (FIG. 147) for clearing the pinwheel 2318 as described, wire 2214 (FIG. 140) and the minimum tape switch 1033 which is closed when the tape 577 for the line is completely fed through the justifying punches 2046, 2047 and clear tape 577 is in the main punches 567, and when the machine is cleared, unlocked etc., ready for the next line, as described.

It can also be seen that, when the justifying key 244 (FIG. 17) is in the "off" condition and, current is made available through the full carriage return switch 1538 (FIG. 140), current will pass through wire 2206, contact 2208, blade 2211, contact 2210, wire 2215, which bypass solenoid 2213 and the space preventing mechanism 2306, wire 2214 and the minimum tape sensing switch 1033 in the main punch mechanism 161. In this manner, the circuit which clears the machine for an ensuing line is controlled by the justifying key 244 to clear the space preventing mechanism 2306 when the justifying key 244 is in the "on" position and controlled to bypass the space preventing mechanism 2306 when the justifying key is in the "off" position and there is no need to clear the mechanism.

32. BOLD-REGULAR AND PRINT-NO PRINT FUNCTIONS AND ENCODING

The description of the upper-lower case switch means 159 and encoding means discussed under topics 10 and 11 should serve generally to aid in the understanding of the structures of the bold-regular and print-no print means to be described now in greater detail.

The details of the bold and regular encoding means will be described first. A bold and regular shift key 2487 (FIG. 3) is located conveniently at the right side of the keyboard as shown, and it is shiftable forward as shown or rearward to encode in the composing machine for "bold" and "regular" operation of the reproducer 2279, respectively, as indicated on the keyboard cover. In the composing machine, the position of the bold and regular shift key 2487 merely indicates to the operator that the reproducer 2279 will reproduce according to the position of the key. In other words, the text typed on the composing machine, when its key 2487 is in "bold"

position, will be reproduced in darker (greater intensity) type by the reproducer 2279, and the text typed on the composing machine (FIG. 1), when its key 2487 is in "regular" position, will be reproduced in normal intensity type by the reproducer 2279. In order to encode for the particular face type, a code 467 (bold face code) is punched on the control tape 577 by the main punches 567 as soon as the bold and regular shift key 2487 is shifted to its "bold" position, and a code 567 (Regular face code) is punched by the main punches 567 as soon as the bold and regular shift key 2487 is shifted to its "regular" position as will be described. The "bold face" and "regular face" function codes are listed in "Chart D" below, with the other function codes to be described later. "Chart D" may also be found among the charts that follow the Figure Descriptions hereinbefore.

CHART D

| FUNCTION CODES | |
|---|---|
| FUNCTION | CODE |
| Carriage return | 1237 |
| Line Delete | 3457 |
| Clear (normal) | 3467 |
| Line space | 4 |
| Rev. Line space | 45 |
| Upper case | 46 |
| Lower case | 47 |
| No Print | 456 |
| Print | 457 |
| Bold face | 467 |
| Delete, any code & | 4567 |
| Stop printer | 56 |
| Back space func | 57 |
| Regular face | 567 |

The structure of the bold and regular shift key 2487 will now be described. The bold and regular shift key 2487 is pivoted on the shaft 604 (FIG. 154), and it may be shifted clockwise or counterclockwise to the "regular" or "bold" positions, respectively. The key 2487 is very similar to the punch control key 602 (FIG. 43) previously described and it is also similar to a print control key 2488 (FIGS. 155 and 156) to be described later.

A yieldable detent 2489 (FIG. 154) is provided for holding the bold and regular shift key 2487 in either one of its shifted positions. Detent 2489 is pivoted on the rod 610, and a torsion spring 2490 is connected to the yieldable detent 2489 and it is anchored in a known manner for urging the detent 2489 counterclockwise against the key 2487. A roller 2491 secured on the remote end of the detent is urged against the key at all times. In the illustrated position of the bold and regular shift key 2487, the roller is urged into a recess 2492 on key 2487 for yieldably holding the key in "bold" position. As the key is manipulated clockwise, a projection 2493 on the bold and regular shift key acts on the roller 2491 and causes the yieldable detent 2489 to rotate clockwise against tension of torsion spring 2490, until the bold and regular shift key 2487 is moved past midpoint, at which time the detent acts to aid movement of the key to its full "regular" position where roller 2491 lodges in a recess 2494 on the bold and regular shift key. When the key 2487 is returned counterclockwise, the opposite takes place and the roller 2491 is again lodged in recess 2492.

An insulator 2495 is secured on a forwardly extending arm 2496 of the bold and regular shift key 2487, and an upwardly extending bifurcated conductor 2497 is secured on insulator 2495 so as to be insulated from extending arm 2496. The upper fibucations of conductor 2497 are pressed leftward against a contact 2498 and a conductor strip 2499 when the bold and regular shift key 2487 and its arm 2496 are in "bold" position as shown, and they are pressed against a contact 2500 and the conductor strip 2499 when the key is in clockwise "regular" position. The arrangement is such that current may flow through conductor strip 2499, conductor 2497 and contact 2498 when the key 2487 is in "bold" position, and that current may flow through conductor strip 2499, conductor 2497 and contact 2500 when the bold and regular shift key is in regular position.

An insulator 2501 supports strip 2499 and contacts 2498 and 2500, and it insulates them from a bracket 2502 on which the insulator 2501 is secured in a known manner. Bracket 2502 is secured on the upper horizontal flange of the channel member 624.

During deleting operations, when a "bold" or "regular" code is back spaced, it is necessary to reverse the position of the bold and regular shift key 2487 as will be described later. However, the motivating means for these reversing actions will now be described. A link 2503 is pivotally connected to the bold and regular shift key 2487 and to the armature of a solenoid 2504. Solenoid 2504 is secured on a vertical plate 2505, which is secured at the forward (left as shown) end of the plate to the channel member 624 and to the bottom plate 607 in any known manner. A link 2506 is pivotally connected to the bold and regular shift key 2487 and to the armature of a solenoid 2507 which is secured on vertical plate 2505. The arrangement is such that upon deletion of "bold" code 467, the solenoid 2504 is operated, as will be described. for pulling link 2503 and for thus rotating the key 2487 to the "regular" position, and that upon deletion of "regular" code 567, the solenoid 2507 is operated, as will be described, for pulling link 2506 and for thus rotating the bold and regular shift key 2487 to the "bold" position. Deletion of "bold" and "regular" codes and operation of the solenoids 2504 and 2507 will be described later in connection with deletion of these function codes.

Whenever the bold and regular shift key 2487 is shifted from the "bold" position, shown in FIG. 154, to the regular position, the blade 2497 is shifted to engage the contact 2500 and the conductor strip 2499 and thereby provide a ground, as indicated in FIG. 157, for the "regular" shifting of the bold and regular shift mechanism and the encoding sequence as follows.

The initial "regular" shift circuit will be described first. A source of power (S) is connected to a brush 2508, which is part of a switch that also includes a brush 2509 and a brush 2510. Brushes 2508–2510 (FIG. 29) are secured on a support insulator 2511, which is secured on plate 416, and the arrangement is exactly like that described for parts 479–482 (FIG. 28) described previously in connection with the upper-lower case switch means 159. The brushes 2508–2510 (FIGS. 29 and 157) cooperate with contacts on a disk 2512, in exactly the same manner as those described above in connection with the support insulators 432–435 (FIG. 28) for example. Therefore, at this point, it should suffice to point out that the brushes 2508 and 2510 (FIG. 157) are conductively connected by contacts on disk 2512 and thus they are effective only when the disk 2512 is in the illustrated counterclockwise regular (normal) position, and similarly the brushes 2508 and 2509 are effective only when the disk 2512 is shifted clockwise in its bold position.

The brush 2509, which is effective when the disk 2512 is in clockwise (bold) position as explained, is connected by a wire 2513 to a regular shift motivating solenoid 2514, which is identical to the previously described solenoid 492 (FIG. 34). Regular solenoid 2514 (FIG. 157) is connected by a wire 2515 to the contact 2500. When the disk 2512 is in the clockwise bold position and the brushes 2508 and 2509 are effective as described and when the bold and regular shift key 2487 is then shifted to the illustrated clockwise regular position, current will travel through effective brushes 2508 and 2509, wire 2513, solenoid 2514, wire 2515, contact 2500, conductor 2497 and it goes to ground through conductor strip 2499 to complete the circuit for operating regular shift motivating solenoid 2514.

Operation of solenoid 2514 motivates a mechanism just like that in FIG. 34. Thus, the solenoid pulls a link 2516 (FIG. 157), rotates a member 2517 clockwise about rod 421 for operating a snap switch arrangement preparatory to snapping the disk 2512 counterclockwise to regular position and ultimately presses an insulator 2518 carried by the member 2517 against a "regular" encoding switch 2519 for closing the switch.

The regular face encoding circuits are rendered effective by closure of "regular" encoding switch 2519 and they will now be described. A wire 2520 is connected between the wire 539 and a disk liberating solenoid 2521, which is provided for liberating the disk 2512 to the influence of the snap switch that is motivated by regular shift motivating solenoid 2514. A wire 2522 is connected to disk liberating solenoid 2521 and to a blade 2523 of the "regular" encoding switch 2519. The other three blades 2524, 2525 and 2526 of the switch 2519 have wires 2527, 2528 and 2529, respectively, connected to them. The wire 2527 is also connected to a brush 2530, which is effective together with a brush 2531 only when the disk 2512 is in clockwise "bold" position. The brush 2531 is effective with a brush 2532 only when the disk 2512 is in the illustrated counterclockwise "regular" position. A wire 2533 is connected between brush 2531 and the 6 code channel punch wire. The wire 2528 is connected between blade 2525 and a brush 2534. Brush 2534 is in contact with a brush 2535 only when the disk 2512 is in its clockwise "bold" position. A brush 2536 is in contact with the brush 2535 only when disk 2512 is in the illustrated counterclockwise "regular" position. A wire 2537 is connected between brush 2535 and the 7 code channel punch wire. The wire 2529 is connected between the blade 2526 and a brush 2538, which is in contact with a brush 2539 only when the disk 2512 is in clockwise "bold" position. A wire 2540 is connected between brush 2539 and the 5 code channel punch wire. The brushes 2530–2532 and brushes 2534–2536 are respectively secured on insulators 2541 and 2542 (FIG. 29), which in turn are secured on plate 416, just like insulators 532 and 432 (FIG. 28) described previously. The brushes 2538 and 2539 (FIG. 157), together with a pair of brushes 2543 and 2544 that are effective only when the disk 2512 is in the illustrated counterclockwise "regular" position as will be described, are mounted on an insulator 2545 (FIG. 29) and the insulator is secured on plate 416, like insulator 537 (FIG. 28).

When the regular shift motivating solenoid 2514 (FIG. 157) completes its operation and closes switch 2519, preparatory to the shifting of disk 2512 from its clockwise "bold" position, current flows from source of power (S) through wires 137, 139, 538, 539 and 2520, and it operates the disk liberating solenoid 2521. Operation of disk liberating solenoid 2521 will be explained presently in greater detail. However, the encoding circuit continues through the disk liberating solenoid 2521, wire 2522 and the blade 2523 of the now closed "regular" encoding switch 2519. At this point, the encoding circuit splits into three distinct parallel code channel punch circuits, particularly for punching the regular face code 5, 6, 7. The 5 code channel circuit passes through blades 2523 and 2526, wire 2529, brushes 2538 and 2539 that remain effective as described while the disk 2512 is momentarily detained in clockwise "bold" position, it continues through the wire 2540, the 5 code channel punch wire, and the corresponding 5 solenoid in main punch mechanism 161 as described. The 6 code channel circuit passes through blades 2523 and 2524, wire 2527, effective brushes 2530 and 2531, wire 2533, the 6 code channel punch wire and the corresponding 6 solenoid in the main punch mechanism 161. The 7 code channel circuit passes through blades 2523 and 2525, wire 2528, effective brushes 2534 and 2535, wire 2537, the 7 code channel punch wire, and the corresponding 7 solenoid in the main punch mechanism 161. By this circuitry the regular code 5, 6, 7 is punched, and the disk liberating solenoid 2521 is operated at the same time.

The solenoid 2521 and a detent 2546 correspond to the arrangement described for upper-lower case and exemplified by solenoid 527 (FIG. 33) and the time-delay detent 517. The disk liberating solenoid 2521 (FIG. 157) operates to render the detent 2546 ineffective for detaining the disk 2512, in this instance in clockwise "bold" position. Whereupon, the disk 2512 is free to rotate counterclockwise, to the illustrated position, under the influence of the snap switch arrangement operated by regular shift motivating solenoid 2514. When this occurs, the brush 2509 is rendered ineffective and the regular shift motivating solenoid 2514 is thereby deenergized to permit "regular" encoding switch 2519 to open, and also the brushes 2530, 2534, 2538 and 2539 are rendered ineffective and the operated main punch solenoids 565 (1-7) are thereby deenergized. At this point, the bold and regular shift key 2487 stands in "regular" position, the "regular" encoding switch 2519 stands open, the disk 2512 is shifted counterclockwise in "regular" position, all as shown, and the regular code (5, 6, 7) is encoded.

Whenever the bold and regular shift key 2487 is shifted from the illustrated "regular" position to the "bold" position, the blade 2497 is shifted to engage the contact 2498 as well as the conductor strip 2499 to provide a ground for the "bold" shifting and encoding sequence as follows.

The "bold" shift circuit will now be described. The brush 2510, which is effective when the disk 2512 is in the illustrated counterclockwise "regular" position as explained, is connected by a wire 2547 to a bold shift motivating solenoid 2548, which is identical to the previously described solenoid 488 (FIG. 34). Bold shift motivating solenoid 2548 (FIG. 157) is connected by a wire 2549 to the contact 2498. When the disk 2512 is in the counterclockwise "regular" position and the brushes 2508 and 2510 are effective as described and when the bold and regular shift key 2487 is then shifted to the counterclockwise "bold" position, current will travel through effective brushes 2508 and 2510, wire 2547, bold shift motivating solenoid 2548, wire 2549, contact 2498, conductor 2497 and it goes to ground through conductor strip 2499 to complete the circuit for operating solenoid 2548.

Operation of bold shift motivating solenoid 2548 motivates a mechanism just like that in FIG. 34. Thus, the solenoid pulls a link 2550 (FIG. 157), rotates a member 2551 counterclockwise about rod 421 for operating a snap switch arrangement preparatory to snapping the disk 2512 clockwise to "bold" position and ultimately presses an insulator 2552 carried by the member 2551 against a "bold" encoding switch 2553 for closing the switch.

The "bold" encoding circuits are rendered effective by closure of "bold" encoding switch 2553 and they will now be described. A wire 2554 is connected to the wire 2522 and to a blade 2555 of the "bold" encoding switch 2553. The other three blades 2556, 2557 and 2558 of the switch 2553 have wires 2559, 2560 and 2561, respectively, connected to them. The wire 2559 is also connected to the brush 2532, which is in contact together with the brush 2531 only when the disk 2512 is in the illustrated "regular" position as described. The wire 2560 is connected between blade 2557 and the brush 2536, which is in contact with the brush 2535 only when the disk 2512 is in the illustrated "regular" position as described. The wire 2561 is connected between the blade 2558 and the brush 2543, which is in contact with the brush 2544 only when the disk 2512 is in the illustrated "regular" position as described. A wire 2562 is connected between the brush 2544 and the 4 code channel punch wire.

When the bold shift motivating solenoid 2548 completes its operation and closes "bold" encoding switch 2553, preparatory to the shifting of disk 2512 from its illustrated counterclockwise "regular" position as described, current flows from source (S) of power through wires 137, 139, 538, 539 and 2520, disk liberating solenoid 2521, wire 2522, the wire 2554 and the now closed "bold" encoding switch 2553. At this point, the encoding circuit splits into three distinct parallel code channel punch circuits, in this instance particularly for punching the bold face code 4, 6, 7. The 4 code channel circuit passes through blades 2555 and 2558, wire 2561, brushes 2543 and 2544 that remain effective as described while the disk 2512 is momentarily detained in the counterclockwise "regular" position, and it continues through the wire 2562, the 4 code channel punch wire and the corresponding 4 channel solenoid in main punch mechanism 161 as described. The 6 code channel circuit passes through blades 2555 and 2556, wire 2559, effective brushes 2532 and 2531, wire 2533, the 6 code channel punch wire and the corresponding 6 channel solenoid in the main punch mechanism 161. The 7 code channel circuit passes through blades 2555 and 2557, wire 2560, effective brushes 2536 and 2535, wire 2537, the 7 code channel punch wire and the corresponding 7 channel solenoid in the main punch mechanism 161. By this circuitry, the bold code 4, 6, 7 is punched, and the disk liberating solenoid 2521 is operated at the same time. Operation of the disk liberating solenoid 2521 disengages the time-delay detent 2546 and permits the disk 2512 to rotate clockwise to "bold" position under the influence of the snap switch arrangement operated by bold shift motivating solenoid 2548. When this occurs and the disk 2512 snaps clockwise to the "bold" position, the brush 2510 is rendered ineffective and the bold shift motivating solenoid 2548 is thereby deenergized to permit the switch 2553 to open, and also the brushes 2532, 2536, 2543 and 2544 are rendered ineffective and the operated main punch solenoids 565 (1-7) are thereby deenergized. At this point, the bold and regular shift key 2487 stands in "bold" position, the "bold" encoding switch 2553 is restored open, the disk 2512 is shifted clockwise in "bold" position, and the "bold" code (4, 6, 7) has been encoded.

The print control key 2488 and its encoding arrangement will now be described. When the print control key 2488 (FIG. 155) is shifted clockwise to the illustrated "print" position, it normally causes the "print" code 4, 5, 7 to be encoded on the control tape 577, and, when this code is read by the main reading device, it will prepare the reproducer 2279 to print and move the carriage according to the character and space codes that follow. When the print control key 2488 is shifted counterclockwise to the indicated "no print" position, it normally causes the "no print" code 4, 5, 6 to be punched on the tape, and this code will prepare the reproducer to move the carriage according to the characters and space codes that may follow but printing of such characters will not occur.

The structure and operations of the print control key 2488 are exactly like those described for the bold and regular key 2487 (FIG. 154), and the details previously described will serve to describe the print control key 2488 (FIG. 155). The print control key 2488 is pivoted on the shaft 604, and it may be shifted clockwise or counterclockwise to the "print" or "no print" positions, respectively. A yieldable detent 2563, including a spring 2564 and and a roller 2565, is provided for holding the print control key 2488 in either one of its shifted positions. An insulator 2566 is secured on an arm 2567 of the key 2488, and an upwardly extending conductor 2568 is secured on insulator 2566 so as to be insulated from the arm. The bifurcations of the conductor 2568 are pressed leftward against a contact 2569 (FIG. 156) and a conductor strip 2570 when the print control key 2488 is in its counterclockwise "no print" position, and the conductor is engaged with a contact 2571 and the conductor strip 2570 when the key 2488 is in clockwise "print" position. An insulator 2572 supports strip 2570 and contacts 2569 and 2571, and it insulates them from a bracket 2573 (FIG. 155) on which the insulator 2572 is secured. The bracket 2573 is secured on the upper flange of the channel member 624.

During deleting operations, when a "no print" or "print" code is back spaced, it is necessary to reverse the position of the print control key 2488, the same as for the bold and regular shift key 2487 as will be described later. For reversing the print control key 2488 to the "print" position, a link 2574 is pivotally connected to the print control key 2488 and to the armature of a solenoid 2575. A link 2576 is pivotally connected to the print control key 2488 and to the armatures of a solenoid 2577. The solenoids 2575 and 2577 are secured on the plate 2505 (FIG. 44) in any known manner. The arrangement is such that upon deletion of a "no print" code 456, the solenoid 2575 (FIG. 155) is operated as will be described, for pulling link 2574 and thereby rotating the print control key 2488 to the "print" position, and that upon deletion of a "print" code 457, the solenoid 2577 is operated as will be described, for pulling link 2576 and for thus rotating the print control key 2488 to the "no print" position. Deletion of "print" and "no print" codes and operation of the solenoids 2575 and 2577 will be described later in connection with deletion of these function codes.

Whenever the print control key 2488 is shifted from the "no print" position of FIG. 156 to the "print" position of FIG. 155, the blade 2568 is shifted to engage the contact 2571 (FIG. 156) and the conductor strip 2570, and to thereby provide a ground as indicated in FIG. 158 for the "print" shifting of the print control mechanism and the encoding sequence as follows.

The initial "print" shift circuit will be described first. A source of power (S) is connected to a brush 2578, which is part of a switch that also includes a brush 2579 and a brush 2580. Brushes 2578–2580 (FIG. 30) are secured on a support insulator 2581, which is secured on the plate 416, like the corresponding arrangements in FIGS. 28 and 29 above. The brushes 2578–2580 (FIGS. 30 and 158) cooperate with contacts on a disk 2582, which is like the disks 423 and 2512 described in connection with FIGS. 28 and 29 above. Therefore, at this point, it should suffice to point out that the brushes 2578 and 2580 (FIGS. 30 and 158) are conductively connected by contacts on disk 2582 and thus they are effective only when the disk 2582 is in the illustrated counterclockwise "print" (normal) position, and similarly the brushes 2578 and 2579 are effective only when the disk 2582 is shifted clockwise in its "no print" position.

The brush 2579, which is effective when the disk 2582 is in its clockwise "no print" position as explained, is connected by a wire 2583 (FIG. 158) to a "print" shift motivating solenoid 492 (FIG. 34). "print" shift motivating solenoid 2584 (FIG. 158) is connected by a wire 2585 to the contact 2571. When the disk 2582 is in the clockwise "no print" position and the brushes 2578 and 2579 are effective as described and when the print control key 2488 is then shifted to the illustrated clockwise "print" position, current will travel through effective brushes 2578 and 2579, wire 2583, "print" shift motivating solenoid 2584, wire 2585, contact 2571, blade 2568 and it goes to ground through conductor strip 2570 to complete the circuit for operating "print" shift motivating solenoid 2584.

Operation of "print" shift motivating solenoid 2584 motivates a mechanism just like that in FIG. 34 described previously. Thus, the solenoid pulls a link 2586 (FIG. 158), rotates a member 2587 clockwise about rod 422 for operating a snap switch arrangement preparatory to snapping the disk 2582 counterclockwise to the illustrated "print" position and ultimately it presses an insulator 2588 carried by the member 2587 against a "print" encoding switch 2589 for closing the switch. Switch 2589 is just like switch 2519 (FIG. 157) described previously in connection with 37 regular" encoding.

The "print" encoding circuits are rendered effective by closure of "print" encoding switch 2589 (FIG. 158) and they will now be described. A wire 2590 is connected between the wire 539 and a disk liberating solenoid 2591, which is provided for freeing the disk 2582 to the influence of the snap switch that is motivated by "print" shift motivating solenoid 2584. A wire 2592 is connected to disk liberating solenoid 2591 and to a blade 2593 of the "print" encoding switch 2589. Three blades 2594, 2595 and 2596 of the "print" encoding switch 2589 have wires 2597, 2598 and 2599, respectively, connected to them. The wire 2597 is also connected to a brush 2600, which is in contact with a brush 2601 only when the disk 2582 is in clockwise "no print" position. The brush 2601 is in contact with a brush 2602 only when the disk 2582 is in the illustrated counterclockwise "print" position. A wire 2603 is connected between brush 2601 and the 4 code channel punch wire. The wire 2598 is connected between blade 2595 and a brush 2604. Brush 2604 is in contact with a brush 2605 only when the disk 2582 is in its clockwise "no print" position. A brush 2606 is in contact with the brush 2605 only when disk 2482 is in the illustrated counterclockwise "print" position. A wire 2607 is connected between brush 2605 and the 5 code channel punch wire. The wire 2599 is connected between the blade 2596 and a brush 2608, which is in contact with a brush 2609 only when the disk 2582 is in contact with a brush 2609 only when the disk 2582 is in clockwise "no print" position. A wire 2610 is connected between brush 2609 and the 7 code channel punch wire. The brushes 2600–2602 and brushes 2604–2606 are respectively secured on insulators 2611 and 2612 (FIG. 30), which in turn are secured on plate 416, just like insulators 532 and 482 (FIG. 28) described previously. The brushes 2608 and 2609 (FIG. 158), together with a pair of brushes 2613 and 2614 that are effective only when the disk 2582 is in the illustrated counterclockwise "print" position as will be described, are mounted on an insulator 2615 (FIG. 30) and the insulator is secured on plate 416, like insulator 537 (FIG. 28).

When the "print" shift motivating solenoid 2584 (FIG. 158) completes its operation and closes "print" encoding switch 2589, preparatory to the shifting of disk 2582 from its clockwise "no print" position, current flows from source of power (S) through wires 137, 139, 538 and 2590, and it operates the disk liberating solenoid 2591. Operation of disk liberating solenoid 2591 will be explained presently in greater detail. However, the encoding circuit continues through the disk liberating solenoid 2591, wire 2592 and the blade 2593 of the now closed "print" encoding switch 2589. At this point, the encoding circuit splits into three distinct parallel code channel punch circuits, particularly for punching the print code 4,5,7. The 4 code channel circuit passes through blades 2593 and 2594, wire 2597, effective brushes 2600 and 2601, wire 2603, the 4 code channel punch wire, and the corresponding 4 solenoid in the main punch mechanism 161. The 5 code channel circuit passes through blades 2593 and 2595, wire 2598, in contact brushes 2604 and 2605, wire 2607, the 5 code channel punch wire, and the corresponding 5 solenoid in the main punch mechanism 161. The 7 code channel circuit passes through blades 2593 and 2596, wire 2599, brushes 2608 and 2609 that remain in contact as described while the disk 2582 is momentarily detained in clockwise "no print" position, it continues through the wire 2610, the 7 code channel punch wire, and the corresponding 7 solenoid in main punch mechanism 161 as described.

The disk liberating solenoid 2591 and a detent 2616 correspond to the arrangement described for upper-lower case and exemplified by solenoid 527 (FIG. 33) and the time-delay detent 517. The solenoid 2591 (FIG. 158) operates to render the detent 2616 ineffective for detaining the disk 2582, in this instance in clockwise "no print" position. Whereupon, the disk 2582 is free to rotate couterclockwise, to the illustrated position, under the influence of the snap switch arragement operated by "print" shift motivating solenoid 2584. When this occurs, the brush 2579 is rendered ineffective and the "print" shift motivating solenoid 2584 is thereby deenergized to permit "print" encoding switch 2589 to open, and also the brushes 2600, 2604, 2608 and 2609 are rendered ineffective and the operated main punch solenoids 565 are thereby deenergized. At this point, the print control key 2488 stands in print position, the "print" encoding switch 2589 stands open, the disk 2582 is shifted counterclockwise in "print" position, all as shown, and the print code (4,5,7) is encoded.

Whenever the print control key 2488 is shifted from the illustrated "print" position to the "no print" position, the conductor 2568 is shifted to engage the cntact 2569 as well as the conductor strip 2570 to provide a ground for the "no print" shifting and encoding sequence as follows.

The "no print" shift circuit will now be described. The brush 2580, which is effective when the disk 2582 is in the illustrated counterclockwise "print" position as explained, is connected by a wire 2617 to a "no print" shift motivating solenoid 2618, which is identical to the previously described solenoid 488 (FIG. 34). "No print" shift motivating solenoid 2618 (FIG. 158) is connected by a wire 2619 to the contact 2569. When the disk 2582 is in the counterclockwise "print" position and the brushes 2578 and 2580 are effective as described and when the print control key 2488 is then shifted to the counterclockwise "no print" position, current will travel through effective brushes 2578 and 2580, wire 2617, "no print" shift motivating solenoid 2618, wire 2619, contact 2569, conductor 2568 and it goes through strip 2570 to complete the circuit for operating "no print" shift motivating solenoid 2618.

Opertion of "no print" shift motivating solenoid 2618 motivates a mechanism just like that in FIG. 34. Thus, the solenoid pulls a link 2620 (FIG. 158), rotates a member 2621 counterclockwise about rod 422 for operating a snap switch arrangement preparatory to snapping the disk 2582 clockwise to "no print" position and ultimately presses an insulator 2622 carried by the member 2621 against a "no print" encoding switch 2623 for closing switch.

The "no" print" encoding circuits are rendered effective by closure of "no print" encoding switch 2623 and they will now be described. A wire 2624 is connected to the wire 2592 and to a blade 2625 of the "no print" encoding switch 2623. The other three blades 2626, 2627 and 2628 of the "no print" encoding switch 2623 have wires 2629, 2630 and 2631, respectively, connected to them. The wire 2629 is also connected to the brush 2602, which is in contact with the brush 2601 only when the disk 2582 is in the illustrated "print" position as described. The wire 2630 is connected between blade 2627 and the brush 2606, which is in contact with the brush 2605 only when the disk 2582 is in the illustrated "print" position as described. The wire 2631 is connected between the blade 2628 and the brush 2613, which is in contact with the brush 2614 only when the disk 2582 is in the illustrated "print" position as described. A wire 2632 is connected between the brush 2614 and the 6 code channel punch wire.

When the "no print" shift motivating solenoid 2618 completes its operation and closes "no print" encoding switch 2623, preparatory to the shifting of disk 2582 from its illustrated counterclockwise "print" position as described, current flows from source of power (S) through wires 137, 139, 538, 539 and 2590, disk liberating solenoid 2591, wire 2592, the wire 2624, and the now closed "no print" encoding switch 2623. At this point, the encoding circuit splits into three distinct parallel code channel punch circuits in this instance particularly for punching the "no print" code 4,5,6. The 4 code channel circuit passes through blades 2625 and 2626, wire 2629, brushes 2602 and 2601, wire 2603, the 4 code channel punch wire and the corresponding 4 channel solenoid in the main punch mechanism 161. The 5 code channel circuit passes through blades 2625 and 2627, wire 2630, effective brushes 2606 and 2605, wire 2607, the 5 code channel punch wire and the corresponding 5 channel solenoid in the main punch mechanism 161. The 6 code channel circuit passes through blades 2625 and 2628, wire 2631, brushes 2613 and 2614 that remain effective as described while the disk 2582 is momentarily detained in the counterclockwise "print" position, and it continues through wire 2632, the 6 code channel punch wire and the corresponding 6 channel solenoid in main punch mechanism 161 as described. By these circuits, the "no print" code 4,5,6 is punched, and the disk liberating solenoid 2591 is operated at the same time. Operation of the disk liberating solenoid 2591 disengages the time-delay detent 2616 and permits the disk 2582 to rotate clockwise to "no print" position under the influence of the snap switch arrangement operated by "no print" shift motivating solenoid 2618. When this occurs and the disk 2582 snaps clockwise to the "no print" position, the brush 2580 is rendered ineffective and the "no print" shift motivating solenoid 2618 is thereby deenergized to permit the "no print" encoding 2623 to open, and also the brushes 2602, 2606, 2613 and 2614 are disconnected and the operated main punch solenoids 565 are thereby deenergized. At this point, the "print" control key 2488 stands in "no print" position, the "no print" encoding switch 2623 is reopened, the disk 2582 is shifted clockwise in "no print" position, and the "no print" code 4,5,6 has been encoded.

Deletion of bold and regular, and print and no print codes together with reverse operations of the related keys 2487, 2488 and mechanism (154 and 155), will be described later, along with deletion of other function codes yet to be described.

33. CLEAR KEY AND ITS FUNCTIONS

A clear key 2633 (FIGS. 3 and 159) is provided as a means for immediately preparing the composing machine for normal operation, i.e. lower case, print, regular and punch condition, and at the same time, as a means for causing punching of the clear code 3,4,6,7 which will control the reproducer 2279 to assume the normal condition. If the clear key 2633 is operated when a piece of work is begun, the operator can be assured that the reproducer 2279 will assume the corresponding condition and will reproduce the text properly instead of possibly beginning in the wrong case, in no print instead of print, bold instead or regular, etc. The operator should not operate the clear key 2633 when the punch control key 602 (FIG. 3) is in no punch position and the machine has been operated for a portion of a line, since, if both of these conditions exist, the no-punch portion of the line would not be reproduced and the rest of the line would be quad-left. However, the clear key 2633 may be properly used at any time the carriage is fully returned or the punch control key 602 has been in punch position, during the prepared composition of the line.

The clear key 2633 (FIG. 159) is pivoted on a rod 2634 which is secured at its ends in a known manner on plate 608 (FIG. 44) and on another vertical plate 2635 which is secured on the bottom plate 607 and on the channel member 624 in a known manner. A torsion spring 2636 (FIG. 159) is connected to clear key 2633 and to a contact support plate 2637, which is secured in a known manner at its ends on plates 608 and 2635 (FIG. 44), for urging the clear key 2633 clockwise (FIG. 159) to the illustrated normal position. The remote forward end of the clear key 2633 extends through a guidance slot (not shown here) in the channel member 624, and the ends of the slot limit the clockwise and counterclockwise operation of the clear key 2633 in a known manner.

A stud 2638 is secured on clear key 2633 and it cooperates with a pawl 2639 to hold the clear key in operated position during clearing operations as will be described. Pawl 2639 is pivoted on a rod 2640 which is secured on plates 608 and 2635 (FIG. 44). A torsion spring 2641 (FIG. 159) is connected to pawl 2639 and to plate 2637 for urging the pawl clockwise against stud 2638. A solenoid 2642 is provided for automatically releasing clear key 2633 at the end of the clearing sequences as will be described. Solenoid 2642 is secured on bottom plate 607 and a link 2643 is pivotally connected to the armature of the solenoid and to the pawl 2639. A pair of insulators 2644 and 2645 are secured on opposite sides of the clear key 2633, and each insulator carries a trifurcated brush 2646 and 2647, respectively. Brushes 2646 and 2647 respectively press rightwardly and leftwardly against opposing insulators 2648 and 2649 (FIG. 44) which are situated vertically and which are secured on a U-shaped bracket 2650. Bracket 2650 is secured at its center portion on the plate 2637. In the normal position of the parts, the brush 2646 (FIG. 159) engages one pair of contacts 2651 and 2652, that are secured on the insulator 2648 for conducting current between the contacts while the brush 2647 engages another pair of contacts 2653 and 2654 on its respective insulator 2649. Upon counterclockwise operation of the clear key 2633, the brush 2646 is disengaged from contacts 2651 and 2652 and the brush 2647 is disengaged from contacts 2653 and 2654, and then the brushes 2646 and 2647 are respectively engaged with contacts 2555–2657 and 2568–2660. The contacts 2655, 2656 and 2657 are secured on the insulator 2648 and contacts 2658, 2659 and 2660 are secured on insulator 2649, in a customary manner.

A solenoid 2661 is provided for at times operating the clear key 2633 automatically, as in a sequence following "line delete" operations, in a manner to be described later. Solenoid 2661 is secured on bottom plate 607 in any convenient manner, and a lin 2662 is pivotally connected to the armature of the solenoid 2661 and to a depending arm of the clear key 2633.

The arrangement is such that upon operation of automatic means including solenoid 2661, or upon manual operation of clear key 2633, the key rotates counterclockwise about rod 2634 against tension of spring 2636. During such operation of the clear key 2633, the brushes 2646 and 2647 are shifted as described above, and, at about the time the key 2633 reaches operated position, the pawl 2639 latches on to stud 2638. At completion of clearing operations, the clear key releasing solenoid 2642 is energized as will be described for pulling link 2643 and rotating pawl 2639 against tension spring 2641. When pawl 2639 releases stud 2638, the spring 2636 restores the clear key 2633 to the illustrated normal position.

The circuitry for clearing the machine and for punching the clear code upon operation of the clear key 2633 (FIG. 161), will now be described.

The circuit is derived from a power soruce (S) through the normally closed switch 1213 in the back space tape cycling mechanism 1159. The circuit continues through the wire 1295, solenoid 1296, wire 1307, solenoid 1308, and wire 1309, the same as for restoring the machine to lower case condition upon deletion of an upper case code as previously described.

The clearing operation continues through a wire 2663 connected between the wire 1309 and a soleniod 2664. Solenoid 2664 (FIG. 44) is provided for restoring the keys 602, 2487 and 2488 to normal position as will be described. A wire 2665 (FIG. 161) is connected between key restoring solenoid 2664 and a solenoid 2666 provided for clearing the case shift snap switch as will be described. A wire 2667 is connected to solenoid 2666 and to a solenoid 2668 provided for clearing the bold-regular snap switch means as will be described. A wire 2669 is connected between the solenoid 2668 and a solenoid 2670 provided for clearing the print control snap switch means as will be described. A wire 2671 is connected to solenoid 2670 and to the contact 2655. A wire 2672 is connected to wire 2671 and to the contact 2658 under the clear key 2633. The contacts 2655 and 2658 could just as well be one contact with a brush that would contact it and the four contacts 2656, 2657, 2659 and 2660, when the clear key 2633 were operated, but the described, preferred form is used to reduce the linear arrangement of the contacts and brushes. Four wires 2673–2576 (FIG. 162) are individually connected to the contacts 2656, 2657 and 2659, 2660 (FIG. 161) and the other ends of these wires are connected as shown in FIG. 162 to the code channel punch wires 3,4,6,7 which correspond to the clear code as described.

The mechanisms operated by solenoids 2664 (FIG. 161), 2666, 2668 and 2670 will now be described.

The key restoring solenoid 2664 (FIGS. 42–44) is secured on the plate 605, in a known manner. A link 2677 (FIG. 429 is pivotally connected to the armature of key restoring solenoid 2664 and to a bail member 2678 which is secured on the pivoted shaft 604. Another bail member 2679 (FIG. 154) is also secured on pivoted shaft 604, and a bail rod 2680 (FIG. 44) is secured on members 2678 and 2679 so as to be unitarily operable with the members and the pivoted shaft 604 about the axis of the pivoted shaft. The bail rod 2680 is extended leftward of member 2678, in a known manner, so it is in alignment for at times operating the punch control key 602. The rod 2680 may also at times affect the keys 2487 and 2488, which are located between the members 2678 and 2679 as shown. A torsion spring 2681 is connected to the member 2679 and to plate 606 for urging the unit including bail rod 2680 counterclockwise (FIG. 154) to the illustrated normal position of the parts where a portion 2682 (FIG. 42) of member 2678 rests on a flange of channel member 624. Upon operation of key restoring solenoid 2664, it pulls link 2677 and rotates the unit including rod 2680 clockwise for moving or otherwise assuring that the punch control key 602 is in "ON" position, that the "BOLD-REGULAR" shift key 2487 (FIG. 154) is in "regular" position and that the print control key 2488 (FIG. 155) is in the "PRINT" position, and these keys are then held in their normal postion by the previously described yieldable detents.

Upon deenergization of key restoring solenoid 2664 (FIG. 42), the torsion spring 2681 (FIG. 154) restores the arrangement including bail rod 2680 counterclockwise to the illustrated normal position, where the punch control key 602 (FIG. 44), the bold and regular shift key 2487 and the print key 2488 may be manipulated, as described, without interference with the rod 2680.

The solenoid 2666 for clearing the case shift snap switch (FIG. 34) and the clearing means operated thereby in the upper, lower case snap switch mechanism 159 are identical to the solenoid 2668 and 2670 (FIG. 161) and their respective clearing means in the bold-regular and print control snap switch mechanisms, so a description of one should serve to describe the others. The solenoid 2666 (FIG. 34) is secured on plate 417, and a link 2683 is pivotally connected to the armature of solenoid 2666 and on a bail type rod 2684. Rod 2684 is secured on parallel members 2685 and 2686 (FIG. 31) which are secured on a common hub 2687. The hub 2687 is pivoted on the rod 518. A link 2688 (FIG. 34) is pivotally connected to member 2686 and to the upper end of the member 506, which is pivoted on rod 415 as previously described. A torsion spring 2689 is connected to member 2686 and to plate 417 for urging the unit comprising the members 2686 and 2685, counterclockwise and therefore urging the link 2688 and member 506 to normal position where member 506 is stopped against the stop stud 507.

An insulator 2690 is secured on member 2685 in alignment with a normally open switch 2691 for closing the switch upon operation of the unit including member 2685. The switch 2691 is secured on plate 417.

An extension 2692 (FIG. 31) of bail type rod 2684 projects through a clearance hole 2693 (FIG. 34) in plate 417 sufficiently to overlie the rightwardly extending arm of the time delay detent 517 (FIG. 33), as shown in FIG. 31, for operating the detent during the clearing operation. The clearance hole 2693 (FIG. 34) is large enough to permit free clockwise and return swing of the bail type rod 2684 and its extension 2692 (FIG. 31).

Upon operation of solenoid 2666 for clearing the case shift snap switch (FIG. 34), it pulls link 2683, rotates the unit including bail type 2684, members 2685 and 2686 and insulator 2690 clockwise, it pulls link 2688, and rotates the member 506 clockwise. During this operation, the extension 2692 (FIG. 31) is swung down on time delay detent 517, and the surface 508 (FIG. 34) of member 506 pushes the snap switch stud 500 clockwise, that is, it pushes the stud unless the stud is already in clockwise normal position. At the end of the operation, the extension 2692 (FIG. 33) will have rotated the time delay detent 517 clockwise clear of the stud 503 to permit rotation of the disk 423 (FIG. 28) counterclockwise to normal lower case position as described, and the member 506 (FIG. 34) will have assured that the pin 500, member 501 and incidentally the members 496 and 497, are in the illustrated normal, lower-case position against stop stud 505, as described. Also, the spring 502 will have shifted the disk 423 (FIG. 28), or held the disk, as the case may be, in the normal position. At about the end of the operation, the insulator 2690 (FIG. 34) closes normally open switch 2691 to signal completion of the operation, as will be described.

From the above, it can be seen that very rapid operation of solenoid 2666 for clearing the case shaft snap switch may cause the stud 500 to be shifted clockwise with such force that the momentum of member 497 shifted therewith, might overcome the tension of spring 499 and close the switch 515 which would cause unwarranted punching of the lower case code. Therefore, in machines having the "Clearing" feature, the circuit through the switch 515 (FIG. 35) will be rendered ineffective upon operation of the clear key 2633, as will now be described. Thus, in this alternative form of the machine, the wire 539 (FIG. 35) will not run directly to the solenoid 527, as previously described, but rather to the contact 2651 (FIG. 161) and a wire 2694 will be connected to the contact 2652 and to the solenoid 527 (FIG. 35) and thus the circuit through the switch 515 is rendered ineffective when the clear key 2633 (FIG. 161) is operated and the contacts 2651 and 2652 are open. Likewise, in order to prevent unwarranted punching circuits from passing through switches 2519 (FIG. 157) and 2589 (FIG. 158) during clearing operations, the wires 2520 (FIG. 157) and the wire 2590 (FIG. 158) will be connected to the wire 2694 (FIG. 161).

Similarly, in machines having the clearing feature, in order to prevent unwarranted operation of solenoids 492 (FIG. 35), 2514 (FIG. 157) and 2584 (FIG. 158), the source "S" at brush 481 (FIG. 35), for temporarily rendering the circuit for solenoid 492 ineffective, the source (S) at brush 2508 (FIG. 157), for regular shift motivating solenoid 2514 and the source "S" at brush 2578 (FIG. 158) for "print" shift motivating solenoid 2584 are all derived through the contacts 2654 and 2653 (FIG. 161) which are effective only when the clear key 2633 (FIG. 159) is not operated as described. Thus, the solenoids 492 (FIG. 35), 2514 (FIG. 157) and 2584 (FIG. 158) are not operable during clearing operations.

From the above, it can be seen that manual or automatic operation of the clear key 2633 (FIG. 161) effectuates clearing of the composing machine and punching of the clear code for corresponding control of the reproducer, by the circuit as follows. The circuit travels from Source ("S") through normally closed switch 1213, wire 1295, the solenoid 1296 for permitting restoration of the case shift key 17, 18 to normal position, as will be described later, wire 1307, solenoid 1308 for releasing the shift key lock 22 for possible return to lower case, wires 1309 and 2663, the solenoid 2664 for restoring the punch key 602 (FIG. 44) to normal punch on position, for restoring the print control key 2488 to normal print position and bold-regular shift key 2487 to regular position, through wire 2665 (FIG. 161), solenoid 2666 for restoring the case shift snap switch arrangement to lower case, through wire 2667, solenoid 2668 for restoring the bold and regular snap switch arrangement to regular, through wire 2669, solenoid 2670 for restoring the print control snap switch arrangement to normal print condition, and via the wires 2671 and 2672 to the contacts 2655 and 2658 under the operated clear key 2633. Upon depression of the clear key 2633 as described, the contacts 2655 and 2658 are connected with contacts 2656, 2657 and 2659, 2660, respectively, and thus the circuit divides into parallel circuits through the wires 2673—2676 (FIG. 162), the code channel punch wires 3,4,6,7 and the corresponding solenoids in the main punch mechanism 161 for punching the clear code. At this point, the parallel circuits merge as described into the wire 162 (FIG. 11), and the circuit continues through switch 669, wire 163, switch 164, wire 165, line tape feed control 166, wire 167 and goes to ground through solenoid 168 for operating the solenoid and preparing for forward feeding of the control tape 577 through the main punches 567, the same as for other normal main punch operations as described.

Upon full operation of the solenoids 2664 (FIG. 161), 2666, 2668, and 2670, the clear key 2633 is released for terminating the clearing operation. The circuit for releasing the clear key originates at a source ("S") connected to the solenoid 2642. A wire 2695 is connected to solenoid 2642 and to a contact 2696 (FIG. 42). A contact 2697 is connected by a wire 2698 (FIG. 161) to the switch 2691 (FIG. 34) in the case shift snap switch arrangment. A wire 2699 (FIG. 161) connects the switch 2691 to an identical switch 2700 in the bold-regular snap switch arrangement. A wire 2701 is connected to switch 2700 and to a switch 2702 in the print-no print snap switch arrangement. The switch 2702 is also identical to the switch 2691.

Te contacts 2696 and 2697 (FIG. 42) are secured on an insulator 2703 (FIG. 43) and the insulator is secured on a bracket 2704 which in turn is secured on the plate 605. An insulator 2705 (FIG. 429 is secured on member 2678. A bifurcated brush 2706 is secured on insulator 2705 and the free end of the brush is pressed against the surface of insulator 2703. Upon operation of key restoring solenoid 2664, member 2678, rod 2680, etc. for clearing the keys 602, 2487 and 2488 (FIG. 44) as described, the brush 2706 (FIG. 42) is shifted clockwise so as to engage the contacts 2696 and 2697 at the end of the clearing stroke. Thus, at the end of this clearing stroke, when the contacts 2696 and 2697 are engaged by brush 2706, and when the solenoids 2666, 2668 and 2670 (FIG. 161) are fully operated and have closed the respective switches 2691, 2700 and 2702, as described, the circuit for operating the solenoid 2642 is complete. This circuit travels through solenoid 2642, wire 2695, now effective contacts 2696 and 2697 (FIG. 42) and wire 2698 (FIG. 161), switch 2691, wire 2699, switch 2700, wire 2701 and the current goes to ground as indicated through switch 2702. When solenoid 2642 is thus operated, the clear key 2633 (FIG. 159) is released as described for return by spring 2636. It can be seen that return of the clear key 2633 (FIG. 161) and breaking of contacts thereunder deenergizes the circuit including solenoids 1296, 1308, 2664, 2666, 2668, 2670, the solenoids in the main punch mechanism 161 (FIG. 162) and the solenoid 168 (FIG. 11) in the forward tape cycle control 169, and the respective mechanisms are returned by their means as described. It can also be seen that, upon restoration of solenoids 2664, 2666, 2668 and 2670 (FIG. 161) and their respective switches, the circuit through solenoid 2642 is deenergized.

34. CONDITION ENCODING AND KEY THEREFOR

This arrangement is provided for encoding the immediate condition (upper or lower case, bold or regular, and print or no print) of the composing machine upon manual operation of a condition key 2707 (FIGS. 3 and 160). The condition encoding arrangement does not alter the condition of the composing machine, but it does control the main punches 567 to punch a code that represents the condition of the composing machine, and the code controls the reproducer 2279 to assume the corresponding condition when the main reader senses the code.

The condition key 2707 may be used instead of the clear key 2633 (FIG. 3) previously described, when a piece of work is begun, to assure proper coordination between the succeeding encoded text and the condition of the reproducer 2279. Since the condition encoding arrangement does not alter the set up of the composing machine, the arrangement may be utilized at any time, but it or the clear key 2633 should be used to begin a piece of work whenever there is a possibility that the tape 577 for the work may be separated from the other tape and stored for future reuse.

The condition key 2707 (FIG. 160) is pivoted on the rod 2634 and a torsion spring 2708 is connected to the condition key and to the plate 2637 for urging the condition key to the illustrated normal position. an insulator 2709 is secured on condition key 2707 and a brush 2710 is secured on the insulator 2709. Brush 2710 is tensioned against an insulator 2711 which is secured on an angle bracket 2712 that is secured on plate 2637. Upon depression of condition key 2707, it rotates counterclockwise against tension of spring 2708 and the brush 2710 conductively engages a pair of contacts 2713 and 2714 that are secured on insulator 2711. A stud 2715 is secured to condition key 2707 and it is latchable by a pawl 2716 for temporarily holding the key in operated position. Pawl 2716 is pivoted on the rod 2640 and a torsion spring 2717 connected to the pawl and plate 2637 urges the pawl clockwise against the stud 2715.

Late in condition encoding operations, as will be described, a solenoid 2718 is energized for releasing the condition key 2707. Solenoid 2718 is secured on the plate 607 and a link 2719 is pivotally connected to the armature of the solenoid and to the pawl 2716. Upon operation of solenoid 2718, it pulls link 2719 and rotates pawl 2716 against tension of spring 2717 for releasing the stud 2716. Whereupon, the spring 2708 restores the condition key 2707 and breaks a circuit between contacts 2713 and 2714.

The condition key 2707 extends forward (left as shown) through a slot (not shown) in the channel member 624 which guides the forward end of the condition key 2707 and which limits the key's travel in operated and restored positions, in a customary manner.

Circuitry for determining the existing condition of the machine will now be described.

A power source (S) is connected to contact 2713 (FIG. 162) under the condition key 2707. A wire 2720 is connected between the contact 2714 and a brush 2721 (FIG. 28) in the upper-lower case snap switch arrangement previously described. Brush 2721 is secured on an insulator 2722 which is secured on the plate 416 in the same manner as the insulators 433, 435 and 482 previously described. A brush 2723 is in contact with the brush 2721, by contacts on the disk 423 as explained, when the disk is in the illustrated counterclockwise normal lower case position, and alternatively a brush 2724 is in contact with brush 2721 when the disk 423 is in its clockwise upper case position. Brushes 2723 and 2724 are also secured on insulator 2722. Wires 2725 and 2726 (FIG. 162) are respectively connected to the brushes 2723 and 2724 (FIG. 28) and respectively to brushes 2727 and 2728 (FIG. 29) in the bold-regular snap switch arrangement previously described. A brush 2729 is in contact with brush 2727, when the disk 2512 is in its illustrated counterclockwise normal "regular face" position, and in turn a brush 2730 is in contact with brush 2727 when the disk 2512 is shifted in "bold face" position. The brush 2728 is effective with a brush 2731 when the disk 2512 is in counterclockwise position, and in turn a brush 2732 is effective with brush 2728 when the disk 2512 is in clockwise position. The brushes 2727, 2729 and 2730 are secured on an insulator 2733 and the brushes 2728, 2731 and 2732 are secured on an insulator 2734, and the insulators 2733 and 2734 are secured on the frame plate 416 like the other similar insulators in the mechanism.

A pair of wires 2735 and 2736 (FIG. 162) are respectively connected to the brushes 2729 and 2730 (FIG. 29) and also respectively to brushes 2737 and 2738 (FIG.

30) in the print, no-print snap switch arrangement. Another pair of wires 2739 and 2740 (FIG. 162) are respectively connected to the brushes 2731 and 2732 (FIG. 29), and the other ends of these wires are respectively connected to brushes 2741 and 2742 (FIG. 30).

Like the previously described brushes and contacts in the arrangement, the brush 2737 is effective with a brush 2743 when the disk 2582 is in the illustrated counterclockwise normal print position, but the brush 2737 is only effective with a brush 2744 when the disk 2582 is shifted in clockwise no-print position. The brush 2738 is normally effective with a brush 2745, but it is effective only with a brush 2746 when the disk 2582 is shifted clockwise Brush 2741 is normally effective with a brush 2747, but it is only effective with a brush 2748 when the disk 2582 is shifted clockwise. Bursh 2742 is normally in contact with a brush 2749, but it is only in contact with a brush 2750 when the disk 2582 is shifted clockwise.

The brushes 2737, 2743 and 2744 are secured on an insulator 2751, brushes 2738, 2745 and 2746 are secured on an insulator 2752, brushes 2741, 2747 and 2748 are secured on an insulator 2753, and brushes 2742, 2749 and 2750 are secured on an insulator 2754, and the insulators are secured on frame plate 416 as the other similar insulators in this arrangement.

A wire 2755 (FIG. 162) is secured to brush 2743 (FIG. 30) and to a solenoid 2756 (FIG. 162) in a condition encoding mechanism 2757. The solenoid 2756 is marked "L.R.P." which represents lower case, regular face and print conditions of the machine, and solenoid 2756 will be utilized to encode these represented conditions as will be described presently. A wire 2758 is connected to the brush 2747 (FIG. 30) and to a solenoid 2759 (FIG. 162) in the condition encoding mechanism 2757. The solenoid 2759 is marked "U.R.P.", which represents upper case, regular face and print conditions. A wire 2760 is connected to brush 2745 (FIG. 30) and to a solenoid 2761 (FIG. 162) in mechanism 2757. Solenoid 2761 is marked "L.B.P." to represent lower case, bold face and print conditions. A wire 2762 is connected to brush 2749 (FIG. 30) and to a solenoid 2763 (FIG. 162) in condition encoding mechanism 2757. Solenoid 2763 is marked "U.B.P." to represent upper case, bold face, and print conditions. A wire 2764 is connected to brush 2744 (FIG. 30) and to a solenoid 2765 (FIG. 162) in the condition encoding mechanism 2757. Solenoid 2765 is marked "L.R.N." to represent lower case, regular face and no print conditions. A wire 2766 is connected to brush 2748 (FIG. 30) and to a solenoid 2767 (FIG. 162) in the condition encoding mechanism 2757. Solenoid 2767 is marked "U.R.N." to represent upper case, regular face, and no print. A wire 2768 is connected to brush 2746 (FIG. 30) and to a solenoid 2769 (FIG. 162). Solenoid 2759 is marked "L.B.N." to represent lower case, bold face and no print. Finally, a wire 2770 is connected to brush 2750 (FIG. 30) and to a solenoid 2771 (FIG. 162). Solenoid 2771 is marked "U.B.N." to represent upper case, bold face, and no print.

From the above, it can be seen that the circuit originating upon depression of the condition key 2707 and passing through wire 2720 is directed through binary type switch system in the upper-lower case, the bold-regular and print-no print switch arrangements and the current is fed to the one of the solenoids 2756, 2759, 2761, 2763, 2765, 2767, 2769 and 2771 that corresponds to the instant condition of the machine. The operated one of the just listed solenoids in the condition encoding mechanism 2757 will cause the condition encoding mechanism to control the main punch mechanism 161 to encode the condition of the machine as will be described presently.

The circuit that may be directed through the solenoids 2763 or 2771 will continue via wire 2772 that is connected to these solenoids and to a wire 2773. Similarly, a wire 2774 is connected to solenoids 2759 and 2767 and to the wire 2773. A wire 2775 is connected to the solenoids 2756 and 2765, and to the wire 2773. A wire 2776 is connected to solenoids 2761 and 2769 and to the wire 2773. The wire 2773 is also connected to a solenoid 2777 which is operable for causing punching of code channels 1 and 7 that are included in all the condition codes. The other solenoids in the condition encoding mechanism 2757 are operated for controlling punching of the various channels that distinguish among the condition codes as will be described.

The structure of the condition encoding mechanism 2757 will now be described. Condition encoding mechanism 2757 is supported primarily on two plates 2778 and 2779 (FIG. 163) and the two plates are secured together and spaced as shown by three or more spacer studs 2780 (FIG. 164 and 165). The rearward plate 2779 (FIG. 45) is supported on the inverted T-member 2 of the main frame 1, and the forward plate 2778 (FIG. 2) is secured on plate 238 by any known means.

The solenoids 2763 (FIG. 162), 2771, 2759, 2767 and 2777 are secured on rearward plate 2779 (FIG. 164) and solenoids 2756 (FIG. 162), 2765, 2761 and 2769 are secured on forward plate 2778 (FIG. 165). In this condition encoding mechanism 2757, the structure of all of the solenoids and switches operated individually thereby are identical and a description of one solenoid and its switch should serve to describe the others. Accordingly, the solenoid 2777 (FIG. 164) and a switch 2781, operable thereby, are exemplary and they will now be described in detail.

A discoidal insulator 2782 is secured on the end of the armature of solenoid 2777, and the insulator and armature are stopped against a stud 2783 in operated position. Upon deenergization of solenoid 2777 a spring blade 2784 of switch 2781 pushes the discoidal insulator 2782 and the armature into the extended position whereby the insulator is stopped in normal position against a return stop 2785 which is secured on rearward plate 2779. Stop stud 2783 is also secured on plate 2779. Upon operation of solenoid 2777, its armature and discoidal insulator 2782 are operated against tension of blade 2784 and the blade is shifted against two other blades 2786 and 2787 of the normally open switch 2781 for closing the switch prior to the stopping of insulator 2782 by stop stud 2783. As will be explained further, closure of switch 2781 causes punching of code channels 1 and 7 which are common to all the conditioning codes, and the switch 2781 will be closed at the same time as another one of the switches shown in FIGS. 164 and 165 to complete the punching of a significant conditioning code.

By way of example, let us assume now that the machine is in normal condition and accordingly the disk 423 (FIG. 162) is in lower case position, disk 2512 is in regular position and disk 2582 is in print position, and that the condition key 2707 is operated as described. Upon closure of contacts 2713 and 2714 by brush 2710 (FIG. 160), the circuit is complete from source (S) through these contacts under condition key 2707 (FIG. 162) wires 2720, 2725, 2735 and wire 2755 for operating solenoid 2756 which closes a switch 2788.

The circuit continues through solenoid 2756, wires 2775 and 2773 and goes to ground through solenoid 2777 for closing switch 2781. Closure of switch 2788 (FIG. 165), which is like switch 2781 (FIG. 164), causes punching of code channels 3 and 4, and closure of switch 2781 causes punching of code channels 1 and 7 to complete the code 1,3,4,7 that corresponds to the normal condition of the machine.

The circuitry for punching the normal condition code 1,3, 4,7, and releasing the condition key 2707 will now be described.

A source (S) of power is connected to solenoid 2718 (FIG. 162), which is provided for releasing the conditioning key 2707 as described. A wire 2789 is connected to solenoid 2718 and to the common spring blade of the switch 2788. A wire 2790 is connected to one of the other blades in switch 2788 and to a wire 2791 which is connected to the 3 code channel punch wire. A wire 2792 is connected to the remaining blade in switch 2788 and a wire 2793 which is connected to the 4 code channel punch wire. A wire 2794 is connected between the wire 2789 and the common spring blade of switch 2781. A wire 2795 is connected to another one of the blades of the switch 2781 and to a wire 2796 which is connected to the 1 code channel punch wire. A wire 2797 is connected to the remaining blade in switch 2781 and to a wire 2798 which leads to the 7 code channel punch wire. The arrangement is such that, upon operation of solenoids 2756 and 2777 and the resulting closure of the respective switches 2788 and 2781, as described, current flows through solenoid 2718 for releasing the condition key 2707, and it continues through wire 2789, now closed switch 2788, wires 2788, wires 2790 and 2792, wires 2791 and 2793, the corresponding code channel path wires 3 and 4 and the corresponding solenoids in the main punch mechanism 161. At the same time, the current also flows through the wire 2794, now closed switch 2781, wires 2795 and 2797, wires 2796 and 2798, the code channel punch wires 1 and 7, and the corresponding solenoids in the main punch mechanism 161. The circuit continues through the main punch solenoids 1,3,4,7, the wire 162 (FIG. 11), switch 669, wire 163, switch 164, wire 165, line tape feed control mechanism 166, wire 167, and it goes to ground through the solenoid 168 in the forward tape cycling mechanism which controls the forward shifting of the tape 577 upon deenergization of solenoid 168, the same as described for any other normal encoding operations.

From the above, it can be seen that the solenoids 2756 and 2777 (FIG. 162) in the condition encoding mechanism 2757 remain operated while the solenoid 2718 operates to release the condition key 2707, and while the main punches 567 operate to punch, in this instance, the normal condition code 1,3,4,7. Upon full operation of solenoid 2718 (FIG. 160), the pawl 2716 releases the condition key 2707 and the spring 2708 returns the key to break the circuit through the contacts 2713 and 2714, as described.

As the circuit is now broken between contacts 2713 and 2714 (FIG. 162), the solenoids 2756 and 2777 are deenergized for permitting switches 2788 and 2781 to open for deenergizing the solenoid 2718, the operated solenoids in the main punch mechanism 161, and deenergizing the solenoid 168 (FIG. 11), whereupon the tape 577 is fed one step forwardly through main punches 567 as described previously.

Thus, it is seen that the code 1,3,4,7, is punched, when the machine is in normal condition and the condition key 2707 is operated. A different representative condition code is also punched in a similar manner when the machine is in any other condition and the condition key 2707 is operated. A list of the various conditions and the corresponding exemplary condition codes are listed here below in "CHART E" ("CHART E" may also be found among the Charts that follow the Figure Descriptions).

"CHART E"

| CONDITION CODES | |
|---|---|
| (1) Lower case, Regular face and Print, | 1,3,4,7 |
| (2) Upper case, Regular face and Print, | 1,3,6,7 |
| (3) Lower case, Bold face and Print, | 1,3,5,7 |
| (4) Upper case, Bold face and Print, | 1,2,4,7 |
| (5) Lower case, Regular face and No-Print | 1,5,6,7 |
| (6) Upper case, Regular face, and No-Print | 1,2,6,7 |
| (7) Lower case, Bold Face and No-Print | 1,4,6,7 |
| (8) Upper case, Bold Face and No-Print | 1,2,5,7 |

The conditioning circuits, other than those described in detail above for the normal condition, will now be covered briefly.

Assume now that the second condition in "CHART E" exists and the condition key 2707 (FIG. 162) is operated. The circuit through contacts 2713 and 2714 is complete and it continues through wire 2720 the effective brushes and contacts on the now shifted disk 423, wires 2726, 2739, 2758, the solenoid 2759, wires 2774, 2773 and it goes to ground through the solenoid 2777. Operation of solenoid 2759 closes a switch 2799, and operation of solenoid 2777 closes the switch 2781. A wire 2800 is connected between switch 2799 and the wire 2789. A wire 2801 is connected between switch 2799 and the wire 2791. Another wire 2802 is connected switch 2799 and to a wire 2803 that in turn is connected to the 6 code channel punch wire. Upon closure of switches 2781 and 2799, current flows through solenoid 2718 for releasing the condition key 2707, through wire 2789, wire 2794 and switch 2781 for causing the code channel 1 and 7 to be punched as described. At the same time, current flows through the wire 2789, wire 2800, switch 2799 and wires 2801, 2791 and 2802, 2803 for causing the code channels 3 and 6 to be punched in the same manner. Thus, the code 1,3,6,7 is punched for representing the example condition of upper case, regular face and print.

Assume now that the third condition in "CHART E" exists and the key condition 2707 is operated. The circuit through contacts 2713 and 2714 is complete and it continues through wires 2720 and 2725, the effective brushes and contacts on the now shifted disk 2512, wires 2736 and 2760, solenoid 2761, wires 2776 and 2773, and it goes to ground through solenoid 2777. Operation of solenoid 2761 closes a switch 2804, and operation of the solenoid 2777 closes switch 2781. The wire 2789 is connected to switch 2804. A wire 2805 is connected between switch 2804 and the wire 2791, and another wire 2806 is connected between switch 2804 and a wire 2807 that in turn is connected to the 5 code channel punch wire. Upon closure of switches 2781 and 2804, current travels through solenoid 2718 for releasing the condition key 2707, through wire 2789, wire 2794 and switch 2781 for causing the code channels 1 and 7 to be punched as described. At the same time, current travels through the wire 2789, switch 2804 and wires 2805, 2791 and 2806, 2807 for causing the code channels 3 and 5 to be punched in the same manner.

Thus the code 1,3,5,7, is punched for representing the example condition of lower case, bold face and print.

Assume now that the fourth condition in "CHART E" exists and the condition key 2707 is operated. The primary circuit is complete through contacts 2713, 2714, wires 2720, 2726, 2740 and 2762, solenoid 2763, wires 2772 and 2773, and it goes to ground through solenoid 2777. Operation of solenoids 2763 and 2777 close switches 2808 and 2781, respectively. Closure of these switches causes current to flow through solenoid 2718 for releasing condition key 2707, through wire 2780, wire 2794 and switch 2781 for punching code channels 1 and 7 as described. At the same time the current flows through wire 2789, wire 2800, switch 2808, a wire 2809, a wire 2810 and the 2 code channel punch wire and also through switch 2808, a wire 2811 the wire 2793 and the 4 code channel punch wire. Thus, the code 1,2,4,7, is punched for representing the example condition of upper case, bold face and print.

The fifth condition encoding (Chart E) is accomplished as follows.

The primary circuit flows through contacts 2713 and 2714, wires 2720, 2725, 2535 and 2764, solenoid 2765, wires 2775 and 2773, and it goes to ground through solenoid 2777. Solenoid 2765 closes a switch 2812 and solenoid 2777 closes switch 2781, whereupon the secondary circuit becomes effective through solenoid 2718 for releasing condition key 2707, through the wires 2789, 2794 and switch 2781 for punching code channels 1 and 7 and through wire 2789, switch 2812, a wire 2813, wires 2806, 2807 and the 5 code channel punch wire, and also through a wire 2814, wire 2803 and the 6 code channel punch wire. Thus the code 1,5,6,7 is punched for representing the example condition of lower case, Regular face and No print.

The sixth condition encoding (CHART E) is accomplished as follows:

The primary circuit flows through contacts 2713, 2714, wires 2720, 2726, 2739 and 2766, solenoid 2767, wires 2774, 2773, and it goes to ground through solenoid 2777. Solenoid 2767 closes a switch 2815 and solenoid 2777 closes switch 2781. Whereupon, the secondary circuit is established through solenoid 2718, wire 2789, wire 2794, and the switch 2781 for punching the 1 and 7 code channels as described. At the same time, the circuit through wire 2789 continues through wire 2800, switch 2815, a wire 2816, the wire 2809, the wire 2810 and the 2 code channel punch wire and also through switch 2815, a wire 2817, the wire 2802, the wire 2803 and the 6 code channel punch wire. Thus the code 1, 2, 6, 7 is punched for representing the example condition of upper case, regular face and no print.

The seventh condition encoding (CHART E) is accomplished as follows:

The primary circuit flows through contacts 2713, 2714, wires 2720, 2725, 2736 and 2768, solenoid 2769, wires 2776 and 2773, and it goes to ground through solenoid 2777. Solenoid 2769 closes a switch 2818 and solenoid 2777 closes switch 2781. Whereupon, the secondary circuit is established through solenoid 2718, wires 2789 and 2794 and the switch 2781 for punching the 1 and 7 code channels as described. At the same time, the circuit through wire 2789 continues through switch 2818, a wire 2819, the wire 2792, wire 2793 and the 4 code channel punch wire and also through switch 2818, a wire 2820, the wire 2814, wire 2803 and the 6 code channel punch wire. Thus, the code 1, 4, 6, 7 is punched to represent the example condition of lower case, bold face and no print.

Finally, the eighth condition encoding, (CHART E) is accomplished as follows: The primary circuit flows through contacts 2713, 2714, wires 2720, 2726, 2740 and 2770, solenoid 2771, wires 2772 and 2773, and it goes to ground through the solenoid 2777. Solenoid 2771 closes a switch 2821 and solenoid 2777 closes the switch 2781. Whereupon, the secondary circuit is effectuated through wires 2789, continues through solenoid 2718, wires 2789 and 2794 and switch 2781 for punching the 1 and 7 code channels as described. At the same time, the circuit through the wire 2800, switch 2821, a wire 2822, the wire 2809, wire 2810 and the 2 code channel punch wire and also through switch 2821, a wire 2823, the wire 2807 and the 5 code channel punch wire. Thus, the code 1, 2, 5, 7, is punched by the main punch mechanism 161 to represent the example condition of upper case, bold face and no print.

From the above, it can be seen that the appropriate condition code is punched upon depression of the condition key 2707, and the condition key 2707 is released for its return upon punching of the code and return of the key results in deenergization of the involved circuits. Also, upon deenergization of the main punch circuit, the control tape 577 is advanced through the main punches 567 one step, the same as for any other normal text encoding operation.

35. LINE DELETE

As previously described herein, the delete key 140 (FIG. 3) is provided for consecutively and reversely deleting any undesired previously encoded individual text codes. This arrangement is for making the most common corrections of errors that are usually noticed reasonably soon by a typist, and indeed, it is useful for making corrections anywhere in the line. However, the line delete key 1479 (FIGS. 3 and 141) is provided for eliminating the effectivity of a line of text and the arrangement is particularly advantageous for making corrections by eliminating a long line that is nearly complete when an error near the beginning of the line is detected. Under this latter example condition, the line delete key 1479 can be used and it would not require as many sequences of operation to render the error ineffective, as would the previously described delete key 140 (FIG. 3).

Upon depression of the line delete key 1479 as will be described presently, the key first renders the previously described justifying encoding mechanism ineffective, it then prepares circuits for operating the justifying punches 2046, 2047 to encode a line delete code ahead of the text for the line and it locks down. Then, the operator must return the carriage 80 to bring about the previously described normal line terminating process of causing the main punches 567 to indicate carriage return and in sequence of feeding the tape 577 the end of the line amount through the main punches 567, and finally, in this instance, to cause the justifying punches 2046, 2047 (specifically the remainder set of justifying punches) to punch the line delete code. Operation and restoration of the justifying punches then automatically causes the line of encoded text to be fed through the justifying punches as described.

Upon reading of a line delete code by the main reader, the reproducer 2279 is conditioned to ignore all codes for the line except the carriage return code which then conditions the reproducer 2279 to perform the codes for the next line.

In the preferred form of the invention, the line delete arrangement is coupled with either the previously described clearing or conditioning feature, depending upon a predetermined position of a clear-set key 2824 (FIGS. 3 and 166). As will be explained, the machine will automatically encode the clear code or a condition code, when the clear-set key 2824 is in "Clear" or "Set" position, respectively, and this will be performed by the main punches 567 as the first encoded text information for a succeeding line and it will be done at the time the line delete key 1479 is released. This is a desired feature, since the previous deleted line may include an upper or lower case shift, a bold or regular shift or a print or no print shift that would be lost in a deleted line.

The structure of line delete key 1479 (FIG. 141) will now be described.

Line delete key 1479 is located near the left side of the keyboard, as shown in FIG. 3. The line delete key 1479 (FIG. 141) is pivoted on threaded rod 171, and it is urged counterclockwise in the illustrated normal position by a torsion spring 2825 connected to the line delete key and to the plate 172 in a known manner. The blade 1481 is secured on an insulator 2826 which in turn is secured on the line delete key 1479 in such a way as to insulate the blade from the key 1479. Blade 1481 is preferably formed with five fingers, the extreme ones of which normally engage contacts 1476 and 1480 of the switch 1478 as shown. In clockwise operated position of line delete key 1479, the blade 1481 is shifted off of contacts 1476 and 1480, and onto the contact 1477 and four other contacts 2827, 2828, 2829 and 2830. As previously mentioned, the contacts 1476 and 1477 are interconnected in any known manner. The contacts 1476, 1477, 1480 and 2827–2830 are secured in their illustrated positions on an insulator 2831 which is secured on plate 172. A stud 2832 is secured on the line delete key 1479 and it extends rightward beyond engaging alignment with a hold down pawl 2833 and a normally ineffective depression preventing lock pawl 2834. Pawls 2833 and 2834 are pivoted on a stud 2835, and they are urged clockwise and counterclockwise, respectively, against a position control stud 2836 by a torsion spring 2837 that is connected to both pawls 2833, 2834. The stud 2836 is secured on a member 2838, and an insulator 2839 is secured on position control stud 2836 and against the leftward face of member 2838. Member 2838 is pivoted on stud 2835, and a stud 2840 extends through a hole 2841 in member 2838 for limiting rotation of the member. Stud 2840 is secured on plate 172. A yieldable detent 2842 is pivoted on a stud 2843 which is secured on plate 172. A torsion spring 2844 is anchored against the solenoid 2204 and it is connected to yieldable detent 2842 for urging the detent clockwise against a point 2845 on member 2838. The yieldable detent 2842 cooperates with point 2845 for yieldably holding the member 2838 in either its illustrated, normal, clockwise position or in an operated counterclockwise position. A normally open switch 2846 is situated in alignment with the insulator 2839 for being closed by the insulator when the member 2838 and position control stud 2836 are shifted in counterclockwise position. Switch 2846 is secured on an angle bracket 2847 which is secured on plate 172. The previously mentioned solenoid 2204 is secured on plate 172, and a link 2848 is pivotally connected to the armature of the solenoid 2204 and to the member 2838. Another solenoid 2849 is secured on plate 172, and a link 2848 is pivotally connected to its armature and to the member 2838. The remote, forward end of the line delete key 1479 is guided in a customary slot therefor (not shown) in the channel member 624 and as usual in such arrangements, the slot limits the key's travel in operated and restored positions. The arrangement is such that upon depression of line delete key 1479, the stud 2832 operates hold down pawl 2833 against tension of spring 2837, and the blade 1481 is shifted off of contacts 1476 and 1480 and onto contacts 1477 and 2827–2830. When the line delete key reaches operated position, the hold down pawl 2833 latches onto stud 2832 for preventing immediate return of the line delete key. The key 1479 is thus held in operated position during the succeeding carriage return operations. When the carriage 80 is returned and the machine is normalized thereafter as described, the solenoid 2204 is operated. Operation of solenoid 2204 pulls link 2848 and rotates the member 2838 counterclockwise and the member is then held in operated position by yieldable detent 2842. As the member 2838 is shifted counterclockwise, the position control stud 2836 rotates the hold down pawl 2833 while the spring 2837 rotates the depression preventing lock pawl 2834 against the stud 2832, and the insulator 2839 is shifted against the switch 2846. At about the time member 2838 reaches counterclockwise, operated position, hold down pawl 2833 releases the stud 2832 and the insulator 2839 closes the switch 2846. When hold down pawl 2833 releases the stud 2832, the spring 2825 restores the line delete key 1479 and the blade 1481 is disengaged from contacts 1477 and 2827–2830. At about the time the line delete key 1479 reaches restored position, the stud 2832 ratchets upward beyond a nib 2851 on depression preventing pawl 2834 that is still in operated position for thereafter preventing immediate reoperation of the line delete key 1479, and the blade 1481 reengages the contacts 1476 and 1480. Upon automatic sequential operation of the clearing or condition encoding arrangement through now closed switch 2846, as will be described, the solenoid 2849 is operated to restore the member 2838. Operation of solenoid 2849 pulls link 2850 and returns member 2838. As member 2838 returns clockwise, the position control stud 2836 pushes the locking pawl 2834 likewise to ineffective position, the spring 2837 restores the hold down pawl 2833 against stud 2832 now in normal position and the insulator 2839 permits the switch 2846 to open, all as indicated. The circuitry and sequences of operations involved in line deleting will now be described.

It should be recalled that initial depression of the line delete key 1479 breaks the electrical contact between the contacts 1476 and 1480. This renders the normal justifying circuit through these contacts, wires 1482, 1498 (FIG. 92), the "word space counter 850", the amount left in line mechanism 1483 and the dividing mechanism 1923 ineffective. It should also be remembered that the line delete key 1479 is latched down by hold down pawl 2833 (FIG. 141) and blade 1481 is engaged with contacts 1477 and 2827–2830, upon depression of the line delete key 1479 and throughout the succeeding carriage return operations.

While the key 1479 is locked down and upon return of the carriage 80 as described, the carriage return function is encoded on the control tape 577 by the main punches 567 as described, and as now will be briefly reiterated. The carriage return circuit runs from source of power (S) and wire 137 (FIG. 11), through the tape return key 138 in normal position, wires 139 and 538 (FIG. 92), switch 1330 which is closed as described when work for a line has been encoded and forward tape cycle control mechanism 1335, wire 1336, solenoid 1337 for shifting switch 1334, wires 1338 and 1339, and through the switch 1315 which is closed only when the carriage is returned any amount as described. The circuit through wire 1331 also flows through wire 1333, switch 1340, wire 1342, solenoid 1343 for operating the end of line tape control 166 to effect punching of the carriage return code by the main punches 567 and to effect the end of line main punch tape handling operations as described, the circuit continues through wires 1344 and 1339, together with the other part of the circuit through the switch 1315, wires 1345 and 1098, and the current goes to ground through the punch control switch 1099 in normal position.

When solenoid 1343 is operated, the end of line tape control 166 operates as described for shifting switch 1382 and the then closed carriage return encoding switch 1386. As described, closure of switch 1386 completes the circuit from source of power (S) through solenoid 1402, wire 1404, switch 1386, wires 1404–1407, the main punch mechanism 161 for punching the carriage return code 1, 2, 3, 7, wire 162, switch 669, wire 163, switch 164 in normal position, and the circuit goes to ground through wire 165 and the shifted switch 1382 the same as in any other carriage return sequence.

When the solenoid 1337 (FIG. 84) is operated, the switch 1334 in the mechanism 1335 (FIG. 83) is shifted for breaking the circuit through solenoid 1337 as described. The operation of solenoid 1337 locks the keyboard against operation as will be described, except for the line delete key 1479 (FIG. 141) which is now latched in fully operated position. When the carriage return circuit breaker 1341 (FIG. 83) is operated by solenoid 1402, the switch 1340 is opened for deenergizing solenoid 1343 and for thus restoring switches 1386 and 1382 as described. The switch 1386 is opened for deenergizing the main punch solenoids 565 that were operated for punching the carriage return code 1, 2, 3, 7, and the switch 1382 is returned to the normal position shown. Also, upon deenergization of solenoid 1343, the control 166 operates to close switch 1401 which causes operation of the end of line tape feed 1422 as described. Upon full operation of the tape feed 1422, the switch 1423 is closed as described, for restoring the end of line tape feed control mechanism 166.

Upon shifting of switch 1334 in the mechanism 1335 as described, the circuit through wire 1332 is shifted from wire 1336 to wire 1475 (FIG. 92) and it continues through the operated line delete key switch 1478. Four wires 2852, 2853, 2854 and 2855 are individually connected to the contacts 2827, 2828, 2829 and 2830 (FIG. 141) of the switch 1478, and to the solenoids 2051-3, 2051-4, 2051-5, 2051-7 (FIG. 37), respectively, in the justifying punches 2046. Thus, the circuit continues through the operated switch 1478 (FIG. 92) the wires 2852–2855, the justifying punches 2046 that punch the line delete code 3, 4, 5, 7, wire 2125, solenoid 1441 for opening switch 1330 as described, wires 2126 and 1098, and it goes to ground through the punch control switch 1099. In this manner, the line delete code 3, 4, 5, 7, is punched ahead of the encoded text for this now deleted line. When solenoid 1441 is operated and switch 1330 is opened as described, the just described circuit for punching the line delete code is broken.

Return of the operated justifying punches 2046 closes the switch 2073 and this, as described, renders effective the circuit through switch 2073, wires 2127 and 1484 and the solenoid 2128 for operating the tape feed control switch means 1486 and for thus causing the justifying tape feed mechanism 2161 to feed the tape 577 for the deleted line through the justifying punches 2046, 2047. The circuit continues through wire 1487, it operates the solenoid 944 for clearing the word space counter 850 as described, wire 1488, operates the solenoid 1010 for clearing the mechanism 1483, wire 1011, switch 1012, wires 1013 and 1489, the delete key 140, not depressed wire 1490, and it goes to ground through the clearing sequence control solenoid 1491, wire 1493 and switch 1495. When the clearing sequence control 1492 is fully operated, the just described circuit is broken by shifting of switch 1495 as described. When solenoid 2128 is nearly fully operated, the switch means 1486 will shift to close the switch 2131 for the consecutive operation of solenoid 2156 and for the step by step feeding of the control tape 577 through the justifying punches 2046, 2047 as described. Operation of switch means 1486, by solenoid 2128, also closes switch 2132 for operating solenoid 2129 to return the switch means when the tape sensor switch 1033 is closed and the tape sensor thus indicates that the tape 577 for the line is fully fed through the justifying punches 2046, 2047 as described.

When the clearing sequence control 1492 breaks the clearing circuit as described, its switch 1495 completes the circuit for opening the switch 2073. This circuit runs from source (S) through switch 2073, wires 2127 and 2159, solenoid 2094 for opening switch 2073, as described during discussion of the justifying encoding processes.

Following carriage return the machine is restored to normal condition by the previously described end of line restoring circuit and this also occurs following line delete. However, in this instance, the line delete key 1479 is actually released for its return. The end of line restoring circuit will now be reiterated only briefly. It originates in a source (S) and flows through wire 1273 (FIG. 140), solenoid 1274 for releasing switch 1315 that was closed upon return of the carriage 80, wire 1275, solenoid 1276 for restoring the clearing sequence control 1492, wire 1277, solenoid 1278 for restoring the holding detent 1655 in amount left in line measuring mechanism 1483, wires 1279 and 2191, contacts 1717 and 1718 that become effective upon return of amount left in line measuring mechanism 1483 to normal position, wire 2192, solenoid 1353 for restoring the general key lock mechanism 1335, wire 2193, now closed switch 1361 which opens to break this circuit upon restoration of the mechanism 1335, wire 2194, solenoid 1417 for restoring the carriage return circuit breaker 1341, wire 2195, solenoid 960 for restoring the detents 887, 899 in the word space counter 850, wire 2196, switch 2197 that is closed whenever the word space counter stands at less than 16, wire 2200, contacts 2201 and 2202 that are effective only when the word space counter stands at zero, wire 2203, solenoid 2204 (FIG. 141) for releasing the operated line delete key 1479 and for closing the switch 2846 as described, wire 2205 (FIG. 140), the switch 1539 that is closed upon full return of the carriage, wire 2206, the commutator 142 and normally through wire 2212, solenoid 2213 for clearing the space at end of line preventing mechanism 2306, wire 2214, switch 1033 that is closed only when the tape sensor is operated to indicate a minimum amount of tape 577 in the punches 567 as described, and the current goes to ground for performing the operations just reiterated only when all of the just mentioned conditions exist.

Within the deleted line, there may have been functions encoded, such as upper case, bold, print, etc. which now will not be performed in the reproducer 2279. In order to properly condition the reproducer 2279, in machines having the described conditioning encoding arrangement and/or the described clearing feature, condition encoding or clearing encoding may be automatically performed following line delete and carriage return as will now be described.

In the preferred form of the machine, the "Clear-Set" key 2824 (FIG. 166) is provided for predetermining whether the machine will automatically perform the clearing function or the condition encoding operations following line delete and carriage return operations. In the "Set" position of the clear-set key 2824, the machine will perform the automatic condition encoding function which corresponds to the condition in which the machine is "set" at the moment, and, in the "clear" position of the clear-set key 2824, the machine will perform the automatic clearing and clear encoding functions which returns the machine to normal as described.

The clear-set key 2824 is pivoted on a stud 2856 which is secured on plate 2635. A detent 2857 is pivoted on a stud 2858 which is secured on plate 2635. A torsion spring 2859 is connected to detent 2857 and to plate 2635 for urging the detent counterclockwise. A roller 2860 is secured on the upper end of detent 2857, and the roller cooperates with a point 2861 on clear-set key 2824, for yieldably holding the key in one or the other of its positions. Manual shift of the key 2824 normally causes its point 2861 to shift the roller 2860 and its detent 2857 clockwise against tension of spring 2859, and as the point passes the roller, the spring, detent and roller aids the shift to the other position.

Since the clear-set key 2824 should not be shifted while the automatic clearing or conditioning operations are being performed, means are provided for preventing the shifting of the key 2824 at such times. To this end, a roller 2862 is secured on a member 2863 which is pivoted on a stud 2864 that is secured on plate 2635. A pair of studs 2865 and 2866 are secured on plate 2635 in positions for limiting rotation of member 2863 in its illustrated normal clockwise position and in its operated counterclockwise position respectively. A torsion spring 2867 is connected to member 2863 and to stud 2866 for urging the member against stud 2865 as shown. A link 2868 is pivotally connected to member 2863 and to a solenoid 2869 which is secured on plate 2635. Solenoid 2869 is operated whenever automatic condition encoding or automatic clearing functions are performed as will be described, and its operation pull link 2868 and rotates member 2863 to operated position against stud 2866. In operated position of member 2863, the roller 2862 is shifted down in alignment with a surface 2870 on detent 2857 for preventing any significant clockwise pivoting of the detent. Thus, the clear-set key 2824 cannot be shifted, when the solenoid 2869 is operated. Upon deenergization of solenoid 2869, the spring 2867 restores the member 2863 to the illustrated ineffective position.

An insulator 2871 is secured on clear-set key 2824 and a brush 2872 is secured on the insulator so as to be moved with the key while being insulated therefrom. The lower bifurcated end of brush 2872 is pressed toward the plain surface of an insulator 2873 which is secured on plate 2635.

In the illustrated "Set" position of clear-set key 2824, the end of brush 2872 engages a strip 2874 and a contact 2875, and in "Clear" position of the clear-set key 2824, the brush is shifted off of contact 2875 and on to a contact 2876 for conducting current between strip 2874 and contact 2876. The strip 2874 and contacts 2875, 2876 are secured on insulator 2873 in a known manner, so as to be insulated from each other and from plate 2635.

Automatic condition encoding following line delete and carriage return will now be described. In order to perform the automatic condition encoding operations, the clear-set key 2824 must be in the "Set" position as described.

A source of power (S) is connected to the switch 2846 (FIG. 141). A wire 2877 (FIG. 161) is also connected to switch 2846 and to the solenoid 2869. A wire 2878 is connected between solenoid 2869 and the strip 2874. A wire 2879 is connected to contact 2875 and to the wire 2720.

With the clear-set key 2824 in "Set" position, upon release of the line delete key 1479 (FIG. 141) and closure of switch 2846 as described, the current through switch 2846 (FIG. 161) passes through wire 2877, solenoid 2869 for locking clear-set key 2824 in position as described, wire 2878, strip 2874, contact 2875, wire 2879, wire 2720 (FIG. 162), and so on through the condition encoding arrangement for punching the appropriate condition code as described. The condition encoding arrangement functions in the same manner as before described, except that the condition key 2707 is not operated in this instance. In this instance, when the condition encoding mechanism 2757 is operated as described, the condition punching circuit that travels through the solenoid 2718 operates this solenoid for no particular purpose since the condition key 2707 is not operated and locked down. Otherwise, however, the punch circuit is the same as before described. When the main punch mechanism 161 is operated to punch the condition code, the circuit continues, as before described, through wire 162 (FIG. 83), switch 669, wire 163, switch 164 in normal condition, wire 165, switch 1382 now in normal condition, wire 167, and it goes to ground through the solenoid 168 in the forward tape cycling mechanism 169 which was normalized following carriage return as described. As also described, operation of solenoid 168 (FIG. 51) prepares for feeding of the tape 577 one step through the main punches 567. As further described, solenoid 168 causes member 1432 to be rotated clockwise, whereupon the pawl 1436 (FIG. 53) is shifted by spring 1437 into notch 1435 for closing switch 1439.

Upon closure of switch 1439, the solenoid 2849 (FIG. 141) is operated for normalizing the line delete key 1479 and opening the switch 2846 as will now be explained.

A wire 2880 is connected to now closed switch 2846 and to the solenoid 2849. A wire 2881 is connected to solenoid 2849 and to one blade of the switch 1439 (FIG. 53), and the other blade of which is grounded as indicated. Thus, as the main punches 567 operate and the switch 1439 is closed thereupon as described the circuit is complete from source (S) (FIG. 161) and switch 2846, through wire 2880, solenoid 2849, wire 2881 and now closed switch 1439 (FIG. 53). Upon operation of solenoid 2849 (FIG. 141), the switch 2846 is opened as described. However, it should be pointed out that the normal air gap in the switch 2846 is sufficiently close for the switch to remain closed until after the member 2838 is rotated clockwise and its point 2845 passes midway in its travel, thereupon the detent 2842 shifts the member 2838 the rest of the way to the normal illustrated position. The member 2838, insulator 2839 and switch 2846 could just as well be a snap switch arrangement that snaps the switch after more than half of the travel of member 2838, without departing from the spirit of the invention. When the switch 2846 is opened, the circuit through wire 2877 (FIG. 161) is broken for normalizing the condition encoding mechanism 2757 (FIG. 162) and main punch mechanism 161. Thereupon, the control tape 577 is advanced one step, the same as in any other text encoding operation as previously described. Opening of switch 2846 (FIG. 161) also deenergizes the solenoid 2849. Thus the sequences of line delete, carriage return, condition encoding and normalizing of the machine thereafter are completed.

Automatic clearing after line delete and carriage return will now be described. For automatic clearing operations, the clear-set key 2824 is shifted to its "Clear" position. A wire 2882 is connected to the contact 2876 and to the solenoid 2661 which is provided for automatically operating the clear key 2633 as described. Solenoid 2661 is grounded in a convenient manner. When the machine is restored following carriage return as described, the solenoid 2204 is operated for closing the switch 2846. Closure of switch 2846 completes the circuit from source through the switch, wire 2877, solenoid 2869 for locking the clear-set key 2824 against manipulation, wire 2878, strip 2874, now effective contact 2876, wire 2882 and the circuit goes to ground through the solenoid 2661 for operating the clear key 2663. This automatic operation of clear key 2633 causes the key to be locked down, and thus causes the clearing sequences of operations to be performed in exactly the same manner as described above under Topic 33, entitled "THE CLEAR KEY AND ITS FUNCTIONS". When the clear code is punched by the main punches 567, the forward tape cycling mechanism is operated, as described for closing the switch 1439 (FIG. 53) as described above in connection with the automatic condition encoding operations. As in the automatic condition encoding operations, the closure of switch 1439 causes the solenoid 2849 (FIG. 161) to be operated for opening the switch 2846 for, in this case, deenergizing the solenoid 2661. Thus, when the clear functions and the clearing encoding is performed and the solenoid 2642 is then operated, the clear key 2633 is restored and the clearing mechanisms are restored as described.

From the above it can be seen that either conditioning encoding, or clearing and clear encoding functions are automatically performed following line delete and carriage return operations, in a preferred form of the invention. It should be also understood that a machine could be manufactured and marketed without the line delete key 1479 (FIG. 141) and its switch 1478, and in such machines, conditioning encoding or clearing encoding would be performed by the other described mechanism following each carriage return as previously described. A machine that does not have the line delete key 1479 and its switch 1478 would also not have the pawl 2833 and the lock pawl 2834, but it would have the solenoids 2204 and 2849, detent 2842, member 2838, insulator 2839 and switch 2846 substantially as described and shown in FIG. 141.

It should also be understood in the preferred form of the machine (i.e. a machine equipped with a clear-set key 2824, the conditioning encoding arrangement, the clearing and clearing encoding feature and the line delete feature), that clearing or conditioning will occur as described, following each carriage return operation, regardless of whether of not the line delete key 1479 is operated before the carriage 80 is returned. It can be seen that this is true, since the solenoid 2204 is operated upon full return of the carriage 80 and since operation of solenoid 2204 closes the switch 2847 that causes conditioning or clearing as described, regardless of whether or not the line delete key 1479 was used. When the line delete key 1479 is depressed and the carriage is fully returned, the solenoid 2204 is operated to close switch 2846 and to operate pawl 2833 to release line delete key 1479 and when the line delete key 1479 is not depressed and the carriage 80 is fully returned, the solenoid 2204 is operated to close switch 2846 and the pawl 2833 is operated idly since the line delete key 1479 is already in normal returned position.

Thus, it is seen that conditioning or clearing is performed automatically following carriage return. When a line is deleted, the sequential conditioning or clearing will unerringly cause proper coordination between the composer and the reproducer 2279. When a preceding line is not deleted, the conditioning or clearing code at the beginning of the next line is not normally necessary, but such a code is of great importance in instances where a tape 577 may be separated (torn off) between lines and the latter part of the next on the tape 577 is run a second time through the main reader. In the latter instance, the reproducer 2279 would always be properly coordinated by the first code in the first line.

36. STOP PRINTER

A stop printer key 2883 (FIG. 3) is provided primarily for encoding a stop printer signal and therethrough for stopping the reproducer 2279 at the end of a piece of work so the finished copy may be removed and new paper inserted for the next job. It may also be used for stopping the automatic typing processes of the reproducer 2279 within a line, where it is desired to manually insert variables (names, addresses, dates, etc. for example) in a plurality of otherwise identical papers that may be reproduced several times in the reproducer 2279 or that may be copied by other means. It is conceivable that a variable type face typewriter may be employed, instead of the typewriter illustrative used herein, and in such arrangements, the stop printer key 2883 in the composer might be used to stop the reproducer 2279 at a point in the text where a change of type face might be required.

In finishing a piece of work, the operator of the composer should return the carriage before depressing the stop printer key 2883, so the carriage of the reproducer 2279 will be returned automatically before it is stopped. This practice should be adopted particularly in establishments where any amount of reproducing from tape 577 that has been filed away is common, because the code for carriage return might not appear ahead of the first bit of work on the next tape 577. If the establishment does not call for the tape's being stored or otherwise being removed from the punch mechanism 161, whether or not the carriage is returned before the stop printer key 2883 is used will make no difference, since the carriage of the reproducer 2279 will always be returned before the next piece of work is begun. Of course, if for some reason the carriage of the reproducer 2279 was not returned when the reproducing was stopped for change of paper, the operator could return the carriage by manual operation of the reproducer 2279 when the operator changes the paper.

In a preferred method of providing controlled space for variables in a justifiable line, the operator selectively operates the nut space keys 761, 762 and/or 763 a sufficient number of times to provide appropriate space for the variables, and then he completes the line with non-variable text before operating the stop printer key 2883. In this procedure, the reproducer 2279 automatically produces the entire justified line normally, including the blank space, before the reproducer 2279 automatically stops upon reading and decoding the stop printer code. The operator could then enter the variable in the space in the justified line, and then he could start the automatic operation of the reproducer 2279. In this most desirable method, justification of the line is performed automatically, without dependence upon positioning of the carriage by the operator.

In another method of providing space for variables in a justified line, the composer operator depresses the stop printer key 2883 before entering the nut spaces for the variables. He then enters the nut spaces and finishes the line with non-variable text. Following this practice, when the reproducer 2279 stops as controlled by the stop printer code, the reproducer operator must first note the exact position of the carriage, insert the desired variable, return the reproducer carriage to the exact noted position, and then start the automatic operations of the reproducer 2279 again. If this procedure is followed carefully, the line will be properly justified, but the justification will depend upon the operator's positioning of the carriage in the mentioned exact noted position.

Of course, the simplest method is to provide the nut spaces for the variables and complete the work in the composer, and insert the variables in the justified copy after the work is completed by the reproducer.

In machines having the previously described conditioning and clearing features, it is advantageous for the composer to be arranged for performing for one of these operations automatically following the stop printer function, as will be described, particularly if the example machine were not arranged to perform one of these operations automatically following carriage return.

The structure of the stop printer key 2883 will now be described. Stop printer key 2883 is pivoted on rod 2634 (FIG. 167), and it is urged clockwise to illustrated normal position by a torsion spring 2884 that is connected to the key and to the contact support plate 2637. The forward end of the stop printer key is guided in a vertical slot therefor (not seen here) in channel member 624, and the ends of the slot limit the rotation of the key 2883 in normal and operated positions in a customary manner. An insulator 2885 is secured on stop printer key 2883 and a brush 2886 is secured on the insulator. The free end of brush 2886 is pressed against an insulator 2887 which is secured on an angle bracket 2888. Angle bracket 2888 is secured on the contact support plate 2637. A pair of contacts 2889 and 2890 are secured on insulator 2887 in positions to be engaged by brush 2886 only when the stop printer key is in operated position. A stud 2891 is secured on the key 2883. A hold-down pawl 2892 is pivoted on the rod 2640 and a torsion spring 2893 is connected to the hold-down pawl 2892 and to contact support plate 2637 for urging the pawl against stud 2891. A link 2894 is pivotally connected to pawl 2892 and to the armature of a solenoid 2895 which is secured on the bottom plate 607.

Upon depression of stop printer key 2883, the key is rotated against tension of spring 2884, and in operated position of the key the brush 2886 engages the contacts 2889, 2890 for conducting current therebetween and the hold-down pawl 2892 latches on to stud 2891 for holding the stop printer key 2883 in operated position. Upon completion of the stop printer encoding operations, to be described, the solenoid 2895 is energized whereby link 2894 is pulled and hold-down pawl 2892 is rotated against tension of spring 2893 for releasing the pawl from stud 2891. Whereupon, spring 2884 restores the key 2883 to the illustrated normal position.

Upon depression of stop printer key 2883 and completion of a circuit through contacts 2889 and 2890, a stop printer circuit control mechanism 2896 is caused to operate and to control punching of the stop printer code 5,6, as will be described. The structural details of stop printer circuit control mechanism 2896 are shown in FIGS. 168 and 169, and this mechanism will now be described.

Stop printer circuit control mechanism 2896 is assembled in and about a frame consisting primarily of a top plate 2897, a bottom plate 2898, and studs 2899, 2900, 2901 and 2902 secured to the plates and extending therebetween. The top plate 2897 is shown in phantom in FIG. 168 to clearly show the mechanism that is situated there below. The bottom plate 2898 rests on a pair of angle members 2903 and 2904, and it is secured on the angle members as by bolts 2905. The angle members 2903 and 2904 rest on the top of the back space decoder frame plates 1100 and 1102 (FIG. 71), and the members are secured to the plates by angle brackets 2906 secured to the left ends of the angle members and to plate 1100 (FIG. 72) and identical brackets 2906 secured to the right ends of the angle members 2903 and 2904 and to the plate 1102 (FIG. 71).

A pair of motivating solenoids 2907 and 2908 (FIGS. 168 and 169) are secured on bottom plate 2898. A link 2909 is pivotally connected to the armature of motivating solenoid 2907 and to a spacer rod 2910. A link 2911 (FIG. 168) is likewise connected to the armature of motivating solenoid 2908 and to a rod 2912. The rods 2910 and 2912, together with an identical rod 2913, are secured at their ends to a member 2914 and to a member 2915 (FIGS. 168 and 169). The members 2914 and 2915 are pivoted on the rod 2899. A stud 2916 is secured on the remote end of member 2914, and it extends upward therefrom above the top plate 2897 which is equipped with stop surfaces 2917 and 2918 (FIG. 168) for limiting counterclockwise and clockwise pivoting of the members 2914 and 2915. A contractile spring 2919 (FIG. 169) is connected to stud 2916 and to a stud 2920 that is secured on a member 2921 (FIG. 168). The stud 2920 extends through a hole 2922 in the top plate 2897, and the hole is arranged to limit the swing of stud 2920 and thereby it limits the clockwise and counterclockwise pivoting of member 2921. Member 2921 is secured on a hub 2923 (FIG. 169) which is pivoted on stud 2899. From the above, it can be seen that pivoting of member 2914 (FIG. 168) at an opposite extreme will cause the spring 2919 to exert a snap switch effect on member 2921 as will be explained further.

A time delay detent and switch closing means is mounted generally on stud 2900. Two members 2924 and 2925 are secured on a common hub 2926 (FIG. 169), and the unit thus formed is pivoted on a stud 2900.

This unit is urged counterclockwise by a spring 2927 (FIG. 168) connected to top plate 2897 and to member 2925 of the unit. A stud 2928 is secured on member 2925 and it extends up through a limit hole 2929 in top plate 2897. A link 2930 is pivotally connected to member 2924 and to the armature of a solenoid 2931 that is secured to top plate 2897. The solenoid 2931 is also shown in phantom in FIG. 169. Normally, as shown, the spring 2927 (FIG. 168) holds the unit including member 2925 counterclockwise where the stud 2928 engages one side of the hole 2929, and upon operation of solenoid 2931, the unit is rotated clockwise against tension of spring 2927 until the stud 2928 is stopped against the opposite side of limit hole 2929. Upon deenergization of solenoid 2931, the spring 2927 restores the unit to the position shown. A member 2932 is pivoted as at 2933 on the remote end of member 2925, and a lost motion slot 2934 in member 2932 surrounds the stud 2928. A contractile spring 2935 is connected between the members 2925 and 2932 for urging the member 2932 clockwise against stud 2928 as shown. Normally, when the member 2921 is snapped counterclockwise, the stud 2920 and therefore the member 2921 is stopped approximately halfway in their travel as the stud engages a surface 2936 on the member 2932. Then, in the sequence to be explained, solenoid 2931 is operated to rotate the unit including members 2924 and 2925 clockwise for swinging the surface 2936 and member 2932 out of the path of stud 2920 and thus to permit the member 2921 to complete its counterclockwise rotation under tension of the spring 2919. Then, as will be explained, the solenoid 2931 is deenergized for permitting the spring 2927 to restore the time delay detent and switch closing means to the illustrated position, but the member 2921 and its stud 2920 are then in counterclockwise operated position. An insulator 2937 is secured on member 2932 in engaging alignment with a normally open switch 2938 that is secured on the top plate 2897. Further in the sequence to be described, the solenoid 2908 is operated for restoring member 2914 counterclockwise to where its stud 2916 engages surface 2917 and the spring 2919 returns stud 2920 and member 2921 clockwise. As stud 2920 returns it engages a surface 2939 on member 2932 and rotates member 2932 counterclockwise about its pivot 2933 against the relatively light tension of spring 2935. When member 2932 is thus rotated, its insulator 2937 closes the switch 2938. As the stud 2920 travels further, the member 2932 engages the other end of its slot 2934 with the stud 2928 and thereafter the stud 2920 cams surface 2939 rightward, rotating the member 2925 clockwise against tension of its spring 2927. Just prior to the time stud 2920 achieves the illustrated position, the surface 2939 drops off of stud 2920, and the spring 2935 restores member 2932 clockwise and spring 2927 restores member 2925 counterclockwise to the illustrated positions. During the later part of this just described restoring action, the insulator 2937 moves away and permits the switch 2938 to open.

An insulator 2940 is secured on the member 2921 and in normal position of the member, the insulator holds a stop printer code switch 2941 in closed condition as shown. The stop printer code switch 2941 is secured on top plate 2897. When the member 2921 is snapped counterclockwise and its stud 2920 engages the surface 2936, as described, the insulator 2940 is shifted away from the stop printer code switch 2941 allowing the switch to open. In full counterclockwise operated position of the member 2921, its insulator 2940 closes a normally open restoring circuit 2942 that is secured on top plate 2897. Upon clockwise return of member 2921, the insulator 2940 permits restoring circuit switch 2942 to open and it again closes the stop printer code switch 2941 as shown.

A circuit changing switch means 2943 is shiftable with the members 2914 and 2915 and it will now be described. An insulator 2944 is secured on the member 2915 for movement with the member. Two pairs of contacts 2945, 2946 and 2947, 2948 are secured on the insulator 2944 and their effective surfaces are on the underside of the insulator. The contacts 2945–2948 are all conductively interconnected in a known manner. Brushes 2949, 2950 and 2951 are secured on an insulator 2952 which in turn is secured on bottom plate 2898. The brushes 2949–2951 (FIG. 169) are pressed upward against the bottom of insulator 2944 and the contacts thereon as the case may be. In the illustrated position of the parts, the brushes 2949 and 2950 (FIG. 168) are engaged with the contacts 2945 and 2946, respectively, for conducting current thereamong. In clockwise operated position of the member 2915 and insulator 2944, the brushes 2950 and 2951 are engaged with contacts 2947 and 2948, respectively, for conducting current among these parts.

The stop printer circuitry will now be described. A source of power (S) is connected to the contact 2889 (FIG. 167). A wire 2953 is connected to the contact 2890 and to both of the motivating solenoids 2907 and 2908 in the stop printer circuit control mechanism 2896. A wire 2954 is connected between the solenoid 2907 and the switch 2941. A pair of wires 2955 and 2956 are individually connected to separate blades of switch 2941 and to respective code channel punch wires 5 and 6.

As previously described and shown in FIG. 54, the forward tape cycling clearing circuit passes through the solenoid 698, wire 699, switch 697 when the tape 577 is fed one step following a normal encoding operation, and the circuit goes to ground as indicated. This occurs following stop printer encoding except that the circuit does not go to ground at this point in a preferred form of the invention that includes the stop printer encoding feature. In machines having the stop printer feature, the switch 697 is not grounded as shown in FIG. 54. Instead, a wire 2957 (FIG. 167) is connected between switch 697 and the brush 2950, and the brush 2949 is grounded as indicated.

Thus, it can be readily seen that the previously described forward tape cycling clearing circuit normally functions as described, since the brushes 2949 and 2950 are normally effective and the normal clearing circuit finds its ground through wire 2957 and these brushes as indicated. A wire 2958 is connected between brush 2951 and the solenoid 2931, which is grounded as indicated, for completing the forward tape cycling clearing circuit during stop printer operations as will be described further herein.

A wire 2959 is connected to the solenoid 2908 and to the restoring circuit switch 2942, which is grounded in one preferred form. However, in a second preferred form, the restoring circuit switch 2942 is not grounded and the switch is connected with the clearing and/or conditioning arrangements. In the second preferred form, a wire 2960 is connected between the restoring circuit switch 2942 in the stop printer circuit control 2896 (FIG. 161) and the wire 2877 that leads to the arrangement under control of the clear-set key 2824. In the second preferred form, clearing or conditioning will be performed, depending on the preset position of clear-set key 2824 as described, following stop printer operations in a sequence to be described presently.

A stop printer release circuit is derived in a source of power (S) connected to the switch 2938 (FIG. 167). A wire 2961 is connected to the switch 2938 and to the solenoid 2895 which is grounded as shown.

Upon depression of the stop printer key 2883, the brush 2886 engages the contacts 2889 and 2890, and the key 2883 is latched down by hold-down pawl 2892 as described. Thus, the circuit is complete from the source (S) through contact 2889, brush 2886, contacts 2890, wire 2953, solenoid 2907, wire 2954, normally closed switch 2941, wires 2955 and 2956, the code channel punch wires 5 and 6, the punch mechanism 161 (FIG. 11) for punching the code 5 and 6 in the control tape 577, wire 162, switch 669, wire 163, switch 164, wire 165, line tape feed control 166, wire 167, and the circuit goes to ground through the solenoid 168 for operating the forward tape cycle control 169 as described. Thus, the stop printer code 5,6 is punched by the punch mechanism 161 and the forward tape cycle control 169 is operated to cause one step feeding of the tape 577 thereafter as described. When the solenoid 2907 (FIG. 167) is thus energized, it rotates the members 2914, 2915 (FIG. 168), and insulator 2944 clockwise, as described, for first disengaging the contacts 2945 and 2946 from the brushes 2949 and 2950, and at the end of this forward stroke the contacts 2947 and 2948 are engaged with the brushes 2950 and 2951. Also as the member 2914 is rotated clockwise, its stud 2916 shifts the centerline of spring 2919 to the opposite side of stud 2889. The stud 2916 is shifted against stop 2918 as described. When spring 2919 is thus shifted beyond stud 2899, the spring shifts member 2921 counterclockwise initially until the stud 2920 engages the stop surface 2936. During this initial rotation of member 2921, the insulator 2940 is shifted to permit stop printer code switch 2941 to open. Opening of switch 2941 (FIG. 167), deenergizes the solenoid 2907, the main punch mechanism 161 (FIG. 11) for return of the operated punches 567 and the solenoid 168 for causing the control tape 577 to be fed one step through the main punches 567 as described.

When the tape feed mechanism is operated, it closes the switch 697 (FIG. 54) as described. Closure of switch 697, in instances where the stop printer key 2883 is used, completes a circuit leading from the source (S) and wires 137, 693 and 694, solenoid 698 for restoring the forward tape cycling mechanism 169 as described, wire 699 (FIG. 167), switch 697, wire 2957, brush 2950, contacts 2947, and 2948 (FIG. 168) now engaged with the brushes, brush 2951 (FIG. 167), wire 2958, and goes to ground through solenoid 2931 for withdrawing surface 2936 (FIG. 168) out of the path of stud 2920 and permitting the member 2921 to snap fully counterclockwise under tension of spring 2919 as described. Restoration of the forward tape cycling mechanism 169 by solenoid 698 (FIG. 167) controls the switch 697 to open, as described, for deenergizing solenoids 688 and 2931. Deenergization of solenoid 2931 permits the spring 2927 (FIG. 168) to restore members 2925 and 2932, and to put surface 2939 in the return path of stud 2920 that is now in operated position as described.

Upon full counterclockwise movement of member 2921, its insulator 2940 closes switch 2942 as described. Closure of restoring circuit of switch 2942 (FIG. 167) completes the circuit through the still effective contacts 2889 and 2890, wire 2953, the restoring solenoid 2908, wire 2959 and restoring circuit switch 2942. Where it is not desired to perform clearing or conditioning operations automatically after stop printer encoding, the restoring circuit switch 2942 is grounded and this circuit is terminated at this point. However, in machines arranged to perform either of the automatic operations, this circuit continues via wire 2960 (FIG. 161) as will be discussed further hereinafter. However, in either case, operation of restoring solenoid 2908 (FIG. 167) returns the members 2914 and 2915 (FIG. 168) and insulator 2944 counterclockwise to the illustrated position where the stud 2916 rests against surface 2917 and the spring 2919 rotates the member 2921 clockwise as described.

As the member 2921 restores clockwise, its stud 2920 engages surface 2939 and rotates member 2932 to close switch 2938 as described. Closure of switch 2938 (FIG. 167) completes the circuit through the switch, wire 2961 and solenoid 2895 for releasing the stop printer key (2883) as described. Upon release of the stop printer key 2883 and its return by spring 2884, the circuit through restoring solenoid 2908 is broken by removal of brush 2886 from the contacts 2889 and 2890 as described. Just prior to completion of clockwise restoration of member 2921 (FIG. 168), the stud 2920 slips past the surface 2939 as described and the spring 2935 and 2927 restore the forward tape cycling mechanism 169 to the position shown where switch 2938 is open and solenoid 2895 (FIG. 167) is deenergized. At this point, the stop printer code has been punched in the tape 577 and the tape is advanced one step through the main punches 567, and the forward tape cycling mechanism 169 shown in FIGS. 167 and 168 are restored to normal.

In the second preferred form mentioned above, the automatic clearing or conditioning operations are initiated upon closure of restoring circuit switch 2942 (FIG. 167), at the time the restoring solenoid 2908 operates as described. In this instance, the current through restoring circuit switch 2942 is not grounded as previously mentioned, but instead it flows through wire 2960 (FIG. 161), wire 2877, solenoid 2869 and so on through the clearset key arrangement for performing the clearing and clearing encoding operations or the conditioning encoding operations, as determined by the position of the clear-set key 2824, in exactly the same manner as described above for the performance of these features following carriage return.

37. EXTRA LINE SPACING ENCODING AND PLATEN ROTATING

The line space key 20 (FIG. 3) and the reverse line space key 21 are operable for adding and deducting line spaces, respectively, and thus, in this respect they are for supplementing the normal line spacing that occurs automatically upon return of the carriage 8D by lever 111 and as controlled by the preset button 112 as previously described. With each operation of the line space key 20 or reverse line space key 21, the platen 90 in the composing machine's paper carriage 80 is advanced or reversed respectively, one line space and a forward line space code (4) or reverse line space code (4,5), respectively, is punched on the control tape 577, for causing the corresponding operation of the platen in the paper carriage of the reproducer 2279. It may be noted that there is no longitudinal carriage shift in these supplementary line space sequences.

The line space key 20 (FIG. 4) is secured on a key lever 2962. The reverse line space key 21 is secured on a key lever 2963. Key levers 2962 and 2963 are like the character key levers 23, previously described, except that the key levers 2962 and 2963 do not have any differential key lock depending lugs 1787–1792 (FIG. 112). When the line space key 20 (FIG. 4) and its lever 2962 are operated, a related bellcrank 24 and type arm 25 cause imprinting of a related sign, an arrow that points downward (↓) for example on the unjustified copy paper, before the line space mechanism shifts the platen 90 one forward line space. Operation of the reverse line space key 21 and its lever 2963 cause a respective bellcrank 24 and type arm 25 to imprint a related sign [an arrow that points upward (↑) for example] on the unjustified copy paper, before the reverse line space operation occurs as will be described. However, if desired, a machine may be produced that does not imprint these signs by merely eliminating the bellcrank 24 and the type arms 25 from these line space keys 20, 21. In either case the reproducer 2279 does not print these signs but only performs the appropriate line space operation, when a line space code is read by the main reader M.R.

The structural details of the mechanism for advancing or reversing the platen 90 of the composer, upon manual operation of one of the line space keys 20, 21 or automatically upon deletion of a line space code, will now be described. It will become apparent that the line space mechanism (Shown particularly in FIGS. 170–173) is adapted for machines having platens that are shifted upward and downward to upper and lower case positions, respectively, and it is adapted for machines having a paper carriage that is shiftable longitudinally. However, this mechanism for advancing or reversing the platen 90 of the composer is equally suitable for other machines where the platens are not so shifted vertically and it is suitable for machines where the carriage is not shifted longitudinally.

A platen 90 (FIG. 170) is secured on axle 91 that is rotatable in the platen carrier frame 81 in a customary manner. A clutch output member 2966 is secured on axle 91 and a clutch input member 2967 is rotatable on axle 91 and the hub of member 2966 in a customary manner as shown. A friction clutch 2968 is engageable between the members 2967 and 2966. A cam member 2969 is slidably mounted on the axle 91 between the clutch and a customary knob 2970. Knob 2970 is secured on axle 91 as by a set screw 2971. A pair of pins 2972 (only one shown) are slidable in suitable holes therefor through knob 2970 and they are connected with the cam member 2969 for sliding the cam member 2969. A clutch control button 2973 is secured on the left ends of the pins 2972. In the illustrated leftward position of clutch control button 2973, the pins 2972 and the cam member 2969 are pulled into their leftward positions where the cam member 2969 permits the friction clutch 2968 to disconnect the clutch input and output members, and the knob 2970, axle 91, and platen 90 may be rotated manually gradiently in respect to the clutch input member 2967. By pressing the clutch control button 2973 toward knob 2970, the pins 2972 slide the cam member 2969 rightward in thier normal positions for engaging the friction clutch 2968 and thereby connecting all of the just described mechanisms for unitary rotation and position with the axle 91. A customary normal-line-space and detent-ratchet wheel 2974 is secured on the clutch input member 2967, and a customary yieldable detent **2974*a* (FIG. 171)cooperates with the detent-ratchet wheel 2974 for yieldably holding the ratchet wheel and clutch input member 2967 (FIG. 170) in any line space position of rotation. It should also be understood that the detent-ratchet wheel 2974 also normally yieldably holds the knob 2970, friction clutch 2968, axle 91 and the platen 90 unitarily in a line space position, when the friction clutch 2968 is engaged as described. The just described platen positioning means is substantially the same as the corresponding parts in the Underwood typewriter chosen as exemplary and employed as a basic component of the machine described herein. However, the clutch input member 2967 is modified herein to include a sprocket 2975**.

As shown, the sprocket 2975 (FIG. 171) is a radial pin type and a perforated endless belt 2976 (preferrably steel) is suitable assembled on the sprocket 2975 and on a similar sprocket 2977. Sprocket 2977 is secured to a gear 2978 and the sprocket and gear are rotatably mounted on the left end of the torque shaft 96 which is carried on the carriage base carrier 80 (FIGS. 1 & 8) as previously described. Thus, this mechanism shown in FIG. 170, together with the belt 2976 (FIG. 171), sprocket 2977 and gear 2978 are shiftable longitudinally with the carriage 80. It can also be seen that the platen 90 and axle 91 may be shifted up and down for case shifting, as described, without disturbing the rotational positions of the sprockets 2975 and 2977.

The gear 2978 is constantly meshed with a wire gear 2979 which extends longitudinally sufficiently to remain engaged with the gear 2978 in all positions of the carriage and the gear 2978. To illustrate this, the gear 2978 (FIG. 19) is shown in phantom in both its left and right extreme positions, and the wire gear 2979 is shown to be longer than the distances between these positions. Wire gear 2979 is secured on a shaft 2980, which extends leftward and rightward therefrom, and the ends of the shaft 2980 are rotatably mounted on identical brackets 2981. Brackets 2981 are secured on the angle iron 2982, and the angle iron 2982 is secured on top of the carriage rail supporting portions 84 and the typewriter frame 15 by cap screws 2983 as indicated. The upper part of plate 288 is also secured to the angle iron 2982 by cap screws 2984. The upper part of plate 173 is also secured to the angle iron 2982 by a cap screw 2985.

A spur gear 2986 (FIG. 171) is meshed with the wire gear 2979 and it is rotatably mounted on a bolt 2987 that is secured on plate 173. Spur gear 2986 meshes with a gear 2988 which is secured on a hub 2989 (FIG. 172). Hub 2989 is pivoted on a bolt 2990 and the bolt is secured on plate 173. A gear 2991 is pivoted on an extension of the hub 2989 and it is spaced from gear 2989 by a washer 2992 on the hub 2989, sufficiently, to be clear of the spur gear 2896. Gear 2991 is meshed with a gear 2993 that is secured on a rotatable shaft 2994 to be described presently. An adjustment stud 2995 is secured on gear 2988 and it extends through an arcuate slot 2996 (FIG. 171) in the gear 2991. A washer 2997 (FIG. 172) is assembled on the stud 2995, between the gears 2988 and 2991, and it is of the same thickness as the washer 2992. The adjustment stud and slot arrangement, between the gear 2991 that is engaged with gear 2993 and the gear 2988 that is engaged with spur gear 2986 and is thus entrained with the platen 90, is provided so that the platen 90 may be adjusted to a proper line space as determined by the ratchet wheel detent 2974 (FIG. 171) and the gear 2993 (FIG. 172) may be adjusted in proper angle of rotation, for synchronizing the detent and the line space mechanism. When the parts are thus properly adjusted, a nut 2998 (FIG. 171) is tightened on the stud 2995 for clamping the gears 2988 and 2991 together for unitary rotation.

Two identical ratchet wheels 2999 and 3000 are assembled on the shaft 2994, but each is reversed in respect to the other as shown, and the ratchet wheels are secured for rotation with rotatable shaft 2994 by a key 3001 (FIG. 173). By rotating the ratchet wheels counterclockwise one tooth, as by such operation of ratchet wheel 2999, the rotatable shaft 2994 and gear 2993 (FIG. 172) are rotated counterclockwise, gears 2991 and 2988 (FIG. 171) are rotated clockwise, gear 2986 is rotated counterclockwise, gear 2979 is rotated clockwise, gear 2978 and sprocket 2977 are rotated counterclockwise, the perforated endless belt 2976 and sprocket 2975 are likewise operated counterclockwise, the clutch input member 2967 (FIG. 170) and detent ratchet wheel 2974 are operated one step of ratchet wheel 2974 in a forward direction, and the platen 90 is thereby normally rotated one line space forwardly. In this manner, the platen 90 is forward line spaced one line whenever the ratchet wheel 2999 (FIG. 171) is operated one tooth in the same counterclockwise direction. It also holds true that when the ratchet wheels 2999 and 3000 are rotated one tooth clockwise as by ratchet wheel 3000, the platen is likewise rotated one line space reversely. It can also be understood that the ratchet wheels 2999 and 3000 are rotated counterclockwise and clockwise one tooth whenever the operator rotates the platen 90 (FIG. 170) forwardly and reversely, respectively, for each tooth on detent ratchet wheel 2974, by turning knob 2970, for example.

A forward motivating solenoid 3002 is secured on plate 173 and a link 3003 is pivotally connected to the armature of the solenoid and to a bellcrank 3004 that is pivoted on rotatable shaft 2994. A contractile spring 3005 is connected to bellcrank 3004 and to a stud 3006 (FIG. 172) secured on plate 172, and the spring urges the bellcrank 3004 counterclockwise in normal position against a rod 3007 (FIG. 171) that is secured at its ends to plates 172 and 173. A drive pawl 3008 is mounted on bellcrank 3004 at pivot 3009. Pawl 3008 is urged clockwise by a torsion spring 3010 connected to the pawl and to bellcrank 3004, and the pawl normally rests against a stud 3011 as shown in FIG. 173. Stud 3011 will be described presently.

A reverse motivating solenoid 3012 (FIG. 171) is secured on plate 172, and a link 3013 is pivotally connected to the armature of the reverse motivating solenoid and to a bellcrank 3014 that is pivoted on rotatable shaft 2994. Bellcrank 3014 is like bellcrank 3004, but it is assembled in the reverse direction. A spring 3015 is connected to the bellcrank 3014 and to a stud 3016 secured on plate 173, and the spring urges the bellcrank clockwise in normal position against a rod 3017 that is secured at its ends to plates 172 and 173. A pawl 3018 is pivoted on bellcrank 3014 at 3019. Pawl 3018 is urged counterclockwise by a spring 3020 connected to the pawl and to the bellcrank 3014, and the pawl normally rests against the stud 3011 as shown in FIG. 173.

Stud 3011 (FIG. 172) is secured in any known manner to the upper end of a member 3021 and the stud extends from both sides of the member as shown. The member 3021 is pivoted on rotatable shaft 2994. The stud 3011 and member 3021 (FIG. 171) are yieldably held in the illustrated position by a pair of centralizer members 3022 and 3023 that are pivoted on the rotatable shaft 2994. A contractile spring 3024 is connected to the centralizer members 3022, 3023 for urging the members 3022 and 3023 clockwise and counterclockwise, respectively, against the stud 3011 and at the same time against an indicator stud 3025 that is secured on plate 172 (FIG. 172).

As will be explained presently, the centralizer members 3022 and 3023 are individually rotated away from the indicator stud 3025 (FIG. 171), and, at the end of such rotation, a respective switch 3026 or 3027 is closed. To this end, an insulator 3028 is secured on centralizer member 3022 in alignment with switch 3026, and an insulator 3029 is secured on centralizer member 3023 in alignment with switch 3027. The switches 3026 and 3027 are secured on the plate 172 (FIG. 172).

Upon full forward line space operation, as will be described, a member 3030 (FIG. 173) is operated to release the pawl 3008 from ratchet wheel 2999. Member 3030 is pivoted on a rod 3031 that is secured at its ends to plates 172 and 173 (FIG. 172). A stud 3032 (FIG. 173) is secured on member 3030 and it extends under the pawl 3008. A torsion spring 3033 is connected to member 3030 and to a stop rod 3034 for urging the member clockwise in normal position against the stop rod as shown. Rod 3034 is secured on plates 172 and 173 (FIG. 172). A link 3035 (FIG. 173 pivotally connected to member 3030 and to the armature of a solenoid 3036. Solenoid 3036 is secured on plate 173 (FIG. 171).

A similar arrangement is provided for restoring the pawl 3018, after a reverse line space operation to be described. This arrangement is just like that just described, and it comprises a member 3037 (FIG. 173) pivoted on rod 3038, a stud 3039 secured on the member 3037, a spring 3040, rod 3041, a link 3042 and a solenoid 3043. The rods 3038 and 3041 are secured at their ends to the plates 172 and 173 (FIG. 172), like the rods 3031 and 3034 described above.

The arrangement is such that, upon operation of the forward motivating solenoid 3002 (FIG. 173), the solenoid pulls link 3003, rotates bellcrank 3004 clockwise and shifts pawl 3008 clockwise. Just prior to the end of this motion and prior to the instant bellcrank 3004 is stopped against rod 3017, a surface 3044 on pawl 3008 passed to the right of stud 3011 and the spring 3010 rotates the pawl into engagement with a tooth on ratchet wheel 2999, that is one tooth clockwise from the normal position of the pawl 3008. Upon deenergization of forward motivating solenoid 3002, as will be described, the spring 3005 returns the bellcrank 3004 and pawl 3008 counterclockwise. This counterclockwise movement of pawl 3008 pulls the now engaged stud 3001 and the ratchet wheel 2999 counterclockwise for rotating the previously described gears (FIG. 171), sprocket 2975 and the platen 90 counterclockwise one forward line space. As stud 3011 and its supporting member 302 are thus shifted counterclockwise, the stud 3011 rotates the centralizer member 3022 to engage the insulator 3028 with the switch 3026, and near the end of the counterclockwise motion, the insulator 3028 closes the switch 3026.

At the same time the stud 3011 (FIG. 173) is shifted counterclockwise about the axis of rotatable shaft 2994, it permits the spring 3020 to rotate pawl 3018 into engagement with the ratchet wheel 3000 for preventing over-rotation of the line space mechanism at the end of the forward line space operation.

Closure of switch 3026 (FIG. 171), at the end of the forward line space stroke as described, completes a circuit from a source of power (S) through the switch 3026, a wire 3045, and the solenoid 3036 as indicated. Operation of solenoid 3036 (FIG. 173) pulls link 3035 and rotates member 3030 counterclockwise against stop rod 3034. Such rotation of member 3030, by its stud 3032, rotates pawl 3008 out of engagement with ratchet wheel 2999 and above stud 3011. As the surface 3044 clears the stud 3011, the spring 3024 (FIG. 171) restores member 3022, stud 3011 and member 3021 back into registration with indicator stud 3025 as shown. Return of member 3022 and its insulator 3028 permits switch 3026 to open for deenergizing the solenoid 3036 and thus permitting the spring 3033 to restore member 3030 to the illustrated position. This also permits the spring 3010 to restore pawl 3008 back against stud 3011 (FIG. 173) as shown. The clockwise return of stud 3011 also lifts the pawl 3018 to the illustrated position out of engagement with the ratchet wheel 3000. Thus, the platen 90 is rotated forwardly one line space for each operation of the forward motivating solenoid 3002.

Upon operation of the reverse motivating solenoid 3012, it pulls link 3013, rotates bellcrank 3014 counterclockwise and likewise shifts pawl 3018. Prior to the instant bellcrank 3014 is stopped against rod 3007, a surface 3046 on pawl 3018 passes to the left of stud 3011 and the spring 3020 rotates the pawl into engagement with a tooth on ratchet wheel 3000 one tooth counterclockwise from the normal position of the pawl 3018. Upon deenergization of reverse motivating solenoid 3012, the spring 3015 returns the bellcrank 3014 and pawl 3018 clockwise. This movement of pawl 3018 pulls the now engaged stud 3011 and the ratchet wheel 3000 clockwise for rotating the previously described transmission gears (FIG. 171), sprocket 2975 and the platen 90 clockwise one reverse line space. As stud 3011 and its member 3021 are thus shifted clockwise, the stud rotates the centralizer member 3023 to engage its insulator 3029 with the switch 3027, and, near the end of this motion, the insulator closes the switch.

At the same time stud 3011 (FIG. 173) is shifted clockwise, it permits the spring 3010 to rotate pawl 3008 into engagement with the ratchet wheel 2999 for preventing overrotation of the line space mechanism at the end of the reverse line space operation.

Closure of switch 3027 (FIG. 171) at the end of the reverse line space stroke as described, completes a circuit from a source (S) through the switch 3027, a wire 3047 and the solenoid 3043 as indicated. Operation of solenoid 3043 (FIG. 173) pulls link 3042 and rotates member 3037 clockwise against rod 3041. Such rotation of member 3037, by its stud 3039, rotates pawl 3018 out of engagement with ratchet wheel 3000 and above stud 3011. As the surface 3046 clears the stud 3011, the spring 3024 (FIG. 171) restores centralizer member 3023, stud 3011 and member 3021 counterclockwise back into registration with indicator stud 3025 as shown. Return of member 3023 and its insulator 3029 permits switch 3027 to open for deenergizing solenoid 3043 and thus permitting the spring 3040 to restore member 3037 to the illustrated position. This also permits the spring 3020 to restore pawl 3018 back against stud 3011 (FIG. 173) as shown. The counterclockwise return of stud 3011 also returns the pawl 3008 to the elevated illustrated position out of engagement with the ratchet wheel 2999. Thus, the platen 90 is rotated reversely one line space for each operation of the reverse motivating solenoid 3012.

The line space circuits will now be described. A wire 3048 (FIG. 174) is connected to the normally closed switch 1213 and to the forward line space motivating solenoid 3002. A wire 3049 is connected between forward motivating solenoid 3002 and blade 114 in the switch 113 that is under the line space key 20. A wire 3050 is connected to the blade 116 of the same switch 113 and to the 4 code channel punch wire. A wire 3051 is connected between the wire 3048 and the reverse line space motivating solenoid 3012. A wire 3052 is connected to reverse motivating solenoid 3012 and to blade 114 in the switch 113 that is under the reverse line space key 21. A wire 3053 is connected to blade 116 under key 21 and to the wire 3050. A wire 3054 is connected to blade 117 under reverse line space key 21 and to the 5 code channel punch wire.

For deleting a forward line space code, a wire 3055 is connected between the wire 3052 and the forward line space terminal (4) (FIG. 70) which becomes effective upon operation of the solenoid 1091 that represent the code 4 as described. For deleting a reverse line space code, a wire 3056 (FIG. 174) is connected to the wire 3049 and to the reverse line space terminal (4,5) (FIG. 70) which becomes effective upon operation of the solenoids 1091 and 1092 that represent the code 4,5 as explained. Deletion of the line space codes will be discussed further hereinafter.

During normal forward operation of the machine and upon depression of the forward line space key 20 (FIG. 174), current flows from source (S) through the switch 1213 which is normally closed and which remains closed during forward operations, through wire 3048, it operates forward motivating solenoid 3002 (FIG. 171) to cock the line space mechanism for forward line spacing as described, it continues through wire 3049 (FIG. 174), through now closed switch 113 under the operated forward line space key 20, through wire 3050, the 4 code channel punch wire, normally through the switch 160 and the 4 channel punch solenoid in the main punch mechanism 161, through wire 162, and so on in the same manner as for any other normal text encoding operation. Thus, by depressing the line space key 20, the forward motivating solenoid 3002 is operated in preparation for a forward line space, the 4 code channel is punched and the forward tape cycle control 169 (FIG. 11) is prepared to control a forward step of the control tape 577 as described hereinbefore. Upon return of forward line space key 20 (FIG. 174) and breaking of contact in the switch 113 thereunder, forward motivating solenoid 3002 (FIG. 171) is deenergized and spring 3005 effects a forward line space of the platen 90 as described, the operated main punch mechanism 161 (FIG. 11) is restored and the forward tape cycle control 169 operates to cause a forward step of the tape 577 as described.

Normally, upon depression of the reverse line space key 21 (FIG. 174) current travels from source (S) through switch 1213, wire 3048, wire 3051, reverse motivating solenoid 3012 to cock the line space mechanism for reverse line space as described, wire 3052, now closed switch 133 under reverse line space key 21, wires 3053, 3050 and 3054, and 4 and 5 code channel punch wires, switch 160, the solenoids 565 in punch mechanism 161 for punching the reverse line space code, through wire 162, and so on as for any other text encoding operation. Thus, by depression of the reverse line space key 21, the reverse motivating solenoid 3012 is operated to prepare for reverse line space, the 4 and 5 code channels are punched and the forward tape cycle control 169 (FIG. 11) is prepared to control a forward step of the control tape 577 as described hereinbefore. By return of reverse line space key 21 (FIG. 174) and the breaking of contact in the switch 113 thereunder, reverse motivating solenoid 3012 (FIG. 171) is deenergized and spring 3015 effects a reverse line space as described, the operated punch mechanism 161 (FIG. 11) is restored and the tape cycle control 169 operates to cause a forward step of the control tape 577 as described.

When the punch control key 602 (FIG. 48) is in "off" position and when the encoding, tape handling and automatic deleting operations are not performed as previously described, the code channel punch wires are grounded at switches 160 as described and the line space mechanism described in connection with the FIG. 174 is operable the same as at any other time. At such times, the line space mechanism will still operate according to the line space key 20 or 21 depressed as described, even at such times and when the delete key 140 may be operated for manual back spacing operations to be described.

38. DELETING FUNCTIONS

Deletion of functions generally includes deletion of the particular function code on the control tape 577, and reversal of the function in the composer so the composer is left in the condition it was in before the function was performed and encoded.

Since the just described line space arrangement is fresh in mind, deletion of line space functions will be described first.

When the delete key 140 (FIG. 3) is depressed, deleting operations are initiated and proceed under the control of previously punched codes on the control tape 577, as previously described.

When the back space reader 1097 (FIG. 66) reads a line space code (4), the back space decoder 1095 is conditioned accordingly and it completes the circuit from source of power (S) through switch 1213 (FIG. 174) in the back space tape cycling mechanism 1159, the wires 3048 and 3051, reverse motivating solenoid 3012 to prepare for reverse line spacing as described, wires 3052 and 3055, through the now effective code 4 circuit in the back space decoder 1095, wires 1156 and 1157 (FIG. 66) and goes to ground through the solenoid 1158. Operation of the solenoid 1158, in addition to preparing for a sequential reverse step of the control tape 577 and deletion of the just read code as described, operates the back space tape cycling mechanism 1159 to open its switch 1213 (FIG. 174) as described. When switch 1213 opens, the reverse motivating solenoid 3012 is deenergized for effecting reverse line spacing as described and the solenoid 1158 is deenergized for permitting completion of the sequence and normalizing of the back space tape cycling mechanism 1159 as described.

When the back space reader 1097 (FIG. 66) reads a reverse line space code 4,5, the back space decoder 1095 is conditioned accordingly and it completes the circuit from source (S) through switch 1213 (FIG. 174) in back space tape cycling mechanism 1159, wire 3048, forward motivating solenoid 3002 to prepare for forward line spacing as described, wires 3049 and 3056, through the now effective code 4,5 circuit in the back space decoder 1095, wires 1156 and 1157 (FIG. 66), and solenoid 1158. Operation of solenoid 1158, in addition to preparing for a sequential reverse step of the control tape 577 and deletion of the just read code as described, operates the back space tape cycling mechanism 1159 (FIG. 174) to open its switch 1213 as described. Opening of switch 1213 deenergizes forward motivating solenoid 3002 for effecting forward line spacing as described and this also deenergizes the solenoid 1158 for permitting completion of the deleting sequence and the normalizing of back space tape cycling mechanism 1159 as described.

Deletion of the bold and regular codes (4,6,7 and 5,6,7, respectively) will now be described.

As previously described, the initial delete circuit operates solenoid 1004, 1005 and 1006 (FIG. 66) for rendering ineffective a time delay detent 517 (FIG. 33), for example, in the print control, bold and regular, and the upper lower case snap switches, respectively. Thus, the time delay detent 2546 (FIG. 157) is rendered ineffective, as described, during deleting operations. It should also be remembered that depression of the delete key 140 breaks the hold and regular encoding circuit between wires 538 and 539 for preventing such encoding operations during deleting sequences.

The bold and regular circuits that lead through the back space decoder 1092 will now be described. A wire 3057 is connected between the switch 2113, in the back space tape cycling mechanism 1159, and the solenoid 2507 under the bold and regular shift key 2487. A wire 3058 is also connected to solenoid 2507 and it is connected to the regular face 5,6,7 (FIG. 70) terminal in the back space decoder 1095 (FIG. 157). A wire 3059 is connected between wire 3057 and the solenoid 2504. A wire 3060 is connected to solenoid 2504 and to the bold face 4,6,7, code (FIG. 70) terminal in the back space decoder 1095 (FIG. 157).

Upon back space reading the regular code 5,6,7, and the resulting operation of the back space decoder 1095, the circuit becomes effective from source (S) through the normally closed switch 1213, wire 3057 solenoid 2507 for returning the bold and regular shift key 2487 to the "bold" position as described, wire 3058, the operated back space decoder 1095, wires 1156 and 1157 as described, and it goes to ground through solenoid 1158 in the back space tape cycling mechanism 1159 for continuing the normal deleting cycle. Operation of solenoid 1158 opens the switch 1213 for breaking the just described circuit, and operation of this solenoid 1158 also continues the cycle that includes a reverse step of the control tape 577 and deletion of the just read code as described.

When bold and regular shift key 2487 is shifted to "bold" position by solenoid 2507, the brush 2497 is shifted on to contact 2498 as described. This completes the circuit direct from source (S) and brush 2508, in machines that do not have the clear key feature, or from source (S) and contracts 2654 and 2653 (FIG. 161) under the clear key 2633, as the case may be. However, the circuit passes through momentarily effective brushes 2508 and 2510 (FIG. 157), wire 2547, solenoid 2548 for returning the bold and regular snap switch arrangement to bold condition as described, wire 2549 and goes to ground through contact 2498, brush 2497 and strip 2499 as described. As soon as solenoid 2548 is operated, the disk 2512 is snapped clockwise to render the brush 2510 ineffective and to break the just reiterated circuit as described. In this manner, the machine is returned to "bold" condition, whenever the regular code 5,6,7 is deleted.

Upon reading the "bold" code 4,6,7, and the resulting operation of the back space decoder 1095, the circuit becomes effective from source through switch 1213, wire 3057, wire 3059, solenoid 2504 for returning the bold and regular shift key 2487 to "regular" position as described, wire 3060, the operated decoder 1095, wires 1156 and 1157 as described, and it goes to ground through solenoid 1158 for continuing the normal deleting cycle as described.

When bold and regular shift key 2487 is shifted to regular position by solenoid 2504, the brush 2497 is shifted on to contact 2500 as described. This completes the circuit through momentarily effective brushes 2508 and 2509, wire 2513, solenoid 2514 for returning the snap switch to regular condition as described, wire 2515, and it goes to ground through contact 2500, brush 2497 and conductor strip 2499 as described. As soon as solenoid 2514 is operated, the disk 2512 is snapped counterclockwise to render brush 2509 ineffective and to break the just reiterated circuit as described. In this manner, the machine is returned to regular condition, whenever the bold code 4,6,7 is deleted.

The print and no print circuits that lead through the back space decoder 1095 (FIG. 158) will now be described. It should be remembered that the time delay detent 2616 is rendered ineffective by the initial delete circuit as previously described, and that the print and no print encoding circuits are rendered ineffective, by the operated delete key 140, during deleting operations as previously described. A wire 3061 is connected between the switch 1213 and the solenoid 2577 under the print control key 2488. A wire 3062 is connected to solenoid 2577 and it is connected to the print 4,5,7 (FIG. 70) terminal in the back space decoder 1095 (FIG. 158). A wire 3063 is connected between wire 3061 and solenoid 2575. A wire 3064 is connected to solenoid 2575 and to the no print 4,5,6 code (FIG. 70) terminal in the back space decoder 1095 (FIG. 158).

Upon back space reading of a print code 4,5,7 and the resulting operation of the back space decoder 1095, the circuit becomes effective from source (S) and switch 1213, through wire 3061, solenoid 2577 for returning print control key 2488 to the no print position as described, wire 3062, the operated back space decoder 1095, wires 1156 and 1157 as described, and it goes to ground through solenoid 1158 for continuing the normal deleting cycle including opening of switch 1213 that causes a reverse step of the control tape 577 and deletion of the just read code as described.

When print control key 2488 is shifted to the no print position, by solenoid 2577 in this case, the brush 2568 is shifted on to contact 2569 as described. This completes the circuit through momentarily effective brushes 2578 and 2580, wire 2617, solenoid 2618 for returning the snap switch to no print condition as described, wire 2619, and it goes to ground through contact 2569, brush 2568 and conductor strip 2570 as described. As soon as no print shift motivating solenoid 2618 is operated, the disk 2582 is snapped clockwise to render brush 2580 ineffective and to break the just reiterated circuit as described. In this manner the machine is returned to no print condition whenever the print code 4,5,7, is deleted.

Upon back space reading of a no print code 4,5,6 and the consequent operation of the back space decoder 1095, the circuit becomes effective through switch 1213, wires 3061 and 3063, solenoid 2575 for returning print control key 2488 to the print position, wire 3064, the operated back space decoder 1095, wires 1156 and 1157 as described, and it goes to ground through solenoid 1158 for continuing the deleting cycle as described.

When print control key 2488 returns to print position, brush 2568 is returned to contact 2571 as described. This completes the circuit through momentarily effective brushes 2578 and 2579, wire 2583, solenoid 2584, wire 2585, and it goes to ground through contact 2571, brush 2568 and conductor strip 2570 as described. As soon as solenoid 2584 is operated, the disk 2582 is snapped counterclockwise to render brush 2579 ineffective and to break the just reiterated circuit as described. In this manner, the machine is returned to normal print condition whenever the no print code 4,5,6, is deleted.

During deleting operations, the stop printer code 5,6, (FIG. 70) the clear code 3,4,6,7 and the conditioning codes 1,5,6,7; 1,4,6,7; 1,3,6,7; 1,3,5,7; 1,3,4,7; 1,2,6,7; and 1,2,4,7; 1,2,5,7, cause no change in the condition of the composing machine. Therefore, in order to delete these codes, it is only necessary for the machine to reverse the tape 577 and delete the code, which are operations also required when deleting other codes. For convenience, deletion of these above mentioned codes is handled in much the same manner as the deletion of already deleted codes, previously described under Topic 19. To this end, the deleted code circuit wire 1272 is connected by a wire 3065 to the stop printer code 5,6 terminal in the back space decoder 1095, by a wire 3066 to the clear code 3,4,6,7 terminal, and by wires 3067–3074 to the respective conditioning code terminals mentioned above. Thus, during deleting operations, when one of the codes now under discussion is sensed and the back space decoder 1095 (FIG. 66) is operated accordingly, current will pass through the normally closed switch 1213 (FIG. 80) wire 1294, wire 1272, one of the respective wires 3065–3074 (FIG. 70) and the operated back space decoder 1095 (FIG. 66), wire 1156, wire 1157 and it goes to ground through the solenoid 1158 in the back space tape cycling mechanism 1159. As described, operation of solenoid 1158 causes switch 1213 (FIG. 80) to open, whereupon solenoid 1158 is deenergized to continue the cycle, and to bring about the back spacing of the control tape 577 and the deleting of the code.

Once the codes are deleted they are no longer effective as distinctive codes but rather serve only as delete codes for cycling the tape through the back space reader 1097 during tape return as discussed under Topic 19, and for cycling the tape through the main reader as described.

39. TAPE FEED KEYS

Tape feed keys 3075 and 3076 (FIGS. 3,175,176) are operable for automatically feeding the control tape 577 through the main punches 567 to provide clear unpunched tape there along that may be used for pencil or other notations directly on the tape 577. The additional space on the tape may also be used to indicate clearly the beginning and end of each piece of work, and to make it easier to tear out a piece of work without danger of damaging the codes at the beginning and end of the work. Notations on such blank spaces are extremely useful, particularly when filing or identifying separated pieces of tape.

Such blank space may also be provided within a line at a point where it is desirable to have the reproducer 2279 stop for some manual conditioning of the reproducer 2279. In such an instance, a tape feed key in the composer may be used, special instructions written in the space and the text continued thereafter in the usual manner. When this blank tape 577 is introduced in the main reader, the main decoder 2292 (FIG. 143) is therefore not operated and the reproducer 2279 stands idle, and the operator of the reproducer 2279 can then read the special instruction, perform according to the instructions and manually start the reproducer 2279. To start the reproducer 2279, the operator will cause the feed-read switch means 2287 to be restored to the illustrated position, and he may do this by operating a tape feed key (not shown here) in the reproducer 2279 and described particularly in our co-pending application Ser. No. 212,895 now U.S. Pat. No. 3,945,480 for inducing a momentary current in a known manner into wire 2304, through now closed switch 2298, wire 2305 and solenoid 2301 for operating the solenoid 2301. As described, operation of solenoid 2301 restores the switch means 2287 for closing its switch 2297 and for thus cycling blank tape 577 through the main reader. After feeding the blank tape 577, when the next code is read, the solenoid 2286 is energized, as described, and the reproducer 2279 is again conditioned to resume reproduction as controlled by the encoded text.

The tape feed keys 3075 (FIG. 175) and 3076 (FIG. 176) are both pivoted on rod 2634 and they extend through guidance and rotation limit slots therefor in channel member 624, and in these respects they are like the condition key 2707 (FIG. 160).

A torison spring 3077 (FIG. 175) is connected to tape feed key 3075 and to plate 2637 for urging the key up in the illustrated position. An insulator 3078 is secured on tape feed key 3075 and a brush 3079 is secured on the insulator. Brush 3079 is tensioned against an insulator 3080 which is secured on a bracket 3081, and the bracket is secured on plate 2637.

In one form of the tape feed key 3075 (FIG. 54), the tape 577 is fed forwardly only one step upon each operation of the key 3075. In this arrangement, a pair of contacts 3082 and 3083 are secured on the insulator 3080 in positions to be engaged by the brush 3079 upon depression of the tape feed key 3075. A wire 3084 is connected between the contact 3082 and the wire 694, and a wire 3085 is connected between contact 3083 and the wire 167. Upon depression of the tape feed key 3075, the circuit is effective from source (S) and wires 137 and 693, wires 694 and 3084, contact 3082, brush 3079, contact 3083, wires 3085 and 167 and it goes to ground through solenoid 168. As described, operation of solenoid 168 cocks the forward tape cycling mechanism 169 for operation. When the tape feed key 3075 is released, the spring 3077 restores the key and breaks the circuit between contacts 3082 and 3083 for deenergizing solenoid 168. Whereupon, the forward tape cycling mechanism 169 operates to close the switch 691, and to thus render effective the circuit through wire 694, switch 691, wire 695, and the solenoid 696 for advancing the control tape 577 one step as previously described. As the control tape 577 is advanced one step, the switch 697 is snapped closed for rendering effective the circuit through wire 694, solenoid 698, wire 699 and the switch 697 as described. Operation of solenoid 698 restores the forward tape cycling mechanism 169 and opens switch 691 for deenergizing solenoid 696 as described. Whereupon, switch 697 is opened for deenergizing solenoid 698 as described. Thus, the control tape 577 is advanced one blank space through the main punches 567 for each operation of the tape feed key 3075. One such blank space, within a line of text codes, is sufficient to stop the normal progress of the reproducer 2279, as previously described and thus the tape feed key 3075 may be used for this purpose instead of the stop printer key 2883 (FIG. 3) previously described. The tape feed key 3075 (FIG. 54) may also be operated a number of times in succession for advancing the control tape 577 as many spaces for notation purposes or whatever, as described.

A second form of the tape feed key 3075 (FIG. 175) will now be described. In this form, the control tape 577 is fed consecutive steps as long as the tape feed key 3075 is held depressed by the operator. In this form, in order to prevent unnecessary operation of solenoid 698 (FIG. 54) during tape feed cycling of the control tape, the wire 699 is replaced by wires 3086 and 3087 (FIG. 177) together with normally effective contacts 3088 and 3089 under tape feed key 3075, between the solenoid 698 and the switch 697. Wire 3086 is connected to solenoid 698 and contact 3088. Contacts 3088 and 3089 are secured on insulator 3080 in position to be engaged by brush 3079 only in normal position. Wire 3087 is connected between contact 3089 and the switch 697. Thus, normally the solenoid 698 is operable as controlled by switch 697 during normal forward tape cycling as described previously, but the solenoid 698 is not operable during tape feed cycling when the tape feed key 3075 is operated and the contacts 3088 and 3089 are therefore ineffective. A wire 3090 is connected from source of power (S) to a contact 3091. A contact 3092 is connected by a wire 3093 to the normally closed switch 735. Contacts 3091 and 3092 are secured on insulator 3080 in position to be engaged by brush 3079 only when the tape feed key 3075 is operated. Upon depression of the consecutive tape feed key 3075 the brush 3079 is first shifted off of contacts 3088 and 3089, and then onto contacts 3091 and 3092. Whereupon, the circuit is completed from source of power (S) through wire 3090, contacts 3091 and 3092, wire 3093, switch 735 wires 1263 and 695, and solenoid 696 for advancing the control tape as described. Upon a full step advance of the central tape, the switch 735 is snapped open for deenergizing solenoid 696, whereupon the switch 735 is again snapped closed as described. Thus, it can be seen that the control tape 577 is advanced one or more blank consecutive steps depending on how long the consecutive tape feed key 3075 is depressed. Upon manual release of the tape feed key 3075, the spring 3077 restores the key, disengaging brush 3079 from contacts 3091 and 3092 for terminating the tape feed operations and reengaging the brush with contacts 3088 and 3089 for rendering the solenoid 698 again operable in normal forward tape cycling operations as described. This second form of the tape feed key 3075 may be peferred by more operators, since by a momentary operation of the key 3075 the control tape 577 may be fed one step, and since by holding the tape feed key down a longer period of time the control tape is advanced a plurality of consecutive steps with less hand travel than when the one step tape feed key 3075 is employed as shown and described previously in connection with FIG. 54.

The tape feed key 3075 (FIGS. 3 & 176) will now be described. This is called a "12" step tape feed only because the arrangement utilizes the end of the line tape feed mechanism 1422 shown and described in connection with FIG. 91 and because this mechanism feeds the control tape 577 (in one motion) the equivalent of 12 steps as illustratively shown in this particular embodiment. The equivalent movement may be increased or decreased without departing from the spirit of the invention, but for the purpose of coordinating with the other unitary tape handling mechanism in the machine, the amount should be commensurate with a step of the tape. The term "12 step tape feed" is used also to differentiate from the one step and consecutive tape feed arrangement previously described.

The 12 step tape feed key 3076 (FIG.176) is urged to the illustrated normal position by a torsion spring 3094 connected to the 12 step tape feed key and to the plate 2637. An insulator 3095 is secured on 12 step tape feed key 3076 and a brush 3096 is secured on the insulator. Brush 3096 is pressed against an insulator 3097 which is secured on an angle bracket 3098 that is secured on plate 2637. In normal position of the 12 step tape feed key, the brush 3096 is engaged with two contacts 3099 and 3100 that are secured on insulator 3097. When the key 3076 is operated the brush is shifted out of engagement with contacts 3099 and 3100 and into engagement with three contacts 3101, 3102 and 3103 on the insulator 3097. A stud 3104 is secured on key 3076. A pawl 3105 is pivoted on rod 2640 and it is normally urged against stud 3104, as shown, by a torsion spring 3106 connected to the pawl 3105 and plate 2637. A link 3107 is pivotally connected to the pawl 3105 and to the armature of a solenoid 3108 which is secured on plate 607.

In machine equipped with the 12 step tape feed arrangement now under discussion, the wire 1425 (FIG. 83) is not connected directly to the switch 1423 of the end of the line tape feed mechanism 1422 as shown here, but instead it is connected to the normally effective contact 3099 (FIG. 178) under the 12 step tape feed key 3076 and a wire 3109 is connected between the normally effective contact 3100 and the switch 1423. Thus, the solenoid 1424 (FIG. 83) will normally operate under control of the switch 1423 in the same manner as described previously, but when the 12 step tape feed key 3076 (FIG. 178) is operated and contacts 3099 and 3100 are not connected by brush 3096 as described, the solenoid 1424 (FIG. 83) will not be needlessly operated during 12 step tape feed operations.

The circuitry of performing a 12 step tape feed will now be described. A source of power (S) is connected to the contact 3101 as indicated in FIG. 178. A wire 3110 is connected to contact 3102 and to the solenoid 3108. A wire 3111 is connected between solenoid 3108 and the wire 3109. A wire 3112 is connected to contact 3103 and to the solenoid 1421. Upon depression of the 12 step tape feed key 3076, the brush 3096 is first disengaged from contacts 3099 and 3100 as described and then it is engaged with contacts 3101–3103 and the key 3076 is latched down by pawl 3105. Upon engagement of contacts 3101–3103 by brush 3096, current travels from source (S) through contact 3101, brush 3096, contact 3103, wire 3112 and it goes to ground through solenoid 1421. When solenoid 1421 is operated, it engages the gear segment 1447 with gear 1465, and then rotates the shaft 739 and feeds the control tape 577 (FIG. 38) the end of line amount (12 steps) into loop 753 in exactly the same manner as described previously. As the rack 1447 (FIG. 91) reaches its fully operated position, insulator 1467 closes the switch 1423, as described, for completing the circuit through contact 3101 (FIG. 178), brush 3096, contact 3102, wire 3110, solenoid 3108, wires 3111 and 3109, and the closed switch 1423. Operation of solenoid 3108 pulls link 3107 (FIG. 176) and rotates pawl 3105 to unlatch the 12 step tape feed key 3076. Whereupon, spring 3094 restores the key 3076 and breaks the just described circuits, and the operated line tape feed mechanism shown in FIG. 91 restores automatically as previously described. Thus, it is seen that one operation of the 12 step tape feed key 3076 (FIG. 178) automatically causes the control tape 577 to be fed the end of line amount (12 steps) in one motion and this motion feeds the tape faster than as if the tape were fed incrementally the same amount by single consecutive steps.

A final combined form of tape feed key will now be described. This key 3113 (FIG. 179), combined with a presettable key 3114 as will be described, is operable for causing either a 12 step or a consecutive tape feed operation as determined by the preset position of the key 3114. As may be seen by one schooled in the art, the one step tape feed feature (described in connection with FIG. 54) may be substituted for the consecutive tape feed feature of the combination to be described.

In one preferred form of the machine, the tape feed key 3113 (FIG. 179) and the presettable key 3114 is substituted for the tape feed keys 3075 and 3076 (FIG. 3), however all of these keys may be employed in one machine without departing from the spirit of the inventions included herein.

The structure of tape feed key 3113 (FIG. 179) is the same as that described for stop printer key 2883 (FIG. 167), except two brushes are provided under tape feed key 3113 (FIG. 179) and except for a pivot stud connection 3115 to be described presently. The structure of presettable key 3114 is substantially the same as that described for clear-set key 2824 (FIG. 166), except the presettable key 3114 (FIG. 179) includes an integral arm 3116 for at times cooperating with the stud 3115. The keys 3113 and 3114 are preferably located in adjacent planes where the stud 3115 under tape feed key 3113 can extend beyond engaging alignment for at times receiving direct action from integral arm 3116 of presettable key 3114. Stud 3115 is secured at right angles to the armature of a solenoid 3117, and it serves also as a pivot connection between a link 3118 and the armature. The link 3118 is also pivotally connected to a pawl 3119 which is provided for at times latching tape feed key 3113 in operated position. Presettable key 3114 is normally held in one or the other of its indicated positions by a yieldable detent 3120. In the illustrated clockwise position of presettable key 3114, its integral arm 3116 does not interfere with stud 3115 or the latching action of pawl 3119 under tension of the spring 3121. However, when presettable key 3114 is shifted to its "consecutive" position, its arm 3116 shifts stud 3115 rightward pulling link 3118 and rotating pawl 3119 counterclockwise to ineffective position, whereupon tape feed key 3113 may be manually operated and released and the tape feed key 3113 will be returned by its spring 3122 without being latched by the pawl 3119.

When the tape feed key 3113 is in normal position, a brush 3123 carried by the key 3133 is engaged with separate contacts that are respectively connected with wires 3086 and 3087 for normally rendering the solenoid 698 operable as controlled by switch 697 and as described for this same circuit in connection with FIG. 177. At the same time, a brush 3124 (FIG. 179) is also engaged with separate contacts that are respectively connected with wires 1425 and 3109 for normally rendering the solenoid 1424 (FIG. 83) operable as controlled by switch 1423 and as described for this same circuit in connection with FIG. 178. Upon depression of tape feed key 3113 (FIG. 179), the just described circuits through brushes 3123 and 3124 are broken for rendering the solenoids 698 and 1424 (FIG. 83) inoperable during the tape feed operations to be described now.

Upon full depression of tape feed key 3113 (FIG. 179), the brushes 3123 and 3124 are engaged with contacts 3125, 3126, 3127 and 3128, and when the presettable key 3114 is in the 12 step position, the pawl 3119 latches the tape feed key 3113 in operated position as described. A wire 3129 is connected to a source of power (S) and to the contacts 3125 and 3126. A wire 3130 is connected to contact 3128 and a contact strip 3131. A brush 3132 is carried by presettable key 3114 and it is insulated therefrom in the usual manner. In the 12 step position of presettable key 3114, the brush 3132 is engaged with the strip 3131 and with a contact 3133. When key 3114 is shifted to the consecutive position, brush 3132 is slid along strip 3131, and it is disengaged from contact 3133 and then engaged with a contact 3134. A wire 3135 is connected between contact 3133 and the solenoid 1421. A wire 3136 is connected to contact 3134 and to the switch 735.

When presettable key 3114 is in the 12 step position and the tape feed key 3113 is depressed, the tape feed key 3113 is latched down as described and current travels from source of power (S) and wire 3129 through contact 3126, brush 3124, contact 3128, wire 3130, strip 3131, brush 3132, contact 3133, wire 3135 and it goes to ground through the solenoid 1421 for advancing the control tape 577 the end of line amount (illustratively the equivalent of 12 steps in one motion) through the main punches 567 as described. At this motion of the tape is completed, the switch 1423 is closed, as described, for completing the circuit from source (S) and wire 3129, through contact 3125, brush 3123, contact 3127, a wire 3137, the solenoid 3117, a wire 3138, the wire 3109 and the now closed switch 1423. When solenoid 3117 is thusly operated, it pulls link 3118 and rotates pawl 3119 to release the tape return key 3113. Whereupon, spring 3122 restores the tape return key 3113 and thus breaks the just described circuits through the contacts 3125–3128, and remakes the normal circuits as described.

When the presettable key 3114 is shifted to the "consecutive" position, its arm 3116, stud 3115, and link 3118 rotates pawl 3119 to ineffective position, as described, for permitting manual operation and random manual release of the tape feed key 3113. Under this condition, upon depression of tape feed key 3113, current will travel from source (S) and wire 3129, through contacts 3126 and 3128 as described, wire 3130, strip 3131 and contact 3134 as described, wire 3136, normally closed switch 735, wires 1263 and 695, and solenoid 696 for advancing the control tape 577 one step, as described. As also described, if the operator holds the tape feed key 3113 down for more than one step of the tape, the switch 735 opens and closes for causing as many additional steps of the tape, the same as described in connection with FIG. 177. Since the pawl 3119 (FIG. 179) is held ineffective under the example condition, the tape feed key 3113 may be released by the operator for terminating the consecutive tape feeding process whenever desired.

40. GENERAL KEY LOCKS

A general key lock mechanism 3139 (FIGS. 4, 12, 44, 57, 117 and 118) is generally speaking a customary ball type interlock lock arrangement for preventing depression of one keyboard key when any other key is operated. However, the interlock mechanism diclosed herein is designed to include several novel features that will be covered in the accompanying claims.

The key lock mechanism 3139 is comprises of a line of balls 3140 (FIG. 117) that are received in generally tubular recesses formed in ball cages 3141, 3142, 3143, 3144 and 3145 (FIG. 118). These cages are secured on the channel member 624 (FIGS. 117 and 118) as by screws 3146. A rightward extension of this lock mechanism 3139 is comprised of additional balls 3140, which are held in a cage 3147 (FIG. 118) that is pivoted on a rod 3148. Rod 3148 is supported on a bracket 3149, which is secured on the main frame member 1. Normally, the balls in cage 3147 are in alignment with the balls in cage 3145 for normal cooperation among the balls 3140 in the entire lock mechanism 3139. However, in clearing operations, only, as will be described later, the cage 3147 (FIG. 84) is pivoted counterclockwise about rod 3148 for rendering that portion of the lock mechanism 3139 ineffective for blocking operation of only those keys that may be shifted during the clearing operation.

The distance center to center of adjacent keys is never less than equal to the diameter of one of the balls 3140 (FIG. 118), and when the space is greater than one ball, usually the distance center to center is commensurate with the diameter of the balls. However, when the distance is more than one ball and a fraction thereof, one or more balls and a plug 3150 (equal to one or more balls and the required fraction) is used to account for the odd space. The balls 3140 and plugs 3150 are adjustable to include the thickness of only one key that may be interposed thereamong at any one time, by a threaded plug 3151 screwed into threads therefor in the rightward end of the tubular recess of cage 3147 and a similar threaded plug 3152 (FIG. 117) in the left end of cage 3141. The cages are formed to include a clearance slot 3153 to permit free passage for each key's interposer, for example, the interposer portion 197 (FIG. 14) of tape return key 138, between the adjacent balls 3140 that are generally contiguous at that point. When some other key is depressed and the balls 3140 are held against each other under the portion 197, the tape return key 138 is locked thereby against any effective operation. However, upon full depression of the tape return key 138 as described, an interposer extension portion 3154 is lodged between the adjacent balls 3140 for locking all other keys against operation during the tape return operations. Other interlock means between the tape return key 138 and the delete key 140 (FIG. 3) will be described later.

The line delete key 1479 is equipped with an interposer 3155 (FIG. 141) that together with the adjacent balls 3140 prevents operation of the key when another key is operated. However, the interposer 3155 is such that it will pass through and beyond the balls 3140 by the time the line delete key 1479 is fully depressed. This is done in order to permit an interposer surface 3156 (FIG. 84) on interposer 1347 to enter between a pair of balls 3140 for locking the keyboard, when the solenoid 1337 is operated automatically during the carriage return encoding function following line delete as described under Topic 35. "LINE DELETE". At the end of line delete and carriage return operations as also described, the solenoid 1353 is operated for restoring the interposer 1347 and this withdraws the interposer surface 3156 from the ball locks, and the solenoid 2204 (FIG. 141) is operated to release the line delete key 1479 and the interposer 3155 again passes through the locks as the key returns to the illustrated position.

The delete key 140 (FIG. 15) has an interposer 3157 which enters between a pair of the balls 3140 for locking the keyboard during deleting operations and which is blocked by the balls for preventing effective operation of the delete key 140 when some other interposer is operated. Since the tape return key 138 (FIG. 3) should be operated after the delete key 140 is used and since the tape return key 138 should not be used unless the delete key 140 were used, locking means are provided for blocking all keys except the delete key 140 and the tape return key 138 following an operation of the delete key 140 and for blocking operation of the tape return key 138 except at times when the delete key 140 has been operated. These locking means will now be described.

It should be recalled that the operator merely depresses the delete key 140 to correct or change text and functions already encoded on the control tape 577. This causes the back space function and causes the control tape to be fed reversely and at the same time a delete code is punched on each code step of the tape as described under Topic 17. When the unwanted codes have been thusly deleted, the operator releases the delete key 140. At this point, no encoding must be done before fresh tape is made available for new text and function codes. To make fresh tape available, the operator next depresses the tape return key 138. This causes the deleted tape to move through the main punches 567 and puts fresh tape in position ready for further encoding operations as described in Topic 18. Following deleting operations, it can be seen from the above that improper performance of encoding operations that would result from misoperation of text and function keys before the required operation of the tape return key 138, would result in these codes being punched on already deleted code portions of the control tape 577. Thus, after operation of the delete key 140, the next key used must be the tape return key 138 and no other, so fresh tape is properly made availabe.

The means for enforcing manual operation of the tape return key 138, following operation of the delete key 140, will now be described.

Figures 13, 14:
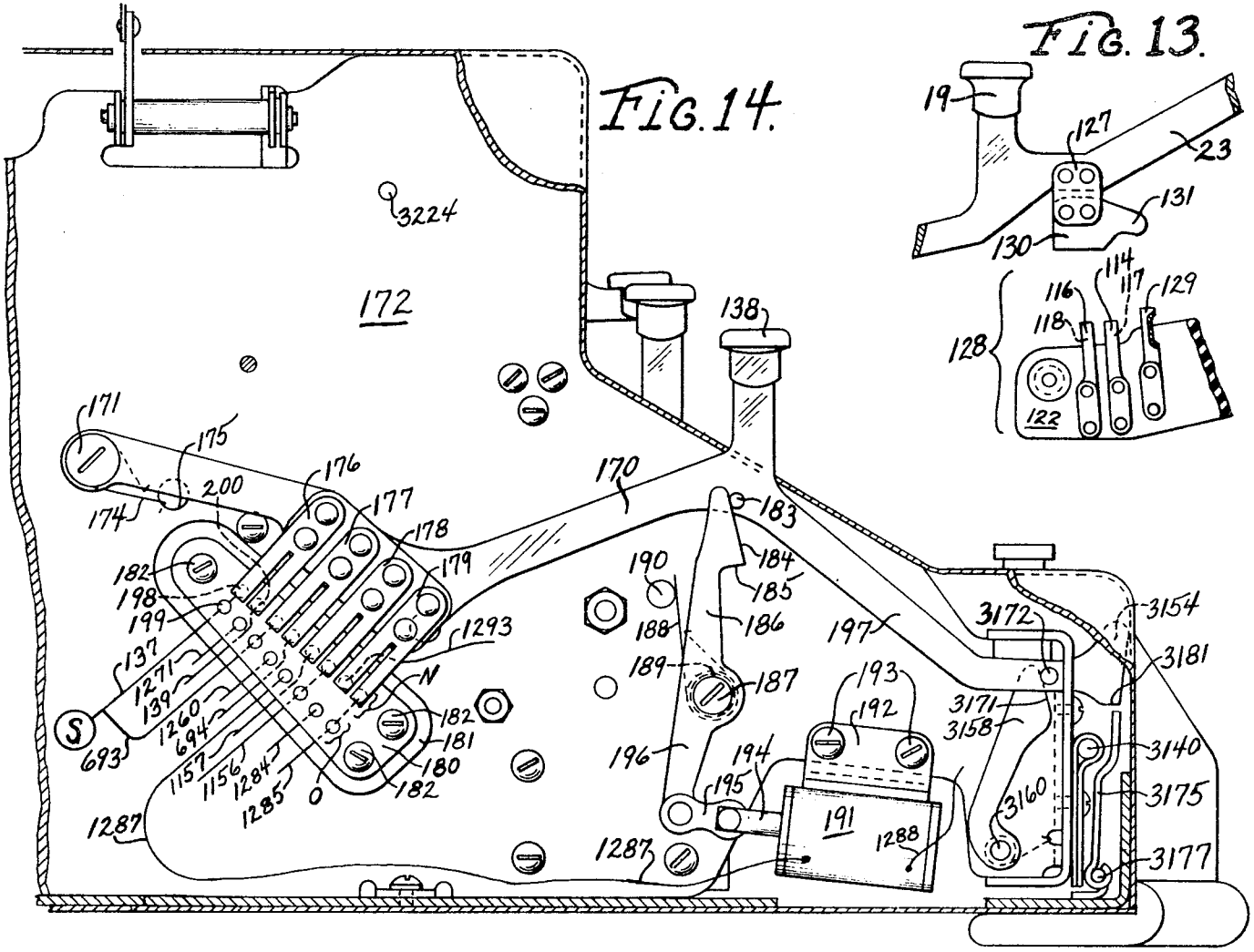
FIG. 13 is a fragmentary right side view of part of the underline key and its coding switch.
FIG. 14 is a fragmentary left side elevational view of the tape return key, taken generally on line 14—14, FIG. 3.

A lever 3158 (FIG. 14) and a lever 3159 (FIG. 15) are secured on a rotatable shaft 3160 so that any rotational movement of one lever 3158 or 3159 will be duplicated by the other. Shaft 3160 is pivoted in holes therefore in plates 173 and 172 (FIG. 14). An interposer arm 3161 (FIG. 15) is pivoted on a stud 3162 secured on delete key lever 201. A latch 3163 is pivoted on a stud 3164 that is secured on interposer arm 3161. Studs 3165 and 3166 are secured on latch 3163. A torsion spring 3167 is anchored on delete key lever 201 and, being supported on the extended head of stud 3162, urges the stud 3166 and latch 3163 counterclockwise against a stop stud 3168 which is secured on interposer arm 3161.

Latch 3163 has a latching surface 3169 adapted for latching on a stud 3170 which is secured on delete key lever 201. Interposer arm 3161, between latch 3163 and the extremity of the interposer arm 3161, is laterally formed so the extremity lies in the same vertical plane as the delete key lever 201 whereby said extremity can pass through the same slot and between the same pair of balls (3140) (FIG. 16) Upon return of the delete key 140.

A cam surface 3171 (FIG. 14) on lever 3158 normally lies against a stud 3172 secured on tape return key lever 170. A torsion spring 3173 (FIG. 15) is connected to lever 3159 and it is anchored in a known manner for urging the unit formed of lever 3159, shaft 3160 and lever 3158 (FIG. 14) clockwise to where the cam surface 3171 rests against the stud 3172. The latch 3163 (FIG. 15) is normally disengaged from stud 3170 and the extremity of interposer arm 3161 normally rests on a stop bracket 3174, while the delete key lever 201 is in the normal position as shown. Stop bracket 3174 is secured on channel member 624.

When the delete key lever 201 is operated as explained its interposer 3157 enters the balls 3140 so as to lock all other keys. Near the end of the downward operation of delete key lever 201, its stud 3170 acts against latch 3163, rotating the latch clockwise against tension of spring 3167, until the latch surface 3169 moves over stud 3170 at substantially the end of the operation of delete key lever 201. When the delete key 140 is released, the delete key lever 201 will move upwards and interposer arm 3161 and its latch will be pulled up into the ball locks in the position shown in FIG. 16. Since the extremity of interposer arm 3161 is in the same vertical plane and the same ball lock slot as just previously occupied by the extremity of delete key lever 201, it will cause the ball locks to refuse passage of another key until the interposer arm 3161 is released and moved out of the ball locks.

When the tape return key 138 (FIG. 14) is depressed, the tape return key lever 170 and the stud 3172 move downward. Stud 3172 acts against cam surace 3171 rotating arm 3158 counterclockwise and the rotary motion transmitted through shaft 3160 moves arm 3159 (FIG. 16) counterclockwise the same amount. Rotating arm 3159 will thereupon act on stud 3165 to rotate latch 3163 clockwise thereby disengaging latching surface 3169 from stud 3170, whereupon spring 3167 acting against stud 3166 and latch 3163 rotates the interposer arm 3161 downward, clearing the ball locks just prior to the time interposer 3154 (FIG. 14) of the tape return key 138 enters the locks. As the stud 3165 (FIG. 15) moves downward and away from the lever 3159, the spring 3167 also returns the latch 3163 against the stud 3168 and further returns the interposer arm 3161 down on the bracket 3174 as shown here. When the tape return key 138 is restored to the illustrated normal position, the stud 3172 (FIG. 14) and cam surface 3171 permit the lever 3158, shaft 3160 and lever 3159 (FIG. 15) to be returned to normal position by spring 3173. When the tape return key 138 (FIG. 14) is returned, its interposer 3154 is removed from the ball locks as shown and the machine is again conditioned for further operation.

From the above, it can be seen that upon depression of the delete key 140 (FIG. 15) the interposer 3157 affects the ball locks for preventing operation of other keys during deleting operations, and, upon return of the delete key 140, the interposer arm 3161 is drawn into the ball locks as shown in FIG. 16 for preventing operation of other keys even after deleting operations are concluded. It should also be understood that the delete key 140 may be operated again, or successive times, for performance of additional deleting operations as described without permitting operation of other keys, since the interposer 3161 will remain connected at such times and will travel down and then up again while the interposers 3161 and 3157 are held together as shown. However, when deleting operations are concluded and the interposer 3157 is up in normal position as shown, the tape return key 138 (FIG. 14) may be operated to first release the interposer 3161 (FIG. 15) to return to the position shown here, and, since no interposers are now in the ball locks, the tape return key 138 (FIG. 14) may then be fully operated at its interposer 3154 may now enter the ball locks for preventing operation of other keys during the previously described tape return operations. Thus, by virtue of interposer 3161 (FIG. 15) as described, it is seen that the tape return key 138 (FIG. 14) is the only key that may be operated following deleting operations.

A second interlocking arrangement, aside from the just described ball lock arrangement, is provided to prevent operation of the tape return key 138 at all times except following operation and return of the delete key 140, and this arrangement will now be described. A stop lever 3175 and a release lever 3176 (FIG. 15) form an integral unit similar to a hinge plate pivoted on a rod 3177 (FIG. 117). Rod 3177 is supported by a pair of brackets 3178 and 3179 that are secured on the frame base I. A torsion spring 3180 is connected to release lever 3176 and it is anchored in a known manner for normally urging the levers 3175 and 3176 (FIGS. 14 and 15 respectively) counterclockwise against the ball lock cage 3141 as shown. Normally, as shown in FIG. 14, the upper end of stop lever 3175 lies in blocking position under a surface 3181 at the bottom of interposer 3154 on the tape return key lever 170 for normally preventing operation of the lever and tape return key 138. However, the configuration of release lever 3176 (FIG. 15) is such that it permits operation of the delete key lever 201.

As previously described, depression of the delete key 140 causes its stud 3170 to be connected to interposer arm 3161 by latch 3163, and upon return of the delete key 140 the interposer arm 3161 is brought up into the ball locks as shown in FIG. 16. When interposer arm 3161 moves into this position, the end of the arm coacts with a surface 3182 on release lever 3176 for rotating the levers 3176 and 3175 (FIG. 14) clockwise, and for swinging the stop lever 3175 out from under the surface 3181 and for thus releasing the tape return key 138 for operation. Upon such operation of the tape return key 138, the surface 3181 of its lever 197 moves down behind the stop lever 3175, and the interposer arm 3161 (FIG. 16) is released from stud 3170 and the arm drops down to the position shown in FIG. 15 as previously described. When the interposer arm 3161 is thus restored and it moves away from surface 3182, the spring 3180 urges the release lever 3176 and stop lever 3175 (FIG. 14) counterclockwise to press the stop lever 3175 against the end of the interposer 3154 then in effective position. When tape return operations are completed and the tape return lever 170 is returned upward as described, the stop lever 3175 snaps under the surface 3181 under the influence of spring 3180 (FIG. 15) for again preventing operation of the tape return key 138 can be operated only following deleting operations, and because of the ball lock arrangement and the interposer arm 3161 (FIG. 15) as described previously, no other key can be operated following deleting operations.

The shift keys 17 and 18 (FIG. 3) are equipped with identical interposers 3183 and 3184 (FIG. 4) respectively, which together with the balls 3140 prevent operation of the shift keys 17, 18 when another key is operated. The interposers have only sufficient generally vertical width to be between a pair of balls 3140 during shifting to upper case or back to lower case for preventing operation of other keys at such times. In other words, other keys are blocked when a shift key 17 or 18 is between up or down position, but other keys are not blocked when both shift keys 17, 18 are up or when a shift key is fully depressed. Thus, character keys 16 and 19, for example may be operated when the shift keys 17, 18 are up or down and the machine is properly conditioned for lower case or upper case, respectively, but they cannot be operated when the machine is not properly conditioned for either case.

The character keys 16 and 19 (FIG. 3) as well as the line space keys 20 and 21, are each equipped with an interposer 3185 (FIG. 4) on the forward end of their respective key lever. Thus, these keys 16, 19, 20 and 21 cannot be effectively selectively operated when another key, which may be another one of these keys 16, 19, 20 and 21, is operated. Furthermore, when one of these keys 16, 19, 20 and 21 is operated and accordingly its interposer 3185 is between a pair of balls 3140 all other keys are blocked by the ball locks against effective operation. Effective operation should be taken to include return of a shift key 17, 18, in the event that a shift key were down when another key's interposer is in the ball locks.

An interposer 3186 (FIG. 58) is provided on each of the levers 774 (FIG. 57) 783, 791, and 801 for controlling and being operated by the space keys 761, 762, 763 and 760, respectively. Each of the interposers 3186 (FIG. 58) is situated to operate in a slot and enter between the same pair of balls 3140 with which one of the character key interposers 3185 (FIG. 12) is aligned. However, upon depression of one of the space keys 760–763, its lever 791 is rotated clockwise as previously described and the respective interposer 3186 (FIG. 58) enters between a pair of balls 3140 for preventing effective operation of any other key. However, if another key is presently operated, the interposer 3186 will be blocked by the balls before the particular space key is effectively operated.

The stop printer key 2883 (FIG. 167) has an interposer 3187, the 12 step tape feed key 3076 (FIG. 176) has an interposer 3188, tape feed key 3075 (FIG. 175) has an interposer 3189, clear key 2633 (FIG. 159) has an interposer 3190 and the conditioning key 2707 (FIG. 160) has an interposer 3191 and upon operation of one of these keys, its respective interposer enters between an adjacent pair of balls 3140 for preventing effective operation of other keys on the keyboard. However, if another key is previously operated, the interposer is blocked by the balls for preventing effective operation of its respective one of these keys.

Since the clear-set key 2824 (FIGS. 3 and 166) is merely a set-up key and since the shifting of this clear-set key does not cause encoding operations, the clear-set key does not have a ball lock interposer and therefore does not affect the ball locks. However, shifting of this clear-set key 2824 is blocked by detent 2857 and roller 2860 while the automatic clearing and conditioning operations are performed, as previously described.

The punch control key 602 (FIG. 3) does not cause encoding, when shifted, however, it should not be shifted when another key is operated, since it controls the punch circuits and it might interfere with the encoding for that other key. An interposer 3192 (FIG. 43) is carried by the forwardly extending arm 617 of the punch control key 602, and it is constructed and arranged to be effectively engaged between a pair of balls 3140 for preventing operation of another key only when the punch control key 602 is being shifted from one of its positions to the other. For purposes to be clarified presently, the interposer 3192 is twice as thick as the other interposers, and it has a single thickness extension interposer 3193 that is effective only when the punch control key 602 is in "on" position as shown in FIG. 42. When the punch control key 602 is in normal "on" position, the interposer 3193 is between a pair of balls 3140, and the normal adjustment among the balls is such that only one other key operated interposer may be inserted between a pair of balls 3140. Under this condition and when another key is operated and its interposer is effective, the punch control key 602 cannot be shifted to "off" position because its double interposer 3192 will not be admitted between the pair of balls 3140. However, whenever no other key operated interposer is effective, the punch control key 602 may be shifted and its double interposer will pass between the balls to the position shown in FIG. 43, or it may be returned as the case may be. Thus, when the punch control key 602 is in "off" position and no encoding operations will be performed, the interposer 3192 and extension 3193 are not effective, and two key operated interposers may be made effective at one time. This permits the delete key 140 (FIG. 15) to be locked down and its interposer 3157 to be effective while the typewriter character keys 16, 19, shifts keys 17, 18 and space keys 760–763 and their interposers are selectively operable one at a time, during no punch back spacing operations as will be described. However, when the delete key 140 is locked down and its interposer 3157 is effective and the punch control key 602 (FIG. 43) is in "off" position, the punch control key 602 cannot be shifted to "on" position since the double interposer 3192 will not pass through the respective pair of balls 3140 at such time. Thus, the punches 567 cannot be turned "on" until the delete key 140 is first returned to normal position as will be described.

The tolerance in the pivotal mounting of punch control key 602 and the flexibility of forwardly extending arm 617 is such that the single inteposer 3193, when effective as shown in FIG. 42, may be shifted side to side the few thousandths that are necessary to permit the normal lateral shifting of the balls 3140 when other interposers are selectively made effective, much the same as in any other instance.

The print control key 2488 (FIG. 3) and the bold and regular control key 2487 each cause encoding when the key is shifted as previously described. Therefore, each of these keys is equipped with an interposer that is effective only when the key is being shifted from one of its positions to the other. The print control key 2488 (FIG. 155) has an interposer 3194 that moves between an adjacent pair of balls 3140 for preventing operation of other keys only when the key is being shifted from one position to the other, and in either position of the key the interposer is not effective. It can also be understood that the balls will not permit entry of the interposer 3194 and therefore will not permit effective shifting of the print control key 2488 when another key is operated and its interposer is effective. The bold-regular control key 2487 (FIG. 154) has an interposer 3195 that is like the interposer just described. The just described interposers 3192, 3194 and 3195 for the keys 602, 2488 and 2487 (FIG. 3) normally function and stand ready to cooperate with the ball locks as described, however, when the clear key 2633 is operated and its interposer 3190 (FIG. 159) is effectively engaged in the ball locks for preventing operation of other keys as described, one or more of the keys 602, 2488 and 2487 (FIG. 3) may be shifted to normal position during the clearing operation as described previously. To permit this normalizing of these keys 602, 2488 and 2487 during the clearing operation, the lock extension cage 3147 (FIG. 118) is pivoted counterclockwise about the rod 3148 (FIG. 42) to remove the balls 3140 in cage 3147 out of alignment with the interposers 3192, 3194 and 3195 that may be shifted during the clearing operation. The means for controlling the cage 3147 will now be described.

The cage 3147 is normally held in the illustrated effective position by a torsion spring 3196 (FIG. 118) that is connected to the cage and that is anchored in a known manner. Cage 3147 is normally pressed by the spring against a cam surface 3197 (FIG. 42) on the bail member 2678.

During clearing operations, the solenoid 2664 is operated for rotating the bail member 2678 and the bail 2680 clockwise and for thereby shifting any of the keys 602, 2488 and 2487 (FIG. 44) that may be in a shifted position, back to normal position as described previously. By this clockwise operation of bail member 2678 (FIG. 42), its cam surface 3197 rapidly shifts the extension cage 3147 counterclockwise against tension of spring 3196, to a position where the balls 3140 are out of engaging alignment with the interposers 3192, 3194 (FIG. 155) and 3195 (FIG. 154), and the keys 602 (FIG. 3), 2488 and 2487 are shifted or held in punch, print and regular positions, respectively, by the bail 2680 (FIG. 42).

A tab 3198 on the stationary cage 3145 (FIG. 118) is provided for preventing the balls 3140 in cage 3147 from rolling leftward out of the cage when cage 3147 is shifted to ineffective position and the balls therein at such times are not aligned with the balls in cage 3145. A tab 3199 (FIG. 42) on the shiftable extension cage 3147 is provided for blocking the balls 3140 from moving rightward in the stationary cage 3145 (FIG. 118) when the cage 3147 (FIG. 42) is shifted counterclockwise during clearing operations as described.

Near the end of the clearing operations, the solenoid 2664 is deenergized and the bail member 2680 is restored, as described, and the cam surface 3197 permits the spring 3196 (FIG. 118) to restore the cage 3147 and the balls 3140 therein back into normal effective alignment with the rest of such balls in the interlock mechanism 3139.

As previously described, the solenoid 1337 (FIG. 84) is operated automatically at the outset of carriage return operations, and the interposer 3156 is thereby moved between a pair of balls 3140 for preventing encoding keys to be operated. Following carriage return operations, when the machine is ready for an ensuing line, the solenoid 1353 is operated for restoring the machine and removing the interposer 3156 from the balls 3140 to permit encoding of the next line as described hereinbefore.

As described previously, the solenoid 1296 (FIG. 161) is energized at the instant the machine is shifted to upper case and to lower case during deleting operations, and also, as described, it is energized at the instant the machine may be restored to lower case during clearing operations. As described, the delete key 140 (FIG. 15) is depressed and its interposer 3157 is effectively situated between a pair of balls 3140 for blocking operation of other keys, during deleting operations. As also described, the clear key 2633 (FIG. 159) is depressed and its interposer 3190 is effectively situated between a pair of balls 3140 for blocking operation of other keys, during clearing operations. As further described, the interposer 3184 (FIG. 4) of shift key 18 passes through a pair of adjacent balls 3140 whenever the machine is shifted to upper case and to lower case. Therefore, from the foregoing, it can be seen that space for passage of interposer 3184 between the adjacent balls 3140 must be provided when required during deleting and clearing operations. To this end, a normally effective interposer mechanism is operated by the solenoid 1296 (FIG. 5) at the appropriate instances to withdraw its interposer 3208 and to thus make room for interposer 3184, as will now be described.

Solenoid 1296 is secured on channel member 14 (FIG. 180). A link 3200 (FIG. 5) is pivotally connected to the armature of solenoid 1296 and to the upper end of a lever 3201. The lower end of lever 3201 is secured on a sleeve 3202 (FIG. 57), and an identical lever 3203 is secured on the other end of sleeve 3202 so the levers and sleeve may rotate, unitarily on a rod 3204 on which the sleeve is mounted. Rod 3204 is carried by a pair of upturned portions 3205 and 3206 of a bracket 3207 (FIG. 180) that is secured on the lower flange of channel member 624. A normally effective interposer 3208 is loosely and slidably supported in a slot therefor in the channel member 624 and it normally is situated in spacing position between a pair of balls 3140 as shown. The rearward end of the interposer 3208 is pivotally connected to the upper end of lever 3203. A torsion spring 3209 is connected to lever 3203 and it is anchored in a known manner for urging the interposer 3208, lever 3203, sleeve 3202 and lever 3201 forwardly and generally counterclockwise relative to rod 3204. The mechanism is normally stopped in counterclockwise position where lever 3201 engages a stud 3210 secured on the portion 3206 of bracket 3207. When the interposer 3208 is in normal position as shown, the accumulated space among the balls 3140 and interposer 3208 will permit entry of only one more interposer. The arrangement is such that operation of solenoid 1296 (FIG. 5) pulls link 3200, rotates levers 3201 and 3203 clockwise, and pulls the interposer 3208 out from between the adjacent balls 3140, for permitting passage of interposer 3184 between the respective pair of balls 3140 when the machine is shifted to upper case or returned to lower case, even though the delete key 140 or the clear key 2633 is depressed and its interposer 3157, or 3190, respectively, is effective at this time. When the interposer 3208 is out from between the balls, the mechanism is stopped in operated position as a pair of stops 3211 (FIG. 57), secured on a forward extension of interposer 3208, engage the forward face of cage 3145 (FIG. 5).

When the machine is fully shifted to upper or lower case and the interposer 3184 has moved through the ball locks, the solenoid 1296 is deenergized as described and the spring 3209 restores the mechanism to the condition shown, where the lever 3201 is stopped against the stud 3210 and the interposer 3208 is restored to effective position for preventing manual operation of any other key while the delete key 140 or the clear key 2633 is depressed.

41. NO-PUNCH OPERATION OF THE MACHINE

Normally the punch control key 602 (FIG. 3) is in the "punch" position and the punch control relay 603 (FIG. 47) is in normal "on" condition, and the machine is conditioned to operate for encoding text information and justifying information and performing automatic back spacing and deleting operations, as previously described herein. However, when the punch control key 602 (FIG. 3) is shifted forwardly to the "no punch" position and the punch control relay 603 (FIGS. 46 and 47) is automatically shifted to "punch off" condition as described, the machine will not perform any encoding operations, and, of course, it will not perform any automatic deleting operations.

When the machine is in the "punch off" condition, manipulation of character and space keys 16, 760–763 will cause normal typing and forward differential carriage movements in accordance with the upper-lower case switch means 159 (FIG. 11) and an operated character key 16 or in accordance with a space key 760–763 as the case may be and as described, but the operations will not be encoded by the main punch mechanism 161 because the switches 160 and the switch 669 are now shifted as shown in FIG. 48. Under the "punch off" (no punch) condition, depression of the delete key (back space key) 140 (FIG. 15) merely prepares the machine to operate reversely upon operation of the character and space keys 16, 760–763.

Under no punch condition, character and space keys 16, 760–763 may be selectively operated and their interposers individually shifted into the ball-locks at the same time the delete key 140 is depressed and its interposer 3157 is effective, since the normally effective interposer 3193 (FIG. 43) is ineffective at such times as shown here and as described previously. As will be explained, depression of the delete key 140 also shifts a mechanical means for preventing imprinting of characters on the paper carriage when a character key 16 is operated. In other words, characters will not be imprinted when the character keys 16 are operated and the machine is in the no punch back space condition, as will be explained in greater detail hereinafter.

When the punch control key arrangement 144 (FIG. 48) is in off condition as shown, the shifted switches 160 and 669 prevent encoding by main punch mechanism 161 as described, and this also renders ineffective the previously described circuit through wires 163 (FIG. 11), switch 164, wire 165, the end of line tape feed control 166 for preventing this type of tape feeding operations that normally occur upon return of the carriage 80 as described, and this also renders ineffective the circuit through wire 167 and the forward tape cycle control 169 for preventing normal tape shifting through the main punches 567. When the punch control key arrangement 144 is in punch off condition, its switch 670 renders the control for no space at end of justified line commutator 146 and the space at end of line preventing operation of the word space counter 850 (FIG. 62). Under punch off condition, the switches 996, 1002 and 1012 (FIG. 48) are shifted for rendering the previously described initial delete circuit ineffective. The reason these three switches 996, 1002 and 1012 are provided for rendering the initial delete circuit ineffective is so that part of this circuit can be made effective during no punch condition of the machine as will be explained hereinafter. Under punch off condition, the switch 1099 is shifted for rendering the back space decoder 1095 (FIG. 66) and the back space reader 1097 ineffective. Since the wire 1345 is connected to wire 1098 and thus to switch 1099, the now open switch 1099 also renders the previously described carriage return circuits ineffective and therefore the carriage return circuit breaker 1341 (FIG. 83), the general key lock mechanism 1335, and the end of line tape control 166 and thus the carriage return encoding arrangements are inoperable under the no punch condition. Moreover, since the wire 2126 is connected to wire 1098 and to switch 1099, the now open switch 1099 (FIG. 48) renders the justifying punch circuits through the dividing and encoding mechanism 1923 (FIG. 92), the justifying punch mechanisms 2050 and 2061, etc., as previously described, ineffective under the no punch condition. The now shifted switches 670 and 2456 (FIG. 48) cause the forward and back space circuits to avoid the forward motivating solenoid 2378 (FIG. 153) and the reverse motivating solenoid 2399, respectively, while these switches maintain the carriage moving circuits otherwise effective as described in Topic 31 and in connection with FIG. 153.

From the above, it can be seen that some of the novel arrangements that are important in the disclosed encoding composing machine, as previously described, are rendered ineffective when the machine is in no punch condition, but the machine is operable as a generally customary typewriter under this condition.

Further no punch conditioning is accomplished by a circuit that runs from the source of power (S) and wire 137 (FIG. 66), through the tape return key 138 in normal position, wires 139 and 538, the delete key 140 (FIG. 15) in normal position, and wire 539. A wire 3212 (FIG. 181) is connected between wire 539 and a solenoid 3213 that is provided for restoring a "punches on" circuit breaker 3214 to be described presently. A wire 3215 is connected to the restoring solenoid 3213 and to a solenoid 3216 (FIG. 15) that is provided for rendering the back space release key 1037 operable as will be described presently. A wire 3217 is connected between solenoid 3216 and the now effective blade "c" of the switch 1002 (FIG. 48). The no punch conditioning circuit now under discussion continues from wire 539 (FIG. 181) through wire 3212, operates restoring solenoid 3213, continues through wire 3215, operates solenoid 3216 (FIG. 15), goes through wire 3217, the now shifted switch 1002 (FIG. 48) and through the wire 1003 (FIG. 66). The next portion of the no punch conditioning circuit follows a portion of the initial delete circuit that leads through the wire 1003, solenoid 1004, wire 1007, solenoid 1005, wire 1008, solenoid 1006, wire 1009, solenoid 1010 and wire 1011. Thus, the no punch conditioning circuit operates the solenoids 1004, 1005 and 1006 for preparing the print-no print, bold-regular and the case shifting circuit changing mechanism, respectively, to be operable freely, and it also operates the solenoid 1010 for clearing the amount left in line mechanism 1483 so it will follow the return of the carriage, the same as described in connection with the initial delete circuit. The no punch conditioning circuit continues through wire 1011, now shifted switch 1012 (FIG. 48) and a wire 3218 that is connected between the now effective blade "c" of switch 1012 and the solenoid 1491 (FIG. 93) in the clearing circuit breaker 1492. The circuit continues, as shown here, through the solenoid 1491, wire 1493 and it goes to ground through switch 1495.

From the above, it can be seen that the no punch conditioning circuit causes simultaneous operation of the solenoids 3213 (FIG. 181), 3216 (FIG. 15)), 1004 (FIG. 66), 1005, 1006, 1010, and solenoid 1491 (FIG. 93). These solenoids and their respective mechanisms will now be discussed in this same order.

The solenoid 3213 (FIG. 181) is operated for restoring the punch on circuit breaker 3214 which is similar to the carriage return circuit breaker 1341 (FIG. 90), and it is believed that the structural description of the carriage return circuit breaker 1341 is adequate to generally explain the punch on circuit breaker 3214 (FIG. 181). At the moment, it is sufficient to know that solenoid 3213 is operated to restore the punch on circuit breaker 3214 in preparation for a circuit that will restore the machine to "punch on" condition as will be explained.

The solenoid 3216 (FIG. 15) is operated for rendering the back space release key 1037 operable, while the machine is in "no punch" condition, so back space release key 1037 may be operated to release the delete key 140 following manual back spacing operations. Solenoid 3216 is secured on frame plate 173 in a known manner. A link 3219 is pivotally connected to the armature of solenoid 3216 and to a lever 3220. Lever 3220 is secured on a sleeve 3221, between an arm 3222 and a locking pawl 3223 that are also secured on the sleeve. Sleeve 3221 is pivoted on a rod 3224 which is secured in holes therefor in plate 173 and plate 172 (FIG. 14). A spring 3225 (FIG. 15) is connected to link 3219 and to a stud 3226, that is secured on plate 173, for urging the lever 3220, arm 3222 and pawl 3223 clockwise to where the pawl engages a latch portion 3227 of back space release key 1037 in the normal position of the parts as shown, and for thereby locking the back space release key 1037 against manual operation. The back space release key 1037 is pivoted on machine screw 221 and it is urged counterclockwise against a stud 3228 by a relatively strong torsion spring 3229 that is connected to the back space release key 1037 and the stud 3228. Stud 3228 is secured on plate 173. The relatively light spring 223 is connected to a stud 3230 which is secured on back space release key 1037 and which extends leftward therefrom beyond engaging alignment with the pawl 220. A detaining member 3231 is pivoted on a stud 3232 that is secured on plate 173, and it is urged counterclockwise by a torsion spring 3233 connected to the detaining member 3231 and to the plate 173. A tab 3234 on detaining member 3231 is normally pressed against the end of an extension portion 3235 of lever 3220. A link 3236 is pivotally connected to detaining member 3231 and to the armature of a solenoid 3237 that is secured on plate 173 in a known manner. The arrangement is such that, upon operation of solenoid 3216 by the no punch conditioning circuit previously described, the solenoid pulls link 3219 against tension of spring 3225 and rotates the lever 3220, sleeve 3221, arm 3222 and locking pawl 3223 counterclockwise to where the pawl is in ineffective position against stud 3226. At the same time, the end of extension portion 3235 is shifted below the tab 3234, and detaining member 3231 is shifted counterclockwise by spring 3233 to where a surface 3238 on the member engages the sleeve 3221. In this position of the detaining member 3231, its tab 3234 overlies the end extension portion 3235 for preventing return of lever 3220, arm 3222 and locking pawl 3223 under tension of spring 3225 when the no punch conditioning circuit now under discussion is broken. Thus, the back space release key 1037 is rendered operable during the time the machine is in "no punch" (punches off) condition of the machine. Operation of the back space release key 1037 will be discussed further in connection with release of the delete key 140 following no punch back spacing operations. When the solenoid 3237 is operated by a "punch on" circuit to be described later, the solenoid 3237 pulls link 3236 and restores member 3231 clockwise for shifting the tab 3234 beyond the end of extension portion 3235 and, thus, permitting the spring 3225 to restore the link 3219 and to rotate the lever 3220, arm 3222 and the locking pawl 3223 clockwise to the illustrated position where locking pawl 3223 reengages the latch portion 3227 for blocking manual operation of back space release key 1037 when the punches 567 are operable. The arm 3222 is operated counterclockwise and clockwise as just described for locking the line delete key 1479 against manual operation when the punches are off and unlocking the line delete key 1479 when the punches are on, respectively, as will be described later.

The solenoids 1004, 1005 and 1006 (FIG. 66) are operated by the no punch conditioning circuit for rendering ineffective the time-delay detents in the print control, the bold and regular, and the upper-lower case switch means (discussed in re FIGS. 158, 157 and 35), respectively, since the time delays required in normal encoding forward operations are not necessary during no punch operations of the machine. Thus, the print control, bold and regular and the upper-lower case switch means (discussed in re FIGS. 158, 157 and 35) may be operated freely, without the encoding time delay, the same as explained for these switch means (discussed in re FIGS. 158, 157, and 35) in connection with the code controlled deleting operations described previously. However, since shifting of the upper-lower case switch means 159, to properly control carriage movements, is the only one of the three switch means (discussed in re FIGS. 158, 157 and 35) that is important during no punch operations, it is proposed that the print control key 2488 (FIG. 3) and the bold-regular shift key 2487 be locked against manipulation when the punch control key 602 is in no punch position as will be described later. Moreover however, in machines that include the condition code arrangement or the clearing feature, the just mentioned lock will not be necessary, if the conditioning or clearing is performed upon return of the machine to "punches on" condition as will be described.

As described, the no punch conditioning circuit operates the solenoid 1010 (FIG. 66) for rendering the detent 1655 (FIG. 105) ineffective for holding the amount left in the line mechanism 1483 upon return of the carriage, and thus the amount left in the line mechanism 1483 is operated freely forwardly and allowed to return freely as the carriage is operated forwardly and returned, respectively, in a manner described previously, while the machine is in no punch condition.

The solenoid 1491 (FIG. 93) operates the clearing circuit breaker 1492 for shifting the switch 1495, and, in this instance, for breaking the no punch conditioning circuit.

At this point the punch control key 602 (FIG. 3) is in no punch position and the machine is conditioned for forward no punch operation as described. Key locks the prevent manual operation of several function keys, when the punch control key 602 is in no punch position, will be described later.

When the machine is in the forward no punch condition and a character key 16 is depressed, the corresponding character is imprinted on the paper carriage, the carriage moving mechanism 149 (FIG. 11) is cocked to operate forwardly for shifting the carriage an operation determined by the upper-lower case switch means 159 and by the key 16, and, as soon as the key 16 is returned enough to break the circuit through its switch 113, the carriage moving mechanism 149 moves the carriage 80 the appropriate amount, in the same manner as described previously. However, under this condition, the circuit finds its ground through the now shifted switches 160, as described, and all functions related to encoding are avoided.

When the machine is in no punch condition, the upper-lower case switch means 159 controls for appropriate carriage movement in exactly the same manner as described under Topic 10, and the case switch shifting means operates as described in Topic 11 and as illustrated in FIG. 35, except that the encoding circuits are terminated at switches 160 to avoid the main punch mechanism 161 and the rest of the encoding circuit. It should be pointed out that the differential key lock solenoids 490 and 494 are operated by the case switch shifting circuits, and the entire differential key lock mechanism is operable, when the machine is in no punch condition, the same as before described under Topic 26.

It may be noted that the solenoid 527 (FIG. 35) is operable in the case switch shifting sequences for operating the time delay detent 517, during no punch operations, and that the time delay detent 517 is already rendered ineffective by operation of the solenoid 1006 (FIG. 66) in the no punch conditioning circuit described above. Thus, operation of solenoid 527 (FIG. 35) is of no consequence during no punch case shifting operations. This unnecessary energization of solenoid 527 is preferred instead of relying on this solenoid for operating the time delay detent 517 each time a case shift occurs during no punch operations. These same comments may also be made in respect to th solenoid 2521 (FIG. 157) and the solenoid 2591 (FIG. 158), in the bold and regular circuit shifting means and the print-no print shifting means, respectively, since the delay detent 2546 (FIG. 157) and the detent 2616 (FIG. 158) are respectively rendered ineffective by operation of the solenoids 1004 and 1005 (FIG. 66) in the no punch conditioning circuit as described.

However, it should be understood that the clearing solenoids 1004, 1005 and 1006 (FIG. 66), may be eliminated from the previously described no punch conditioning circuit, by connecting the wires 1001 and 1003 together and by connecting the blade "a" of switch 1002 with the solenoid 1006 and connecting wire 1009 to the blade "b" of the switch, and in this manner the carriage return clearing circuit, the initial delete circuit and the no punch conditioning circuit would all work as described, except the solenoids 1004–1006 would not operate in the no punch conditioning circuit. In this modified form, the solenoids 527 (FIG. 35), 2521 (FIG. 157) and 2591 (FIG. 158) are effective for operating their respective delay detents 517, 2546, 2616 as described previously, when a case shift occurs, a bold-regular shift occurs or a print-no print shift occurs, respectively, during no punch condition the same as when the punches are on.

When the machine is in the no punch condition, operation of the delete key 140 (FIG. 3) conditions the machine to operate reversely, that is to move the carriage reversely, upon operation of character and space keys 16, 760–763 as will now be described. Upon depression of the delete key 140, it is locked down by pawl 220 (FIG. 15) as described, and a back space conditioning circuit is immediately rendered effective. This travels from source of power (S) and wires 137 (FIG. 66), 139 and 538, through the now effective contacts 217 and 216 (FIG. 15), wire 995 (FIG. 66), the now shifted switch 996, a wire 3239 that is connected between now effective blade "c" of switch 996 and the wire 999, through wire 999, and it operates the solenoid 1000 that conditions the carriage moving mechanism 149 for reverse (back spacing) operations and for preventing manual return of the carriage as described in connection with the normal initial delete circuit. The back space conditioning circuit presently under discussion continues through the wire 1001, a wire 3240 connected between wire 1001 and a switch 3241, through the now shifted switch 3241 that is one of the previously described switches 652 in the punch control relay, through a wire 3242 connected to switch 3241 and to a solenoid 3243 (FIG. 94) in a no punch backspacing sequence control 3244, operates solenoid 3243 for breaking this circuit as will be described, continues through a wire 3245 between solenoid 3243 and a momentarily closed switch 3246, and goes to ground through the switch 3246 as shown.

From the above, it can be seen that the no punch back space conditioning circuit operates the solenoid 1000 (FIG. 66) for conditioning the carriage moving mechanism 149 for back spacing operations in the same manner as before described for normal back spacing and deleting operations, and the circuit also operates the solenoid 3243 (FIG. 94) in the no punch back spacing sequence control 3244. The control 3244 is exactly the same in construction and operation as the carriage return circuit breaker 1341 (FIG. 90), the description of which should serve to describe the no punch back spacing sequence control 3244 (FIG. 94). Therefore, it can be understood that, upon full operation of solenoid 3243, the switch 3246 is snapped open for breaking the no punch back space conditioning circuit.

At this point, the machine is so conditioned that the typewriter keyboard keys may be operated, automatic deleting is inoperative, operation of any of the punches is prevented, manual return of the carriage 80 is prevented and the carriage moving mechanism 149 is conditioned to operate reversely and to thus move the carriage for back spacing operations. Upon depression of a character key 16 (FIG. 11), printing of the character is prevented as will be described, but the switch 113 is closed for causing a back space operation. Upon closure of a switch 113, a circuit becomes effective from source of power (S) and wire 137, through wire 139, the now effective contacts 212 and 213 (FIG. 15), wire 1145 (FIG. 153), and wire 1146 or 2459 depending on the position of justifying control key 244 as described. When the circuit is through wire 1146, it is transmitted through the now shifted switch 2456 and wires 2460 and 1149. When the circuit is through wire 2459, it goes direct to wire 1149. The circuit continues through the wire 1149, normally closed switch 1150, wire 1151, reversing solenoid 1152, wire 1153, and through wire 150 or the differential stop or stop solenoids 345, 347 and wire 151 or 152, for cocking the carriage moving mechanism 149 in preparation for appropriate reverse carriage movement as described. The circuit continues through one of the relay magnets 153–155 (FIG. 11) for at times operating the differential key locks as described, and it continues through the upper-lower case switch means 159 and one of group wires "A"–"G" as described. The circuit then proceeds through the wire 115, switch 113 of the operated key 16, wires 119–121 for example, the effective code channel punch wires, and it goes to ground through the now shifted switches 160.

When the character key 16 is released and it travels upwardly enough to break the circuit through its switch 113, the carriage moving mechanism 149 operates for shifting the carriage reversely the appropriate amount for the character key 16 and the instant case condition of the machine, the same as described previously in connection with the code controlled backspacing operations. From the above and by referring to Topic 15. "Space Keys and Their Circuits" and to FIG. 59, it can be readily understood that selective operation of the space keys 760–763 also cause appropriate back spacing of the carriage, when the machine is conditioning for no punch back spacing operation as described.

From the above, it can be seen that the machine may be operated forwardly and it may be back spaced for performing typewriter operations, without employing the encoding means and justifying means.

It should be remembered that the delete key 140 is locked down by pawl 220 (FIG. 15), and the solenoid 225 is not operated as the result of any automatic deleting operations, when the machine is in no punch condition. Therefore, under these conditions and when the operator has finished back spacing, he must operate the back space release key 1037 to release the delete key 140 and in order to condition the machine for forward operations, as will now be described.

As previously described, the stud 3230 on the back space release key 1037 extends beyond the plane of pawl 220. The key 1037 also has a rearward extension 3247 which carries a stud 3248 that extends leftward in engaging alignment with a cam surface 3249 on the remote upper end of the detent 1229. An insulator 3250 is secured on the end of rearward extension 3247 and the insulator 3250 is situated in alignment with a normally open switch 3251. Switch 3251 is secured on an angle bracket 3252 that is secured on the frame plate 173. A headed stud 3253 is secured on back space release key 1037, and a link 3254 is connected at its upper end on the stud with a well known type of lost motion connection that permits the link to be operated without moving the stud but that when the back space release key 1037 is operated the link will be operated by the stud as will be described under the next topic.

When the back space release key 1037 is depressed, it rotates clockwise about the machine screw 221, and the stud 3230 disengages pawl 220 from stud 222 for permitting restoration of the delete key 140 as described, the stud 3253 pulls link 3254 for restoring the interposer arm 3161 as will be described, the stud 3248 coacts with cam surface 3249 for rotating detent 1229 to release the tab 961 and thus for permitting the spring 963 to restore bellcrank 962 directly followingly in respect to the delete key 140, and the insulator 3250 closes the switch 3251. At the same time the delete key 140 restores, the spring 974 restores lever 971 and pawl 970 as the stud 969 on lever 201 returns. Thus, the delete key 140 and related parts are restored to normal position upon depression of the back space release key 1037.

Upon depression of the back space release key 1037 and upon the resulting closure of the switch 3251 as described, a circuit is completed from a source of power (S) through wire 3255, the now closed switch 3251, a wire 3256 (FIG. 94), operates a solenoid 3257 for restoring the no punch back spacing sequence control 3244 to the illustrated position, it continues through a wire 3258 (FIG. 80) and wire 1291, and it goes to ground through the solenoid 1060 for operating that solenoid and for thus restoring the carriage moving mechanism 149 to forward operation condition and to render the manual carriage return preventing means ineffective in the same manner as previously described. When the back space release key 1037 (FIG. 15) has been fully operated, the operator may then release the key 1037. Whereupon the spring 3229 restores the key 1037 counterclockwise for opening switch 3251 to deenergize the just described circuit, for moving stud 3248 away from cam surface 3249 to permit pawl 1229 to return against tab 961 as shown, for again permitting pawl 220 to be urged by spring 223 against the stud 222 as shown, and for permitting the link 3254 to return, all as shown here. The machine is now again in condition for forward no punch operations.

When the machine is in forward no punch condition the paper carriage may be returned at any time, much like in any office typewriter, without any particular incidence, since the normal carriage return circuits are rendered ineffective by the now open switches 669 and 1099 (FIG. 83) as described. However, upon full return of the carriage and closure of the switch 1540 (FIG. 119), the differential key locks are restored, if in fact they were operated, as described.

Return of the machine to normal "punches on" condition will now be described. In order to clear the differential key locks and to provide a full line for succeeding encoding operations the carriage should be fully returned by the operator before he shifts the punch control key 602 (FIG. 42) to "on" position. When the punch control key 602 is shifted to "on" position, the punch control key arrangement 144 (FIG. 48) is shifted accordingly as described. This returns a switch 3259, which is one of the switches 652 in the punch control key arrangement 144. Return of switch 3259 to "on" position completes a circuit from source of power (S) and wire 1273 (FIG. 80), operates the solenoid 1274 (FIGS. 23 and 79) for restoring the switch 1315 that may have been closed by a return of the carriage 80 while the punches were off, continues through wire 1275 (FIG. 80), operates the solenoid 1276 for resetting the clearing sequence control 1492 (FIG. 92) that was operated in the punches "off" conditioning circuit as described via wire 1277 (FIG. 80), operates the solenoid 1278 for restoring the amount left in line mechanism clearing means as described, via wire 1279, operates the solenoids 1280, 1282 and 1082 and goes through their interconnecting wires 1281 and 1283 for restoring the print-no print, bold-regular and upper-lower case circuit changers respectively for normal punch, operations as described, continues through wire 1284, a wire 3260 that is connected to wire 1284 and to the solenoid 3237 (FIG. 15) operates solenoid 3237 for blocking manual operation of the back space release key 1037 as described, continues through a wire 3261 that is connected to solenoid 3237 and to a solenoid 3262 (FIG. 181), solenoid 3262 operates the "punch on" circuit breaker 3214, continues via a wire 3263 between solenoid 3262 and a now closed switch 3264, it passes through switch 3264, a wire 3265 connected between switch 3264 and the switch 3259 (FIG. 48), and the circuit goes to ground as indicated through the now closed switch 3259. When the solenoid 3262 (FIG. 181) is fully operated, the switch 3264 is snapped open for deenergizing the just described "punches on" conditioning circuit. The machine is thus in condition for normal punch encoding operations.

In a modified form of the just described circuit, in machines equipped with the conditioning and clearing features described hereinbefore, the "punch on" circuit just described may be expanded to cause automatic conditioning encoding or the clear encoding functions, upon return of the machine to the punches on condition as will now be described.

In the modified form the switch 3259 (FIG. 48) is not grounded as indicated here, but instead a wire 3266 (FIG. 161) is connected between the switch 3259 and the wire 2877. Thus, when the punches are first turned on as described, the circuit just described above continues through the switch 3259, wire 3266, wire 2877, solenoid 2869 and so on for causing conditioning encoding or the clearing feature, depending upon whether the clear-set key 2824 is in the "set" or "clear" position respectively, in the same manner as described previously in connection with such features following line delete for example. Thus, the first code to follow no punch operations will be either the clear code or a conditioning code for enforcing proper coordination of the reproducing machine with the ensuing text codes during further operations.

If a machine is not equipped with the clearing feature, but does include the described conditioning code arrangement, the wire 3266 can be connected with wire 2720 for causing conditioning encoding automatically each time the punches are turned on as described. Similarly, if a machine is not equipped with the conditioning code arrangement but does have the clearing feature the wire 3266 can be connected directly to the wire 2882 for causing the clearing operations automatically each time the punches are turned on as described. In any of these just described modified forms of the invention, the composing machine encodes for proper coordination of the reproducer 2279 upon shift of the punch control key 602 (FIG. 42) to "on" position as described.

Since it may be necessary or desirable to sustain for a slightly longer period of time the just described punch on circuit that runs through the switch 3264 (FIG. 181) and switch 3259 (FIG. 161) for proper performance of the added clearing or conditioning features, a means for retarding the action time of solenoid 3262 (FIG. 181) and therefore retarding the opening of switch 3264 may be employed. Such means will now be described. Since the circuit breaker 3214 is identical to the carriage circuit breaker described, the corresponding identical parts that have not yet specifically been referred to in reference to FIG. 181 will carry the same part number with a suffix "a" as those in FIG. 90 for convenience. A common dashpot 3267 (FIG. 181) or an adjustable resistance dashpot, as desired, is secured to a bracket 3268 which is secured in a well known manner to any convenient stationary frame member. A link 3269 is pivotally connected to the piston rod of the dashpot 3267 and to a member 3270 which is pivoted on the rod 1368. A contractile spring 3271 is connected to member 3270 and to bracket 3268 for restoring the member counterclockwise to where a stud 3272 on the member engages the member 1409*a*. The arrangement is such that, upon energization of the "punch on" circuit, operation of the solenoid 3262 rotates the member 1409*a* clockwise against tension of spring 1410*a*, as previously described. However, the member 1409*a* pushes the stud 3272 and member 3270 clockwise against the tension of spring 2171, and against the tension of link 3269 and the resistance of the dashpot 3267. Since the dashpot 3267 responds relatively slowly the rotations of members 3270 and 1409*a* are retarded and the solenoid 3262 takes longer to shift the stud 1411*a* off of the surface 1412*a*. However, as before described, when the stud 1411*a* is shifted clockwise off of surface 1412*a*, the spring 1414*a* snaps member 1413*a* clockwise for opening the switch 3264 and for breaking the "punch on" circuit therethrough. Thus, the circuit through the switch 3264 etc. is sustained sufficiently to perform all of the described "punch on" conditioning or clearing as described. However, once open, the switch 3264 will stand open until a succeeding no punch circuit operation of solenoid 3213 closes the switch again by operating member 1413a as described. At such time, the stud 1411a is released and member 1409a is snapped counterclockwise by spring 1410a, and thereafter spring 3271 restores the dashpot 3267 and member 3270 counterclockwise to the illustrated position where stud 3272 is stopped against member 1409a.

From the above, it can be seen that a retarding means such as dashpot 3267 can be added to the circuit breakers 1341 (FIG. 90), 1492 (FIG. 93), and 3244 (FIG. 94), for example, to sustain their respective circuits. In fact, such an arrangement may be added to other similar controls, without departing from the spirit of the invention in any previously described instance.

42. PUNCHES-OFF KEY LOCKS AND BACK SPACE PRINT PREVENTING MEANS

When the punch control key 602 (FIG. 3) is shifted to its "no punch" position, the delete key 140 (at the left side of the typewriter keyboard) remains operable and the back space release key 1037 is rendered operable by operation of solenoid 3216 (FIG. 15) and pawl 3223, as previously described.

Operation of the solenoid 3216 and the resulting counterclockwise operation of arm 3222, as previously described, locks the line delete key 1479 (FIG. 3) against operation, as previously mentioned, in a manner that will now be described. The remote end of arm 3222 (FIG. 142) carries a stud 3273 that is embraced by a bifurcated end 3274 of a member 3275. Member 3275 is pivoted on a stud 3276 that is secured on plate 172 (FIG. 141). A stud 3277 (FIG. 142) is secured on the lower end of member 3275 in engaging alignment with a hook portion 3278 on the line delete key 1479, but the stud 3277 is normally disengaged from the hook portion 3278 as shown here. However, when the machine is conditioned for no punch operations and solenoid 3216 (FIG. 15) is operated, the lever 3220, sleeve 3221, arm 3222 and locking pawl 3223 are rotated counterclockwise and they are held in this operated position by detaining member 3231, as previously described. As arm 3222 is thus rotated counterclockwise, its stud 3273 (FIG. 142) rotates member 3275 clockwise for engaging the stud 3277 with the hook portion 3278 and for thereby preventing operation of the line delete key 1479 during no punch operations of the machine. Thus, the line delete key 1479 cannot be depressed and latched down by hold-down pawl 2833 (FIG. 141), when the machine is conditioned for no punch operations and the circuit for operating the key releasing solenoid 2204 is ineffective at such time.

When the punches are again turned on and the solenoid 3237 (FIG. 15) is operated by the punches-on conditioning circuit as described, the solenoid operates detaining member 3231 to release the parts 3220–3223, and the spring 3225 returns these parts clockwise, as described. The clockwise return of arm 3222 (FIG. 142) and its stud 3273 returns the member 3275 counterclockwise to the illustrated position where stud 3277 is disengaged from hook portion 3278 and the line delete key 1479 is again operable as before described.

As described previously, the tape return key 138 (FIG. 14) is normally locked against manual operation by stop lever 3175 and the only time tape return key 138 is operable is following deleting operations when the delete key 140 (FIG. 15) is automatically released and returned, and the interposer 3161 is brought up into the position shown in FIG. 16. In this position of interposer 3161, it holds the release lever 3176 and stop lever 3175 (FIG. 14) in clockwise ineffective position and the tape return key 138 may be depressed as described. However, during no-punch operations, the stop lever 3175 remains in blocking position for preventing operation of tape return key 138, when the delete key 140 (FIG. 15) is returned by manual operation of back space release key 1037 as will now be described.

As described previously, the link 3254 is connected at its upper end on the stud 3253 with a well known type of slip joint that permits the link to be operated without moving the stud 3253 but that the stud 3253 will move the link when the stud 3253 is moved by operation of back space release key 1037. The lower end of link 3254 is pivoted on the upper end of an arm 3279, the lower end of which is secured on the shaft 3160. Thus, during no punch operations of the machine when the back space release key 1037 is operated for releasing the delete key 140 as described, the stud 3253 shifts the link 3254 for rotating arm 3279, shaft 3160, rotating lever 1359 and rotating lever 3158 (FIG. 14) counterclockwise to operated position. At about the time the lever 3159 (FIG. 15) reaches counterclockwise operated position, the pawl 220 is rotated by back space release key 1037 and stud 3230 sufficiently to release stud 222. Whereupon, the delete key 140 is restored, as described. As delete key 140 restores, the stud 3170 on the delete key lever 201 pulls the latch 3163 and the interposer arm 3161 upward with the delete key 140. However, now that rotating lever 3159 is in counterclockwise operated position, the stud 3165 engages the lever 3159 and disengages the latch 3163 from stud 3170 and permits the spring 3167 to restore the interposer 3161 to the normal ineffective position shown here, at about the time the delete key 140 is fully restored. Thus, during no punch operations of the machine and when the delete key 140 is restored by depression of the back space release key 1037, the interposer arm 3161 is not brought up into effective position as shown in FIG. 16, but remains ineffective as shown in FIG. 15, and the release lever 3176 and stop lever 3175 (FIG. 14) remain in normal position where stop lever 3175 prevents operation of the tape return key 138. In this manner, the tape return key 138 is locked against manipulation throughout all no punch operations.

When the operator permits return of the back space release key 1037 (FIG. 15), the key's spring 3229 restores the key 1037 and its stud 3253, and the link 3254, arm 3279 and rotating levers 3159 and 3158 (FIG. 14) are restored clockwise to normal position wherein cam surface 3171 of lever 3158 rests against stud 3172 under tension of spring 3173 (FIG. 15).

When the punches are "on" and the back space release key 1037 is locked against operation as described, operation of the tape return key 138 (FIG. 14) rotates the rotating lever 3158, shaft 3160 and rotation lever 3159 (FIG. 15) counterclockwise, as described, and since the arm 3279 and link 3254 are moved unitarily therewith, the slip joint connection of the link with the stud 3253, as described, is provided to permit such movement while the stud 3253 remains immovable at such times.

When the punch control key 602 (FIG. 3) is shifted to "no punch" position, a slide means 3280 (FIG. 182) is moved to lock the other function keys that are located at the right of the main typewriter keyboard and that are ineffective during succeeding no punch operations. Thus, these keys are locked against undesirable manipulation, and manipulation of these keys is prevented until such time that their movement is again significant, as will now be described.

The slide means 3280 is slidably secured to the under side of the machine's general cover 245 (FIG. 3) by several shouldered rivets 3281, as shown generally in FIGS. 154, 159, 166 and 176. The shanks of rivets 3281 are assembled in slots 3282 (FIG. 182) provided in the slide means 3280. The slots and rivets are situated to allow the slide means 3280 to be shifted rightward from normal illustrated position to operated position. A contractile spring 3283 is connected to a tab 3284 on slide means 3280 and to a stud 3285 that is secured on the cover 245. Spring 3283 urges the slide means 3280 leftward in normal position where a surface 3286 rests against the side of the punch control key 602, when the key 602 is in normal position.

When punch control key 602 (FIG. 3) is manually shifted forwardly to its no punch position, it coacts with a cam surface 3287 (FIG. 182) on slide means 3280 for shifting the slide means rightward and it then moves on to a surface 3288 on slide means 3280 for holding the slide means in operated position without exerting shifting bias on the punch control key 602. In operated position of the slide means 3280, locking projections 3289, 3290 and 3291 on the slide means are shifted into blocking relation with the keys 2487, 2488 and 2824, respectively. The particular projection will thus extend in front or behind the respective key, depending on the instant position of the key. Thus, in operated position of the slide means 3280, the projections will prevent manipulation of their respective keys. If any one of the keys 2487, 2488 or 2824 is inadvertently held between its two positions, such a misplaced key would block the respective projection 3289, 3290 or 3291 and prevent the shifting of slide means 3280 rightward, and the cam surface 3287 would block a forward shift of punch control key 602 to no punch position at such times.

The locking projection 3291 may be eliminated from the slide means, if it is desirable to permit manipulation of the clear-set key 2824 during no punch operations. This may be an advantage in some cases, particularly in machines adapted to perform the clearing or conditioning feature automatically upon return of the punch control key 602 to normal punch on position as described. In this arrangement, the operator can manipulate the clear-set key 2824 to either the clear or set position, before shifting the punch control key 602 to normal punch on position, and then, upon shifting the punch control key 602 to punch on position, the machine will automatically perform the clearing or conditioning encoding as desired and as described. However, if the locking projection 3291 is employed, the clear-set key 2824 is locked against inadvertent manipulation, when the machine is in no punch condition.

In operated position of the slide means 3280, locking portions 3292, 3293, 3294, 3295 and 3296 on the slide means 3281 are shifted under a projection 3297 (FIG. 160 for example) on each of the keys 2707, 2633 (FIG. 182), 3075, 3076 and 2883, respectively, for preventing manipulation of these keys.

When the punch control key 602 is restored to the illustrated normal punches-on position, it is shifted off of surface 3288 and cam surface 3287, and the spring 3283 restores the slide means 3280 leftward to the illustrated position for removing the locking projections and locking portions and thus releasing the respective keys for operation as before described.

A back space print preventing means will now be described. It should be recalled that, during normal punch on deleting operations, the delete key 140 (FIG. 3) is depressed and deleting is accomplished automatically without operation of character and space keys, and imprinting by the type arms 25 is not performed. It should also be remembered that, in order to accomplish no punch back spacing, the delete key 140 is locked down and the character and space keys 16, 760–763 are operated in order to perform the proper differential back spacing operations. It should further be remembered that carriage movement occurs when a character key 16 (FIG. 4) is returned sufficiently to break the circuit through its switch 113, regardless of whether operation of the character key 16 is for forward or back spacing operations. Thus, since imprinting of the character during back spacing is unnecessary and since the imprinting would not be done in precisely the same spot during back spacing as when the character were imprinted during forward typing, the back space print preventing means is provided to prevent the actual imprinting by the type arms 25 during no punch back spacing. This makes the erasing and therefore the correcting much easier.

As previously described, the type arm segment frame 40 is secured on the transverse support member 41 which is secured on the typewriter frame 15. A customary type-arm guide 3298 (FIG. 183–185) is secured on segment frame 40 in the usual manner. A pair of customary card scales 3299 (FIG. 183) are secured on segment frame 40 in a generally usual manner. However, the left hand card scale hinge member 3300 is secured to frame 40 by slightly longer machine screws 3301 which are also assembled through holes therefor in a support spacer 3302 and a guide plate 3303 for securing the base member 3300, support spacer 3302 and guide plate 3302 solidly on frame 40. A print preventing member 3304 is slidably mounted on the support spacer 3302, between the forward plane surface of the hinge base member 3300 and the guide plate 3303. A stud 3305 is secured on guide plate 3303 and it extends rearward only sufficiently to overlie the print preventing member 3304 and to hold it down in the position shown.

The left end of print preventing member 3304 is pivotally connected to a lever 3306 that is secured on the rearward end of a sleeve 3307 (FIG. 185). A lever 3308 is secured on the forward end of sleeve 3307. Sleeve 3307 is pivoted on a rod 3309 that is supported on holes therefor in a pair of bent over tabs 3310 and 3311 formed on plate 172. Lever 3308 extends rightward and its remote end is pivotally connected to a link 3312 (FIG. 183). The lower end of link 3312 is pivotally connected to the delete key lever 201. The arrangement is such that depression of delete key 140 (FIG. 15) rotates its lever 201 clockwise as explained, and this pulls link 3312 downward, rotating the levers 3308 (FIG. 183) and 3306 clockwise, and sliding the print preventing member 3304 rightward. At about the time the delete key 140 (FIG. 15) is fully depressed and latched down, by pawl 220 as described, the print preventing member 3304 (FIG. 183) is shifted rightward to a point where an upwardly directed end portion 3313 is centered, in respect to type arm guide 3298, for blocking full operation of the type arms 25 (FIG. 184). The print preventing member 3304 (FIG. 183) is bent and adjusted about a line 3314 so the rear plane surface of portion 3313 lies flat on a front surface 3315 (FIG. 184) of guide 3298. Resilient material 3316 (FIGS. 183 and 184) is laminated or otherwise secured on the forward surface of portion 3313 for absorbing impact of a surface 3317 (FIG. 184) on an operated type arm 25 when it is moved thereagainst. The type arm 25 is stopped, when its surface 3317 strikes against material 3316, portion 3313 and type-arm guide 3298, in a position just short of contact of the type arm 25 with the platen 90. Thus, imprinting of characters is prevented during back spacing operations.

When the delete key 140 (FIG. 15) is restored as described imprinting is again permitted. Counterclockwise restoration of delete key 140 and its delete key lever 201 shifts link 3312 upward for rotating arms 3308 and 3306 (FIG. 183) counterclockwise, and thereby sliding the print preventing member 3304 leftwardly to normal illustrated position where portion 3313 is left of the center of type-arm guide 3298, and where the type-arms 25 (FIG. 184) may pass to the right of portion 3313 and normal imprinting is performed during forward typing operations of the machine.

Many novel locks and controls for preventing mismanipulation of the machine by an operator and for enforcing particular operations to follow others have been disclosed herein. However, it is understandable that such useful machines may be produced with only some, with all, or with various combinations of the herein disclosed locks and controls. One area where various modifications may be arbitrarily desired involves the back space release key 1037 (FIG. 15), as will now be described.

The back space release key 1037, that is shown in FIG. 15 and that has been previously described herein, works fine in conjunction with all previously described features, and it works fine under all normal conditions. However, if the operator inadvertently depresses the delete key 140 when he has just returned the carriage 80, when there is no codes on the tape 577 for the new line and therefore nothing to be automatically deleted, and when the punch control key 602 (FIG. 42) is in punch "on" position, the solenoid 225 (FIG. 15) would not be operated to releae the delete key 140 due to the then open switch 998 (FIG. 66) as described, and the back space release key 1037 (FIG. 15) would not be operable because of the then effective hold-down pawl 3223 and latch portion 3227 as described. Under the above unnatural condition, the delte key 140 would be locked down and, because its interposer 3157 would be in the general key locks, the keys controlled by the general key locks would not be operable. Several modifications are proposed for making it possible to manually release the delete key 140, if the machine were found in this unnecessary condition, as will now be described.

In the first preferred modification, an obscure delete key release lever 1038 (FIG. 69) is provided. Lever 1038 is located obscurely under the back space release key 1037, so it will not be subject to inadvertent operation during times when the delete key 140 is held depressed by pawl 220 during a normal deleting sequence of operations. In this modified form the back space release key 1037 is pivoted on screw 221, the same as previously described, but it is further comprised only of the latch portion 3227 and a boss surface 3318 on the bottom of the key button. The latch portion 3227 cooperates with the pawl 3223 for preventing operation of the back space release key 1037, when the machine is in the "punches on" condition, the same as previously described. The boss 3318 overlies the lever 1038 so the lever will be operated whenever the back space release key 1037 is depressed. The delete key release lever 1038 is pivoted on screw 221, and the stud 3230, extension 3247, stud 3248, insulator 3250 and stud 3253 are secured together with the lever 1038 instead of being secured as part of the back space release key 1037 as previously described. A torsion spring 3319 is connected to stud 3228 and to extension 3247 for urging the lever 1038 counterclockwise against surface 3318, and for returning key 1037 to normal position where portion 3227 is stopped against stud 3228, all as shown here. When the delete key 140 is depressed and latched down by pawl 220, when there is no codes to be deleted and no deleting functions occur, when the punch control key 602 (FIG. 42) is in "on" position and operation of back space key release key 1037 (FIG. 69) is prevented by the then effective pawl 3223 as described, the operator may insert the end of his finger under the back space delete key 1037 and on the obscure delete key lever 1038, and he can depress the lever 1038 for returning the machine to normal forward operation condition. When he thus rotates the lever 1038 clockwise, stud 3230, stud 3248, insulator 3250 and stud 3253 are rotated clockwise about pivot screw 221 for respectively operating the pawl 220 to release the delete key 140, operating the detent 1229 to release tab 961, closing switch 3251 and thus restoring the carriage moving mechanism 149 to forward operation condition, and pulling the link 3254 to restore the interposer 3161 out of the general key locks, all as described previously. It may be recalled that, upon return of the interposer 3161, the spring 3180 restores the stop lever 3175 (FIG. 14) to effective position for preventing untimely manipulation of the tape return key 138. Thus, the obscure delete key release lever 1038 (FIG. 69) is operable for restoring the machine to normal forward operation condition, whenever the delete key 140 is inappropriately latched down at a time when the punches are operable and when no codes are available to be deleted. When the lever 1038 is operated and then released, the spring 3319 restores the lever counterclockwise to normal position against the surface 3318 of the back space release key 1037.

With the just described modified form of back space release key 1037 and the obscure delete key release lever 1038, the key 1037 is operable to release the delete key 140 following "no punch" back spacing operations. As previously described, the solenoid 3216 is operated for rendering the pawl 3223 ineffective to block latch portion 3227 and for operating lever 3222 to lock the line delete key 1479 (FIG. 142) against operation, when the punch control key 602 (FIG. 43) is shifted to "off" position. Thus, when the punches are off and back spacing operations are concluded as described, the machine may be restored to forward no punch condition by manual operation of the back space release key 1037 (FIG. 69). In this case, operation of back space release key 1037 causes its surface 3318 to rotate lever 1038 clockwise and to restore the machine to forward operation condition as just described. Release of the key 1037 permits the spring 3319 to restore delete release lever 1038 and the lever acting against surface 3318 restores the back space release key 1037 and its latch portion 3227 counterclockwise against rod 3228, whereupon the delete release lever 1038 and the key are stopped in normal position as shown. Thereafter, when the punch control key 602 (FIG. 42) is returned to normal "on" position and the solenoid 3237 (FIG. 69) is automatically operated for restoring the lever 3222 (FIG. 142) to unblock the line delete key 1479 and for restoring the pawl 3223 (FIG. 69), the pawl 3223 is again engaged with latch portion 3227 as shown for preventing operation of the back space release key 1037, while the machine is in the "punches on" condition, as described.

In a second preferred form, the back space release key 1037 (FIG. 68) is constructed like that described in connection with FIG. 15, except that the latch portion 3227 is eliminated and a return stop portion 3320 (FIG. 68) is substituted instead. In this form, the spring 3229 is connected to stud 3228 and to return stop portion 3320 for restoring the back space release key 1037 to normal position where portion 3320 engages the stud 3228 as shown. In this form, a stop lever 3321 is substituted for pawl 3223 (FIG. 69) for merely limiting the position of lever 3222 in normal and operated positions as the stop lever 3321 (FIG. 68) is stopped against the studs 3228 and 3226 respectively. In this form, the solenoid 3216 and 3237 are operated for rotating the lever 3222 counterclockwise and clockwise respectively, and for respectively blocking and allowing operation of the line delete key 1479 (FIG. 142) as described, but the stop lever 3321 (FIG. 68) does not affect the back space release key 1037. Thus, the back space release key 1037 shown in FIG. 68 may be operated at any time, and thus it may be operated for restoring the machine to forward no punch condition as originally described in connection with the key 1037 shown in FIG. 15 and it may also be operated like the obscure delete key release lever 1038 (FIG. 69) for restoring the machine to normal forward condition following inadvertent operation of the delete key 140 as described in connection with the lever 1038. The form of back space release key 1037 that is shown in FIG. 68 is believed to be suitable in most instances, since an operator would not normally depress the delete key 140 (FIG. 69) for a normal sequence of deleting operations and then immediately depress the back space release key 1037 (FIG. 68) before the solenoid 225 were operated automatically to return the delete key 140 in the normal sequence of deleting operations as described.

The back space release key 1037 that is shown and described in connection with FIG. 15 may be utilized to release the delete key 140 in all described instances where the delete key must be manually released, if the interposer 3192 (FIG. 42 and 43) is eliminated from the punch control key 602. The single interposer 3193 may still be retained in this instance. In this case, when the punch control key 602 is in "on" position and the delete key 140 (FIG. 15) were latched down when no automatic deleting can be performed as described, the punch control key 602 (FIG. 43) could be shifted to "off" position, even though the interposer 3157 (FIG. 15) were effective at the time, for automatically causing operation of the solenoid 3216 and for rendering the pawl 3223 ineffective as described. This done, the operator could depress the back space release key 1037 that is shown here for restoring the machine to forward no punch condition as described. He would then return the punch control key 602 (FIG. 42) to "on" position, whereupon the solenoid 3237 (FIG. 15) is operated and pawl 3223 is again engaged with latch portion 3227 for preventing inadvertent operation of back space release key 1037, and the machine would be in the normal forward punch on condition.

43. ELECTRICAL SUPPLY AND CONNECTIONS

All previous references to "power source", "source of power" and (S) on the drawing are to a suitable electrical current supply source that may be connected to the machine by a customary extension cord for example. The extension cord, not shown, may be a customary home utility type, one end of which is plugged into the general power source and the other end is connected to a receptacle 3322 (FIG. 45) which may be secured in a known manner to a plate 3323 that in turn is secured to frame members 1 and 10. A wire 3324 is connected between receptacle 3322 and a customary on-off switch 3325 (FIG. 3) on the keyboard. In preferred form, the wire 2280 (FIG. 143) is connected to the on-off switch 3325 (FIG. 3), as well as being connected to the gravity responsive switch 2281 (FIG. 143) as previously described. Thus, current to the machine is available through on-off switch 3325 (FIG. 3) only when the switch is "on", through wire 2280 (FIG. 143) and gravity responsive switch 2281 only when both switches are on. Since the gravity responsive switch 2281 is closed only when the punch-reader assembly's hinged cover 579 (FIG. 38) is latched down in normal operating position as described, current will flow through switch 2281 only when the hinged cover 579 is closed and when the on-off switch 3325 (FIG. 3) is turned on. A wire 3326 (FIG. 143) is connected with the wire 2282 to the gravity responsive switch 2281, and it is also connected with all other composing machine circuit wires that have been referred to throughout the specification as being connected to a source (S) of power. Thus, the composing machine circuits may be effective as described, through wire 3326 only when the punch assembly cover 579 is in operating position and gravity responsive switch 2281 is closed, and when the on-off switch 3325 (FIG. 3) is turned "on", as described. Likewise, the main reader control of the reproducing machine 2279 (FIG. 143) is effective through wire 2282 as previously described, only when the switches 2281 and 3325 (FIG. 3) are both turned on as described.

A return line 3327 (FIG. 45) is connected to all of the previously described ground wires and to the receptacle 3322 for, therethrough and through the extension cord, completing the circuits to the power source.

A receptacle 3328 and suitable mating plug may be added intermediate the ends of the wires 2216 (FIG. 143), wire 2284 and wire 2303 for providing a more convenient connection of the composing machine with the communication means 2285 or directly with the reproducer 2279, as the case may be. The receptacle 3328 (FIG. 45) may be secured to the plate 3323 in any well known manner.

44. JUSTIFYING AREA SIGNAL

A signal arrangement is provided for indicating to the operator that a line has progressed into the normal end of line signal area, or, as in the instant machine and other justifying composing machines, the area near the end of the line that may be called the justifying area. The preferred signal indicates entry into the justifying area, and thereafter indicates the number of units that are left in the line. When such an arrangement is provided, an operator may type along freely, without concern for the extent of progress, and only upon recognition of the signal will he consider terminating the line, returning the carriage and thus causing justification encoding etc., when the justifying mechanism is effective, as previously decribed. To provide this signalling feature, the following structure is included with that which has already been described.

A member 3329 (FIGS. 186 and 187) is secured on the forward side of the previously described rotary switch blade support lever 1580 for direct rotation of the member with the lever. As previously described, the lever 1580 is rotated clockwise proportionally to the movement of the carriage for indicating the extent of a line that has advanced into the justifying area, and the same can be said of the member 3329. A bifurcated switch blade 3330, having furcations 3331 and 3332 flexed against the forward face of contact support plate 1591 as shown, is secured to the member 3329 and it is insulated from the member 3329 in a well known manner. The furcation 3331 is always engaged with a continuous ring 3333 (FIG. 186) that is secured on plate 1591 as by several rivets 3334. Twenty-four distinct contacts 3335 are secured on plate 1591 in an engaging alignment radius with the remote end of furcation 3332 and in angular positions for being engaged by the furcation 3332 when the lever 1580, member 3329 and the switch blade 3330 are rotated clockwise in the positions corresponding to 0.575"–0" remaining in a line, as indicated in FIG. 188.

There are no contacts 3335 in the 0.700"–0.600" representing positions, since the machine will not enter the justifying area until the line is extended to less than 0.600" from the end of the line as described. There could be contacts in the 0.700"–0.600" positions and there could be corresponding signals to indicate the approach to the justifying area, but this is not preferred since they might be confused with actual justifying area signals. However, when the line has progressed into the justifying area, the furcation 3332 will be engaged with the contact 3335 that is in the 0.575" position or one of the succeeding contacts that corresponds to the precise extent of the line. When the furcation 3332 in on a contact 3335, a significant signal will be presented to the operator, as will now be described.

A wire 3336 is connected to the continuous ring 3333 and to the wire 2280 (FIG. 143) for receiving a source of power (S) through the on-off switch 3325 (FIG. 3) when the switch is "on" as described. The contacts 3335 (FIG. 188) my each be connected to a separate signalling device for indicating the exact number of units left in the entire justifying area of a line. However, for example, to demonstrate that the number of signalling devices may be reduced, th first five contacts 3335 (in the 0.575"–0.475" representing positions) are interconnected in any known manner, and these interconnected contacts are connected by a wire 3337 to a single signalling device (for example, a visible light bulb 3338) for indicating that there are from 19–23 units left in the line and for indicating that the line is extended into the justifying area. Of course, another plurality or other pluralities of contacts may be interconnected and each plurality may be connected to a single bulb for further reduction of the number of signalling devices, and also the number of contacts in a plurality may be more or less than five, without departing from the spirit of the invention. However, it is proposed as illustrated that the remaining contacts 3335, in the 0.450" down to zero (0) representing positions, are individually connected by a wire 3339 to a respective bulb 3340 for indicating precisely the extent of a line from 18–0 units, respectively. A wire 3341 is connected to each of the bulbs 3338 and 3340 and to an audible signalling device 3342, which may be in the form of a bell, buzzer, clicker or other such suitably audible signal means. A wire 3343 is connected to the audible signalling device 3342 and to the return line wire 3327. The audible signalling device 3342 may be any well known type of such a signal, but it is preferably one that makes a pleasant sound when current is introduced or terminated, or both, rather than one that emits a continuous sound while the current passes therethrough. A continuous sound might make an operator nervous, if he permits the machine to stand while he decides how he wants to terminate the line.

The arrangement is such that the visual and audible signals will be given, when the main on-off switch 3325 (FIG. 3) is turned on and when a line has been extended to less than 0.600" from the right margin. When these two conditions exist, and the gear 1577 (FIG. 187) and lever 1580 are positioned to represent the extent of the line, the member 3329 (FIG. 186) and the switch blade 3330 are likewise positioned where the furcation 3332 is on one of the contacts 3335 as described. When the furcation 3332 is on, or passes over, one of the interconnected contacts 3335 (FIG. 188) in the 0.575"–0.475" representing positions, the signal circuit is complete through wire 3336, continuous ring 3333, switch blade 3330, the engaged one of the interconnected contacts, wire 3337, bulb 3338 that visually indicates that there are from 9–23 units left in the line, through wire 3341, the audible signalling device 3342 for sounding the alarm, wire 3343, and the return line wire 3327. From the above, it can be seen that the light bulb 3338 will flash and the audible signalling device 3342 will sound each time the switch blade 3330 passes over the contacts in positions 0.575"–0.475", and when the machine is stopped in one of these positions the bulb 3338 will remain lit and the audible signalling device 3342 will sound and preferably the device will then remain silent. When the machine is in or passes any of the positions from 0.450"–0 from the end of the line, the signalling circuit is similarly effective and the current will pass through switch blade 3330, the distinct position indicating contact 3335, its wire 3339, and the corresponding light bulb 3340 for indicating the precise position of the carriage 80 in respect to the right hand margin and indicating the number of units left in the line at that instant as described. From the above, it can be seen that an alarm is sounded and the progress of a line in the later part thereof is clearly indicated.

As illustrated here, the light bulbs 3338 and 3340 are arranged in unit representing descending order from left to right for graphically indicating the progress of the text toward the right hand margin. However, the light bulbs may be arranged in descending order from right to left for more closely corresponding to the leftward progress of the carriage toward the right margin without departing from the spirit of the invention. In either case, the individual light bulbs should be clearly marked, 0, 1, 2, 3, . . . 17, 18 and 19–23, or marked 23–19, 18, 17, 16 . . . 3, 2, 1 and 0 as shown here, so that a lighted bulb will be easily associated with the number of units remaining in the line.

The bulbs 3338 and 3340 may also be color-coded to significantly delineate among the light bulbs and the respective number of units left in the line. For example, the bulb 3338 that represents the grouped numbers of units 19–23 may be colored blue, and the individual bulbs 3340 that represent the units 18–5 may be green. The light bulb that indicates there are four units remaining in the line may be colored yellow to signify that any character or space will still fit in the line but to further signify that this is the last position in which a 4 unit character will fit. This yellow light would also alert the operator to the facts that a four unit character will completely fill the line, that operation of a 3 or 4 unit key will cause locking of all composing keys, that the three and four unit space keys 762, 763 should not be operated if justifying encoding is effective, that a two unit space key 760, 761 should not be operated unless it will be followed by a two unit character if justifying will be performed (otherwise, in the preferred machine, the carriage 80 will be locked against manual return as described), and that operation of a two unit character or space will cause locking of all composing keys except those that are two units. It should be remembered that deleting of an improperly used space, in the disclosed embodiment, will eliminate the space and permit proper termination of a line, as described. The light bulb that indicates three units in the line may be colored orange, for example, to signify that the four unit keys are locked, that three and two unit characters will still fit and they are still operable, and that no space keys should be operated. The light bulb that indicates two units in the line may be colored red to signify that all but the two unit keys are locked and that spaces should not be added. The one unit and the zero units (0, full line) bulbs 3340 may be white to signify that all composing keys are locked against operation, and that the line is nearly perfectly filled out or it is exactly filled, respectively, as the case may be.

When the carriage 80 is returned, the member 3329 (FIG. 186) and the switch blade 3330 are returned counterclockwise with lever 1580 to the normal 0.700" representing position, where furcation 3332 is not on any contacts, as described.

The bulbs 3338 (FIG. 188) and 3340 are contained in a suitable signal lamp housing 3344 (FIGS. 1, 3 and 58) that is secured on the machine cover 245 in any convenient manner and in a convenient location where a light bulb will be readily noticed by the operator.

The character keys 16 (FIG. 3) may be color coded to correspond with the colors of the several final bulbs 3340 of the signalling device. That is, the visible face upper and lower halves (representing the upper case character and the lower case character, respectively) of each character key 16 may be colored to match the color of the last signal bulb 3340 that indicates the corresponding character will still fit in the line. Thus, at a time for example when the 3 unit (orange "0") bulb 3340 is lit, the operator will know that the 4 unit characters, which have a yellow "Y" key-background to match the example 4 unit representing signal bulb 3340, will not fit in the line and they are locked against operation, but all characters associated with backgrounds that are orange "0" (3units) and that are red "R" (2 units) may still be added. With such an arrangement, the operator may readily determine the keys 16 that are locked and the character keys that may still be used when a line has been extended very near the right hand margin.

What is claimed is:

1. A bidirectional proportional spacing carrier moving mechanism for a carrier of an electric typewriter, comprising:

a ratchet wheel with teeth having a predetermined pitch for determining incremental proportional spacing units;

means coupling said ratchet wheel to said carrier for bidirectional rotation in synchronism with bidirectional linear movement of said carrier;

first force exerting means for urging said carrier in a first direction to cause said ratchet wheel to be urged in a given rotational direction;

detent means normally engaged with said ratchet wheel for preventing rotation thereof in said given direction, to thereby prevent movement of said carier in said first direction;

first control means for momentarily disengaging said detent means from said ratchet wheel to permit rotation of said ratchet wheel in said given direction by said first force exerting means;

an incremental spacing control member having a first end pivotally mounted adjacent said ratchet wheel, and a stop engaging surface remote from said wheel;

a pawl normally engaged with one of said teeth and pivotally mounted on said control member, for preventing rotation of said ratchet wheel in said given direction when said detent means is disengaged therefrom;

a plurality of stop members disposed in mutual alignment adjacent said stop engaging surface, at least two of said stop members being selectively movable in and out of the path of movement of said stop engaging surface, said stop members permitting incremental rotational movement of said stop engaging surface, pawl and ratchet wheel in said given direction and linear movement of said carrier in said first direction, by a distance corresponding to a desired number of proportional spacing increments;

second force exerting means for urging said control member to rotate in a direction to move said stop engaging surface away from said stop members and to cause said pawl to rotate said ratchet wheel in a direction opposite to said given direction, to drive said carrier for linear movement in a second direction opposite to said first direction; and releasable means for momentarily rotating said control member against the force exerted by said second force exerting means to move said pawl a distance corresponding to a desired number of second direction spacing increments, until said stop engaging surface engages one of said stop members, said second force exerting means acting upon release of said control member by said releasable means to move said carrier in said second direction by said desired number of second direction spacing increments.

2. The carrier moving mechanism according to claim 1, wherein said stop members include at least one stationary stop more remote from said stop engaging surface than the other ones of said stop members.

3. The carrier moving mechanism according to claim 1 or 2, further comprising upper case and lower case switch means for defining the case of a character to be traversed by said carriage, and second control means coupled to said switch means for selectively moving said stop members in accordance with said character case.

4. A bidirectional proportional spacing carrier moving mechanism for a carrier of an electric typewriter, comprising:

rotatable ratchet means;

means coupling said ratchet means to said carrier for bidirectional rotation in synchronism with bidirectional linear movement of said carrier;

first force exerting means for urging said carrier in a first direction to cause said ratchet means to be urged in a given rotational direction;

detent means normally engaged with said ratchet means for preventing rotation thereof in said given direction, to thereby prevent movement of said carrier in said first direction;

first control means for momentarily disengaging said detent means from said ratchet means to permit rotation of said ratchet means in said given direction by said first force exerting means;

a movable incremental spacing control member having a stop engaging surface;

means coupled between said control member and said ratchet means, for preventing rotation of said ratchet means in said given direction when said detent means is disengaged therefrom;

adjustable stop member means disposed adjacent said stop engaging surface;

said stop member means permitting incremental movement of said stop engaging surface and incremental rotational movement of said ratchet means in said given direction and linear movement of said carrier in said first direction, by a distance corresponding to a desired number of proportional spacing increments;

second force exerting means for urging said control member away from said stop member means to cause said ratchet means to rotate in a direction opposite to said given direction, to drive said carrier for linear movement in a second direction opposite to said first direction; and releasable means for momentarily rotating said control member against the force exerted by said second force exerting means to move said stop engaging surface into engagement with said stop member means, said second force exerting means acting upon release of said control member by said releasable means to move said carrier in said second direction by said desired number of second direction spacing increments.

* * * * *